US011486275B2

(12) United States Patent
Looney

(10) Patent No.: US 11,486,275 B2
(45) Date of Patent: Nov. 1, 2022

(54) INTERNAL COMBUSTION ENGINE VALVE SYSTEM AND METHOD

(71) Applicant: LSE R&D ENGINEERING LIMITED, Kowloon (HK)

(72) Inventor: Allen Eugene Looney, Kowloon (HK)

( * ) Notice: Subject to any disclaimer, the term of this patent is extended or adjusted under 35 U.S.C. 154(b) by 0 days.

(21) Appl. No.: 17/572,264

(22) Filed: Jan. 10, 2022

(65) Prior Publication Data

US 2022/0127977 A1 Apr. 28, 2022

Related U.S. Application Data

(63) Continuation-in-part of application No. 17/028,028, filed on Sep. 22, 2020, and a continuation-in-part of (Continued)

(51) Int. Cl.
*F01L 1/26* (2006.01)
*F01L 5/04* (2006.01)

(52) U.S. Cl.
CPC ..... *F01L 1/267* (2013.01); *F01L 5/04* (2013.01); *F01L 2820/034* (2013.01)

(58) Field of Classification Search
CPC ..... F01L 1/00; F01L 1/02; F01L 1/12; F01L 1/26; F01L 1/267; F01L 5/04; F01L 5/06; (Continued)

(56) References Cited

U.S. PATENT DOCUMENTS 1,766,101 A 6/1930 Bowen
3,522,797 A 8/1970 Stinebaugh
(Continued)

FOREIGN PATENT DOCUMENTS

DE 19931129 A1 1/2000
GB 2465188 A 5/2010

OTHER PUBLICATIONS

R. Shriram et al., Design and Development of Camless Valve Train for I.C. Engines, Article, International Review of Mechanical Engineering vol. 6, N. 5, 6 pages, © 2012, Praise Worthy Prize.
(Continued)

*Primary Examiner* — Grant Moubry
(74) *Attorney, Agent, or Firm* — Kevin Mark Klughart

(57) ABSTRACT

A valve system/method suitable for an internal combustion engine (ICE), compressor pump, vacuum pump, and/or reciprocating mechanical device is disclosed. The system/method is optimized for construction of a two-stroke ICE. The rudimentary system incorporates an intake engine block cover (IEC) and exhaust engine block cover (EEC) that enclose an intake rotary valve disc (IVD) and exhaust rotary valve disc (EVD) that control intake/exhaust flow through a respective intake rotary valve port (IVP) and an exhaust rotary valve port (EVP) into and out of a combustion cylinder that provides power to a piston and crankshaft. An intake multi-staged valve (IMV) and exhaust multi-staged valve (EMV) provide intake and exhaust flow control for the IVD/IVP and EVD/EVP. An enhanced system may include a variety of intake/exhaust port seals (IPS/EPS), forced induction/discharge (FIN), centrifugal advance (CAD), and/or cooling channel spool (ICS/ECS).

23 Claims, 256 Drawing Sheets

Related U.S. Application Data application No. 16/509,156, filed on Jul. 11, 2019, now Pat. No. 11,220,934, said application No. 17/028,028 is a continuation-in-part of application No. 16/509,156, filed on Jul. 11, 2019, now Pat. No. 11,220,934.

(60) Provisional application No. 62/697,183, filed on Jul. 12, 2018.

(58) Field of Classification Search
CPC ..... F01L 7/00; F01L 7/02; F01L 7/026; F01L 7/04; F01L 7/06; F01L 7/028; F01L 7/029; F01L 7/14; F01L 7/18; F01L 2820/034; F01L 2301/02; F02F 7/0043; F02F 7/00; F02F 1/22
See application file for complete search history.

(56) References Cited

U.S. PATENT DOCUMENTS

| | | | | |
|---|---|---|---|---|
| 4,163,438 | A | 8/1979 | Guenther et al. | |
| 4,373,476 | A | 2/1983 | Vervoordt et al. | |
| 4,494,500 | A | 1/1985 | Hansen | |
| 4,879,979 | A | 11/1989 | Triguero | |
| 5,535,715 | A | 7/1996 | Mouton | |
| 5,890,462 | A * | 4/1999 | Bassett | F02B 75/26 123/56.7 |
| 5,967,108 | A | 10/1999 | Kutlucinar | |
| 5,988,133 | A | 11/1999 | Agapiades et al. | |
| 6,390,048 | B1 | 5/2002 | Luchansky | |
| 6,467,455 | B1 | 10/2002 | Posh | |
| 6,578,538 | B2 | 6/2003 | Trantham | |
| 6,591,794 | B2 | 7/2003 | Toda | |
| 7,140,342 | B1 | 11/2006 | Murray | |
| 7,421,995 | B2 | 9/2008 | Zajac et al. | |
| 7,685,986 | B2 | 3/2010 | Agapiades | |
| 9,194,264 | B2 | 11/2015 | Khajepour et al. | |
| 2013/0327291 | A1 * | 12/2013 | Pett, Jr. | F02B 19/00 123/253 |
| 2015/0233270 | A1 * | 8/2015 | Pattakos | F01L 7/06 123/190.14 |

OTHER PUBLICATIONS

Wikipedia webpages, Two-Stroke (or two-cycle) Engine, 15 pages n.m.wikipedia.org/wiki/Two-stroke_engine, Jun. 17, 2019.

Subhash Chandar et al., "Design of a Camless Rotating Cylinder Engine," 3 pages, Abstract, International Journal of Emerging Technology, Jan. 2010.

PCT/US2019/041534 International Search Report and Written Opinion, dated Oct. 1, 2019, 13 pages.

* cited by examiner 1700
1749

1741

1708
1745
1747
1748
1780
1740

1780
1762
1768
1765
1761

1770
1777
1769
1761
1771
1778
1775

1779
1709

4000

5100

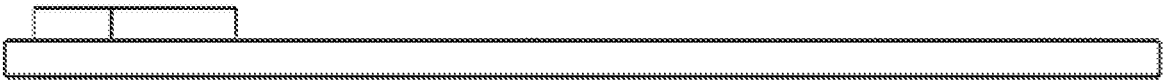
FIG. 75
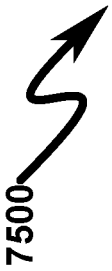
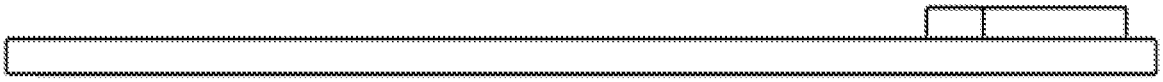

9300

10900

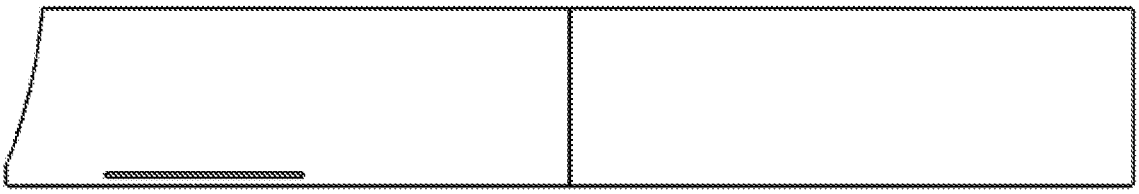
FIG. 129
12900
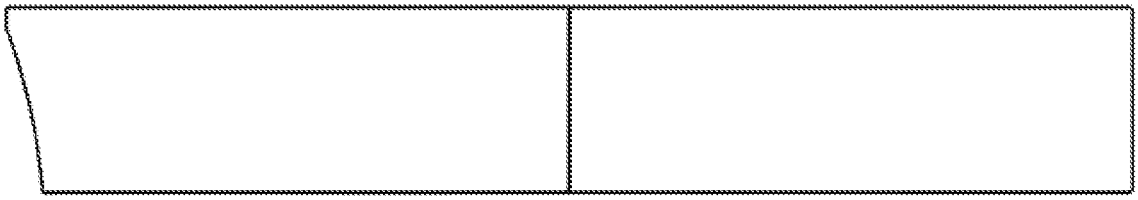

17000

19000

20100

20272

20200

20300

20400

20500

20700

22000

22500

22900

INTERNAL COMBUSTION ENGINE VALVE SYSTEM AND METHOD

CROSS REFERENCE TO RELATED APPLICATIONS

Continuation-In-Part

This patent application is a Continuation-In-Part (CIP) patent application of and includes by reference parent United States Utility Patent Application for APPARATUS AND METHOD FOR VALVE TIMING IN AN INTERNAL COMBUSTION ENGINE by inventor Allen Eugene Looney, filed with the USPTO on 2020 Sep. 22, with Ser. No. 17/028,028, EFS ID 40627326, confirmation number 4029.

This patent application is a Continuation-In-Part (CIP) patent application of and includes by reference parent United States Utility Patent Application for INTAKE AND EXHAUST VALVE SYSTEM FOR AN INTERNAL COMBUSTION ENGINE by inventor Allen Eugene Looney, filed with the USPTO on 2019 Jul. 11, with Ser. No. 16/509,156, EFS ID 36560751, confirmation number 1060, issued as U.S. Pat. No. 11,220,934 on 2022 Jan. 11.

U.S. Patent Applications

United States Utility Patent Application for APPARATUS AND METHOD FOR VALVE TIMING IN AN INTERNAL COMBUSTION ENGINE by inventor Allen Eugene Looney, filed with the USPTO on 2020 Sep. 22, with Ser. No. 17/028,028, EFS ID 40627326, confirmation number 4029, is a Continuation-In-Part (CIP) patent application and incorporates by reference United States Utility Patent Application for INTAKE AND EXHAUST VALVE SYSTEM FOR AN INTERNAL COMBUSTION ENGINE by inventor Allen Eugene Looney, filed with the USPTO on 2019 Jul. 11, with Ser. No. 16/509,156, EFS ID 36560751, confirmation number 1060, issued as U.S. Pat. No. 11,220,934 on 2022 Jan. 11.

Provisional Patent Applications

United States Utility Patent Application for INTAKE AND EXHAUST VALVE SYSTEM FOR AN INTERNAL COMBUSTION ENGINE by inventor Allen Eugene Looney, filed with the USPTO on 2019 Jul. 11, with Ser. No. 16/509,156, EFS ID 36560751, confirmation number 1060, issued as U.S. Pat. No. 11,220,934 on 2022 Jan. 11, claims benefit under 35 U.S.C. § 119 and incorporates by reference. United States Provisional Patent Application for VALVE SYSTEM FOR AN INTERNAL COMBUSTION ENGINE by inventor Allen Eugene Looney, filed electronically with the USPTO on 2018 Jul. 12, with Ser. No. 62/697,183, EFS ID 33164853, confirmation number 3188.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention relates to a valve system and method that may be utilized in a variety of mechanical devices. Specifically, and without limitation, the present invention relates to a valve system and method that may be utilized in an internal combustion engine (ICE), compressor pump, vacuum pump, and/or reciprocating mechanical device. Without limitation, the present invention is particularly suited to construction of a two-stroke internal combustion engine.

BACKGROUND AND PRIOR ART

The closest related art is found in U.S. Pat. No. 6,467,455 issued on Oct. 22, 2002 for FOUR-STROKE INTERNAL COMBUSTION ENGINE to Raymond C. Posh. Citations herein to "POSH" are in reference to this patent.

BRIEF SUMMARY OF THE INVENTION

The present invention pertains to a system and method wherein one or more rotary valve discs (RVD) are used to control the combustion cycle of an internal combustion engine (ICE), compressor pump, vacuum pump, and/or reciprocating mechanical device. The present invention is best described in terms of a rudimentary embodiment and an enhanced embodiment. The rudimentary embodiment incorporates the basic engine construction while the enhance embodiment incorporates advanced features that may or may not be individually or corporately incorporated into the overall system design. While a variety of application contexts for the present invention are possible the overall the system is generally optimized for construction of a two-stroke ICE.

With respect to the rudimentary invention embodiment, the system incorporates an intake engine block cover (IEC) and exhaust engine block cover (EEC) that enclose an intake rotary valve disc (IVD) and exhaust rotary valve disc (EVD) that control intake/exhaust flow through a respective intake rotary valve port (IVP) and an exhaust rotary valve port (EVP) into and out of a combustion cylinder that provides power to a piston and crankshaft. An intake multi-staged valve (IMV) and exhaust multi-staged valve (EMV) provide intake and exhaust flow control for the IVD/IVP and EVD/EVP.

With respect to the enhanced invention embodiment, the rudimentary system may be augmented to include a variety of intake/exhaust port seals (IPS/EPS), forced induction (FIN), centrifugal advance (CAD), crankcase oil reservoir, and/or cooling channel spool (CAP) capabilities.

BRIEF DESCRIPTION OF THE DRAWINGS

For a fuller understanding of the advantages provided by the invention, reference should be made to the following detailed description together with the accompanying drawings wherein:

FIG. 75 illustrates top and bottom views of a preferred exemplary invention intake rotary valve disc (IVD) system embodiment;

FIG. 119 illustrates bottom left rear and bottom left front perspective detail views of a preferred exemplary invention exhaust rotary valve disc (EVD) system embodiment;

FIG. 120 illustrates various perspective section detail views of a preferred exemplary invention exhaust rotary valve disc (EVD) system embodiment;

FIG. 121 illustrates front and rear views of a preferred exemplary invention intake multi-staged valve (IMV) and exhaust multi-staged valve (MSV) system embodiment;

FIG. 122 illustrates left side and right side views of a preferred exemplary invention intake multi-staged valve (IMV) and exhaust multi-staged valve (MSV) system embodiment;

FIG. 123 illustrates top and bottom views of a preferred exemplary invention intake multi-staged valve (IMV) and exhaust multi-staged valve (MSV) system embodiment;

FIG. 124 illustrates various perspective views of a preferred exemplary invention intake multi-staged valve (IMV) and exhaust multi-staged valve (MSV) system embodiment;

FIG. 125 illustrates front and rear internal construction views of a preferred exemplary invention intake multi-staged valve (IMV) and exhaust multi-staged valve (MSV) system embodiment;

FIG. 126 illustrates left and right internal construction views of a preferred exemplary invention intake multi-staged valve (IMV) and exhaust multi-staged valve (MSV) system embodiment;

FIG. 127 illustrates top and bottom internal construction views of a preferred exemplary invention intake multi-staged valve (IMV) and exhaust multi-staged valve (MSV) system embodiment;

FIG. 128 illustrates various internal construction perspective views of a preferred exemplary invention intake multi-staged valve (IMV) and exhaust multi-staged valve (MSV) system embodiment;

FIG. 129 illustrates front and rear views of a preferred exemplary invention exhaust upper engine block head (EUH) and exhaust lower engine block crankcase (ELC) system embodiment;

FIG. 130 illustrates left side and right side views of a preferred exemplary invention exhaust upper engine block head (EUH) and exhaust lower engine block crankcase (ELC) system embodiment;

Figures 17, 65, 66, 67, 68, 69, 70, 71, 72, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 129, 130, 131, 132, 133, 134, 135, 136, 161, 162, 177, 178, 179, 180, 181, 182, 183, 184:
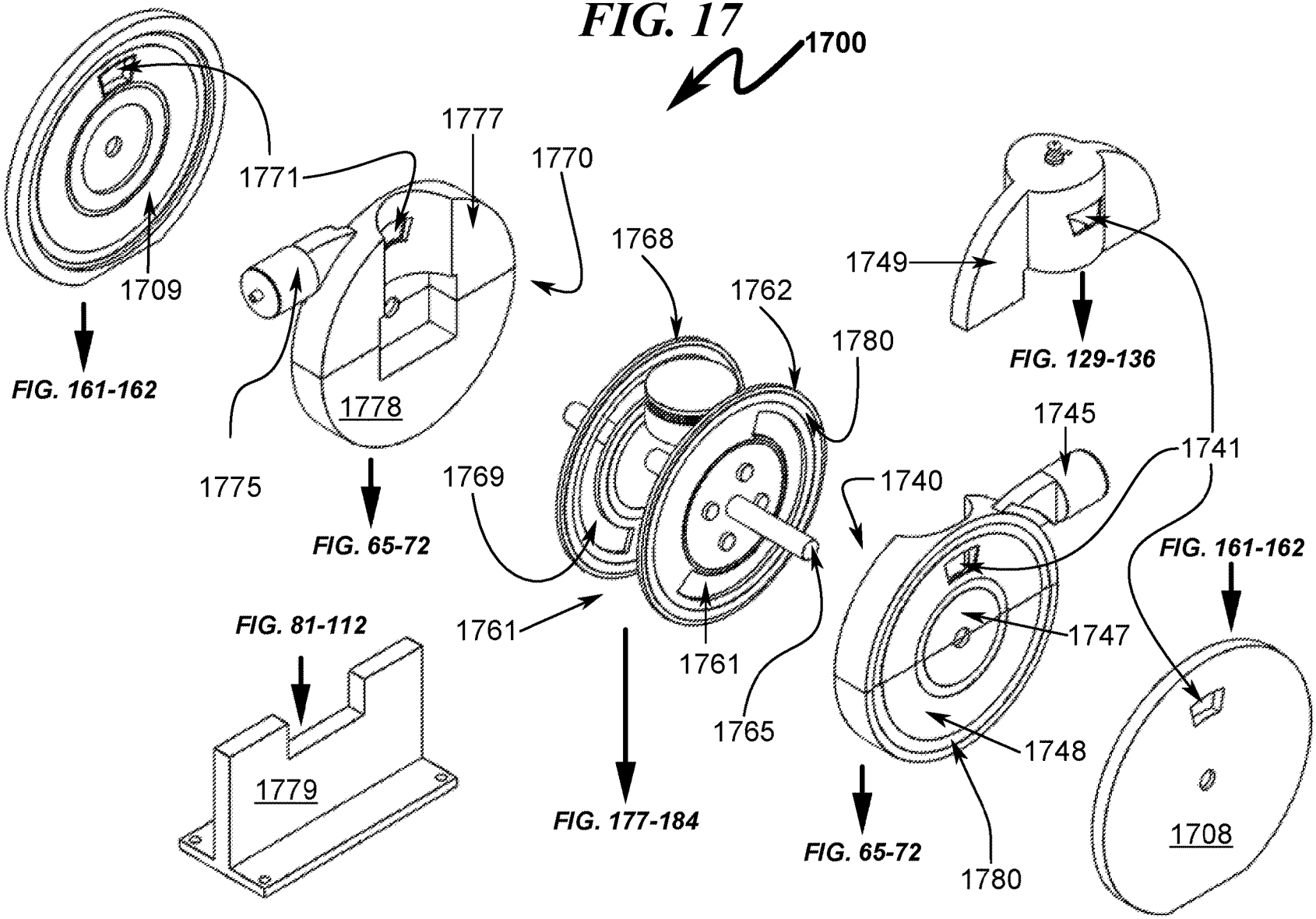
FIG. 17 illustrates a top right front perspective exploded view of a preferred exemplary rudimentary invention system embodiment.
FIG. 65 illustrates front and rear views of a preferred exemplary invention intake upper engine block head (IUH) and intake lower engine block crankcase (ILC) system embodiment.
FIG. 66 illustrates left side and right side views of a preferred exemplary invention intake upper engine block head (IUH) and intake lower engine block crankcase (ILC) system embodiment.
FIG. 67 illustrates top and bottom views of a preferred exemplary invention intake upper engine block head (IUH) and intake lower engine block crankcase (ILC) system embodiment.
FIG. 68 illustrates top right front and top right rear perspective detail views of a preferred exemplary invention intake upper engine block head (IUH) and intake lower engine block crankcase (ILC) system embodiment.
FIG. 69 illustrates top left rear and top left front perspective detail views of a preferred exemplary invention intake upper engine block head (IUH) and intake lower engine block crankcase (ILC) system embodiment.
FIG. 70 illustrates bottom right front and bottom right rear perspective detail views of a preferred exemplary invention intake upper engine block head (IUH) and intake lower engine block crankcase (ILC) system embodiment.
FIG. 71 illustrates bottom left rear and bottom left front perspective detail views of a preferred exemplary invention intake upper engine block head (IUH) and intake lower engine block crankcase (ILC) system embodiment.
FIG. 72 illustrates various perspective section detail views of a preferred exemplary invention intake upper engine block head (IUH) and intake lower engine block crankcase (ILC) system embodiment.
FIG. 81 illustrates front and rear views of a preferred exemplary invention upper engine block center section (UBS) and lower engine block center section (LBS) system embodiment.
FIG. 82 illustrates left side and right side views of a preferred exemplary invention upper engine block center section (UBS) and lower engine block center section (LBS) system embodiment.
FIG. 83 illustrates top and bottom views of a preferred exemplary invention upper engine block center section (UBS) and lower engine block center section (LBS) system embodiment.
FIG. 84 illustrates top right front and top right rear perspective detail views of a preferred exemplary invention upper engine block center section (UBS) and lower engine block center section (LBS) system embodiment.
FIG. 85 illustrates top left rear and top left front perspective detail views of a preferred exemplary invention upper engine block center section (UBS) and lower engine block center section (LBS) system embodiment.
FIG. 86 illustrates bottom right front and bottom right rear perspective detail views of a preferred exemplary invention upper engine block center section (UBS) and lower engine block center section (LBS) system embodiment.
FIG. 87 illustrates bottom left rear and bottom left front perspective detail views of a preferred exemplary invention upper engine block center section (UBS) and lower engine block center section (LBS) system embodiment.
FIG. 88 illustrates various perspective section detail views of a preferred exemplary invention upper engine block center section (UBS) and lower engine block center section (LBS) system embodiment.
FIG. 89 illustrates a front view of a preferred exemplary enhanced invention system embodiment (with housings and engine block hidden)
FIG. 90 illustrates a rear view of a preferred exemplary enhanced invention system embodiment (with housings and engine block hidden)
FIG. 91 illustrates a left side view of a preferred exemplary enhanced invention system embodiment (with housings and engine block hidden)
FIG. 92 illustrates a right side view of a preferred exemplary enhanced invention system embodiment (with housings and engine block hidden)
FIG. 93 illustrates a top view of a preferred exemplary enhanced invention system embodiment (with housings and engine block hidden)
FIG. 94 illustrates a bottom view of a preferred exemplary enhanced invention system embodiment (with housings and engine block hidden)
FIG. 95 illustrates a front view of a preferred exemplary enhanced invention system embodiment (with housings and engine block hidden)
FIG. 96 illustrates a rear view of a preferred exemplary enhanced invention system embodiment (with housings and engine block hidden)
FIG. 97 illustrates a top right front perspective view of a preferred exemplary enhanced invention system embodiment (with housings and engine block hidden)
FIG. 98 illustrates a top right rear perspective view of a preferred exemplary enhanced invention system embodiment (with housings and engine block hidden)
FIG. 99 illustrates a top left rear perspective view of a preferred exemplary enhanced invention system embodiment (with housings and engine block hidden)
FIG. 100 illustrates a top left front perspective view of a preferred exemplary rudimentary invention system embodiment (with housings and engine block hidden)
FIG. 101 illustrates a bottom right front perspective view of a preferred exemplary enhanced invention system embodiment (with housings and engine block hidden)
FIG. 102 illustrates a bottom right rear perspective view of a preferred exemplary enhanced invention system embodiment (with housings and engine block hidden)
FIG. 103 illustrates a bottom left rear perspective view of a preferred exemplary enhanced invention system embodiment (with housings and engine block hidden)
FIG. 104 illustrates a bottom left front perspective view of a preferred exemplary enhanced invention system embodiment (with housings and engine block hidden)
FIG. 105 illustrates front and rear detail views of a preferred exemplary enhanced invention system embodiment (with housings and engine block hidden)
FIG. 106 illustrates a left side detail view of a preferred exemplary enhanced invention system embodiment (with housings and engine block hidden)
FIG. 107 illustrates a right side detail view of a preferred exemplary enhanced invention system embodiment (with housings and engine block hidden)
FIG. 108 illustrates top and bottom detail views of a preferred exemplary enhanced invention system embodiment (with housings and engine block hidden)
FIG. 109 illustrates a front detail view of a preferred exemplary enhanced invention system embodiment (with housings, engine block, and combustion cylinder hidden)
FIG. 110 illustrates top and bottom detail views of a preferred exemplary enhanced invention system embodiment (with housings, engine block, and combustion cylinder hidden)
FIG. 111 illustrates a top right front perspective view of a preferred exemplary enhanced invention system embodiment (with housings, engine block, and combustion cylinder hidden)
FIG. 112 illustrates a bottom right front perspective view of a preferred exemplary enhanced invention system embodiment (with housings, engine block, and combustion cylinder hidden)
Figure 18:
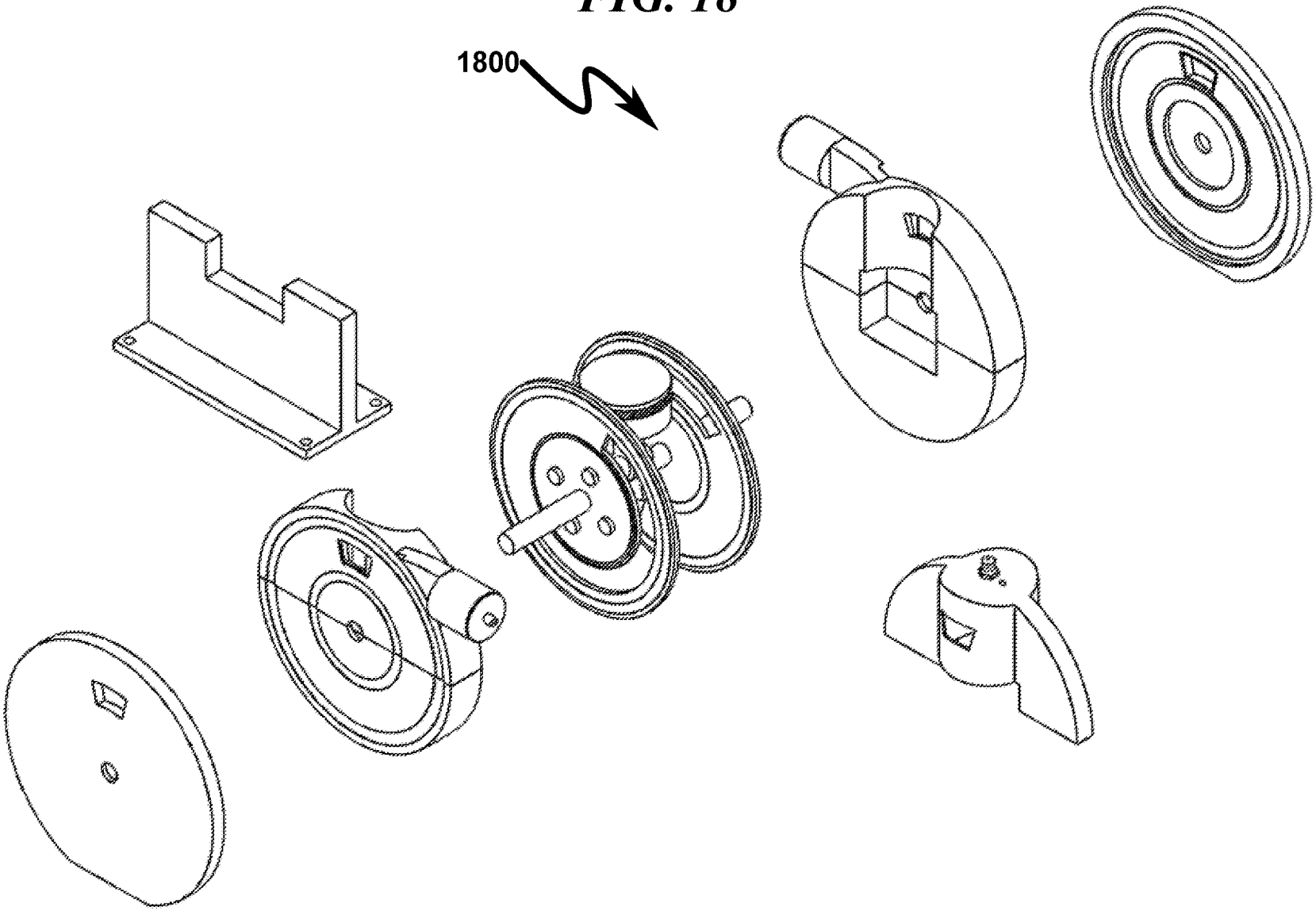
FIG. 18 illustrates a top right rear perspective exploded view of a preferred exemplary rudimentary invention system embodiment.
Figure 19:
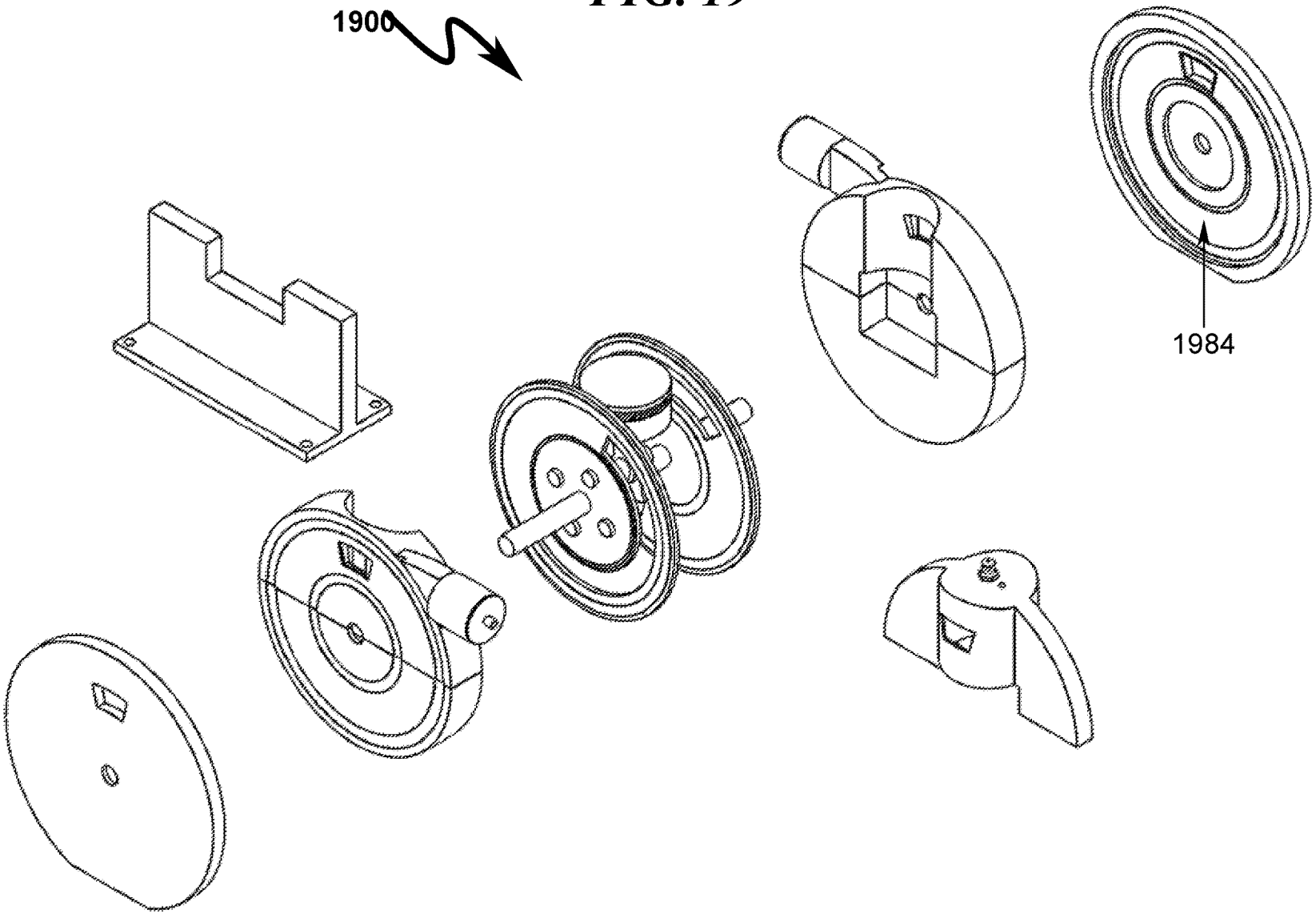
FIG. 19 illustrates a top left rear perspective view exploded of a preferred exemplary rudimentary invention system embodiment.
Figure 20:
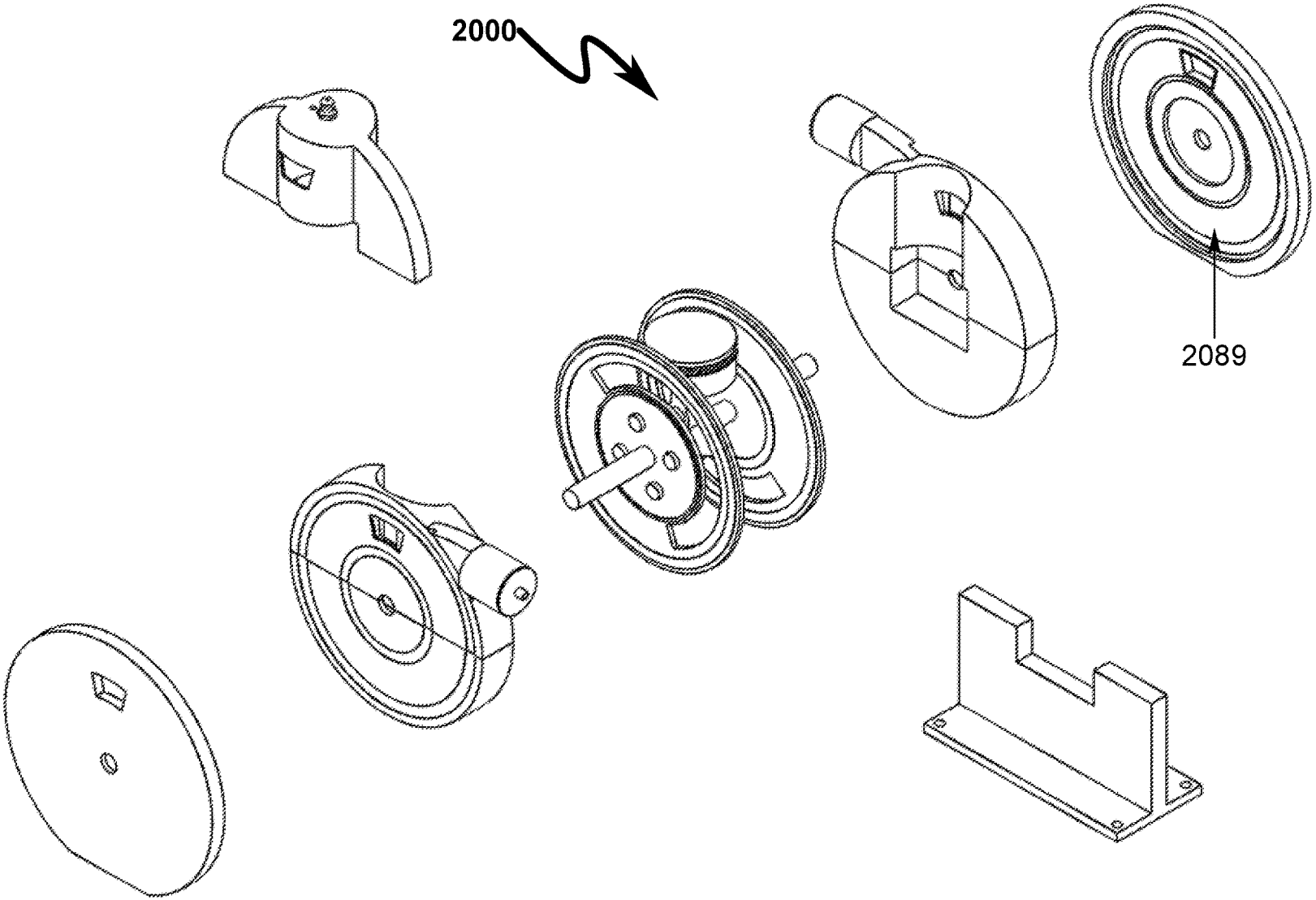
FIG. 20 illustrates a top left front perspective exploded view of a preferred exemplary rudimentary invention system embodiment.
Figure 21:
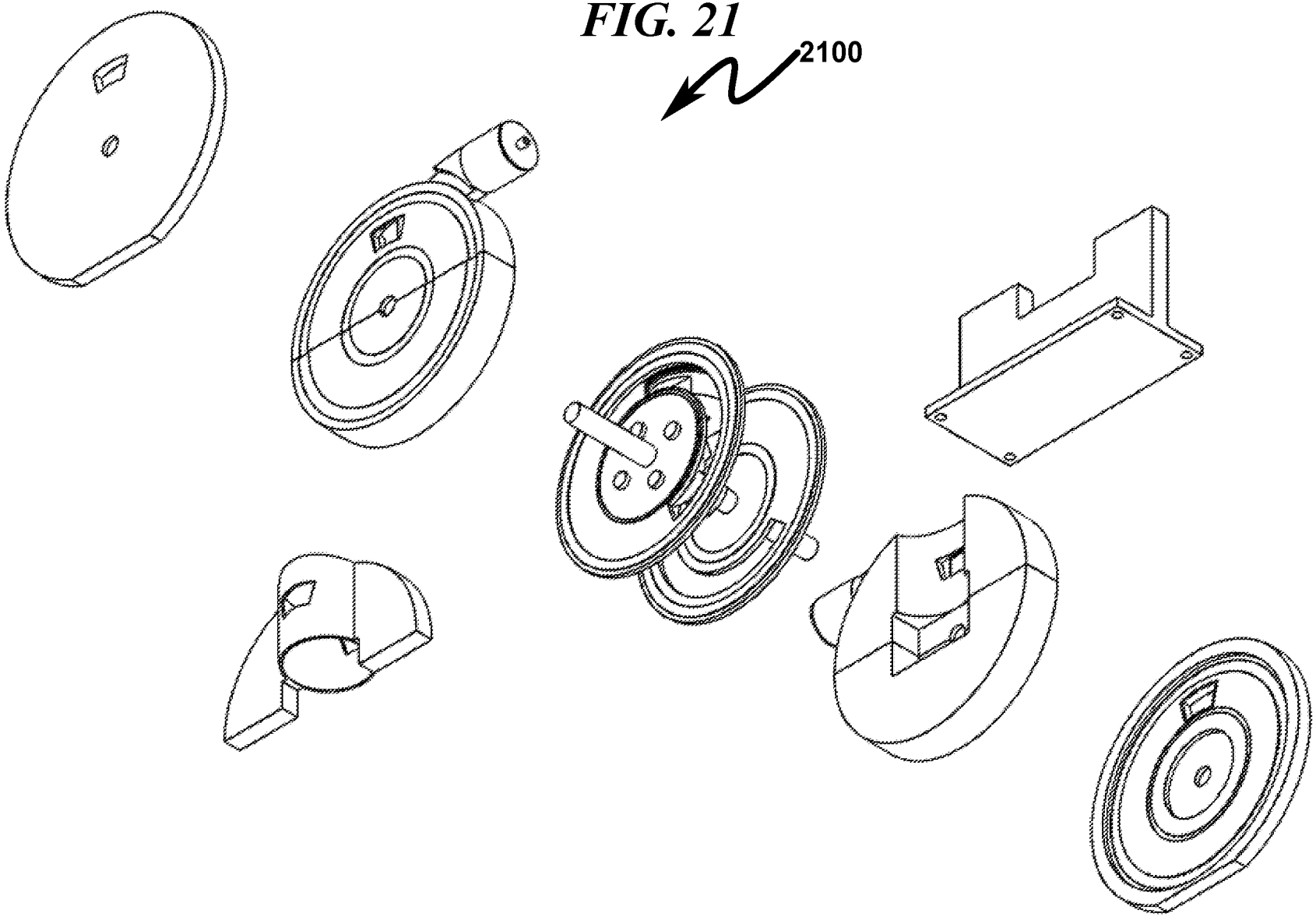
FIG. 21 illustrates a bottom right front perspective exploded view of a preferred exemplary rudimentary invention system embodiment.
Figure 22:
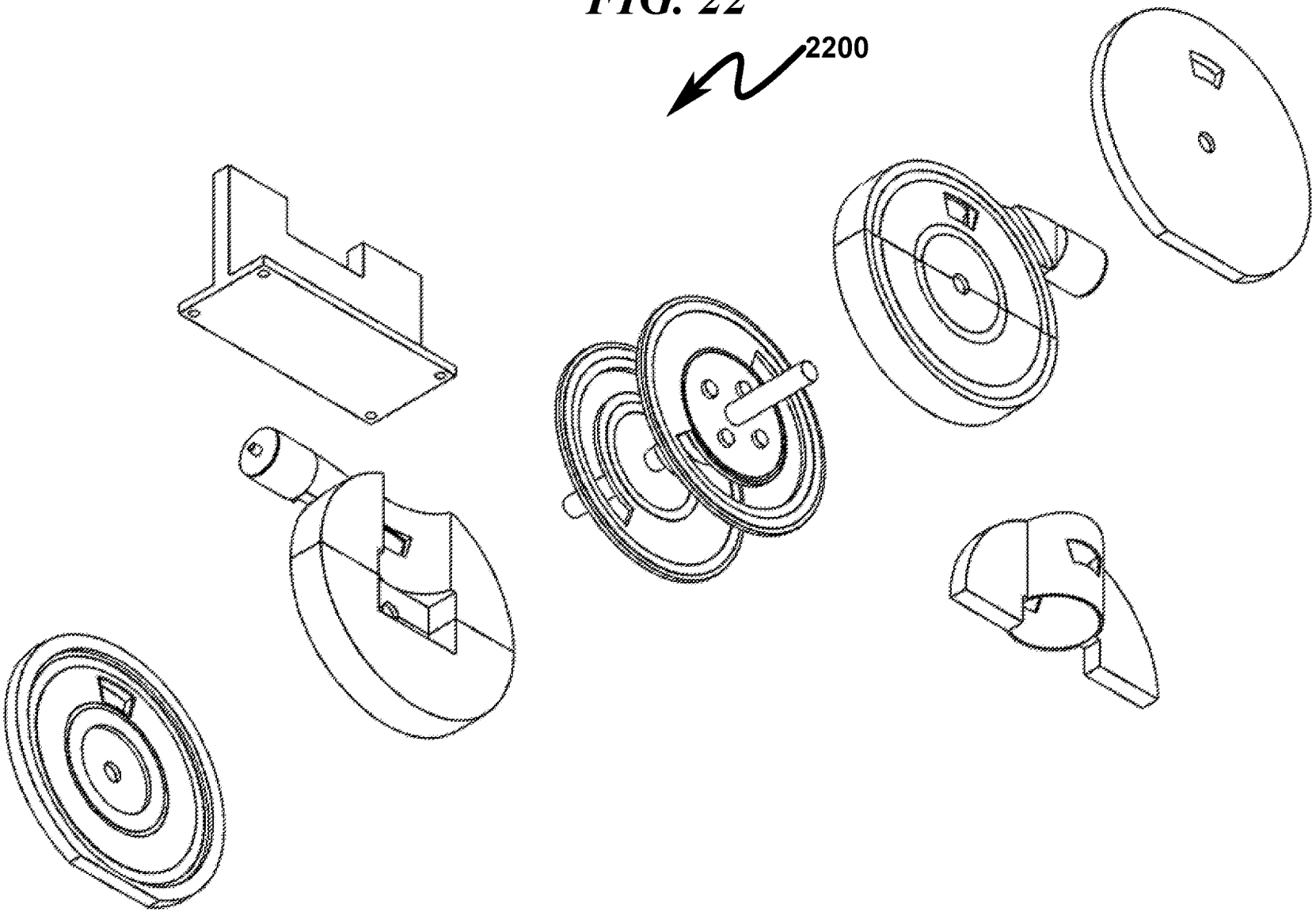
FIG. 22 illustrates a bottom right rear perspective exploded view of a preferred exemplary rudimentary invention system embodiment.
Figure 23:
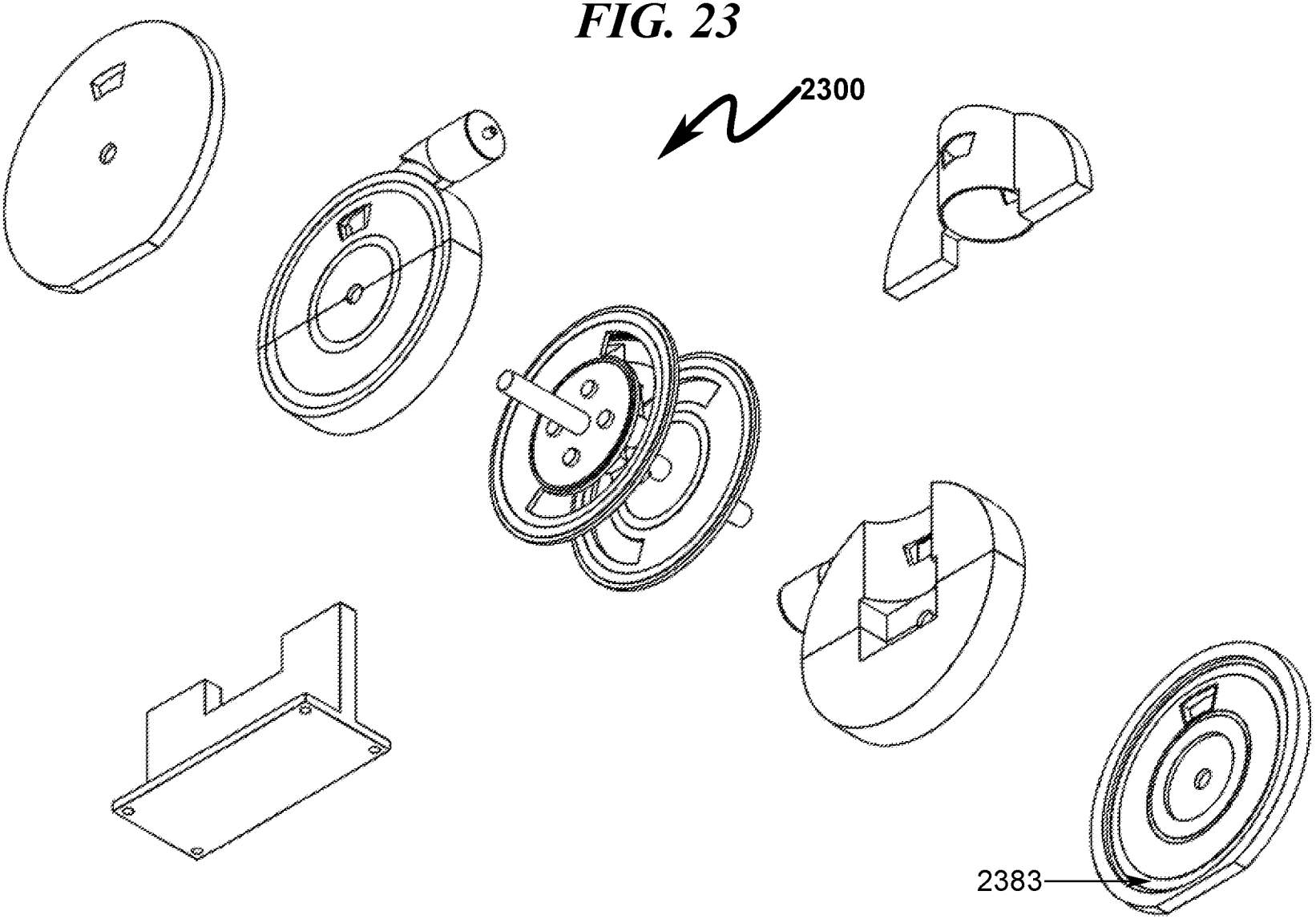
FIG. 23 illustrates a bottom left rear perspective exploded view of a preferred exemplary rudimentary invention system embodiment.
Figure 24:
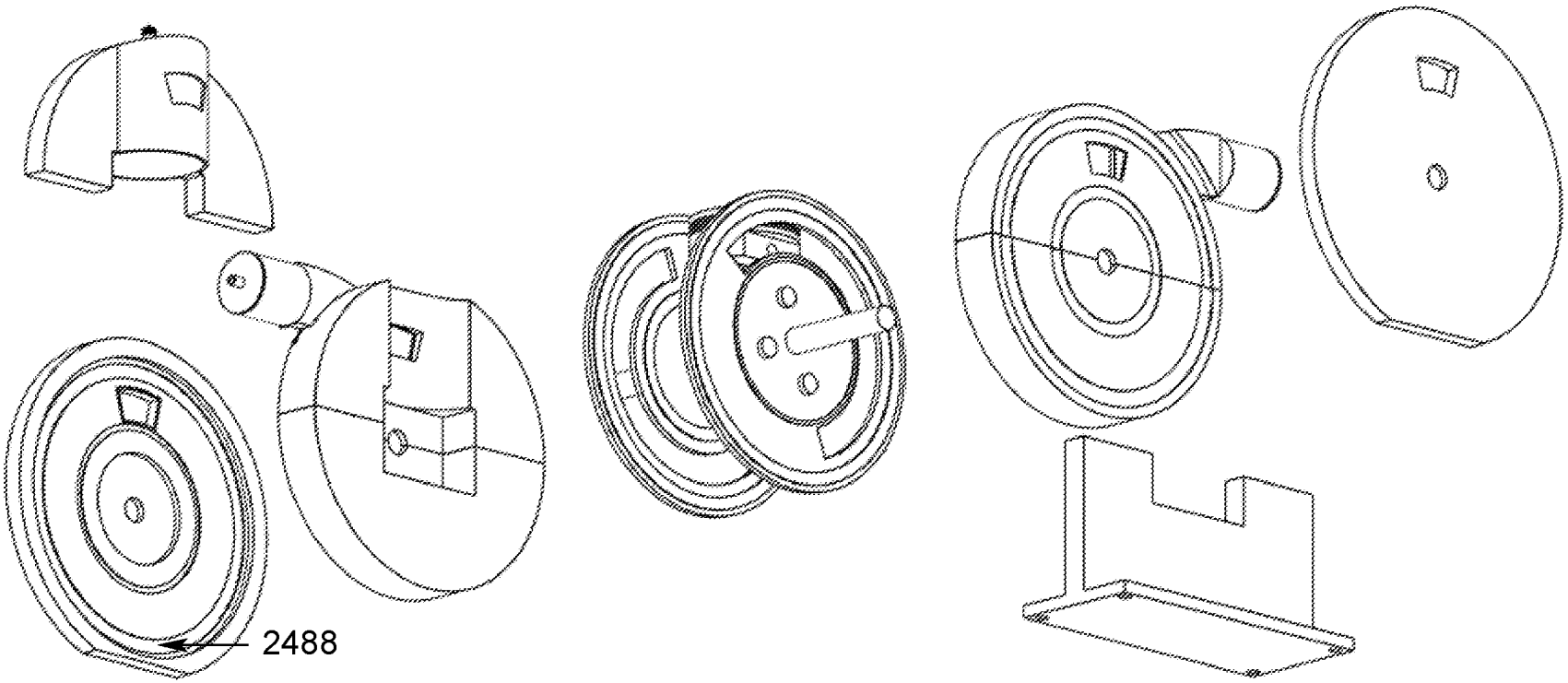
FIG. 24 illustrates a bottom left front perspective exploded view of a preferred exemplary rudimentary invention system embodiment.
Figure 25:
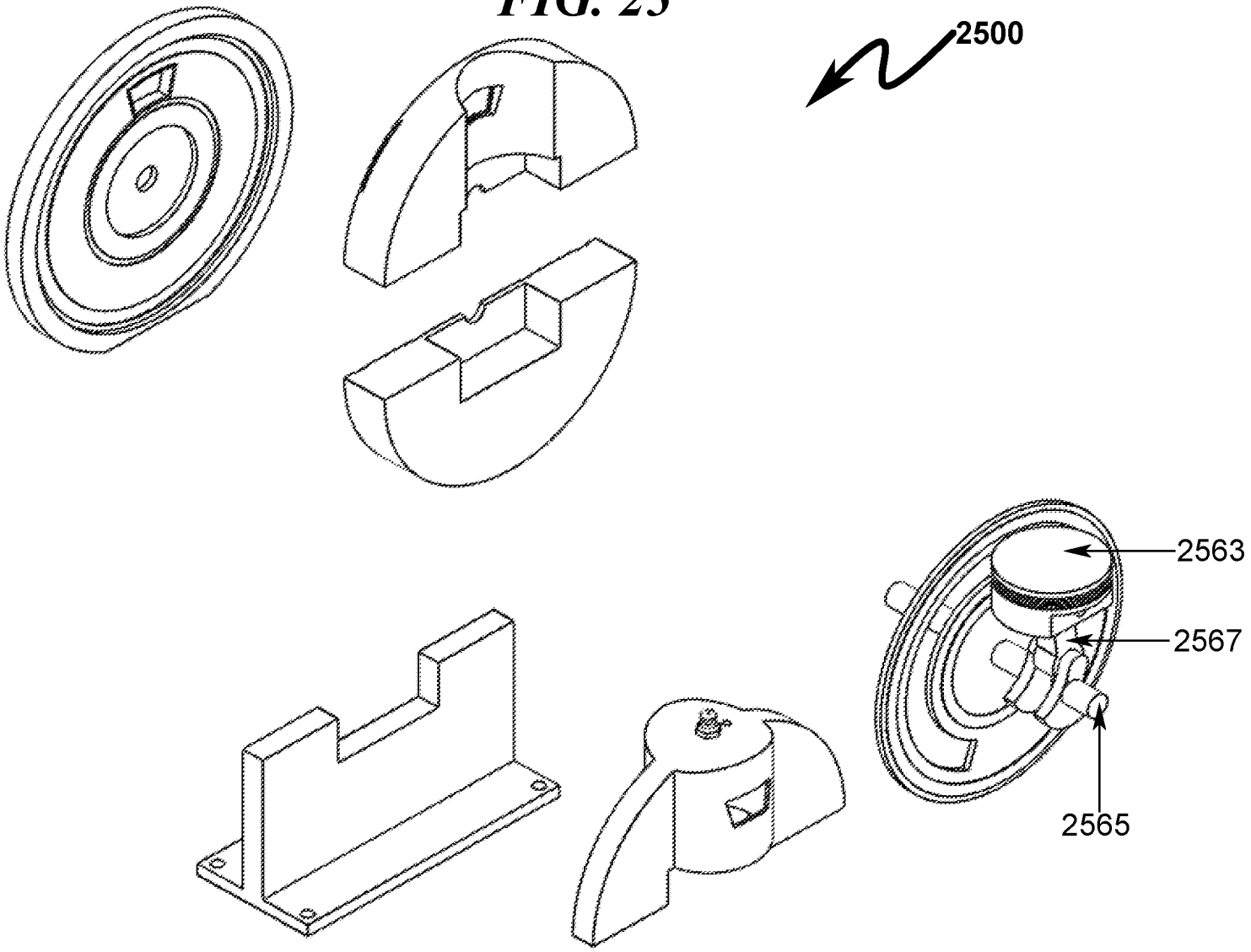
FIG. 25 illustrates a top right front perspective engine block exploded view of a preferred exemplary rudimentary invention system embodiment.
Figure 26:
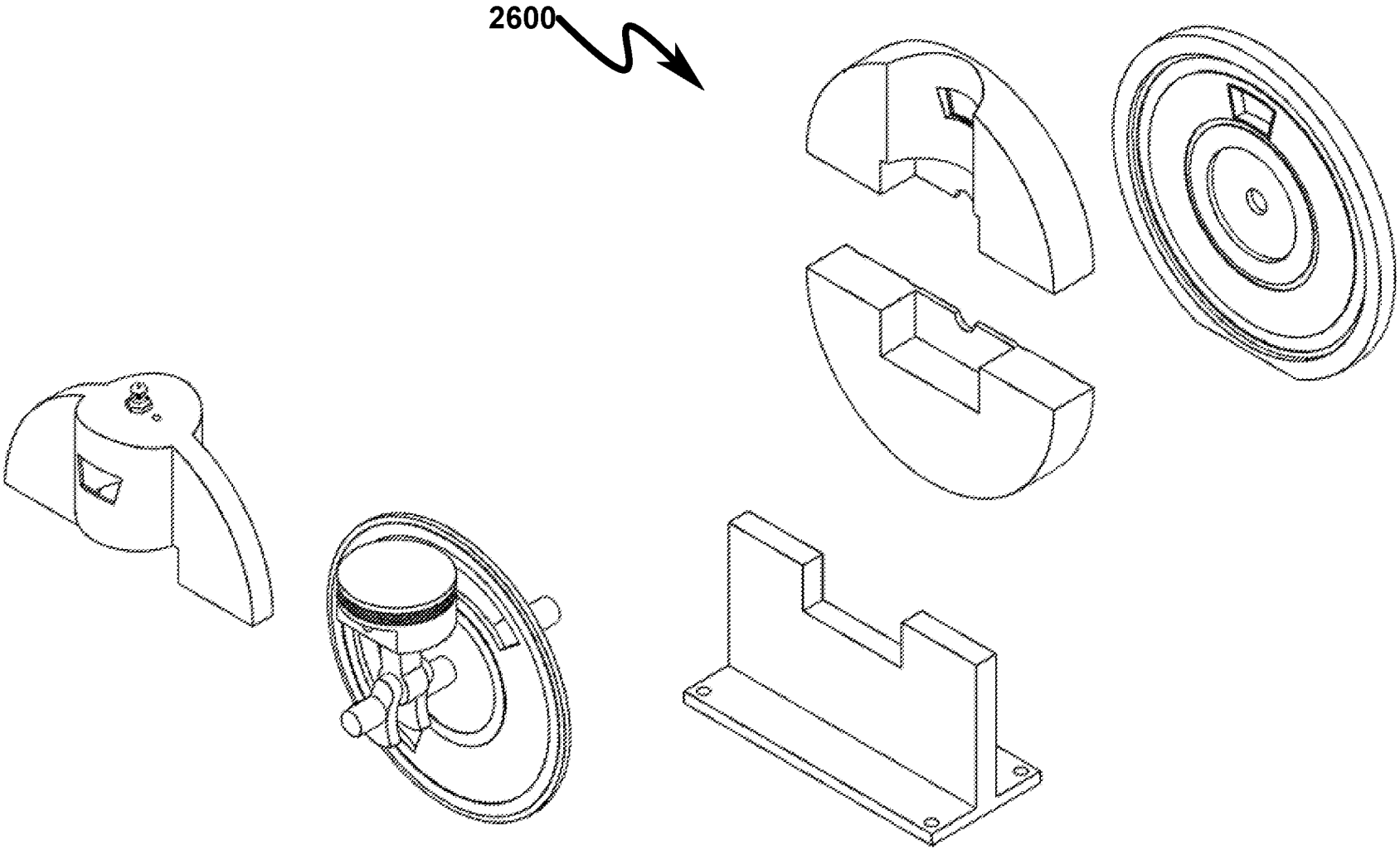
FIG. 26 illustrates a top right rear perspective engine block exploded view of a preferred exemplary rudimentary invention system embodiment.
Figure 27:
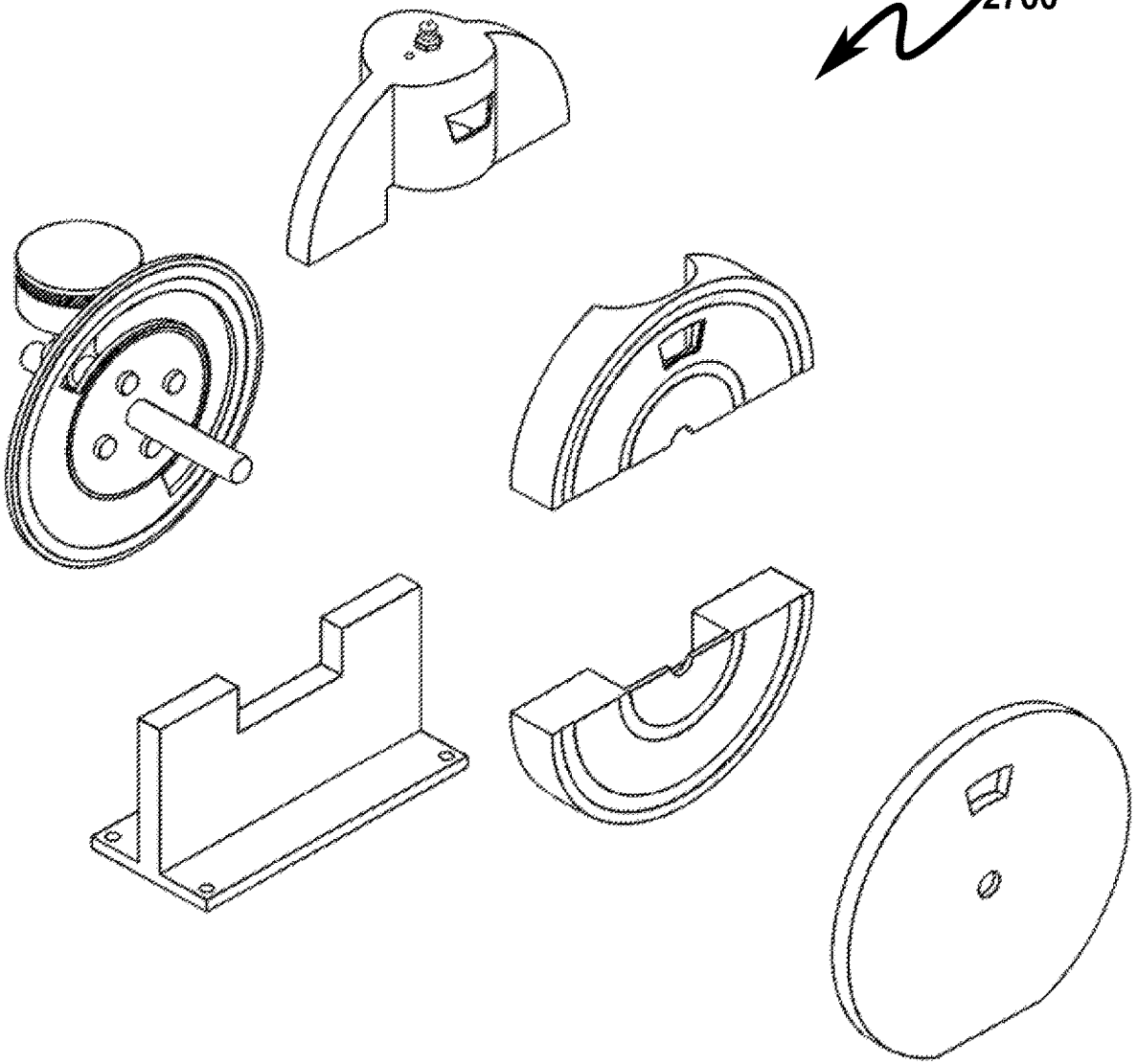
FIG. 27 illustrates a top left rear perspective view engine block exploded of a preferred exemplary rudimentary invention system embodiment.
Figure 28:
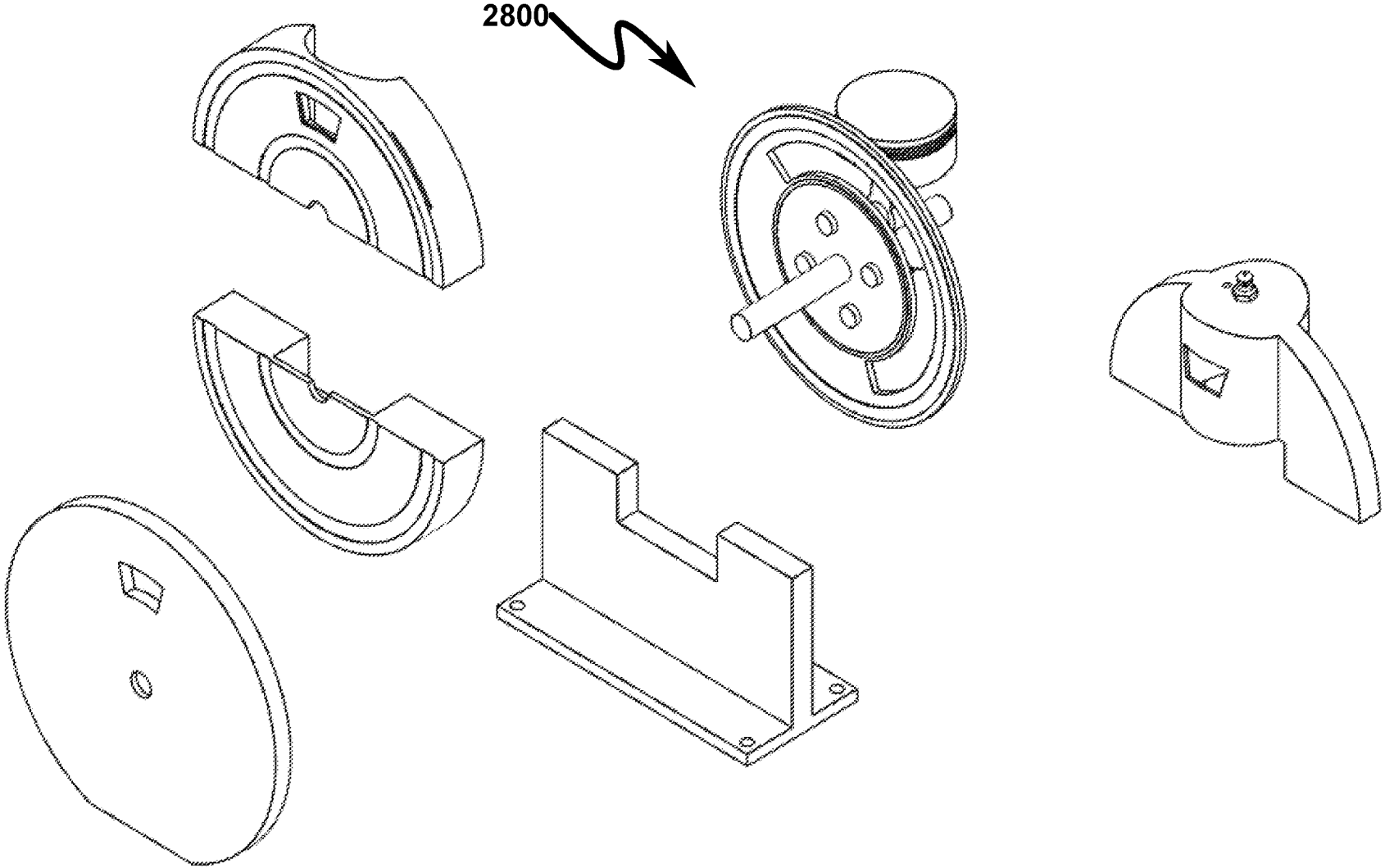
FIG. 28 illustrates a top left front perspective engine block exploded view of a preferred exemplary rudimentary invention system embodiment.
Figure 29:
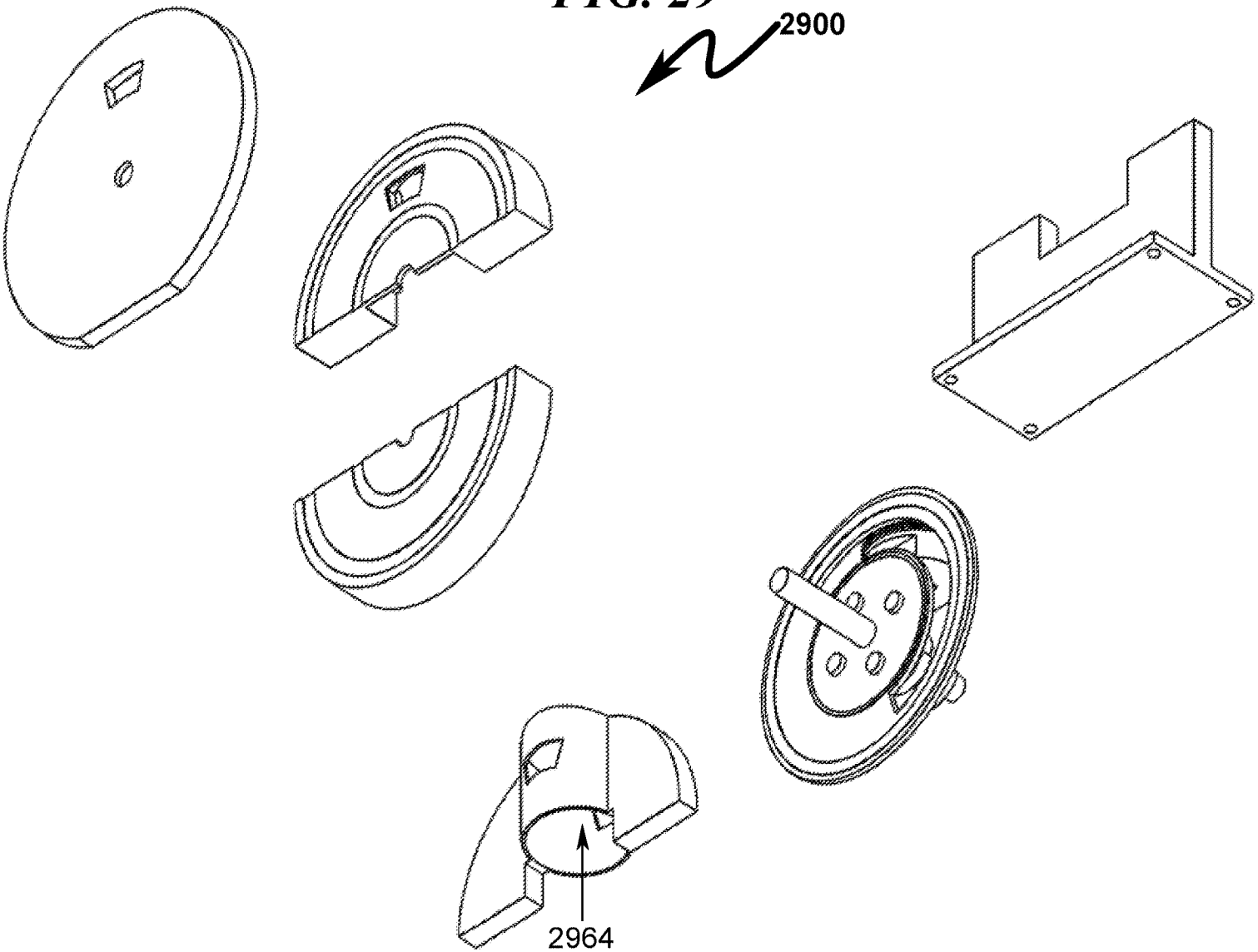
FIG. 29 illustrates a bottom right front perspective engine block exploded view of a preferred exemplary rudimentary invention system embodiment.
Figure 30:
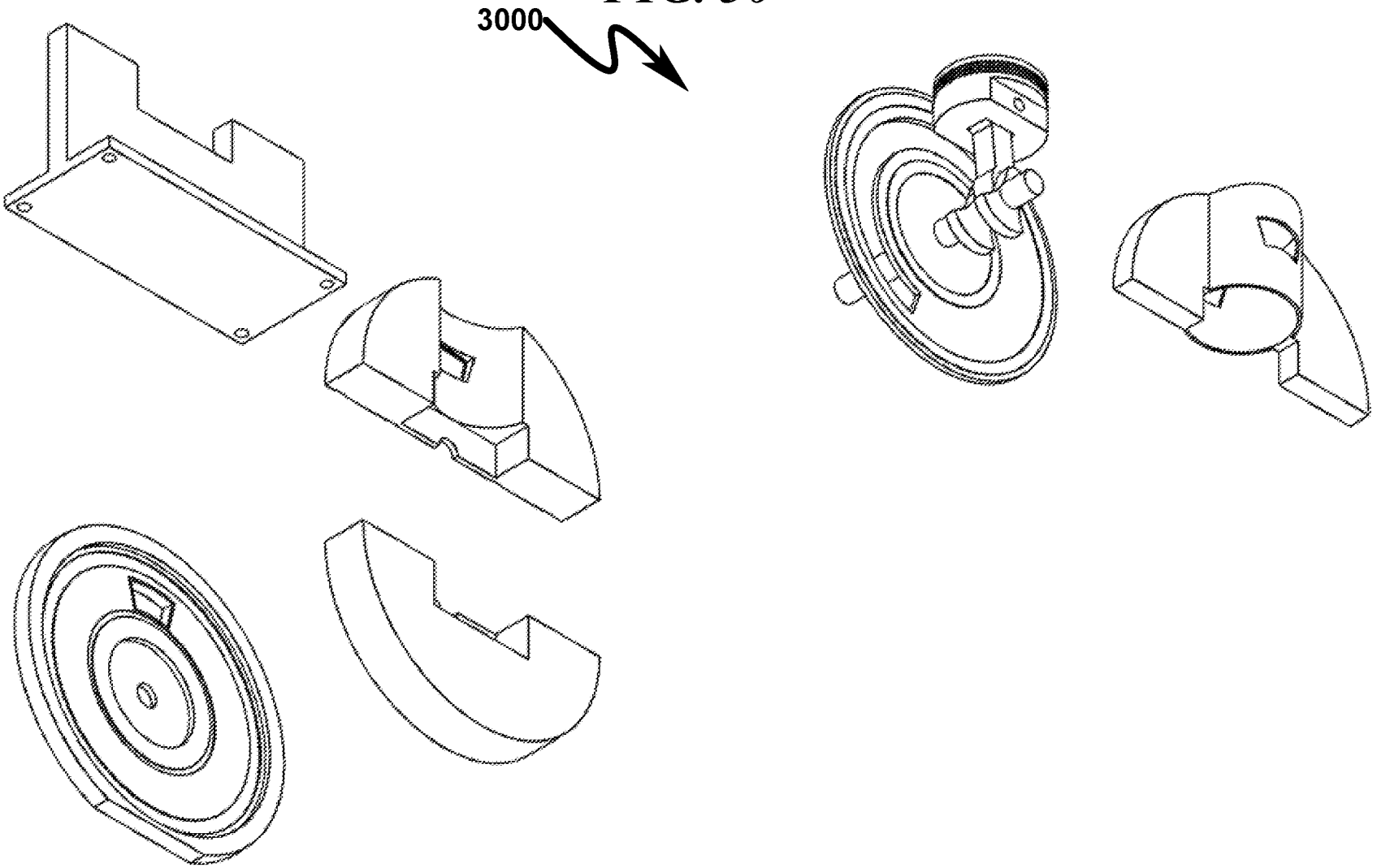
FIG. 30 illustrates a bottom right rear perspective engine block exploded view of a preferred exemplary rudimentary invention system embodiment.
Figure 31:
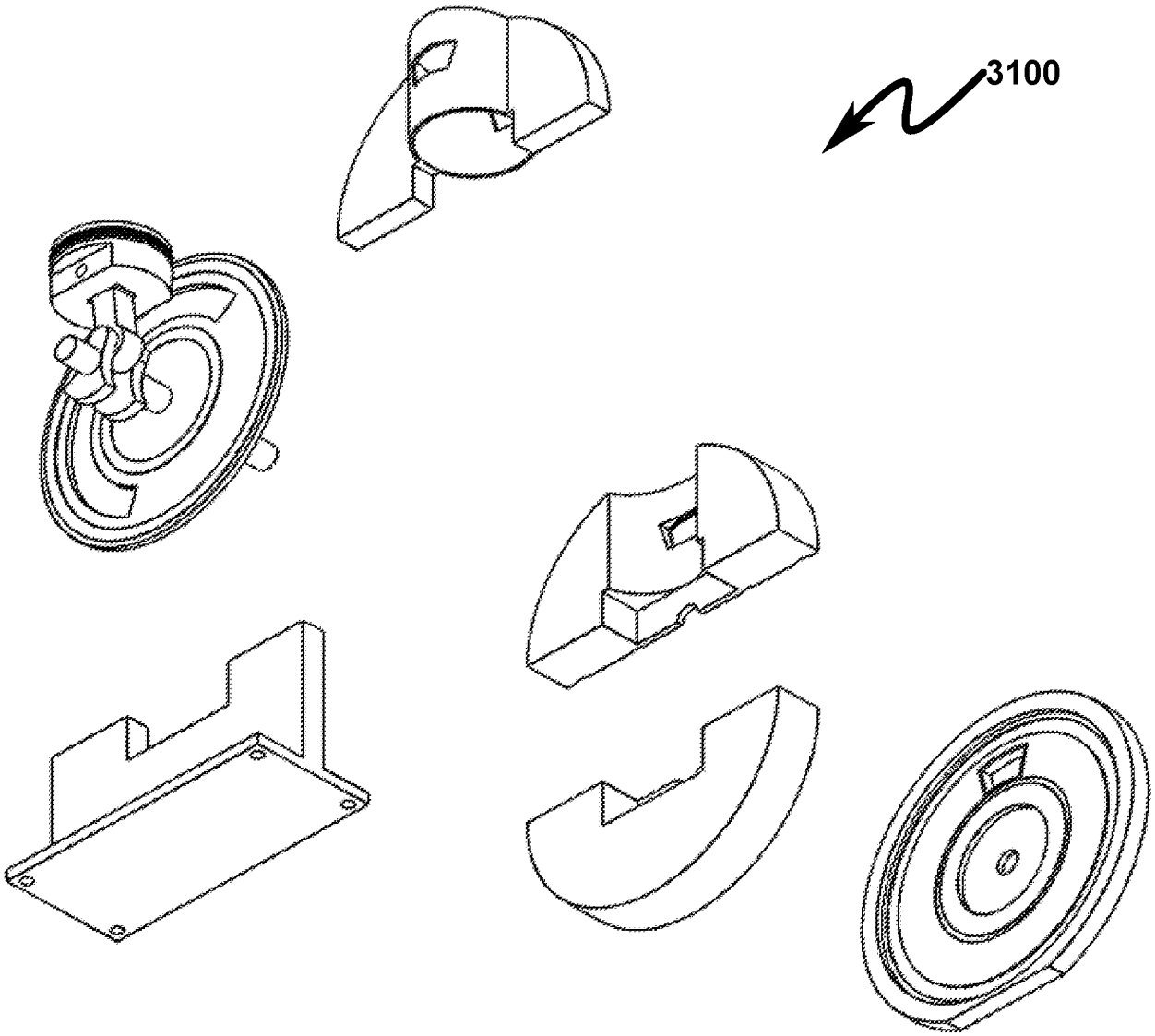
FIG. 31 illustrates a bottom left rear perspective engine block exploded view of a preferred exemplary rudimentary invention system embodiment.
Figure 137:
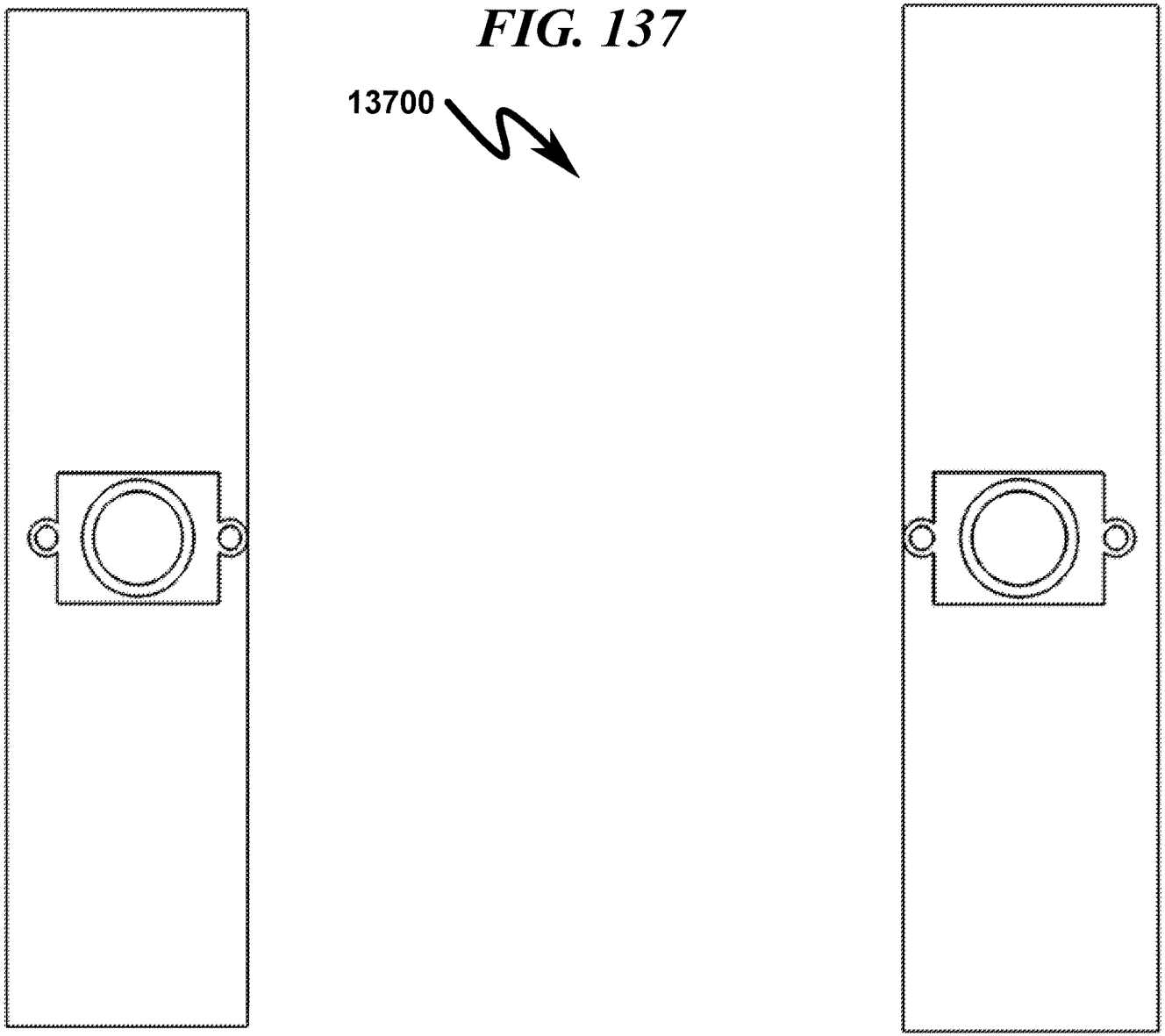
Figure 138:
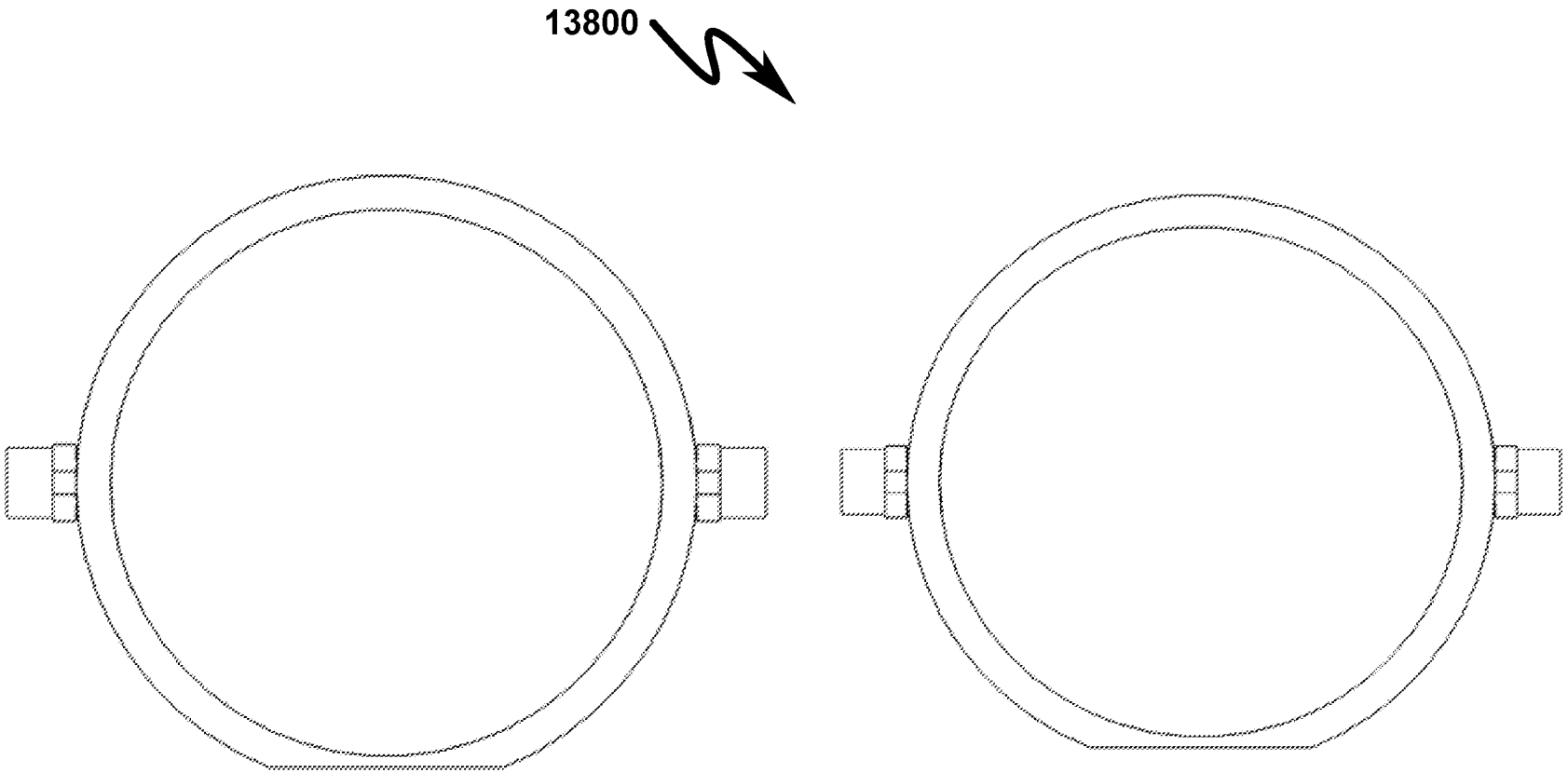
Figure 139:
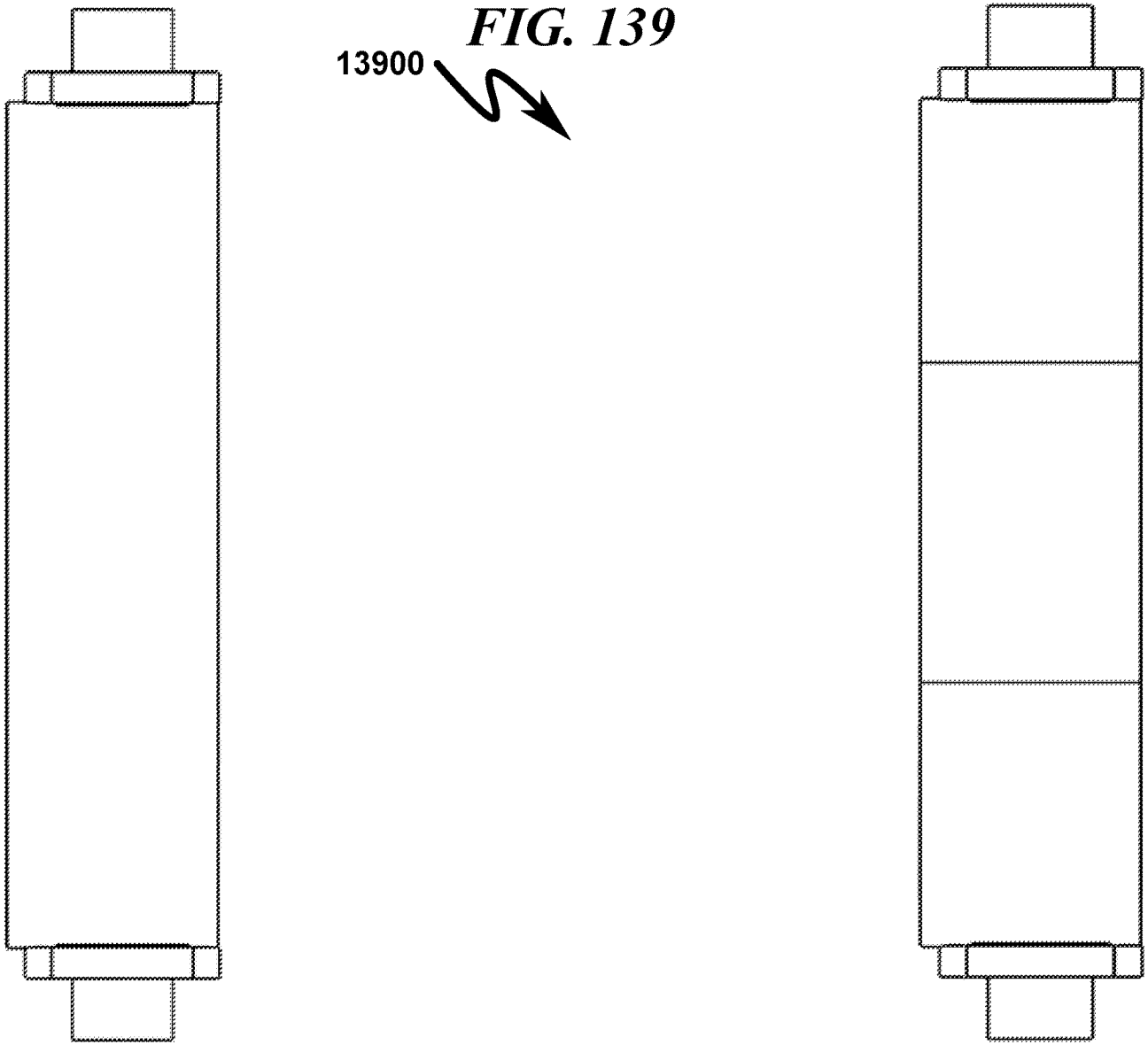
Figure 140:
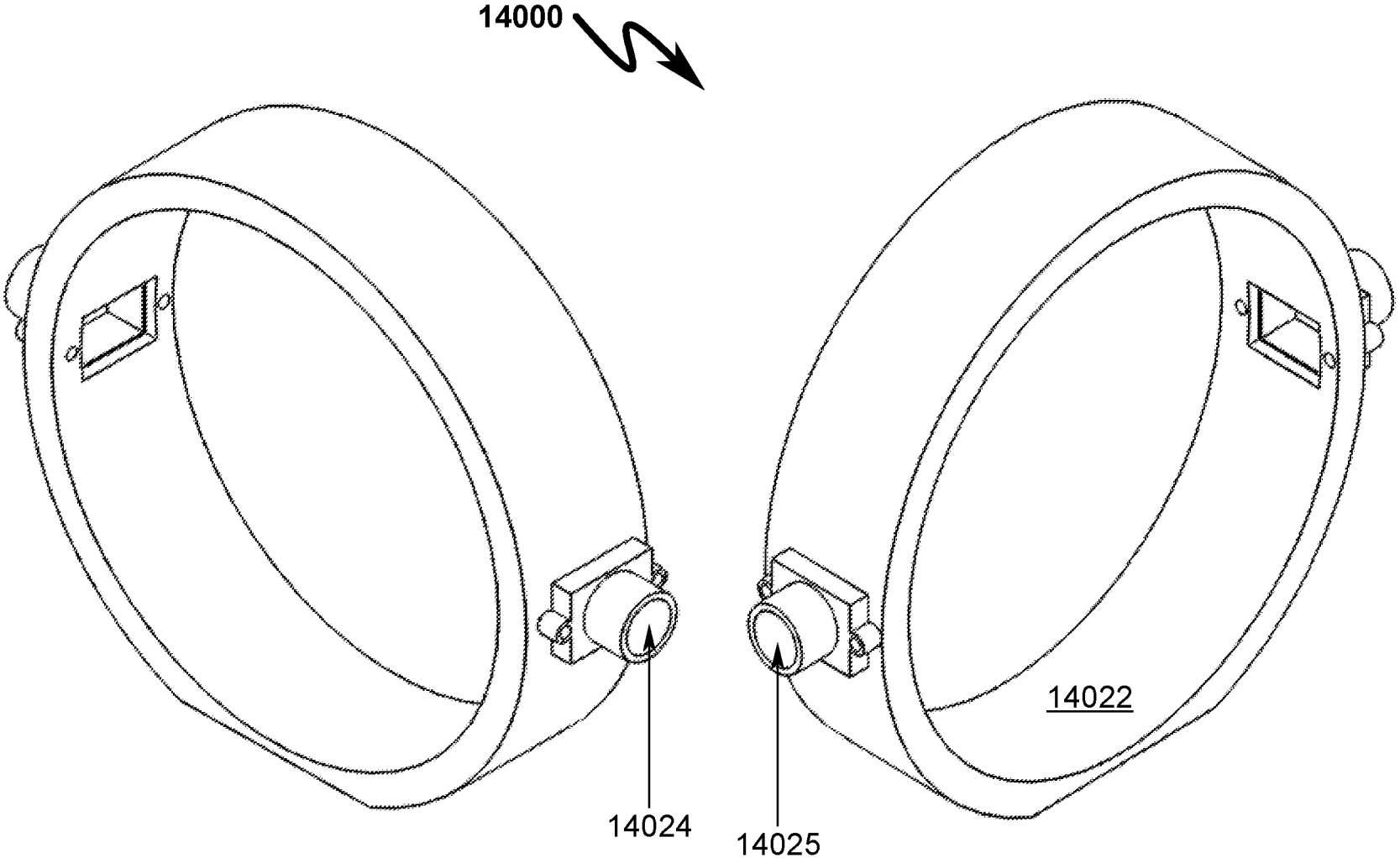
Figure 141:
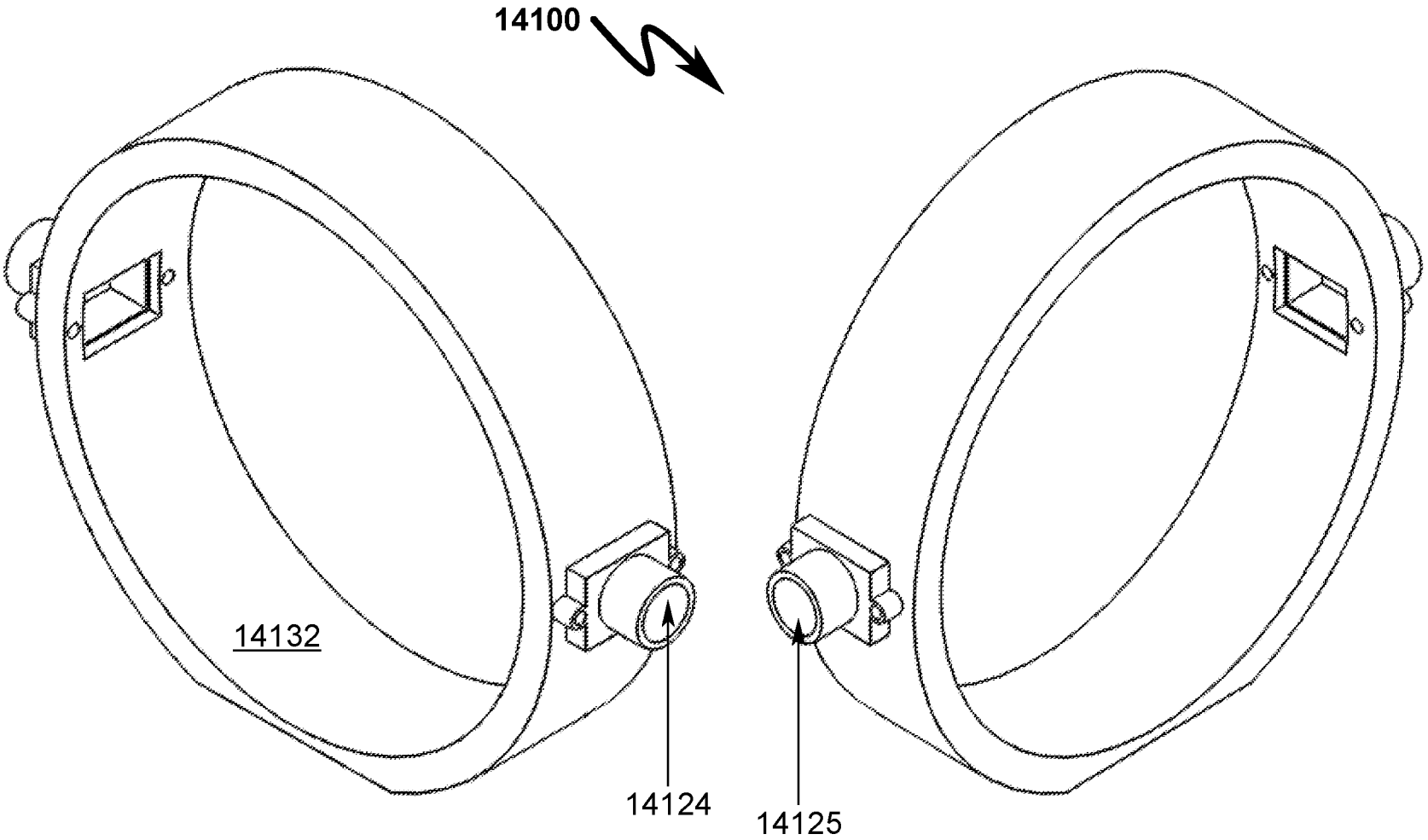
Figure 142:
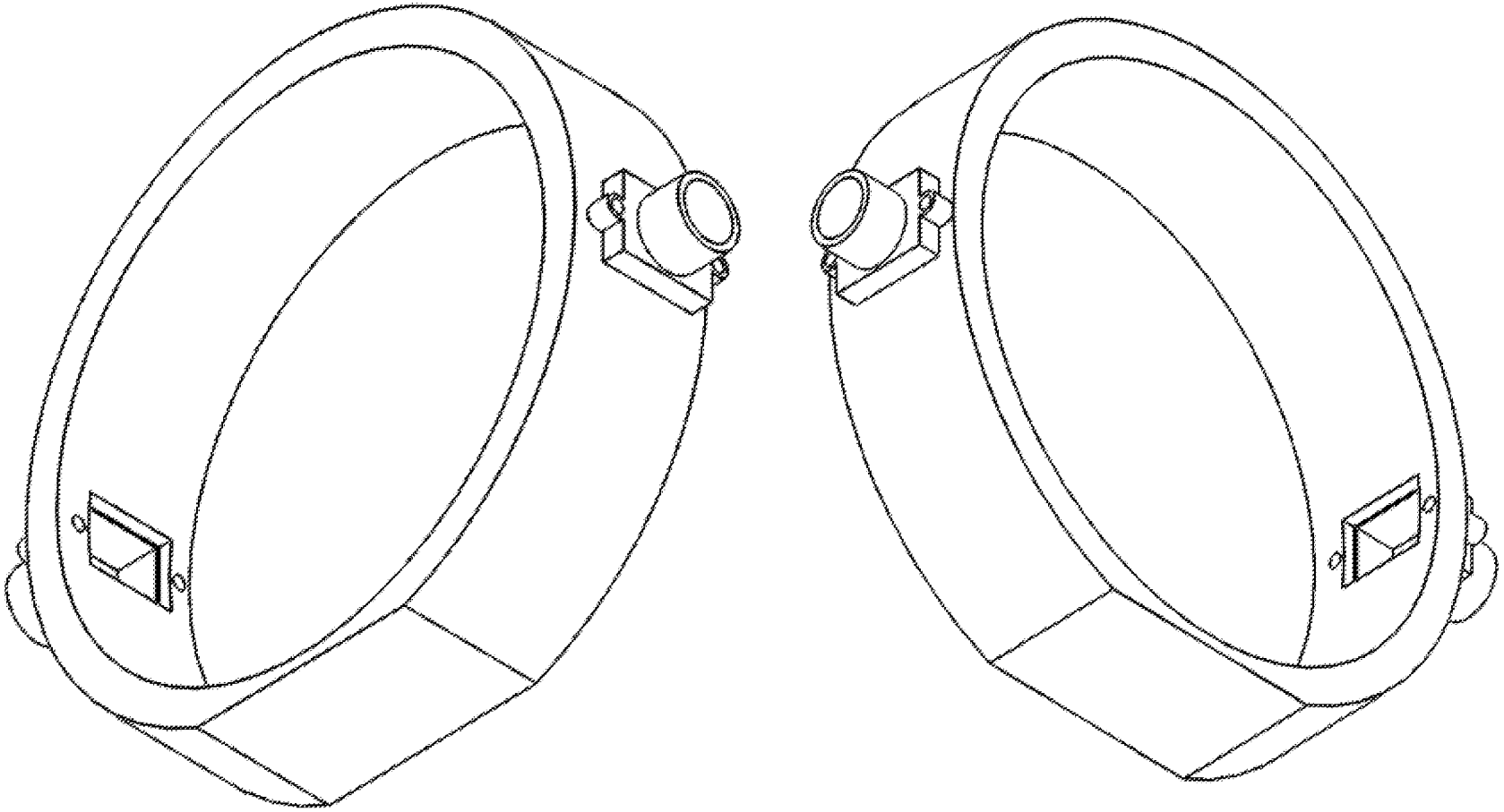
Figure 143:
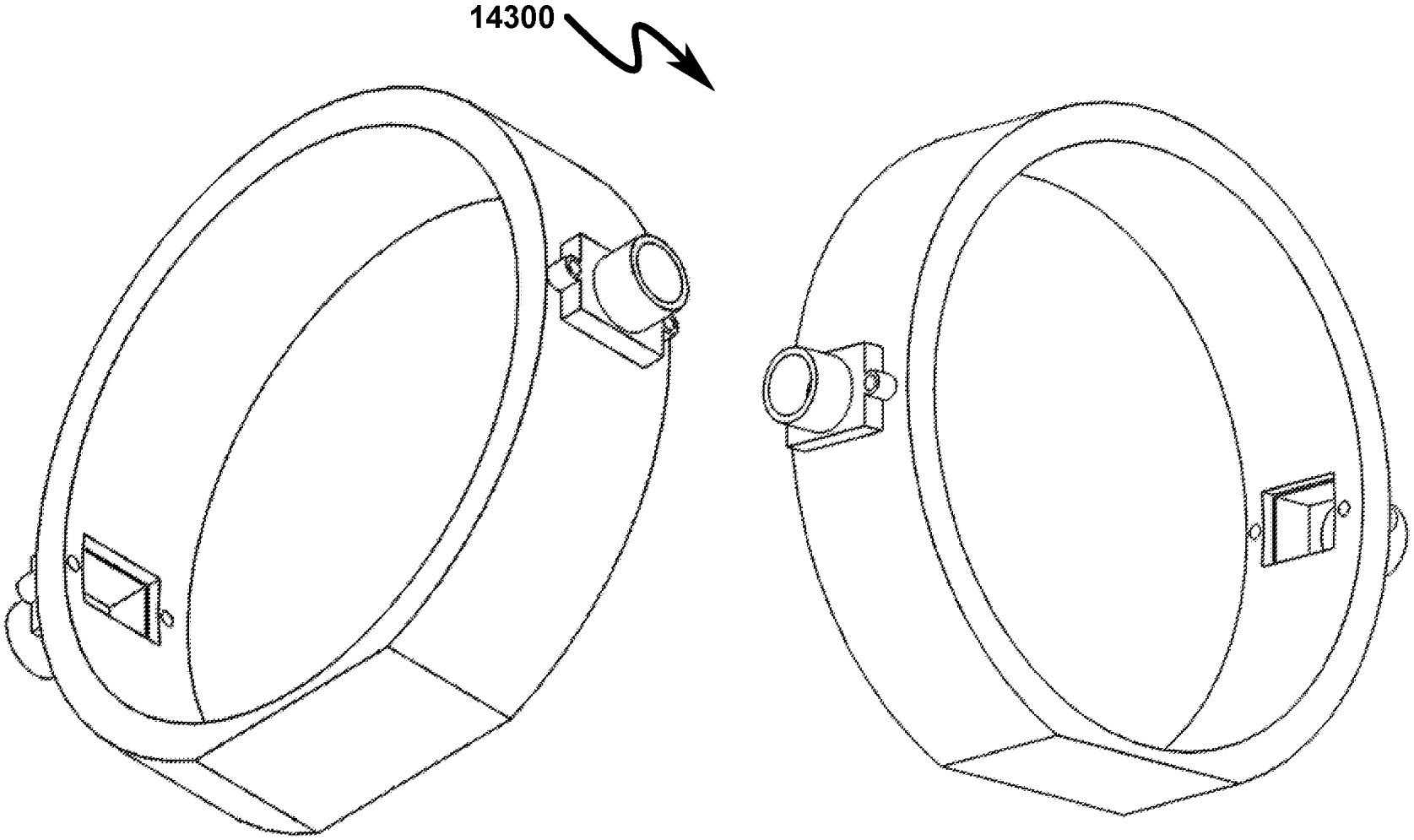
Figure 144:
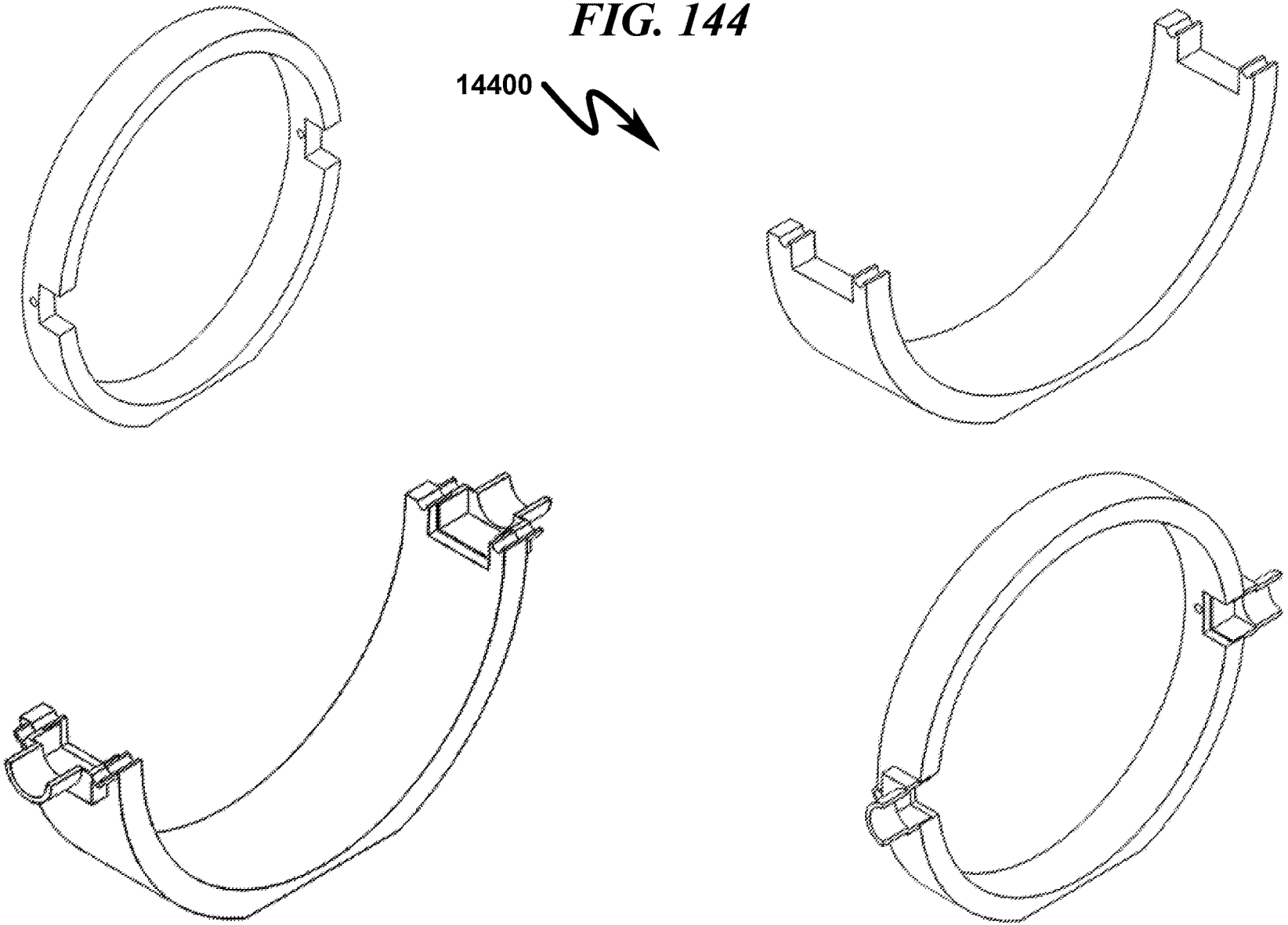
Figure 145:
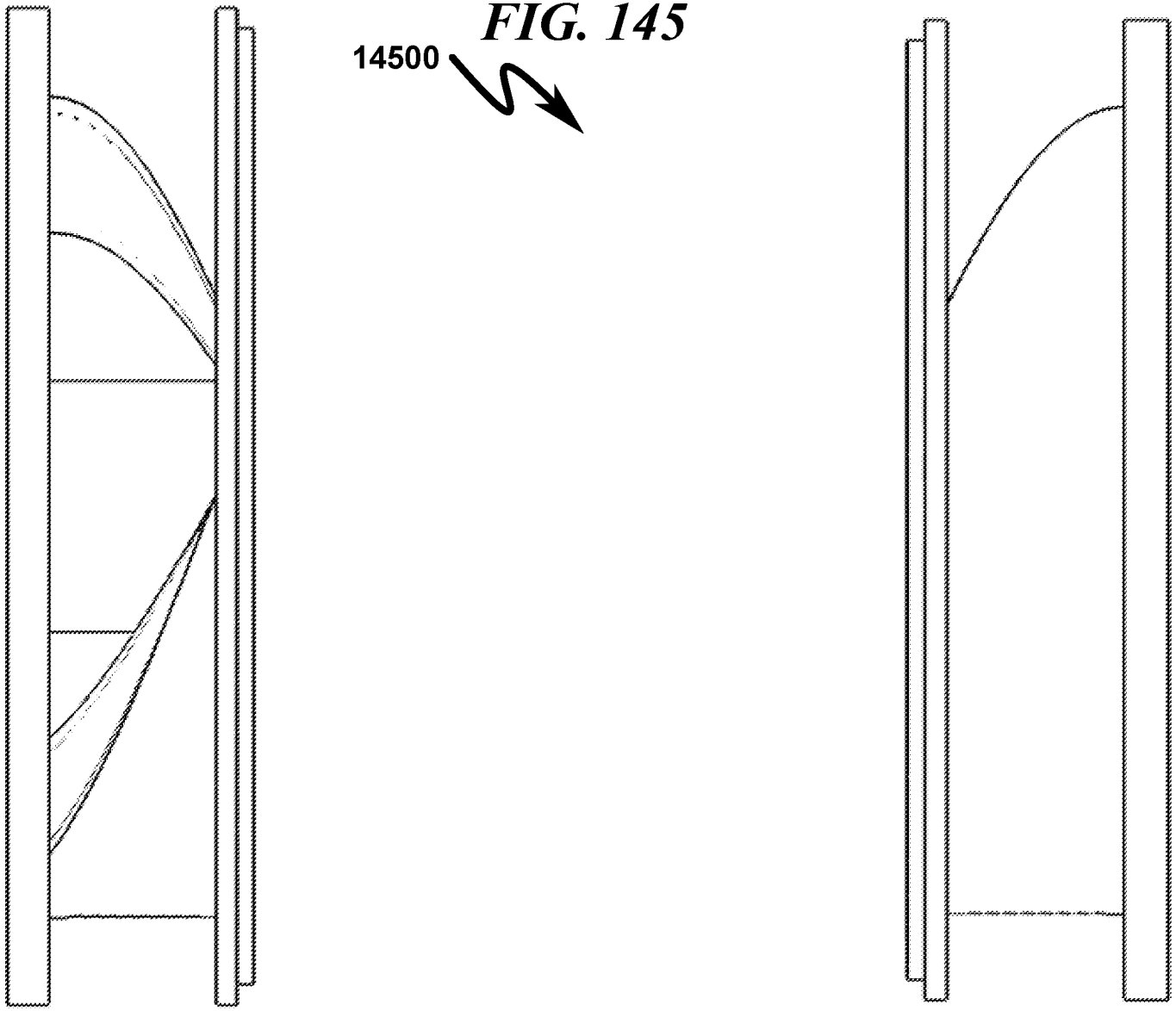
Figure 146:
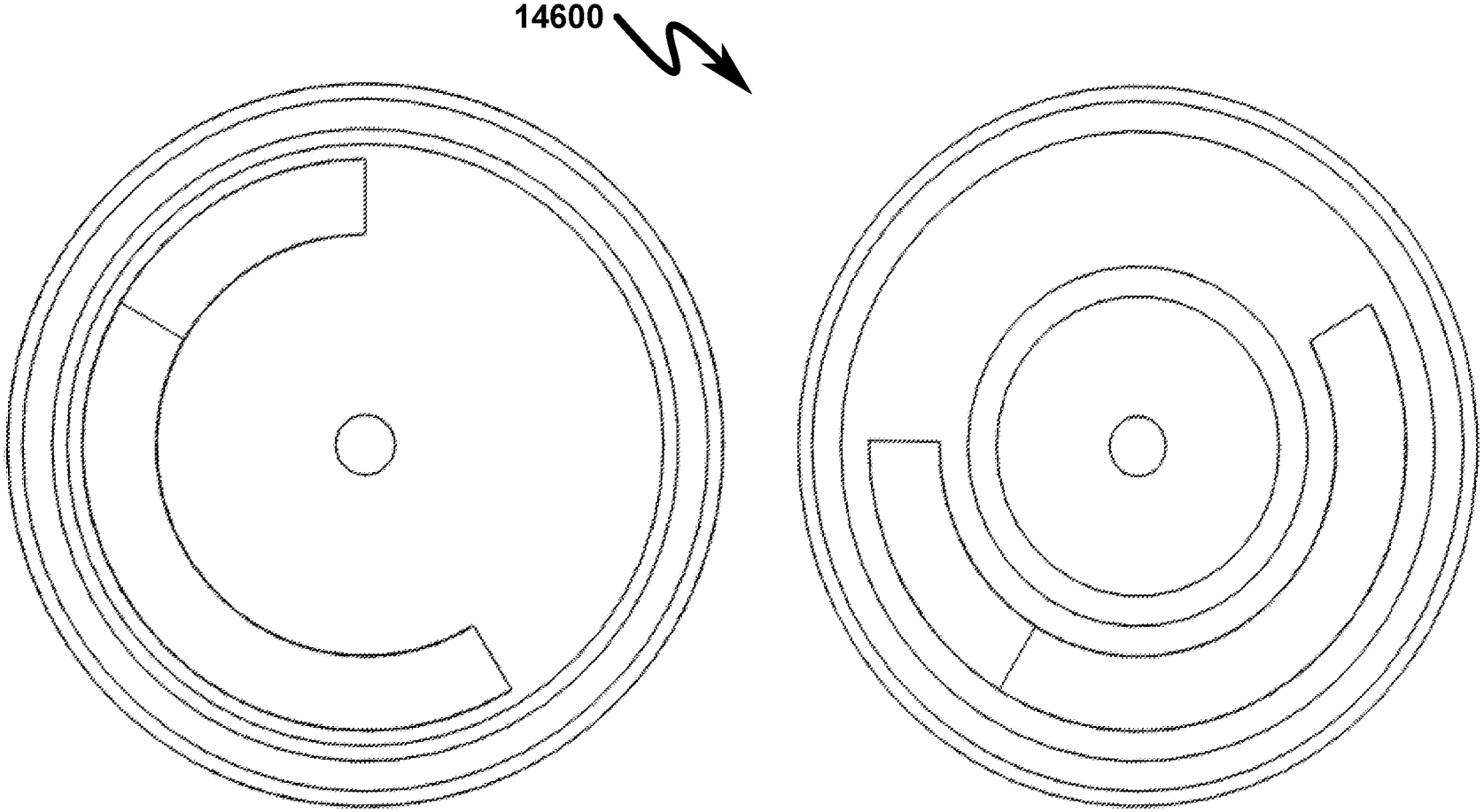
Figure 147:
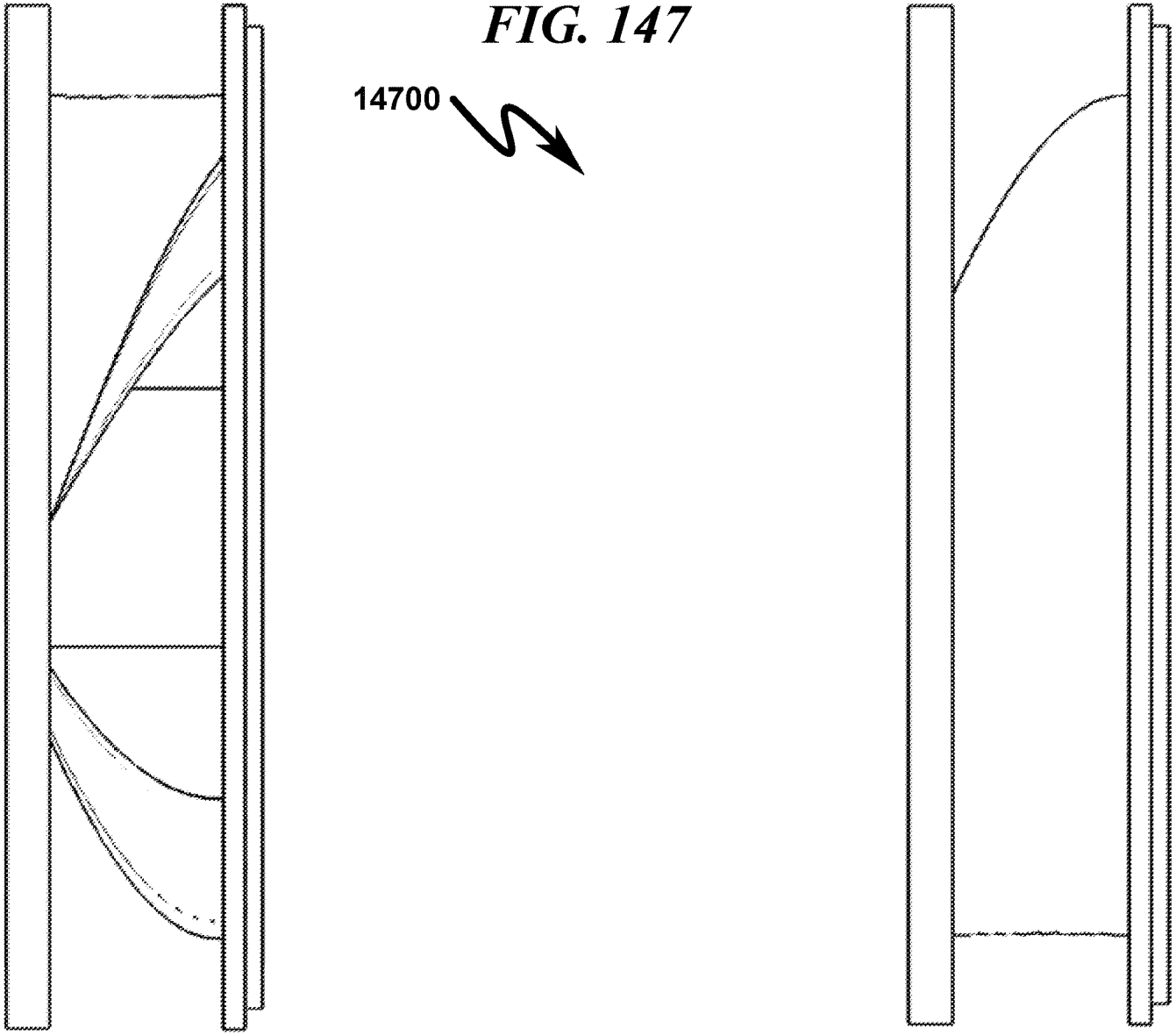
Figure 148:
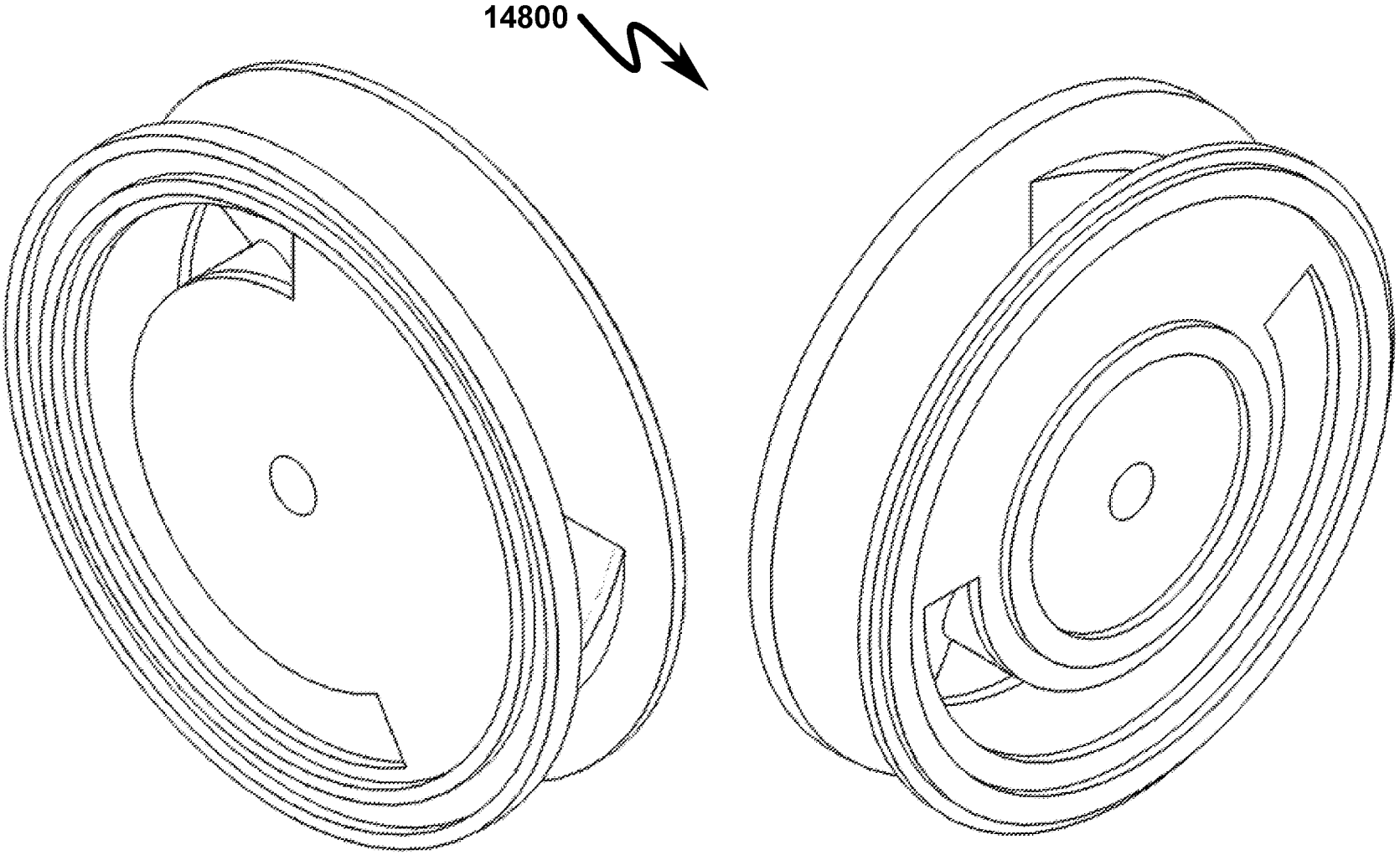
Figure 149:
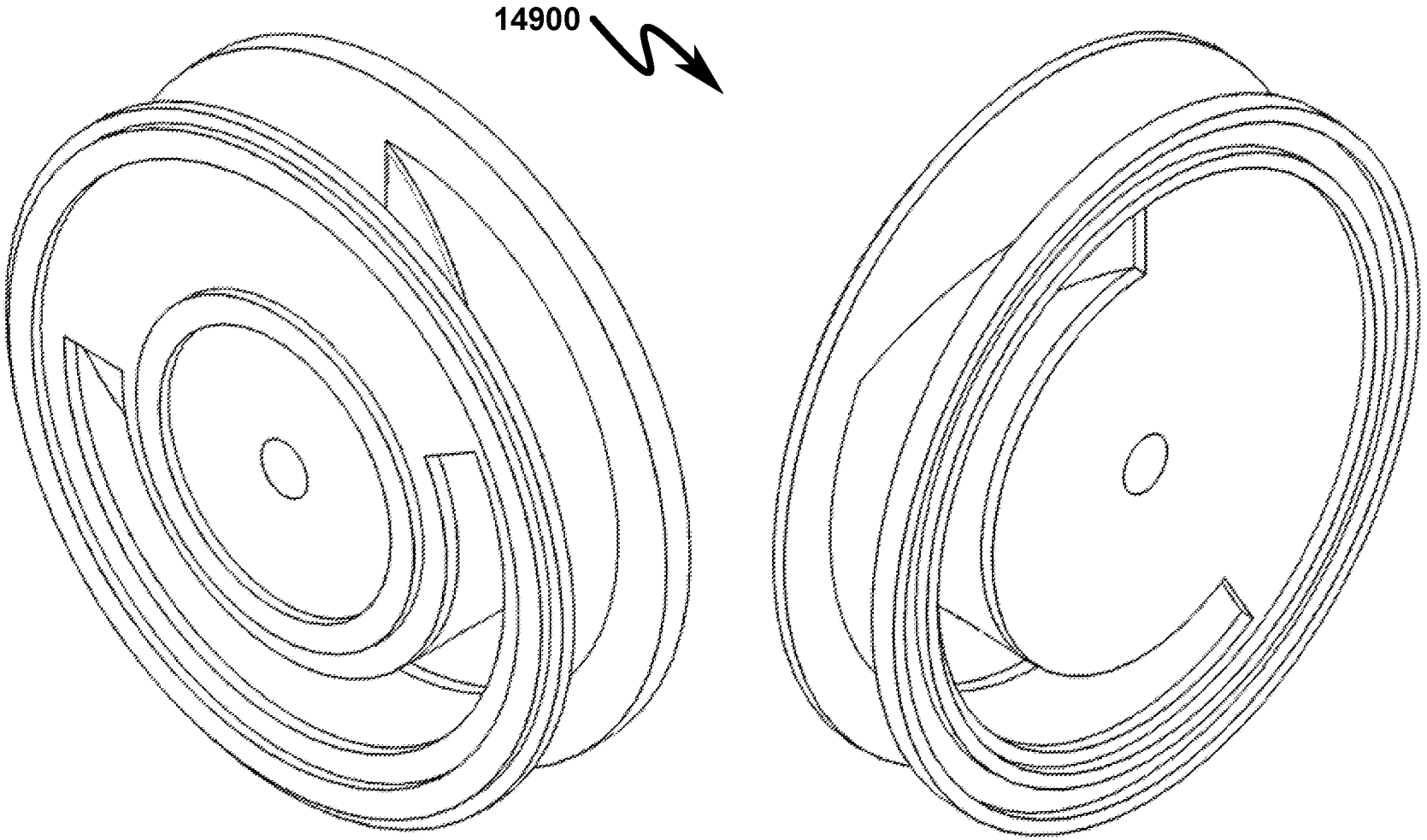
Figure 150:
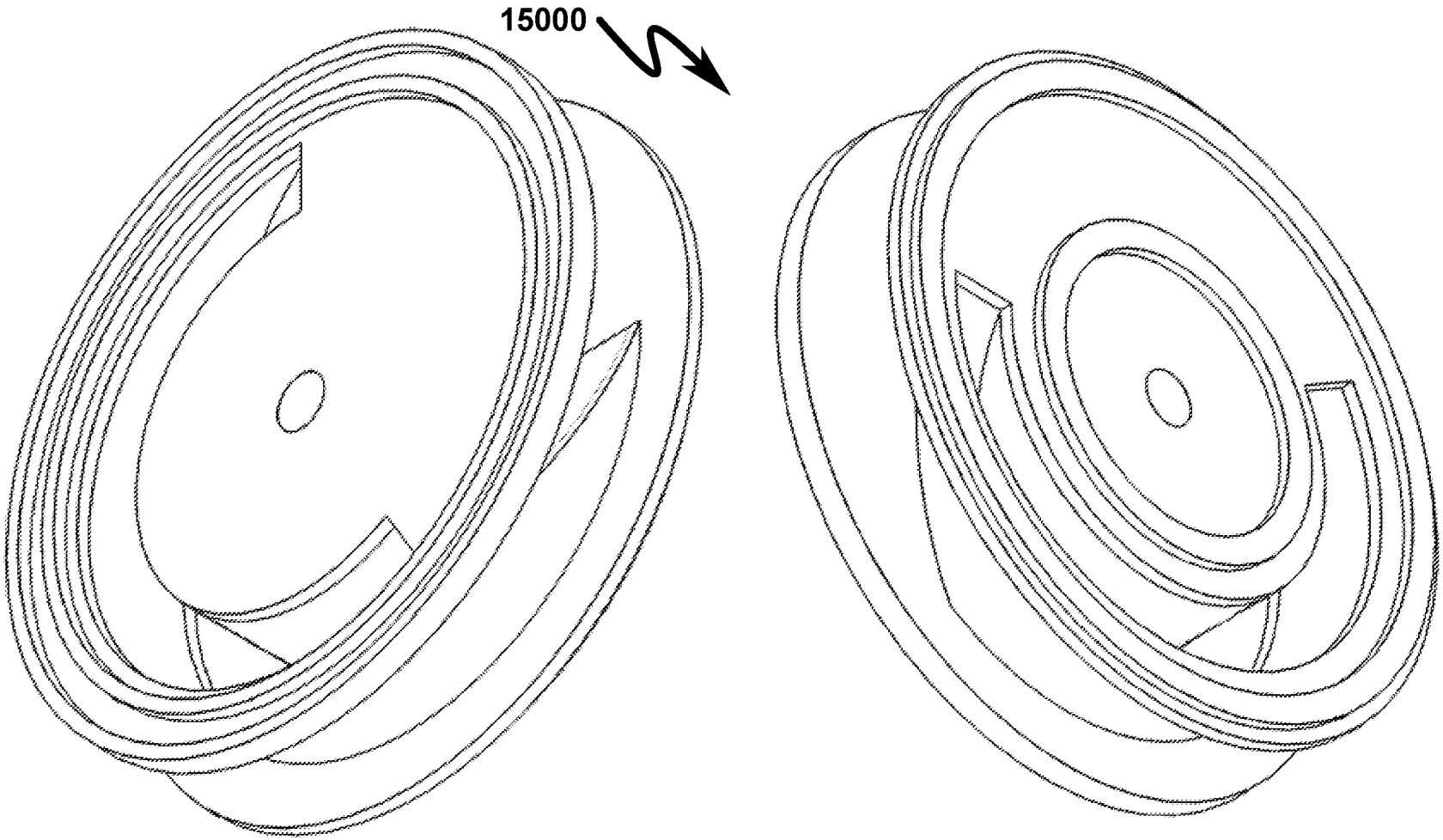
Figure 151:
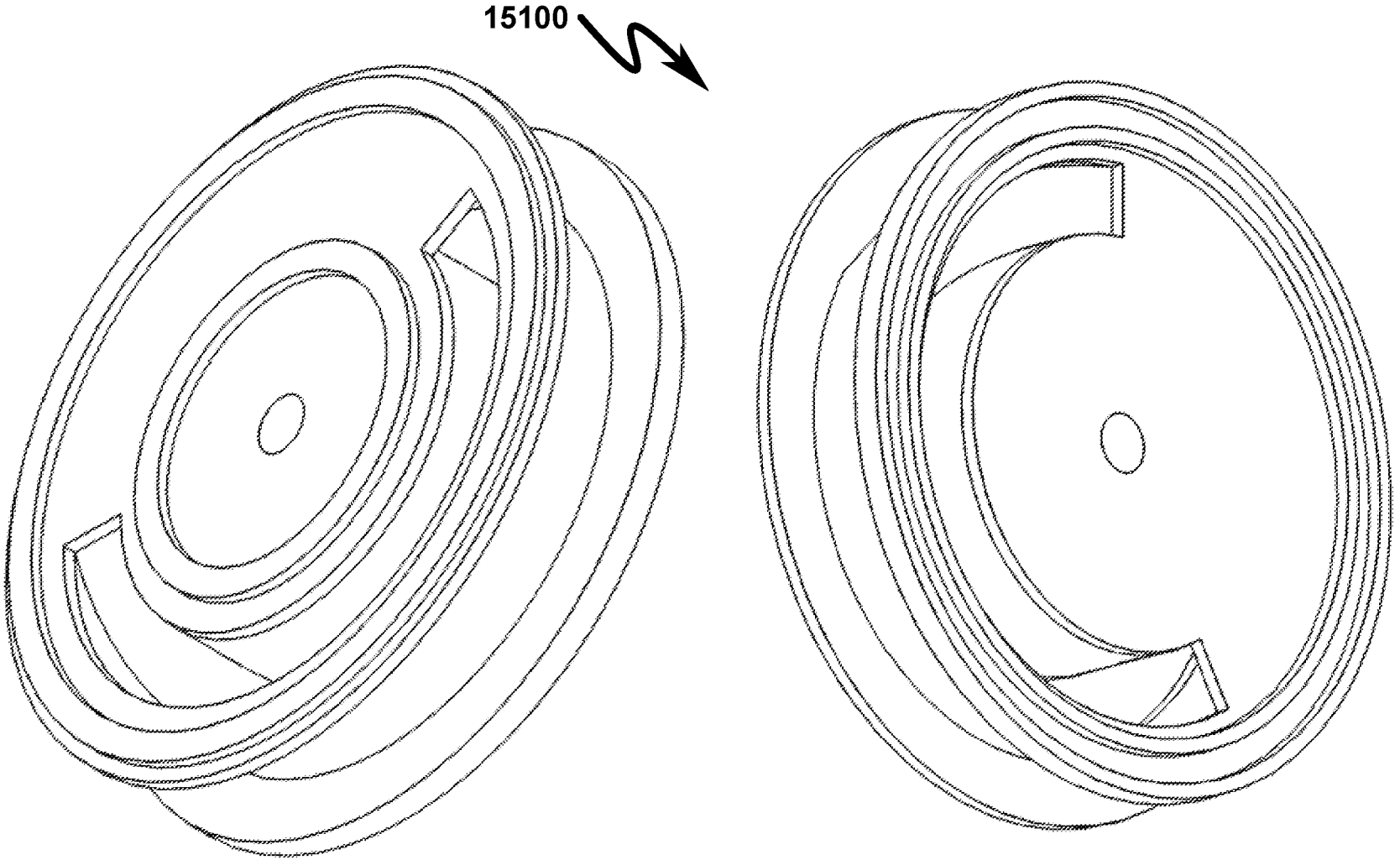
Figure 152:
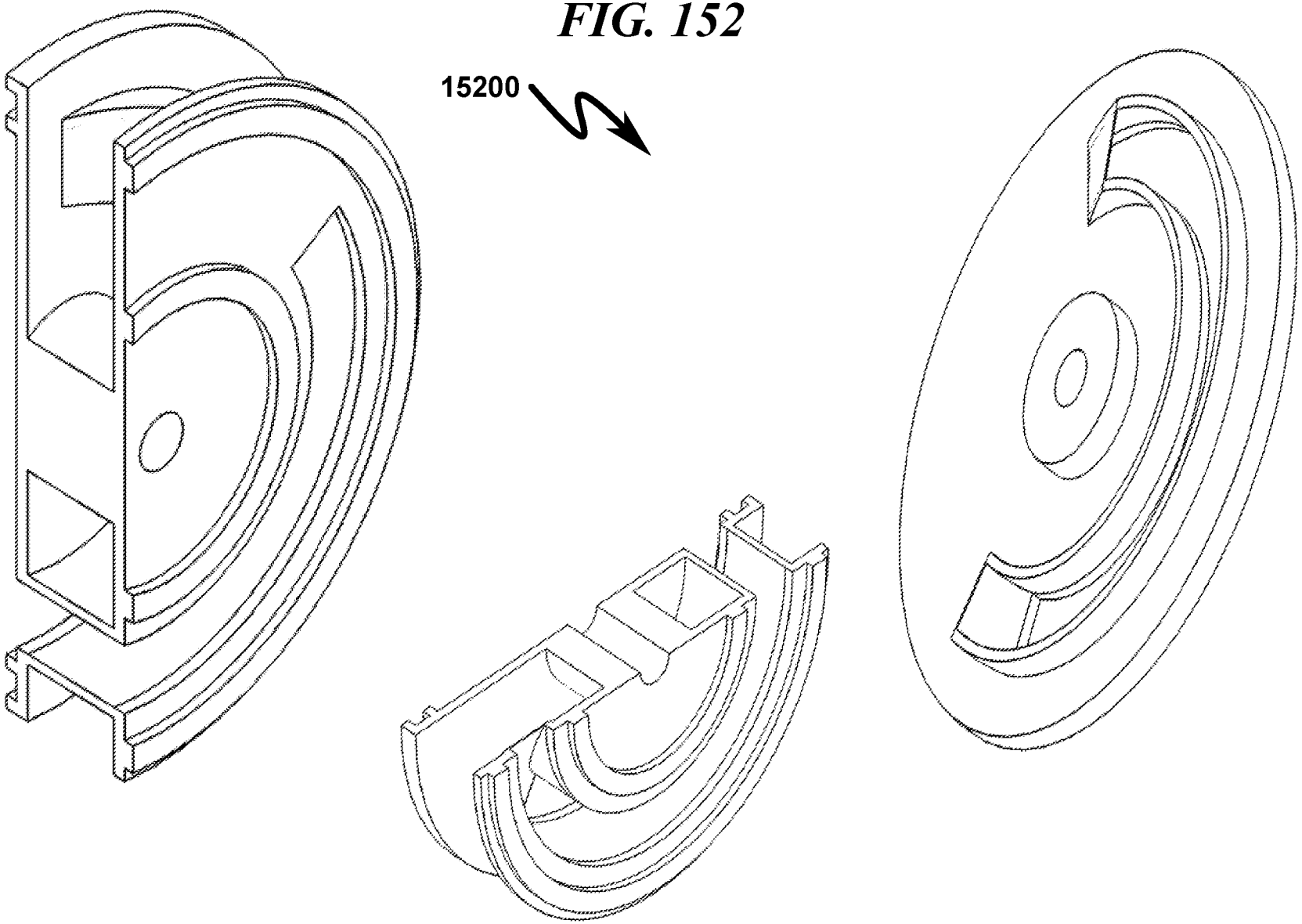
Figure 153:
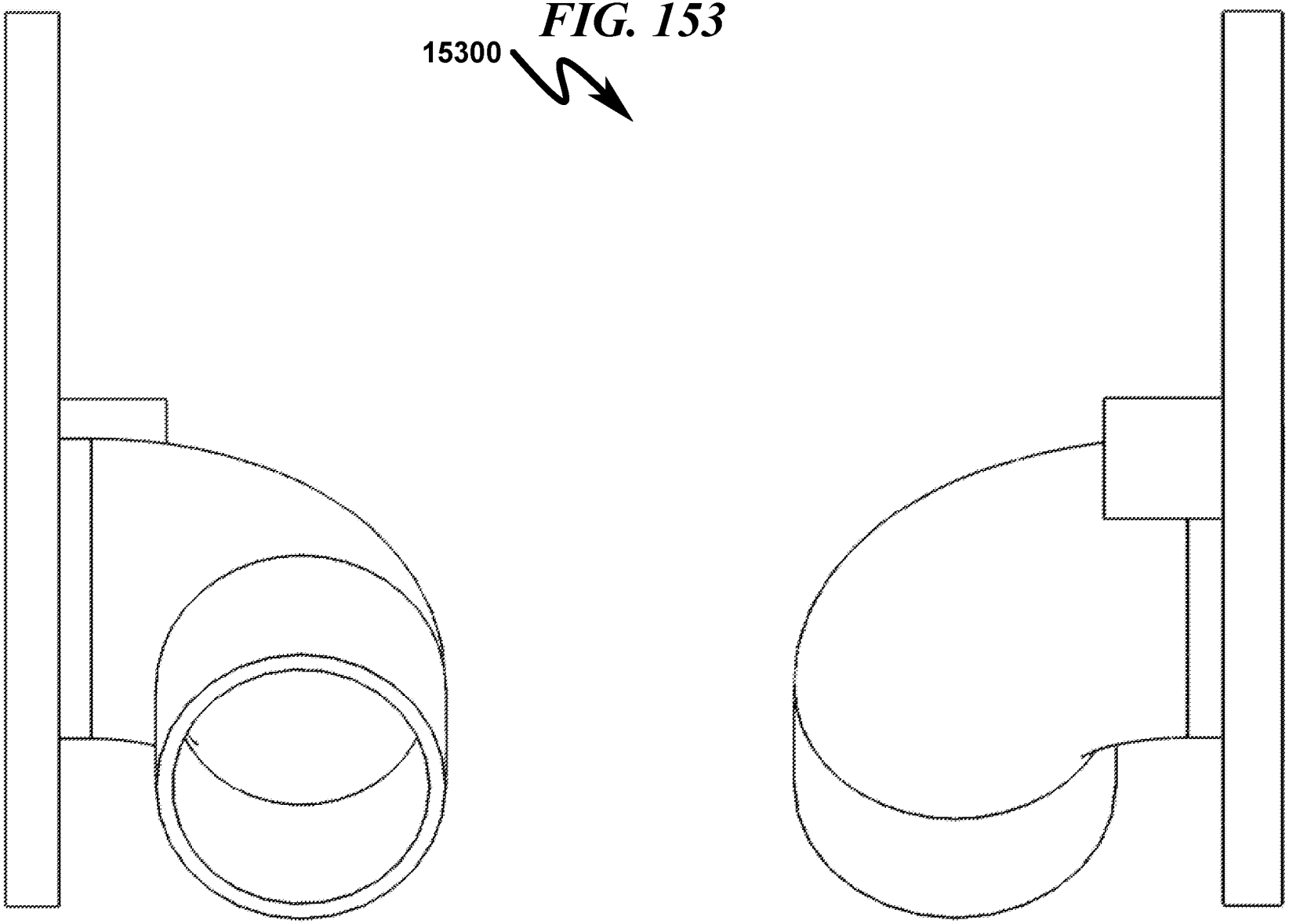
Figure 154:
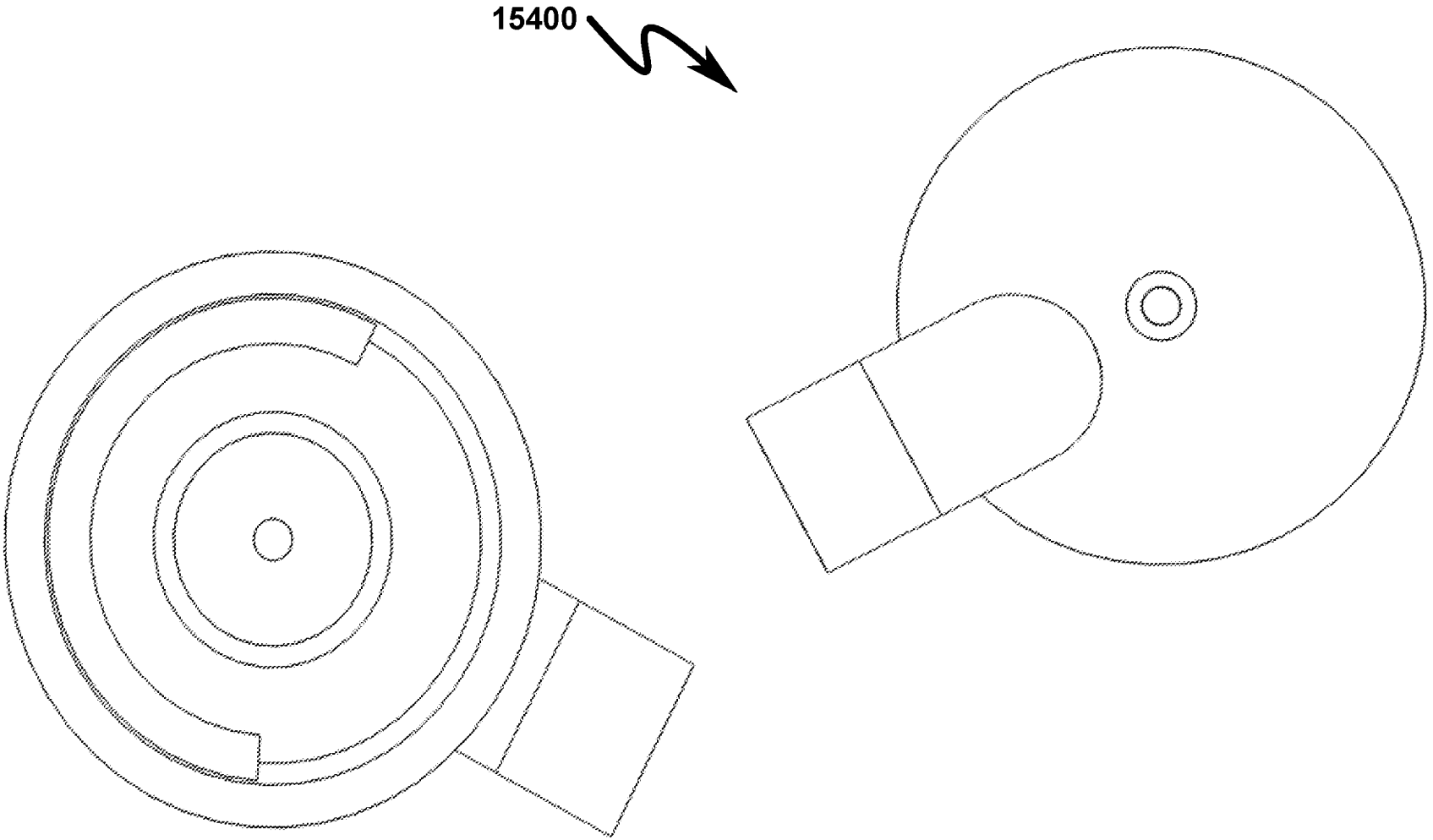
Figure 155:
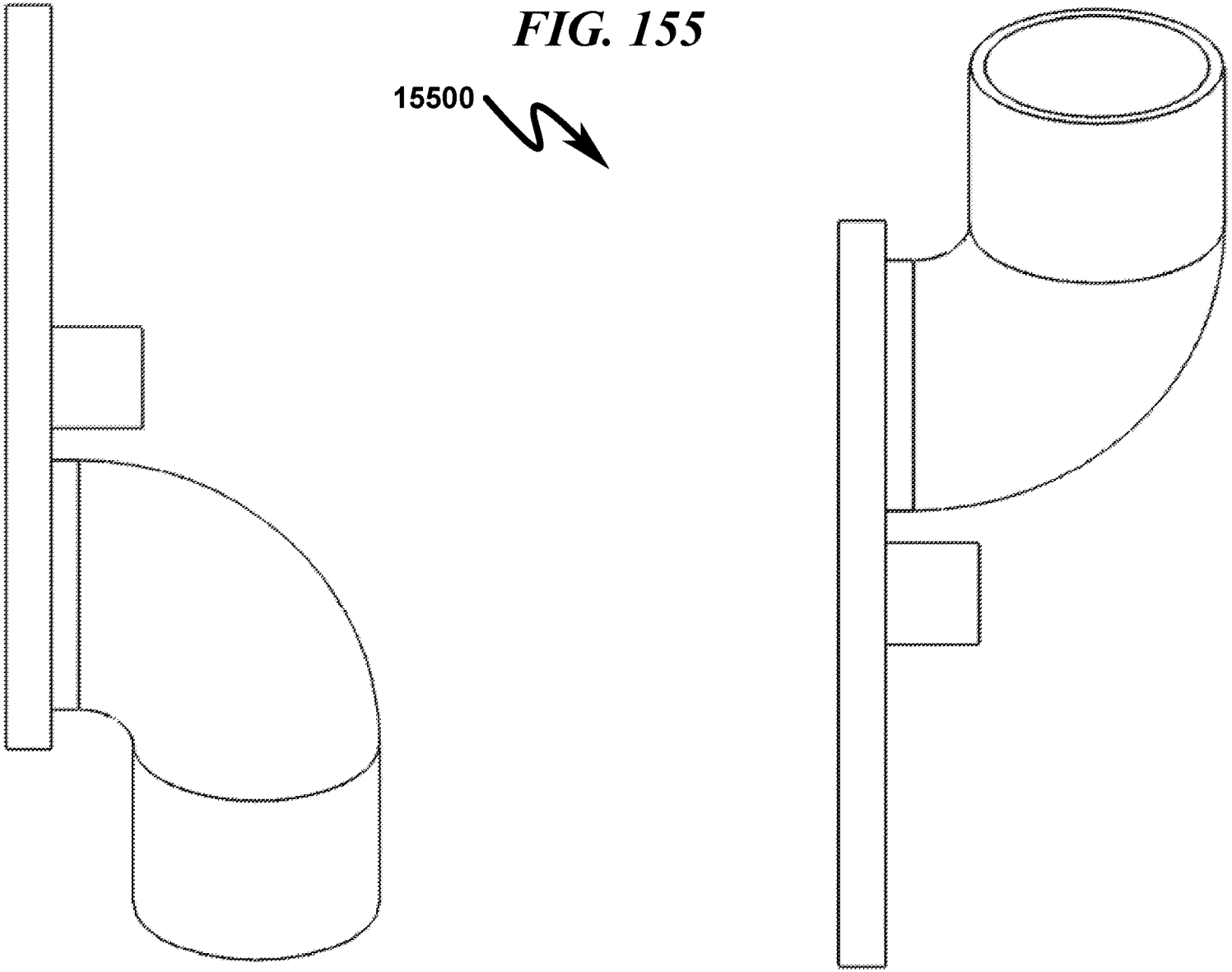
Figure 156:
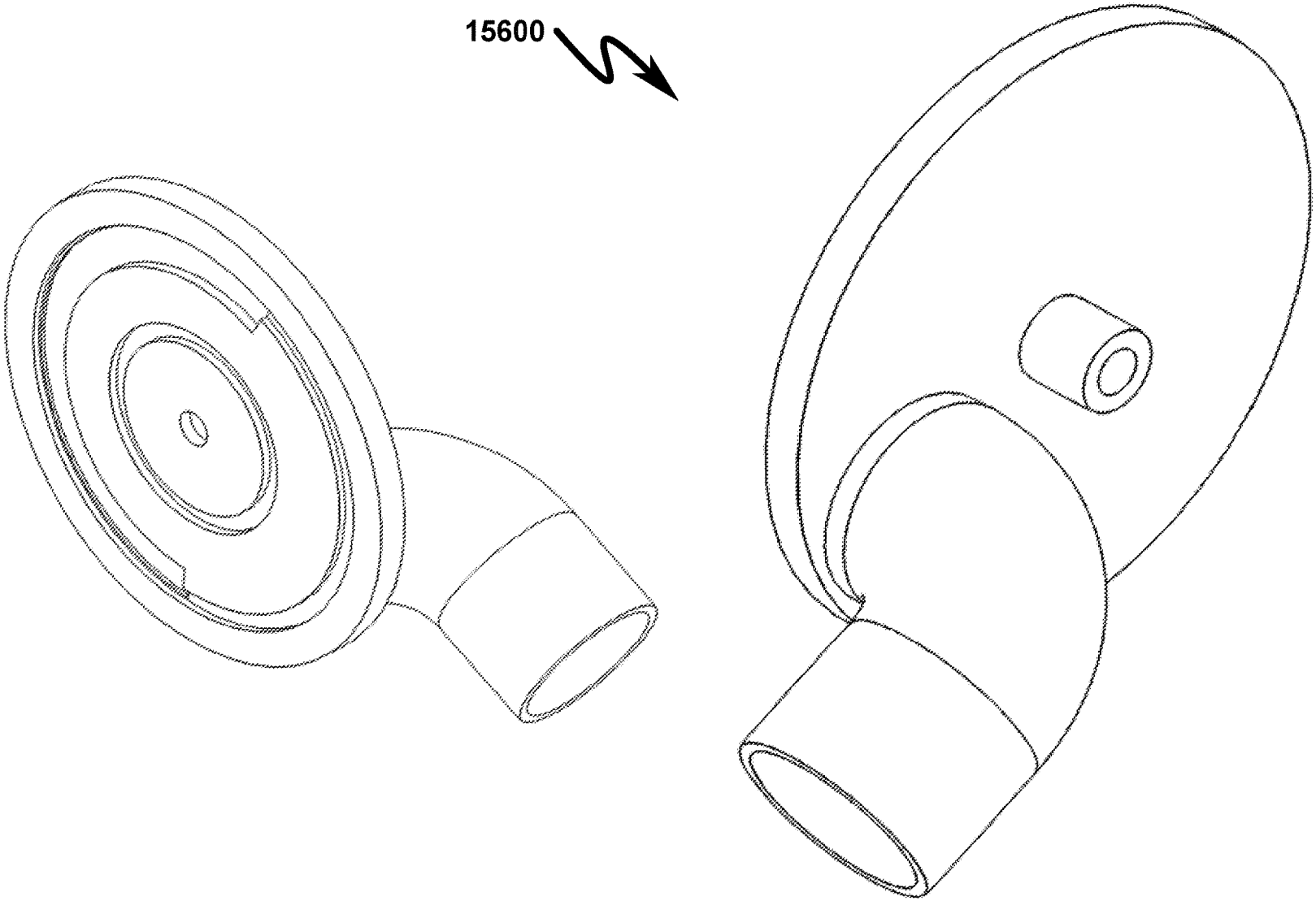
Figure 157:
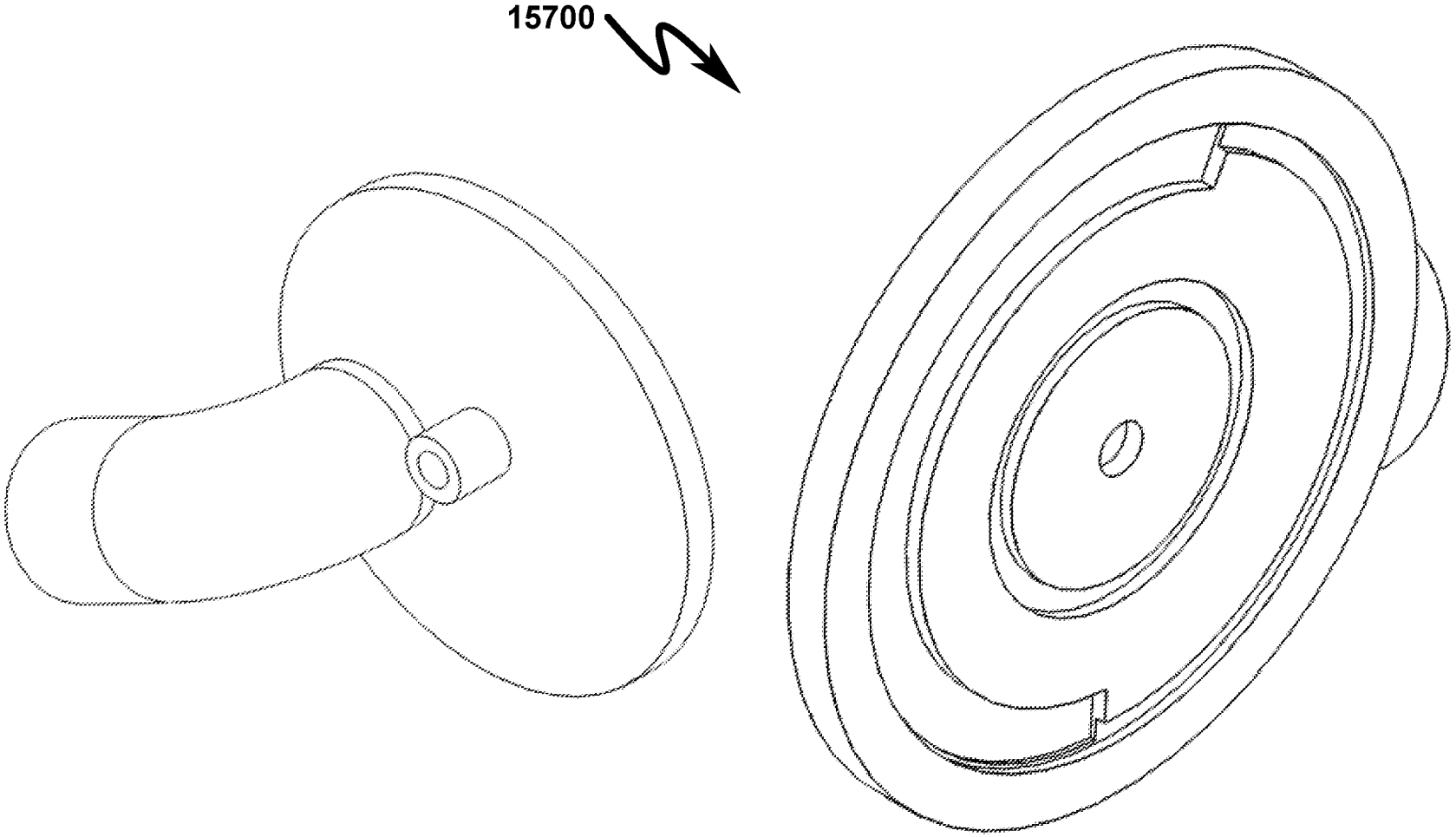
Figure 158:
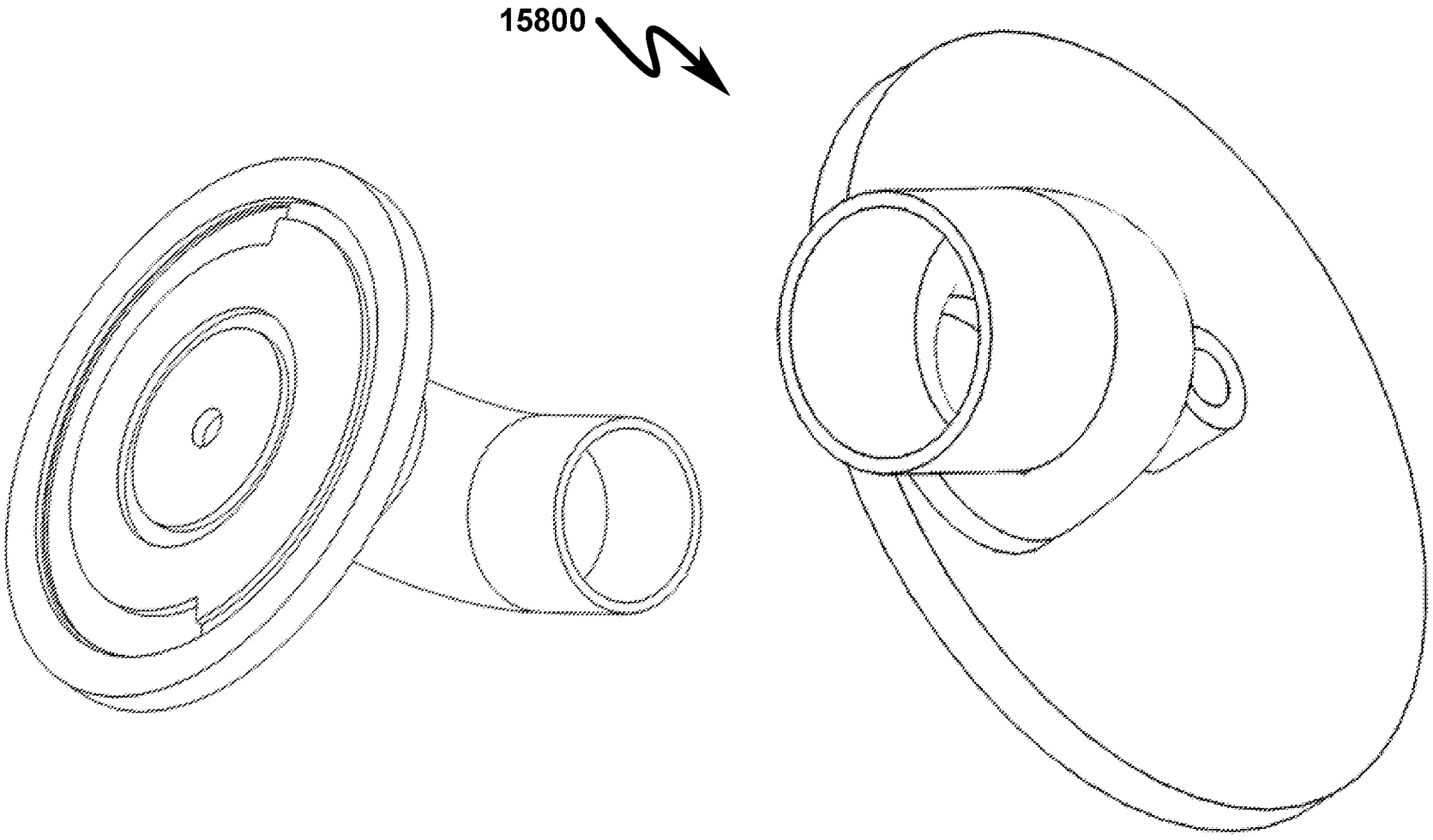
Figure 159:
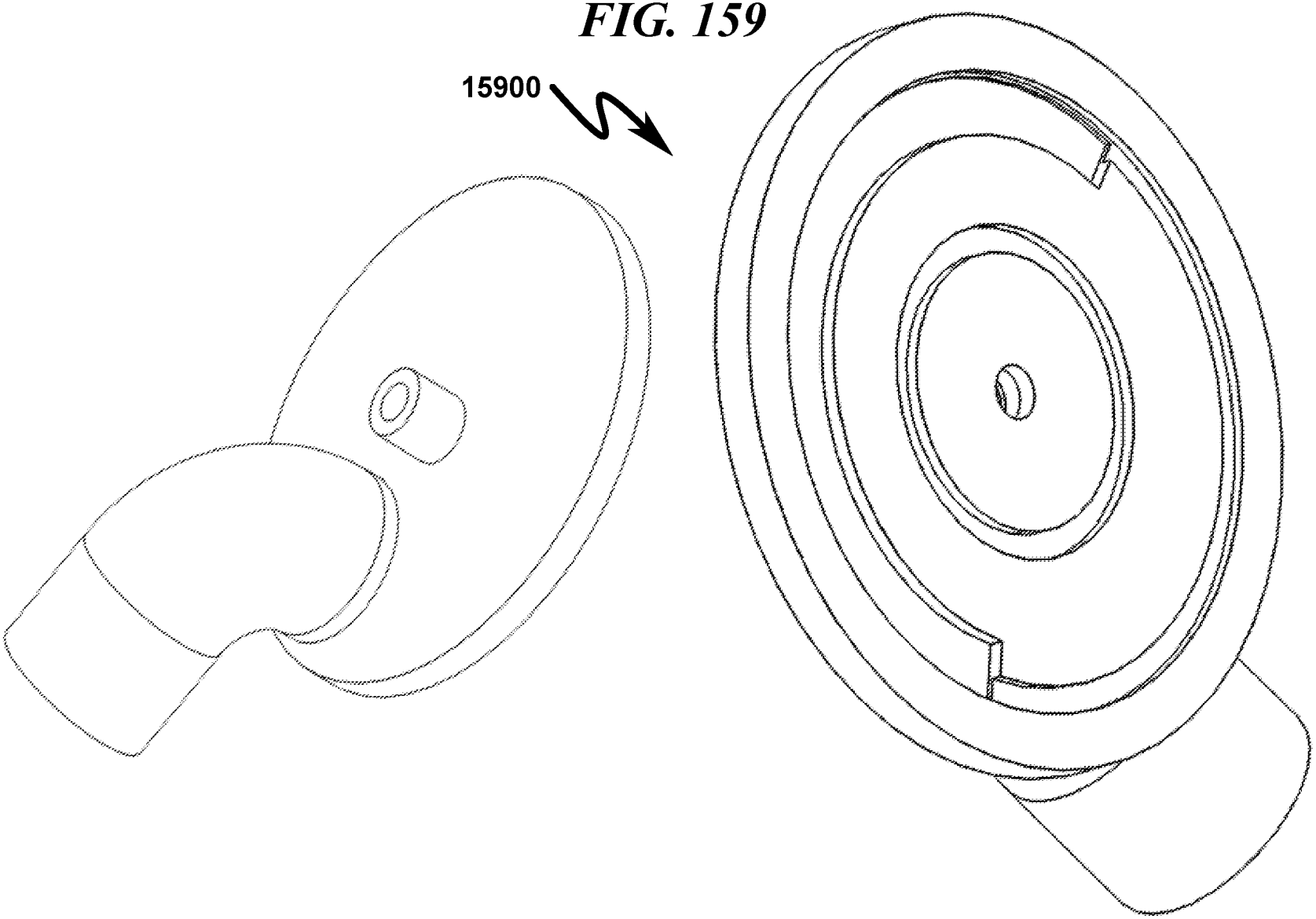
Figure 160:
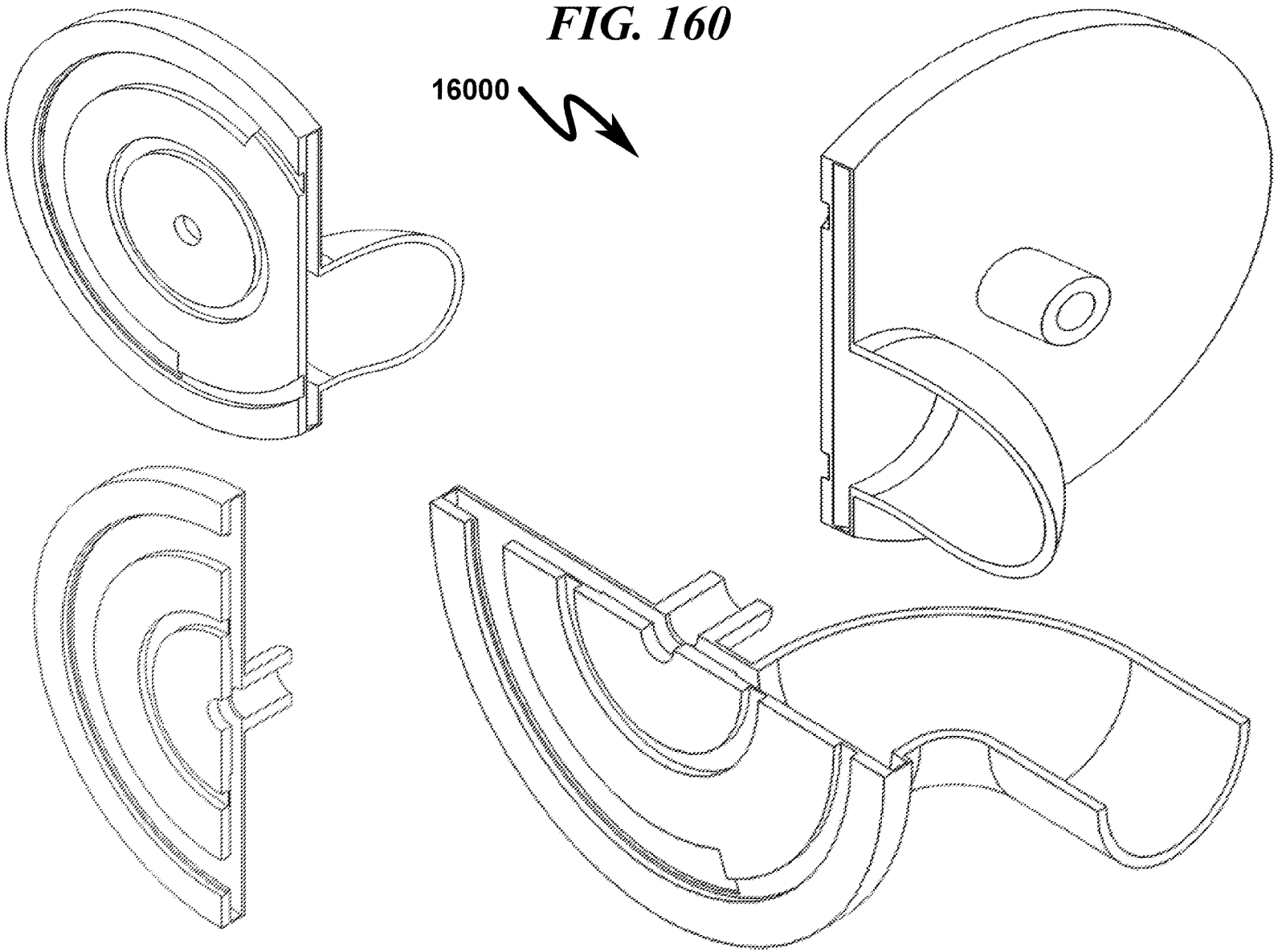
Figure 161:
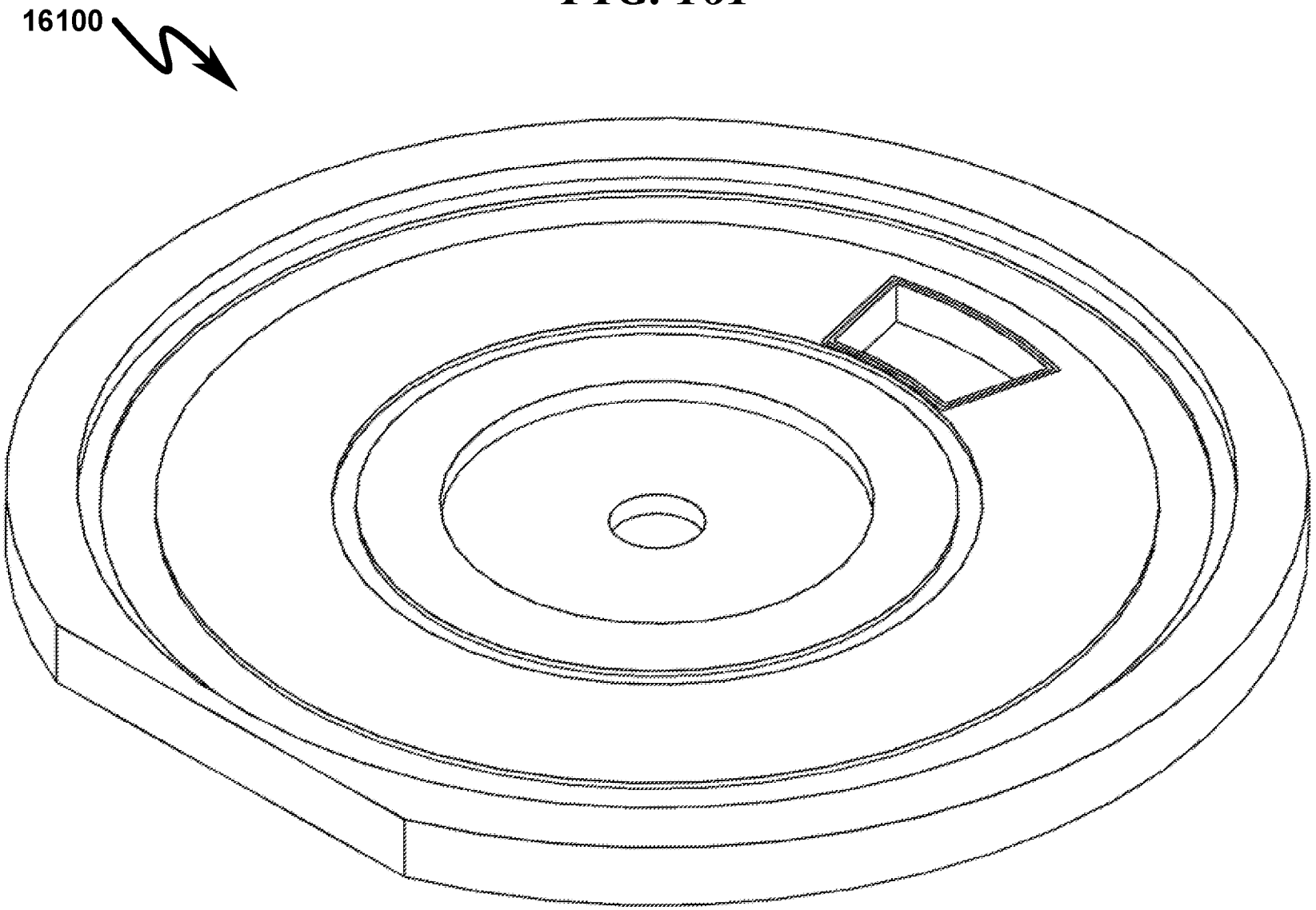
Figure 162:
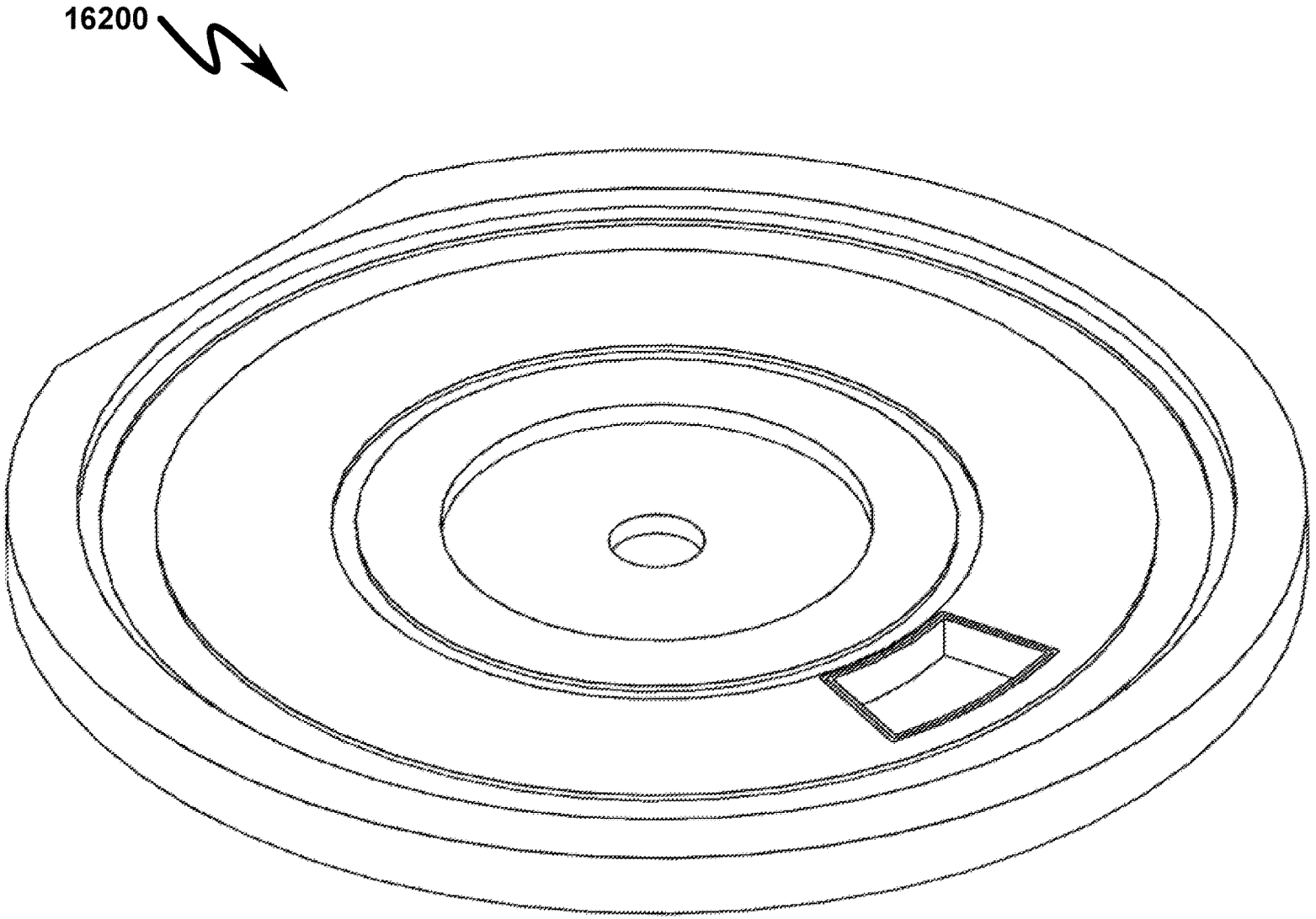
Figure 163:
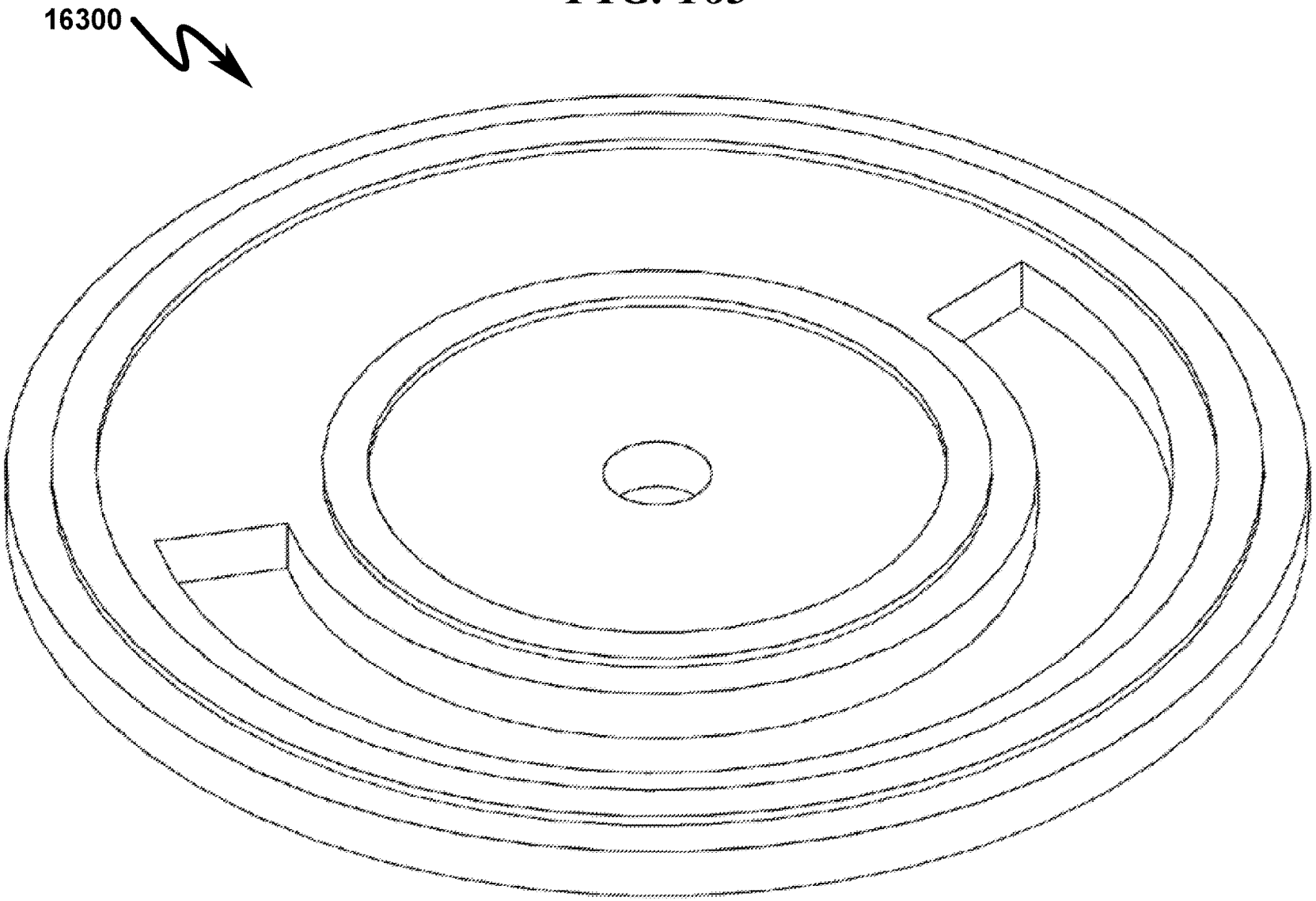
Figure 164:
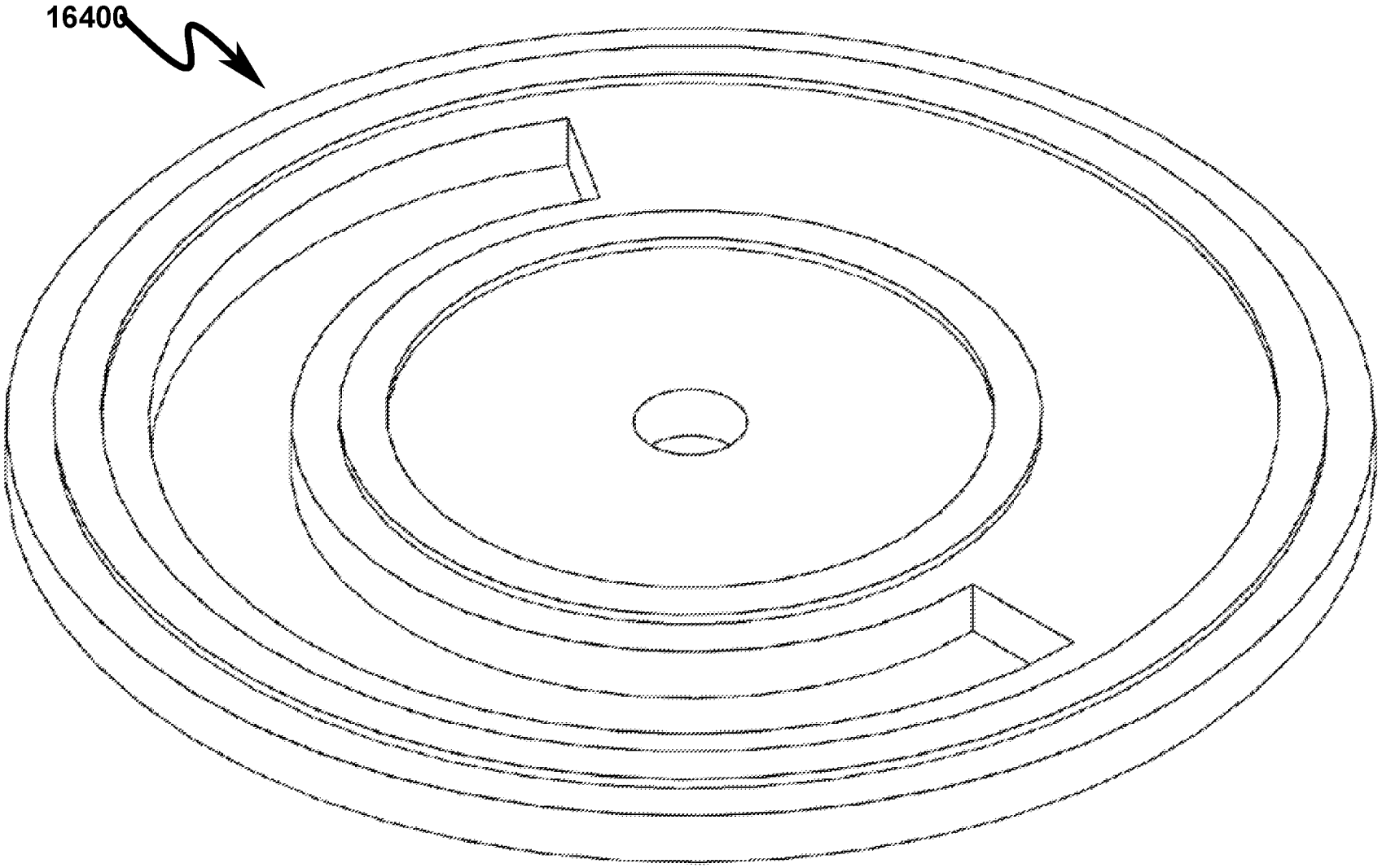
Figure 165:
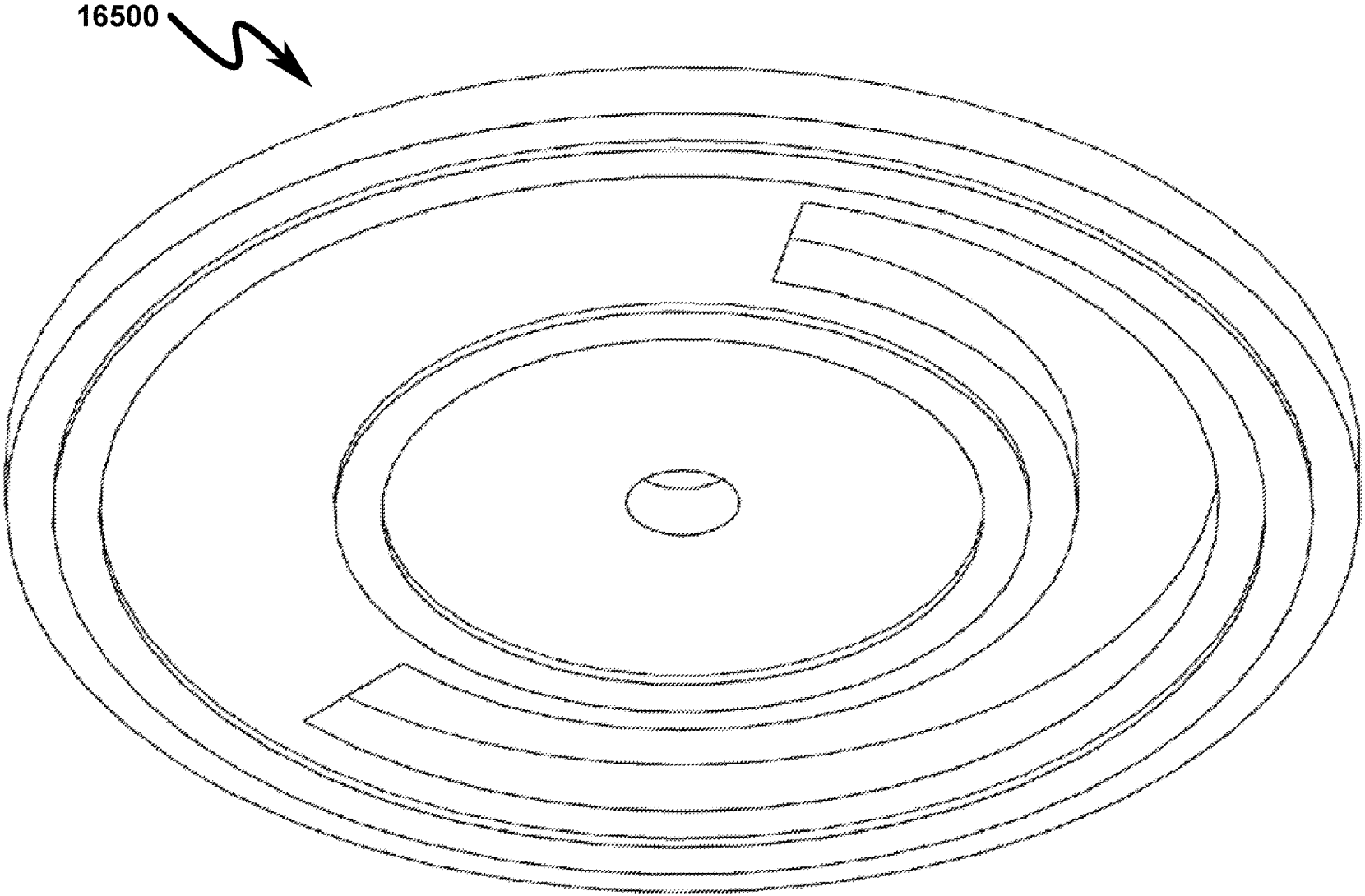
Figure 166:
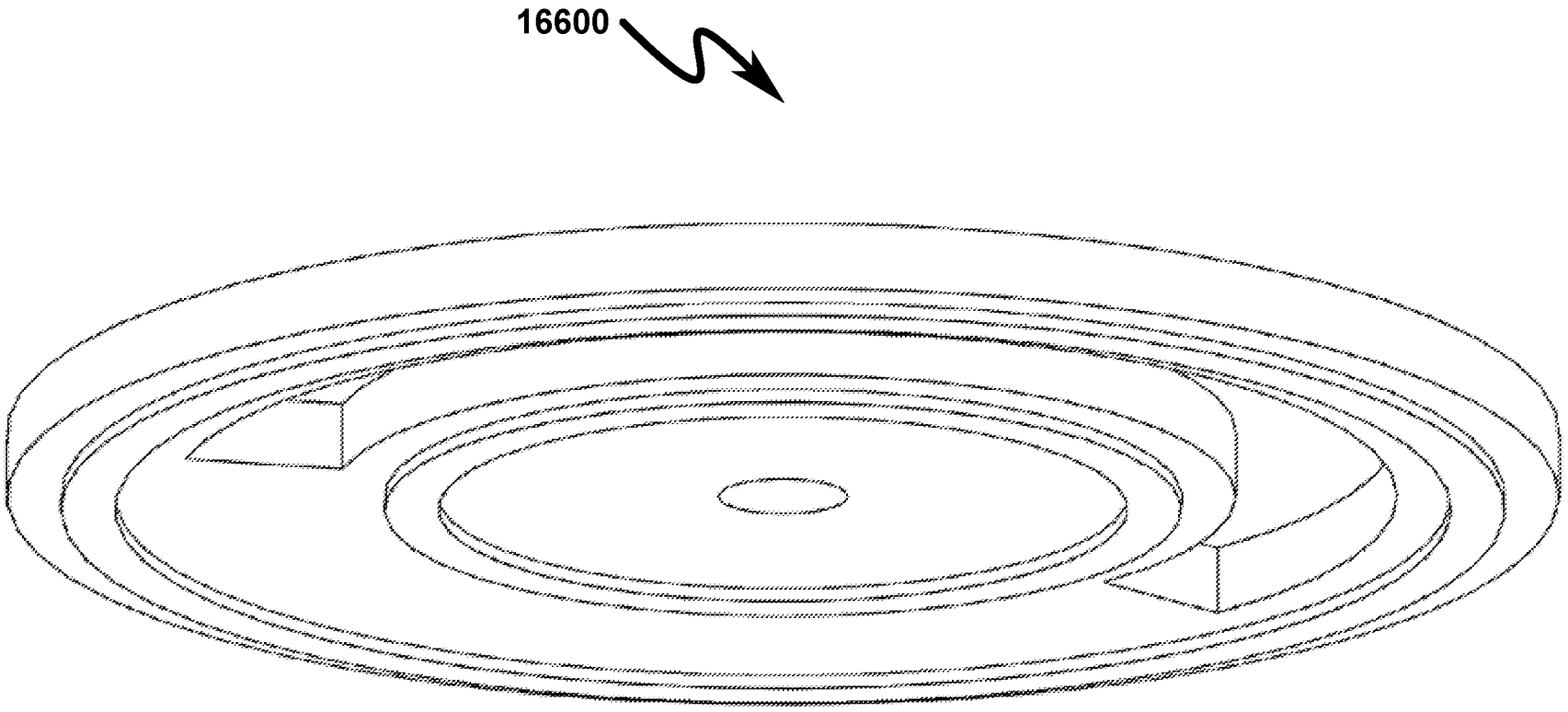
Figure 167:
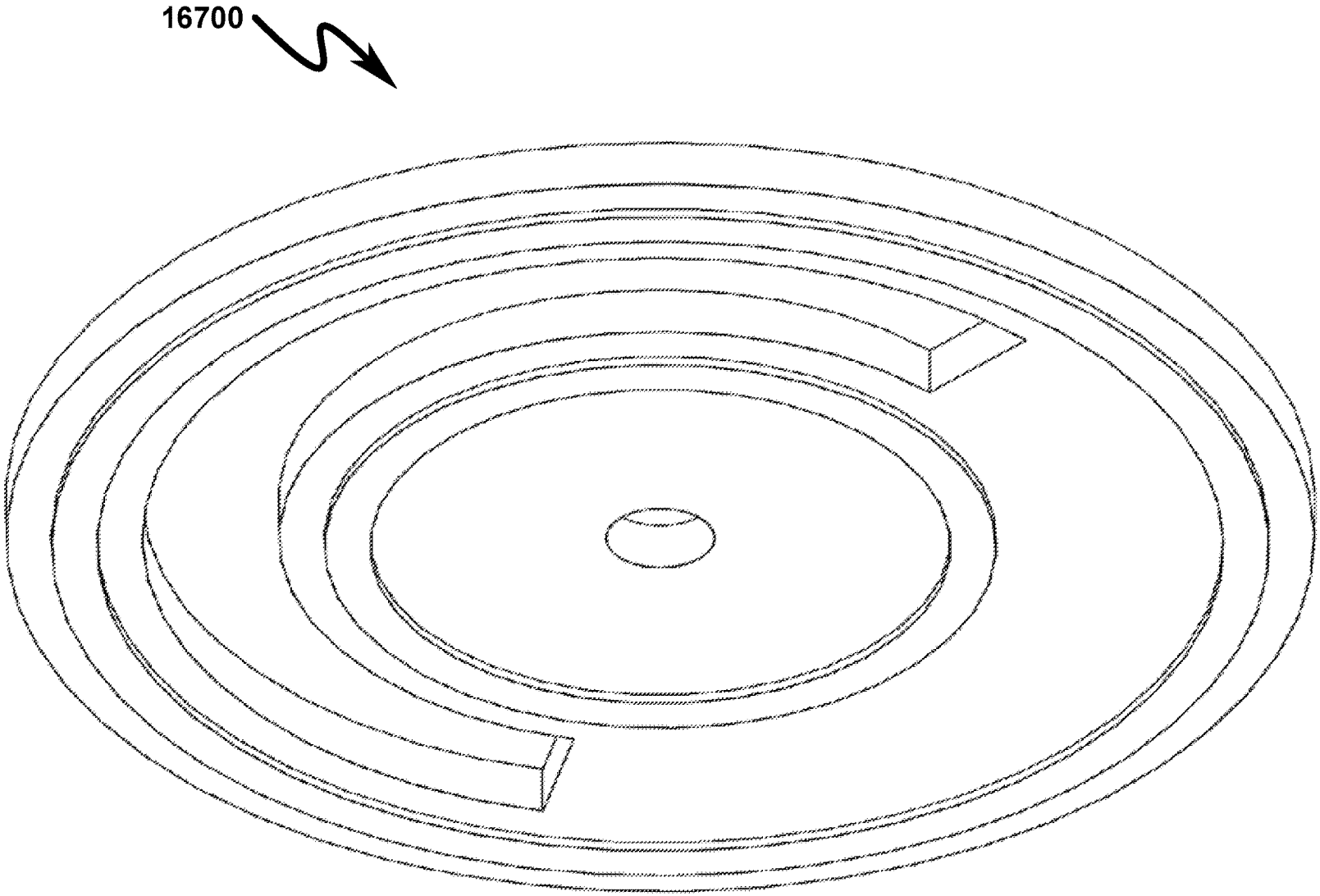
Figure 168:
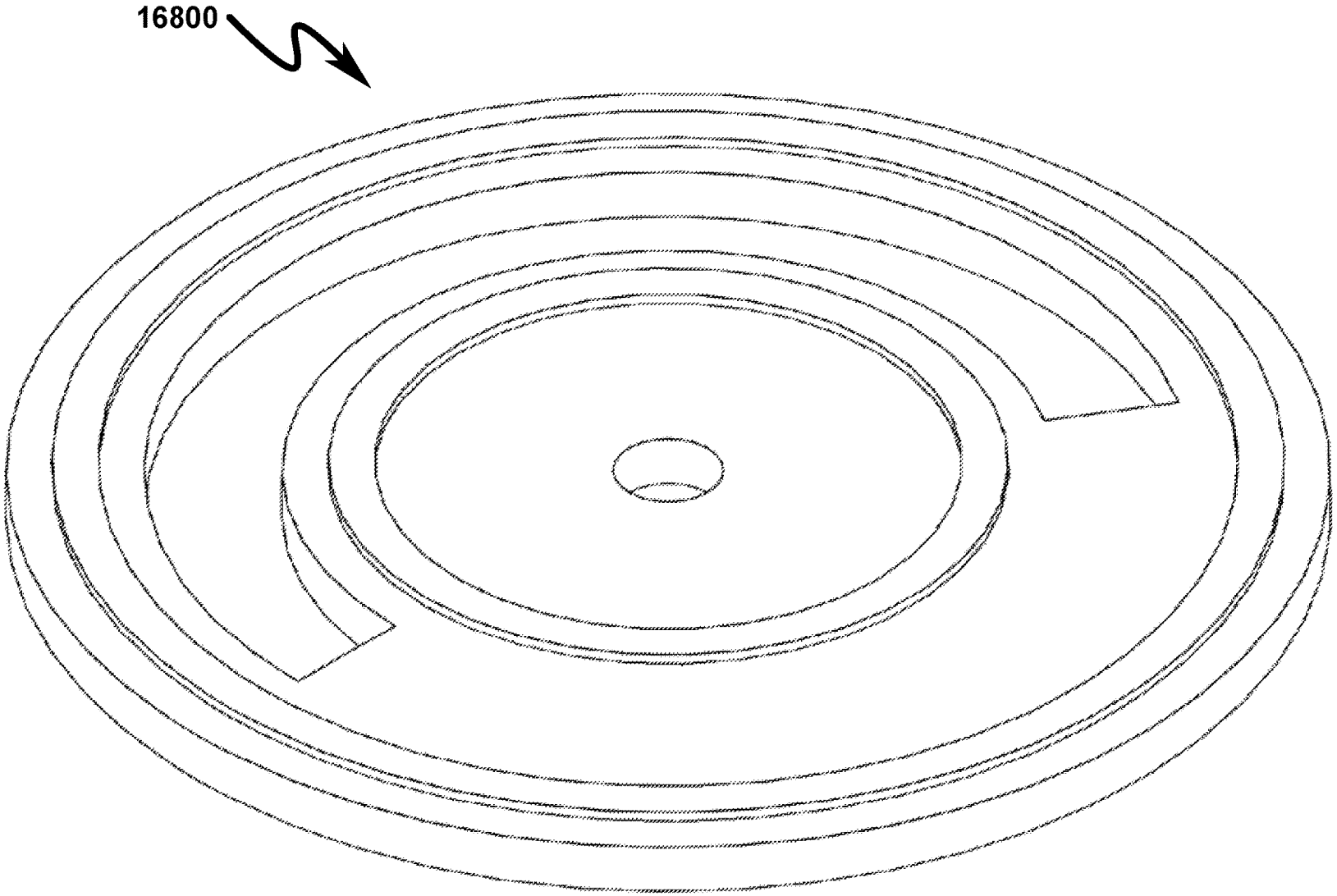
Figure 169:
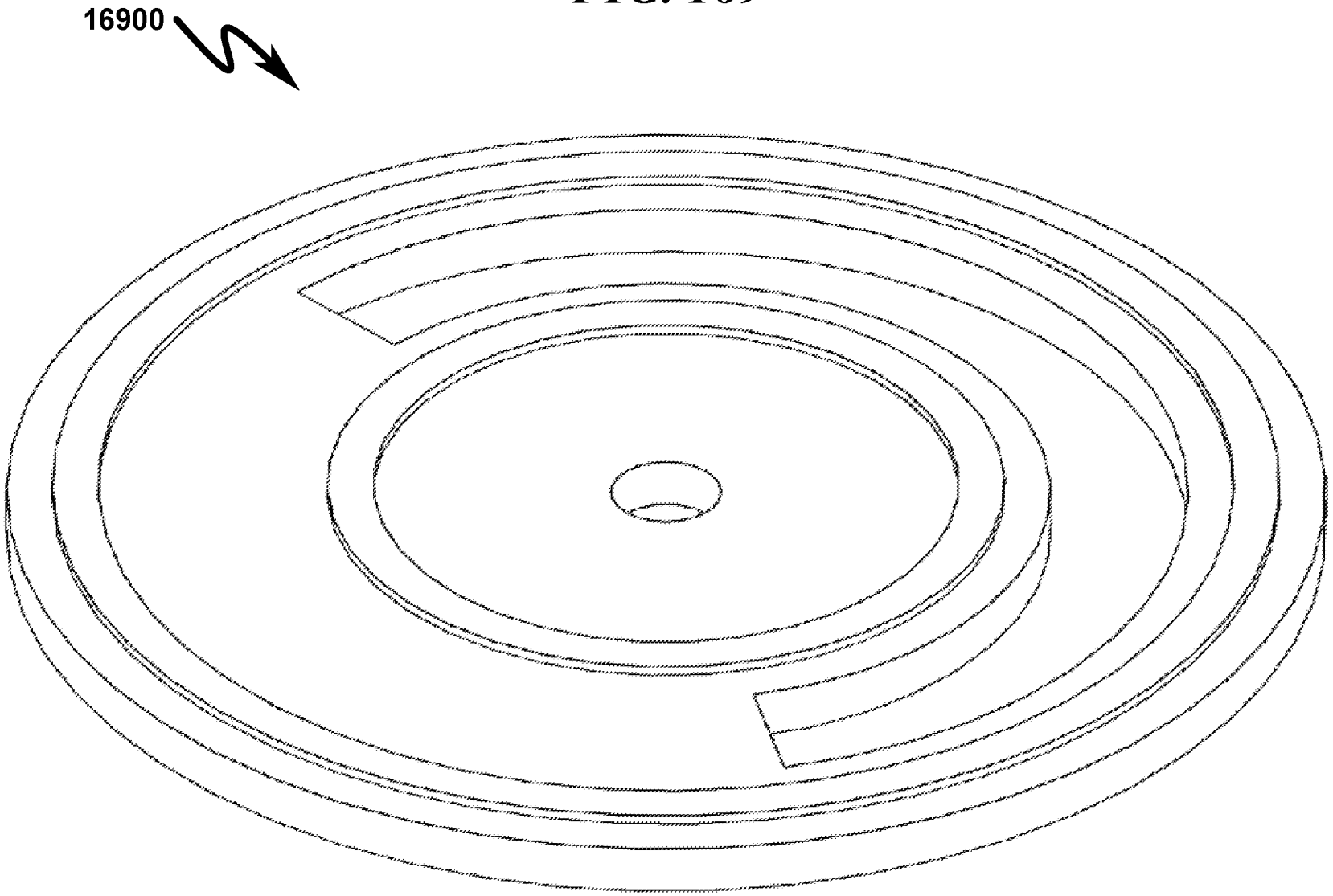
Figure 170:
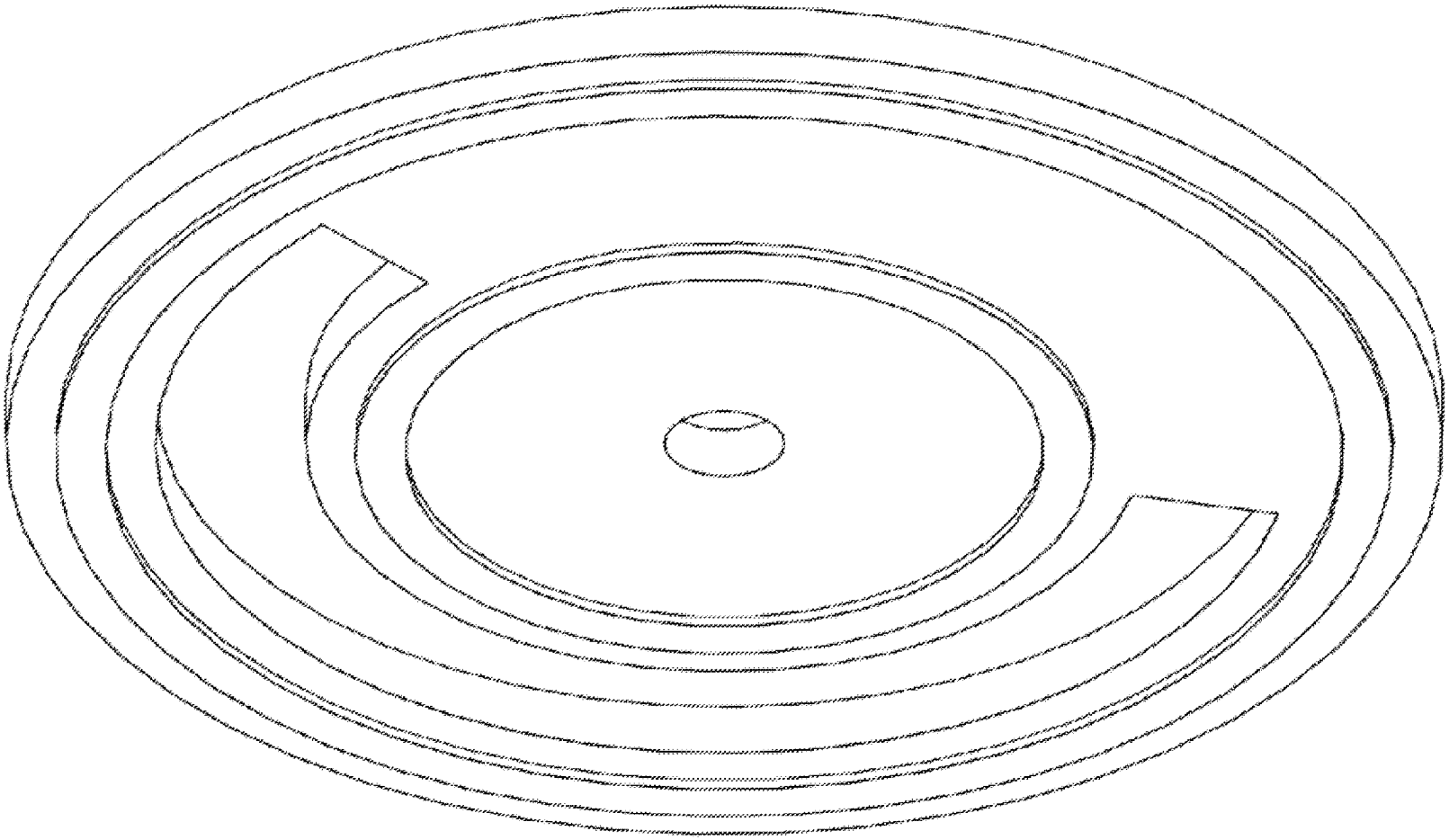
Figure 171:
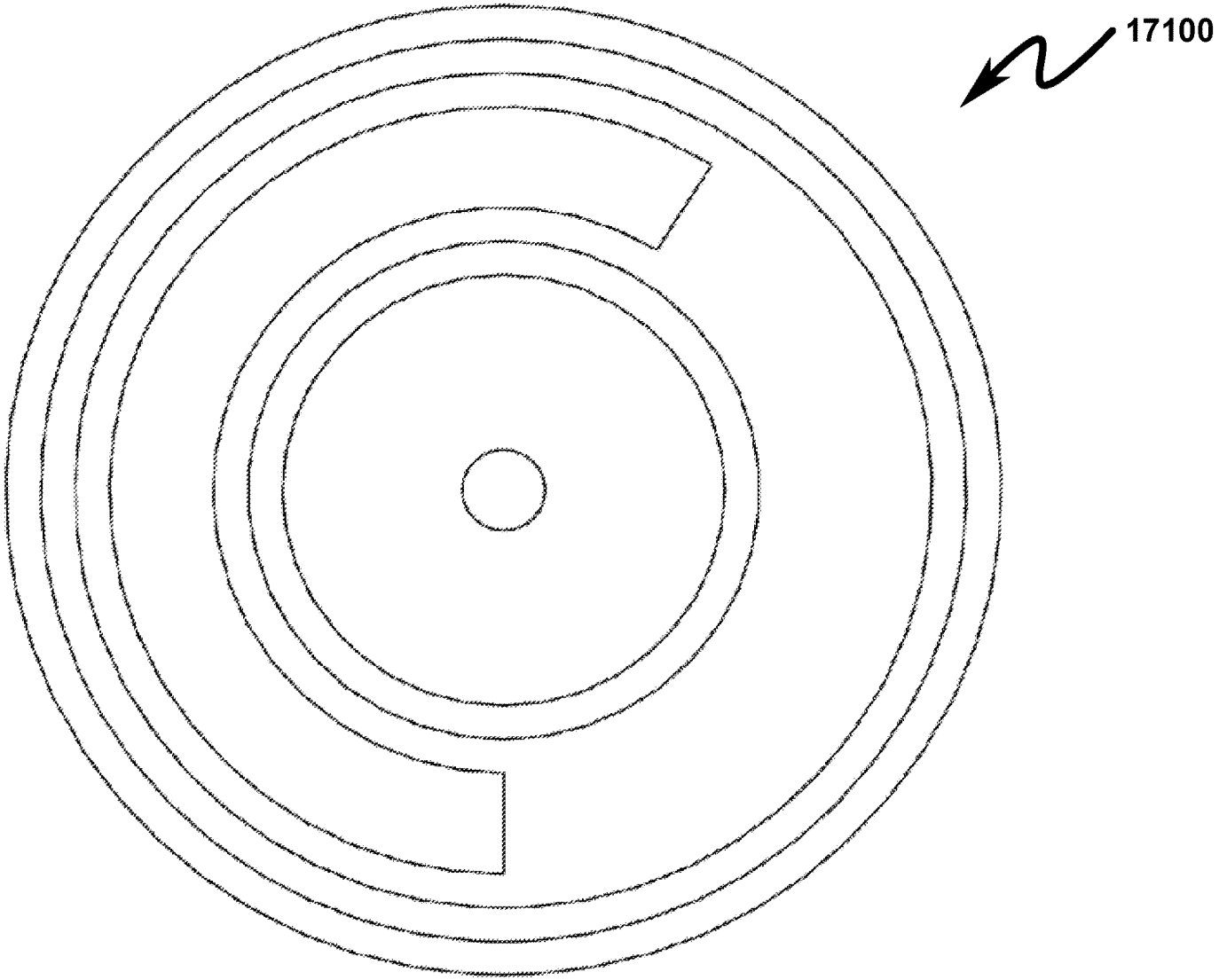
Figure 172:
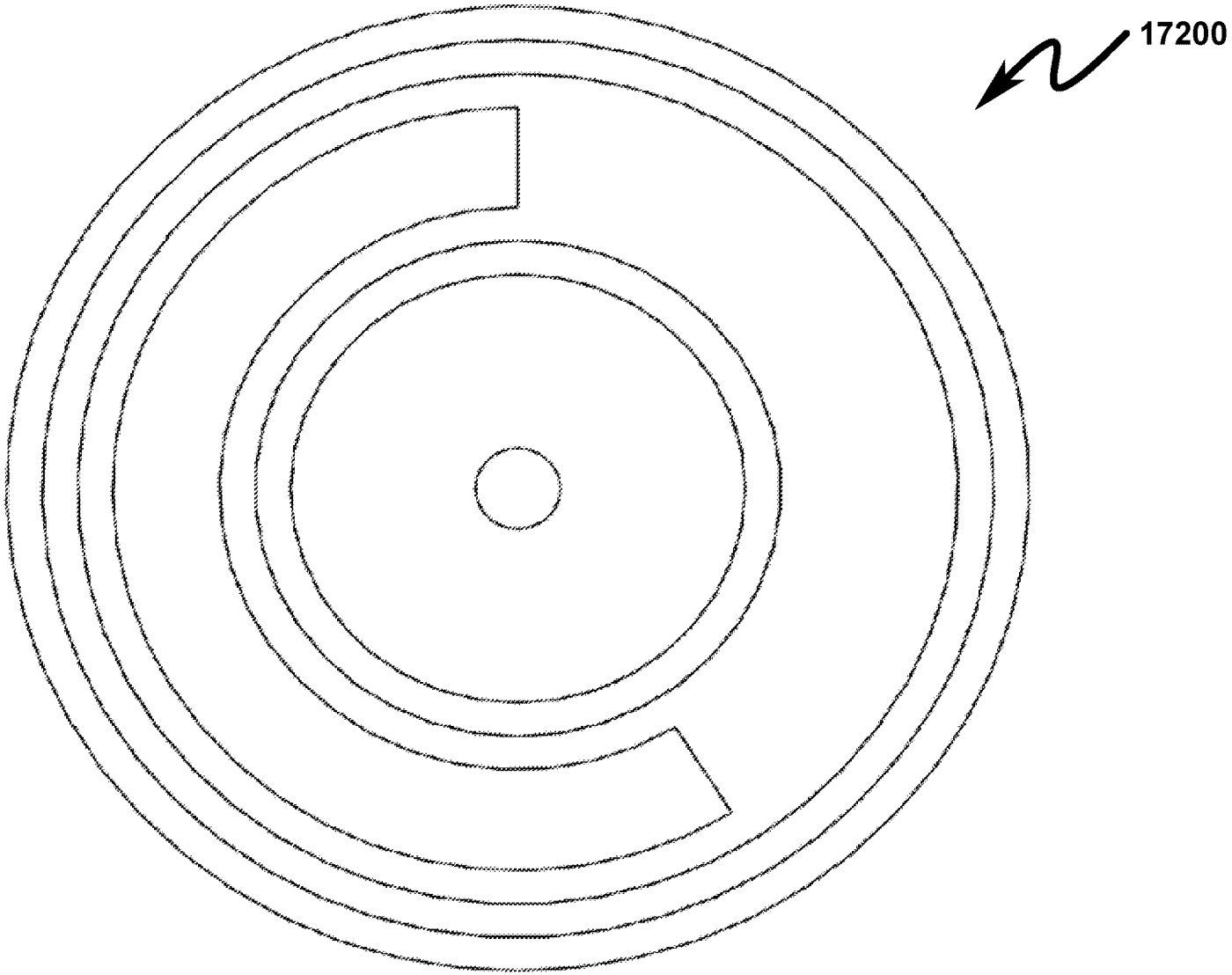
Figure 173:
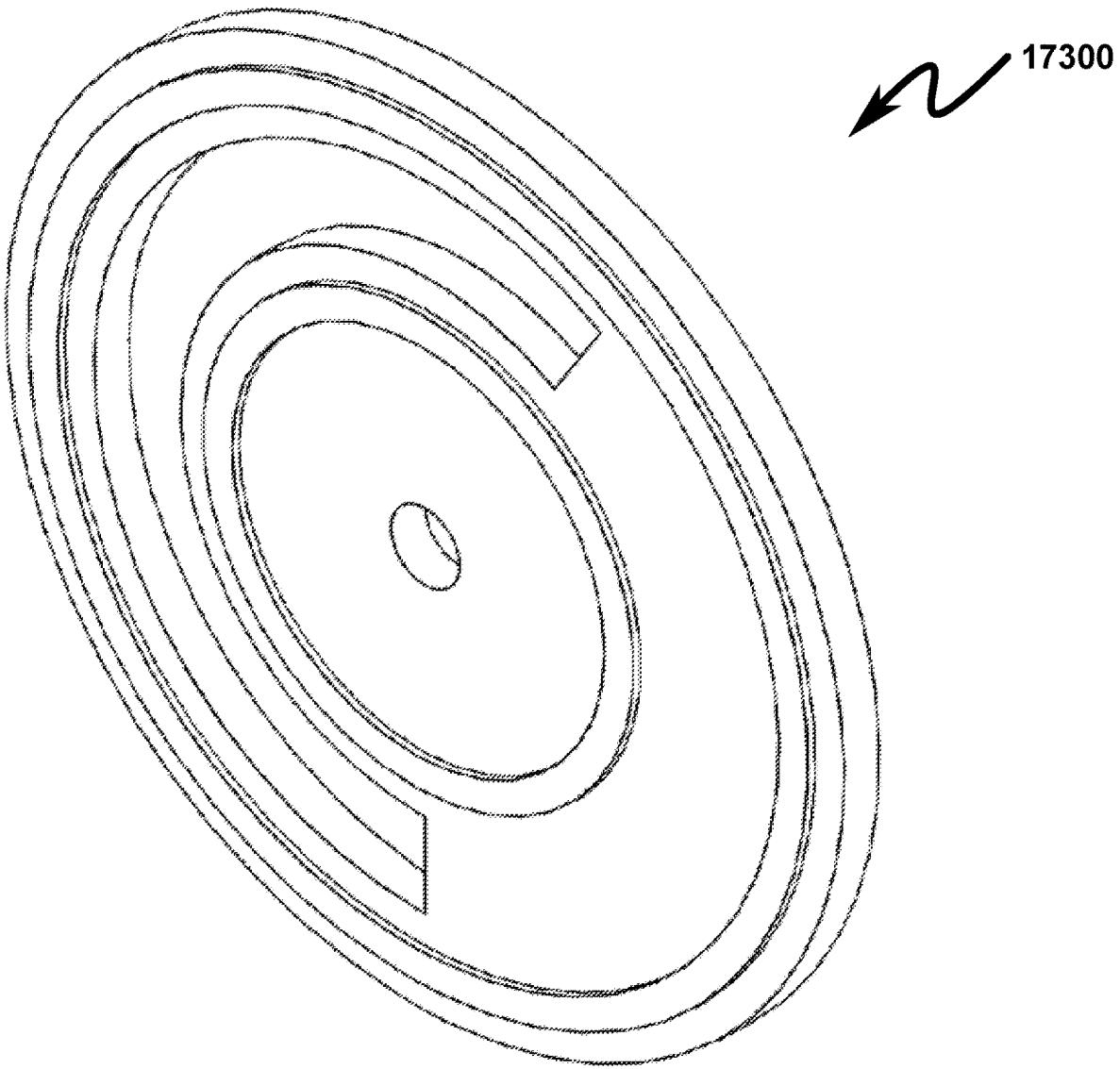
Figure 174:
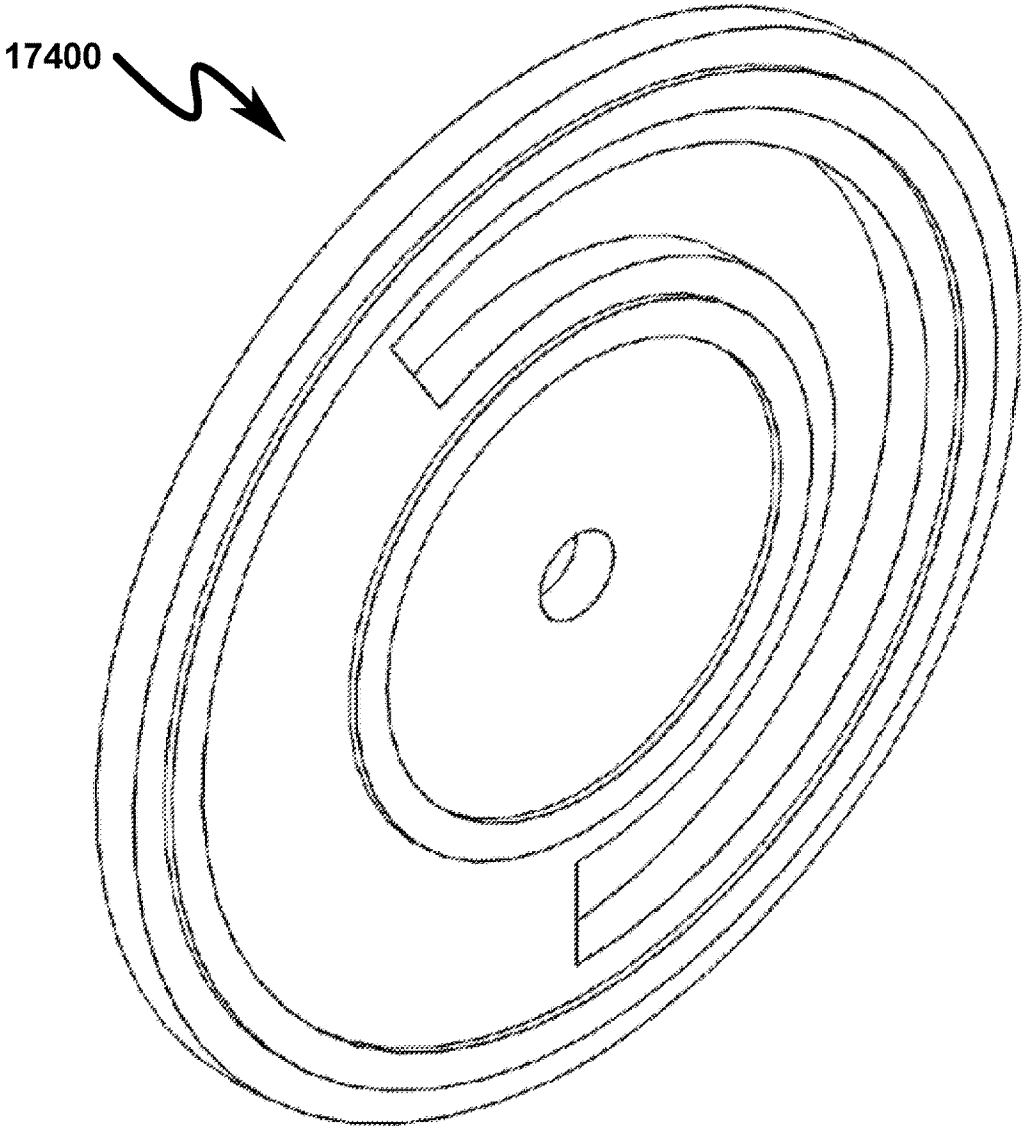
Figure 175:
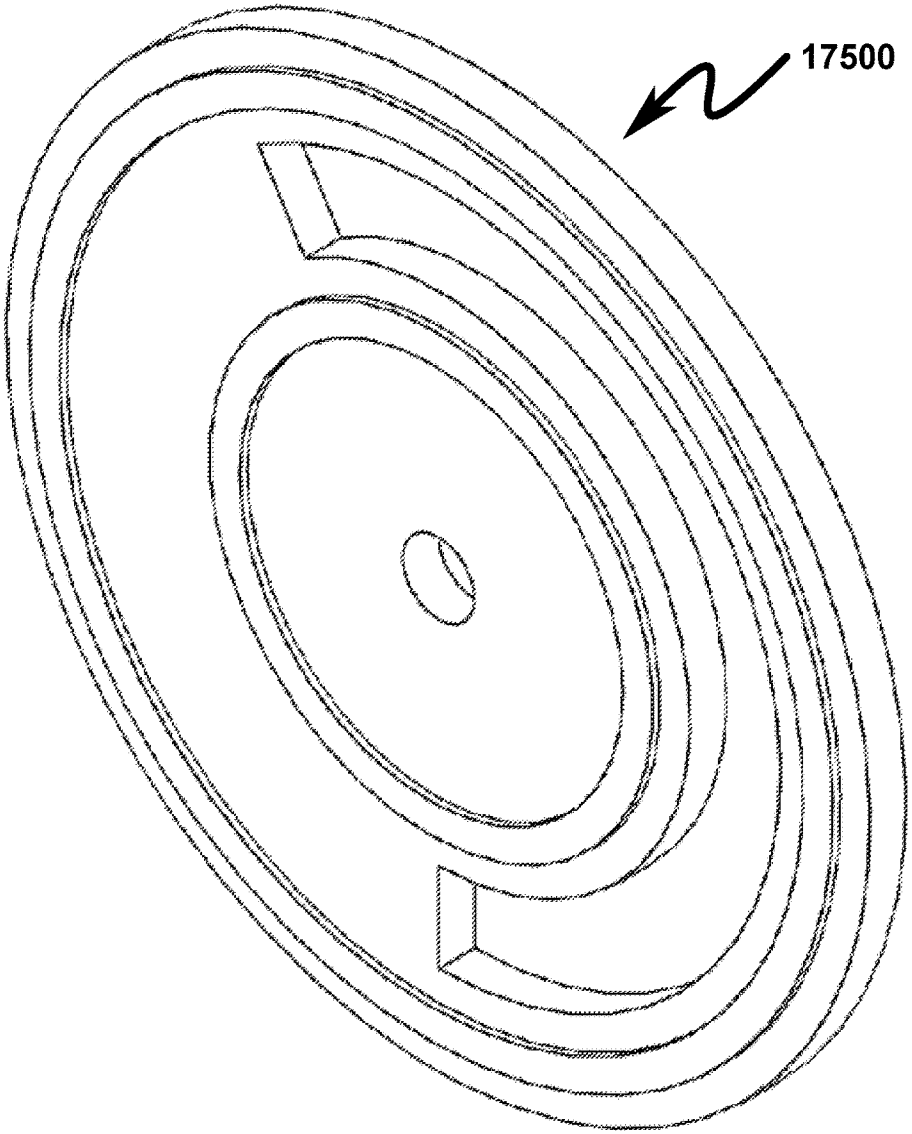
Figure 176:
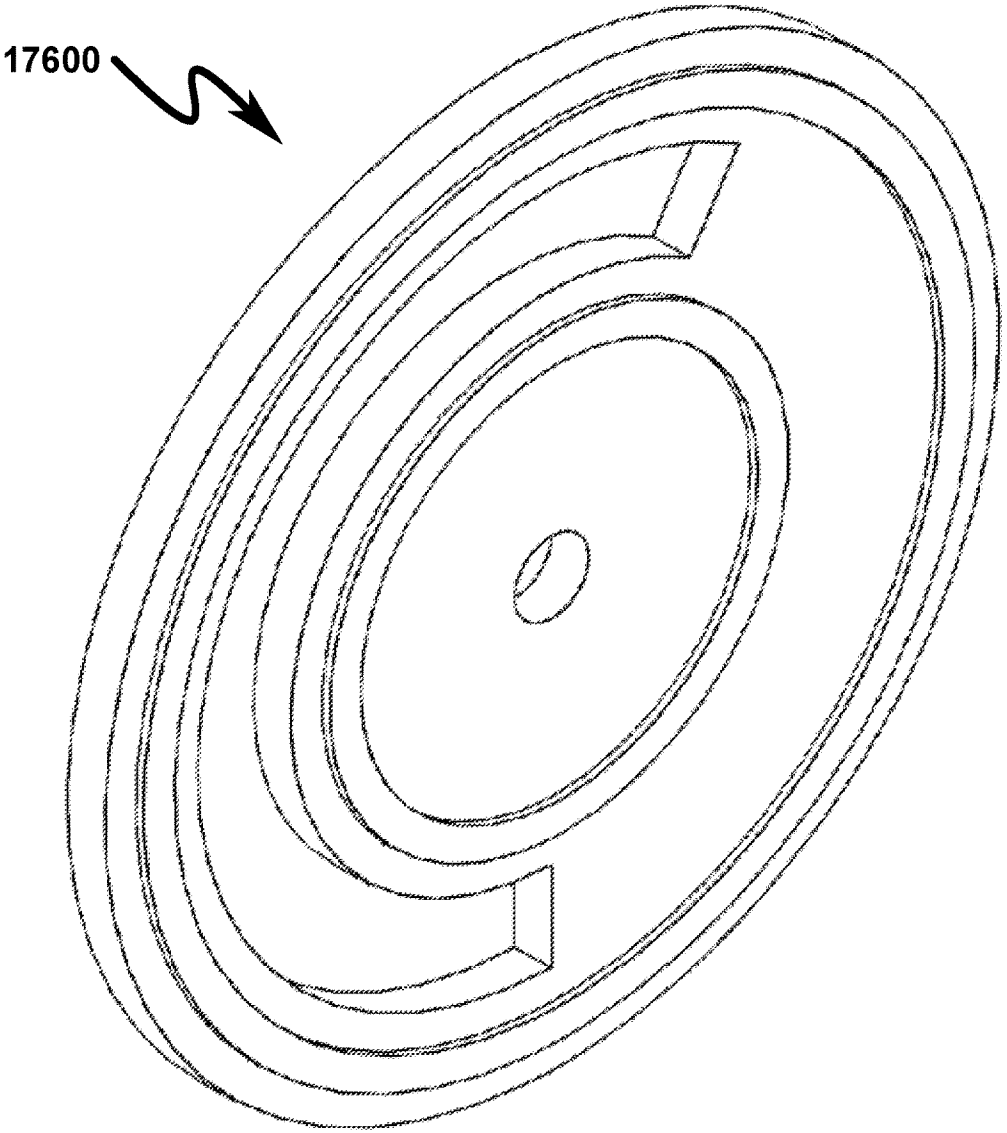
Figure 177:
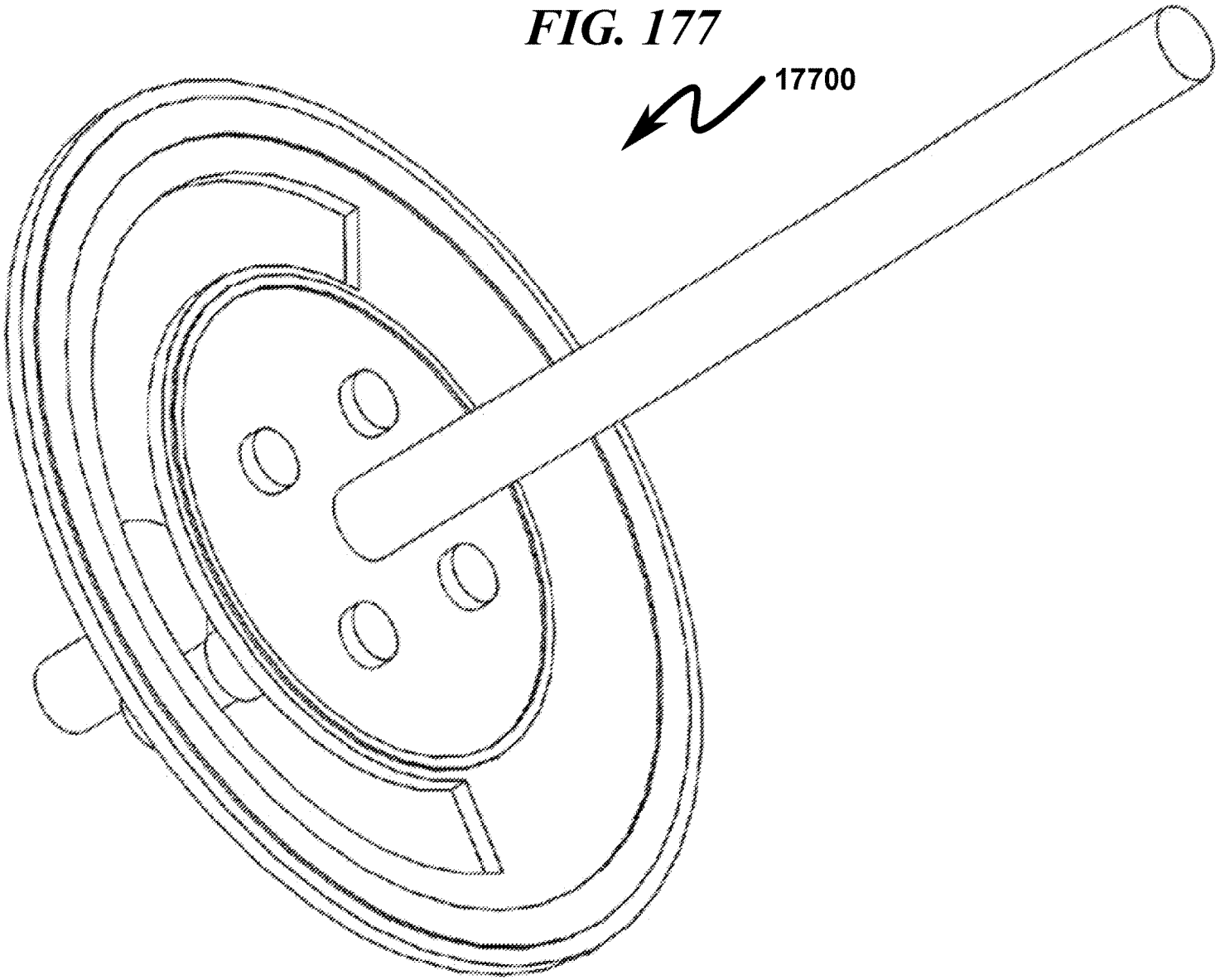
Figure 178:
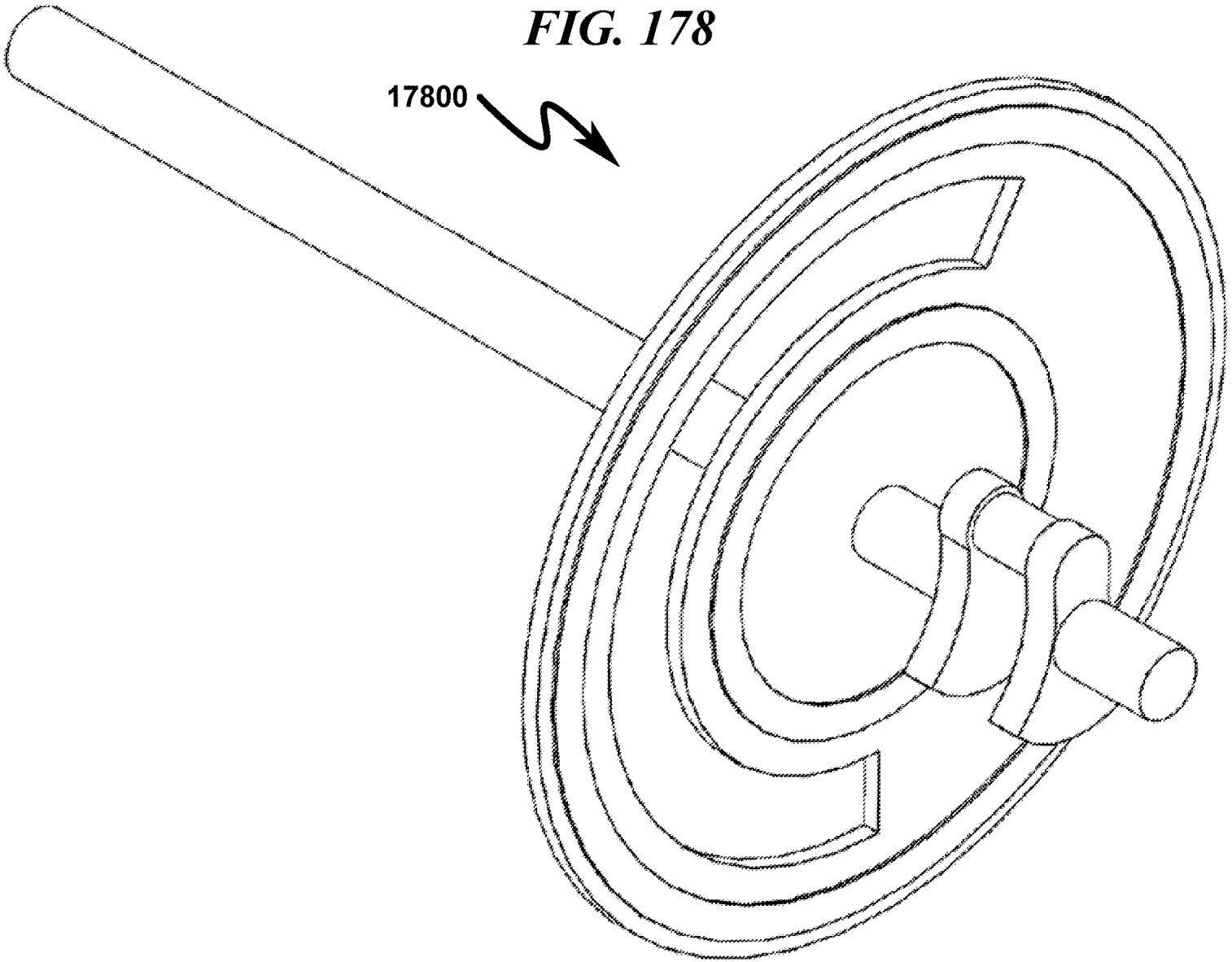
Figure 179:
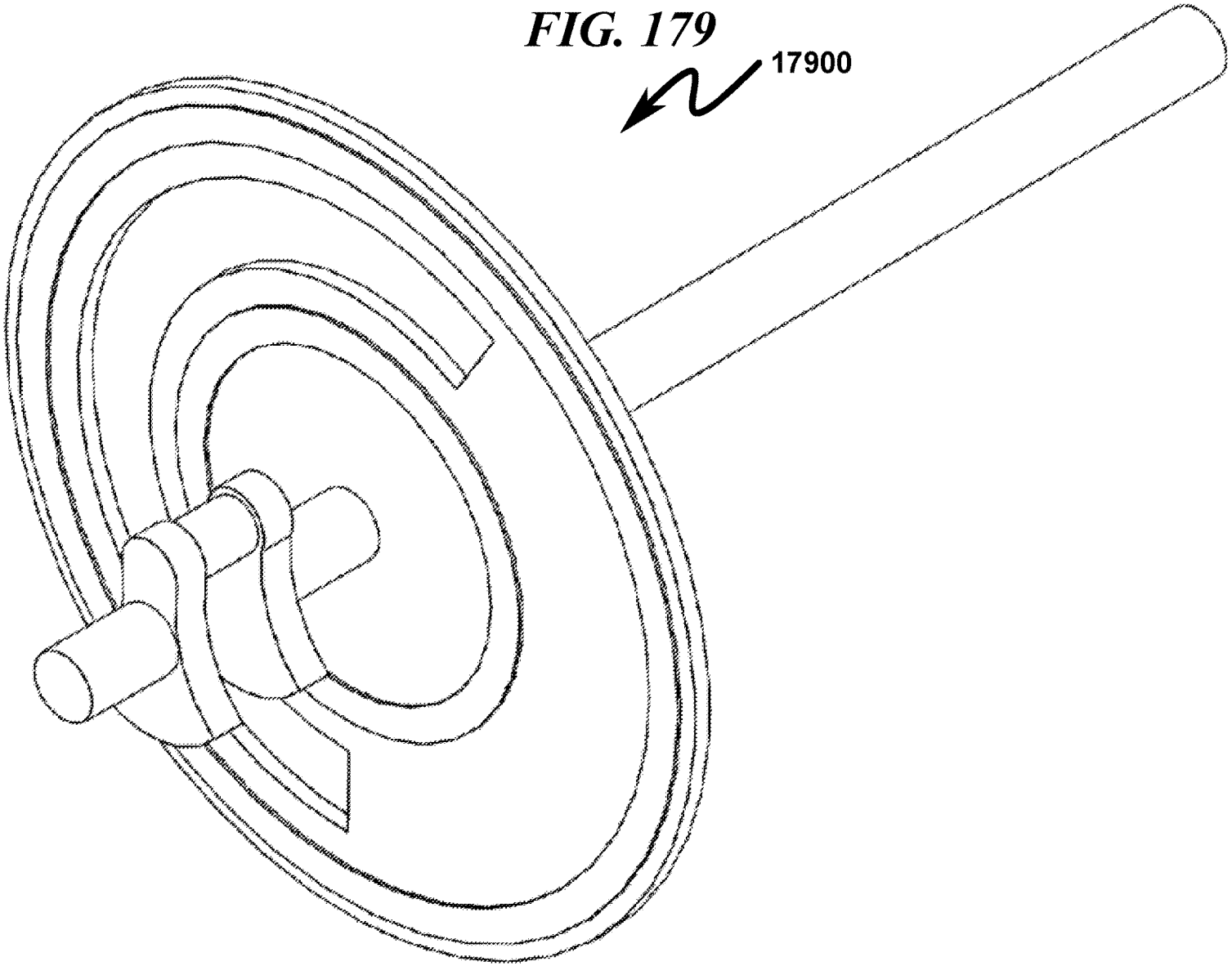
Figure 180:
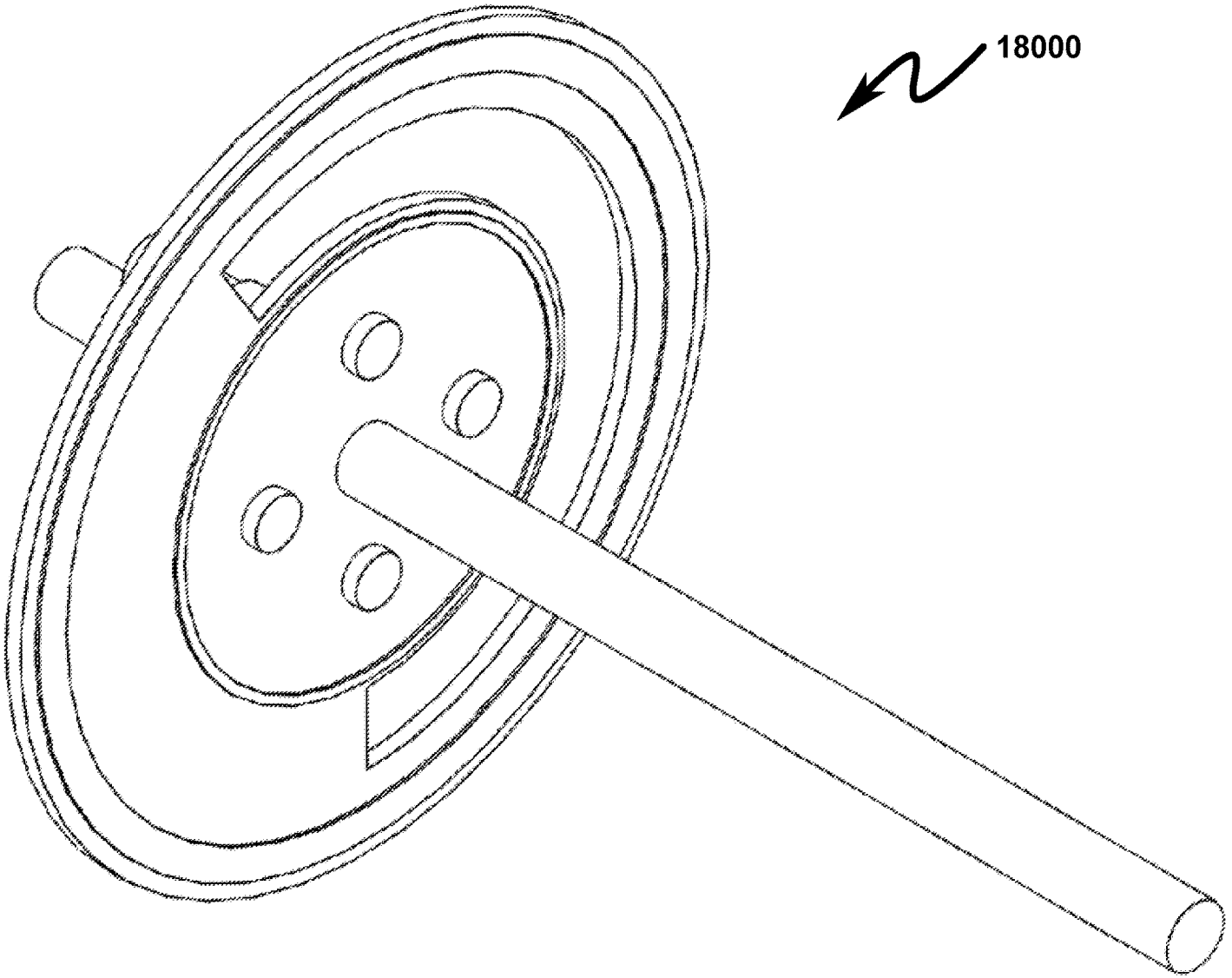
Figure 181:
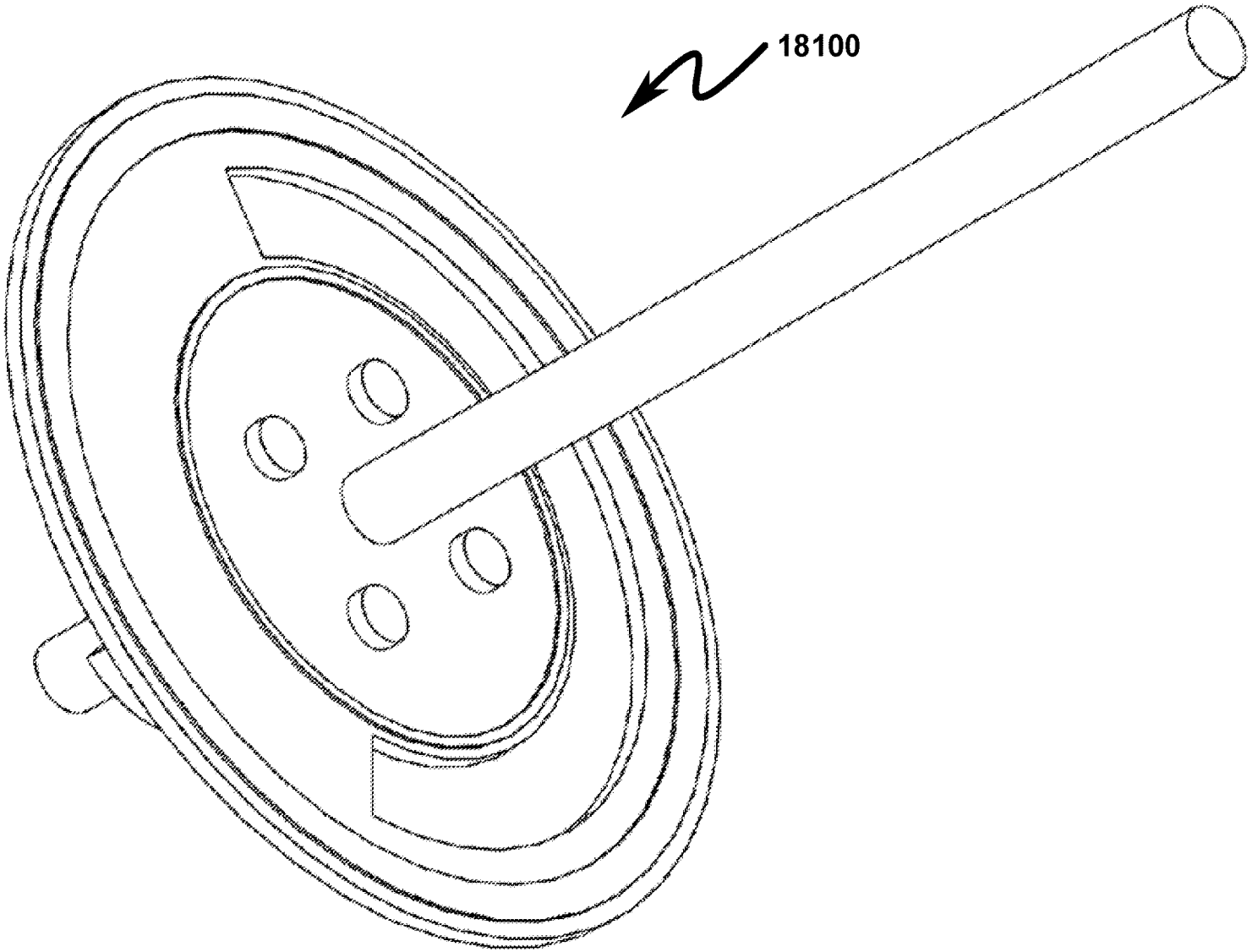
Figure 182:
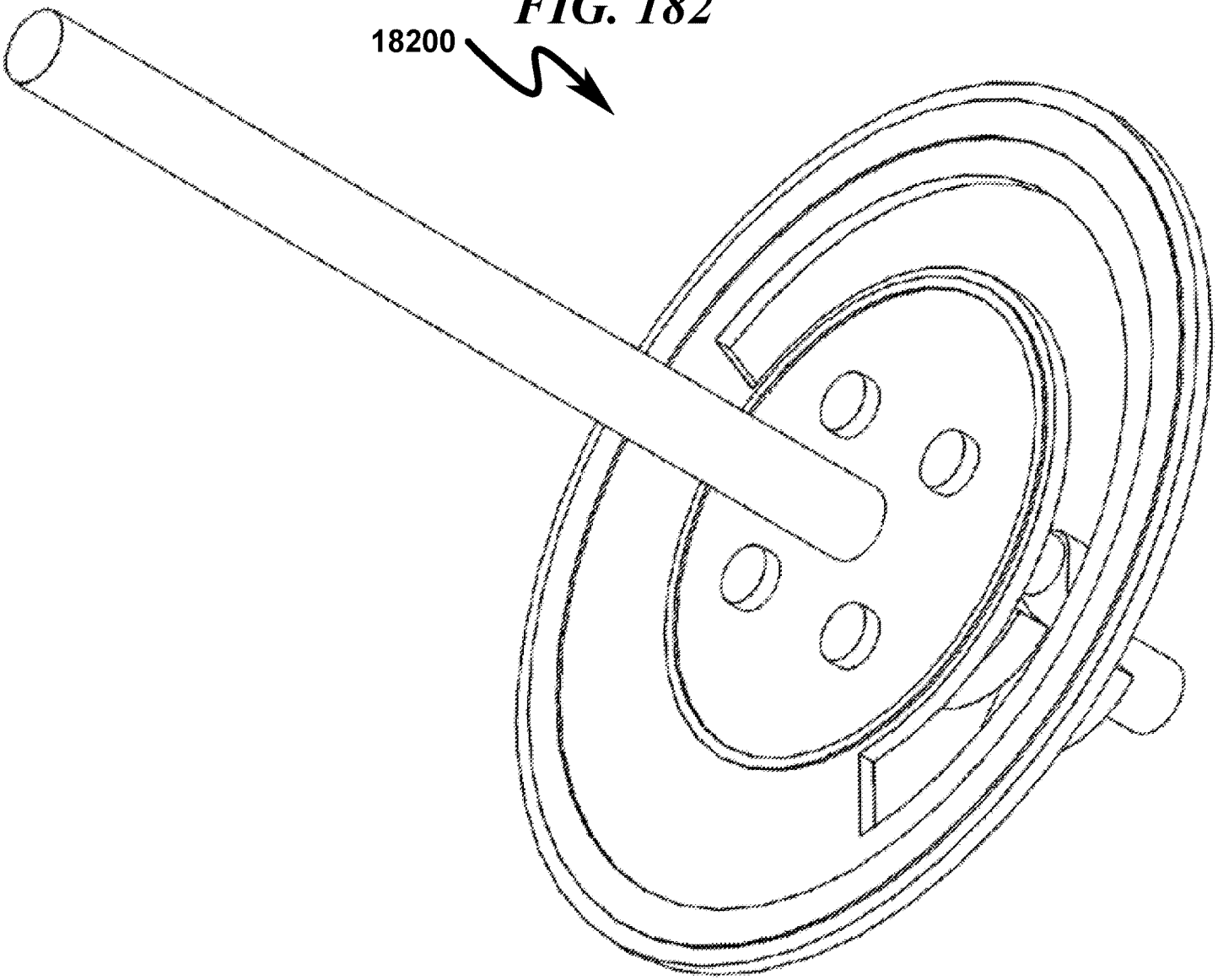
Figure 183:
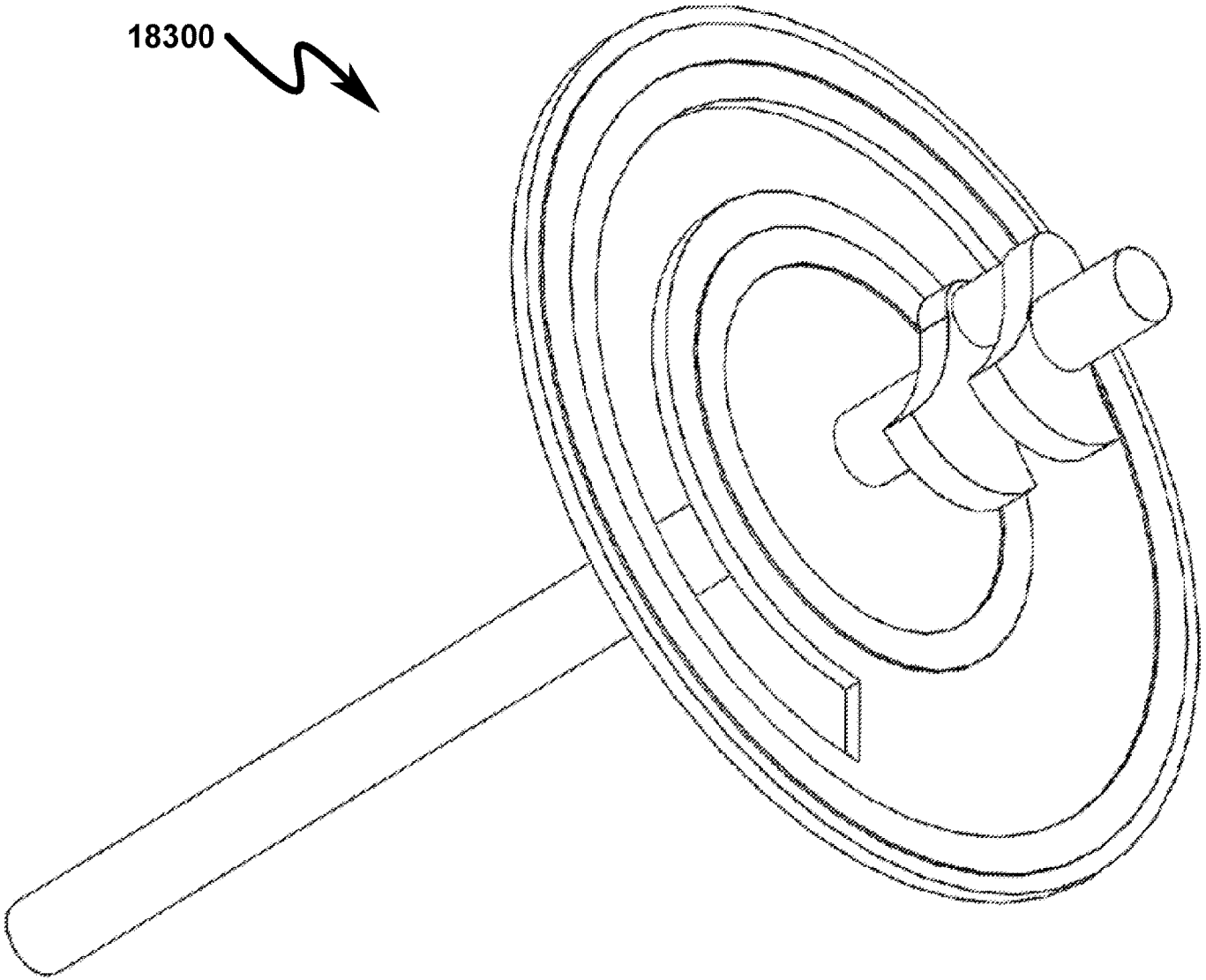
Figure 184:
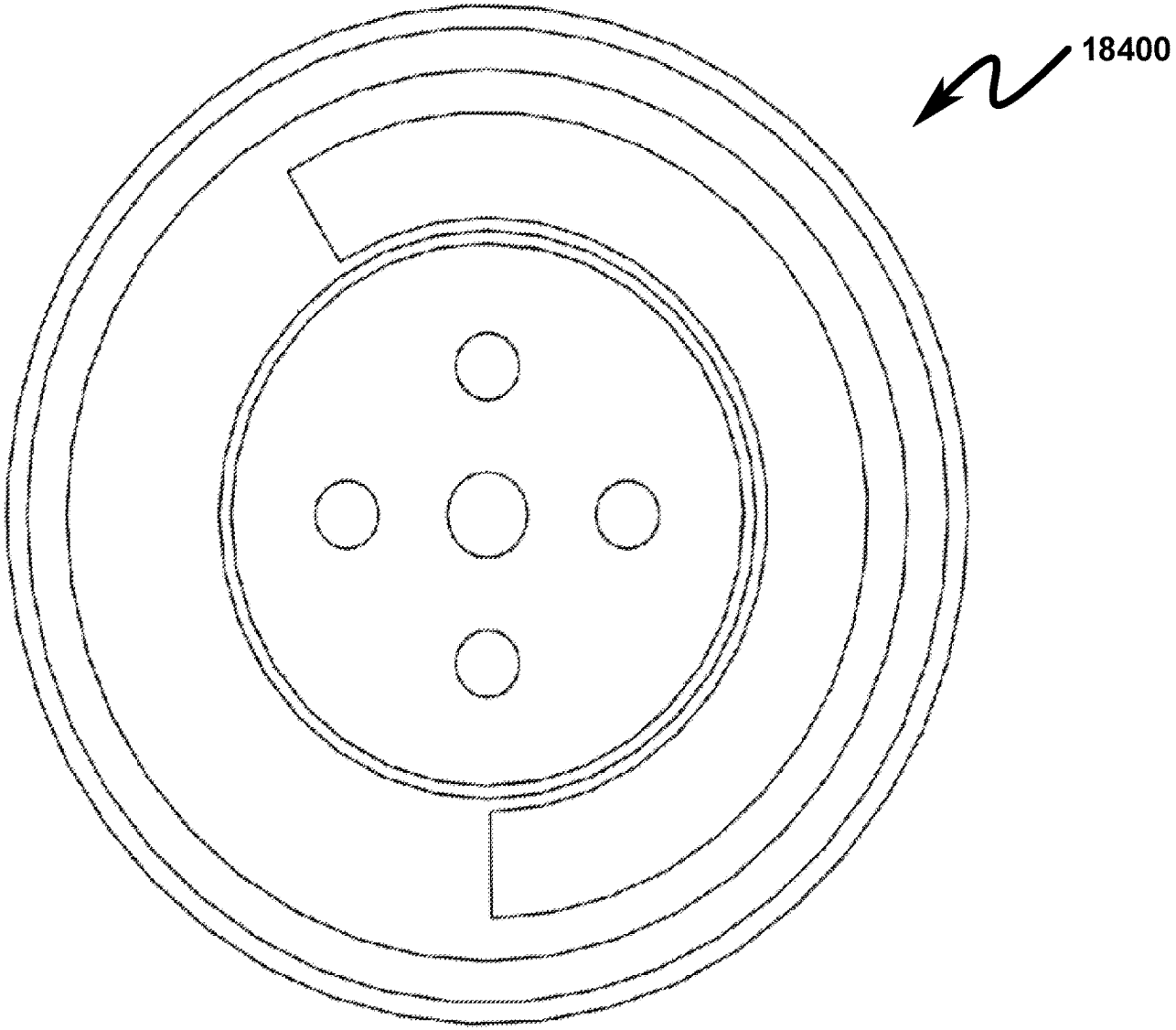
Figure 185:
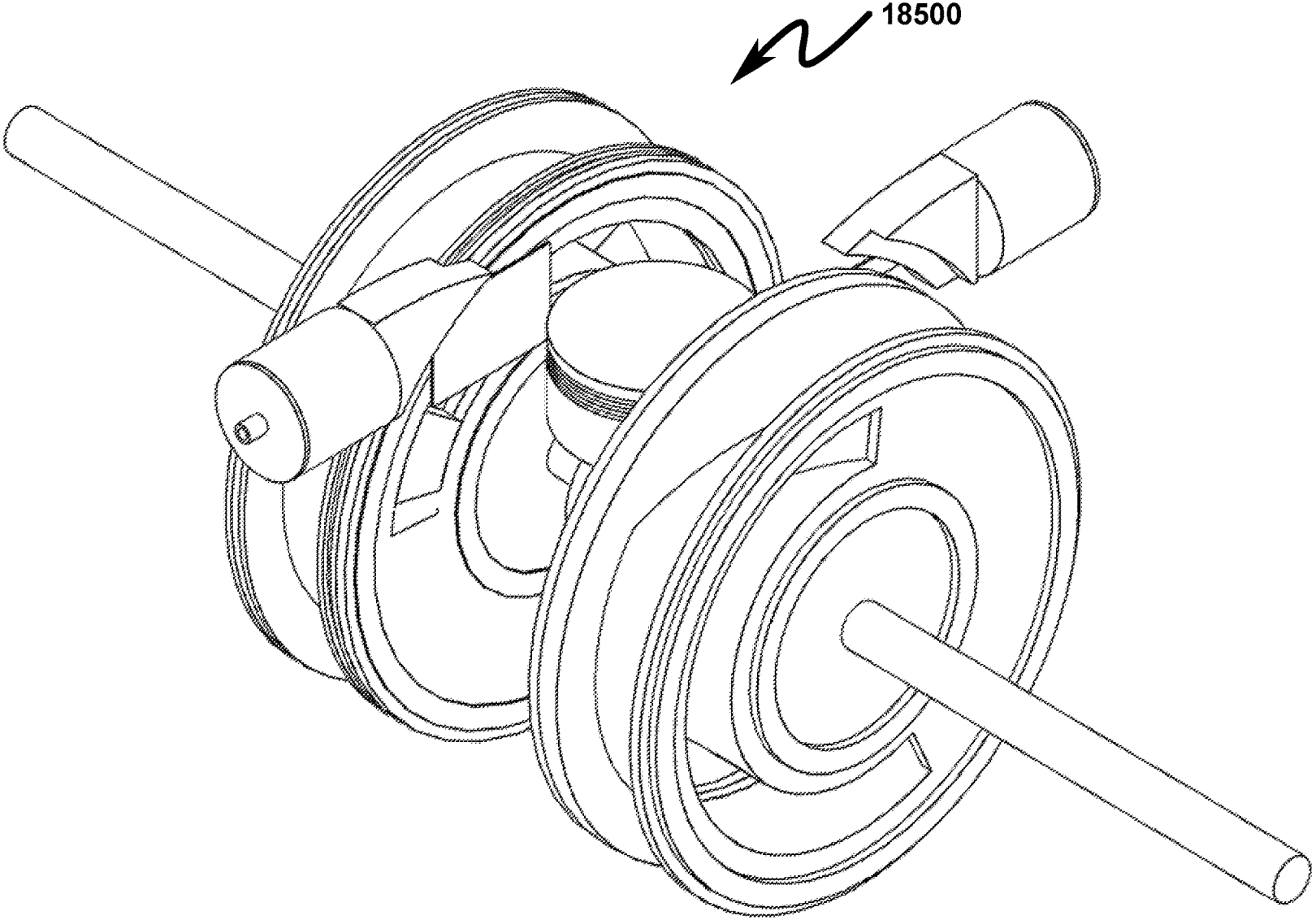
Figure 186:
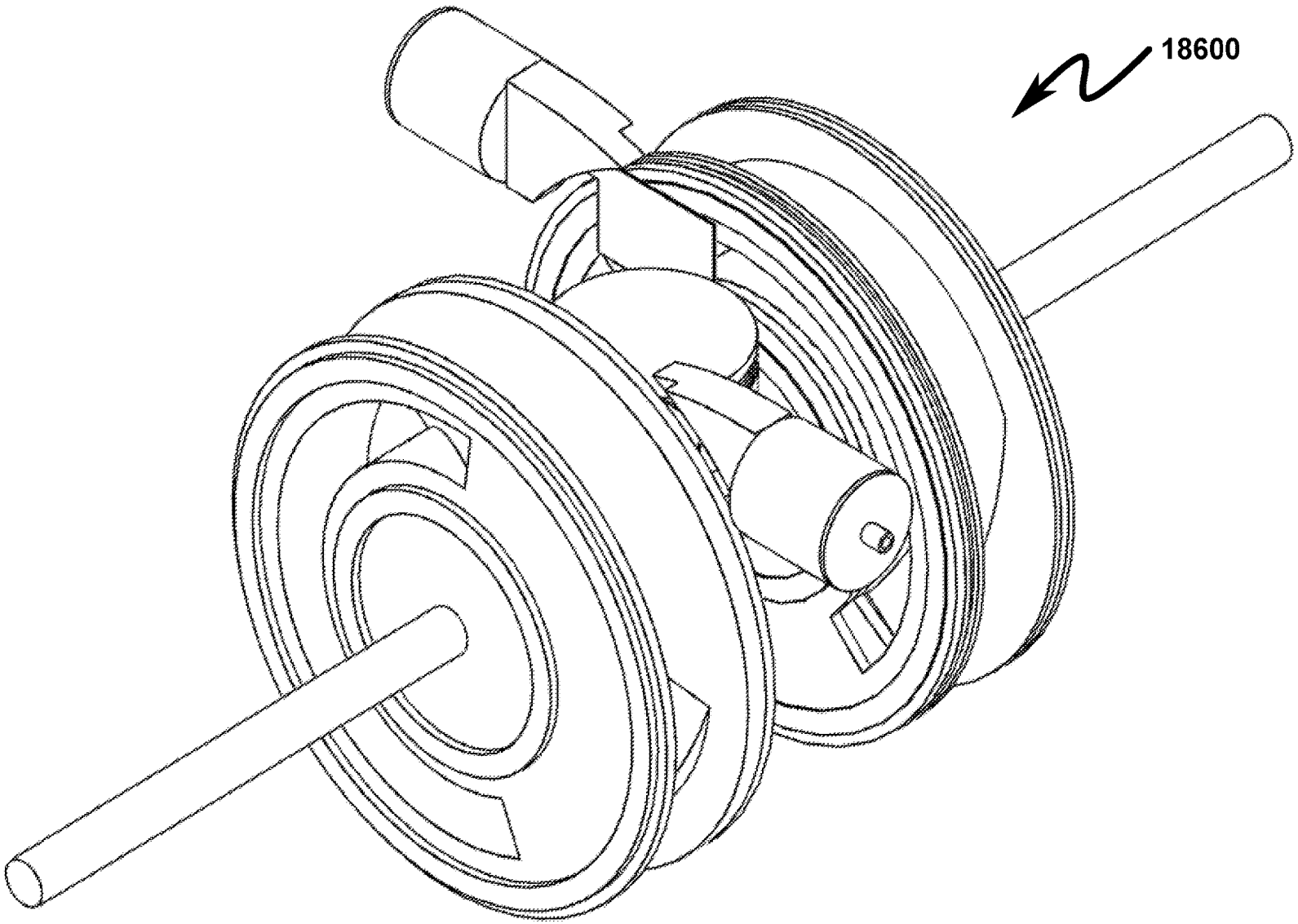
Figure 187:
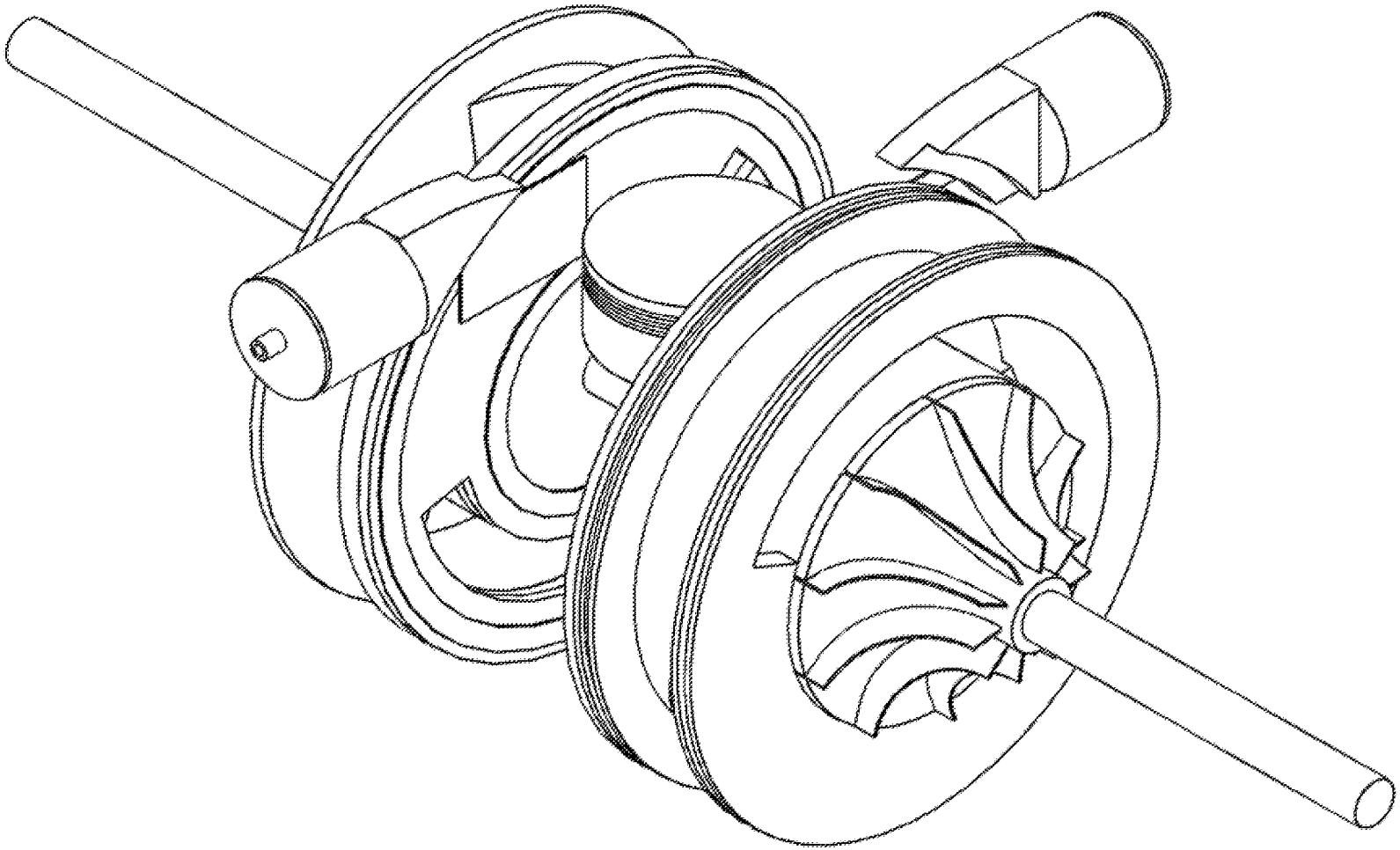
Figure 188:
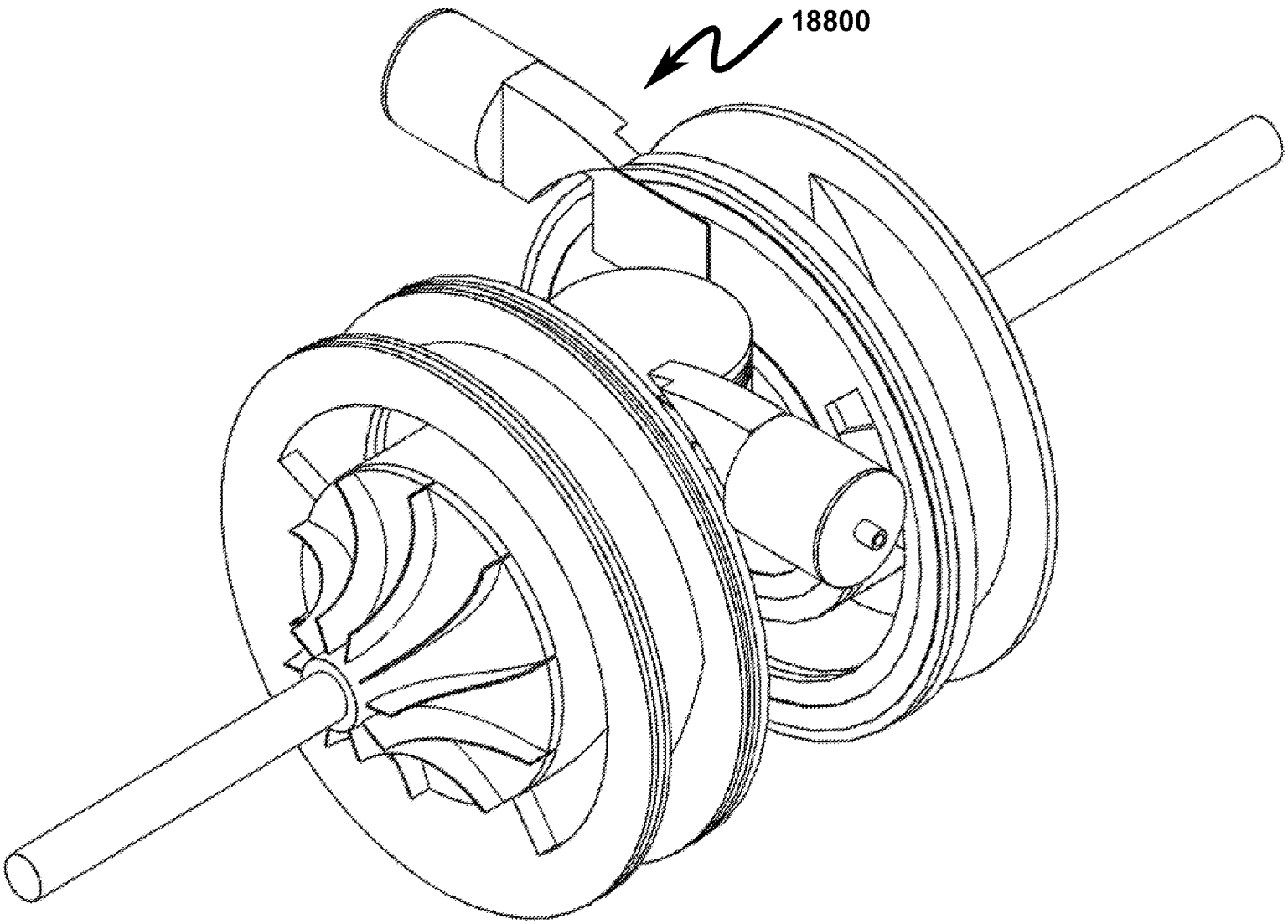
Figure 189:
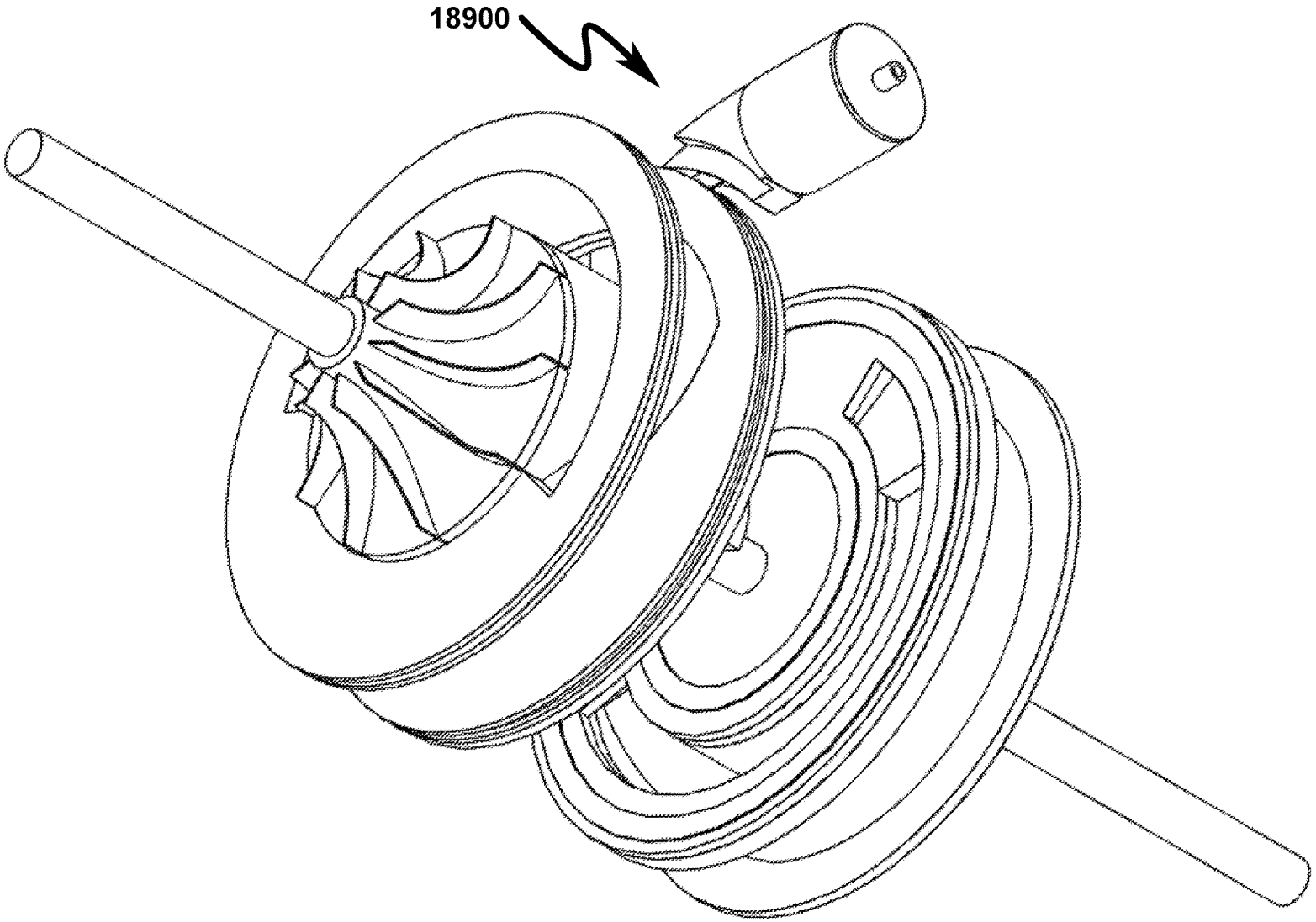
Figure 190:
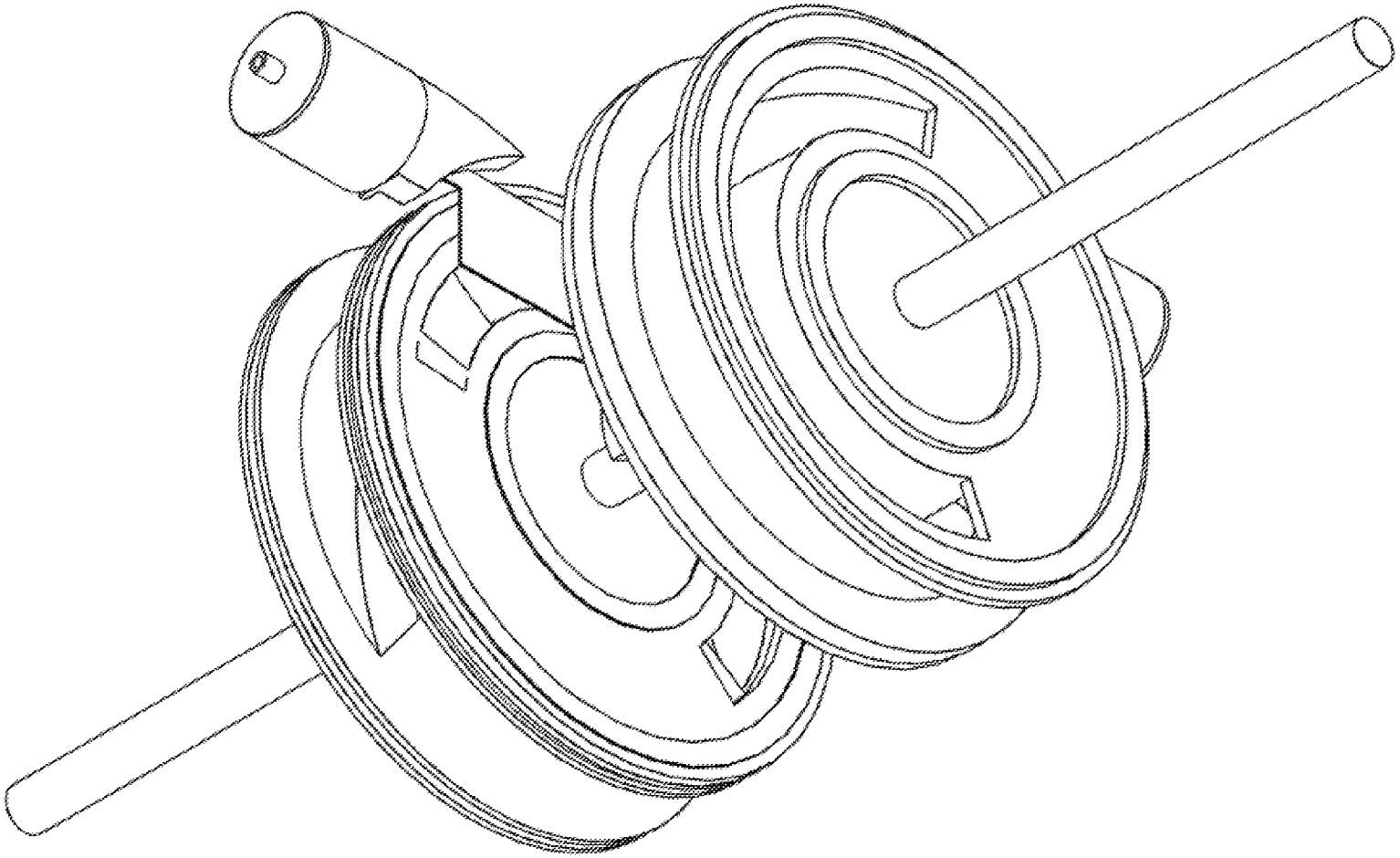
Figure 191:
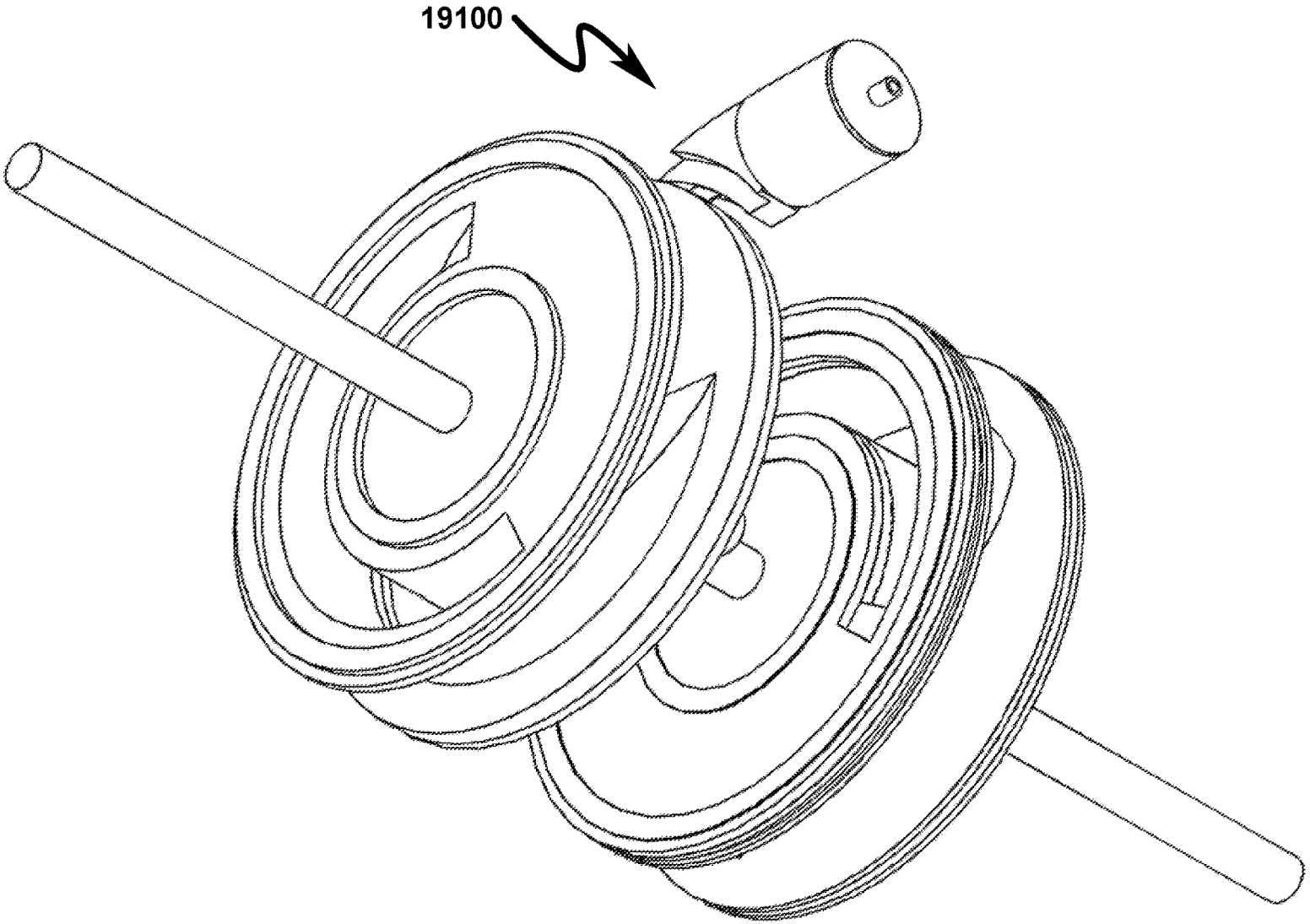
Figure 192:
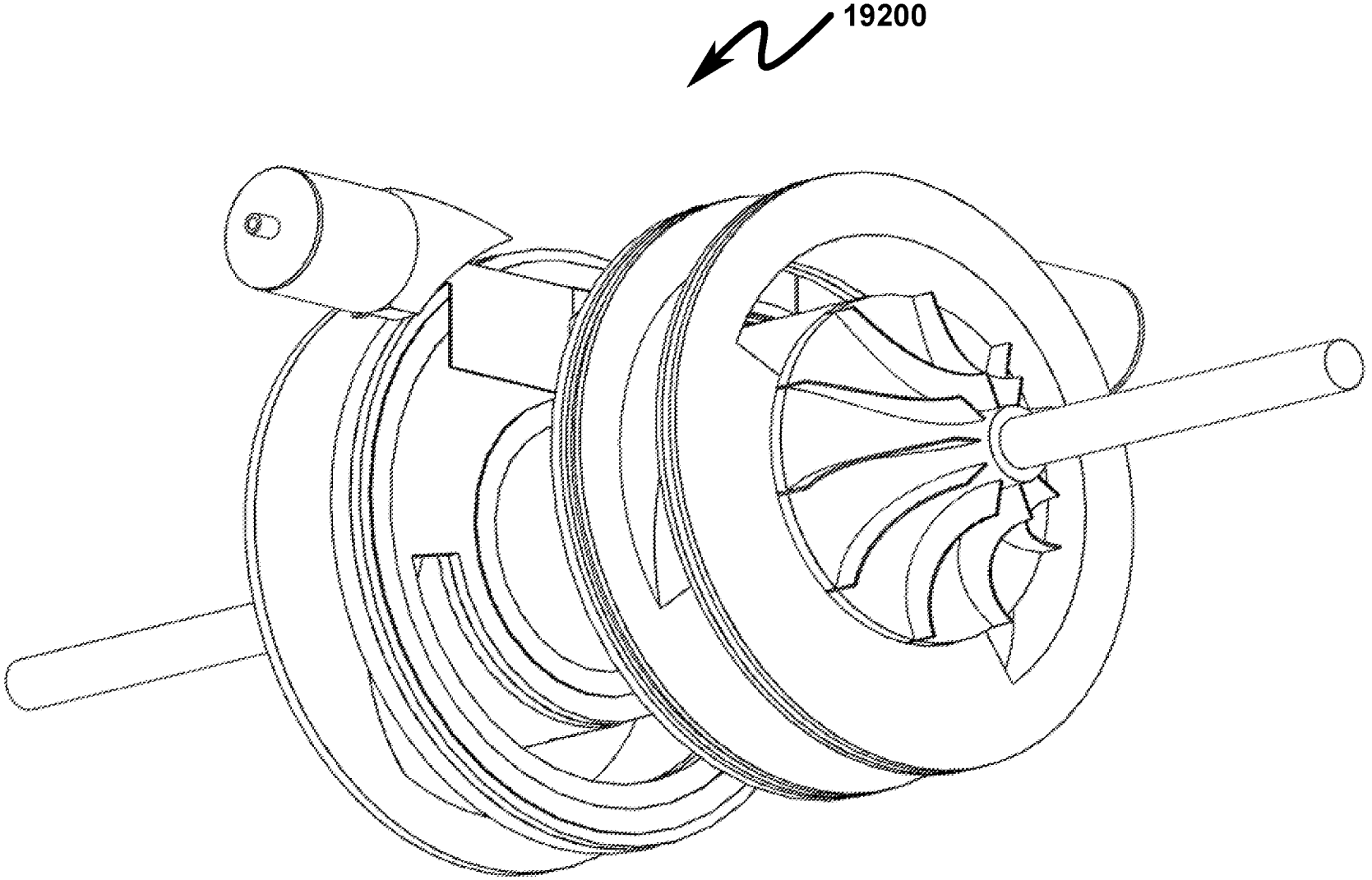
Figure 193:
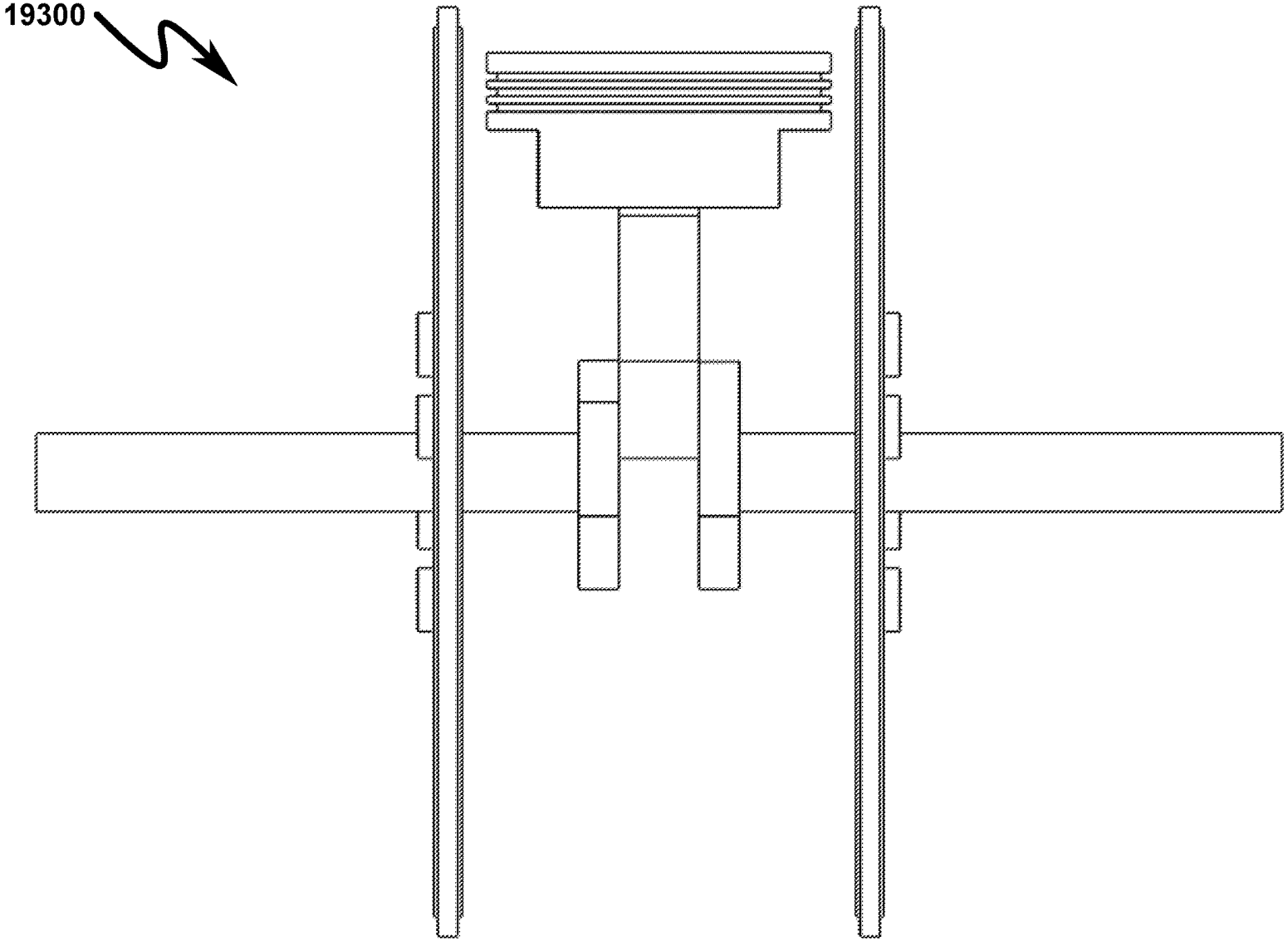
Figure 194:
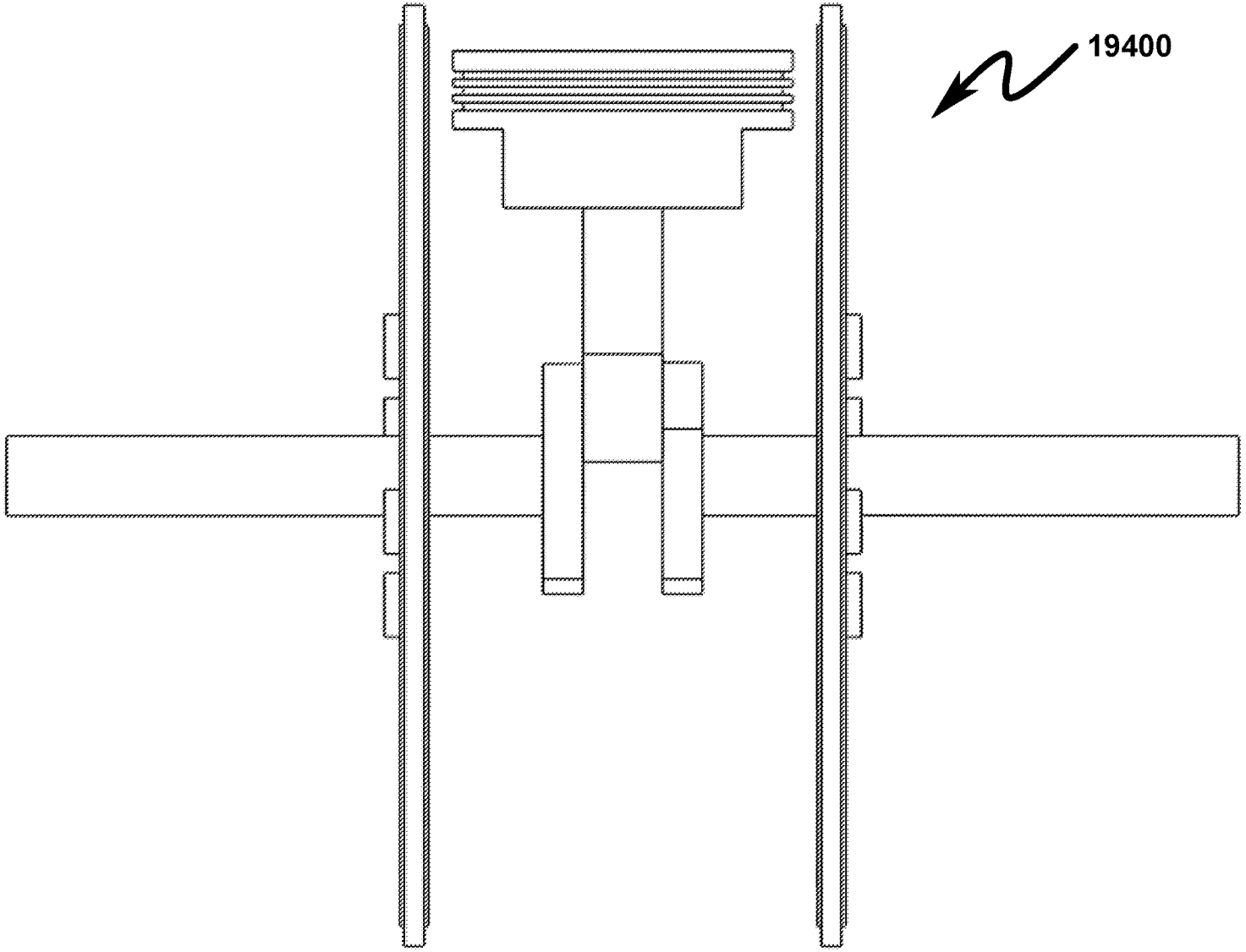
Figure 195:
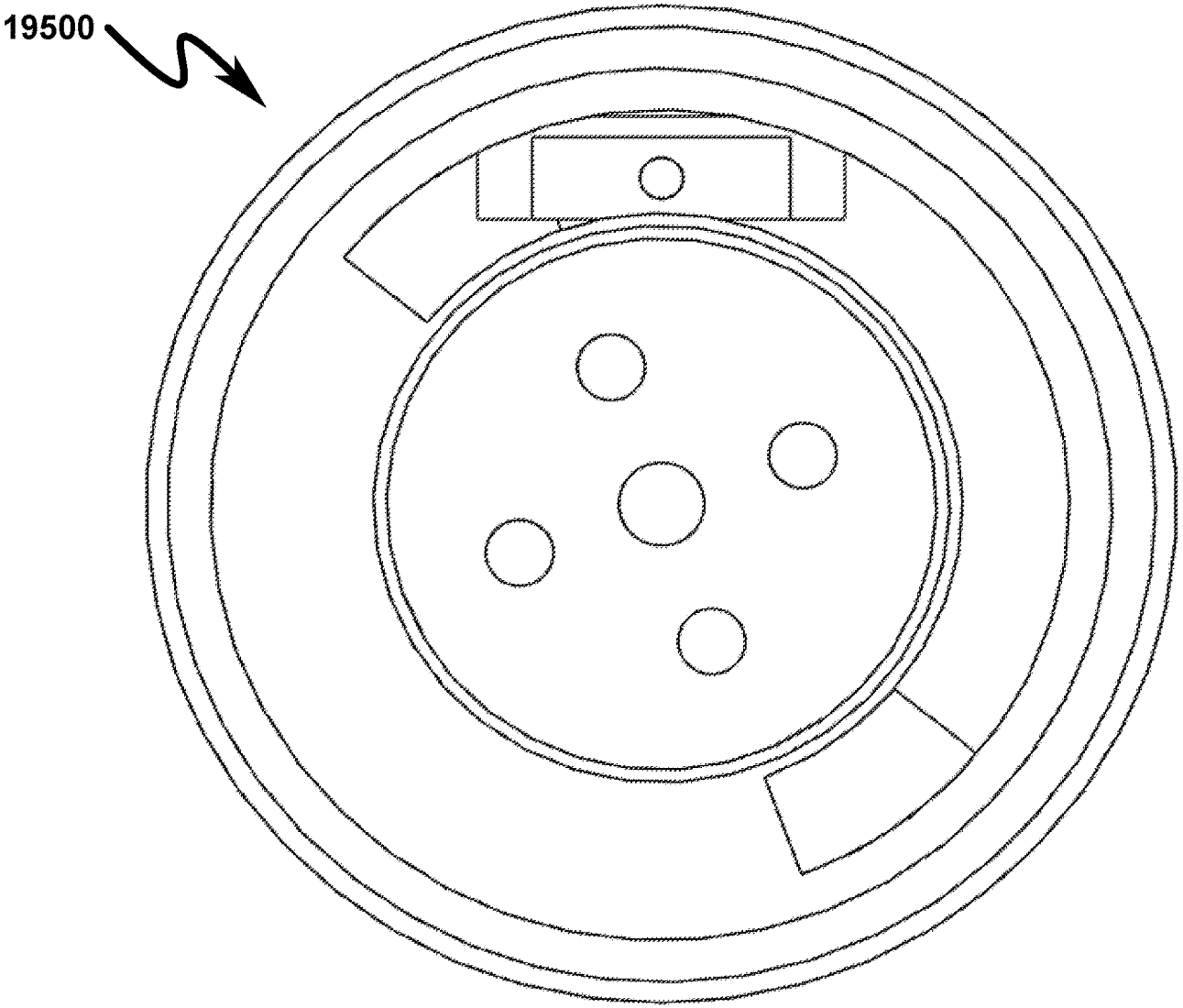
Figure 196:
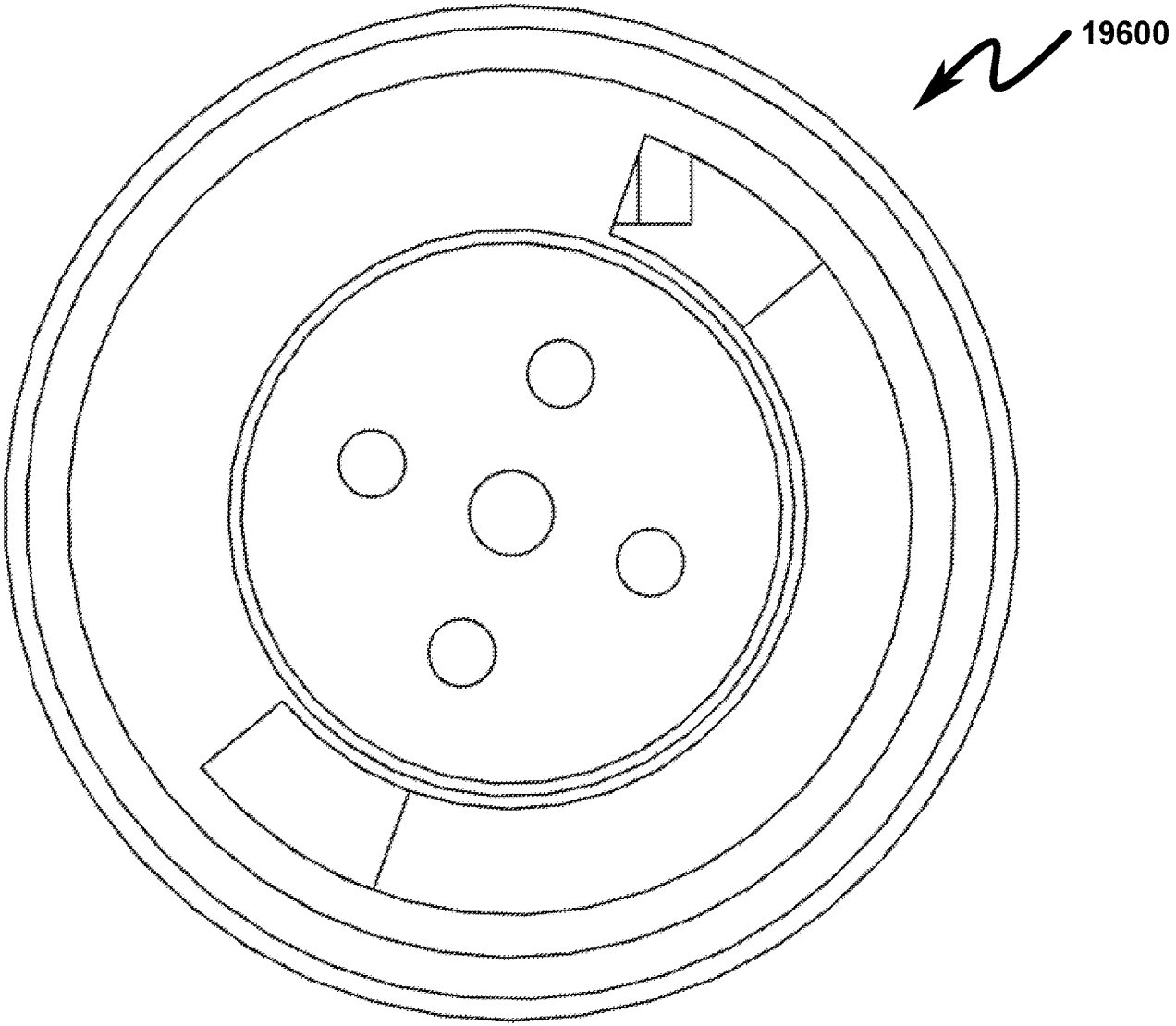
Figure 197:
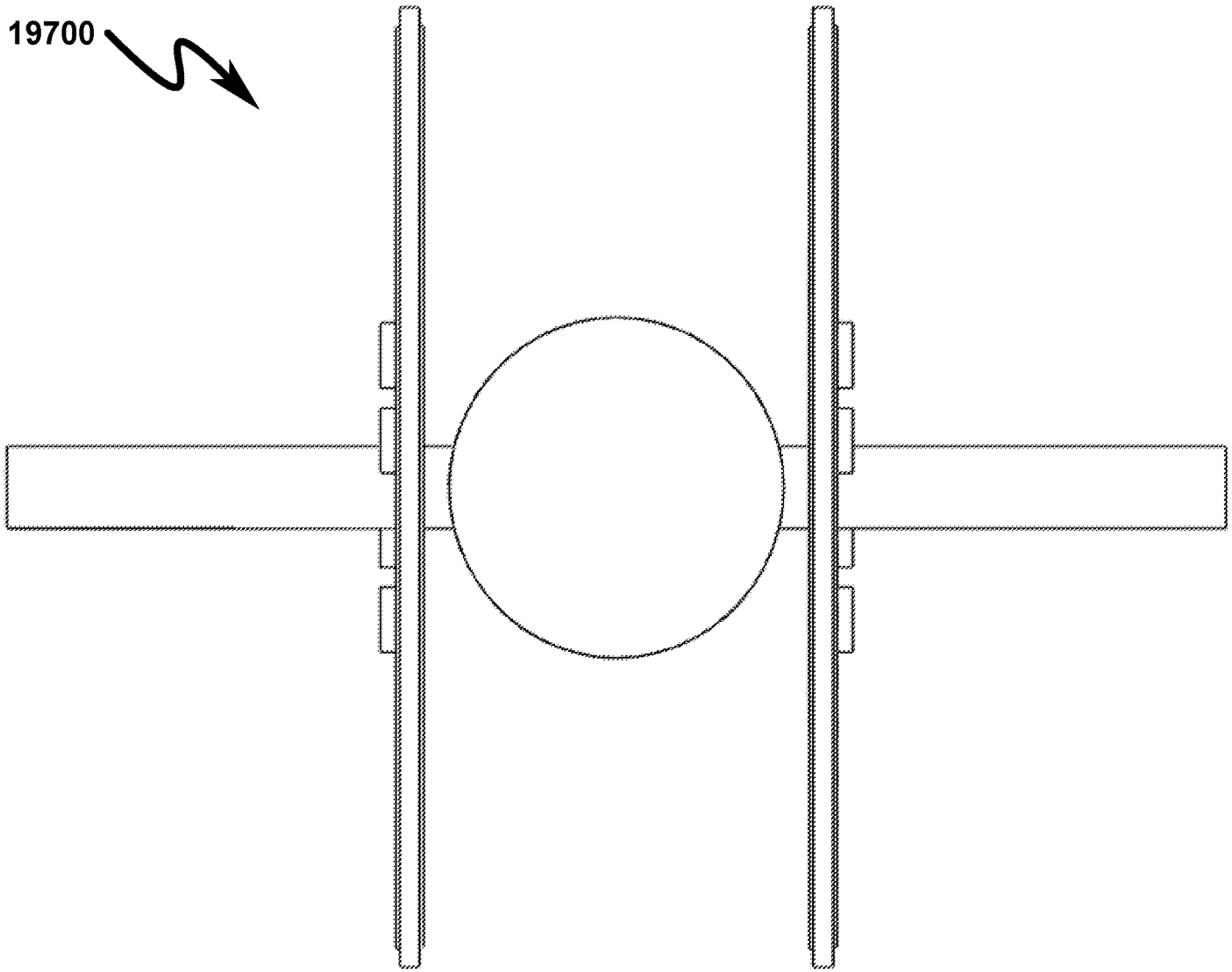
Figure 198:
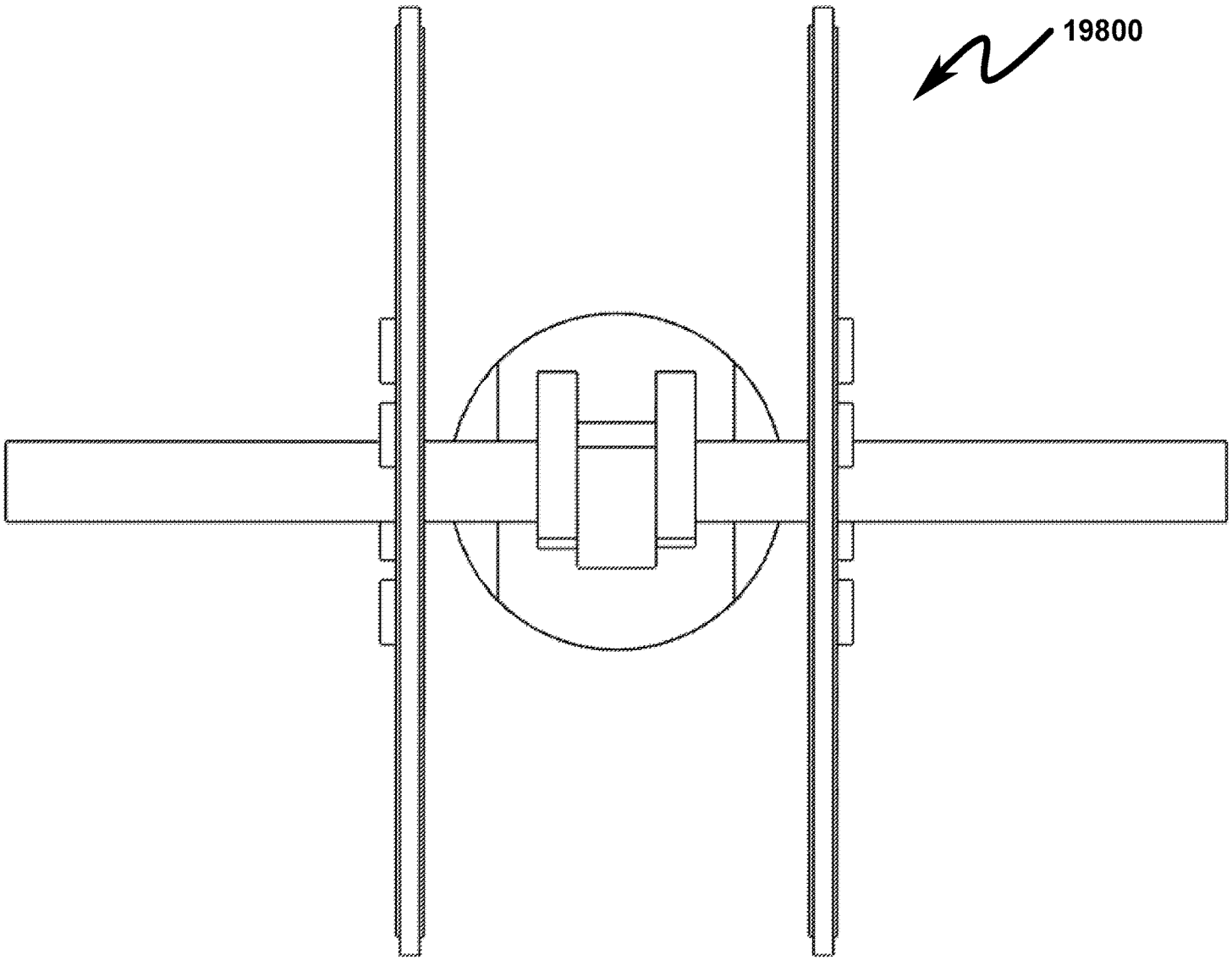
Figure 199:
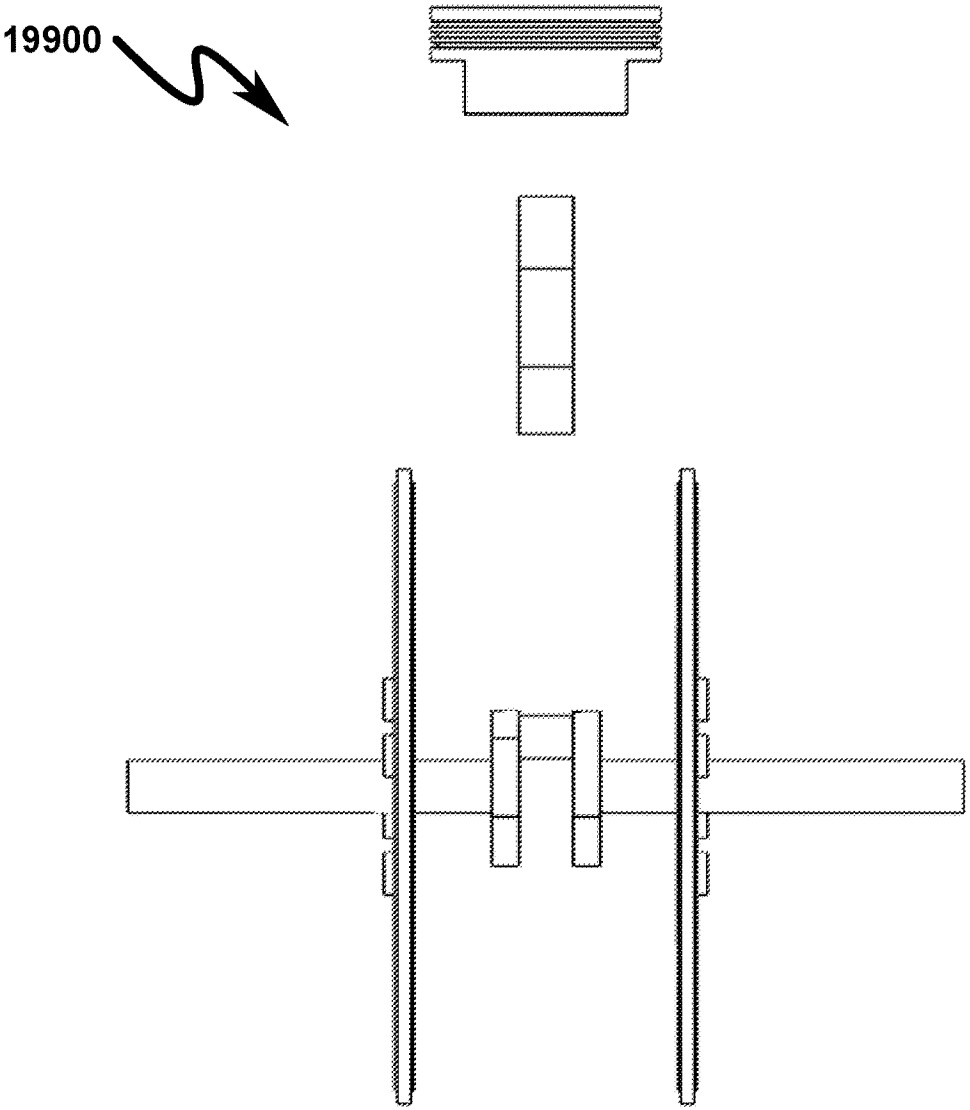
Figure 200:
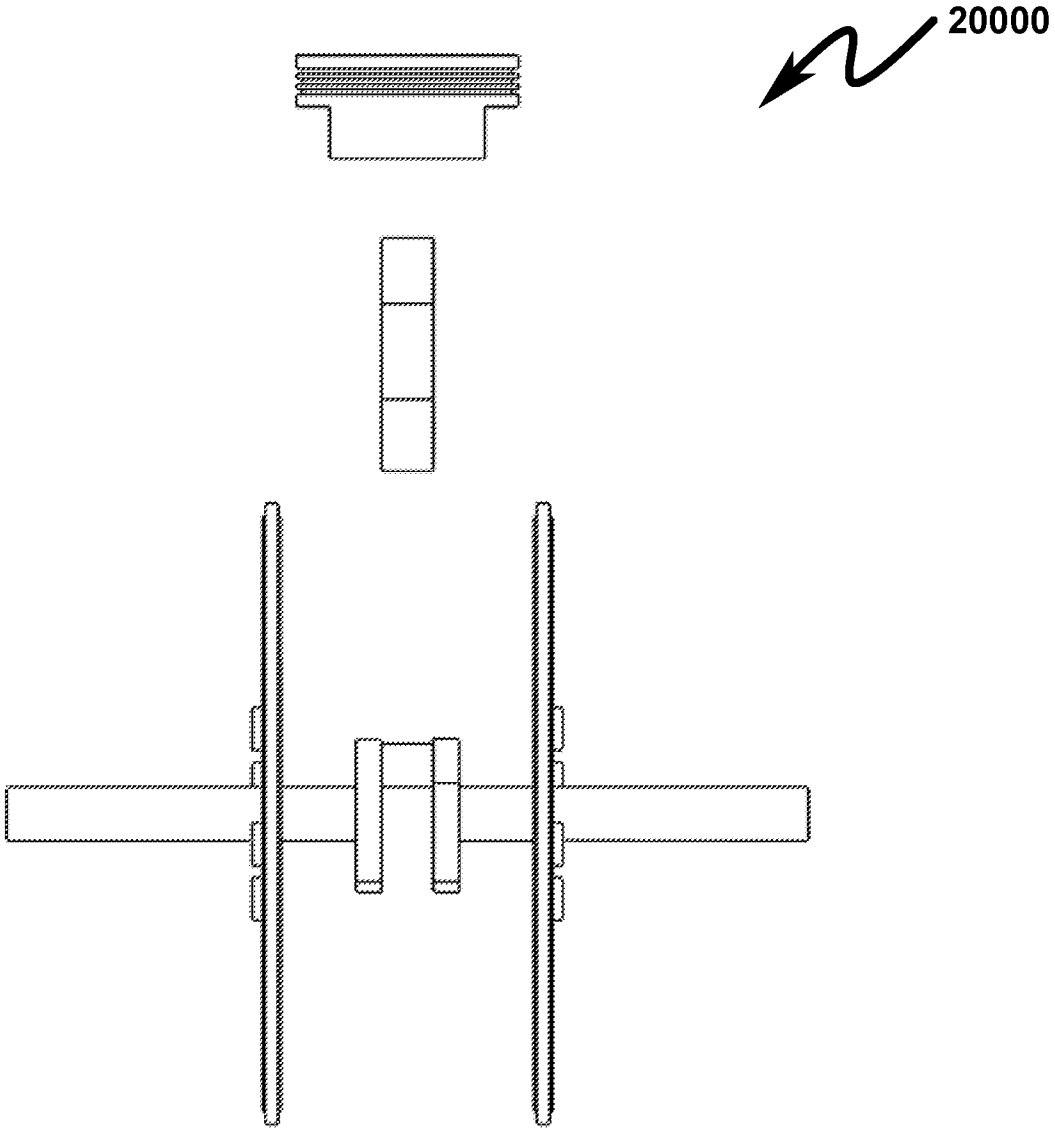
Figure 201:
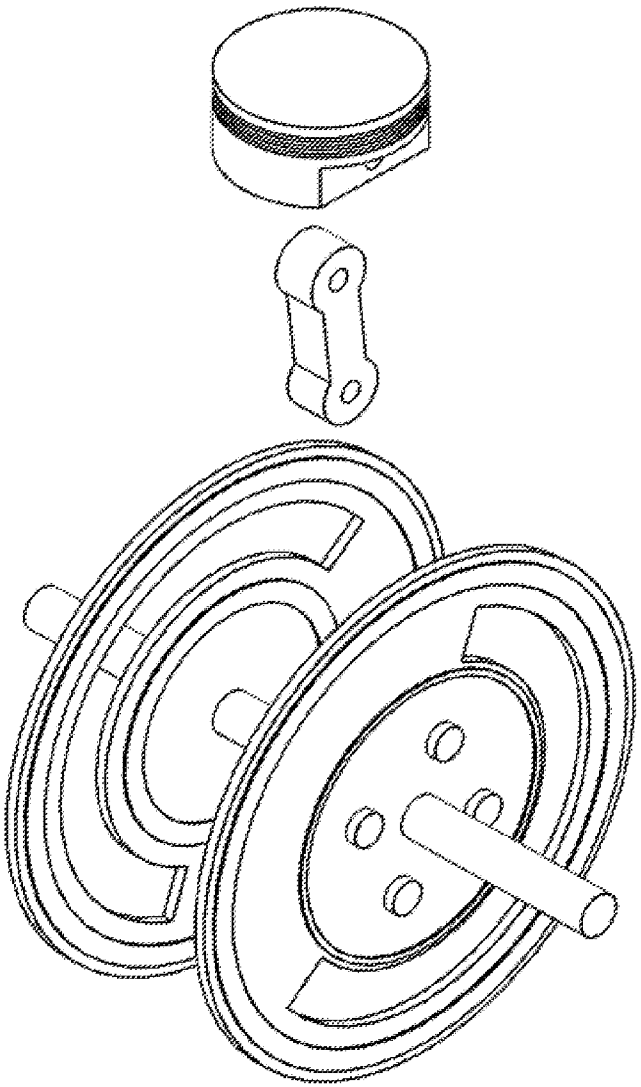
Figure 202:
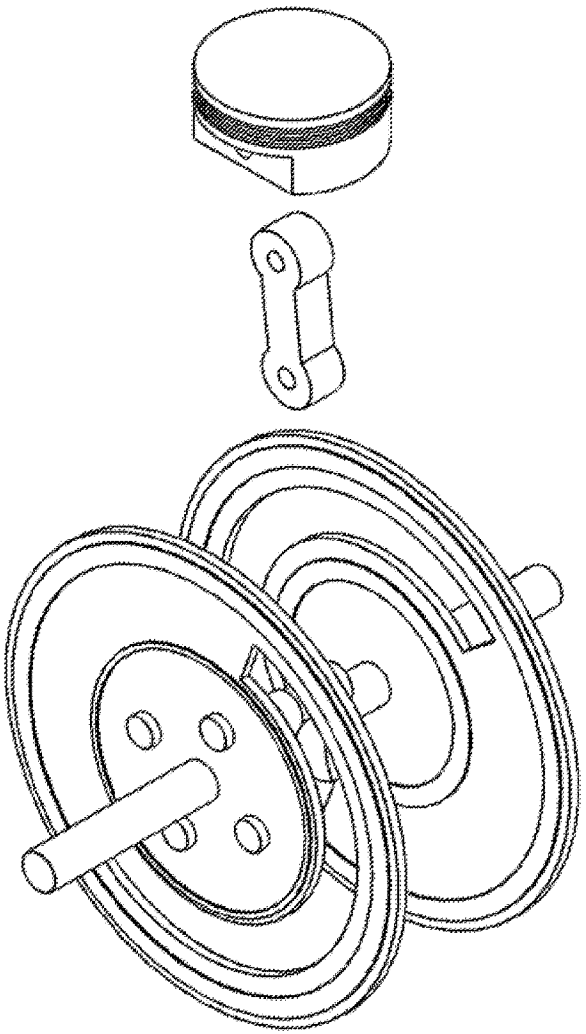
Figure 203:
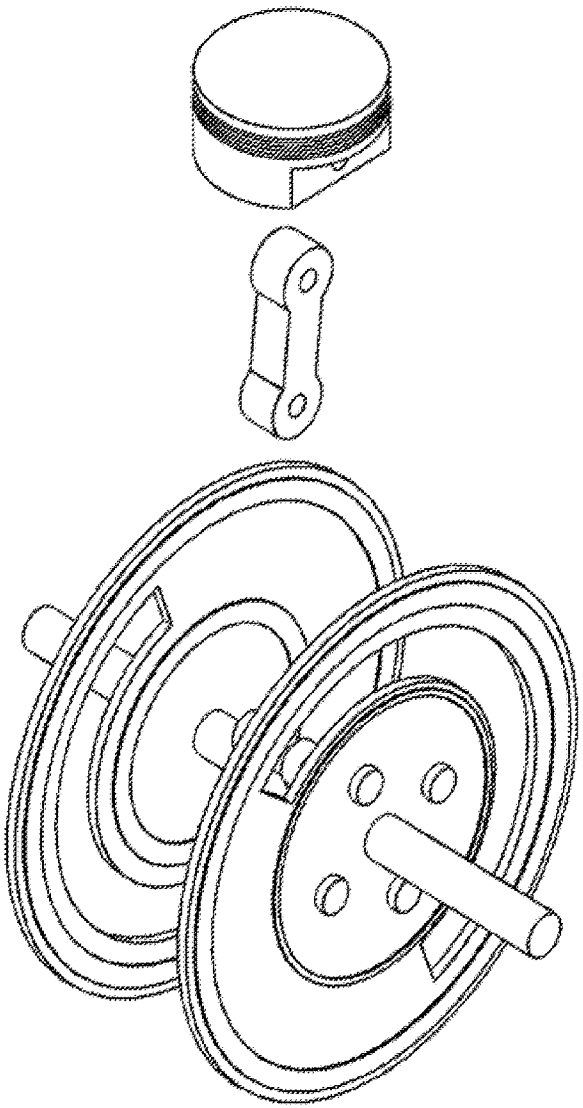
Figure 204:
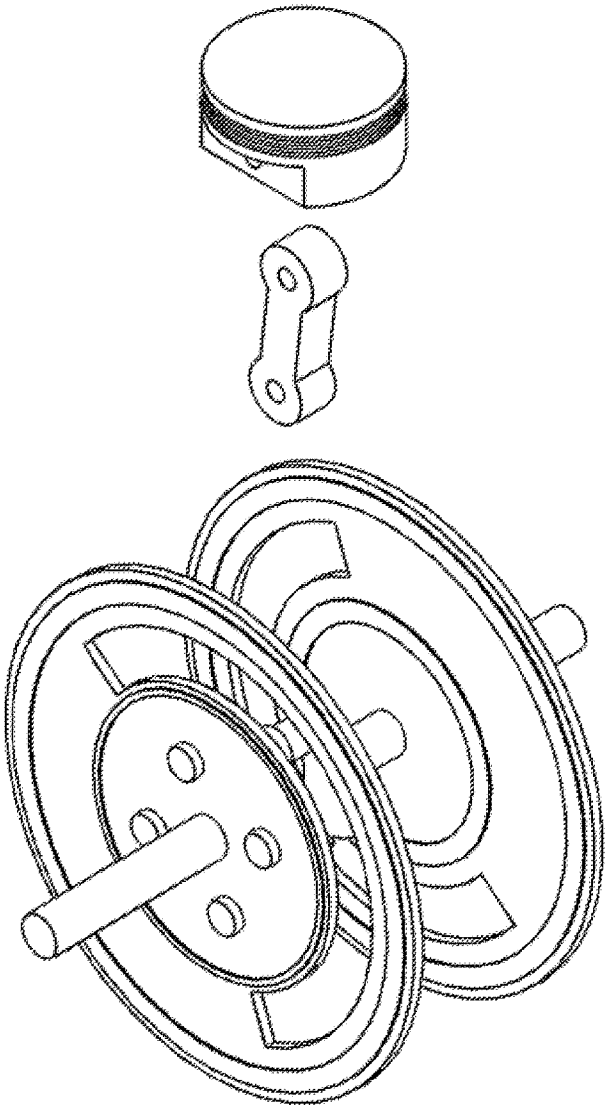
Figure 205:
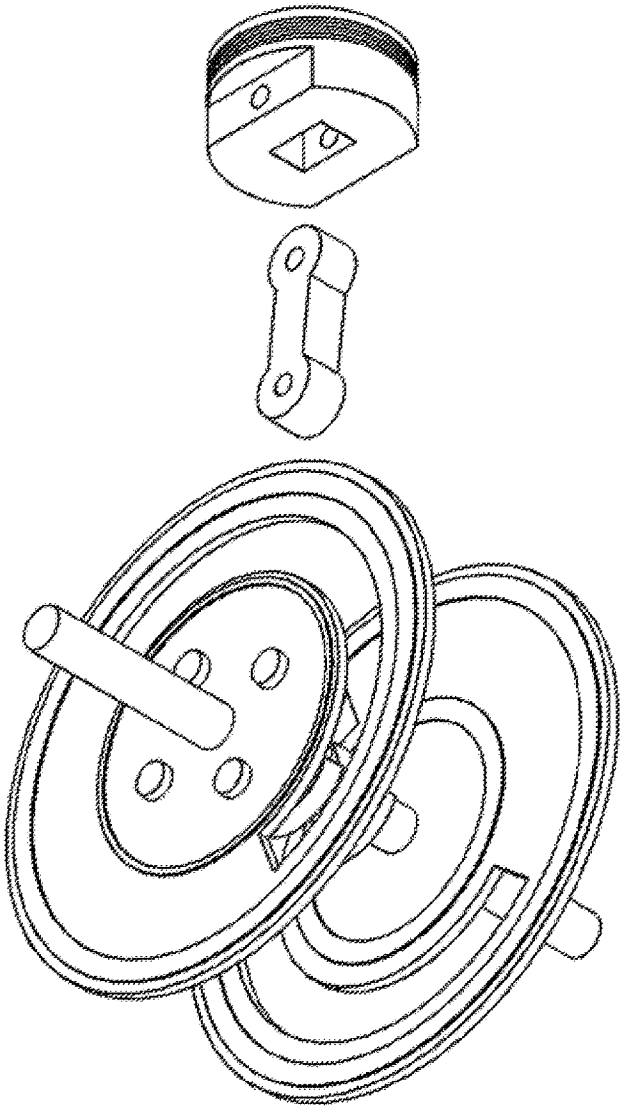
Figure 206:
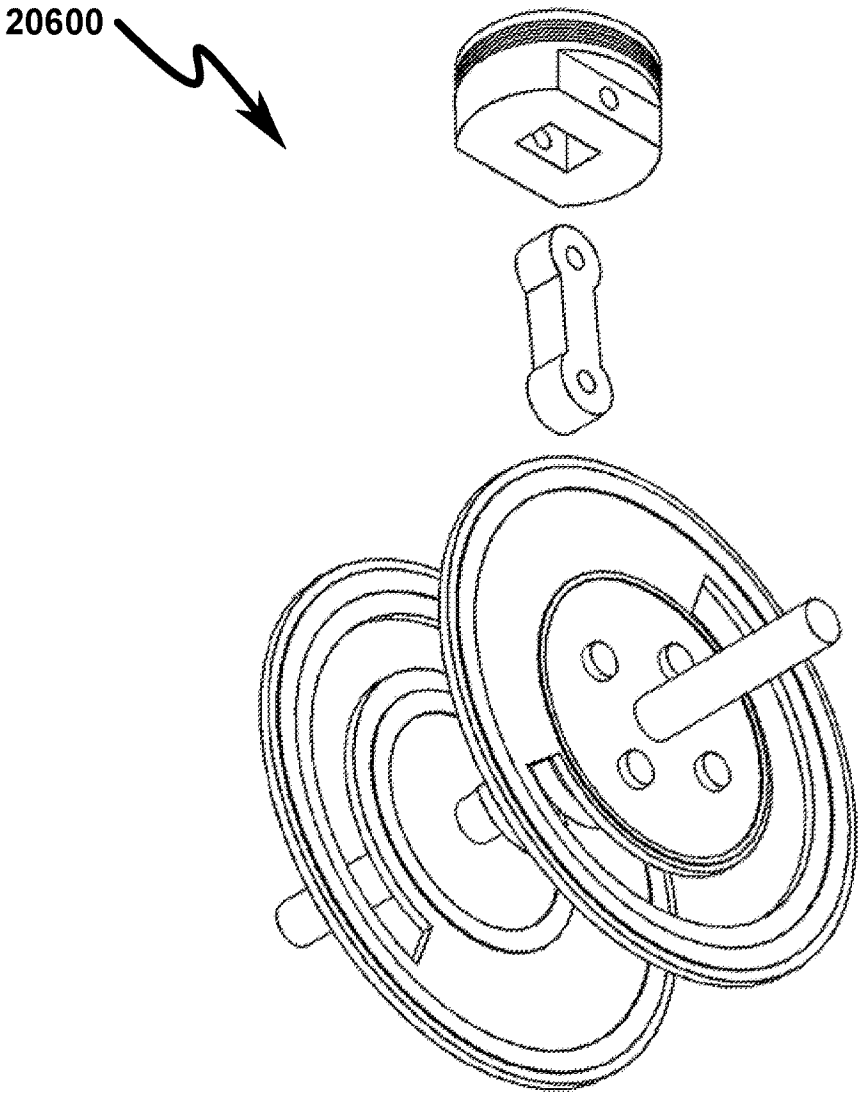
Figure 207:
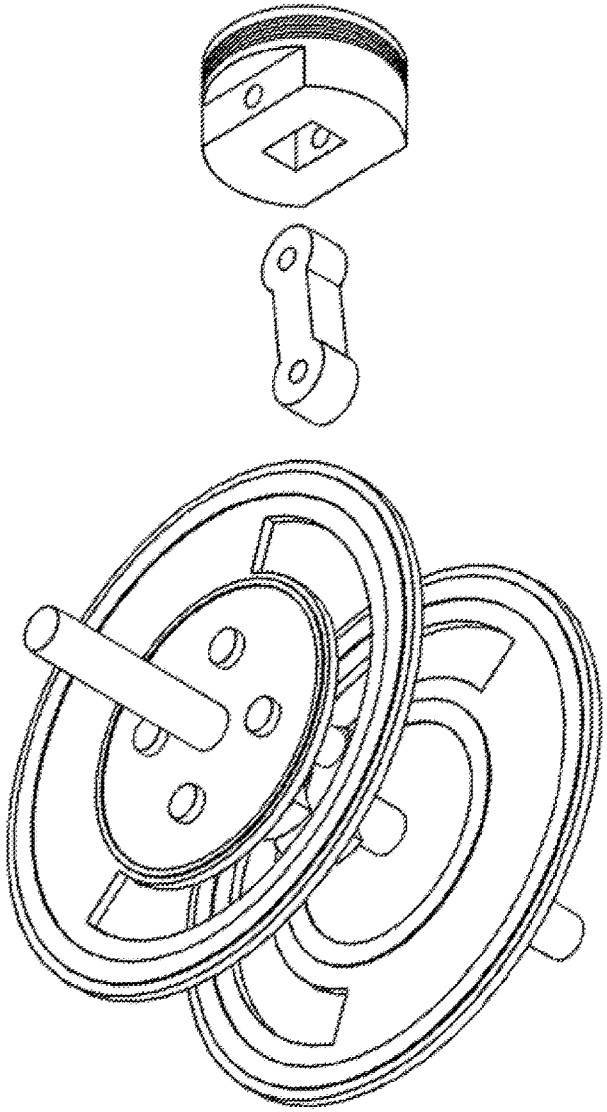
Figure 208:
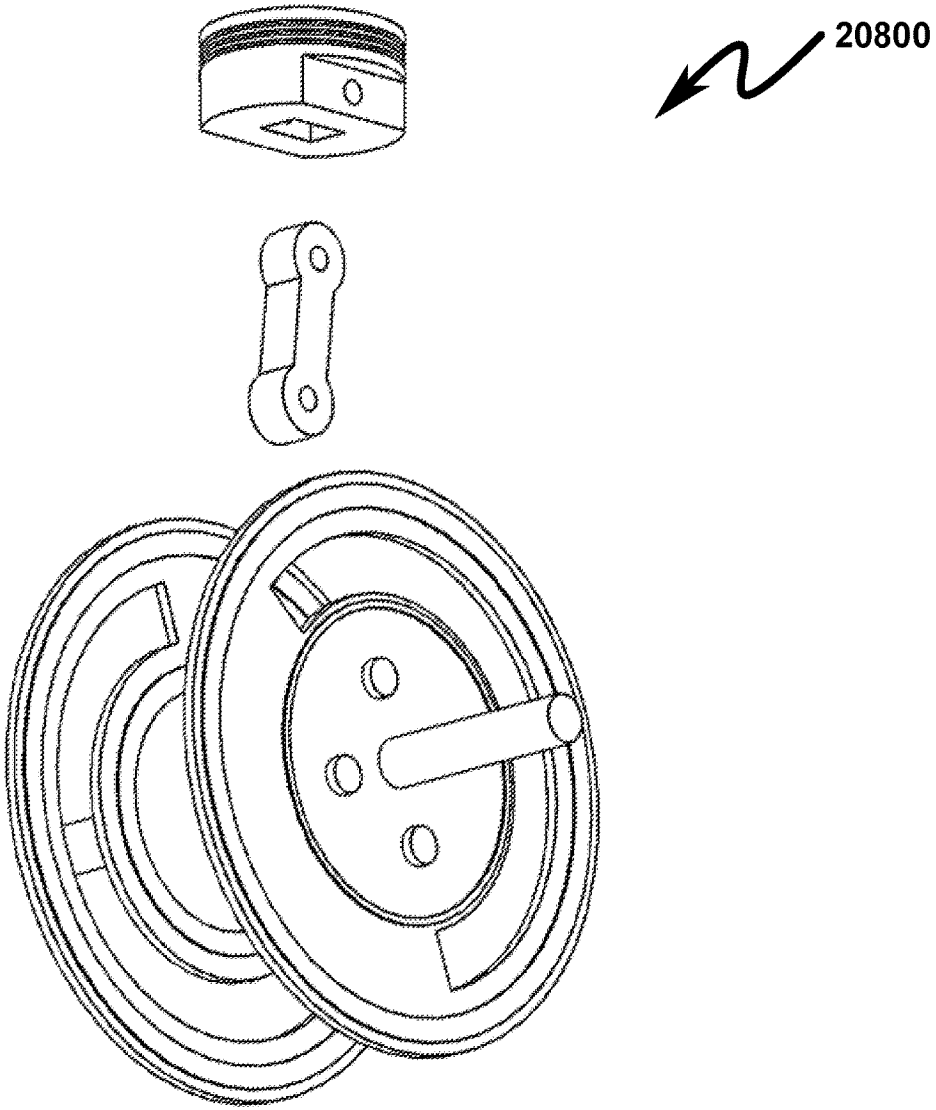
Figure 209:
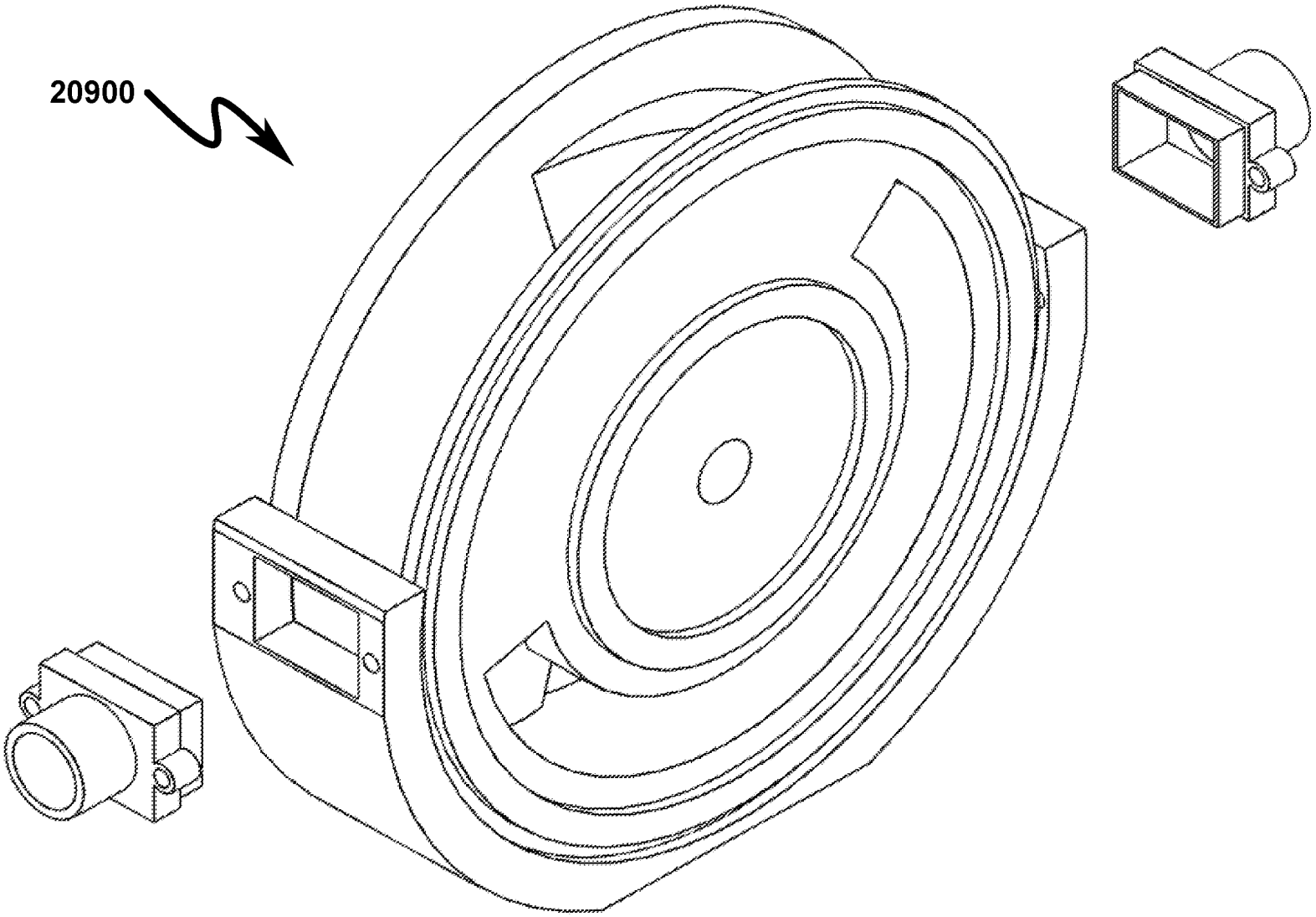
Figure 210:
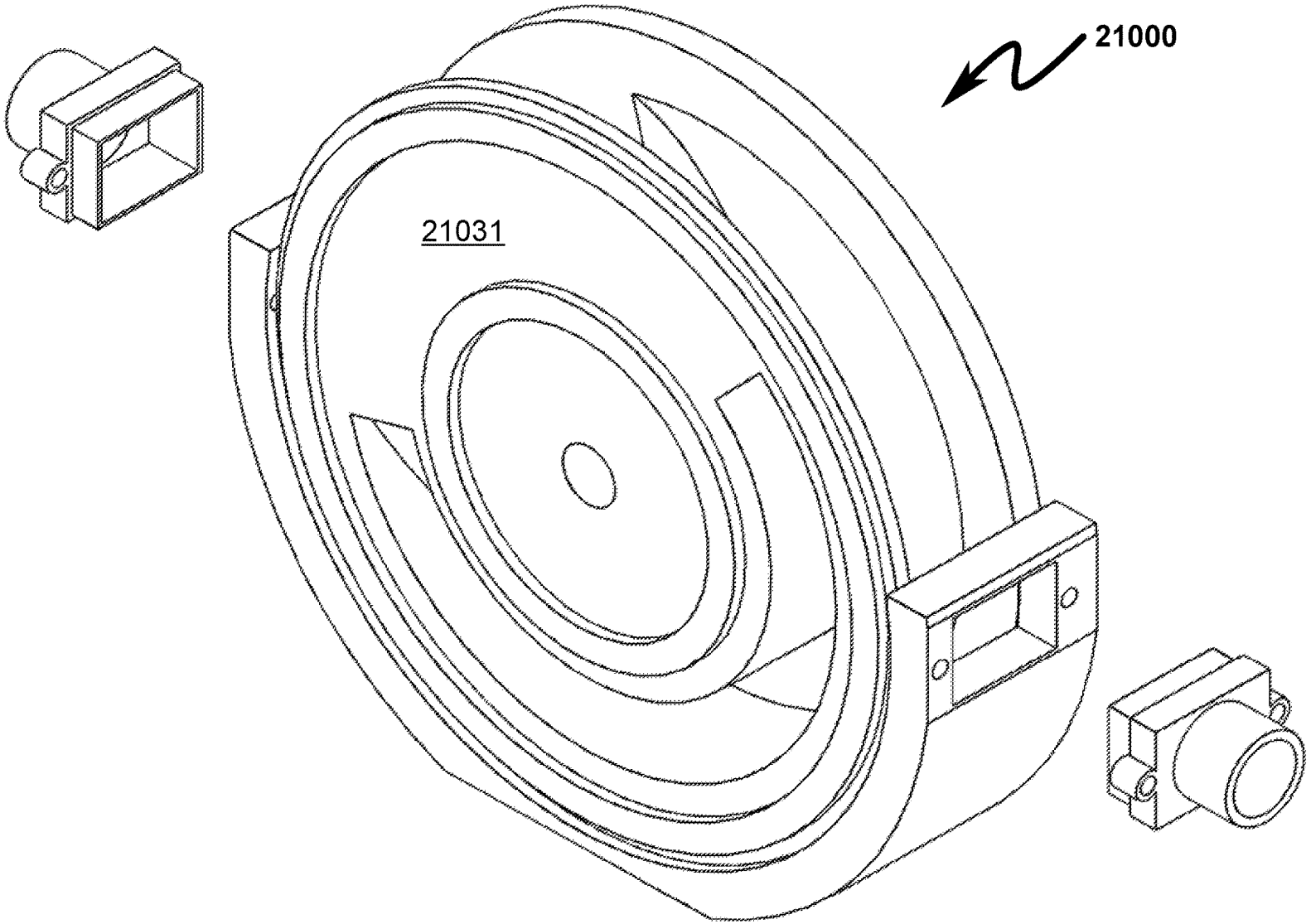
Figure 211:
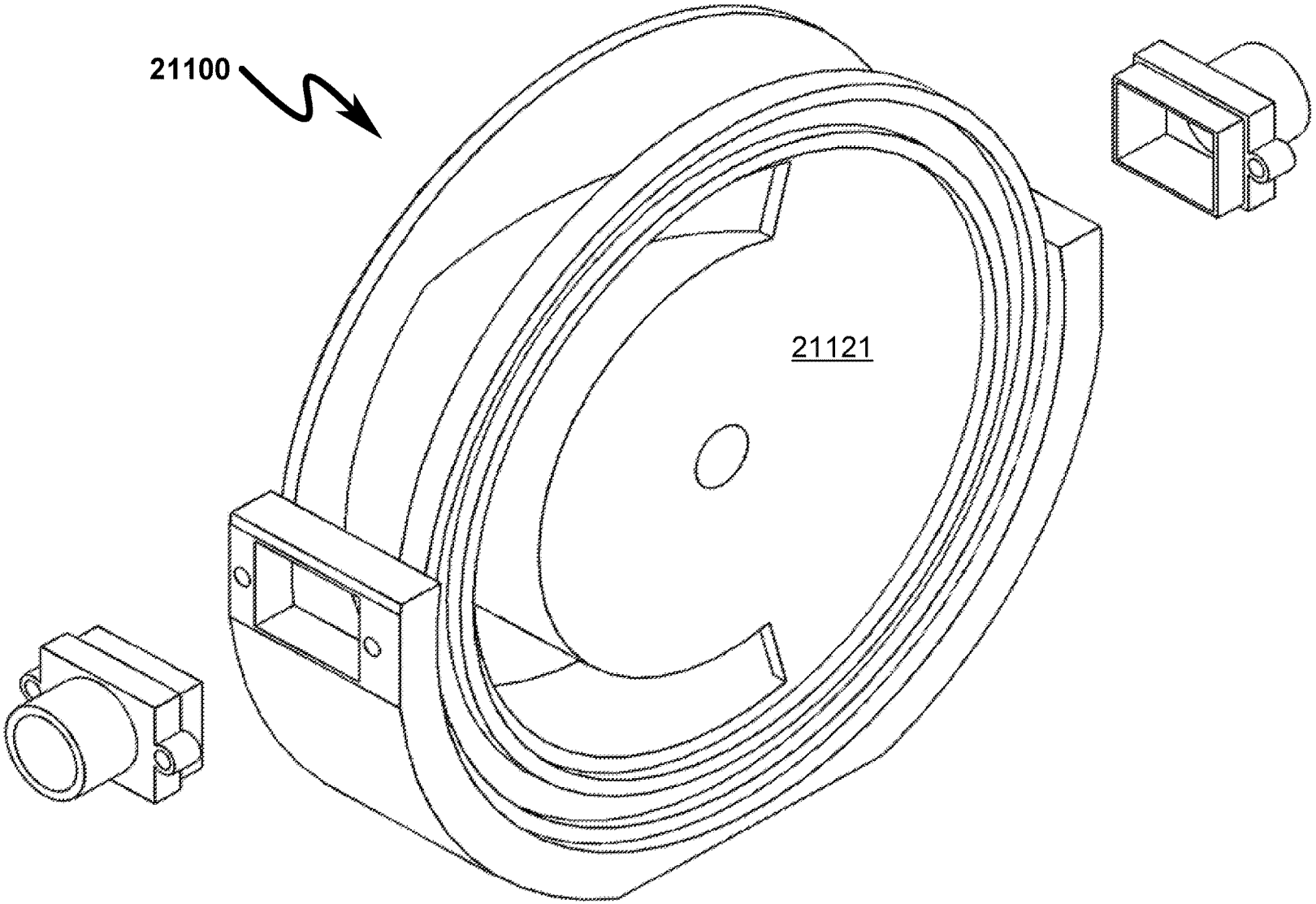
Figure 212:
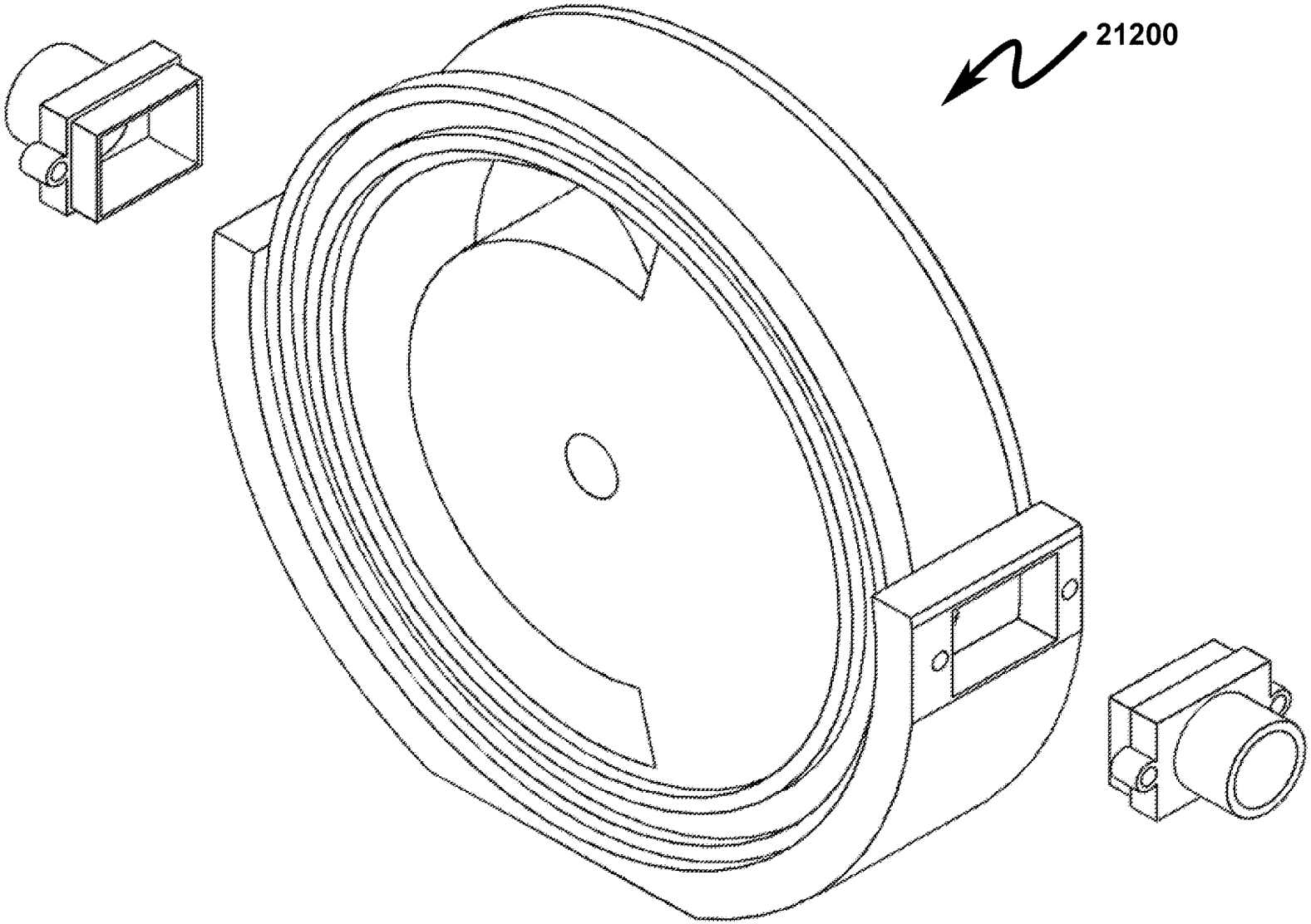
Figure 213:
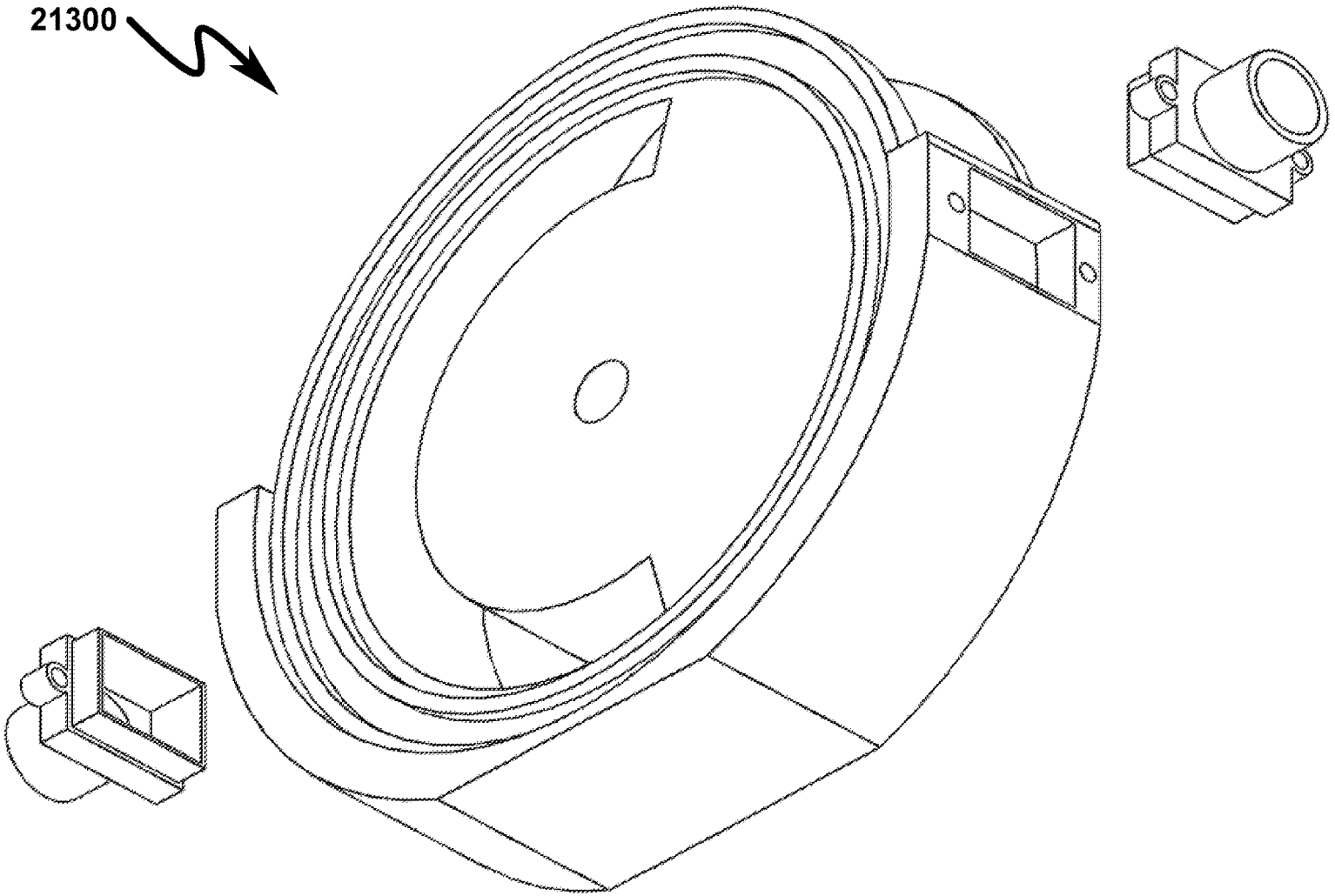
Figure 214:
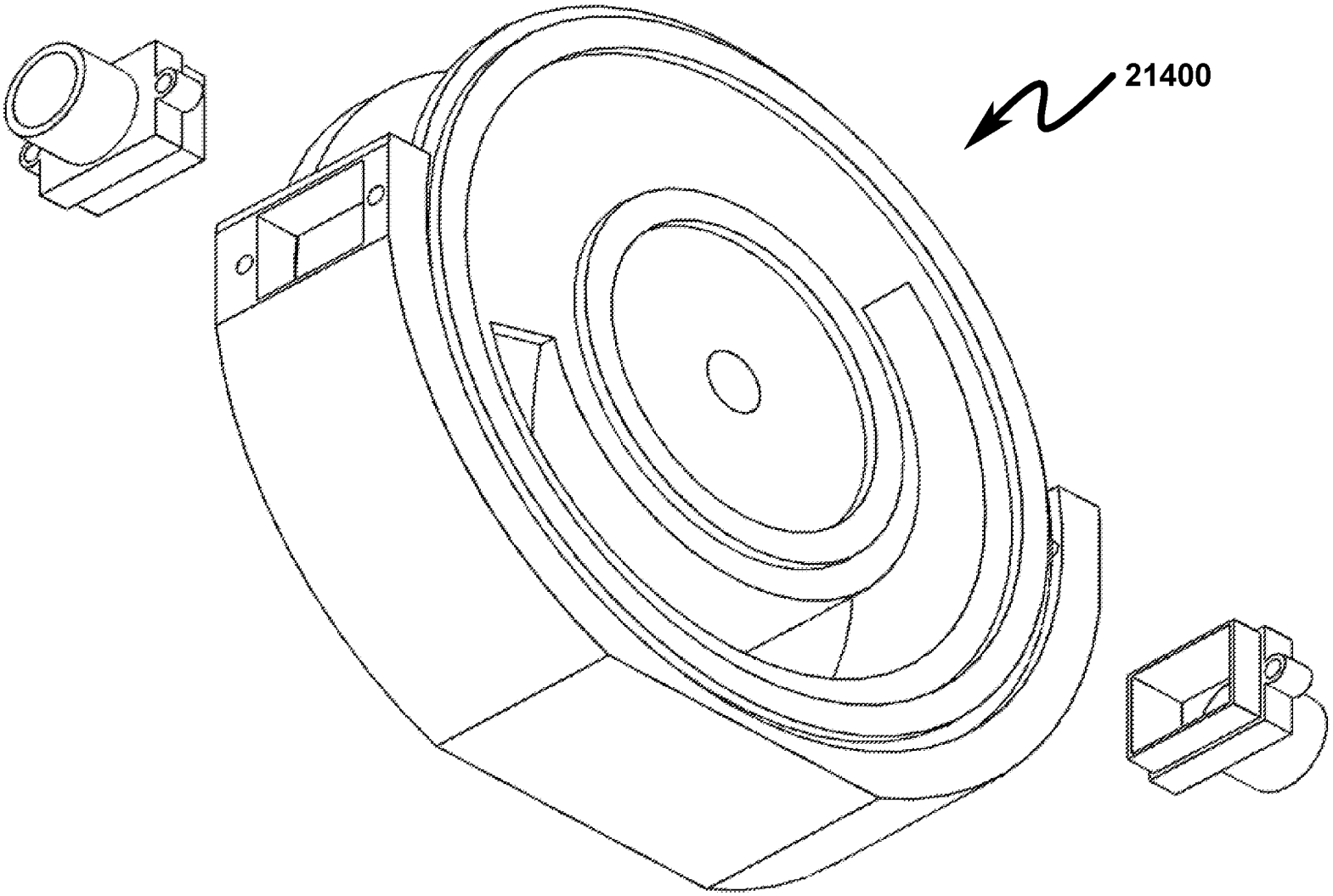
Figure 215:
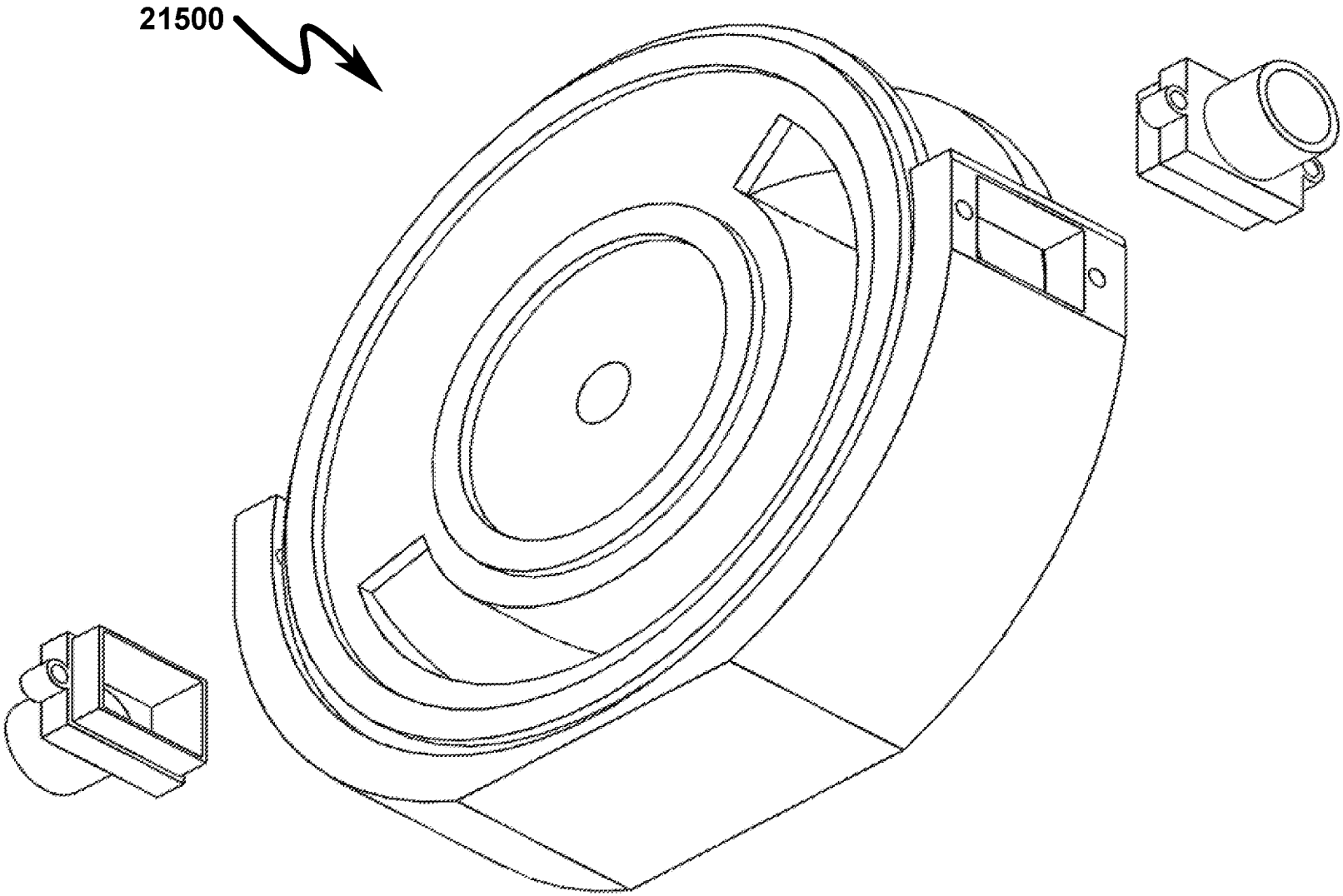
Figure 216:
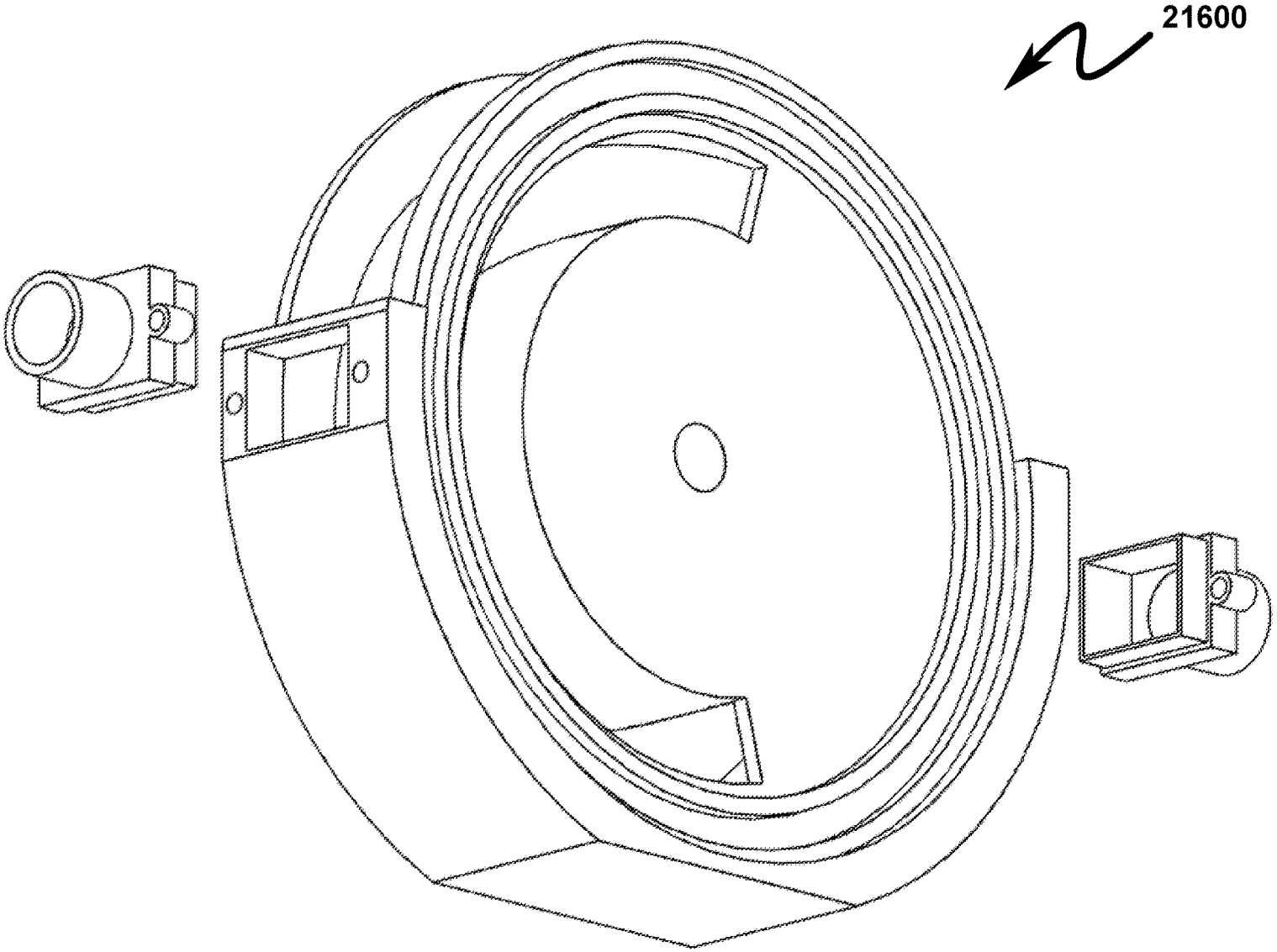
Figure 217:
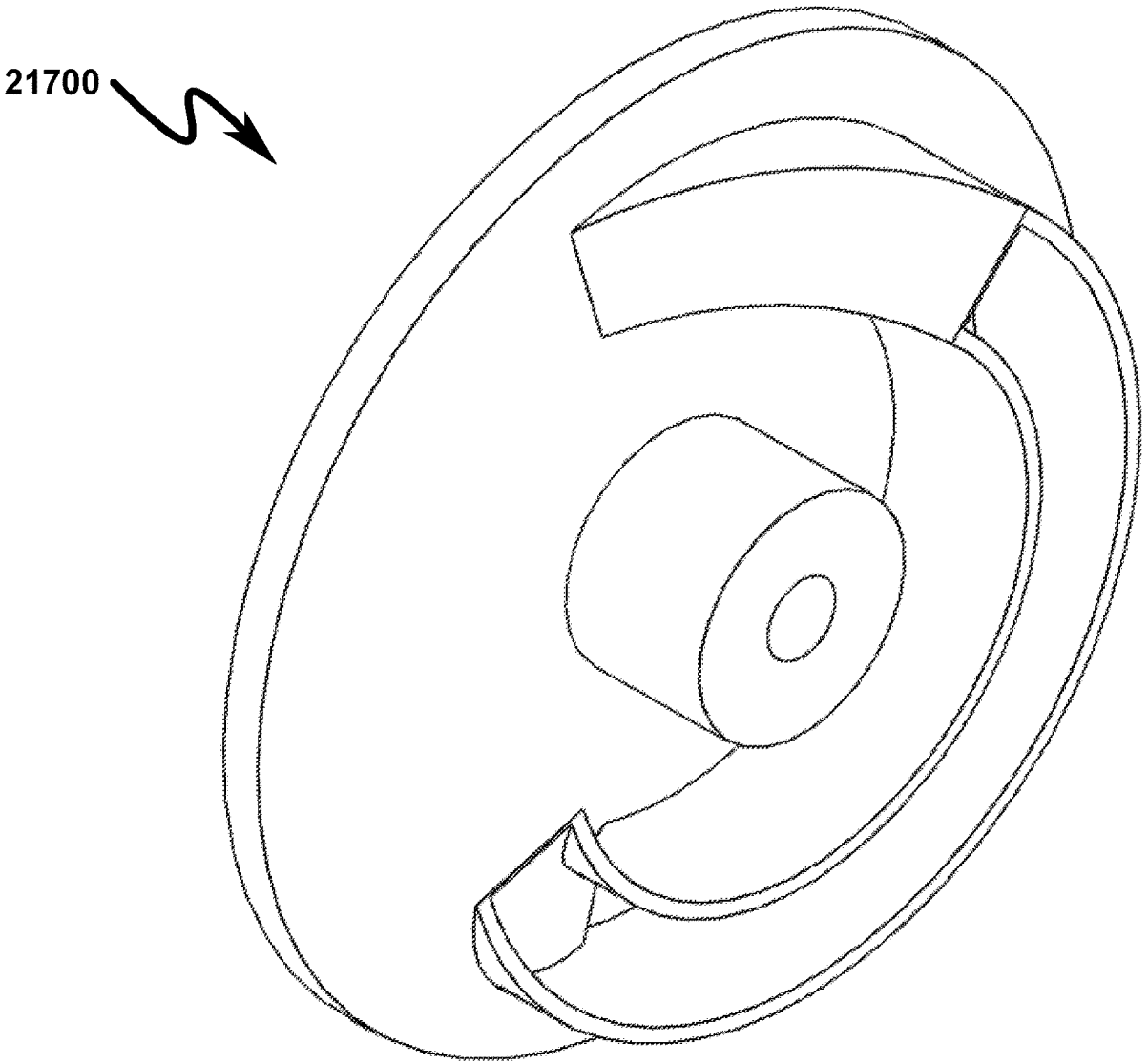
Figure 218:
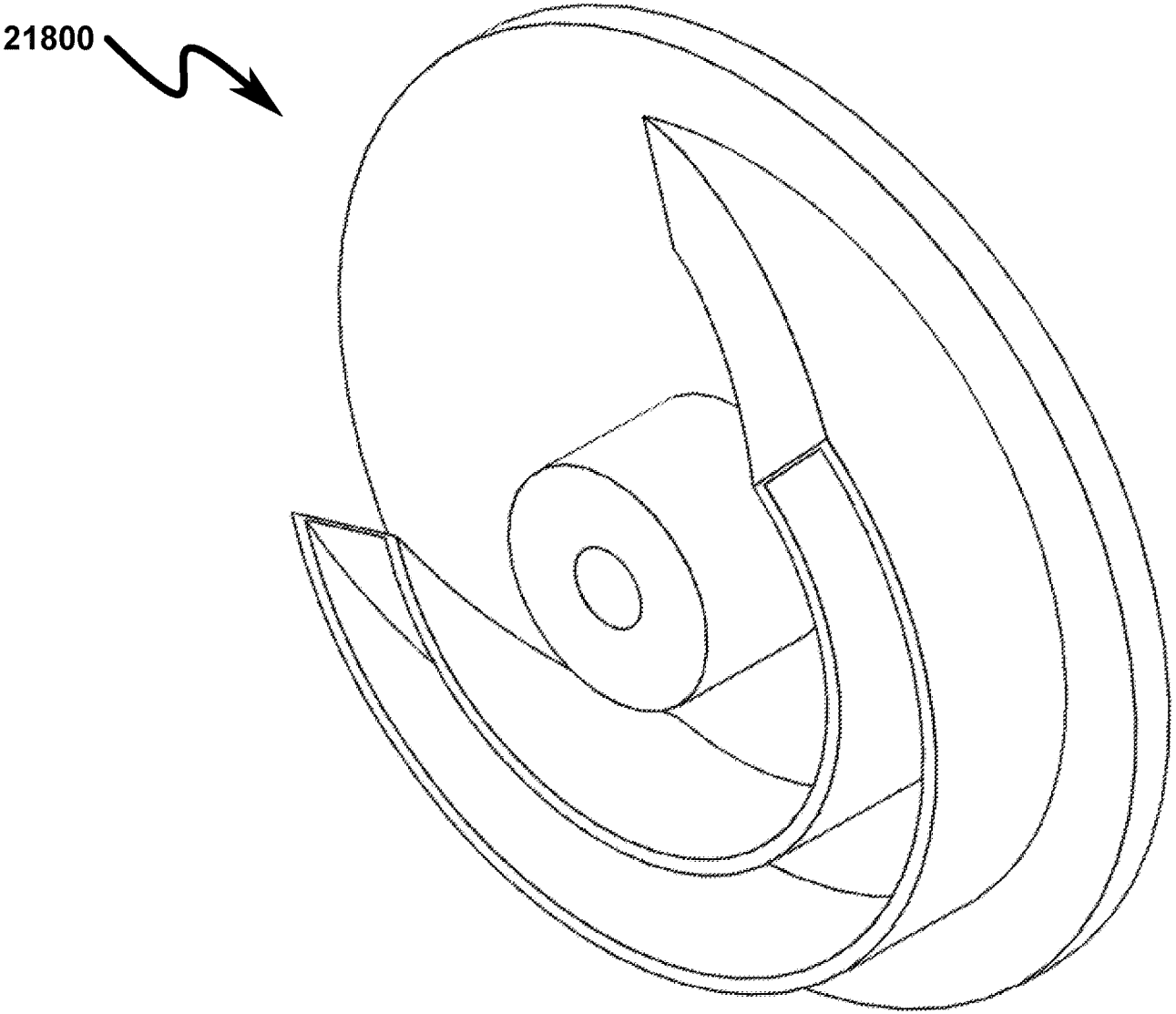
Figure 219:
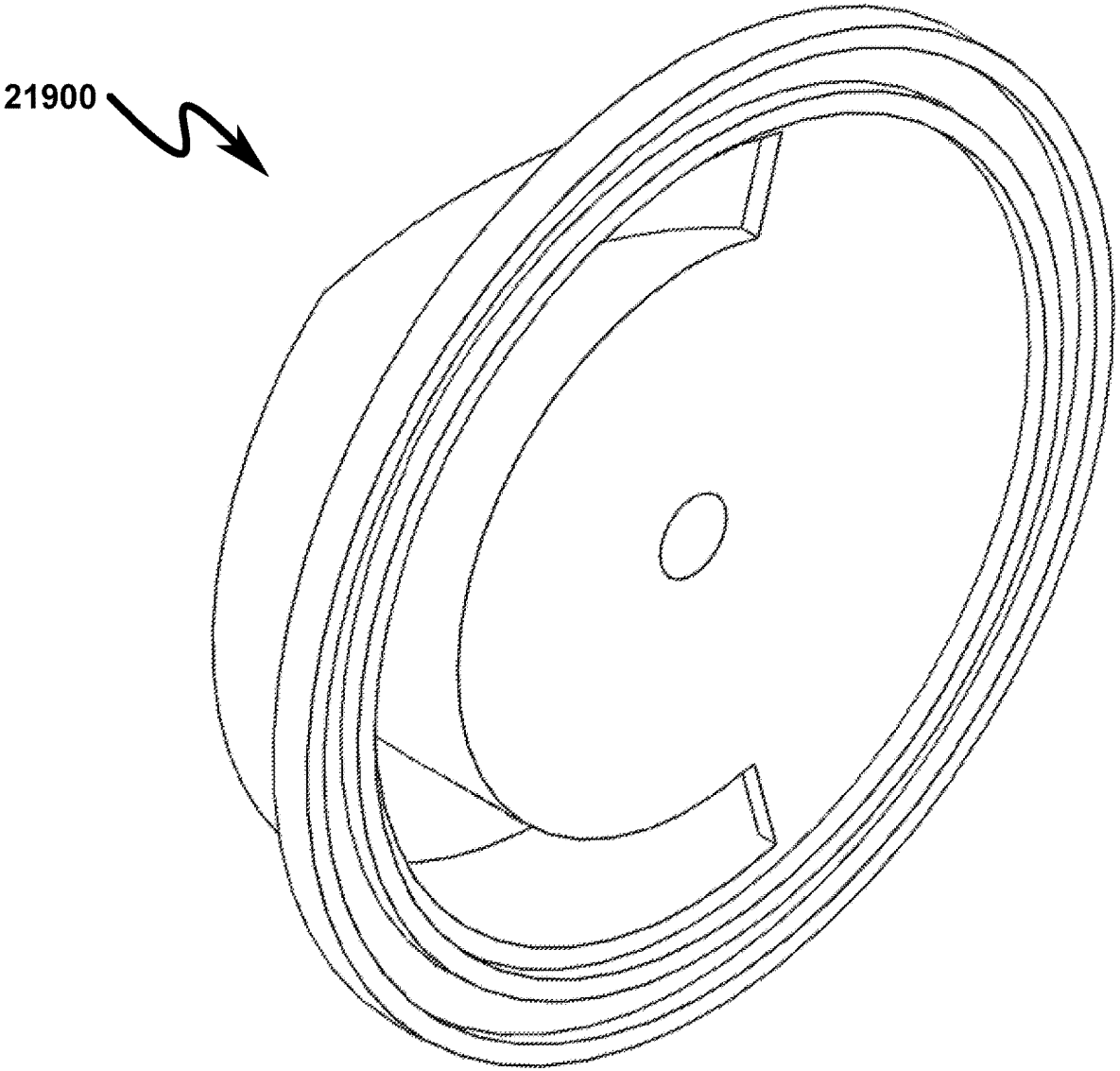
Figure 220:
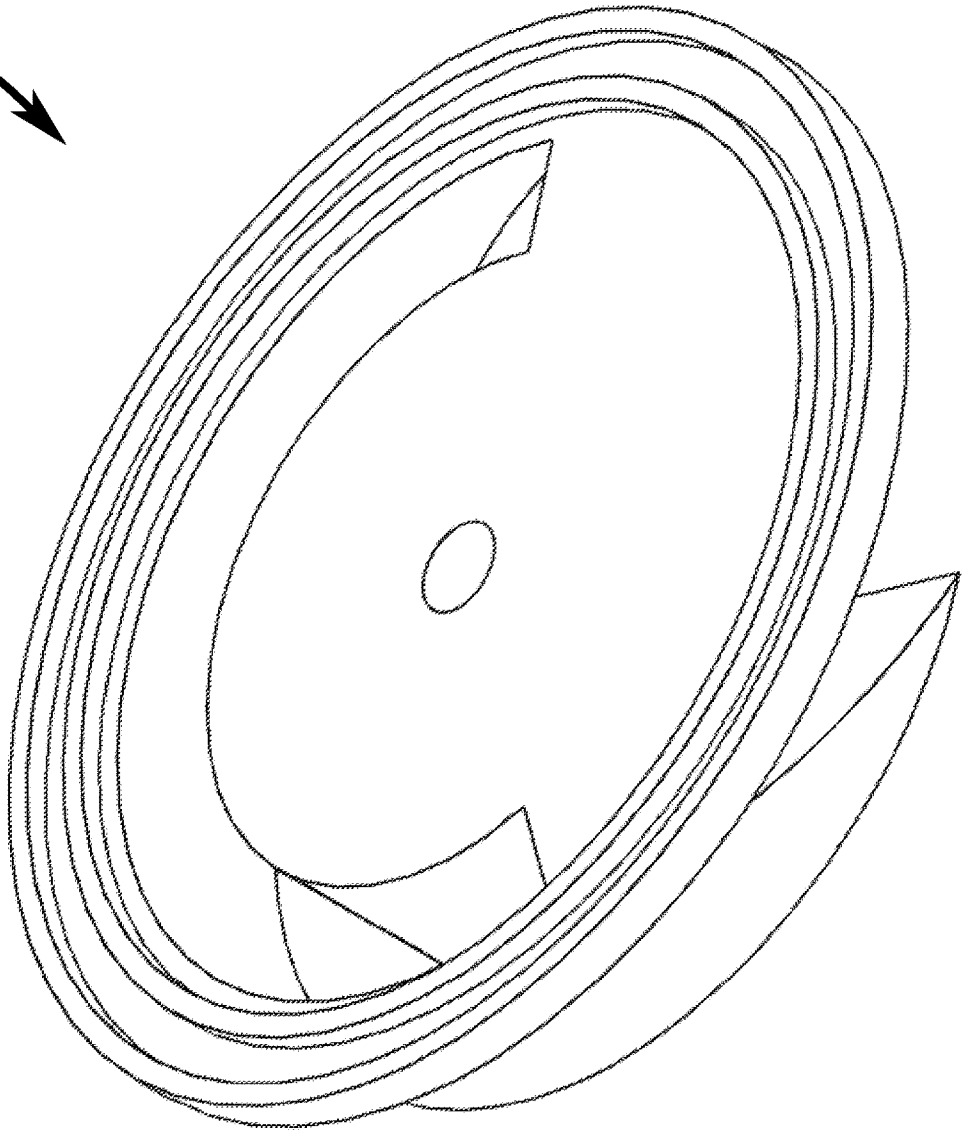
Figure 221:
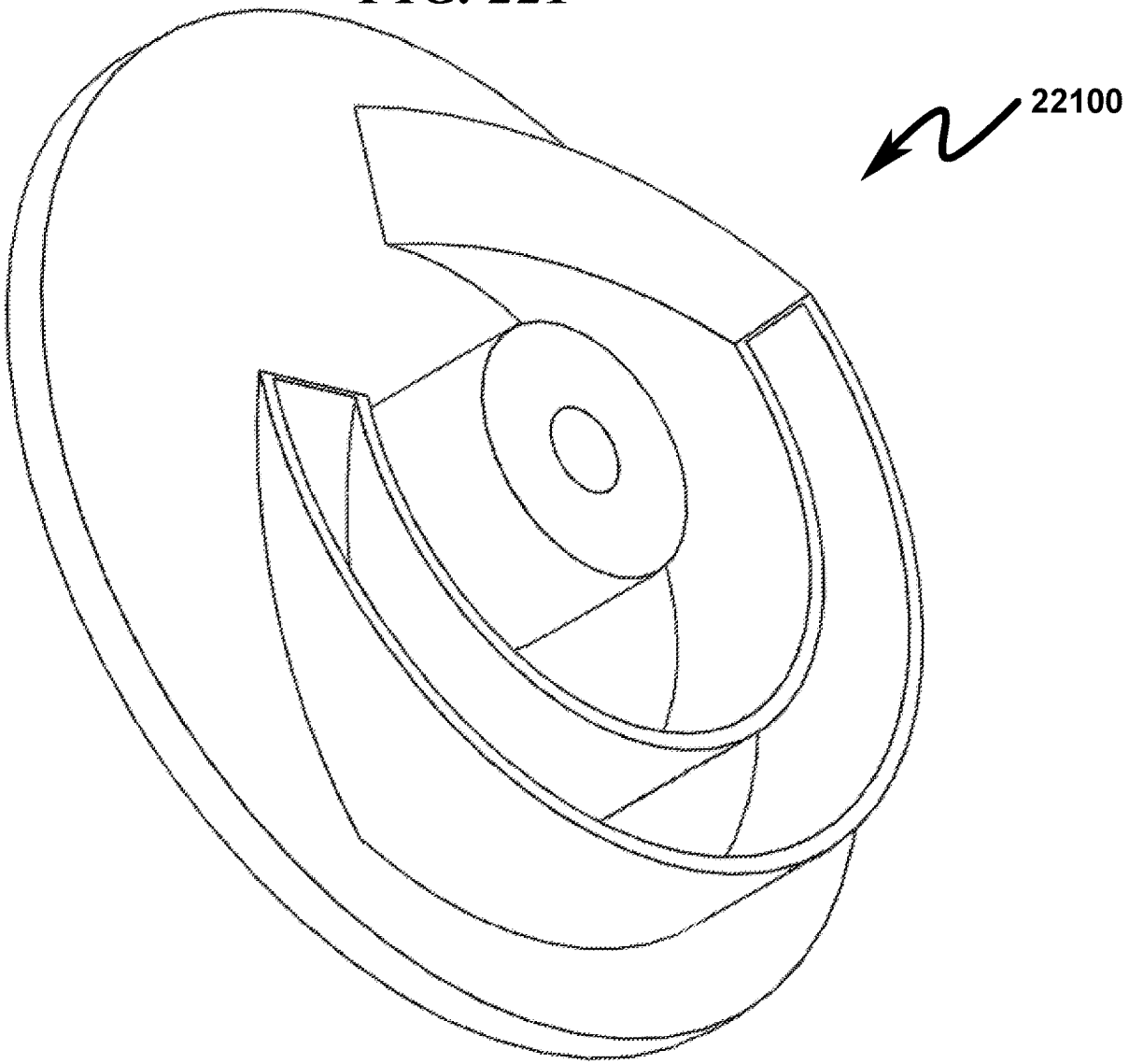
Figure 222:
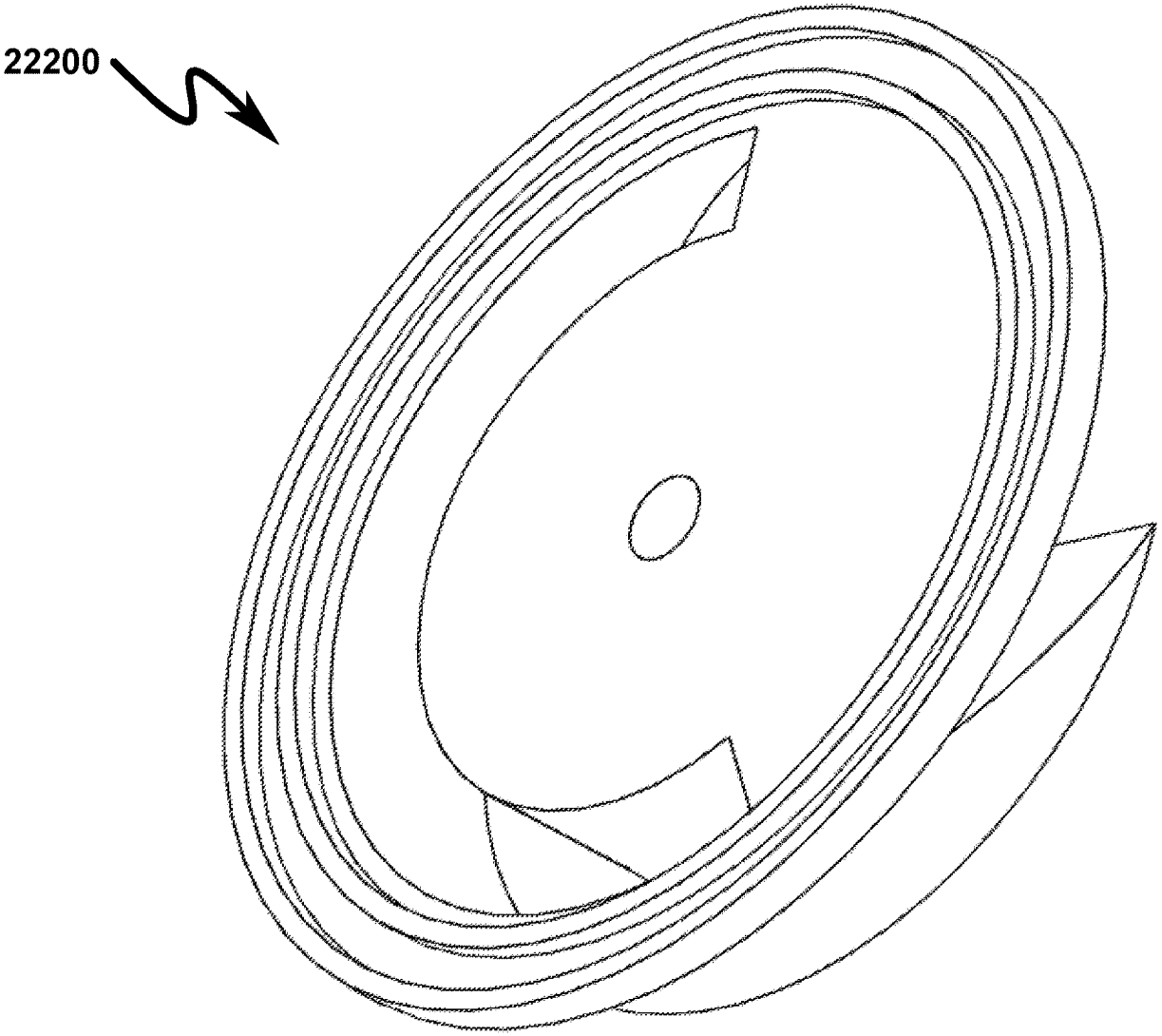
Figure 223:
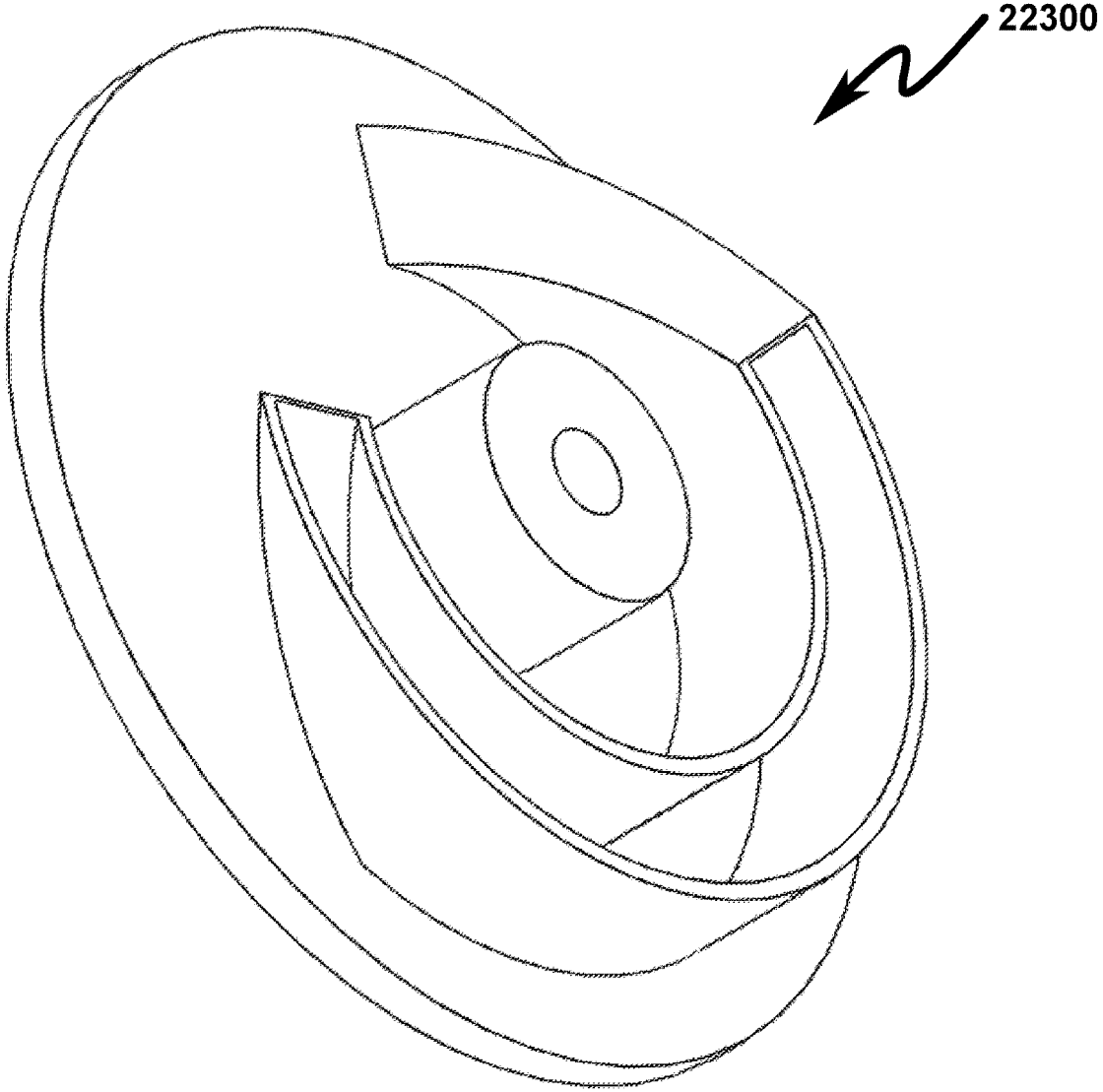
Figure 224:
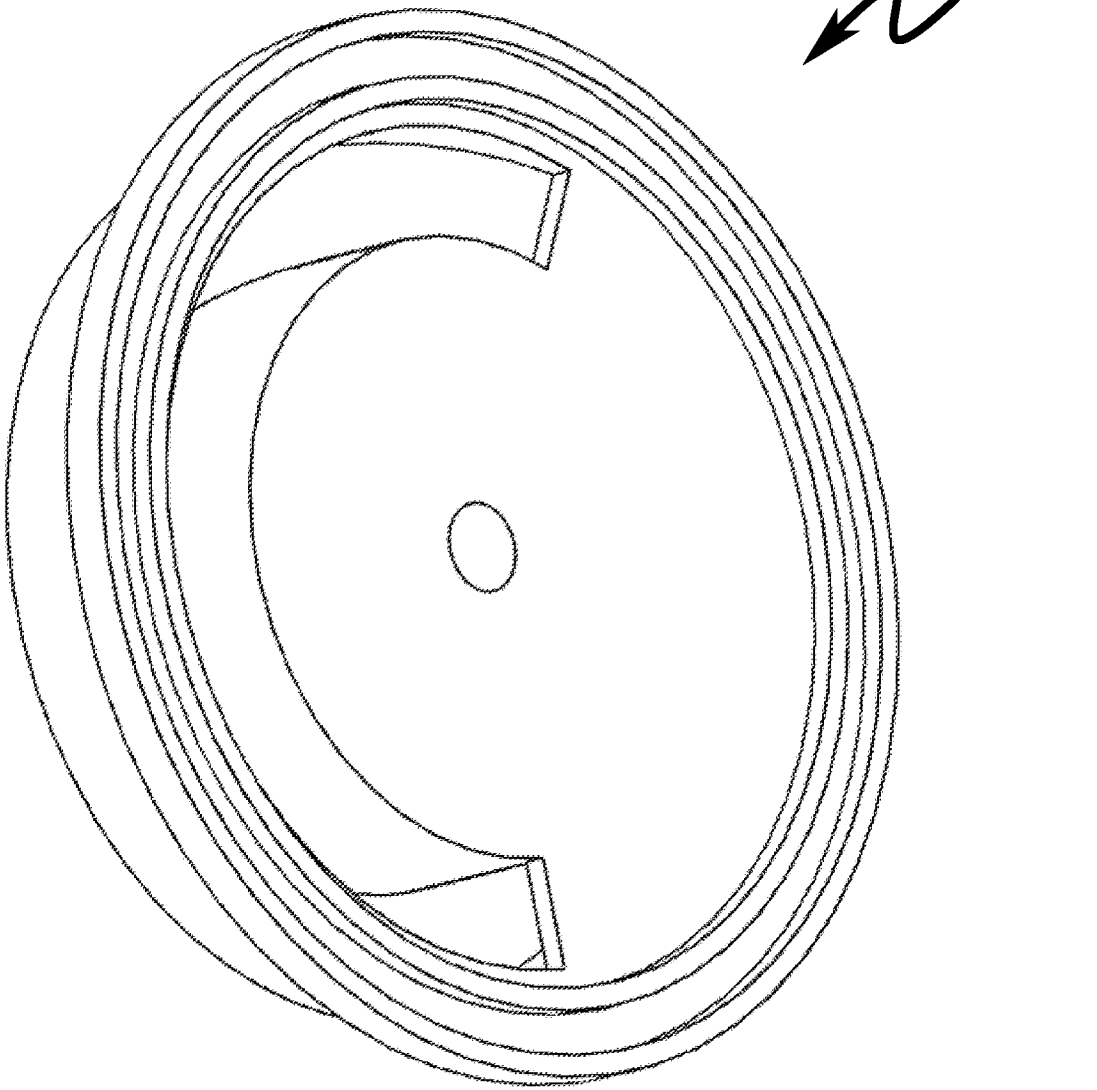
Figure 225:
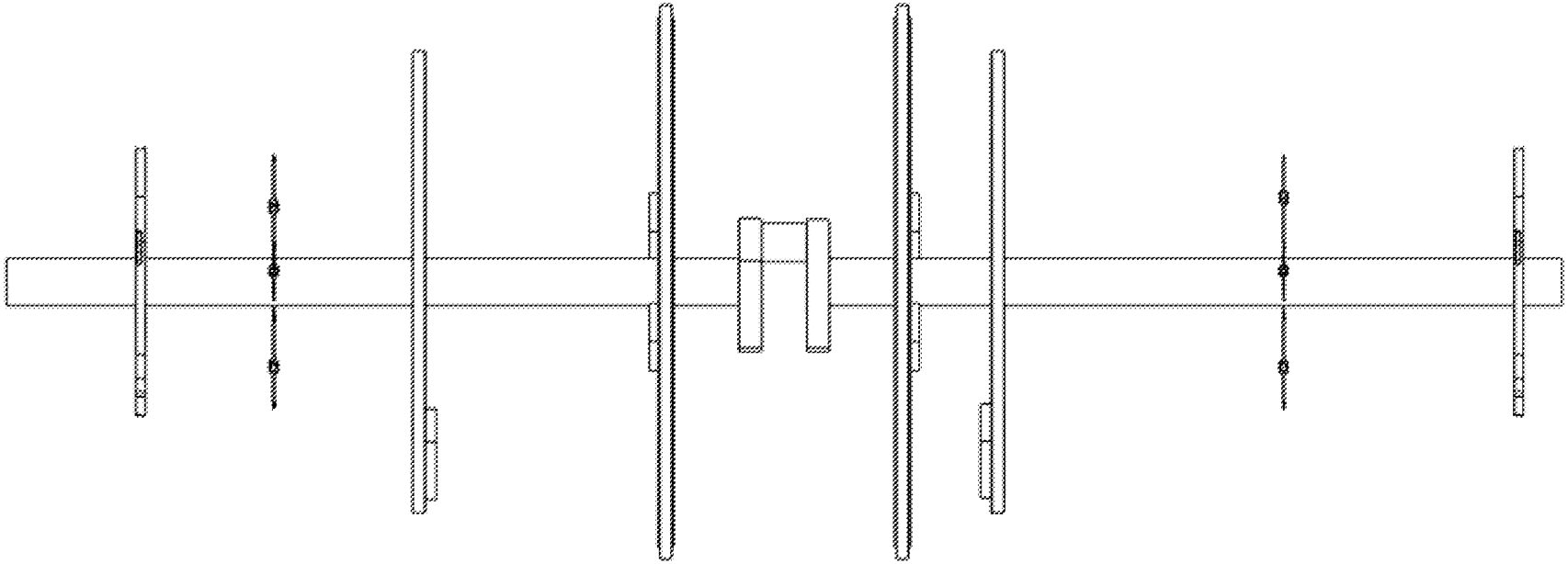
Figure 226:
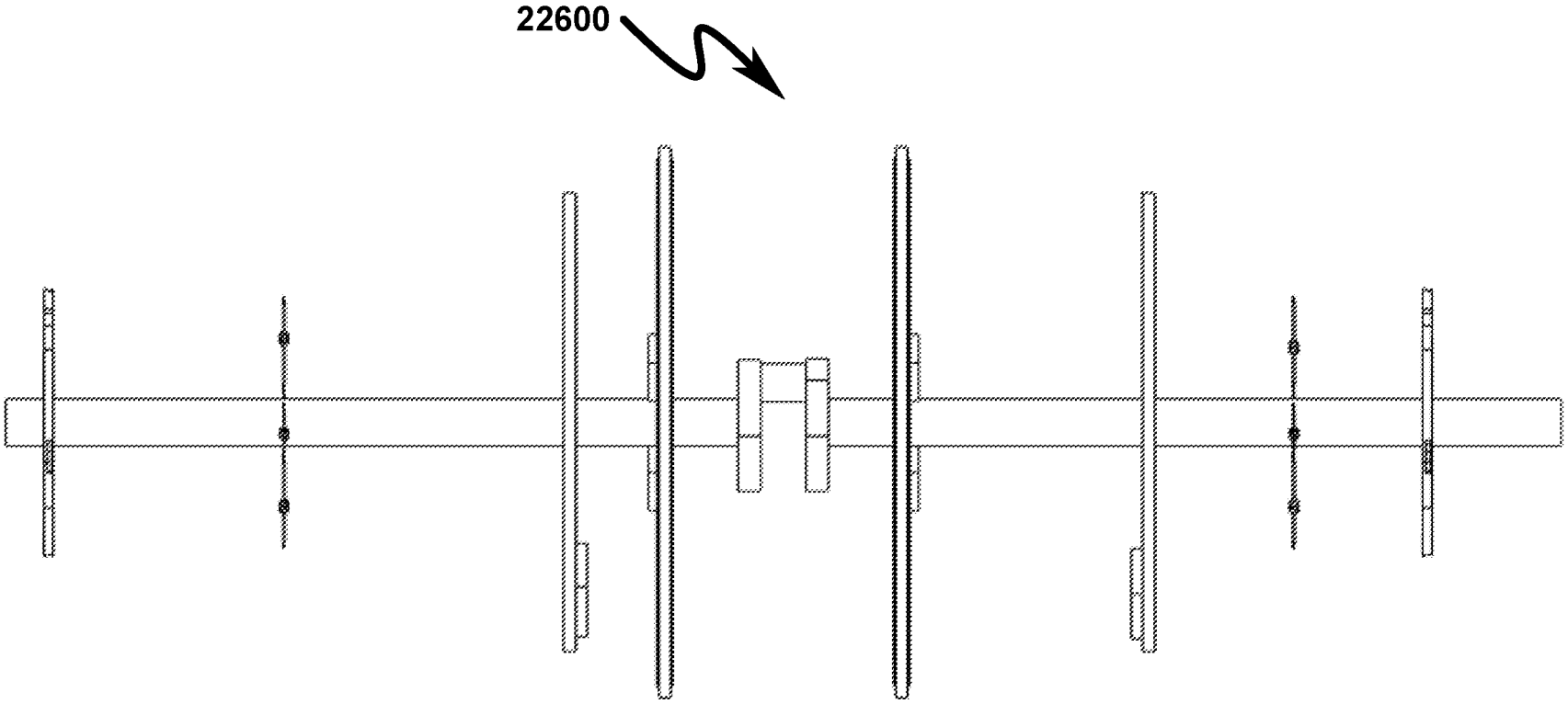
Figure 227:
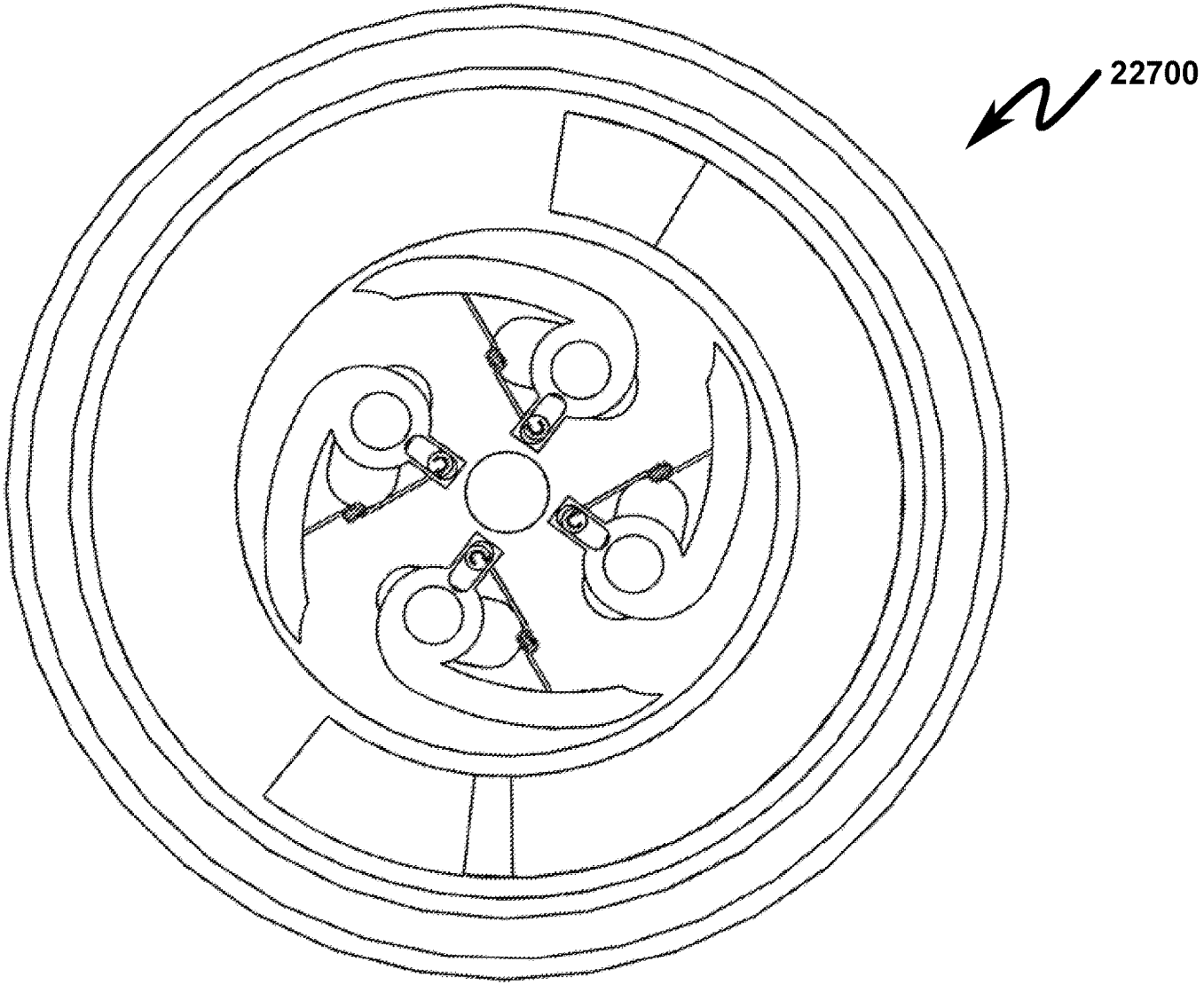
Figure 228:
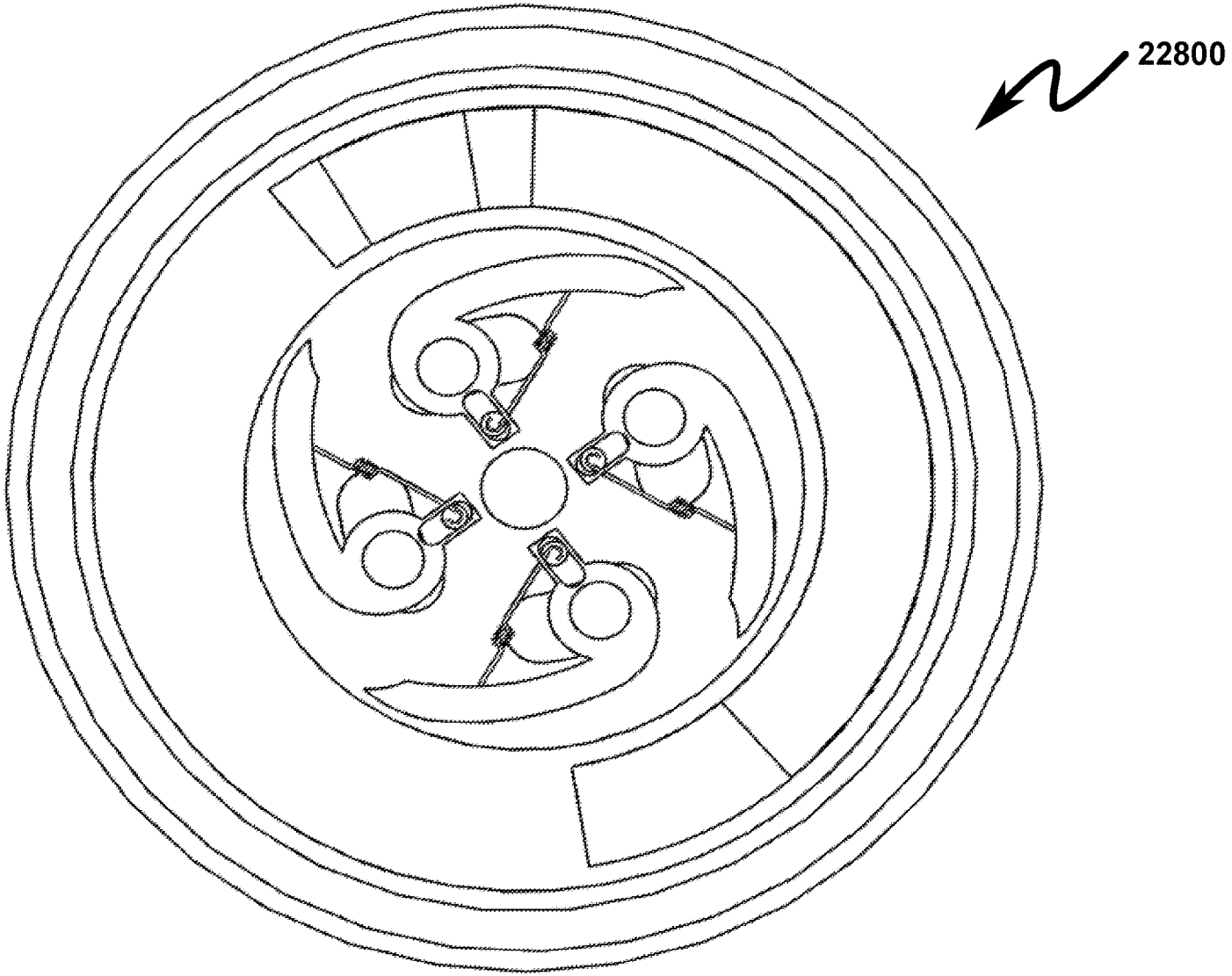
Figure 229:
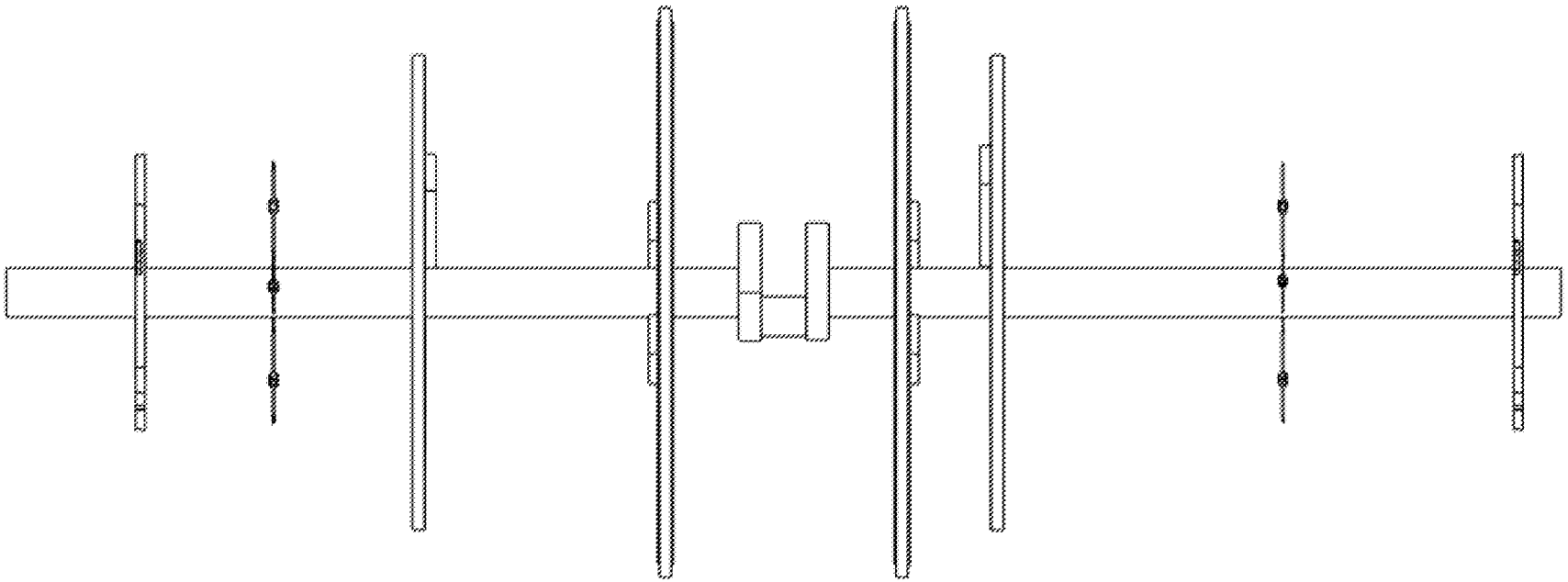
Figure 230:
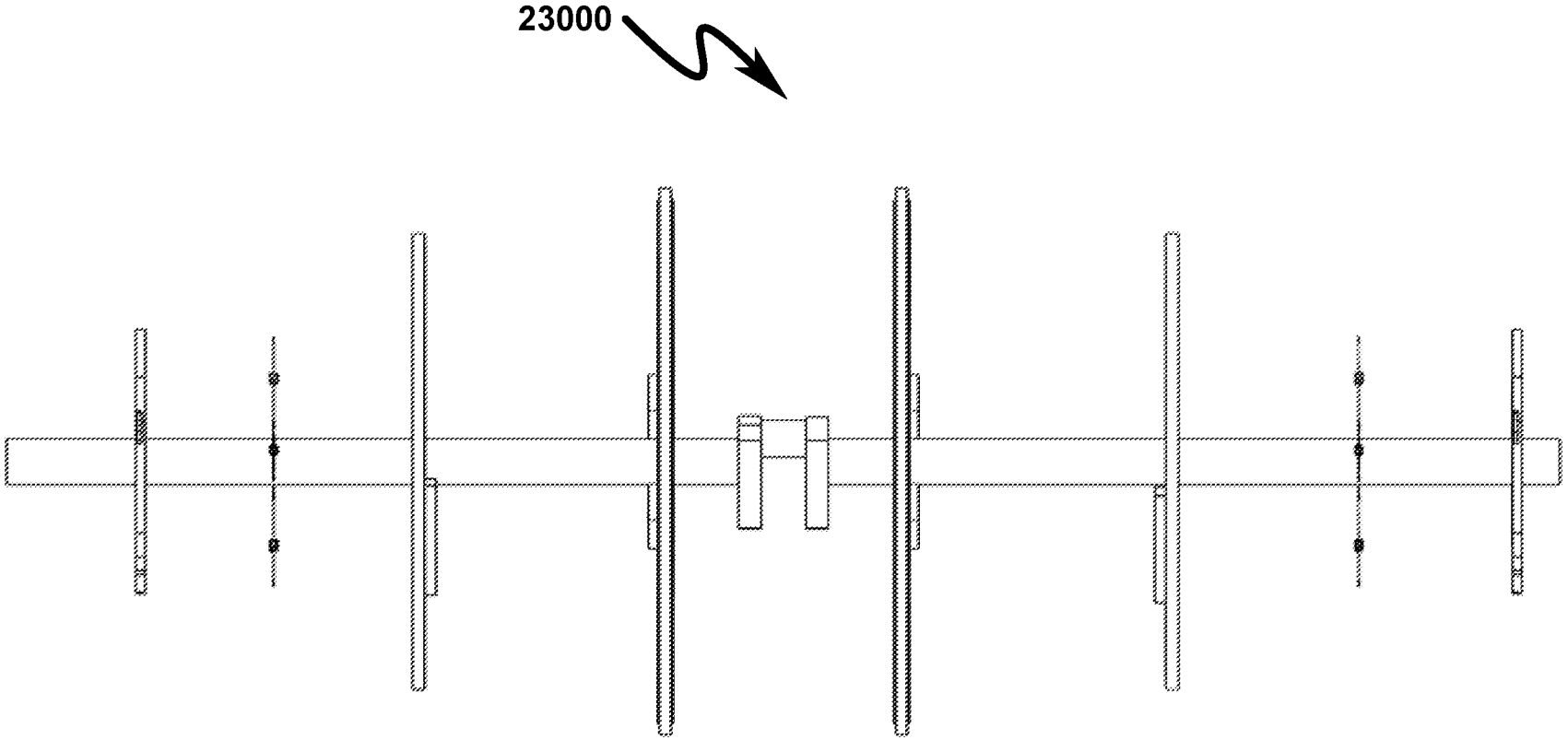
Figure 231:
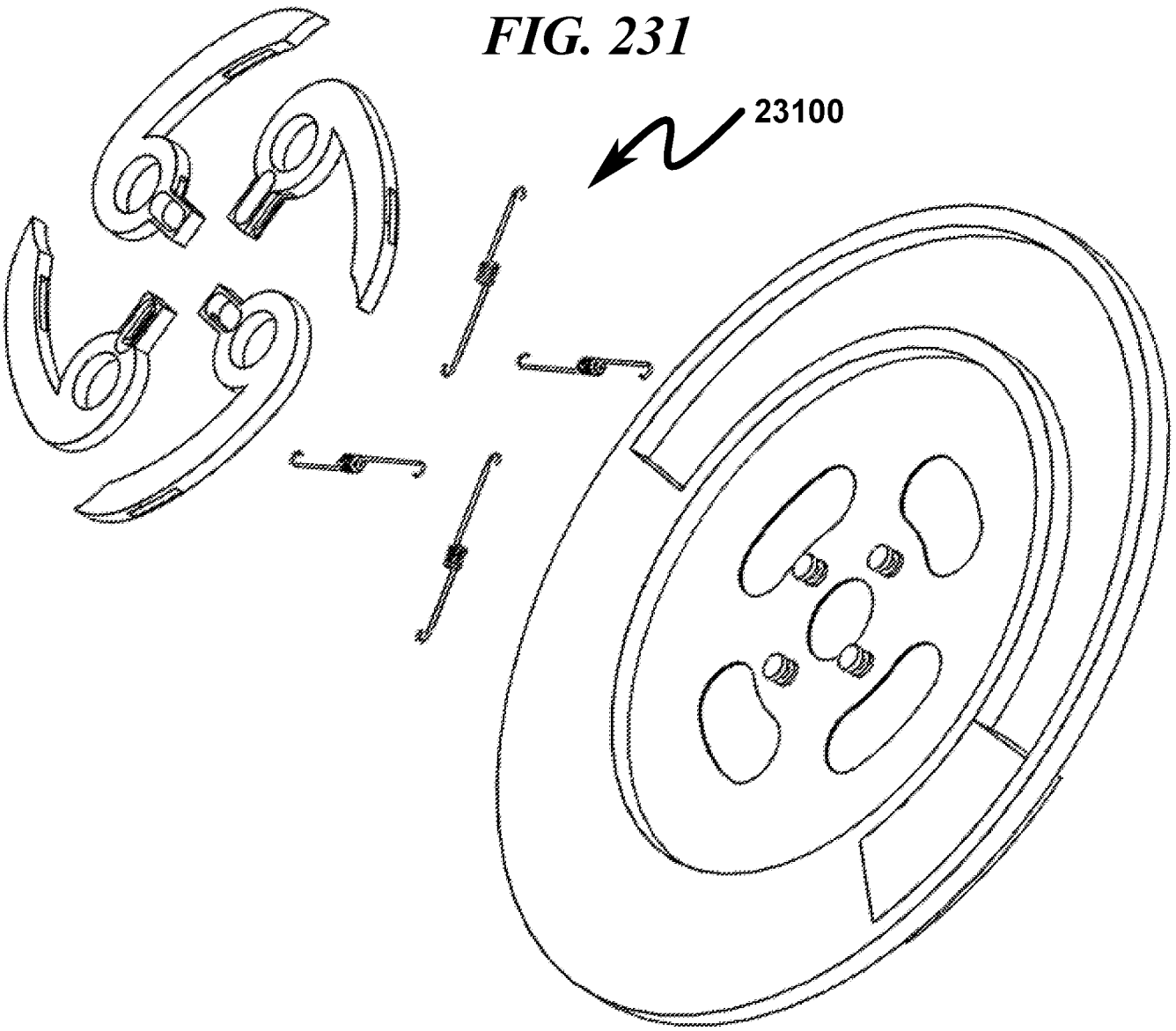
Figure 232:
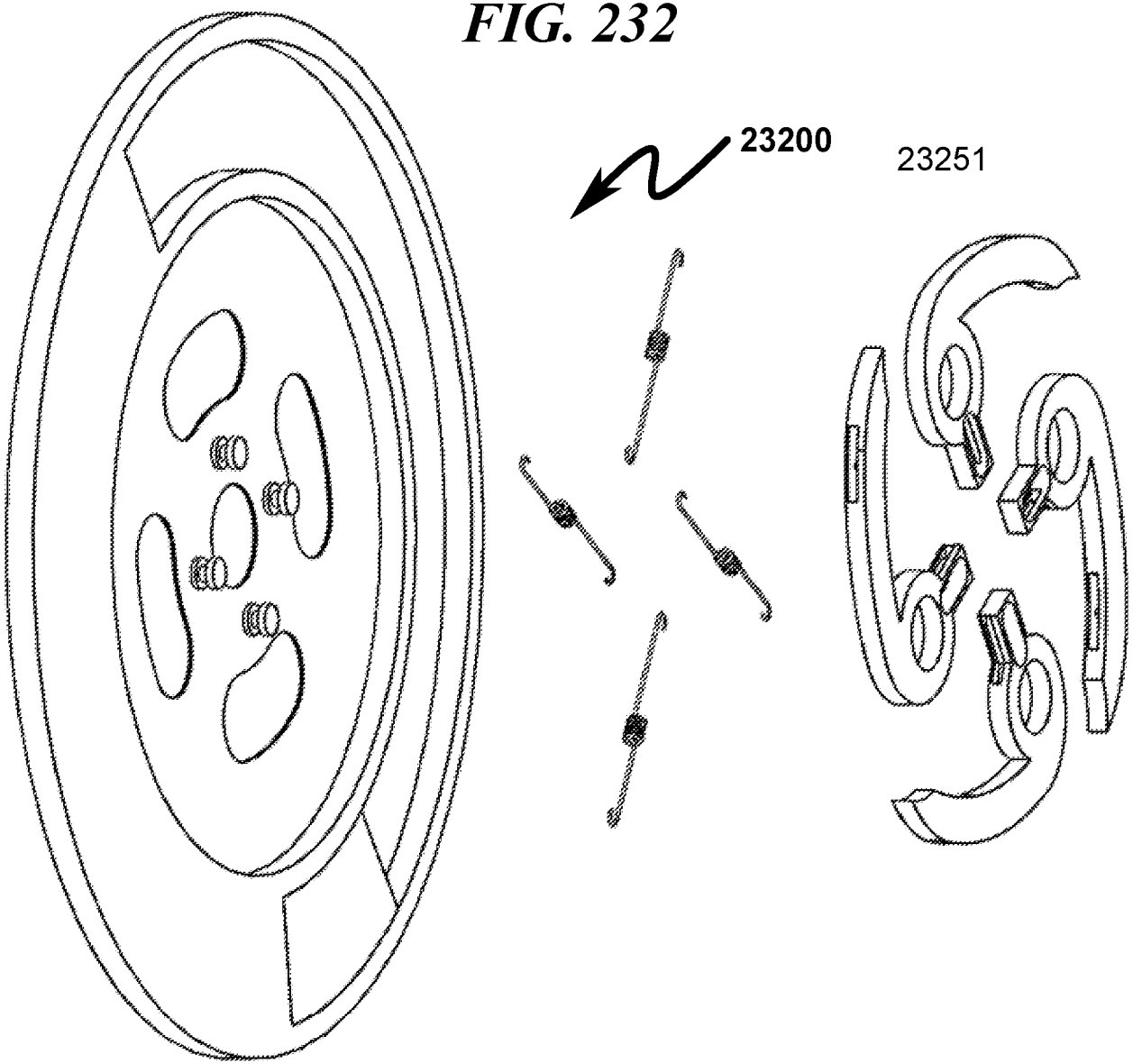
Figure 233:
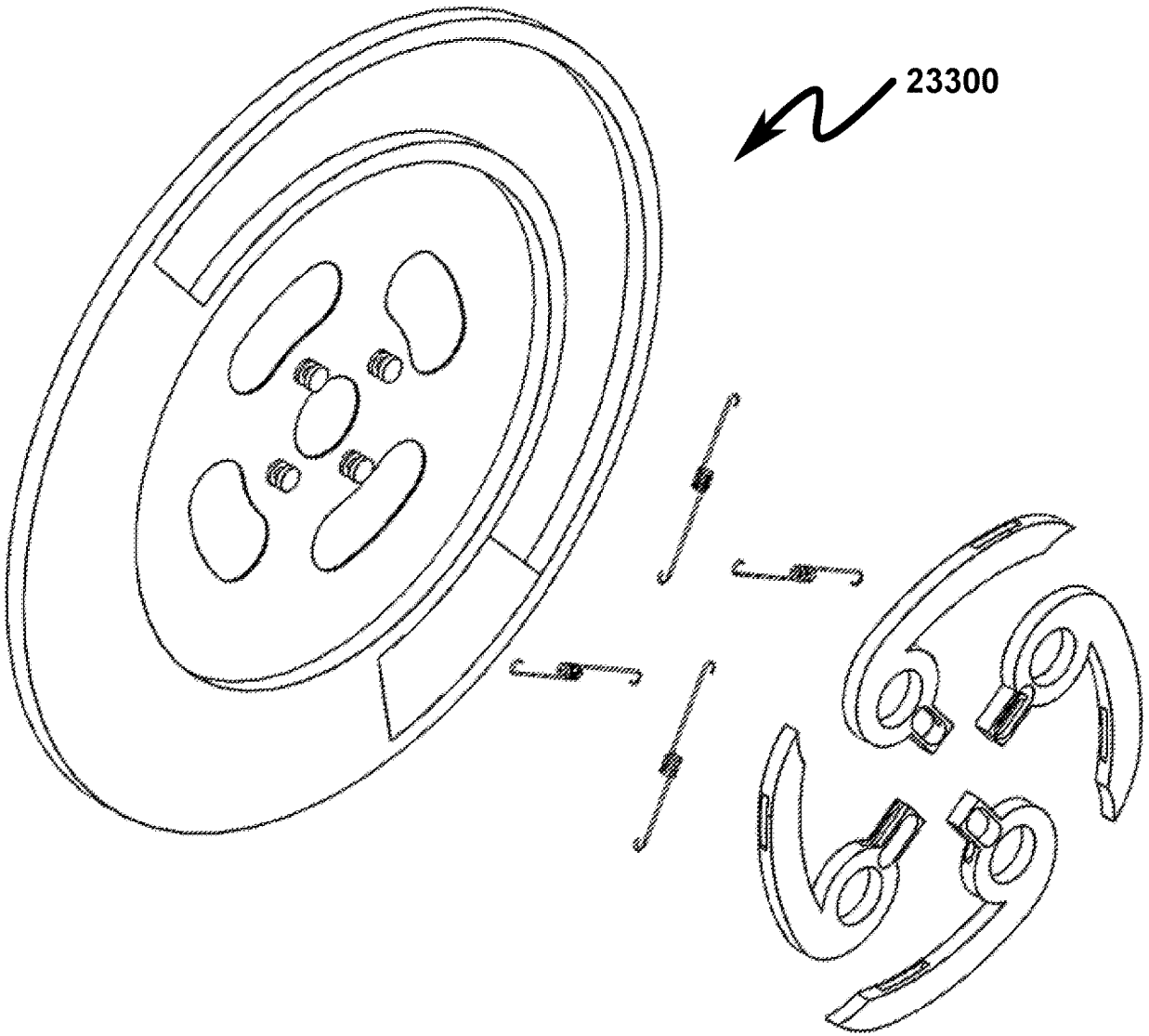
Figure 234:
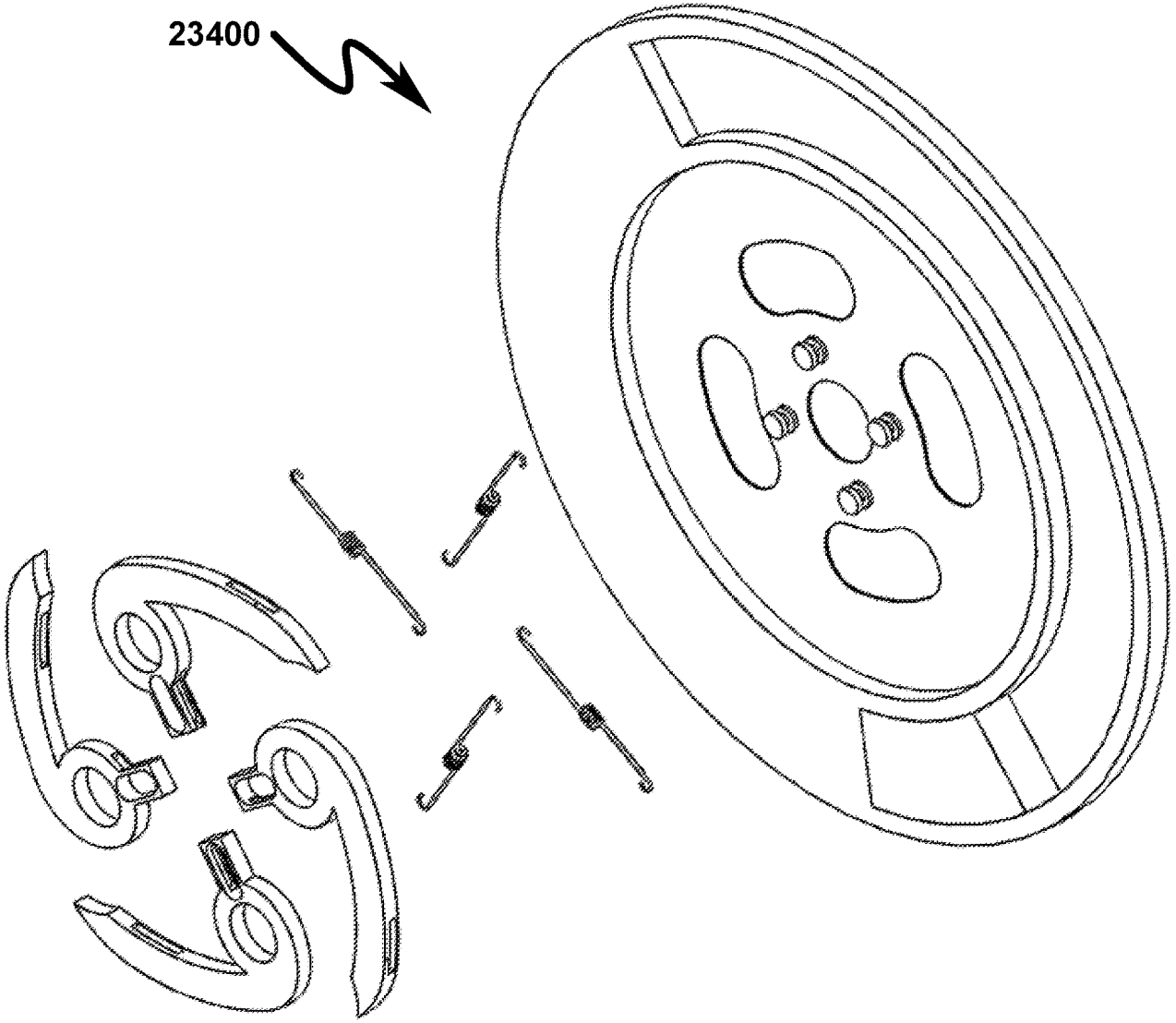
Figure 235:
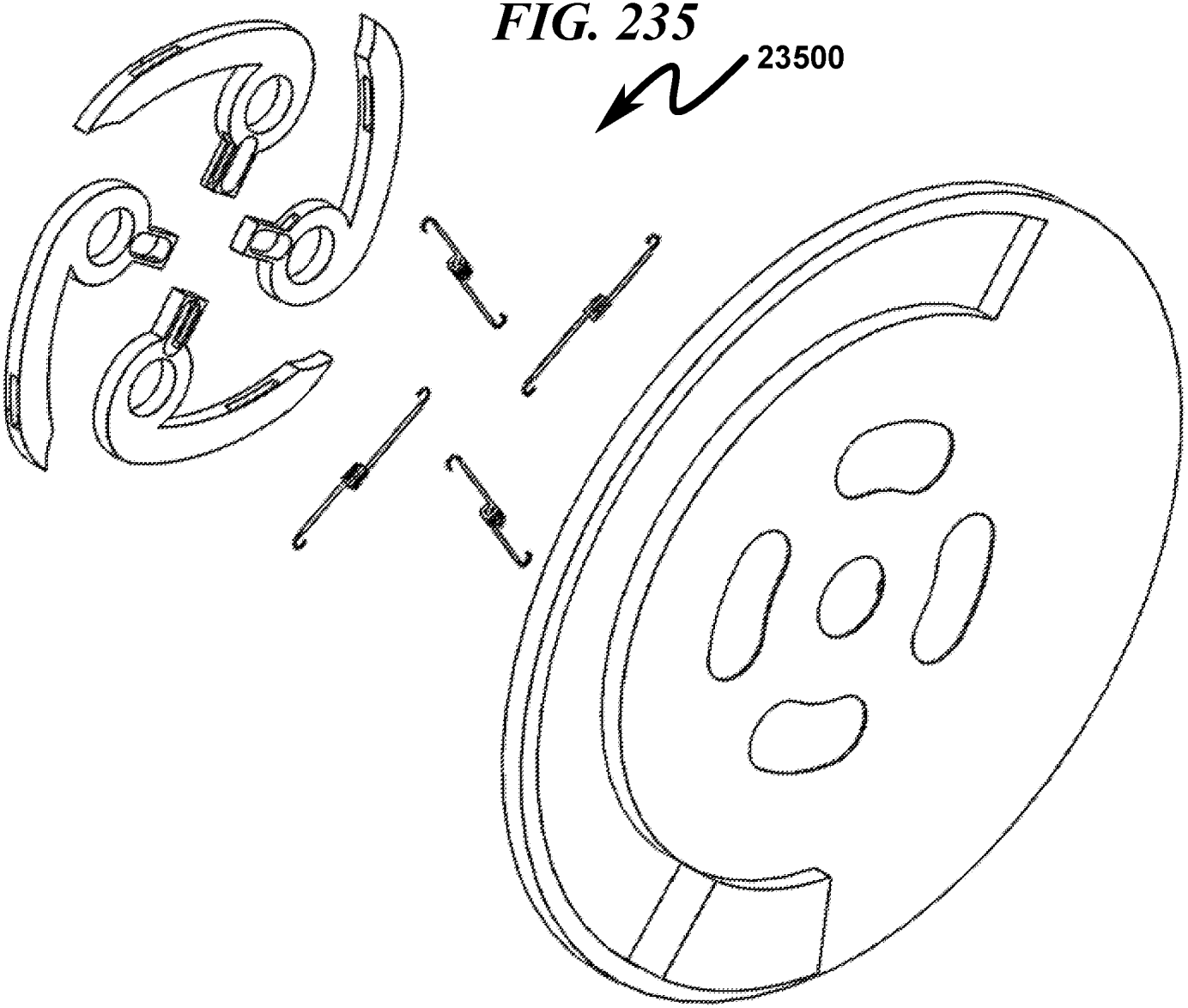
Figure 236:
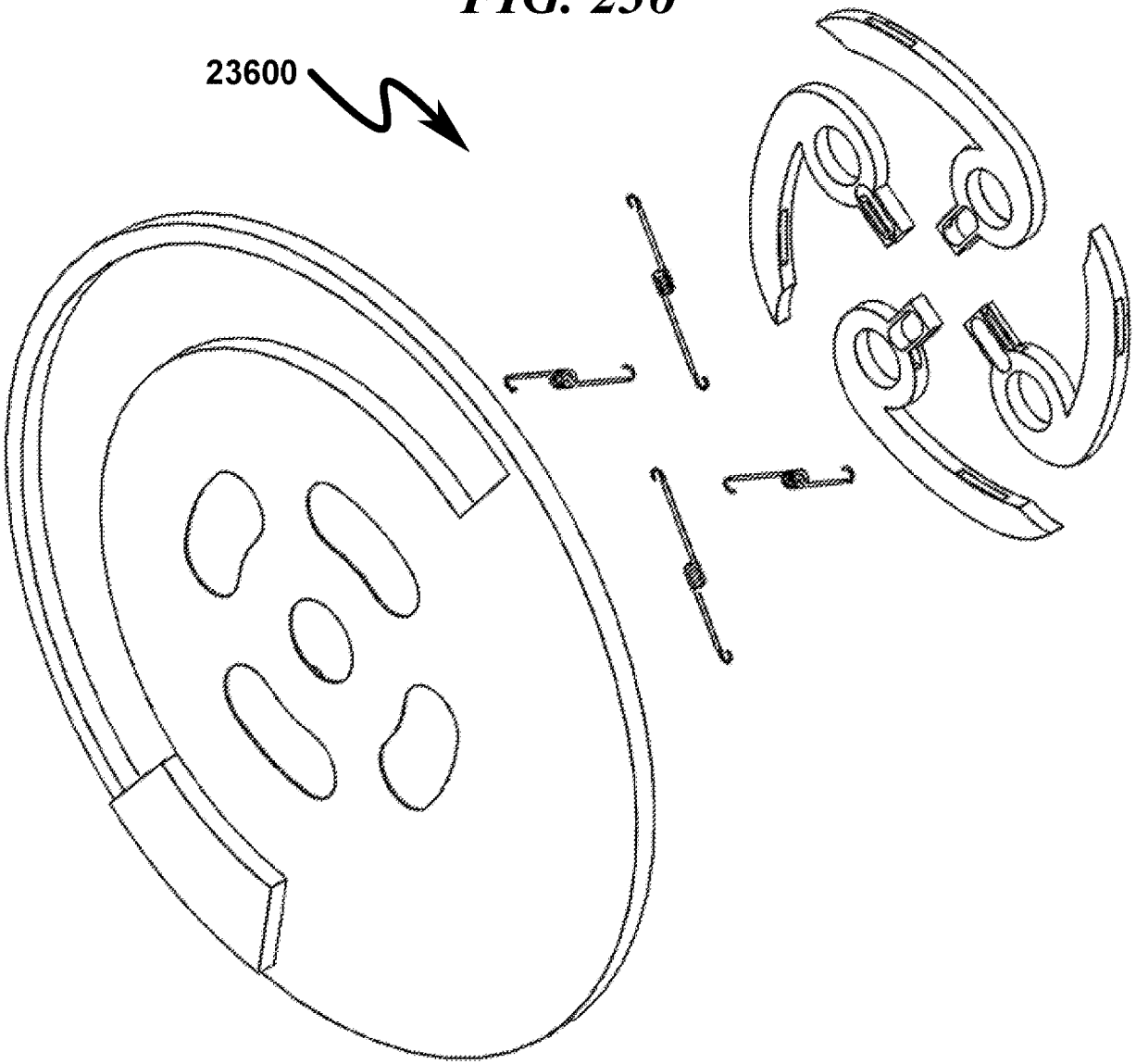
Figure 237:
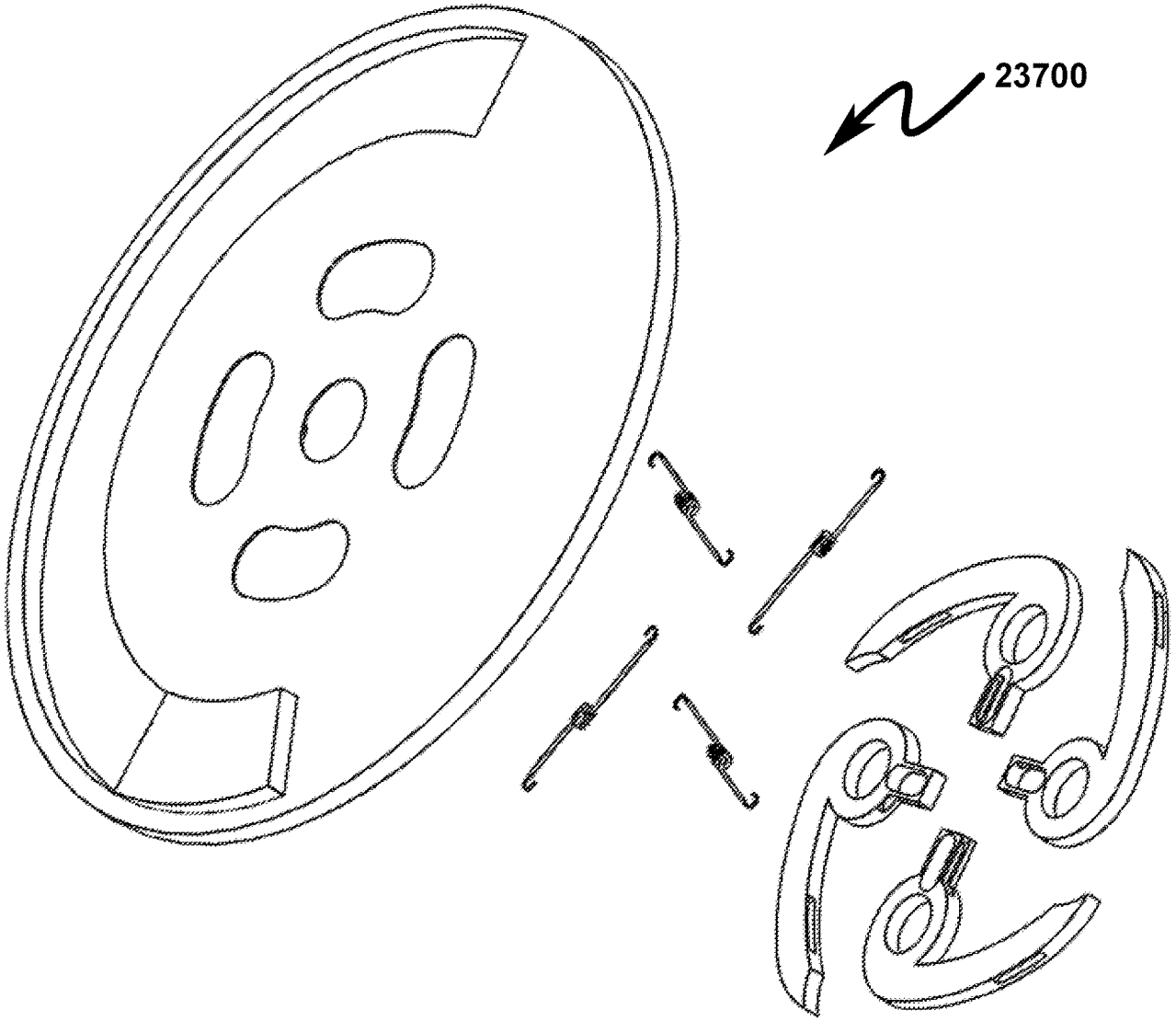
Figure 238:
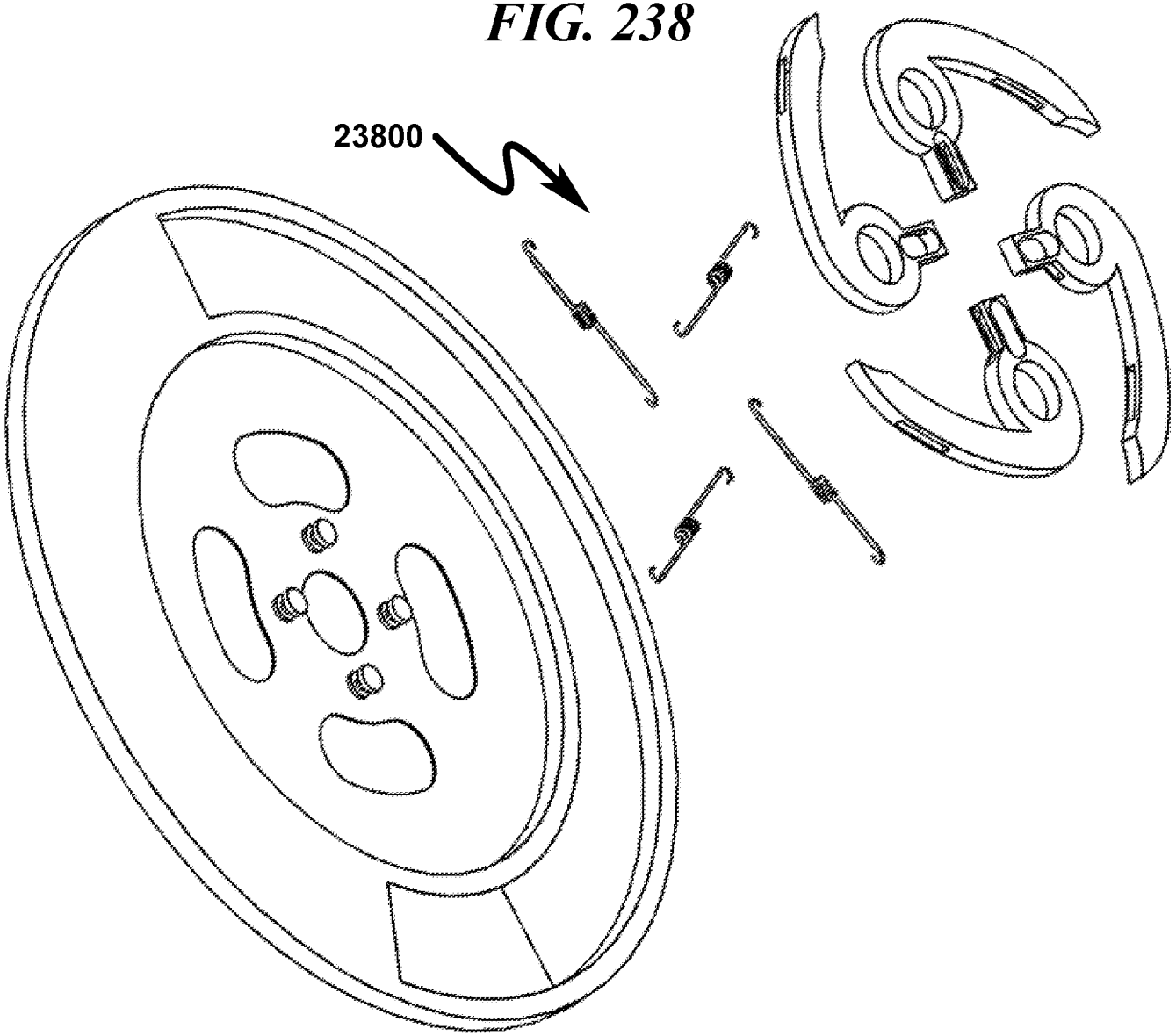
Figure 239:
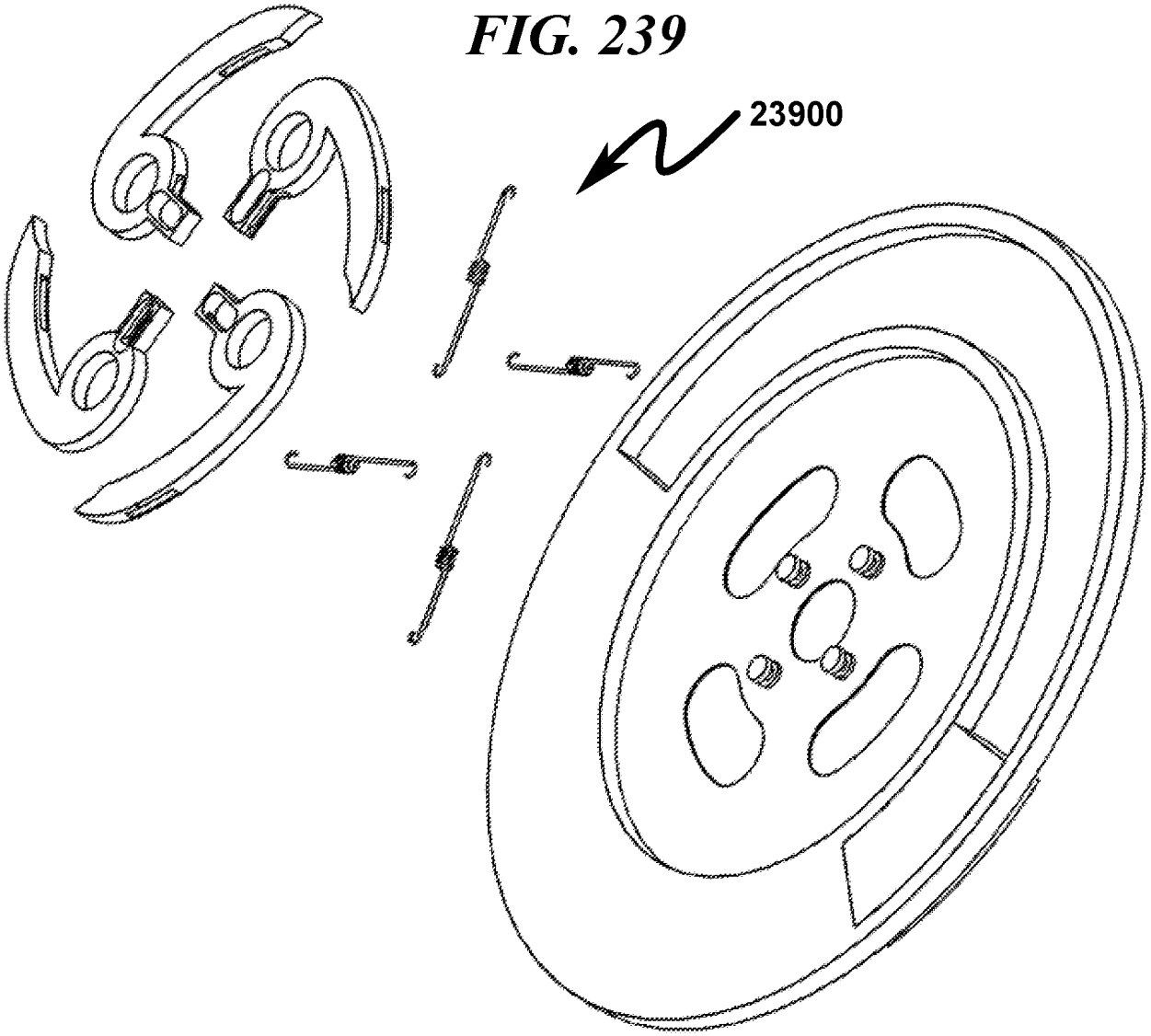
Figure 240:
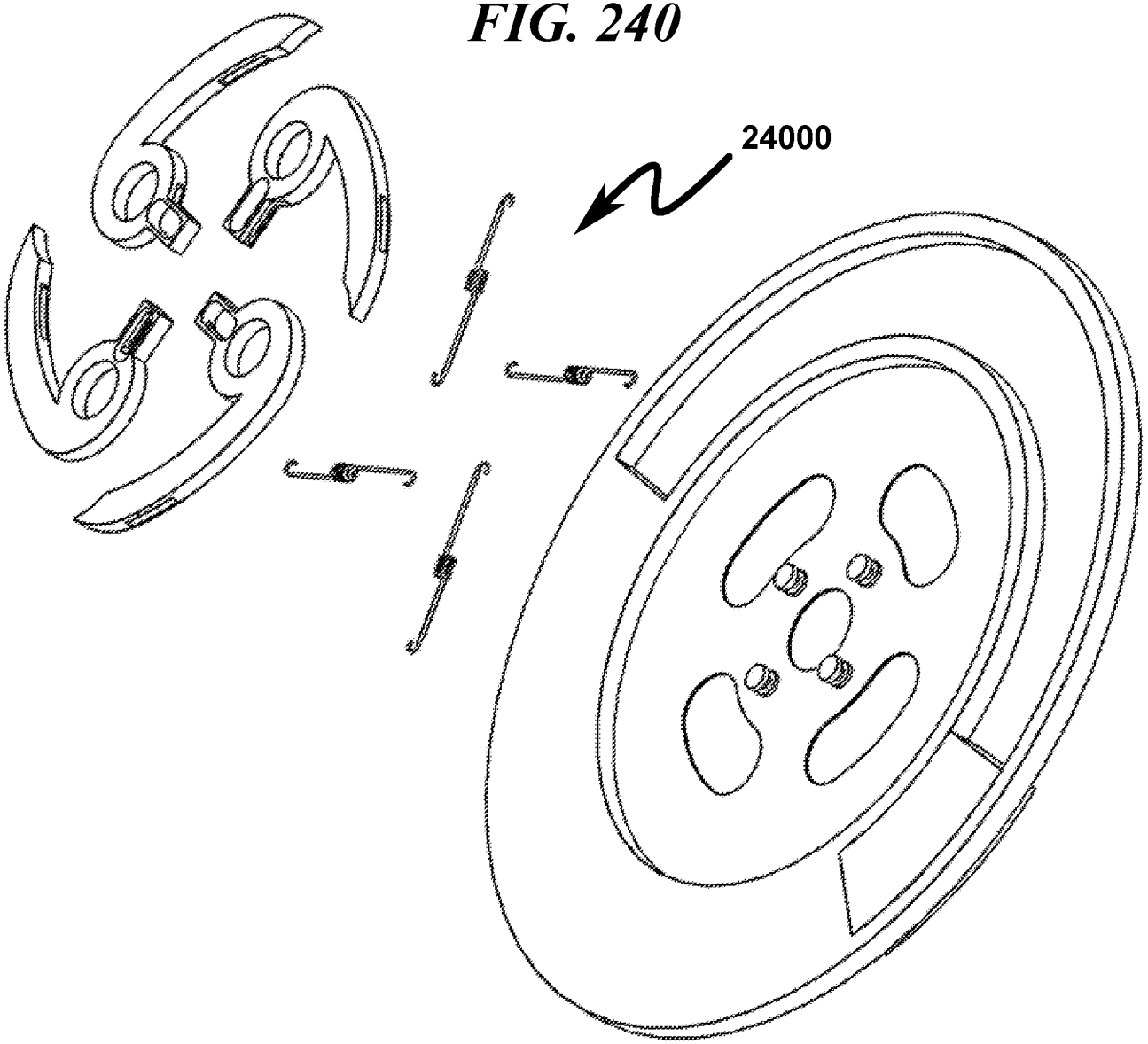
Figure 241:
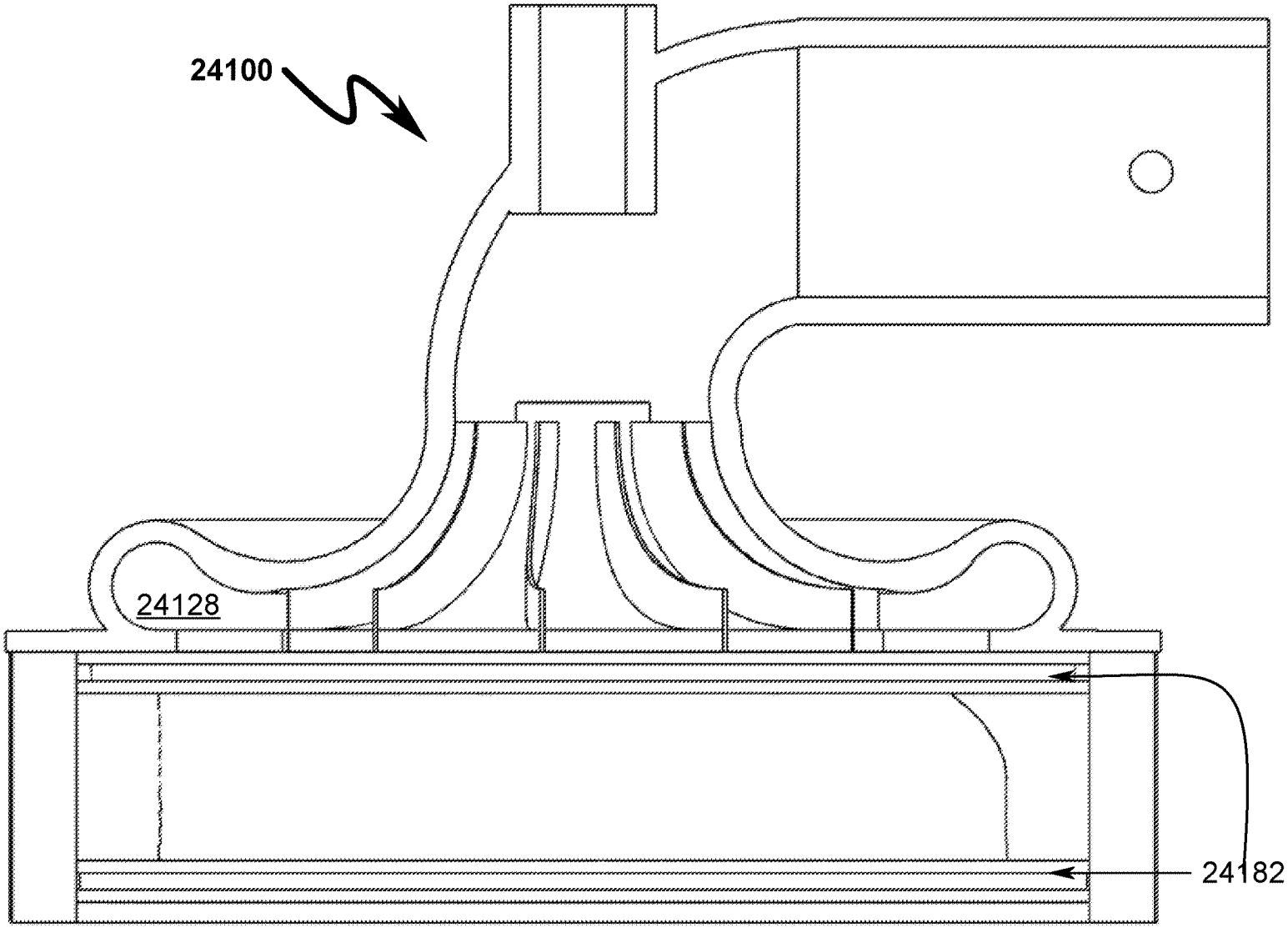
Figure 242:
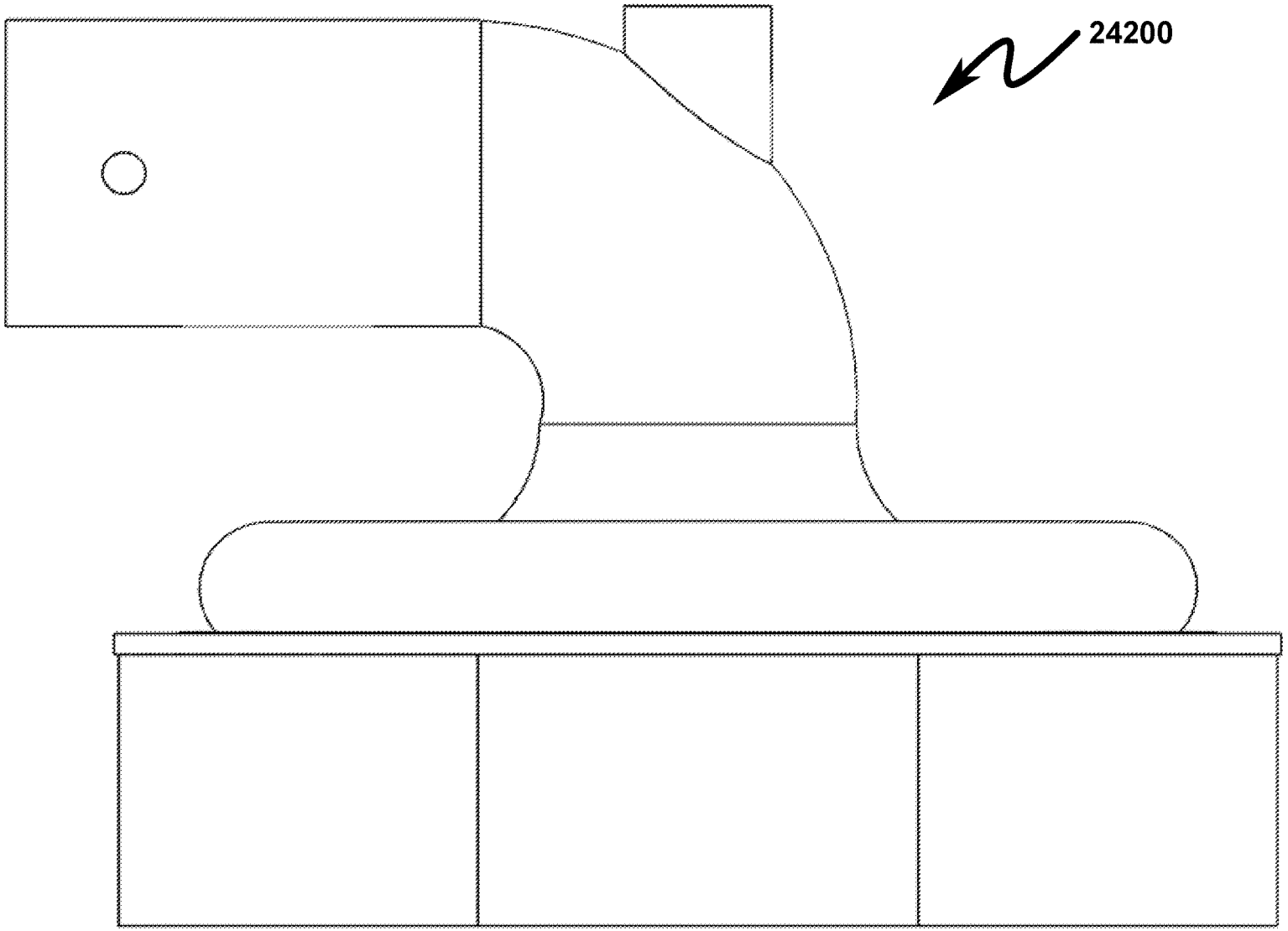
Figure 243:
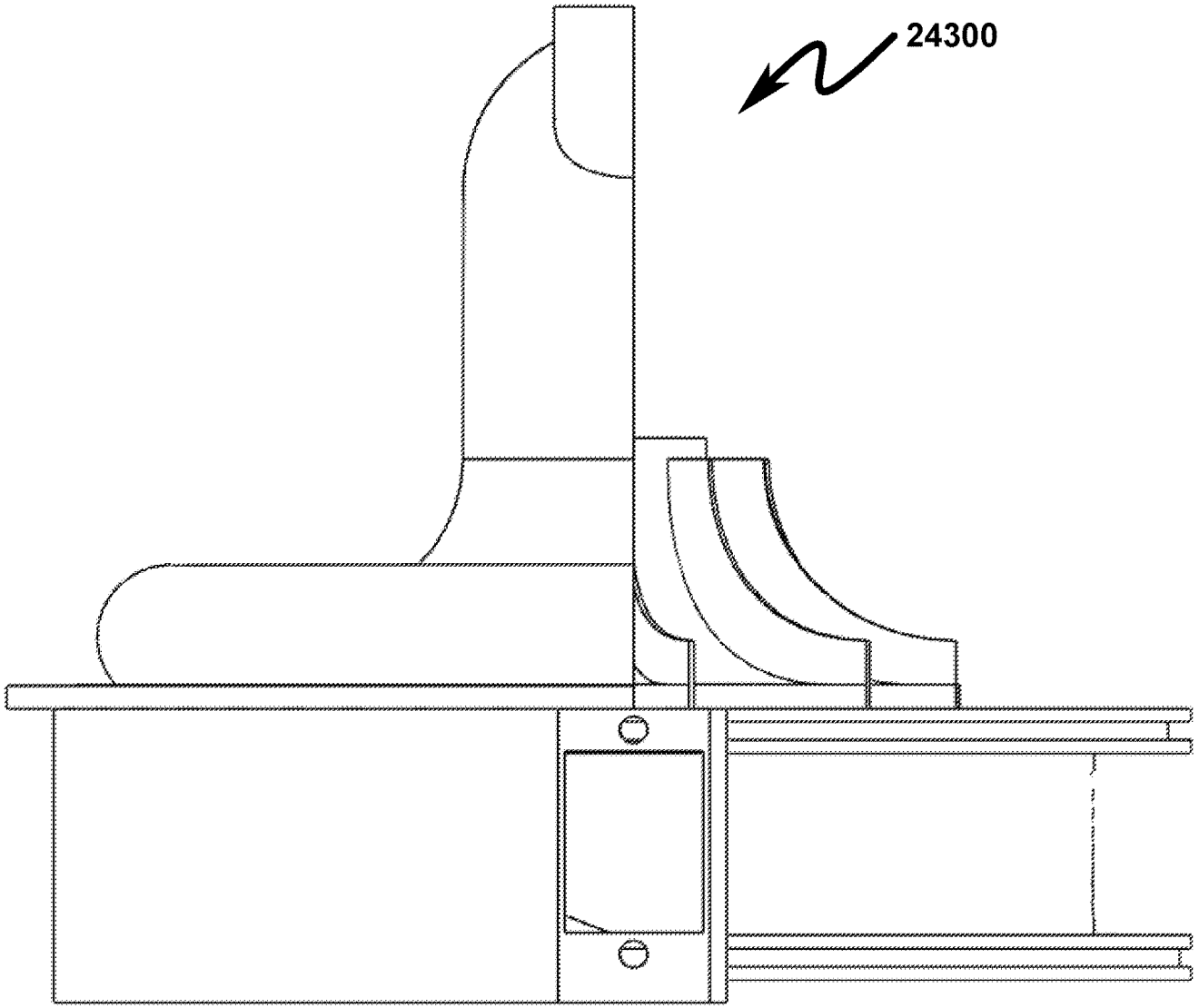
Figure 244:
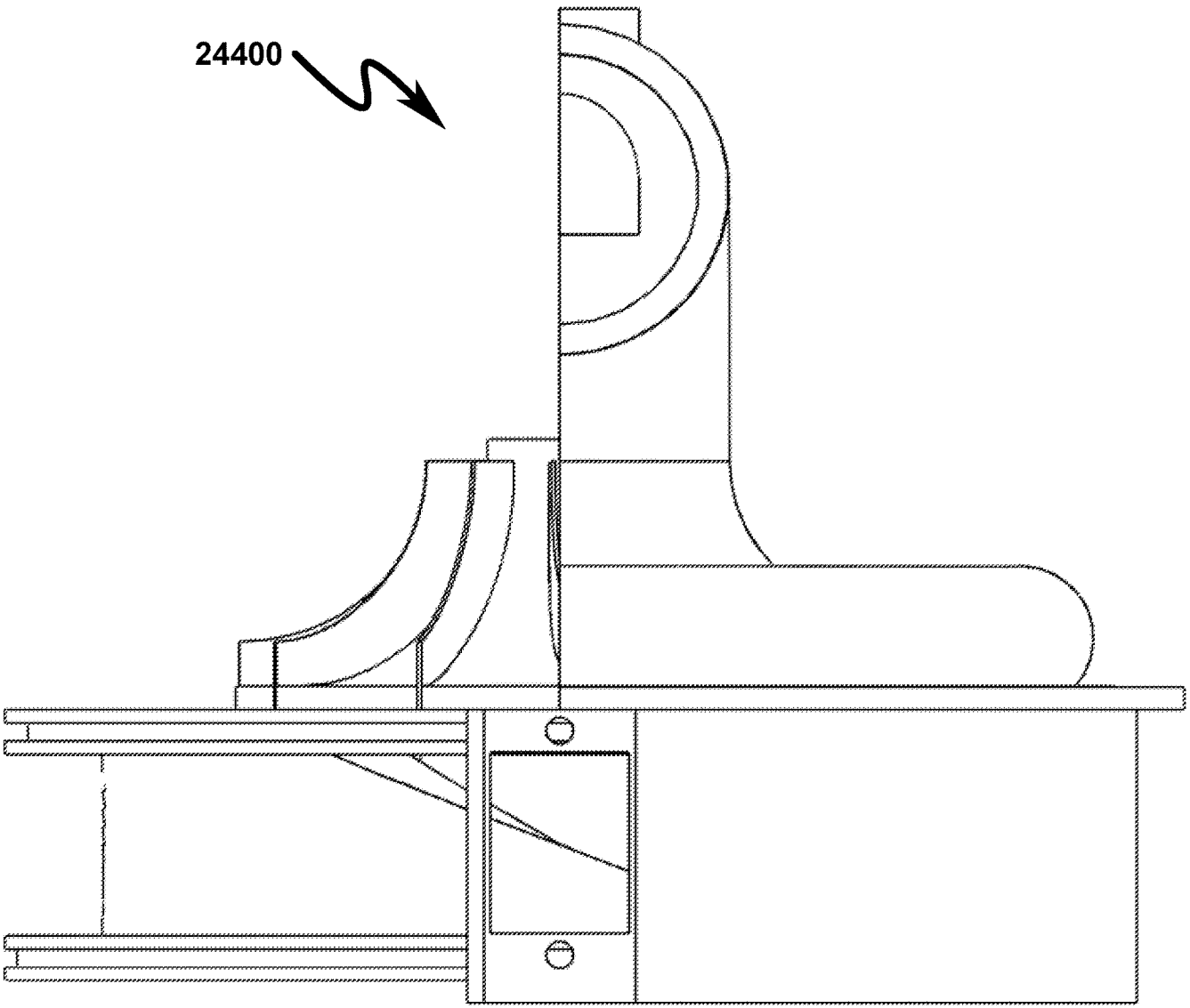
Figure 245:
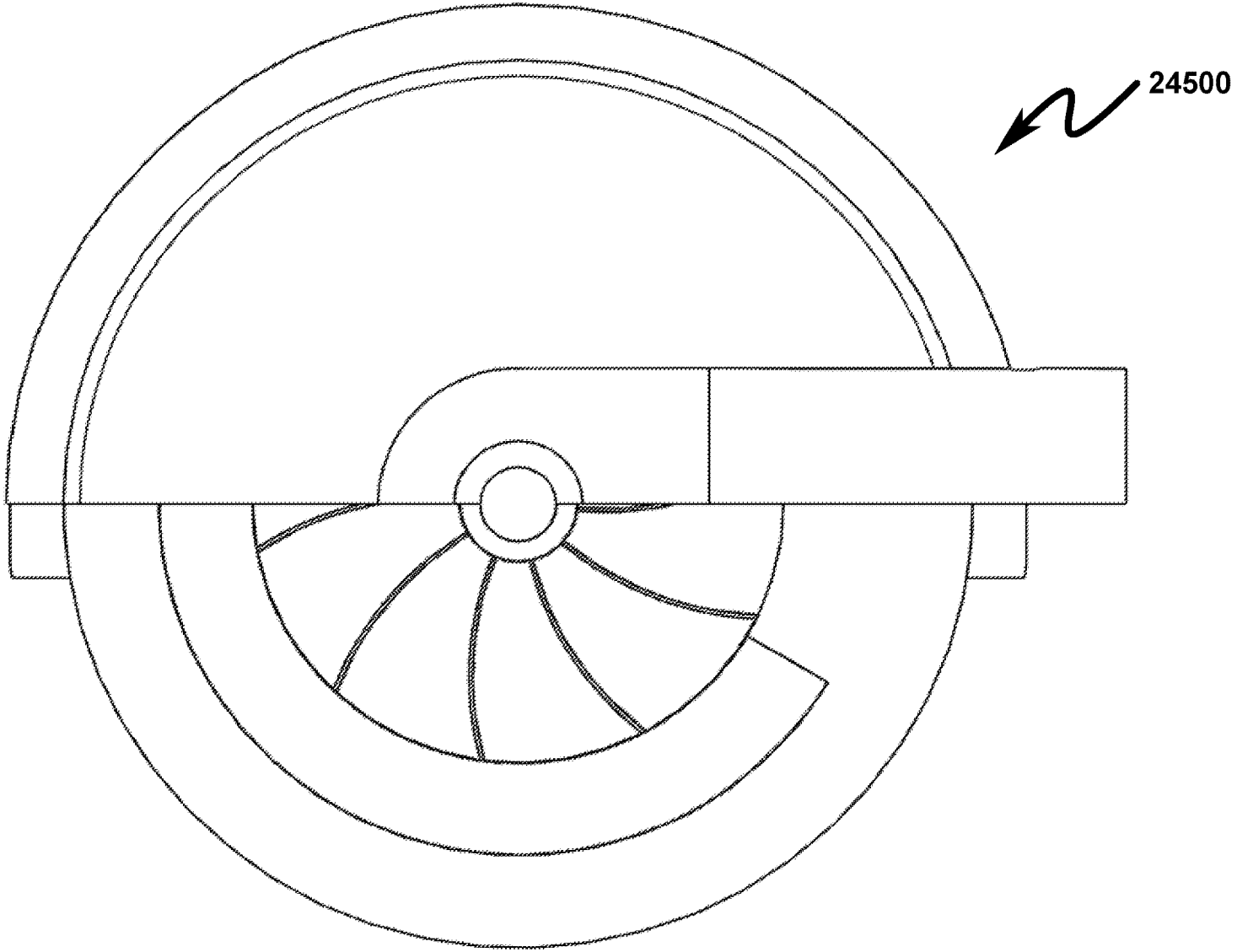
Figure 246:
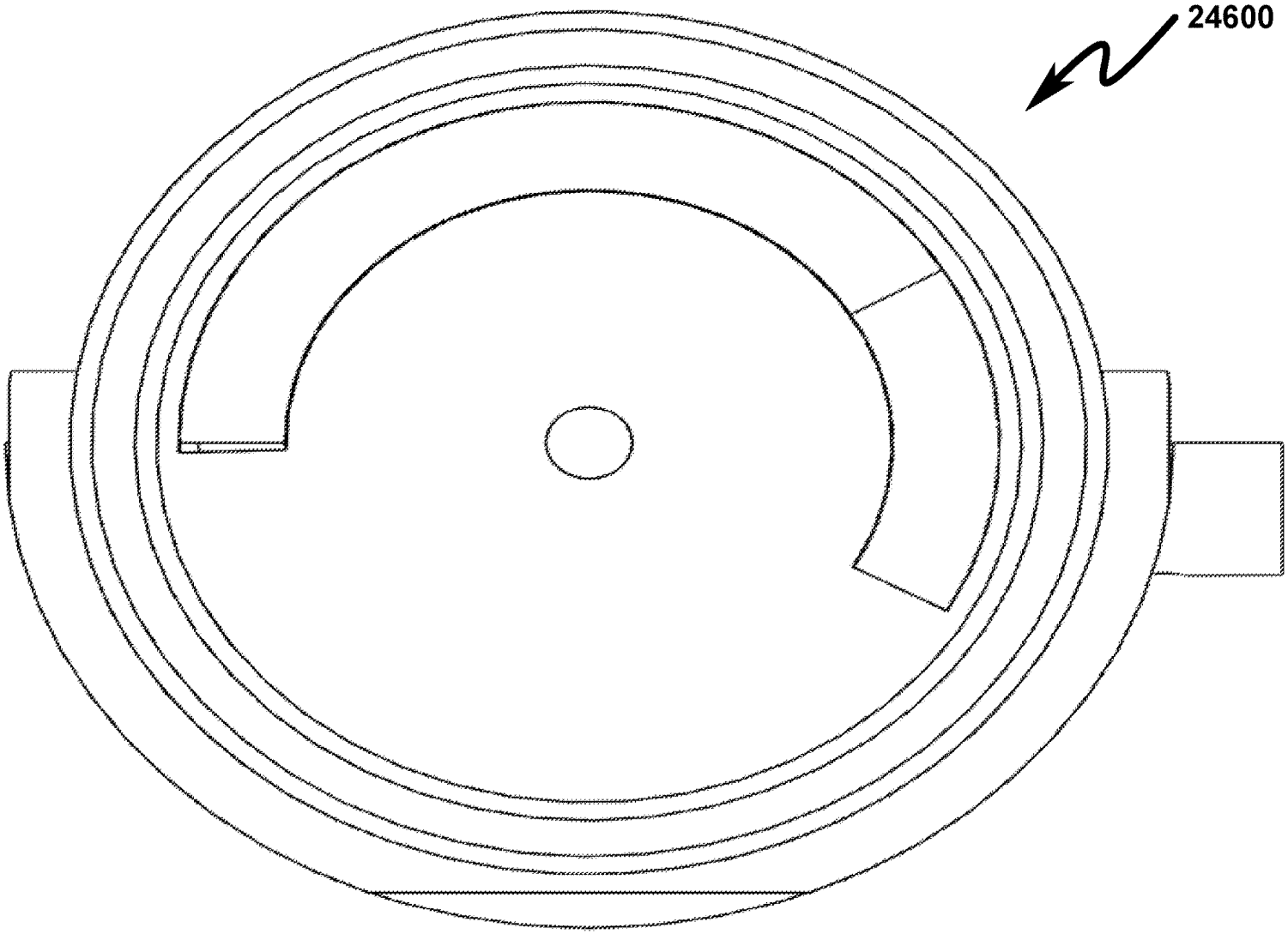
Figure 247:
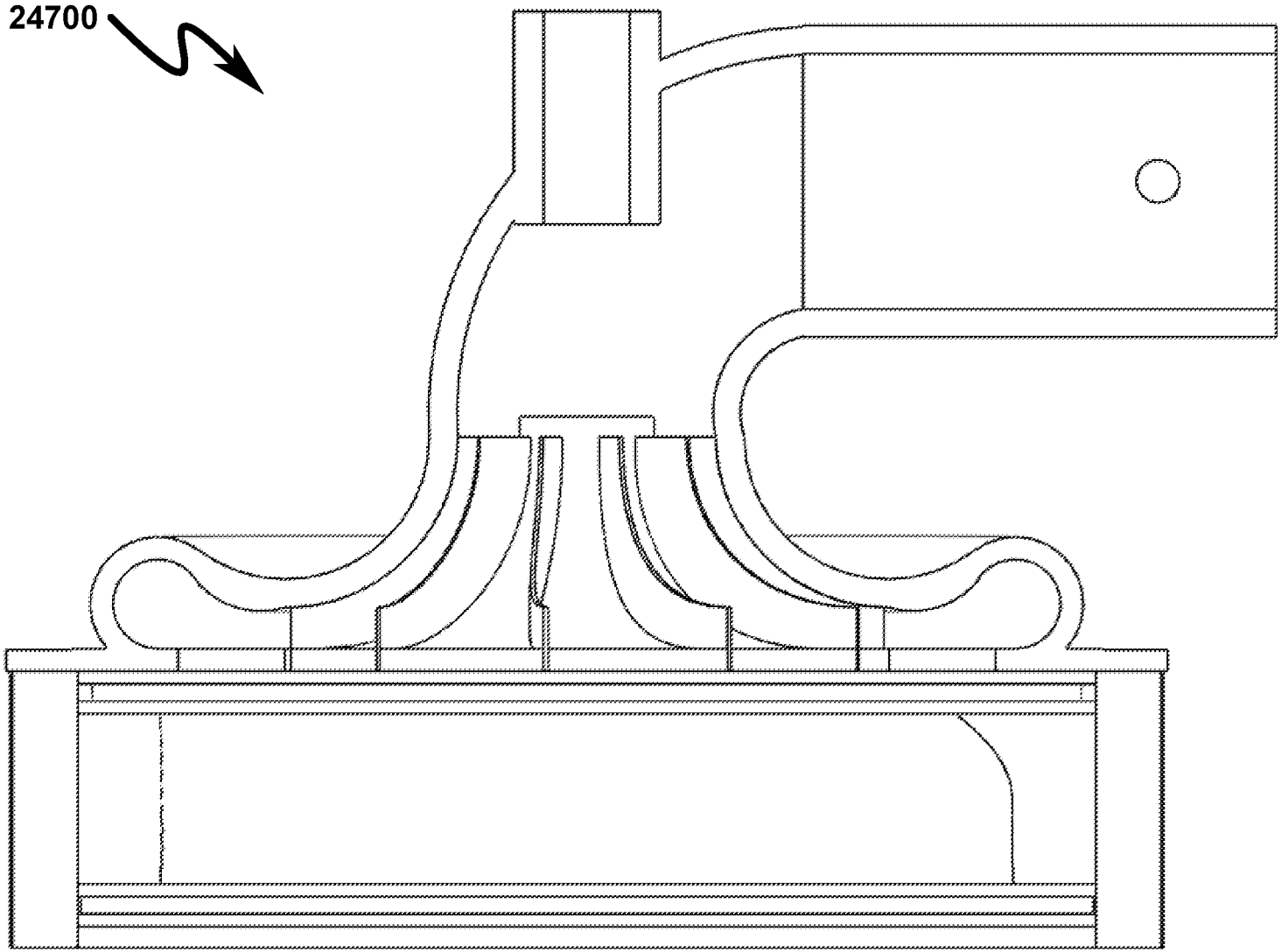
Figure 248:
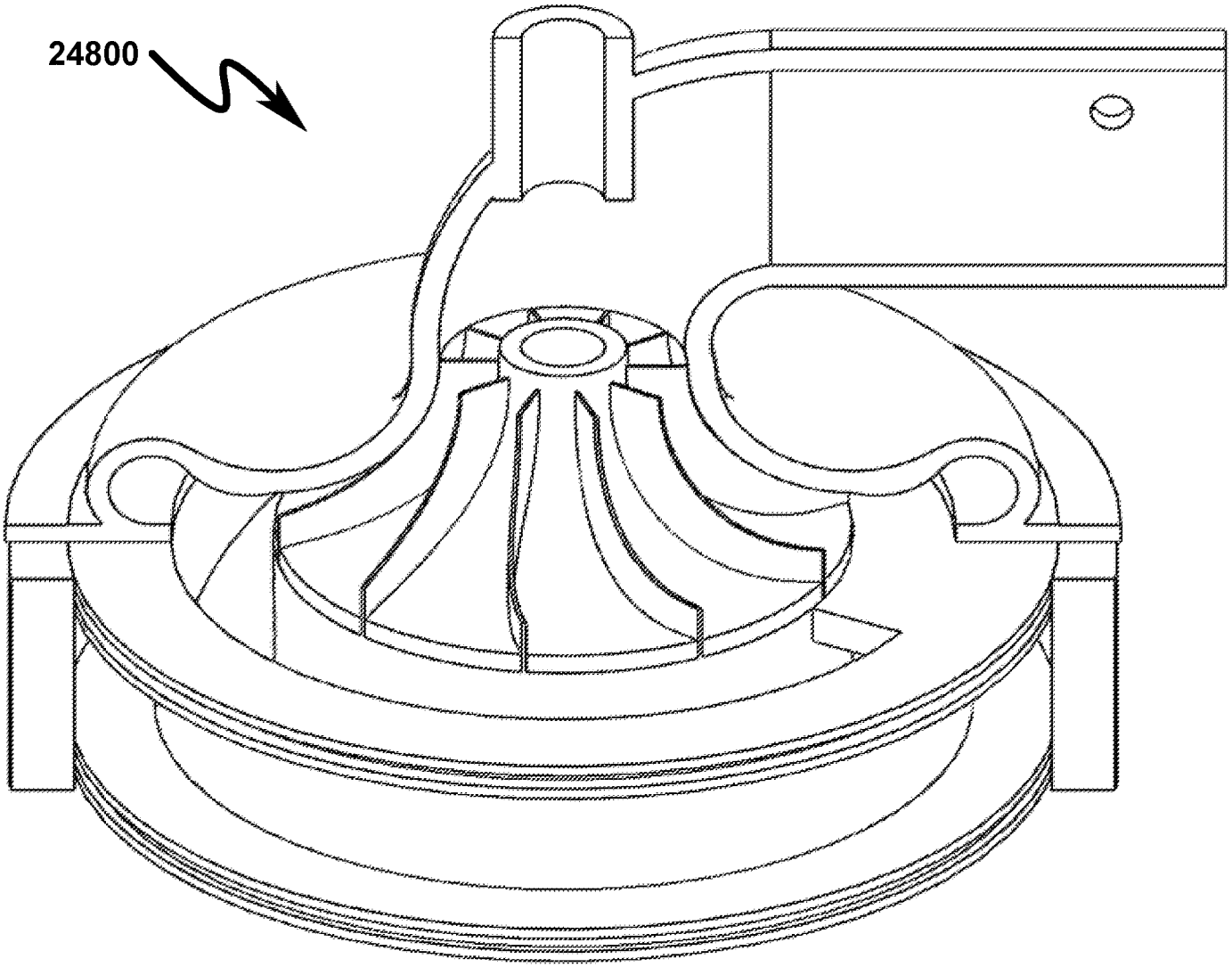
Figure 249:
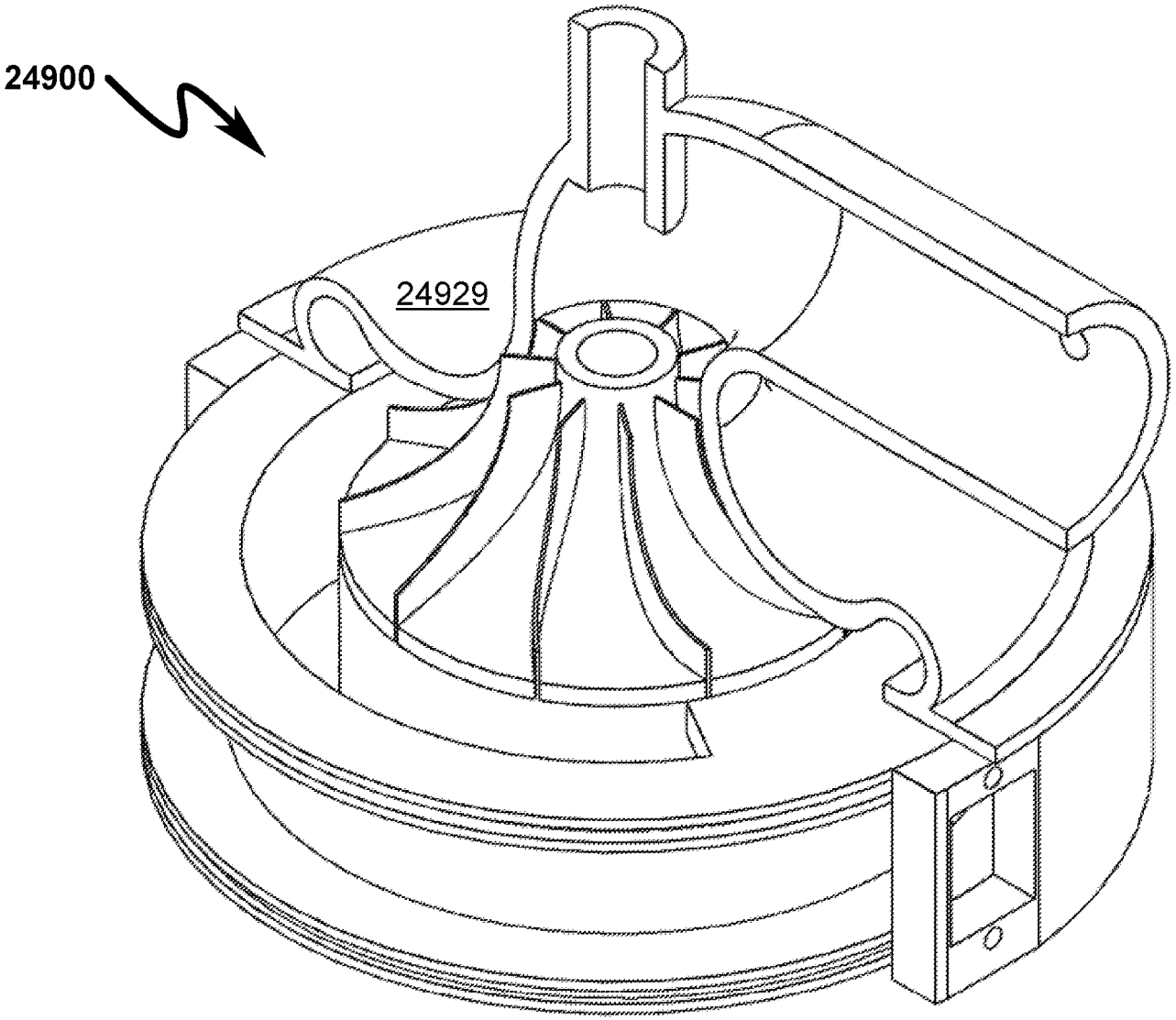
Figure 250:
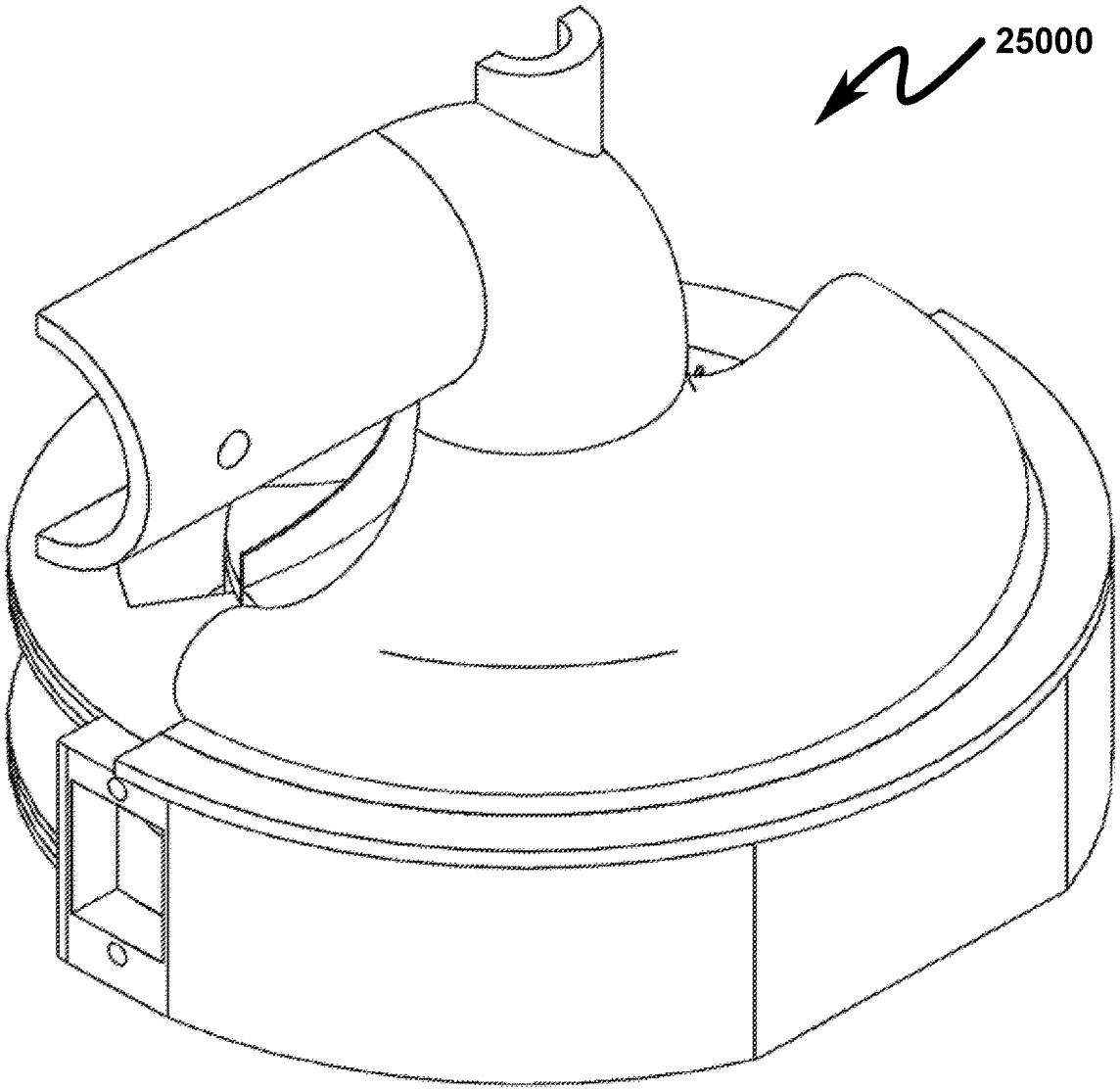
Figure 251:
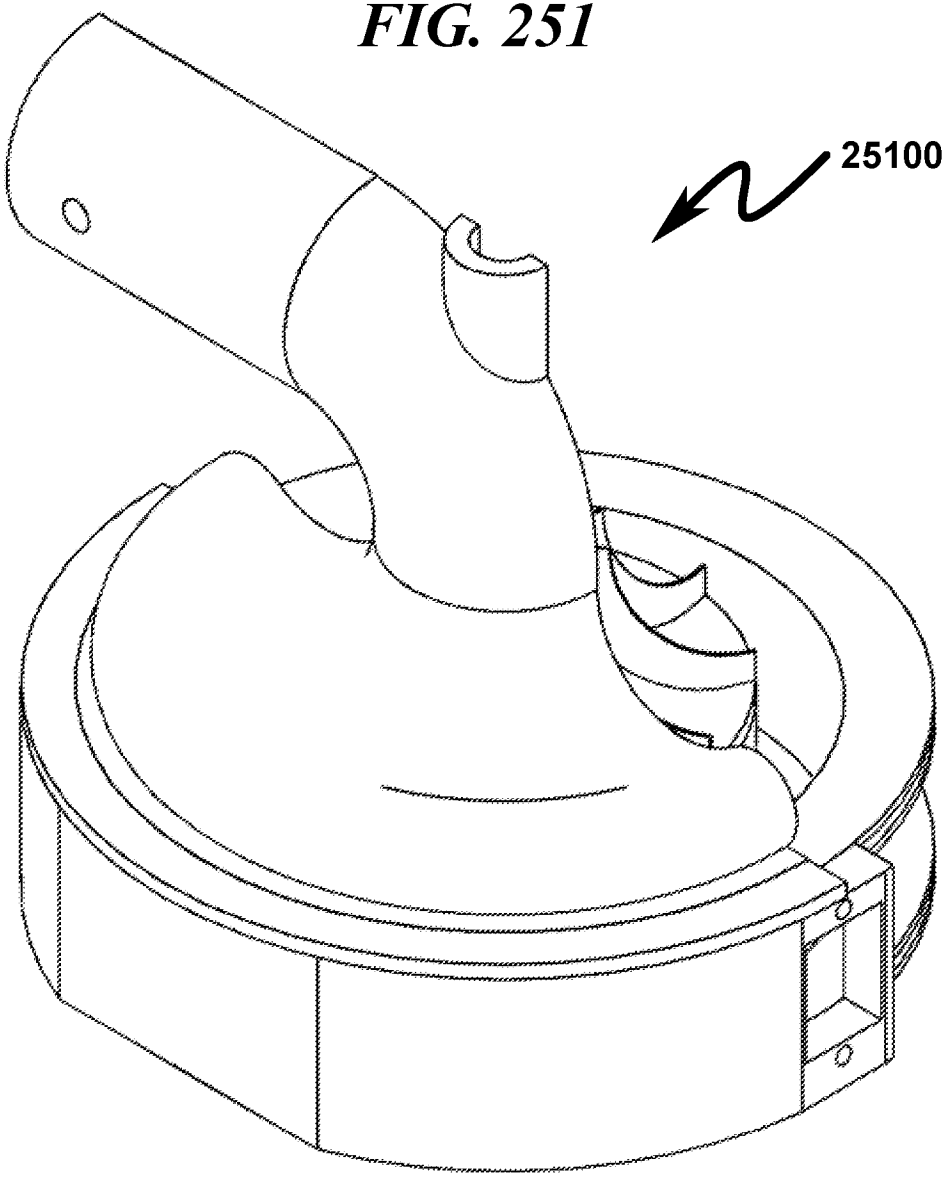
Figure 252:
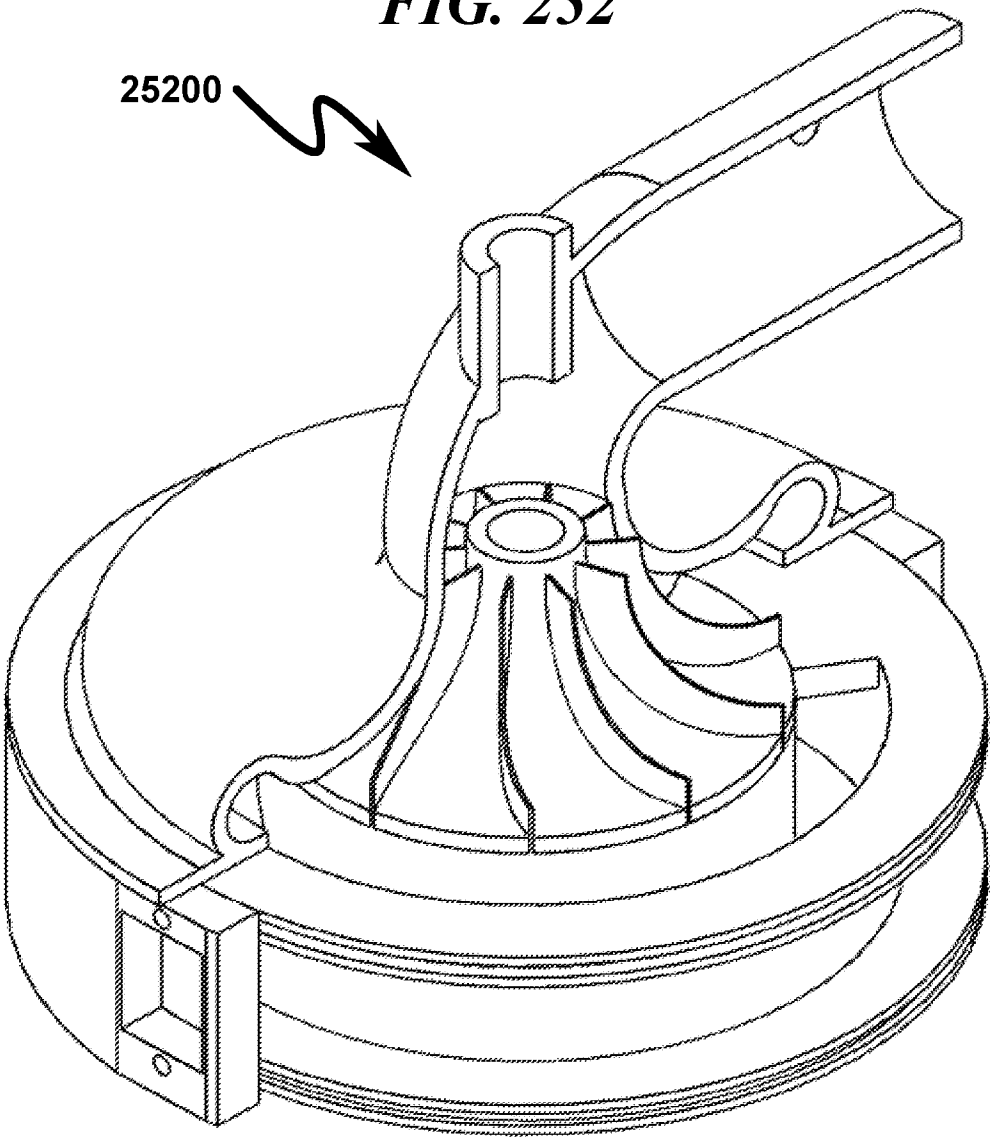
Figure 253:
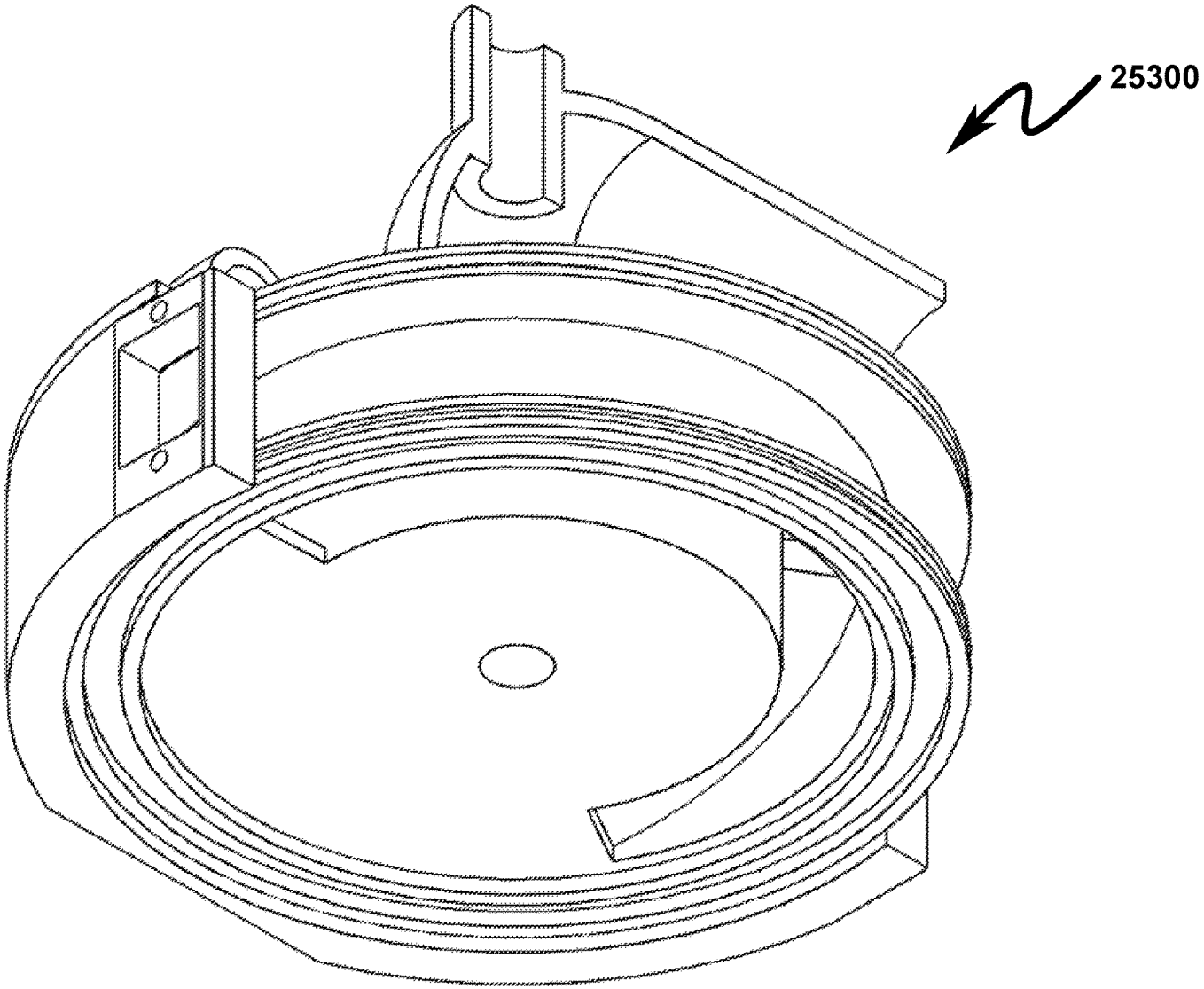
Figure 254:
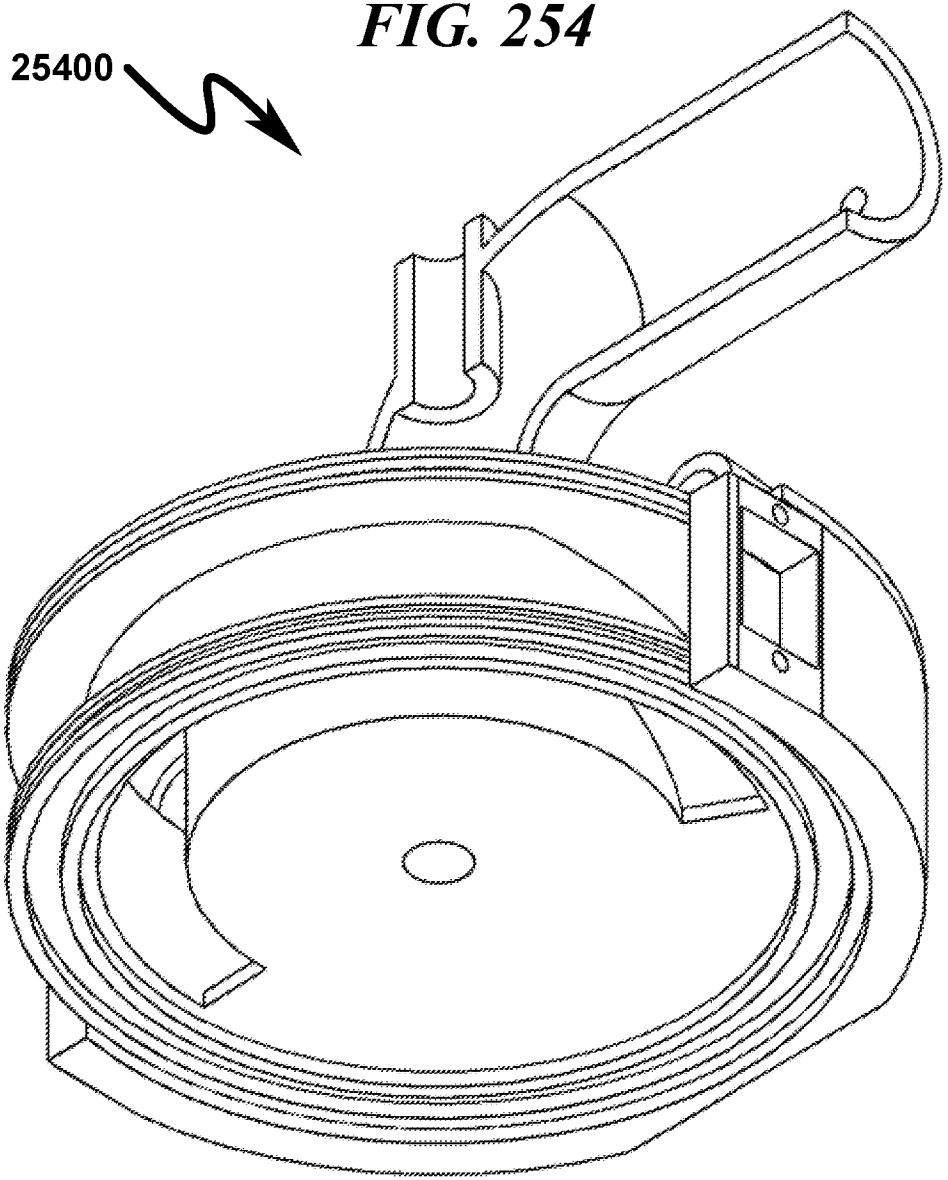
Figure 255:
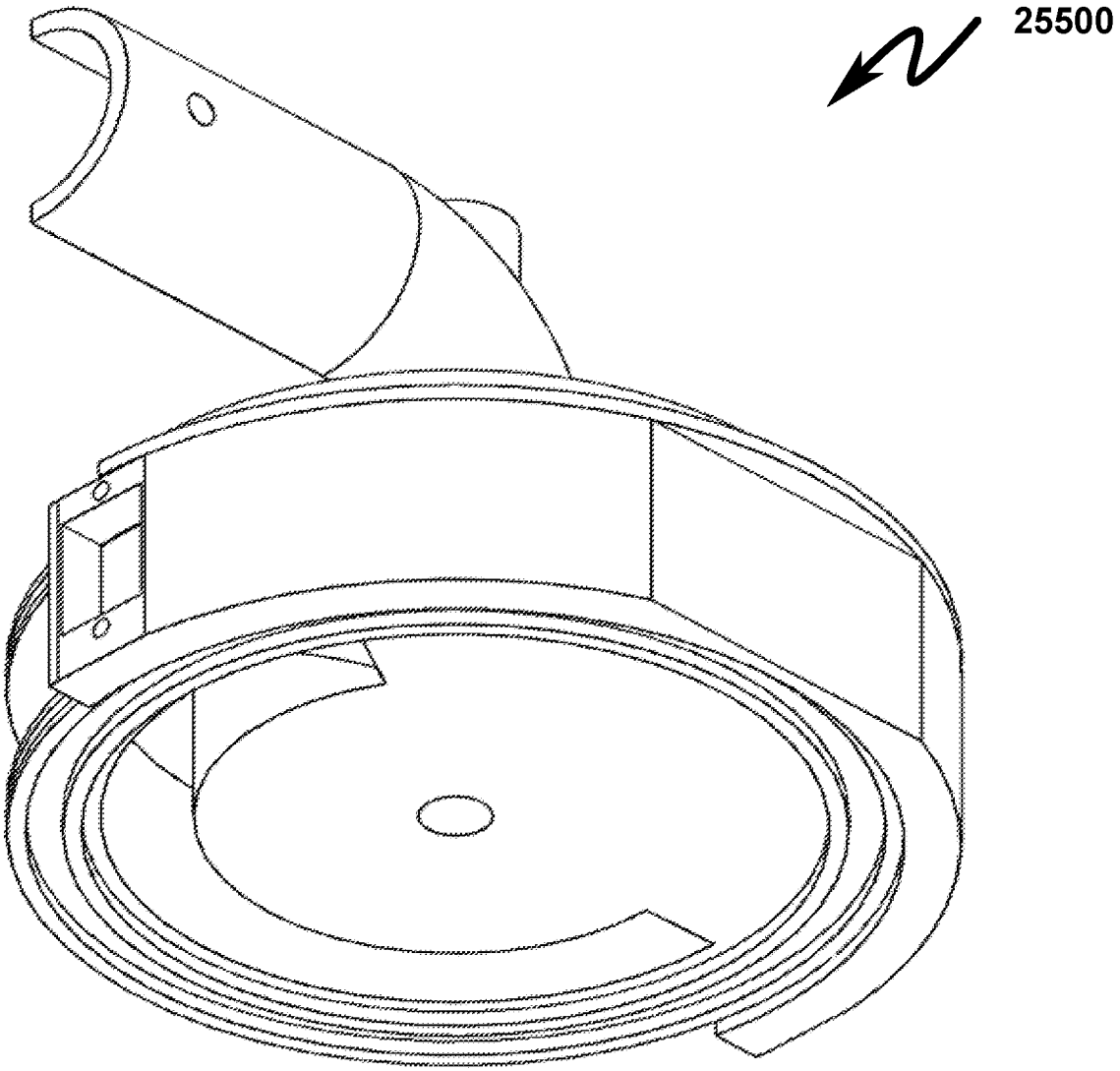
Figure 256:
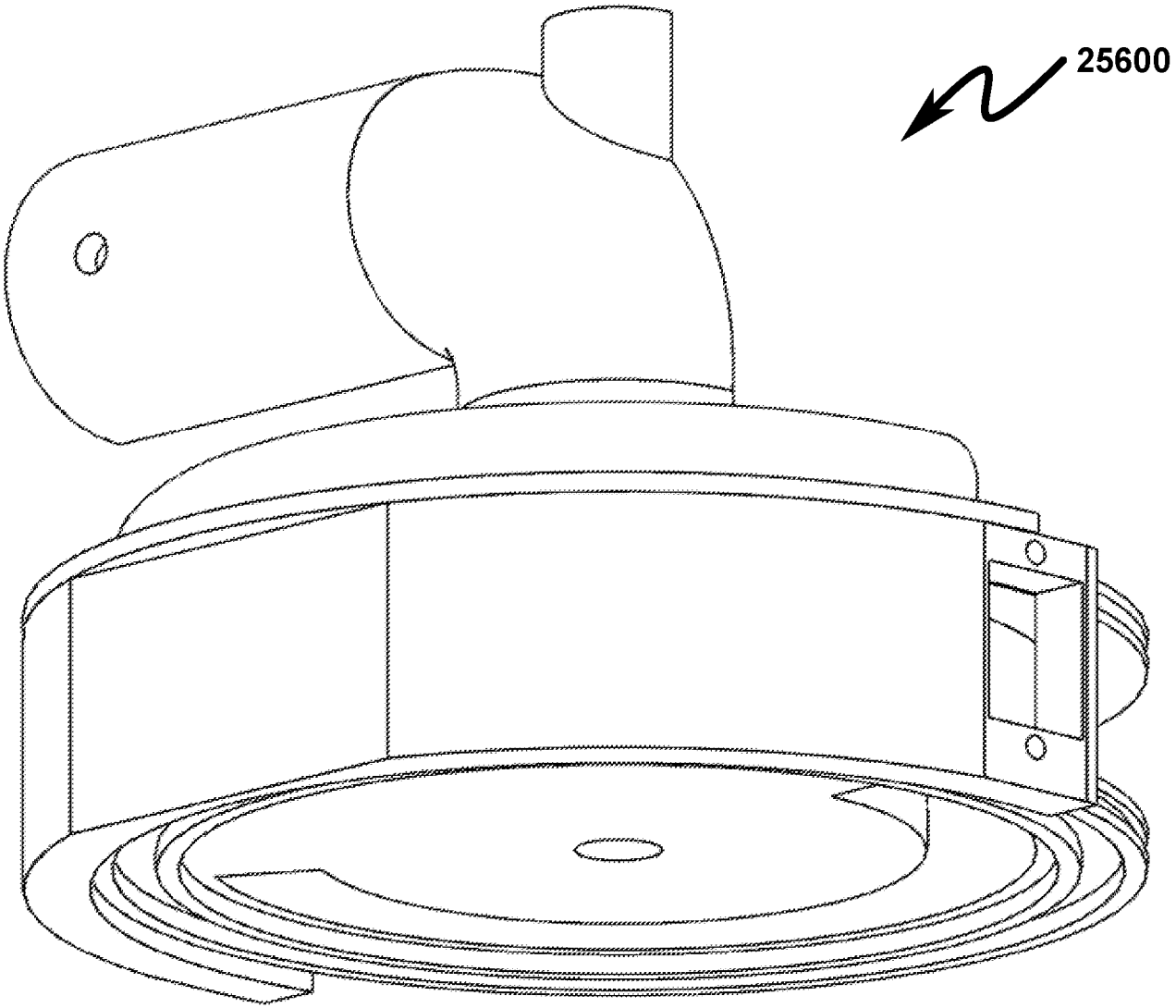

FIG. 131 illustrates top and bottom views of a preferred exemplary invention exhaust upper engine block head (EUH) and exhaust lower engine block crankcase (ELC) system embodiment;

FIG. 132 illustrates top right front and top right rear perspective detail views of a preferred exemplary invention exhaust upper engine block head (EUH) and exhaust lower engine block crankcase (ELC) system embodiment;

FIG. 133 illustrates top left rear and top left front perspective detail views of a preferred exemplary invention exhaust upper engine block head (EUH) and exhaust lower engine block crankcase (ELC) system embodiment;

FIG. 134 illustrates bottom right front and bottom right rear perspective detail views of a preferred exemplary invention exhaust upper engine block head (EUH) and exhaust lower engine block crankcase (ELC) system embodiment;

FIG. 135 illustrates bottom left rear and bottom left front perspective detail views of a preferred exemplary invention exhaust upper engine block head (EUH) and exhaust lower engine block crankcase (ELC) system embodiment;

FIG. 136 illustrates various perspective section detail views of a preferred exemplary invention exhaust upper engine block head (EUH) and exhaust lower engine block crankcase (ELC) system embodiment;

FIG. 137 illustrates front and rear views of a preferred exemplary invention cooling water jacket (CWJ) system embodiment;

FIG. 138 illustrates left side and right side views of a preferred exemplary invention cooling water jacket (CWJ) system embodiment;

FIG. 139 illustrates top and bottom views of a preferred exemplary invention cooling water jacket (CWJ) system embodiment;

FIG. 140 illustrates top right front and top right rear perspective detail views of a preferred exemplary invention cooling water jacket (CWJ) system embodiment;

FIG. 141 illustrates top left rear and top left front perspective detail views of a preferred exemplary invention cooling water jacket (CWJ) system embodiment;

FIG. 142 illustrates bottom right front and bottom right rear perspective detail views of a preferred exemplary invention cooling water jacket (CWJ) system embodiment;

FIG. 143 illustrates bottom left rear and bottom left front perspective detail views of a preferred exemplary invention cooling water jacket (CWJ) system embodiment;

FIG. 144 illustrates various perspective section detail views of a preferred exemplary invention cooling water jacket (CWJ) system embodiment;

FIG. 145 illustrates front and rear views of a preferred exemplary invention cooling channel spool with centrifugal impeller (ICS) system embodiment;

FIG. 146 illustrates left side and right side views of a preferred exemplary invention cooling channel spool with centrifugal impeller (ICS) system embodiment;

FIG. 147 illustrates top and bottom views of a preferred exemplary invention cooling channel spool with centrifugal impeller (ICS) system embodiment;

FIG. 148 illustrates top right front and top right rear perspective detail views of a preferred exemplary invention cooling channel spool with centrifugal impeller (ICS) system embodiment;

FIG. 149 illustrates top left rear and top left front perspective detail views of a preferred exemplary invention cooling channel spool with centrifugal impeller (ICS) system embodiment;

FIG. 150 illustrates bottom right front and bottom right rear perspective detail views of a preferred exemplary invention cooling channel spool with centrifugal impeller (ICS) system embodiment;

FIG. 151 illustrates bottom left rear and bottom left front perspective detail views of a preferred exemplary invention cooling channel spool with centrifugal impeller (ICS) system embodiment;

FIG. 152 illustrates various perspective section detail views of a preferred exemplary invention cooling channel spool with centrifugal impeller (ICS) system embodiment;

FIG. 153 illustrates front and rear views of a preferred exemplary invention exhaust manifold (EMF) system embodiment;

FIG. 154 illustrates left side and right side views of a preferred exemplary invention exhaust manifold (EMF) system embodiment;

FIG. 155 illustrates top and bottom views of a preferred exemplary invention exhaust manifold (EMF) system embodiment;

FIG. 156 illustrates top right front and top right rear perspective detail views of a preferred exemplary invention exhaust manifold (EMF) system embodiment;

FIG. 157 illustrates top left rear and top left front perspective detail views of a preferred exemplary invention exhaust manifold (EMF) system embodiment;

FIG. 158 illustrates bottom right front and bottom right rear perspective detail views of a preferred exemplary invention exhaust manifold (EMF) system embodiment;

FIG. 159 illustrates bottom left rear and bottom left front perspective detail views of a preferred exemplary invention exhaust manifold (EMF) system embodiment;

FIG. 160 illustrates various perspective section detail views of a preferred exemplary invention exhaust manifold (EMF) system embodiment;

FIG. 161 illustrates a front perspective isolation detail view of a preferred exemplary invention intake/exhaust engine block cover system embodiment;

FIG. 162 illustrates a rear perspective isolation detail view of a preferred exemplary invention intake/exhaust engine block cover system embodiment;

FIG. 163 illustrates a perspective isolation detail view of a preferred exemplary invention rotary valve disc (RVD) system embodiment;

FIG. 164 illustrates a perspective isolation detail view of a preferred exemplary invention rotary valve disc (RVD) system embodiment;

FIG. 165 illustrates a perspective isolation detail view of a preferred exemplary invention rotary valve disc (RVD) system embodiment;

FIG. 166 illustrates a perspective isolation detail view of a preferred exemplary invention rotary valve disc (RVD) system embodiment;

FIG. 167 illustrates a perspective isolation detail view of a preferred exemplary invention rotary valve disc (RVD) system embodiment;

FIG. 168 illustrates a perspective isolation detail view of a preferred exemplary invention rotary valve disc (RVD) system embodiment;

FIG. 169 illustrates a perspective isolation detail view of a preferred exemplary invention rotary valve disc (RVD) system embodiment;

FIG. 170 illustrates a perspective isolation detail view of a preferred exemplary invention rotary valve disc (RVD) system embodiment;

FIG. 171 illustrates a front isolation detail view of a preferred exemplary invention rotary valve disc (RVD) system embodiment;

FIG. 172 illustrates a rear isolation detail view of a preferred exemplary invention rotary valve disc (RVD) system embodiment;

FIG. 173 illustrates a perspective isolation detail view of a preferred exemplary invention rotary valve disc (RVD) system embodiment;

FIG. 174 illustrates a perspective isolation detail view of a preferred exemplary invention rotary valve disc (RVD) system embodiment;

FIG. 175 illustrates a perspective isolation detail view of a preferred exemplary invention rotary valve disc (RVD) system embodiment;

FIG. 176 illustrates a perspective isolation detail view of a preferred exemplary invention rotary valve disc (RVD) system embodiment;

FIG. 177 illustrates a partial assembly perspective isolation detail view of a preferred exemplary invention crankshaft (CRK) and rotary valve disc (RVD) system embodiment;

FIG. 178 illustrates a partial assembly perspective isolation detail view of a preferred exemplary invention crankshaft (CRK) and rotary valve disc (RVD) system embodiment;

FIG. 179 illustrates a partial assembly perspective isolation detail view of a preferred exemplary invention crankshaft (CRK) and rotary valve disc (RVD) system embodiment;

FIG. 180 illustrates a partial assembly perspective isolation detail view of a preferred exemplary invention crankshaft (CRK) and rotary valve disc (RVD) system embodiment;

FIG. 181 illustrates a partial assembly perspective isolation detail view of a preferred exemplary invention crankshaft (CRK) and rotary valve disc (RVD) system embodiment;

FIG. 182 illustrates a partial assembly perspective isolation detail view of a preferred exemplary invention crankshaft (CRK) and rotary valve disc (RVD) system embodiment;

FIG. 183 illustrates a partial assembly perspective isolation detail view of a preferred exemplary invention crankshaft (CRK) and rotary valve disc (RVD) system embodiment;

FIG. 184 illustrates a partial assembly isolation detail end view of a preferred exemplary invention crankshaft (CRK) and rotary valve disc (RVD) system embodiment;

FIG. 185 illustrates a top right front partial assembled perspective isolation detail view of a preferred exemplary invention system embodiment illustrating internal construction of major system components;

FIG. 186 illustrates a top right rear partial assembled perspective isolation detail view of a preferred exemplary invention system embodiment illustrating internal construction of major system components;

FIG. 187 illustrates a top left rear partial assembled perspective isolation detail view of a preferred exemplary invention system embodiment illustrating internal construction of major system components;

FIG. 188 illustrates a top left front partial assembled perspective isolation detail view of a preferred exemplary invention system embodiment illustrating internal construction of major system components;

FIG. 189 illustrates a bottom right front partial assembled perspective isolation detail view of a preferred exemplary invention system embodiment illustrating internal construction of major system components;

FIG. 190 illustrates a bottom right rear partial assembled perspective isolation detail view of a preferred exemplary invention system embodiment illustrating internal construction of major system components;

FIG. 191 illustrates a bottom left rear partial assembled perspective isolation detail view of a preferred exemplary invention system embodiment illustrating internal construction of major system components;

FIG. 192 illustrates a bottom left front partial assembled perspective isolation detail view of a preferred exemplary invention system embodiment illustrating internal construction of major system components;

FIG. 193 illustrates a front isolation view of a preferred exemplary invention crankshaft/piston/RVD system embodiment;

FIG. 194 illustrates a back isolation view of a preferred exemplary invention crankshaft/piston/RVD system embodiment;

FIG. 195 illustrates a left isolation view of a preferred exemplary invention crankshaft/piston/RVD system embodiment;

FIG. 196 illustrates a right isolation view of a preferred exemplary invention crankshaft/piston/RVD system embodiment;

FIG. 197 illustrates a top isolation view of a preferred exemplary invention crankshaft/piston/RVD system embodiment;

FIG. 198 illustrates a bottom isolation view of a preferred exemplary invention crankshaft/piston/RVD system embodiment;

FIG. 199 illustrates a front assembly view of a preferred exemplary invention crankshaft/piston/RVD system embodiment;

FIG. 200 illustrates a rear assembly view of a preferred exemplary invention crankshaft/piston/RVD system embodiment;

FIG. 201 illustrates a top right front perspective assembly view of a preferred exemplary invention cooling crankshaft/piston/RVD system embodiment;

FIG. 202 illustrates a top right rear perspective assembly view of a preferred exemplary invention cooling crankshaft/piston/RVD system embodiment;

FIG. 203 illustrates a top left rear perspective assembly view of a preferred exemplary invention cooling crankshaft/piston/RVD system embodiment;

FIG. 204 illustrates a top left front perspective assembly view of a preferred exemplary invention cooling crankshaft/piston/RVD system embodiment;

FIG. 205 illustrates a bottom right front perspective assembly view of a preferred exemplary invention cooling crankshaft/piston/RVD system embodiment;

FIG. 206 illustrates a bottom right rear perspective assembly view of a preferred exemplary invention cooling crankshaft/piston/RVD system embodiment;

FIG. 207 illustrates a bottom left rear perspective assembly view of a preferred exemplary invention cooling crankshaft/piston/RVD system embodiment;

FIG. 208 illustrates a bottom left front perspective assembly view of a preferred exemplary invention cooling crankshaft/piston/RVD system embodiment;

FIG. 209 illustrates a front assembly view of a preferred exemplary invention centrifugal advance (CAD) system embodiment;

FIG. 210 illustrates a back assembly view of a preferred exemplary invention centrifugal advance (CAD) system embodiment;

FIG. 211 illustrates a left assembly view of a preferred exemplary invention centrifugal advance (CAD) system embodiment;

FIG. 212 illustrates a right assembly view of a preferred exemplary invention centrifugal advance (CAD) system embodiment;

FIG. 213 illustrates a top assembly view of a preferred exemplary invention centrifugal advance (CAD) system embodiment;

FIG. 214 illustrates a bottom assembly view of a preferred exemplary invention centrifugal advance (CAD) system embodiment;

FIG. 215 illustrates a left perspective assembly view of a preferred exemplary invention centrifugal advance (CAD) system embodiment;

FIG. 216 illustrates a right perspective assembly view of a preferred exemplary invention centrifugal advance (CAD) system embodiment;

FIG. 217 illustrates a top right front perspective section view of a preferred exemplary invention cooling channel spool (ICS/ECS) and cooling water jacket (CWJ) system embodiment;

FIG. 218 illustrates a top right rear perspective section view of a preferred exemplary invention cooling channel spool (ICS/ECS) and cooling water jacket (CWJ) system embodiment;

FIG. 219 illustrates a top left rear perspective section view of a preferred exemplary invention cooling channel spool (ICS/ECS) and cooling water jacket (CWJ) system embodiment;

FIG. 220 illustrates a top left front perspective section view of a preferred exemplary invention cooling channel spool (ICS/ECS) and cooling water jacket (CWJ) system embodiment;

FIG. 221 illustrates a bottom right front perspective section view of a preferred exemplary invention cooling channel spool (ICS/ECS) and cooling water jacket (CWJ) system embodiment;

FIG. 222 illustrates a bottom right rear perspective section view of a preferred exemplary invention cooling channel spool (ICS/ECS) and cooling water jacket (CWJ) system embodiment;

FIG. 223 illustrates a bottom left rear perspective section view of a preferred exemplary invention cooling channel spool (ICS/ECS) and cooling water jacket (CWJ) system embodiment;

FIG. 224 illustrates a bottom left front perspective section view of a preferred exemplary invention cooling channel spool (ICS/ECS) and cooling water jacket (CWJ) system embodiment;

FIG. 225 illustrates a top right front perspective section view of a preferred exemplary invention cooling channel spool (ICS/ECS) system embodiment;

FIG. 226 illustrates a top right rear perspective section view of a preferred exemplary invention cooling channel spool (ICS/ECS) system embodiment;

FIG. 227 illustrates a top left rear perspective section view of a preferred exemplary invention cooling channel spool (ICS/ECS) system embodiment;

FIG. 228 illustrates a top left front perspective section view of a preferred exemplary invention cooling channel spool (ICS/ECS) system embodiment;

FIG. 229 illustrates a bottom right front perspective section view of a preferred exemplary invention cooling channel spool (ICS/ECS) system embodiment;

FIG. 230 illustrates a bottom right rear perspective section view of a preferred exemplary invention cooling channel spool (ICS/ECS) system embodiment;

FIG. 231 illustrates a bottom left rear perspective section view of a preferred exemplary invention cooling channel spool (ICS/ECS) system embodiment;

FIG. 232 illustrates a bottom left front perspective section view of a preferred exemplary invention cooling channel spool (ICS/ECS) system embodiment;

FIG. 233 illustrates a top right front perspective section view of a preferred exemplary invention centrifugal advance (CAD) system embodiment;

FIG. 234 illustrates a top right rear perspective section view of a preferred exemplary invention centrifugal advance (CAD) system embodiment;

FIG. 235 illustrates a top left rear perspective section view of a preferred exemplary invention centrifugal advance (CAD) system embodiment;

FIG. 236 illustrates a top left front perspective section view of a preferred exemplary invention centrifugal advance (CAD) system embodiment;

FIG. 237 illustrates a bottom right front perspective section view of a preferred exemplary invention centrifugal advance (CAD) system embodiment;

FIG. 238 illustrates a bottom right rear perspective section view of a preferred exemplary invention centrifugal advance (CAD) system embodiment;

FIG. 239 illustrates a bottom left rear perspective section view of a preferred exemplary invention centrifugal advance (CAD) system embodiment;

FIG. 240 illustrates a bottom left front perspective section view of a preferred exemplary invention centrifugal advance (CAD) system embodiment;

FIG. 241 illustrates a front section view of a preferred exemplary invention intake manifold (IMF) system embodiment;

FIG. 242 illustrates a rear section view of a preferred exemplary invention intake manifold (IMF) system embodiment;

FIG. 243 illustrates a left section view of a preferred exemplary invention intake manifold (IMF) system embodiment;

FIG. 244 illustrates a right section view of a preferred exemplary invention intake manifold (IMF) system embodiment;

FIG. 245 illustrates a top section view of a preferred exemplary invention intake manifold (IMF) system embodiment;

FIG. 246 illustrates a bottom section view of a preferred exemplary invention intake manifold (IMF) system embodiment;

FIG. 247 illustrates side section view of a preferred exemplary invention intake manifold (IMF) system embodiment;

FIG. 248 illustrates side section perspective view of a preferred exemplary invention intake manifold (IMF) system embodiment;

FIG. 249 illustrates a top right front perspective section view of a preferred exemplary invention intake manifold (IMF) system embodiment;

FIG. 250 illustrates a top right rear perspective section view of a preferred exemplary invention intake manifold (IMF) system embodiment;

FIG. 251 illustrates a top left rear perspective section view of a preferred exemplary invention intake manifold (IMF) system embodiment;

FIG. 252 illustrates a top left front perspective section view of a preferred exemplary invention intake manifold (IMF) system embodiment;

FIG. 253 illustrates a bottom right front perspective section view of a preferred exemplary invention intake manifold (IMF) system embodiment;

FIG. 254 illustrates a bottom right rear perspective section view of a preferred exemplary invention intake manifold (IMF) system embodiment;

FIG. 255 illustrates a bottom left rear perspective section view of a preferred exemplary invention intake manifold (IMF) system embodiment; and FIG. 256 illustrates a bottom left front perspective section view of a preferred exemplary invention intake manifold (IMF) system embodiment.

DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of an INTERNAL COMBUSTION ENGINE VALVE SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Views Not Limitive

The present invention anticipates a rudimentary implementation as well as a number of enhanced implementations. For clarity of presentation, the views presented for the rudimentary implementation may not depict features in the enhanced implementation. Some common aspects of engine construction such as intake manifolds and exhaust manifolds have been omitted from the presentation of the rudimentary implementation as they are well known to those skilled in the art and not critical to the overall invention design.

Bearings/Bushings Not Limitive

While the present invention as depicted does not explicitly incorporate bearings and/or bushings in the design, the present invention is not limited to designs that do not incorporate these elements. One skilled in the art will readily incorporate these elements as necessary based on the application context of the invention.

Direct Injection Not Limitive

The present invention anticipates that many embodiments will incorporate direct injection of fuel into the combustion chamber. Exceptions to this would be an upstream injector provided for emission and operational profiles. The present invention depicted herein provides for direct injection in the various drawings and views.

Common ICE Components Not Detailed

A variety of common ICE components that may be utilized in the present invention are Not Depicted in detail and identified as ND or N/D within this document. This may include items such as spark plugs, fuel injectors, a variety of covers, etc. that are well known in to those skilled the art.

Seals/Rings Components Constructed From Grooves/Ridges

With respect to seals and rings described herein, the present invention anticipates that a variety of configurations may be utilize, including O-rings and seals conforming to irregular perimeter shapes of a variety of grooves and ridges depicted herein. One skilled in the art will recognize how these seals and/or rings should be constructed from the ridges and grooves depicted in the drawings that detail the present invention construction.

Symmetry Not Limitive

Many components within the present invention as disclosed herein may be identical or symmetric in construction. However, while disclosed as such, the present invention is not limited to this specific type of construction.

Exploded Views Ordering Not Limitive

The present invention as described herein may include a number of exploded views. The ordering of components in these exploded views may be ordered in a number of ways, not necessarily in the order of parts assembly. Thus, exploded views may not necessarily indicate assembly views. Specifically, the engine block and engine cylinder components may be offset in the overall views in order to promote clarity in their disclosure.

Intake/Exhaust Not Limitive

Various views of the present invention may incorporate intake on the left and exhaust on the right side of the figures or the reverse ordering. Due to the symmetry in many aspects of the present invention, one skilled in the art will be able to recognize the appropriate intake/exhaust configuration from the figures depicted.

Reference Designators Nomenclature

Figure 12:
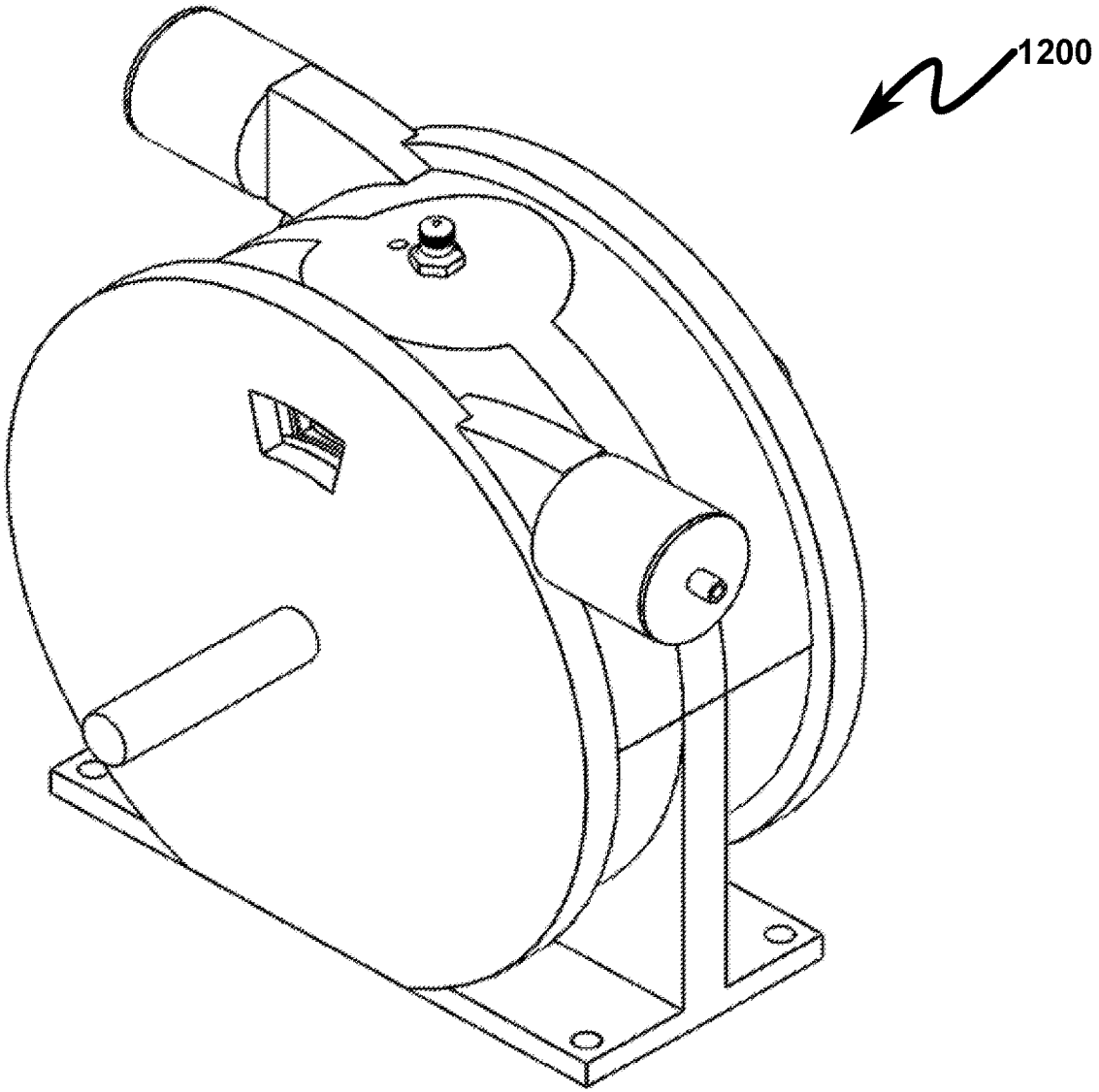
FIG. 12 illustrates a top left front perspective view of a preferred exemplary rudimentary invention system embodiment.
Figure 13:
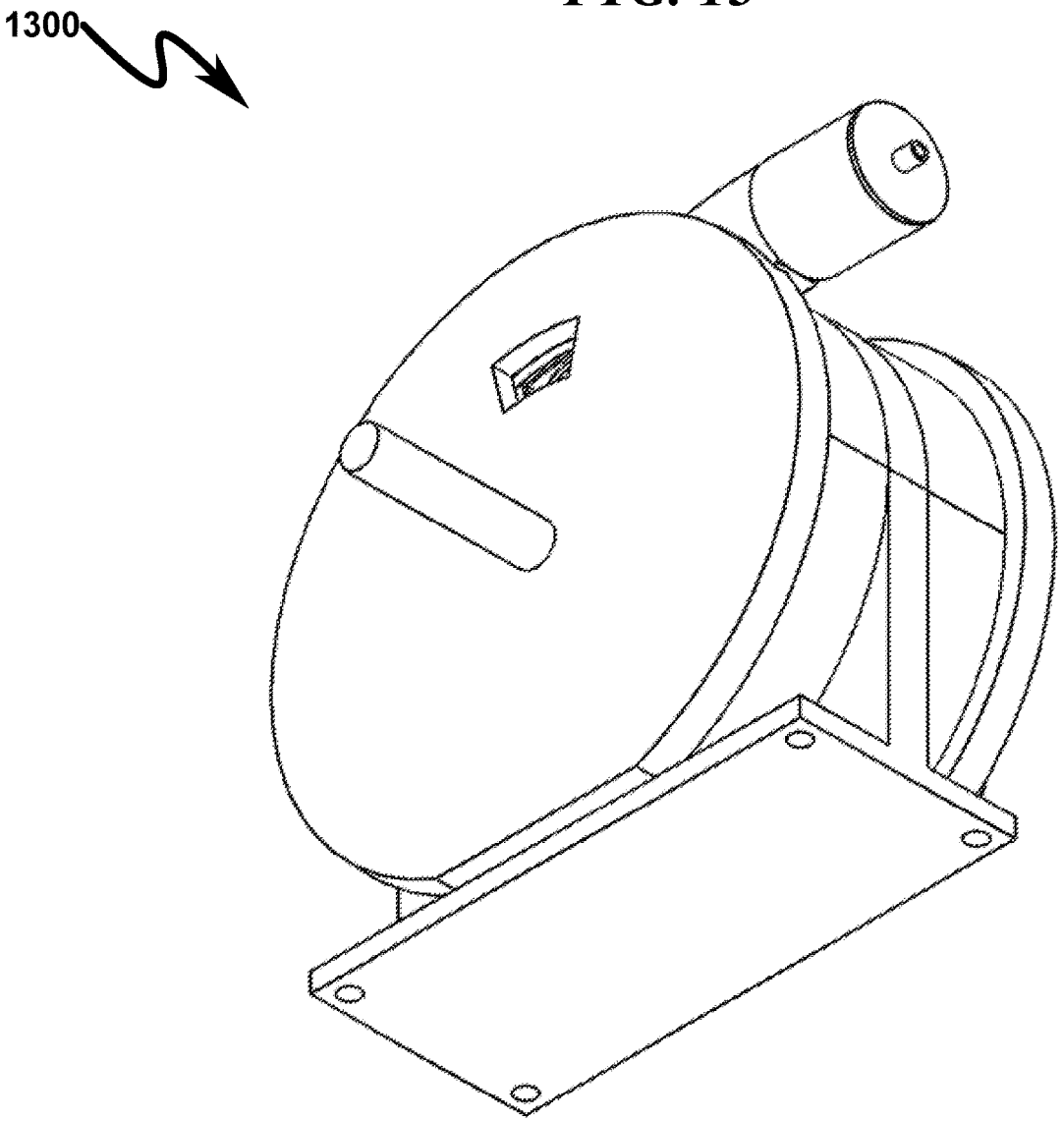
FIG. 13 illustrates a bottom right front perspective view of a preferred exemplary rudimentary invention system embodiment.
Figure 14:
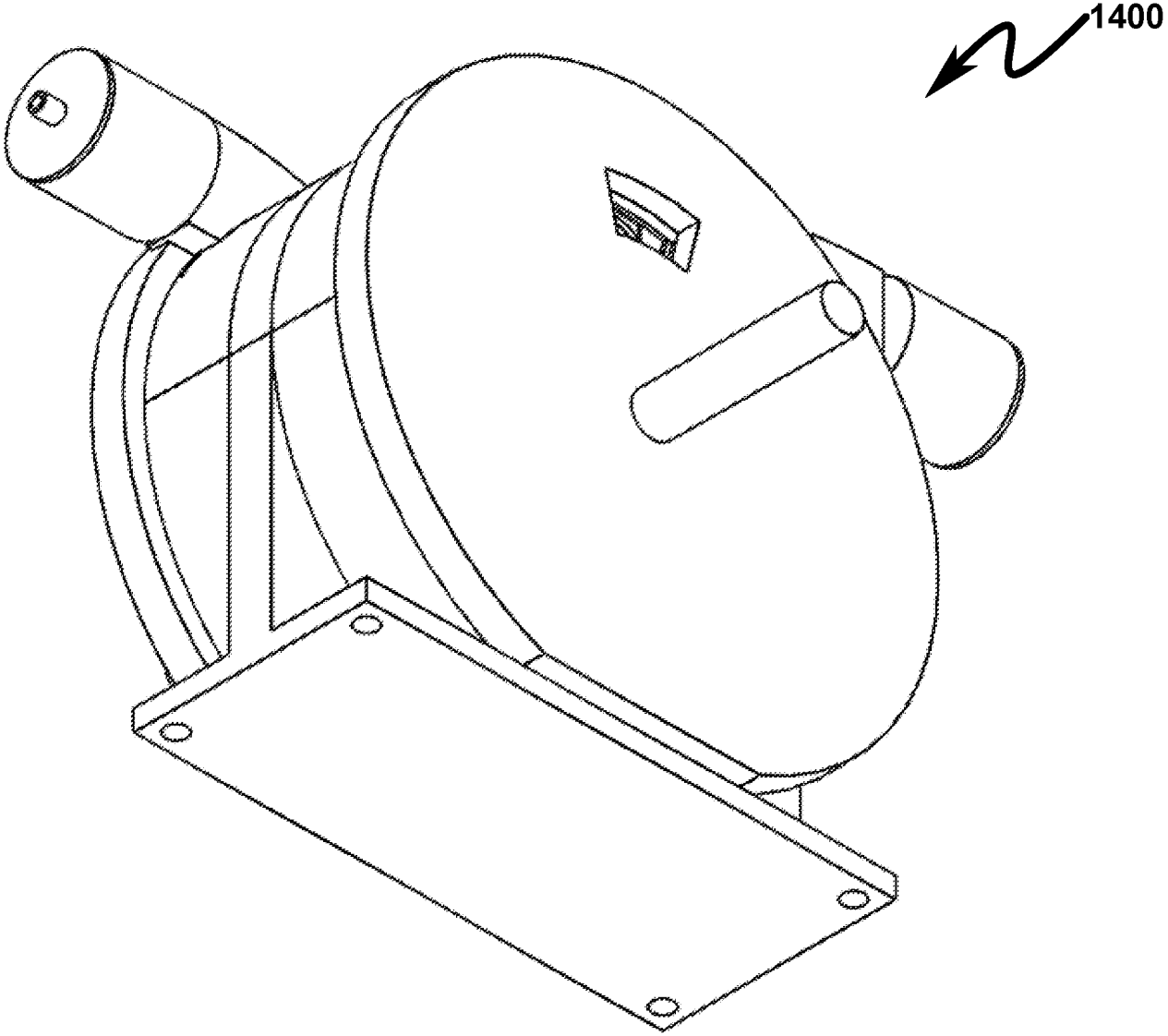
FIG. 14 illustrates a bottom right rear perspective view of a preferred exemplary rudimentary invention system embodiment.
Figure 15:
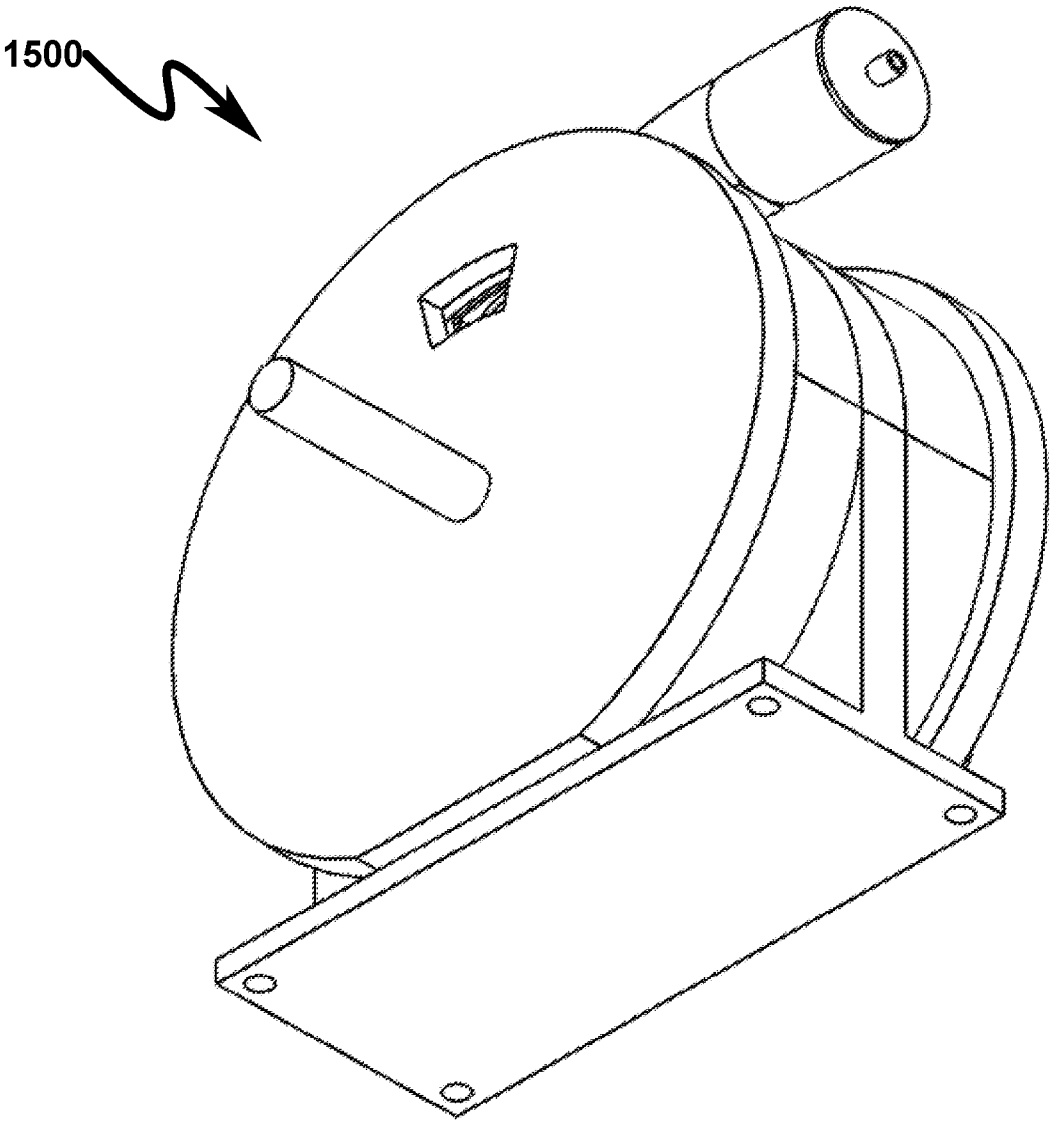
FIG. 15 illustrates a bottom left rear perspective view of a preferred exemplary rudimentary invention system embodiment.
Figure 123:
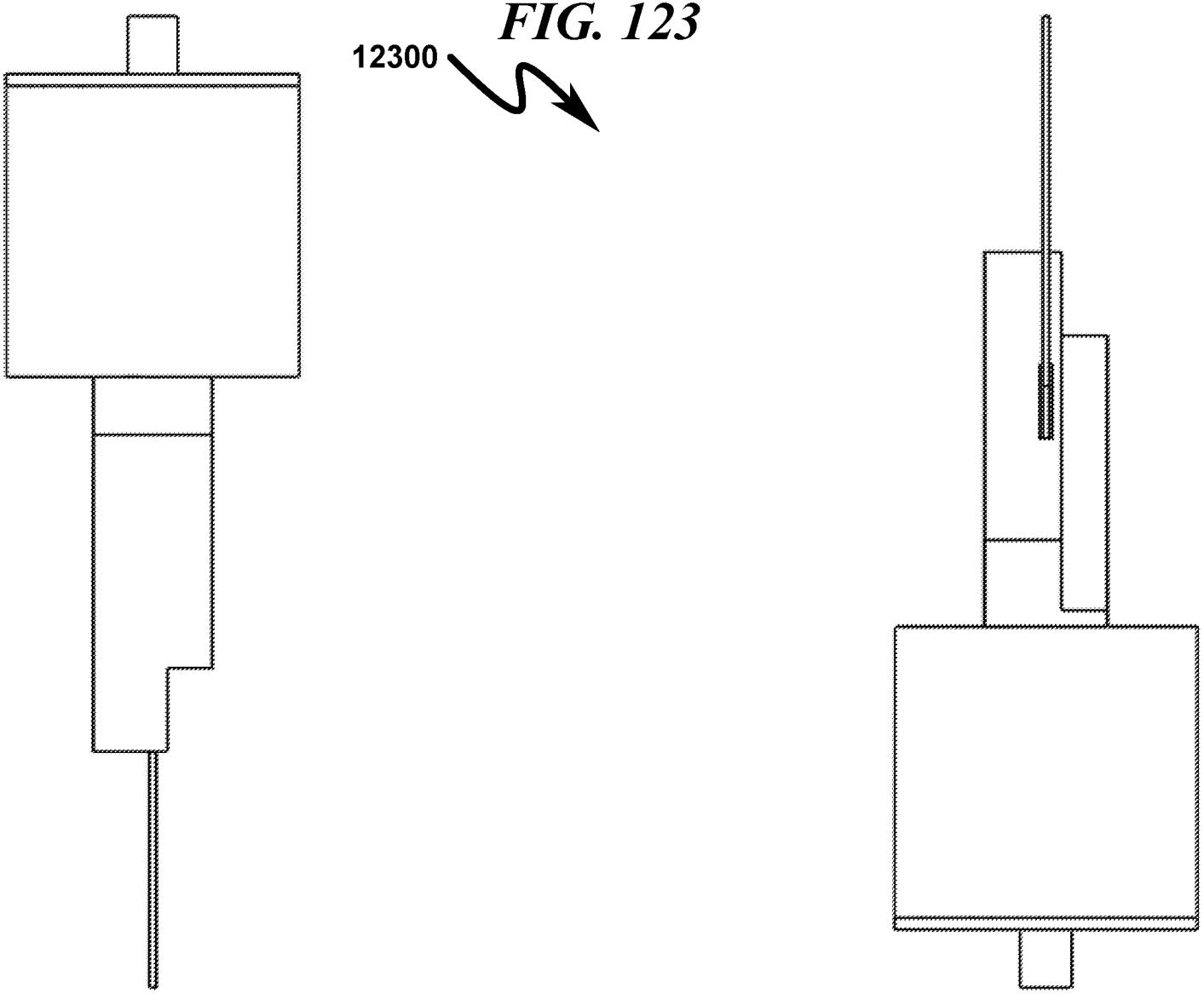
Figure 124:
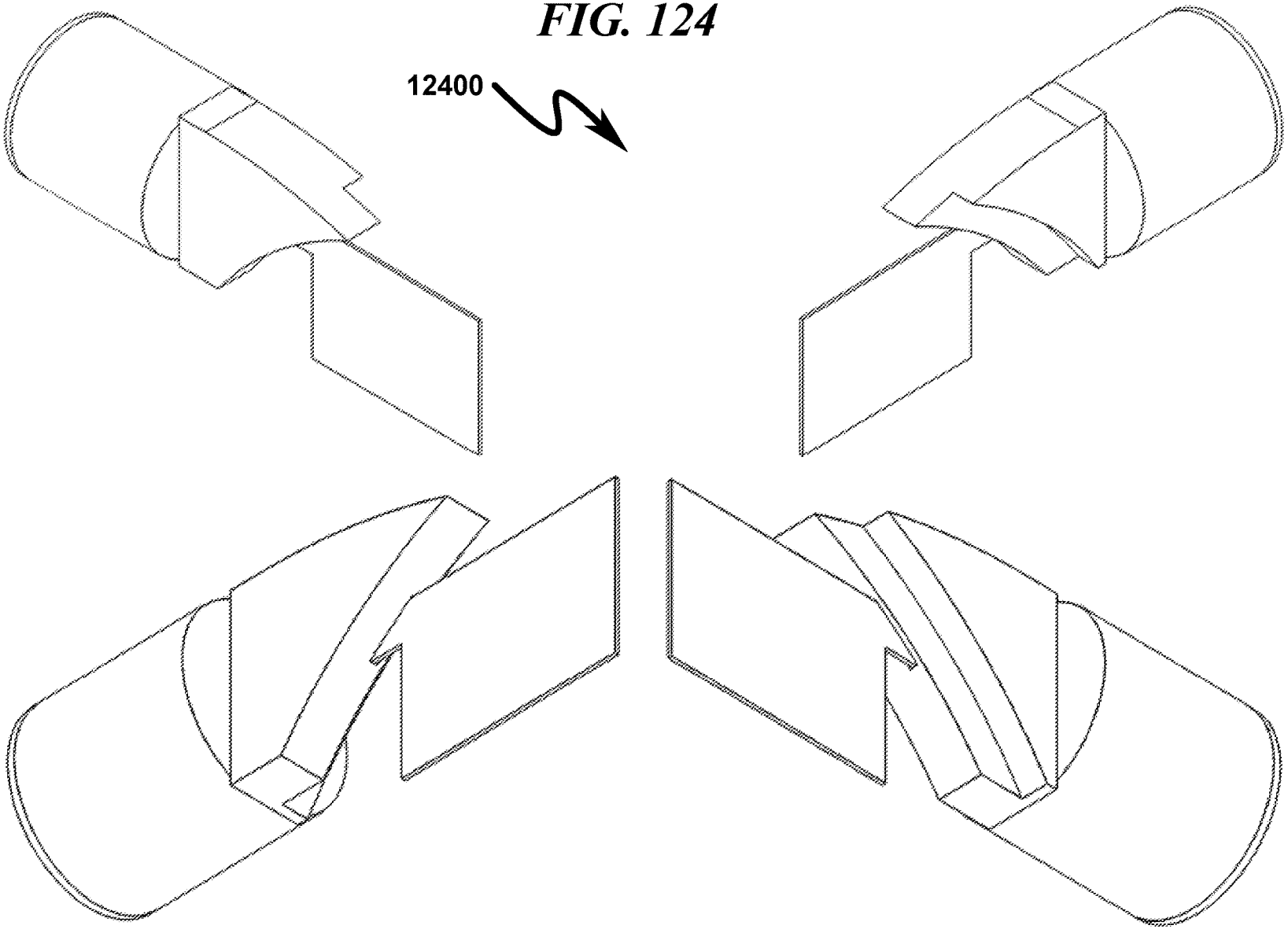
Figure 125:
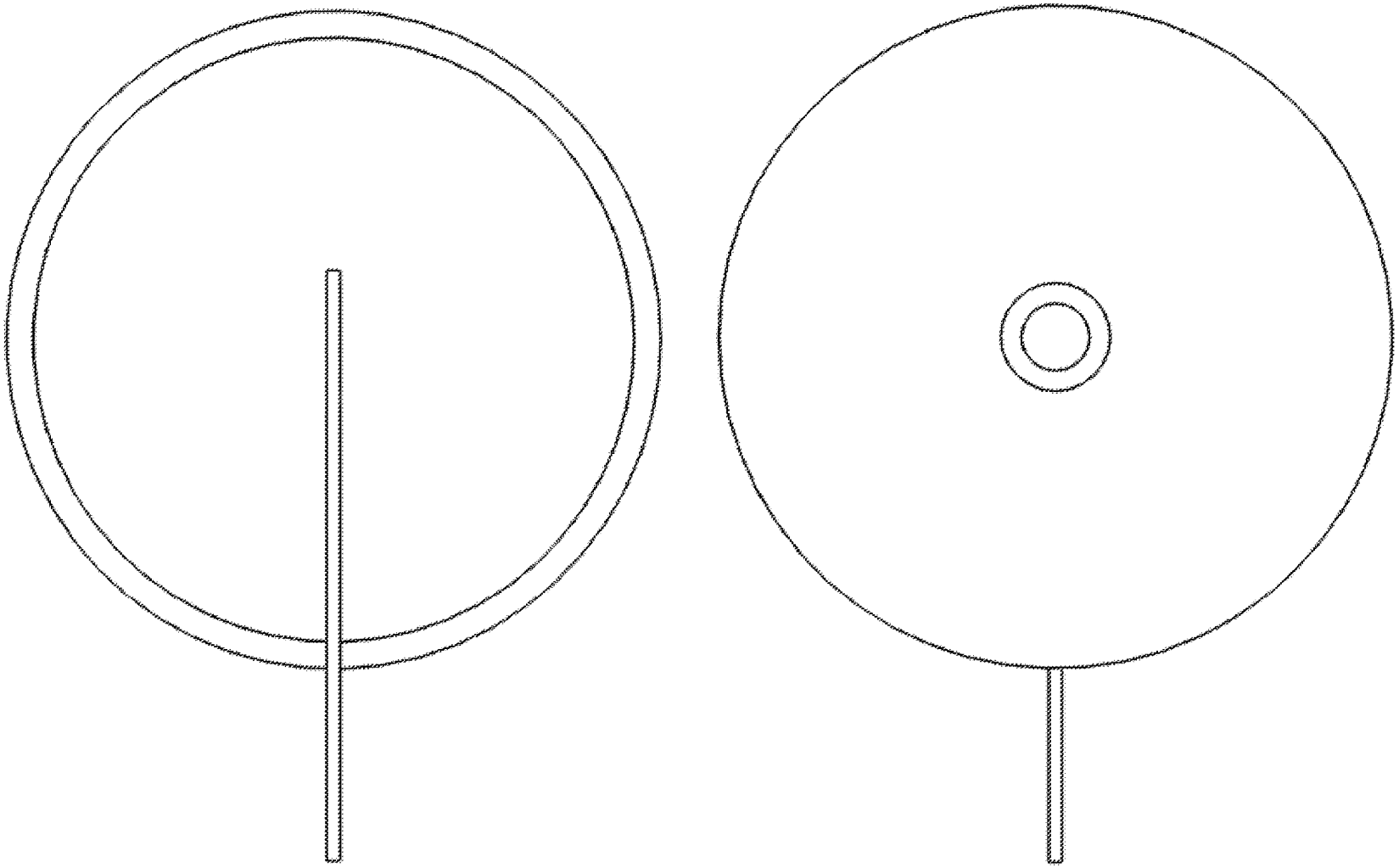
Figure 126:
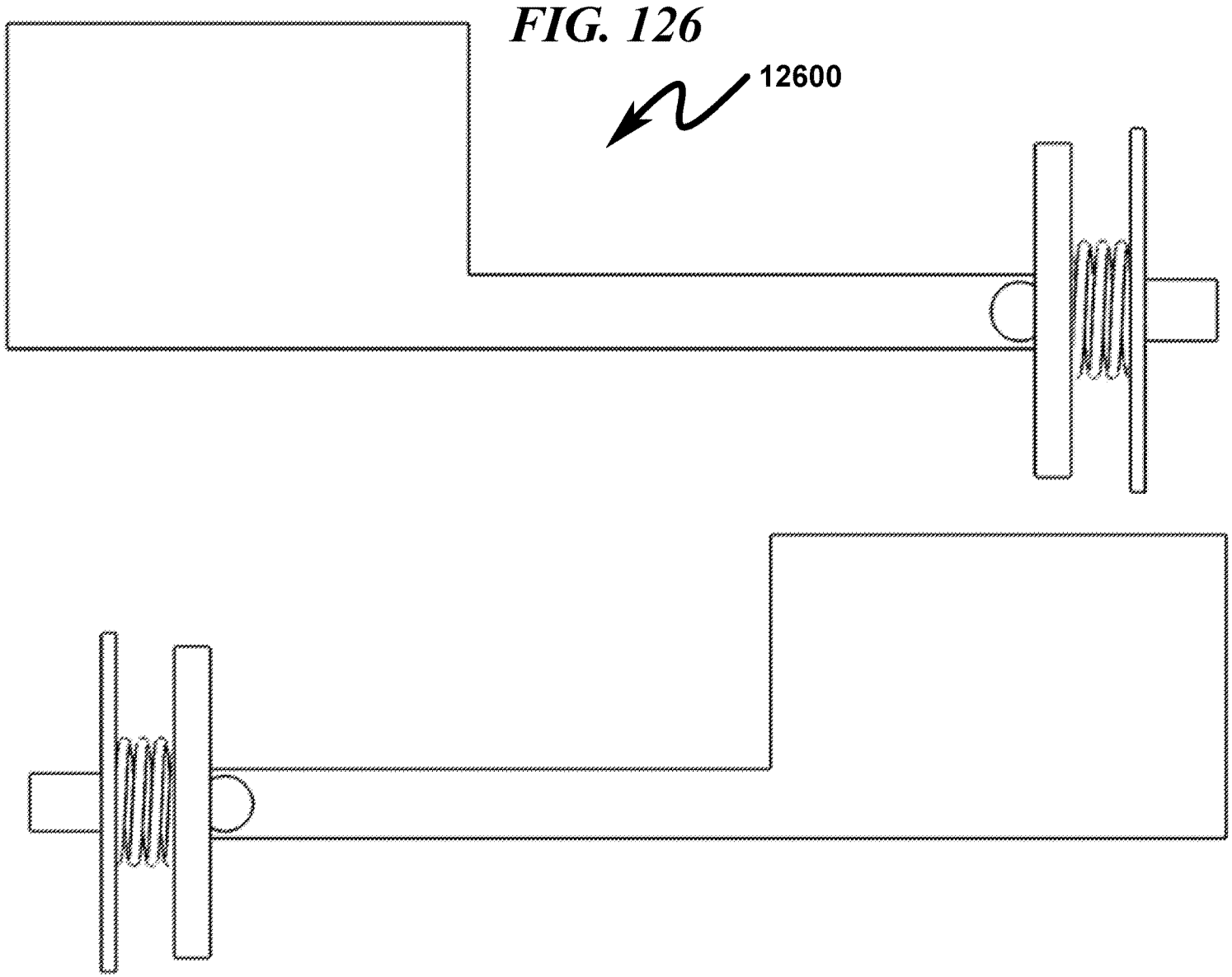
Figure 127:
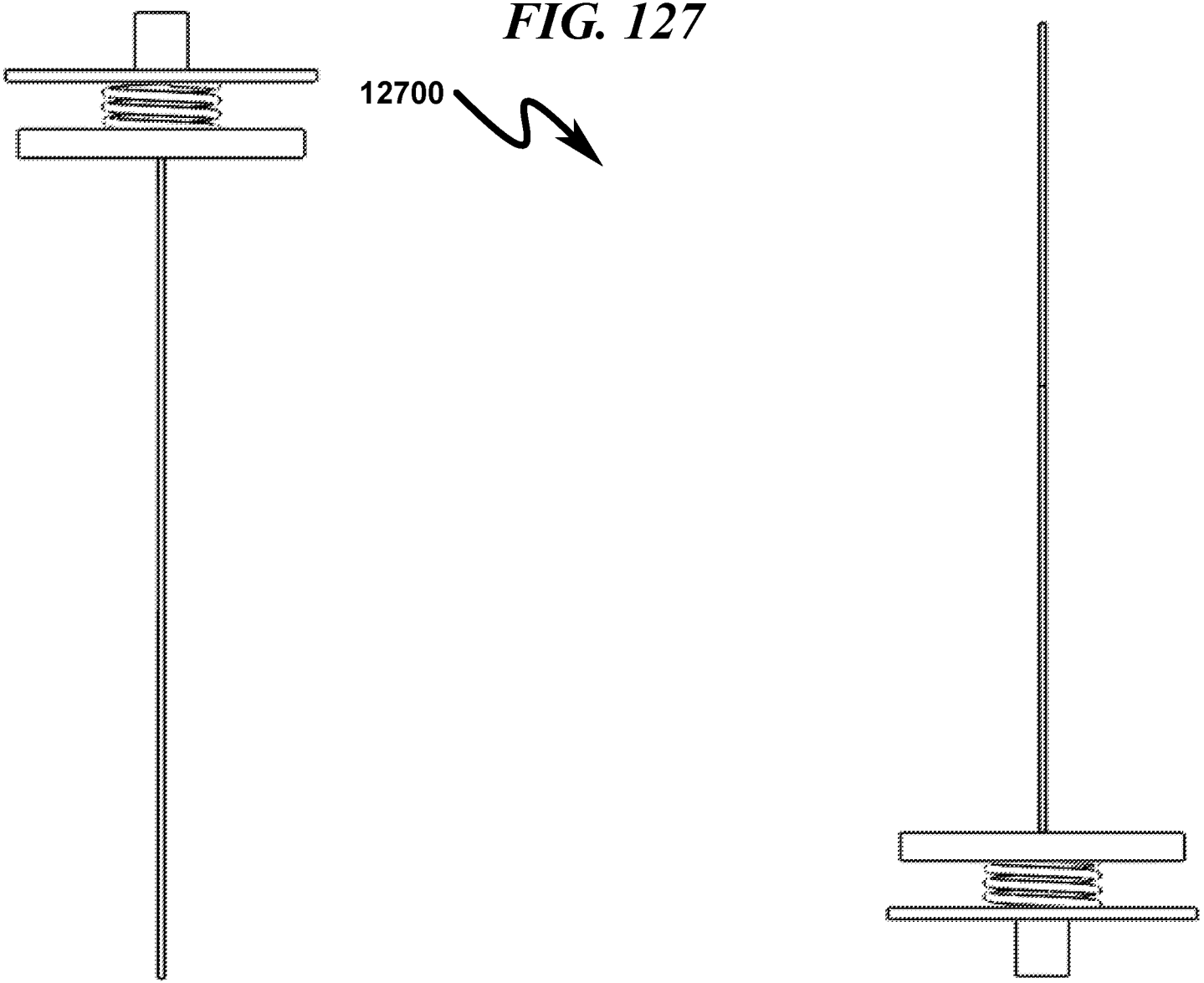

Generally speaking, the components detailed herein will be referred to using a NUMERICAL REFERENCE IDENTIFIER (e.g., (1234) or (12345)) comprising a 2-digit or 3-digit numerical prefix indicating a FIGURE NUMBER on which the element may be identified followed by a 2-digit PART IDENTIFIER for the assembly or part. For example, the NUMERICAL REFERENCE IDENTIFIER (1234) makes reference to PART IDENTIFIER 34 located in FIG. 12. Similarly, the NUMERICAL REFERENCE IDENTIFIER (12345) makes reference to PART IDENTIFIER 45 located in FIG. 123.

Generally speaking, if the NUMERICAL REFERENCE IDENTIFIER is of the form (XXYY) or (XXXYY), the reference is general and refers to any FIG. XX or FIG. XXX containing the PART IDENTIFIER "YY." For example, the NUMERICAL REFERENCE IDENTIFIER (XX34) makes reference to PART IDENTIFIER 34 located in any FIGURE. Similarly, the NUMERICAL REFERENCE IDENTIFIER (XXX45) makes reference to PART IDENTIFIER 45 located in any FIGURE.

In this manner the specific reference to the part and where it may be located can be uniquely specified, as well as allowing a reference to a specific figure in which the part is detailed. Various views of each assembly are systematically and uniformly provided to avoid any ambiguity as to the construction of each part or the related assembly. For clarity, most NUMERICAL REFERENCE IDENTIFIERs will only be listed on a single FIGURE. One skilled in the art will be able to discern the identity of each component given the various views presented.

Invention Component Nomenclature

The present invention discussed herein will utilize component/assembly nomenclature detailed in the tables below. Three-character acronyms will be used to identify individual assemblies and parts within the assemblies.

Rudimentary 2-Stroke Engine (0300)-(3200)

Figure 3:
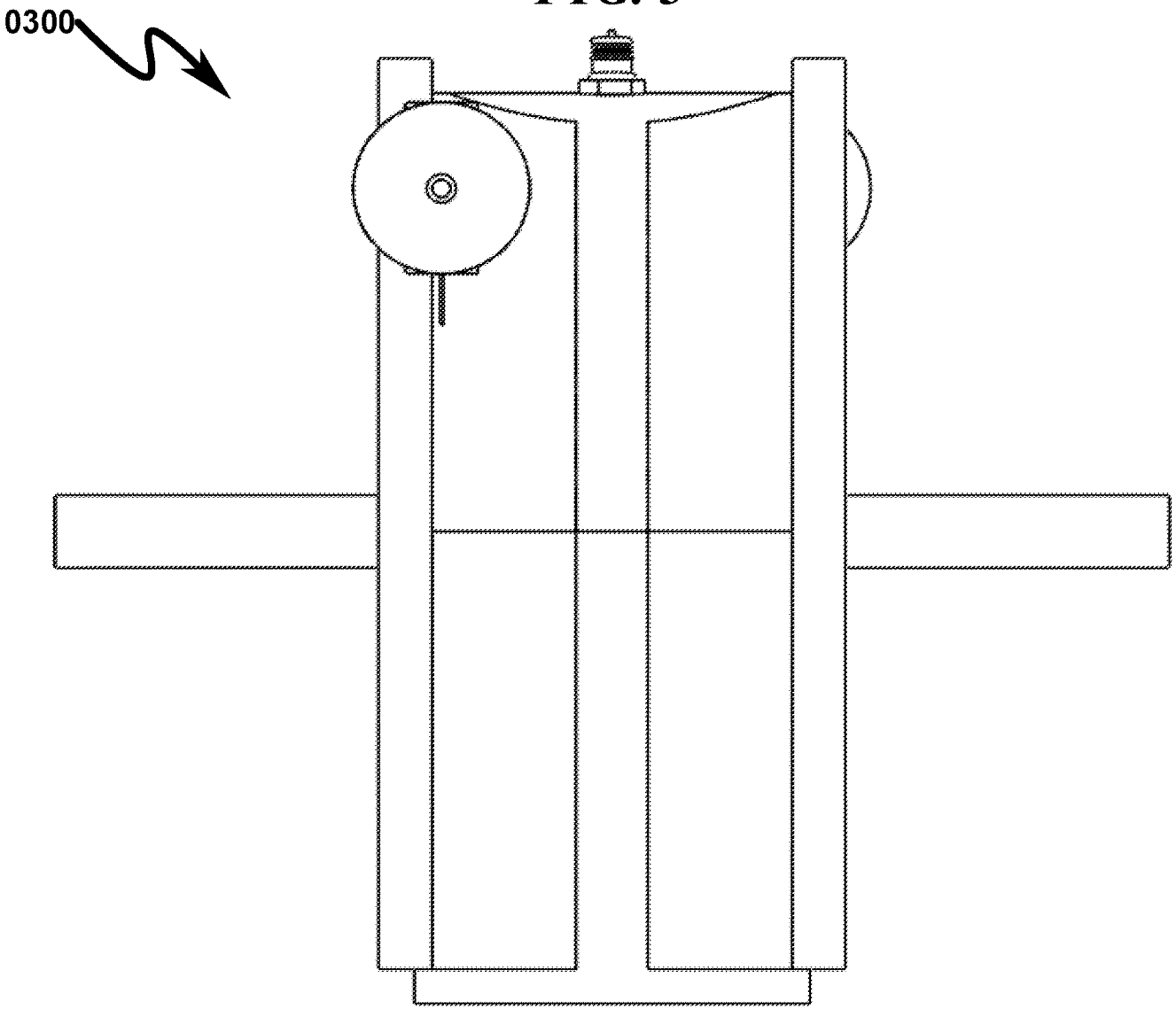
FIG. 3 illustrates a front view of a preferred exemplary rudimentary invention system embodiment.
Figure 4:
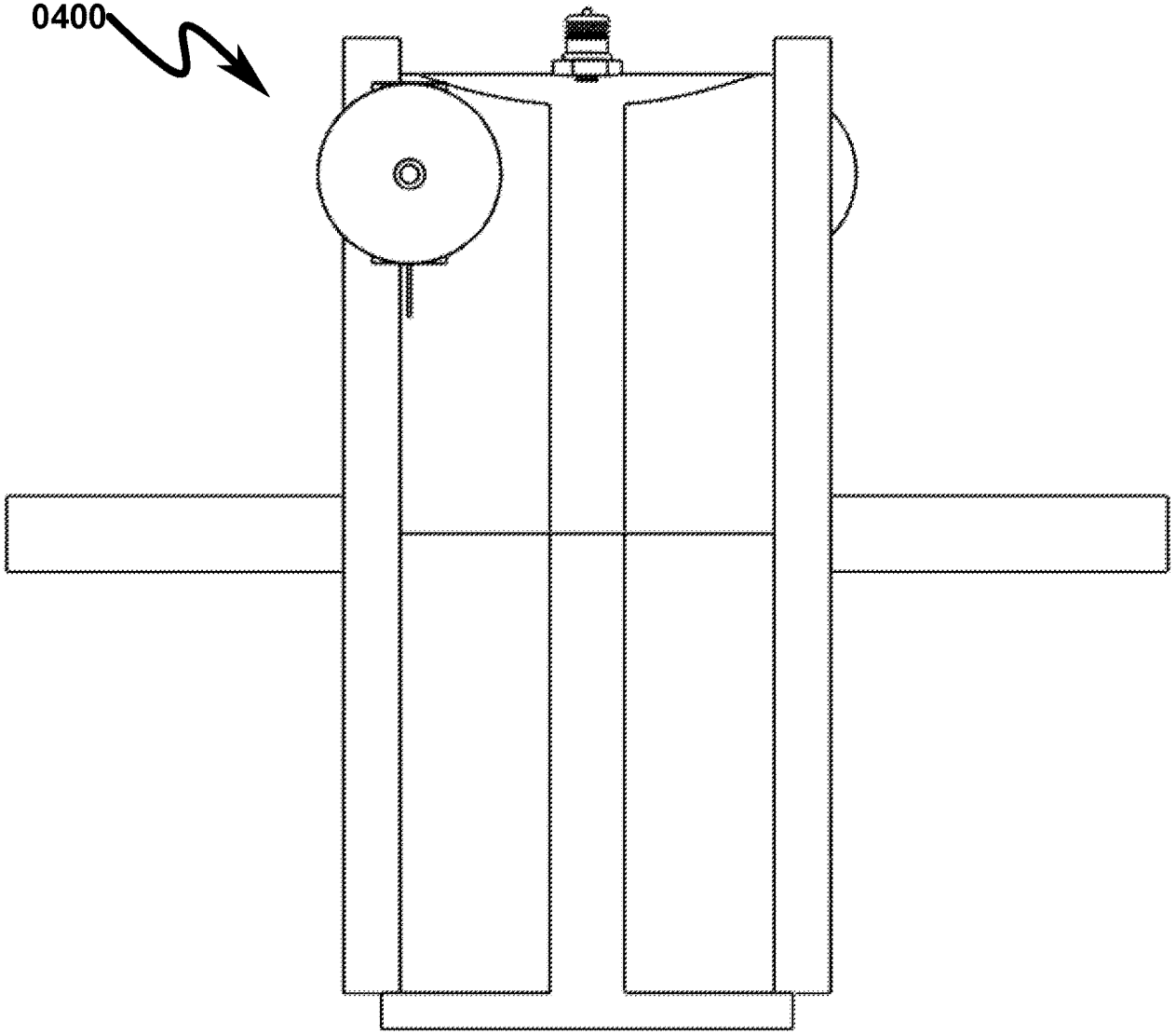
FIG. 4 illustrates a rear view of a preferred exemplary rudimentary invention system embodiment.
Figure 5:
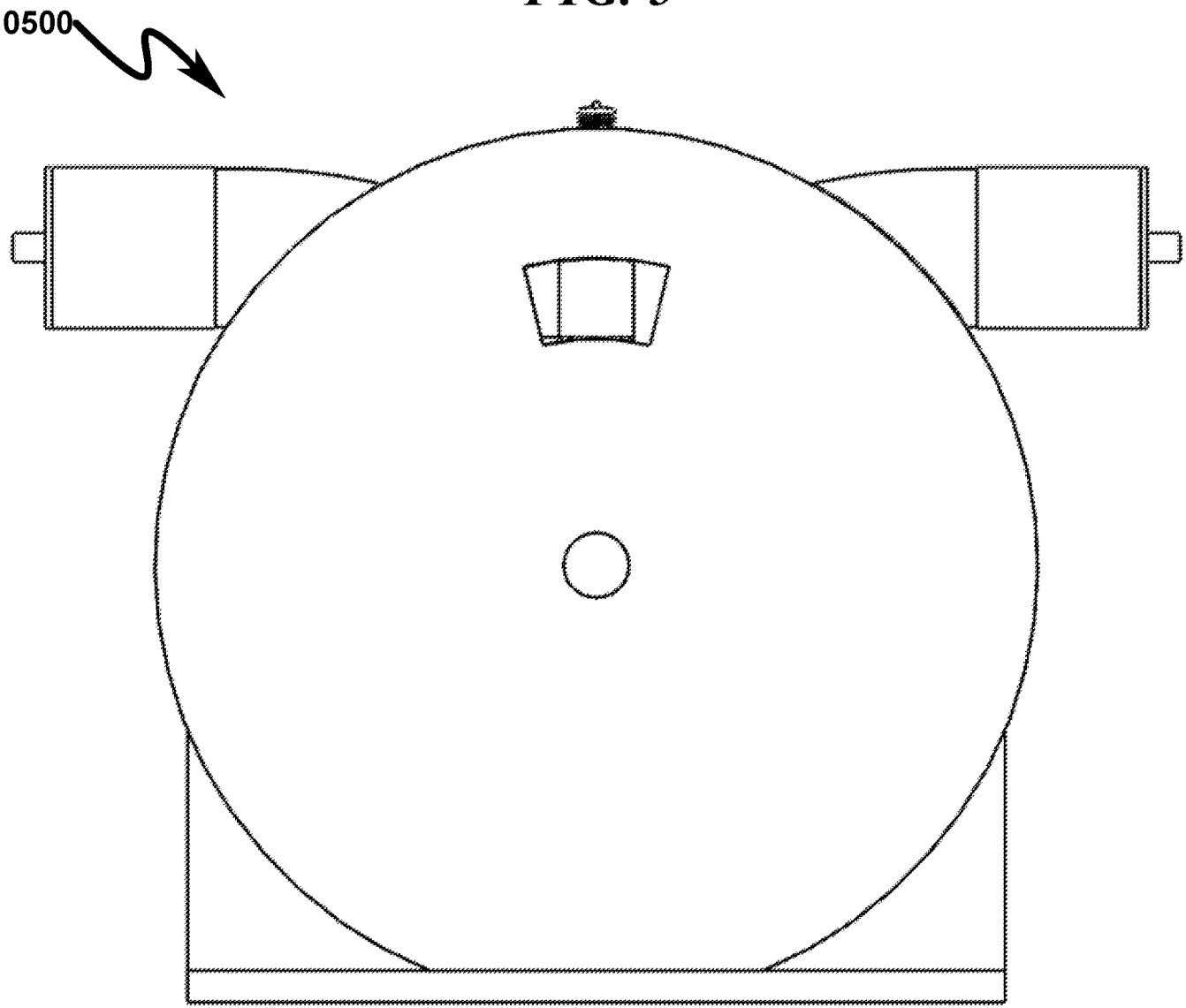
FIG. 5 illustrates a left side view of a preferred exemplary rudimentary invention system embodiment.
Figure 6:
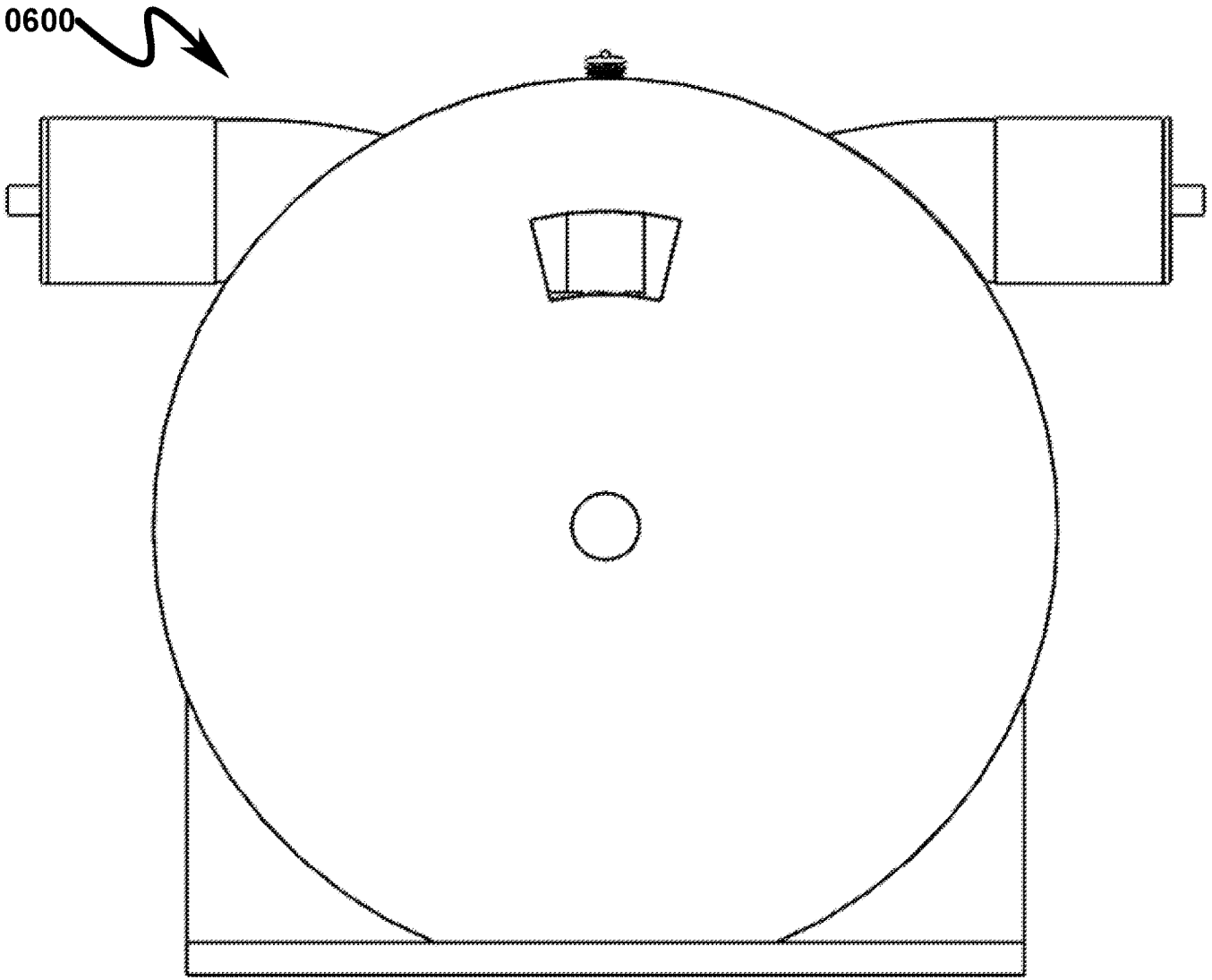
FIG. 6 illustrates a right side view of a preferred exemplary rudimentary invention system embodiment.
Figure 7:
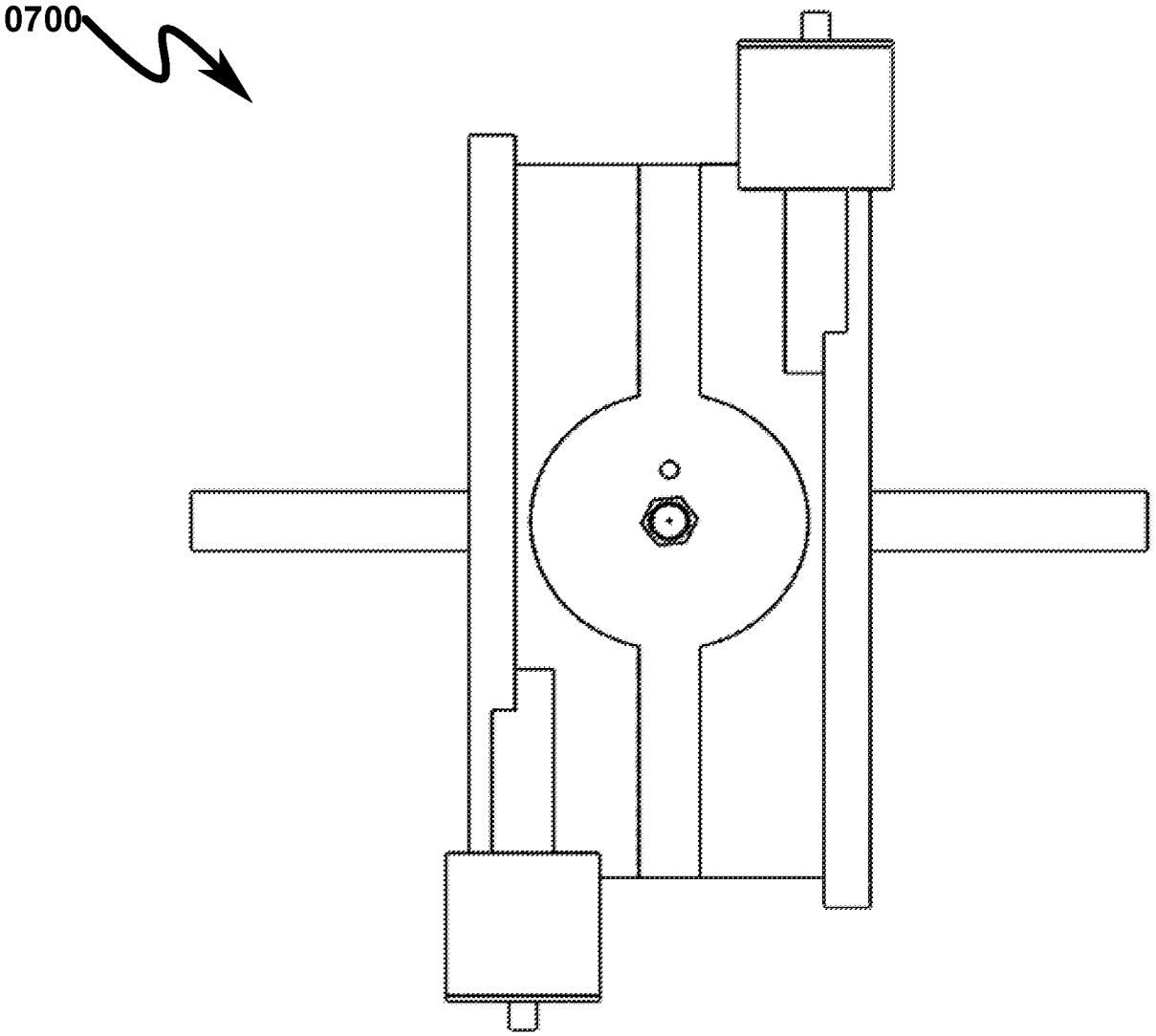
FIG. 7 illustrates a top view of a preferred exemplary rudimentary invention system embodiment.
Figure 8:
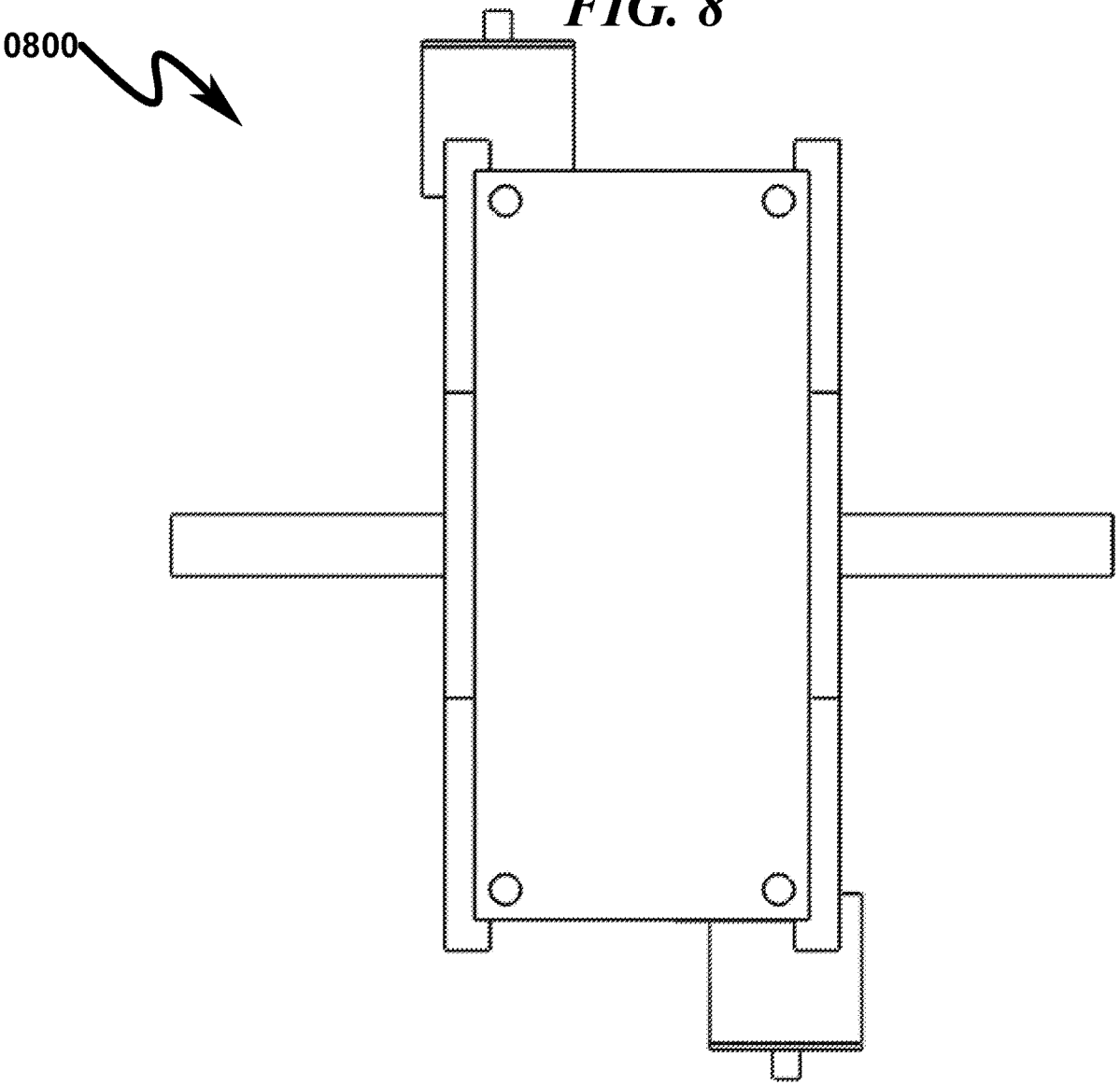
FIG. 8 illustrates a bottom view of a preferred exemplary rudimentary invention system embodiment.
Figure 9:
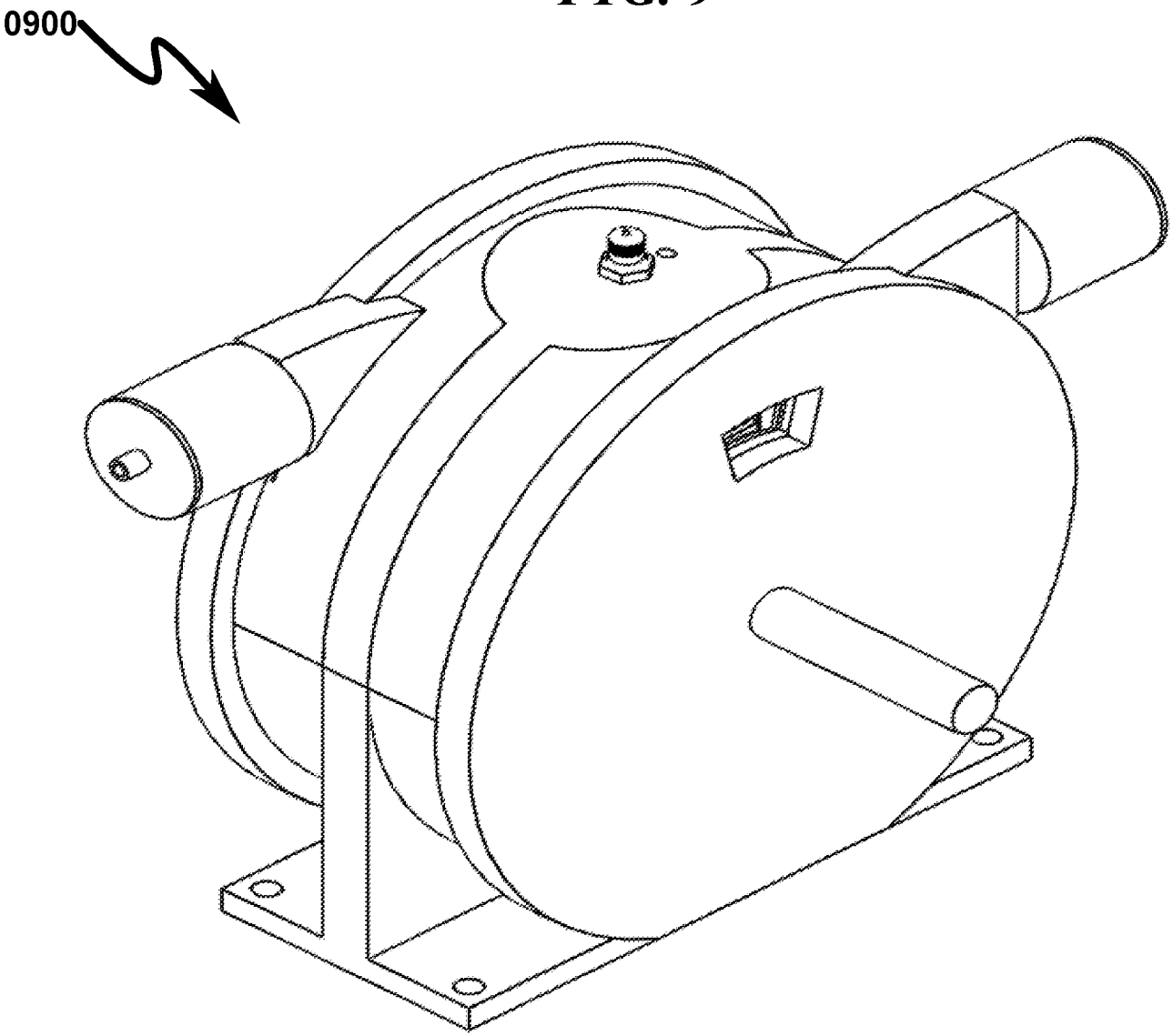
FIG. 9 illustrates a top right front perspective view of a preferred exemplary rudimentary invention system embodiment.
Figure 10:
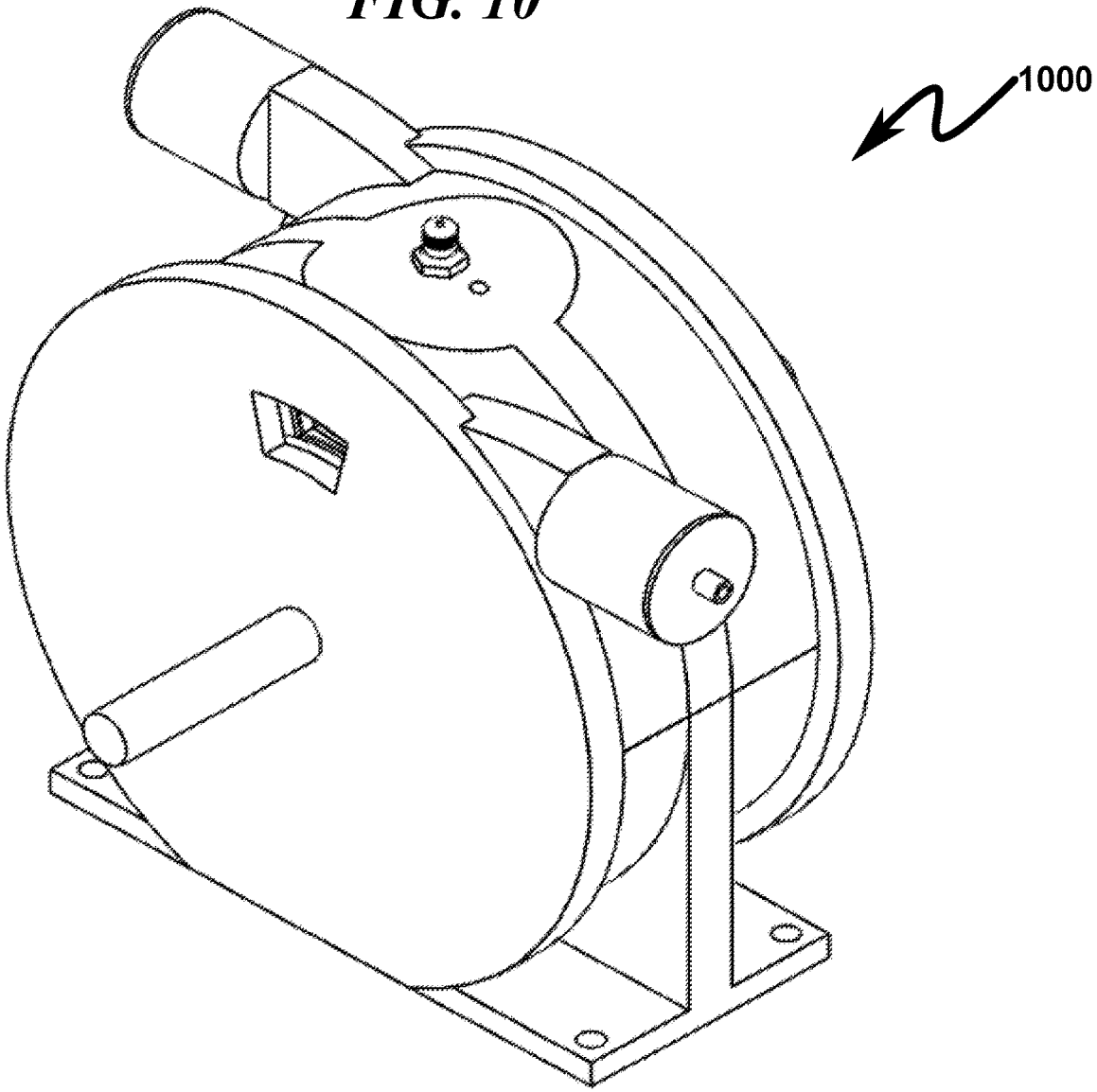
FIG. 10 illustrates a top right rear perspective view of a preferred exemplary rudimentary invention system embodiment.
Figure 11:
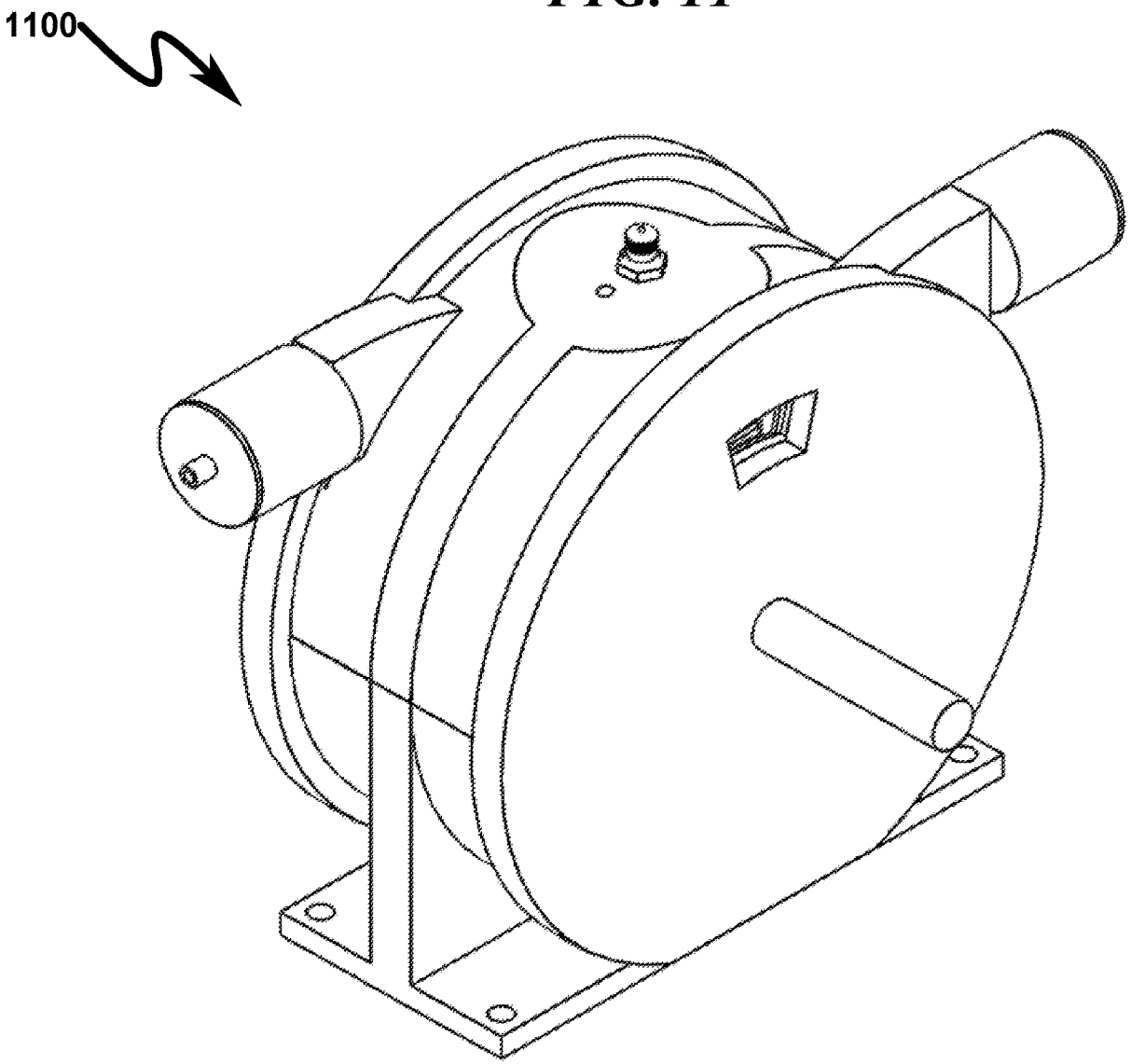
FIG. 11 illustrates a top left rear perspective view of a preferred exemplary rudimentary invention system embodiment.

The rudimentary 2-stroke engine is depicted in FIG. 3 (0300)-FIG. 32 (3200) and includes the elements detailed in the following table:

RUDIMENTARY 2-STROKE COMPRESSOR ENGINE BLOCK (DEPICTED IN FIG. 3 - FIG. 32)

| ASSEMBLY/MECHANISM | ELEMENT/PART/COMPONENT | ACRONYM | ID # |
|---|---|---|---|
| [[Basic]] | Spark Plug | SPK | 15 |
| Rudimentary Engine | Direct Fuel Injector | DFI | 16 |
| Block Accessories | Intake Engine Block Cover | IEC | 08 |
| (BEA) | | | |
| (1700) | | | |
| Intake Sealing | Grooves and Ridges | IGR | 81 |
| (ISP) | Seals and Rings | ISR | 82 |
| (1780) | Engine Covers Grooves/Ridges | IGC | 83 |
| | Recessed Areas | IRA | 84 |
| | Boundary Layer Effect | IBE | 85 |
| Intake Multi-Staged | Fixed Intake Port | FIP | 41 |
| Valve | Intake Multi-Staged Valve | IMB | 42 |
| (IMV) & | Blade | | |
| Intake Engine Block | Intake Multi-Staged Valve | IMS | 43 |
| (IEB) | Spring | | |
| (1740) | Intake Multi-Staged Valve | IMD | 44 |
| | Diaphragm | | |
| | Intake Multi-Staged Valve | IMH | 45 |
| | Housing | | |
| | Intake Fixed Multi-Staged | IMF | 46 |
| | Valve Port | | |
| | Intake Upper Engine Block | IUH | 47 |
| | Head | | |
| | Intake Lower Engine Block | ILC | 48 |
| | Crankcase | | |
| | Upper Engine Block Center | UBS | 49 |
| | Section | | |
| Power Drive Train | Intake Rotary Valve Port | IVP | 61 |
| (PDT) | Intake Rotary Valve Disc | IVD | 62 |
| (1760) | Piston | RPI | 63 |
| | Combustion Chamber | CCH | 64 |
| | Crankshaft | CRK | 65 |
| | Crankcase Oil Reservoir | COR | 66 |
| | Piston Connecting Rod | RPR | 67 |
| | Exhaust Rotary Valve Disc | EVD | 68 |
| | Exhaust Rotary Valve Port | EVP | 69 |
| Exhaust Engine Block | Fixed Exhaust Port | FEP | 71 |
| (EEB) & | Exhaust Multi-Staged Valve | EMB | 72 |
| Exhaust Multi- | Blade | | |
| Staged Valve | Exhaust Multi-Staged Valve | EMS | 73 |
| (EMV) | Spring | | |
| (1770) | Exhaust Multi-Staged Valve | EMD | 74 |
| | Diaphragm | | |
| | Exhaust Multi-Staged Valve | EMH | 75 |
| | Housing | | |
| | Exhaust Fixed Multi-Staged | EMF | 76 |
| | Valve Port | | |
| | Exhaust Upper Engine Block | EUH | 77 |
| | Head | | |
| | Exhaust Lower Engine Block | ELC | 78 |
| | Crankcase | | |

-continued

| RUDIMENTARY 2-STROKE COMPRESSOR ENGINE BLOCK (DEPICTED IN FIG. 3 - FIG. 32) | | | |
|---|---|---|---|
| ASSEMBLY/MECHANISM | ELEMENT/PART/COMPONENT | ACRONYM | ID # |
| | Lower Engine Block Center Section | LBS | 79 |
| Exhaust Sealing (ESP) (1780) | Grooves and Ridges | EGR | 86 |
| | Seals and Rings | ESR | 87 |
| | Engine Covers Grooves/Ridges | EGC | 88 |
| | Recessed Areas | ERA | 89 |
| | Boundary Layer Effect | EBE | 85 |
| [[Basic]] Rudimentary Engine Block Accessories (BEA) (1700) | Exhaust Engine Block Cover | EEC | 09 |

Enhanced Compressor Engine (3300)-(32000)

Figure 33:
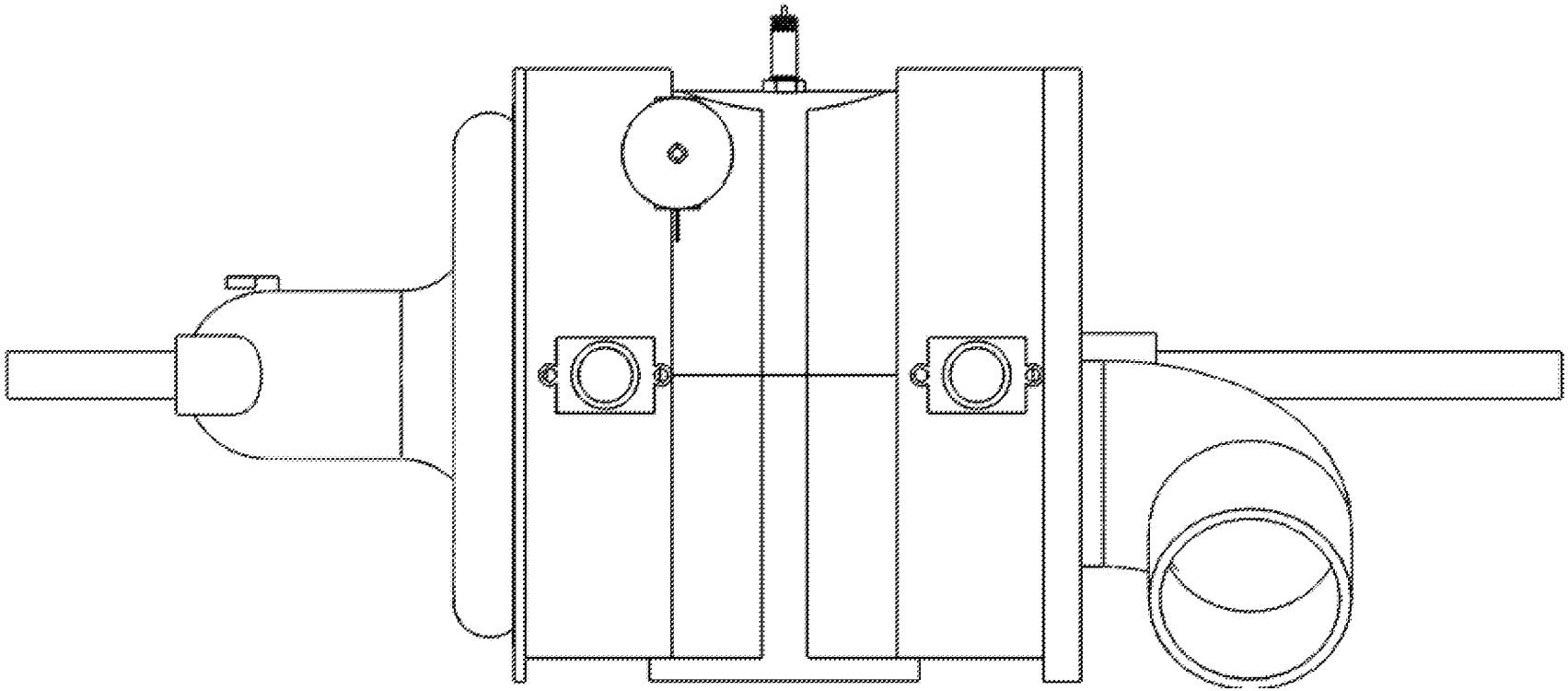
FIG. 33 illustrates a front view of a preferred exemplary enhanced invention system embodiment.
Figure 34:
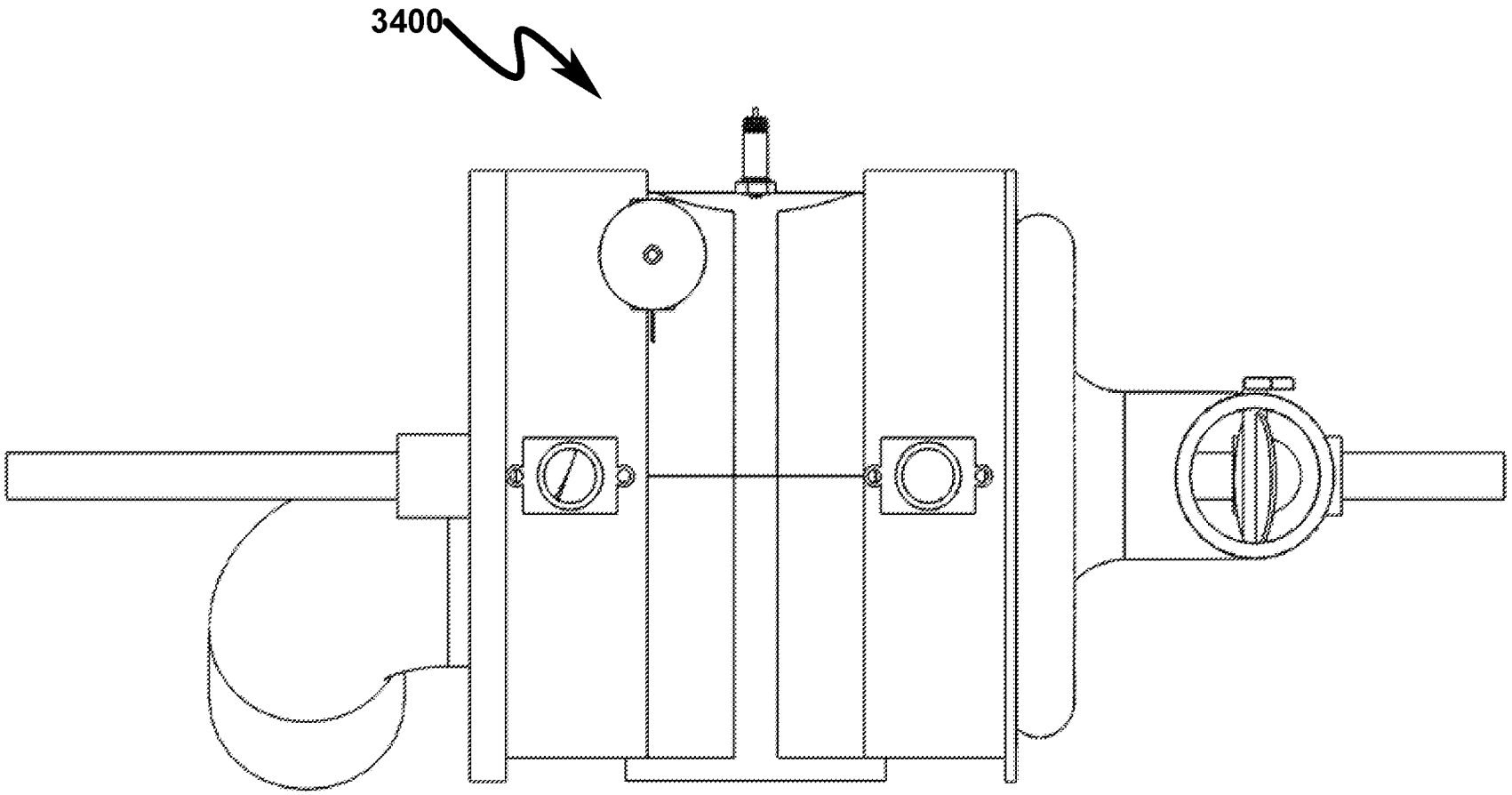
FIG. 34 illustrates a rear view of a preferred exemplary enhanced invention system embodiment.
Figure 35:
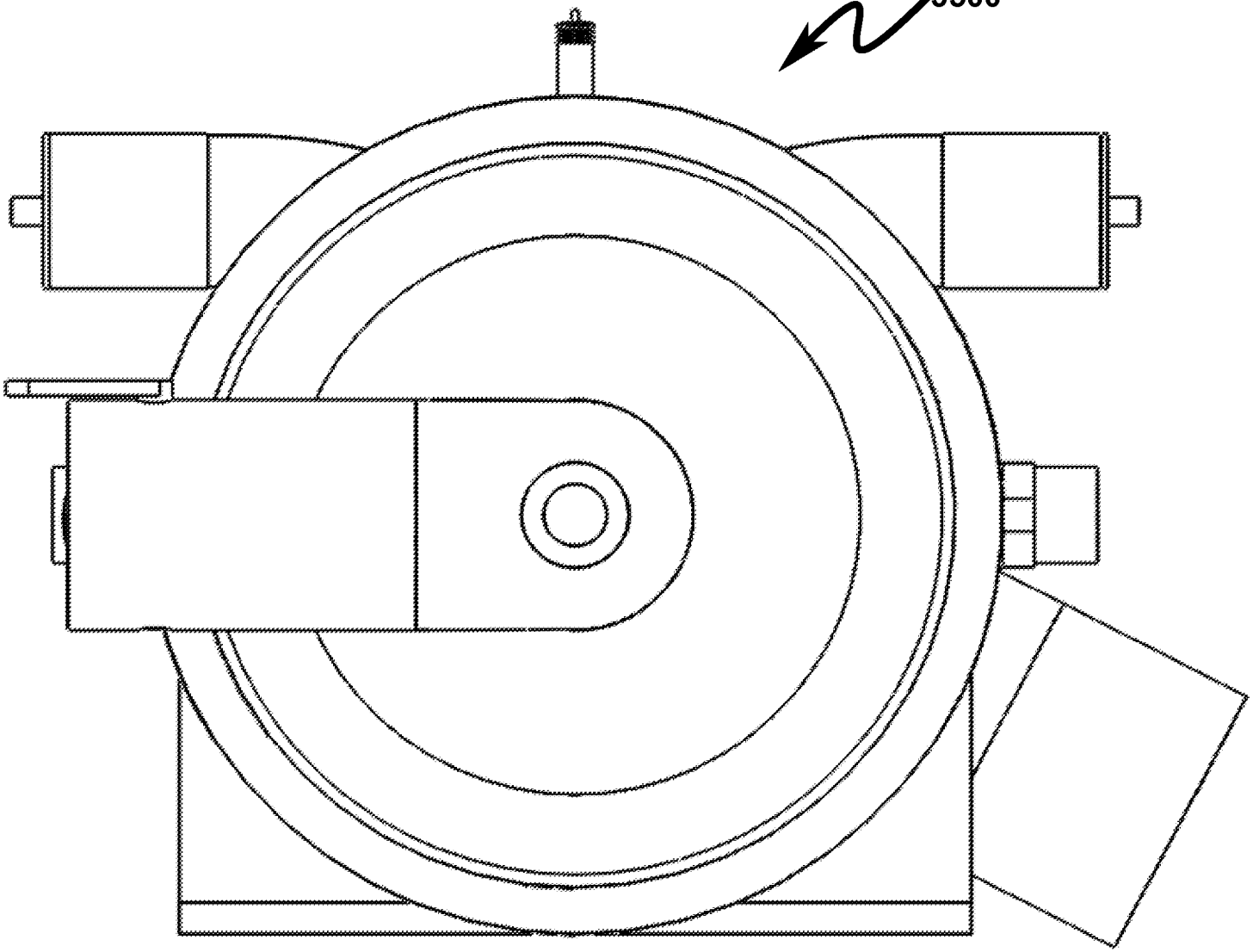
FIG. 35 illustrates a left side view of a preferred exemplary enhanced invention system embodiment.
Figure 36:
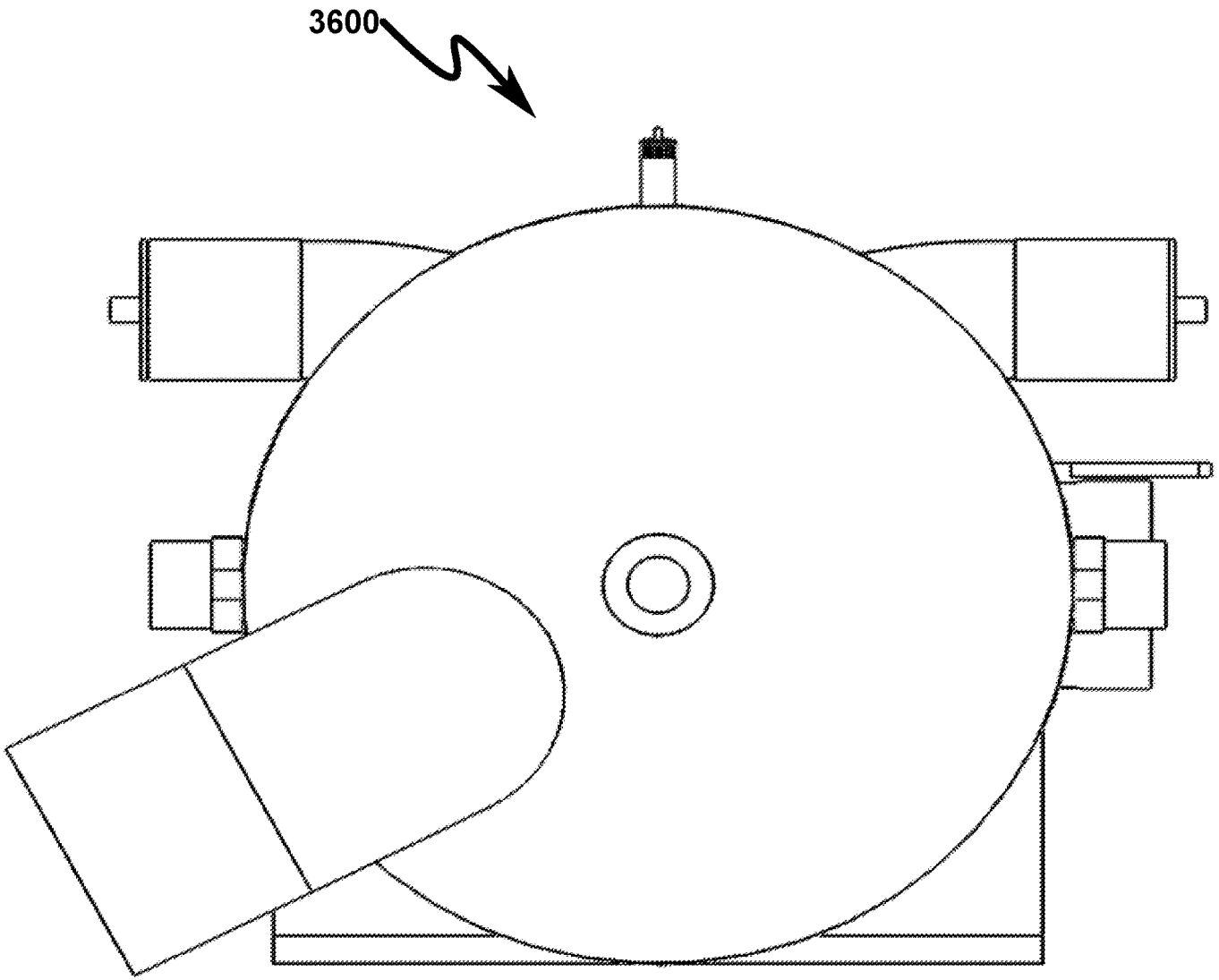
FIG. 36 illustrates a right side view of a preferred exemplary enhanced invention system embodiment.
Figure 37:
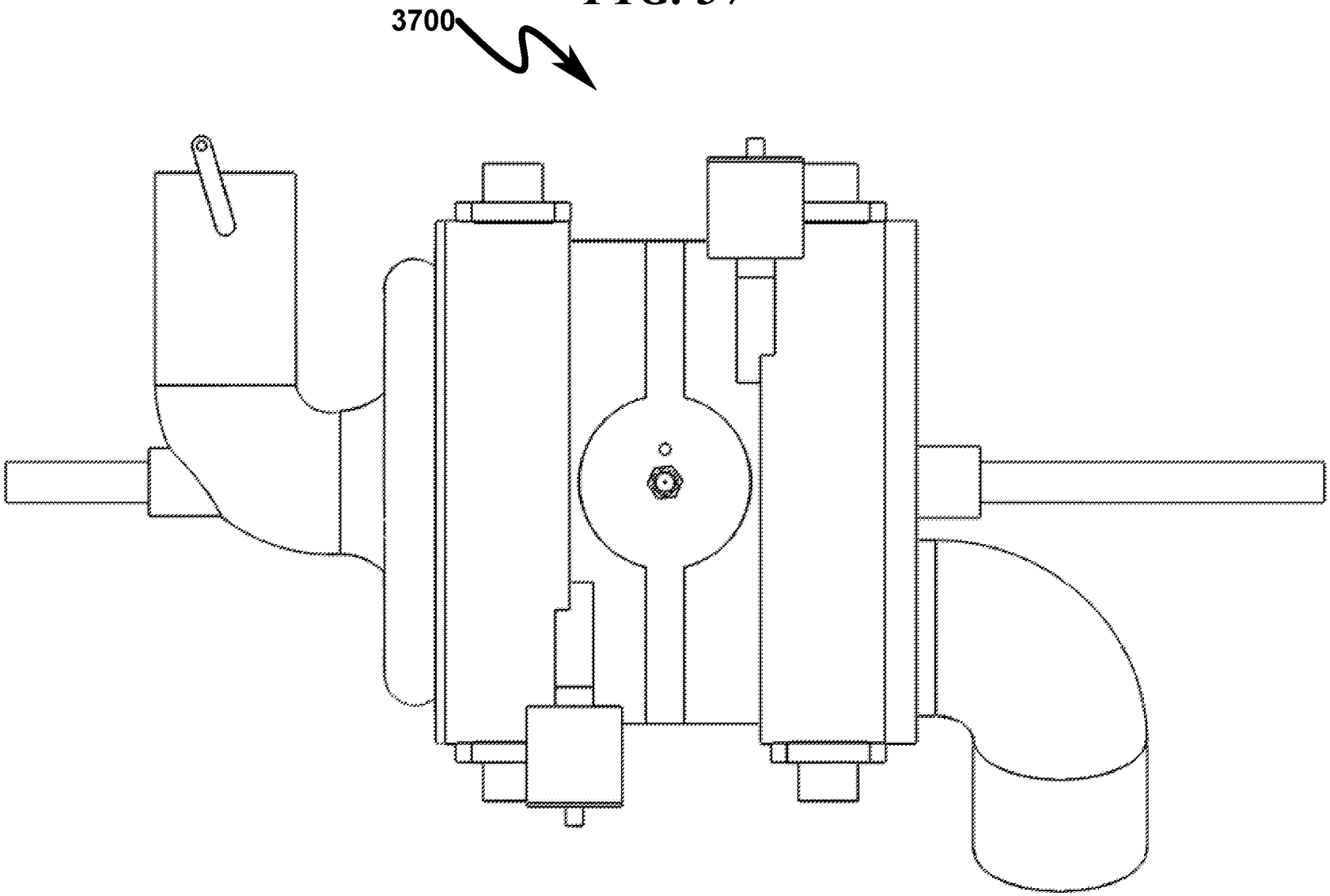
FIG. 37 illustrates a top view of a preferred exemplary enhanced invention system embodiment.
Figure 38:
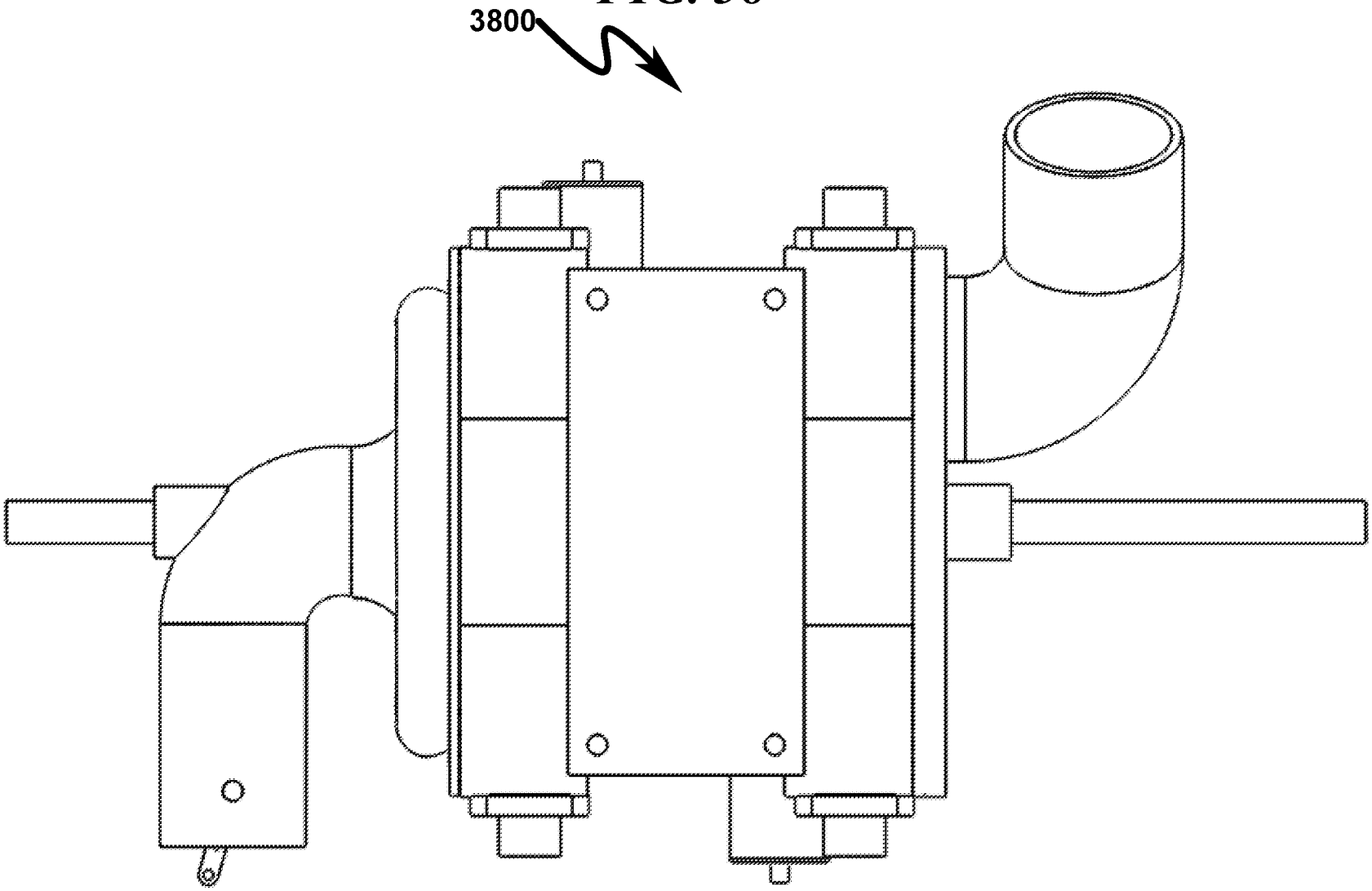
FIG. 38 illustrates a bottom view of a preferred exemplary enhanced invention system embodiment.
Figure 39:
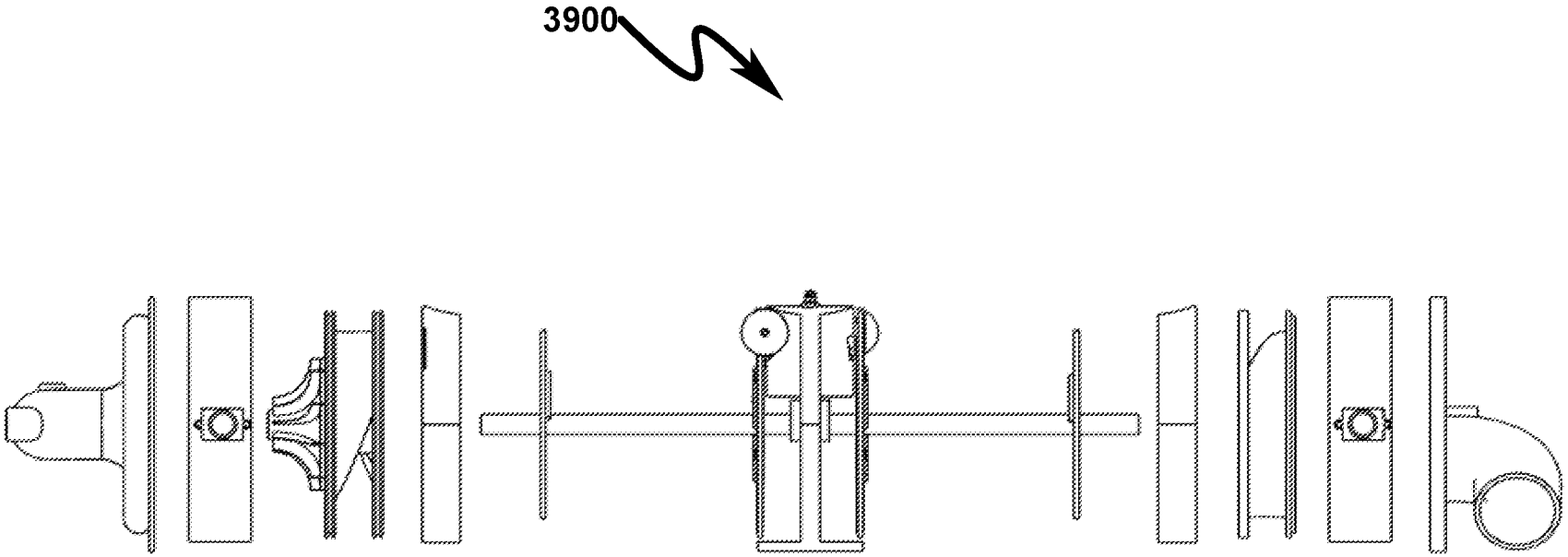
FIG. 39 illustrates a front view of a preferred exemplary enhanced invention system embodiment.
Figure 40:
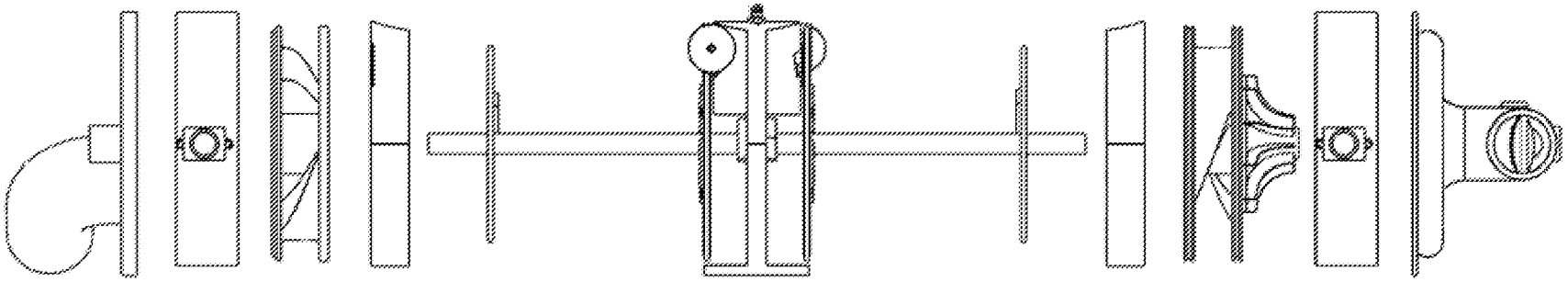
FIG. 40 illustrates a rear view of a preferred exemplary enhanced invention system embodiment.
Figure 41:
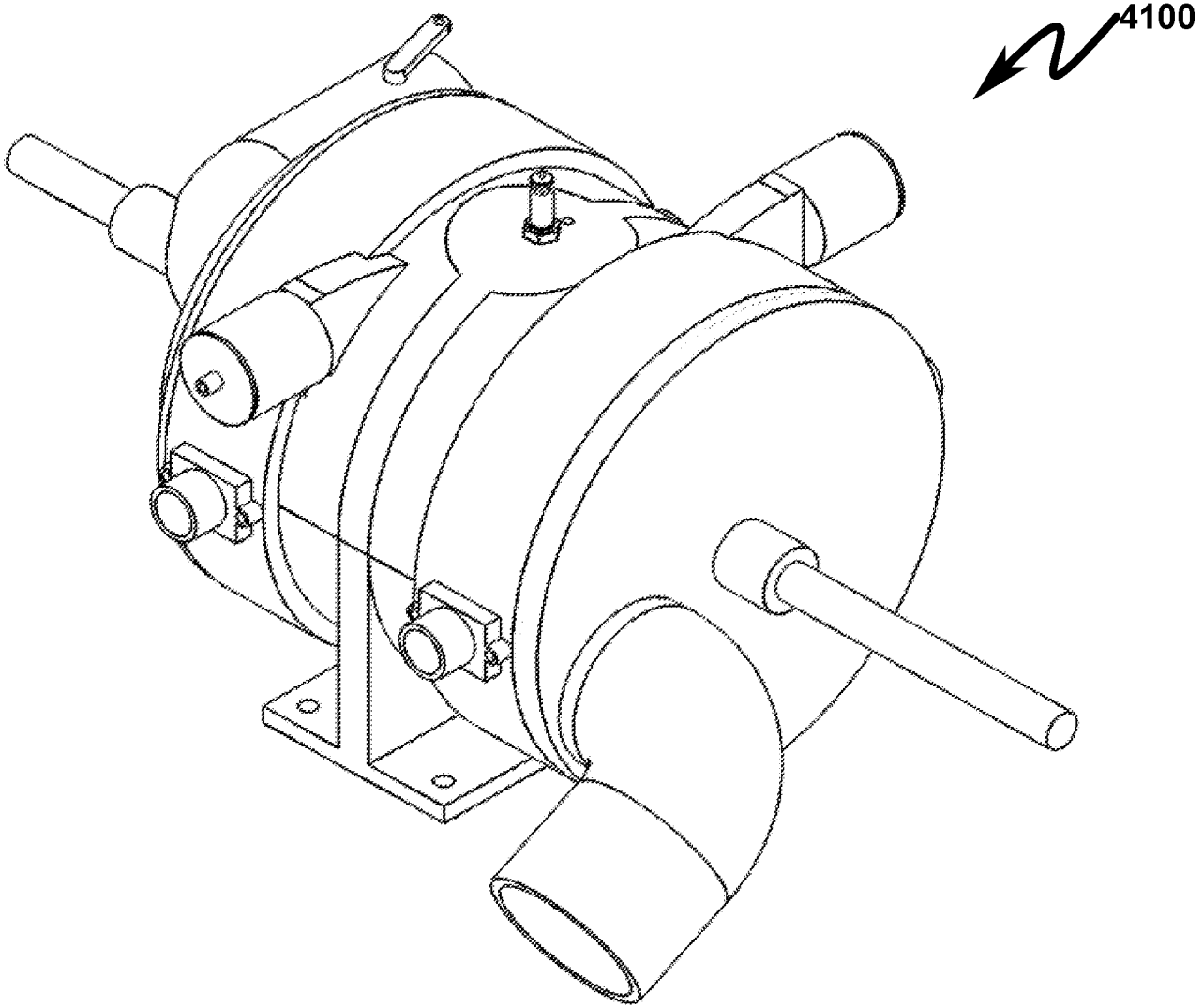
FIG. 41 illustrates a top right front perspective view of a preferred exemplary enhanced invention system embodiment.
Figure 42:
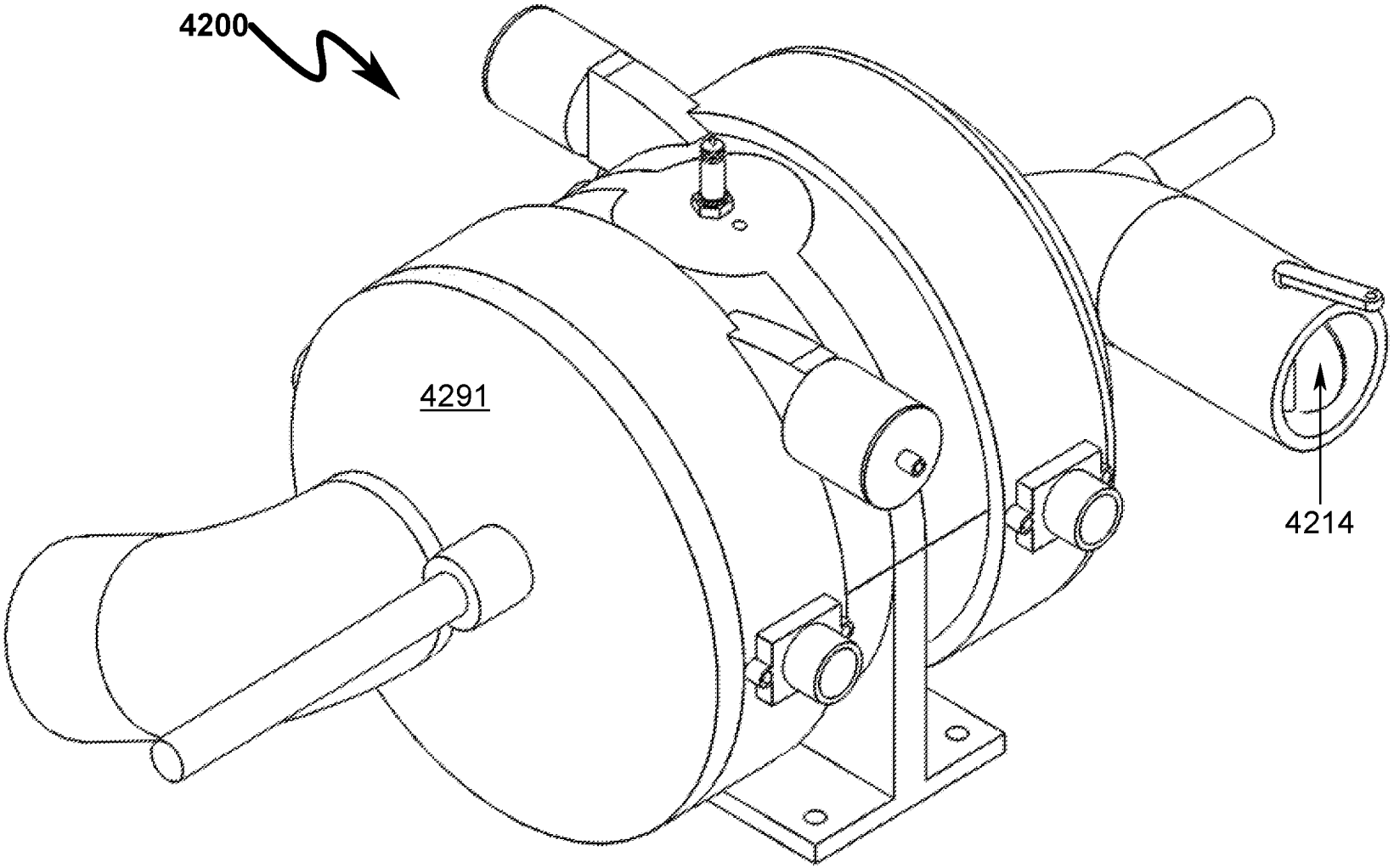
FIG. 42 illustrates a top right rear perspective view of a preferred exemplary enhanced invention system embodiment.
Figure 43:
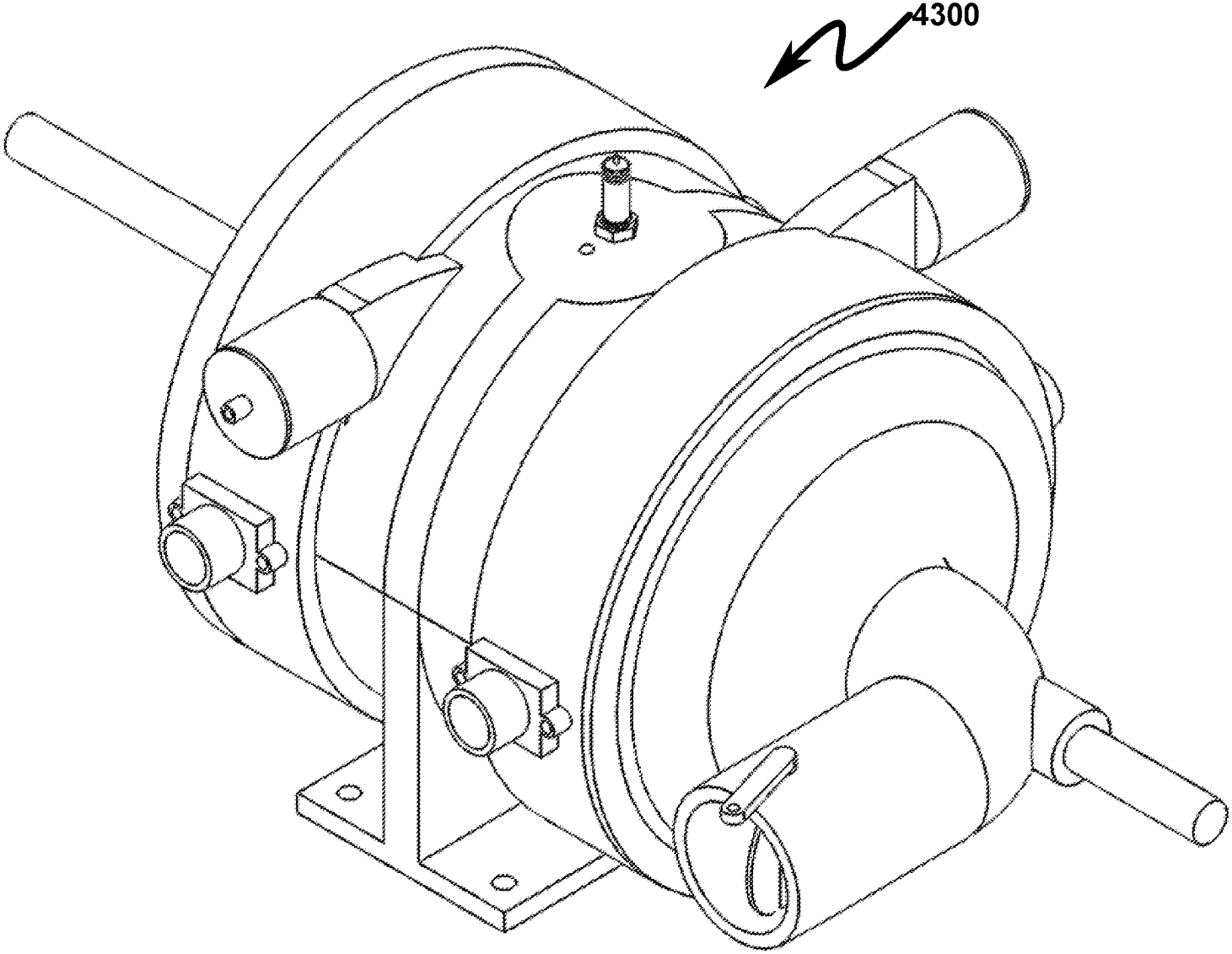
FIG. 43 illustrates a top left rear perspective view of a preferred exemplary enhanced invention system embodiment.
Figure 44:
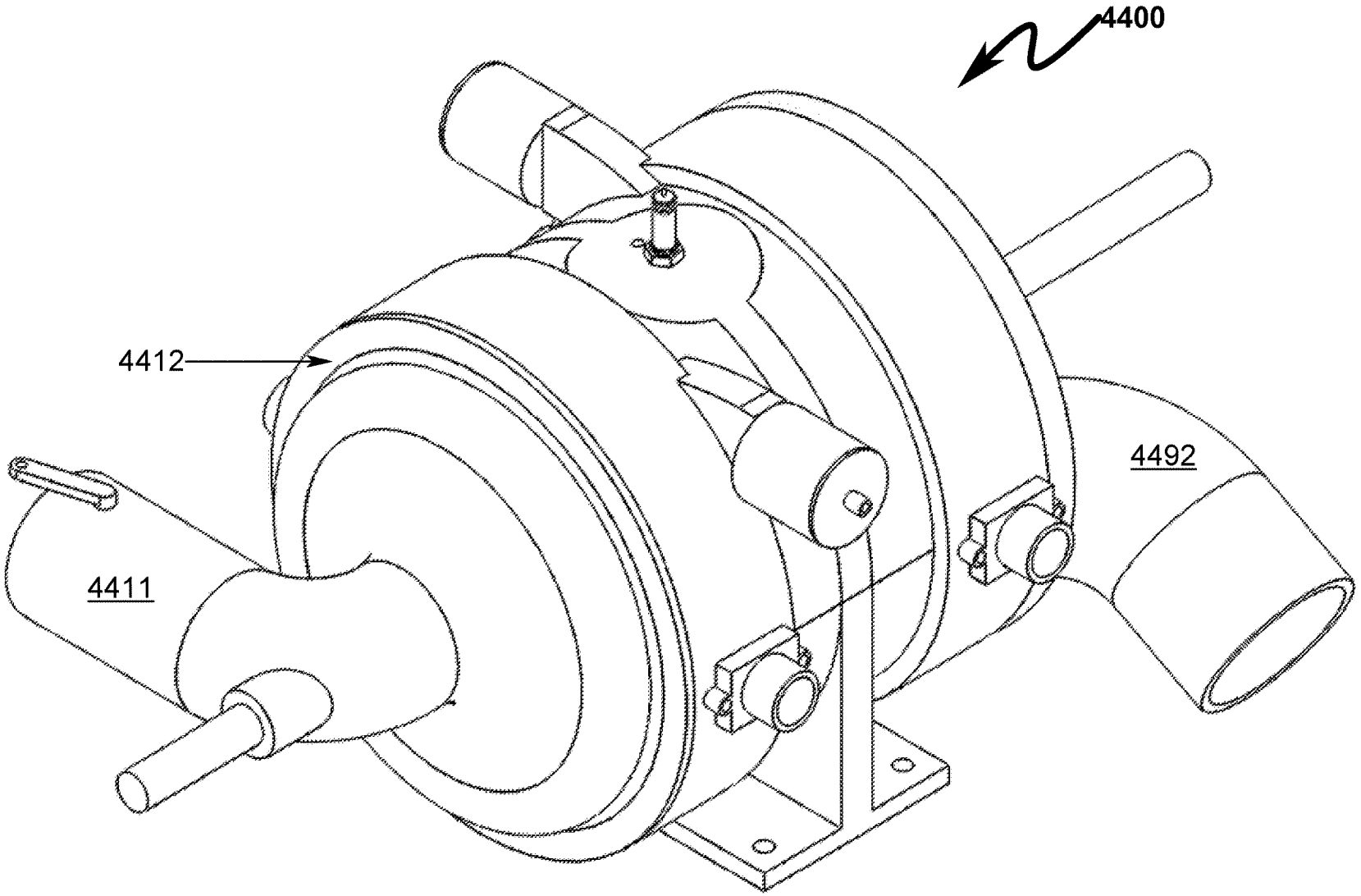
FIG. 44 illustrates a top left front perspective view of a preferred exemplary rudimentary invention system embodiment.
Figure 45:
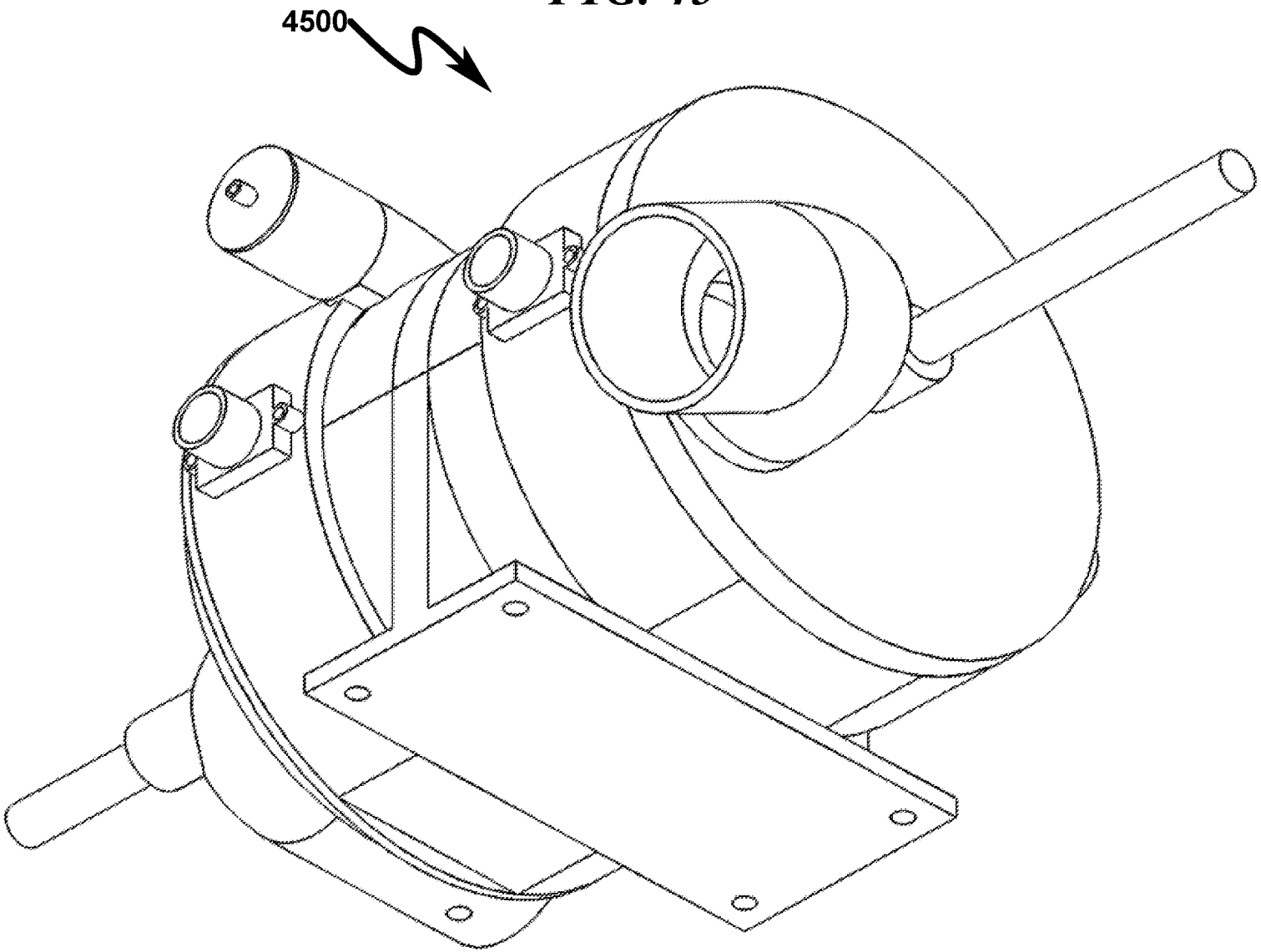
FIG. 45 illustrates a bottom right front perspective view of a preferred exemplary enhanced invention system embodiment.
Figure 46:
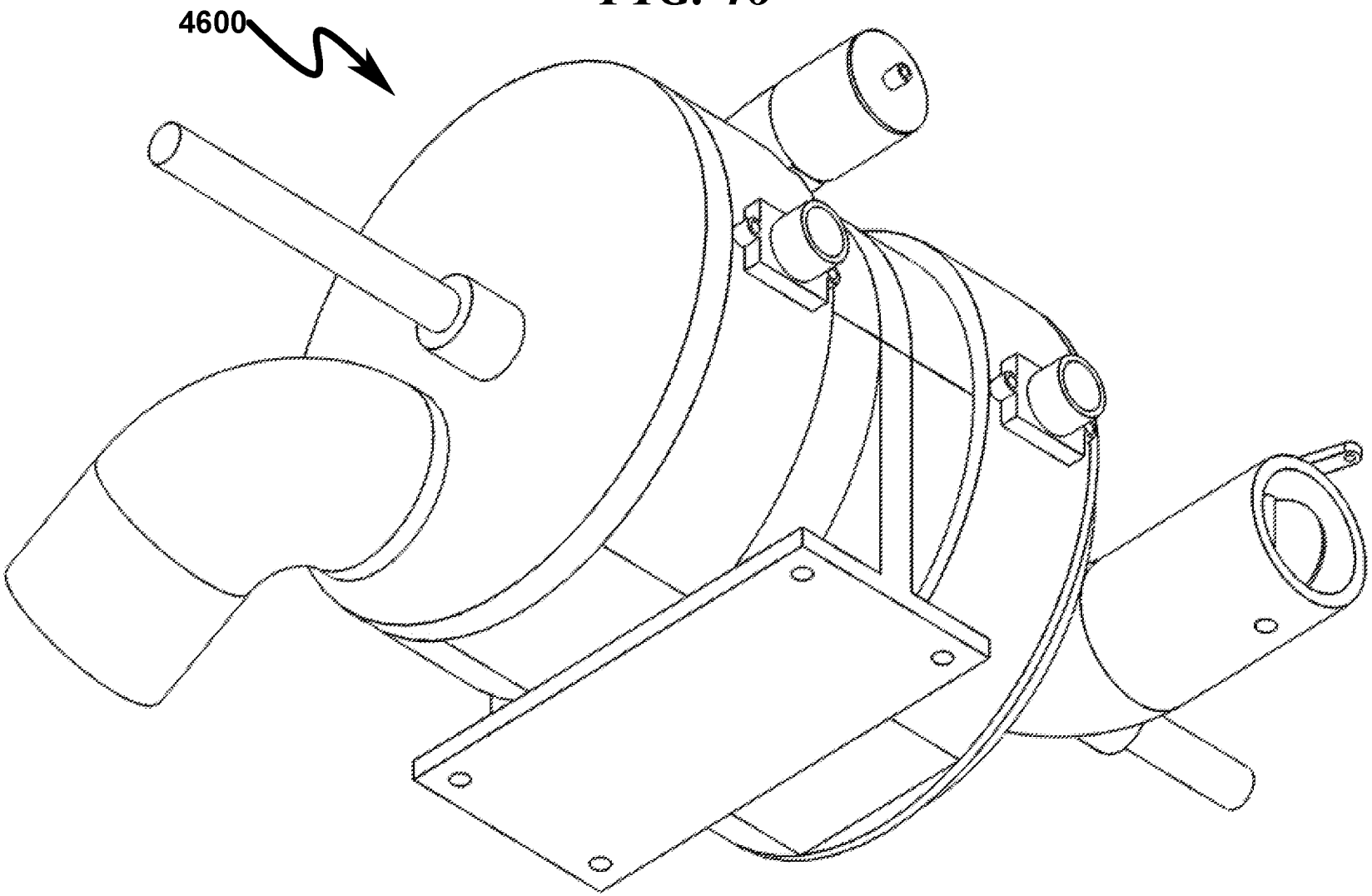
FIG. 46 illustrates a bottom right rear perspective view of a preferred exemplary enhanced invention system embodiment.
Figure 47:
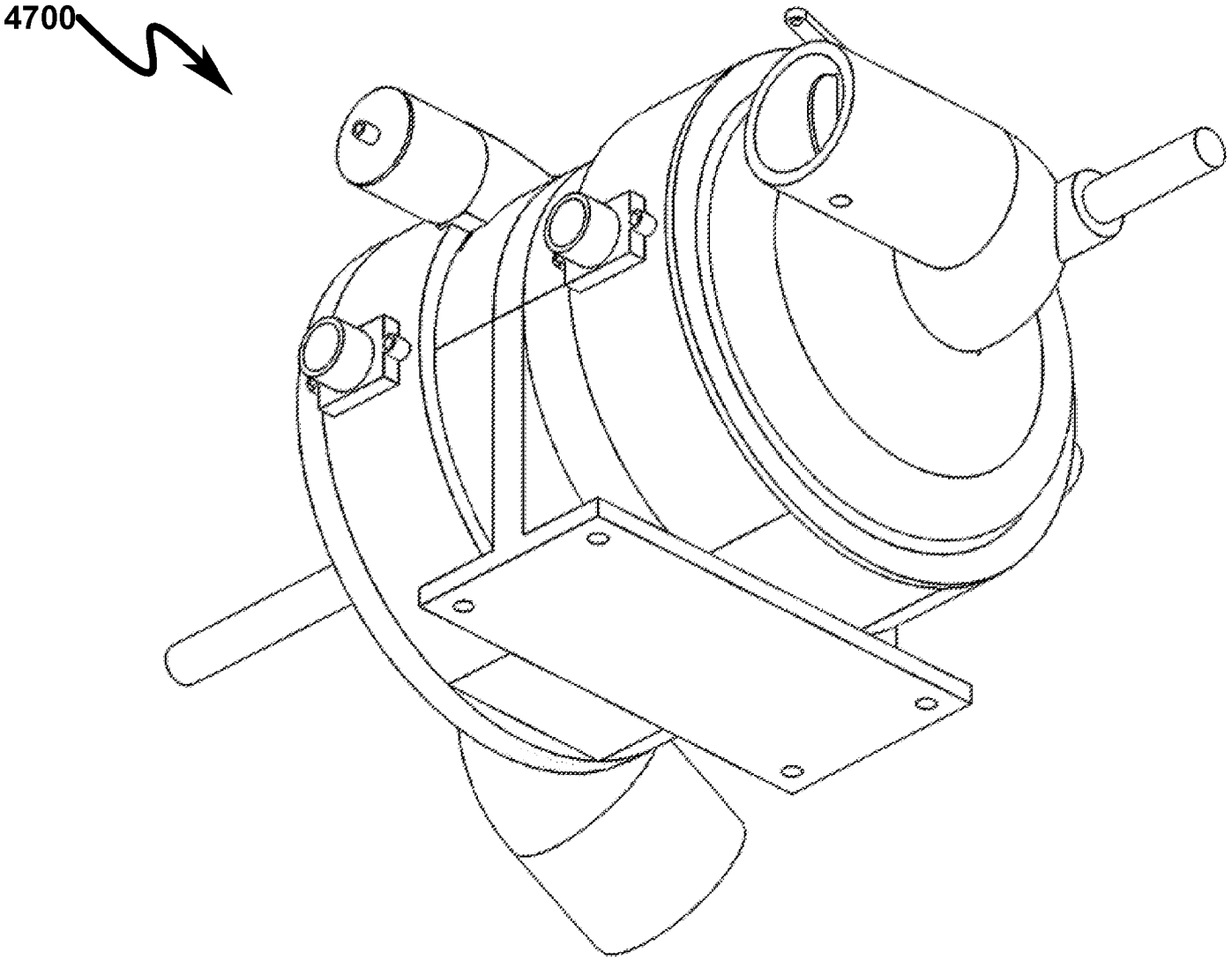
FIG. 47 illustrates a bottom left rear perspective view of a preferred exemplary enhanced invention system embodiment.

The rudimentary 2-Stroke engine may be enhanced using intake and exhaust compressors and is depicted in FIG. 33 (3300)-FIG. 320 (32000). This invention embodiment may include any combination of the elements detailed in the following table:

| ENHANCED COMPRESSOR ENGINE | | | |
|---|---|---|---|
| ASSEMBLY/MECHANISM | ELEMENT/PART/COMPONENT | ACRONYM | ID # |
| Intake-Manifold-Volute & Engine Cover (IMV) (4910) | Intake Manifold | INM | 11 |
| | Engine Block Cover | ENC | 12 |
| | Straight Channel Spool | ISC | 13 |
| | Throttle Plate | THP | 14 |
| | Spark Plug | SPK | 15 |
| | Direct Fuel Injector | DFI | 16 |
| | Positive Crankcase Ventilation | PCV | 17 |
| Intake Forced Induction (FIN) & Cooling Water Jacket (CJA) (4920) | Cooling Channel Spool with Centrifugal Impeller | ICS | 21 |
| | Cooling Water Jacket | IWJ | 22 |
| | Spiral Channel | IPC | 23 |
| | Water Jacket Inlet Port | IIP | 24 |
| | Water Jacket Outlet Port | IOP | 25 |
| | Spiral Impeller | ISI | 26 |
| | Centrifugal Impeller | CIP | 27 |
| | Volute Swirl Chamber | VSC | 28 |
| | Volute Housing | VOH | 29 |
| Intake Centrifugal Advance (CAD) (4950) | Advance Counter Weight | IAW | 51 |
| | Centrifugal Advance Spring | IAS | 52 |
| | Centrifugal Advance Plate | IAP | 53 |
| | Counter Weight Pivot | IWP | 54 |
| | Centrifugal Advance Cover | IAC | ND |
| (COMPONENTS FROM RUDIMENTARY 2-STROKE COMPRESSOR ENGINE) | | | |
| [[Basic]] Rudimentary Engine Block Accessories (BEA) ([[4900]]1700) | Spark Plug | SPK | 15 |
| | Direct Fuel Injector | DFI | 16 |
| | Intake Engine Block Cover | IEC | 08 |
| Intake Sealing (ISP) (4980) | Grooves and Ridges | IGR | 81 |
| | Seals and Rings | ISR | 82 |
| | Engine Covers Grooves/Ridges | IGC | 83 |
| | Recessed Areas | IRA | 84 |
| | Boundary Layer Effect | IBE | ND |
| Intake Multi-Staged Valve (MSV) & Engine Block (4940) | Fixed [[Inlet]] Intake Port | FIP | 41 |
| | Intake Multi-Staged Valve Blade | IMB | 42 |
| | Intake Multi-Staged Valve Spring | IMS | 43 |
| | Intake Multi-Staged Valve Diaphragm | IMD | 44 |
| | Intake Multi-Staged Valve Housing | IMH | 45 |
| | Intake Fixed Multi-Staged Valve Port | IMF | 46 |
| | Intake Upper Engine Block Head | IUH | 47 |

-continued

| ENHANCED COMPRESSOR ENGINE | | | |
|---|---|---|---|
| ASSEMBLY/MECHANISM | ELEMENT/PART/COMPONENT | ACRONYM | ID # |
| | Intake Lower Engine Block Crankcase | ILC | 48 |
| | Upper Engine Block Center Section | UBS | 49 |
| Power Drive Train (PDT) (4960) | Intake Rotary Valve Port | IVP | 61 |
| | Intake Rotary Valve Disc | IVD | 62 |
| | Piston | RPI | 63 |
| | Combustion Chamber | CCH | 64 |
| | Crankshaft | CRK | 65 |
| | Crankcase Oil Reservoir | COR | 66 |
| | Piston Connecting Rod | RPR | 67 |
| | Rotary Valve Disc | EVD | 68 |
| | Exhaust Rotary Valve Port | EVP | 69 |
| Engine Block & Exhaust Multi-Staged Valve (MSV) (4970) | Fixed Exhaust Port | FEP | 71 |
| | Exhaust Multi-Staged Valve Blade | EMB | 72 |
| | Exhaust Multi-Staged Valve Spring | EMS | 73 |
| | Exhaust Multi-Staged Valve Diaphragm | EMD | 74 |
| | Exhaust Multi-Staged Valve Housing | EMH | 75 |
| | Exhaust Fixed Multi-Staged Valve Port | EMF | 76 |
| | Exhaust Upper Engine Block Head | EUH | 77 |
| | Exhaust Lower Engine Block Crankcase | ELC | 78 |
| | Lower Engine Block Center Section | LBS | 79 |
| Exhaust Sealing (ESP) (4980) | Grooves and Ridges | EGR | 86 |
| | Seals and Rings | ESR | 87 |
| | Engine Cover Grooves/Ridges | EGC | 88 |
| | Recessed Areas | ERA | 89 |
| | Boundary Layer Effect | EBE | ND |
| [[Basic]] Rudimentary Engine Block Accessories (BEA) ([[4900]]1700) | Intake Engine Block Cover | EEC | 09 |
| Exhaust Centrifugal Advance (CAD) (4950) | Advance Counter Weight | EAW | 56 |
| | Centrifugal Advance Spring | EAS | 57 |
| | Centrifugal Advance Plate | EAP | 58 |
| | Counter Weight Pivot | EWP | 59 |
| | Centrifugal Advance Cover Exhaust | EAC | ND |
| Exhaust Forced Discharge [[(FIN)]] (FID) & Cooling Water Jacket (CJA) (4930) | Cooling Channel Spool | ECS | 31 |
| | Cooling Water Jacket | EWJ | 32 |
| | Spiral Channel | EPC | 33 |
| | Water Jacket Inlet Port | EIP | 34 |
| | Water Jacket Outlet Port | EOP | 35 |
| | Spiral Impeller | ESI | 36 |
| | Straight Channel Spool | ESC | 37 |
| Exhaust Manifold & Engine Cover (EMC) (4990) | Engine Block Cover | EBC | 91 |
| | Exhaust Manifold | EXM | 92 |
| | Positive Crankcase Ventilation | PCV | ND |

General System Overview

Figure 49:
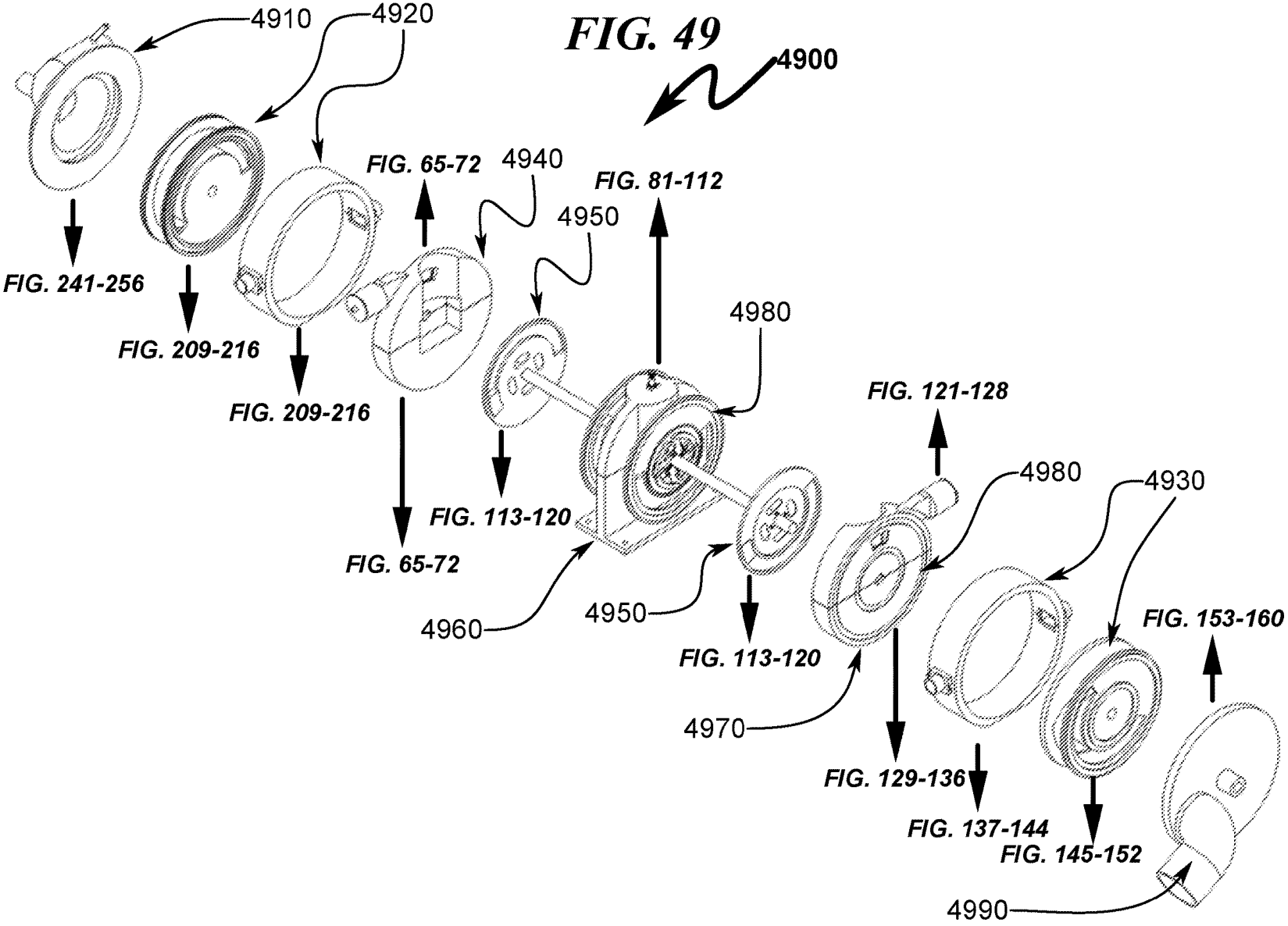
FIG. 49 illustrates a top right front perspective exploded view of a preferred exemplary enhanced invention system embodiment.
Figure 50:
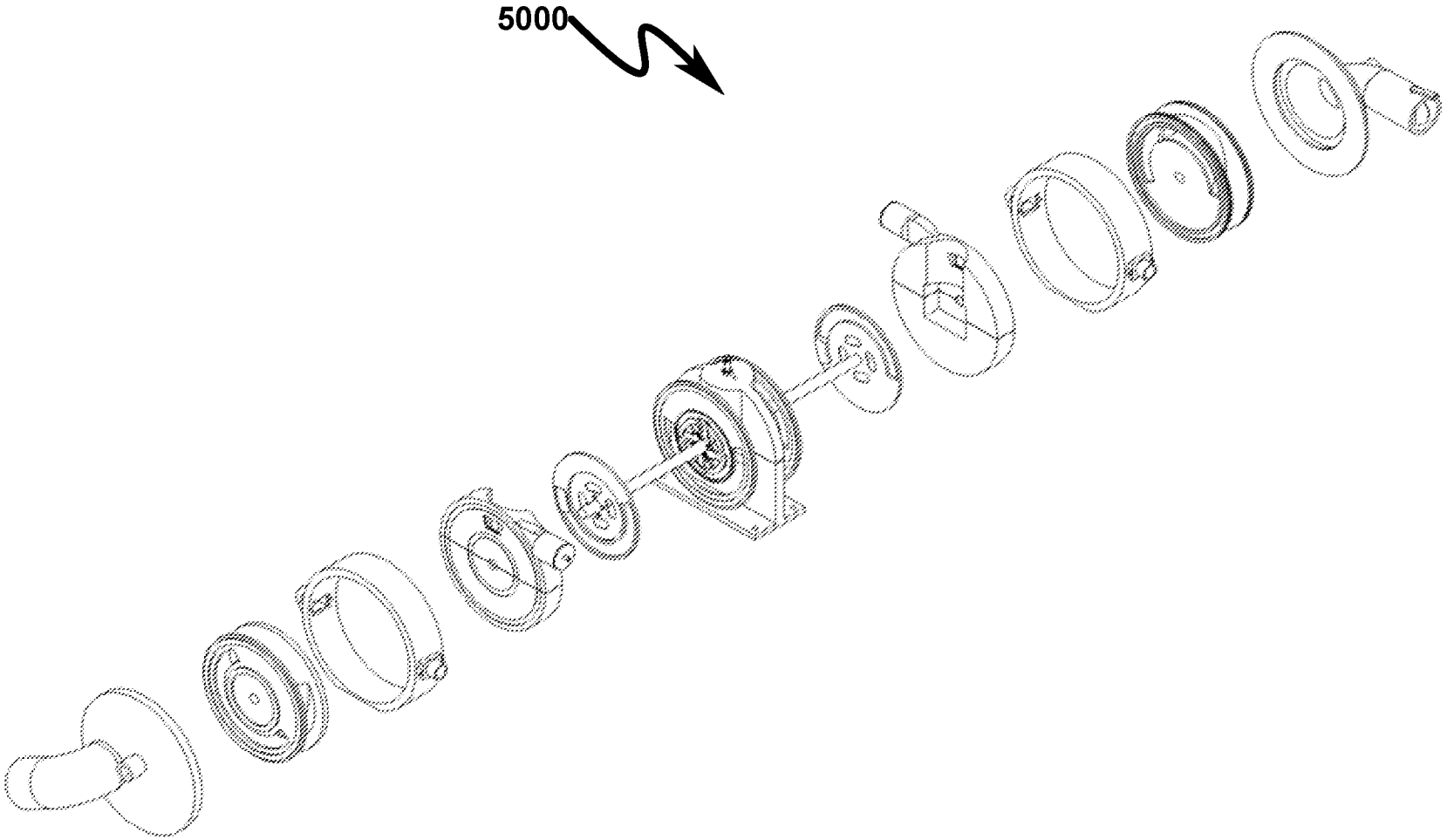
FIG. 50 illustrates a top right rear perspective exploded view of a preferred exemplary enhanced invention system embodiment.
Figure 51:
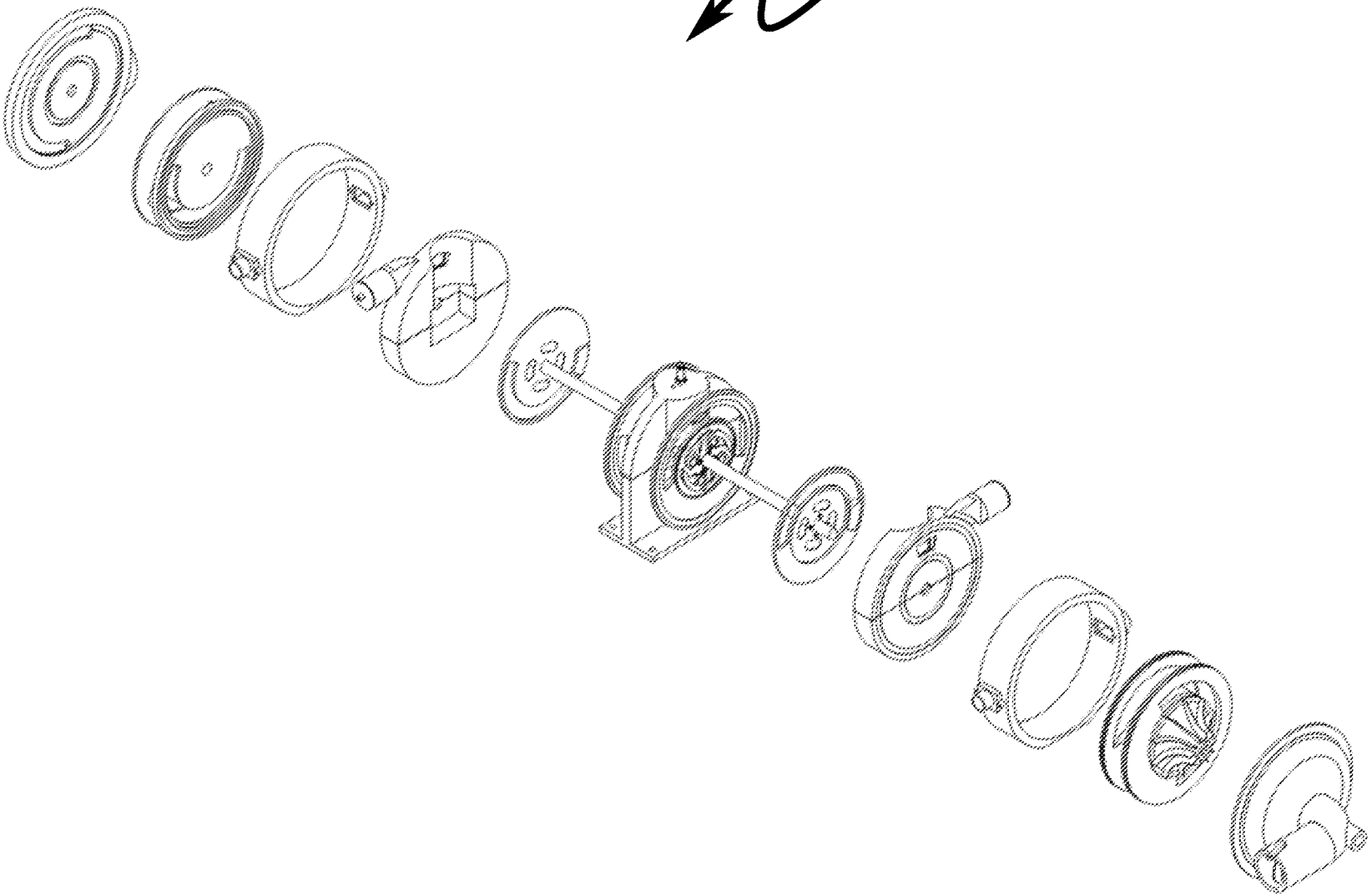
FIG. 51 illustrates a top left rear perspective exploded view of a preferred exemplary enhanced invention system embodiment.
Figure 52:
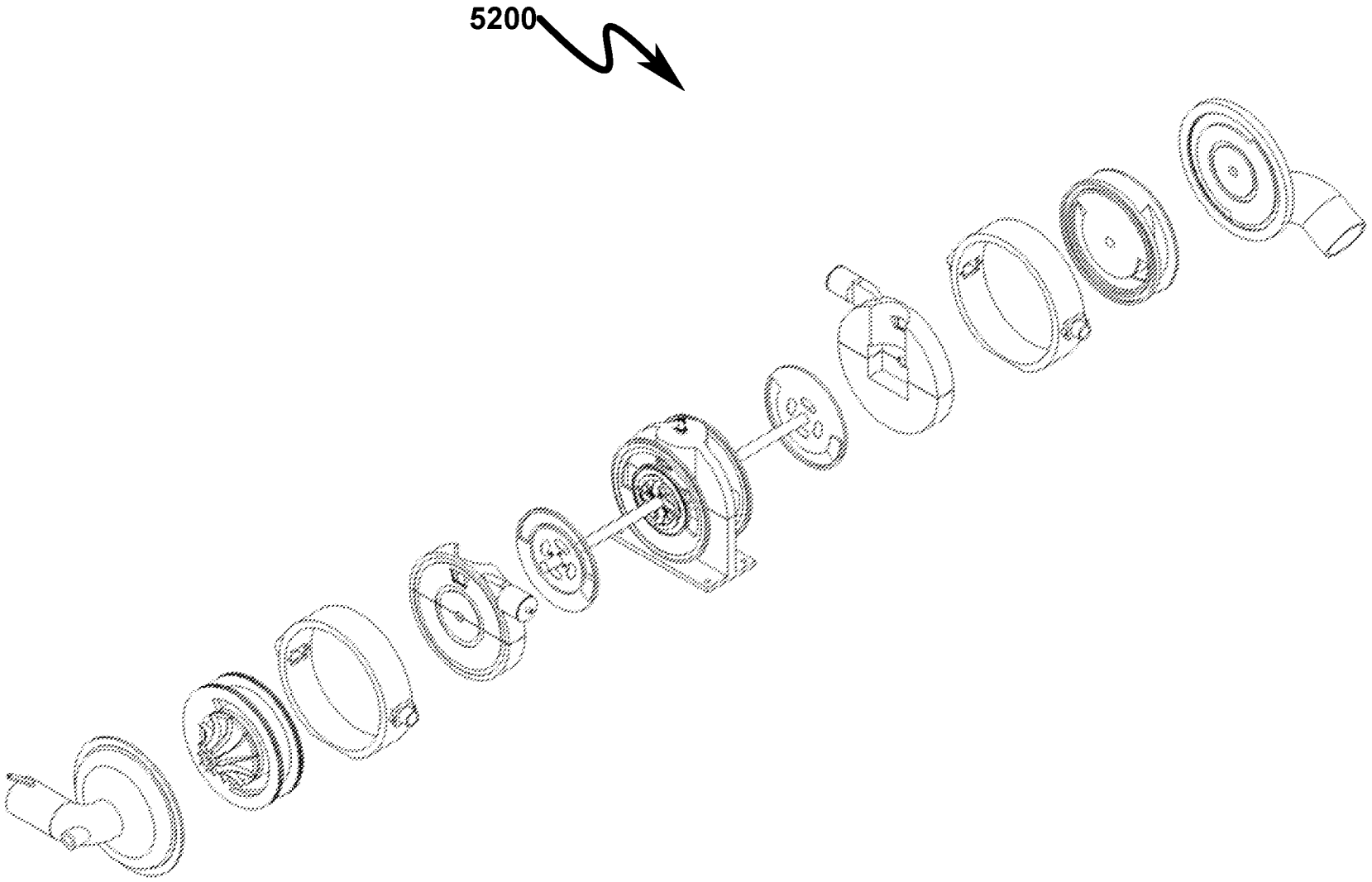
FIG. 52 illustrates a top left front perspective exploded view of a preferred exemplary enhanced invention system embodiment.
Figure 53:
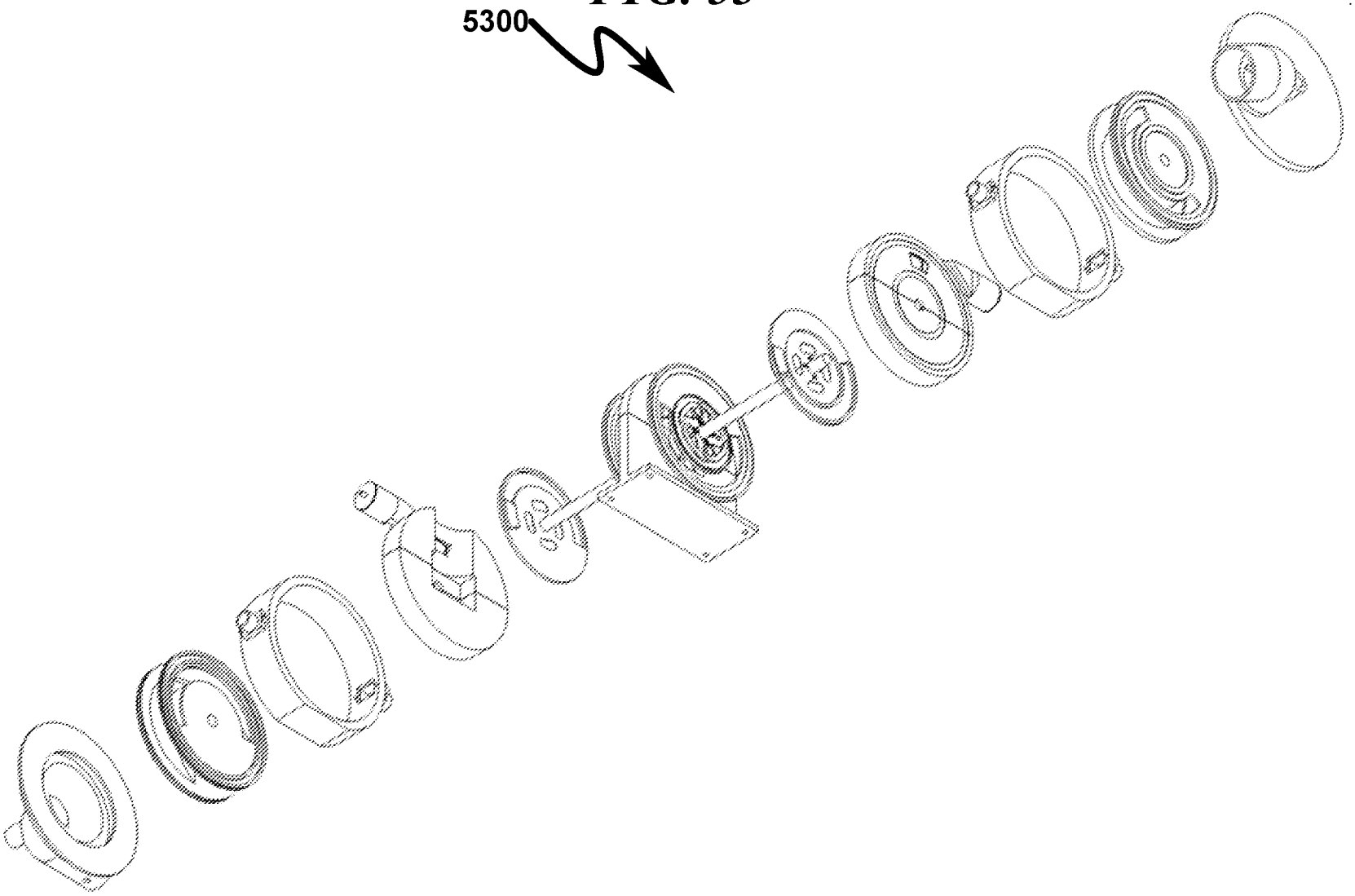
FIG. 53 illustrates a bottom right front perspective exploded view of a preferred exemplary enhanced invention system embodiment.
Figure 54:
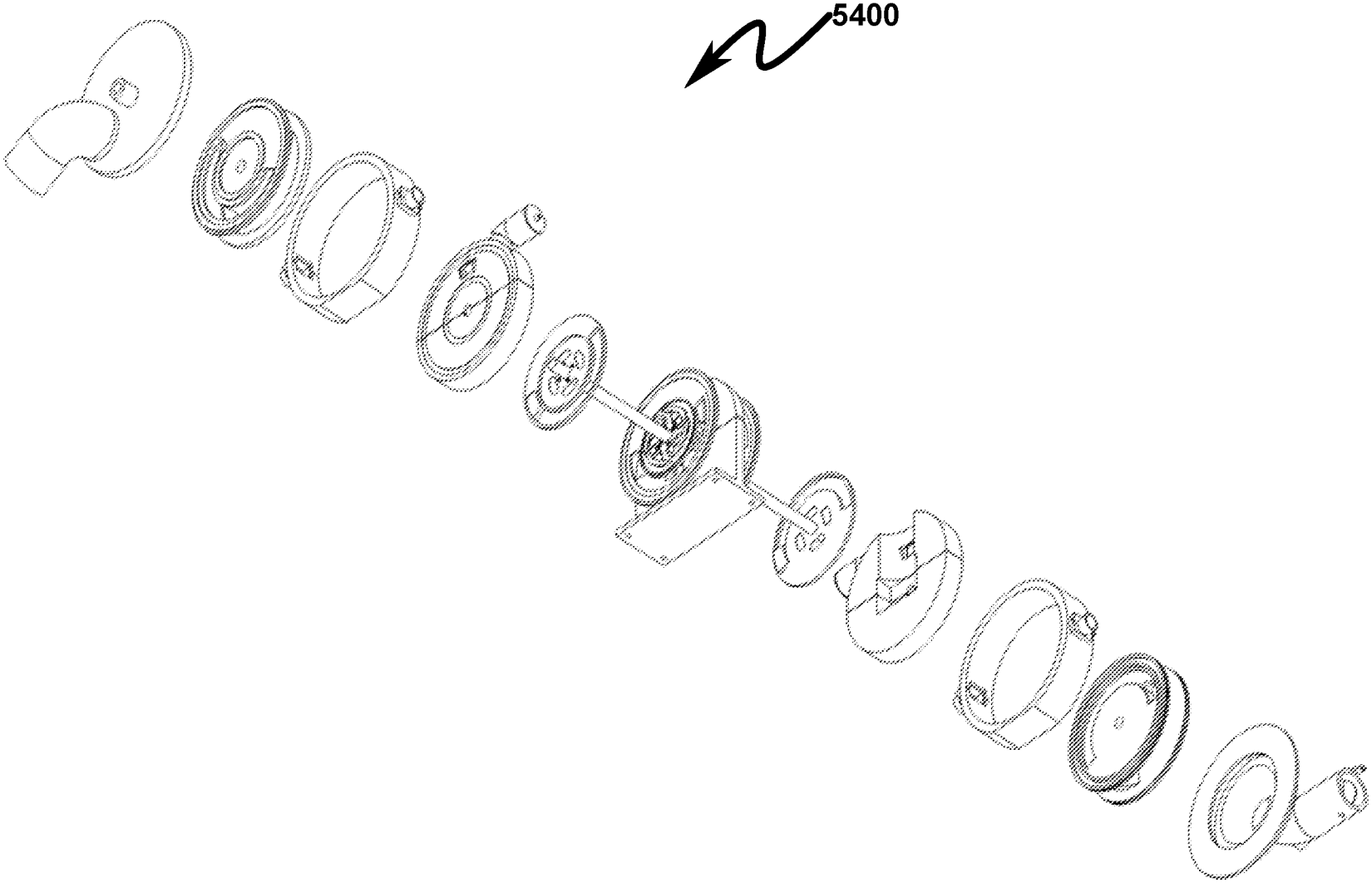
FIG. 54 illustrates a bottom right rear perspective exploded view of a preferred exemplary enhanced invention system embodiment.
Figure 55:
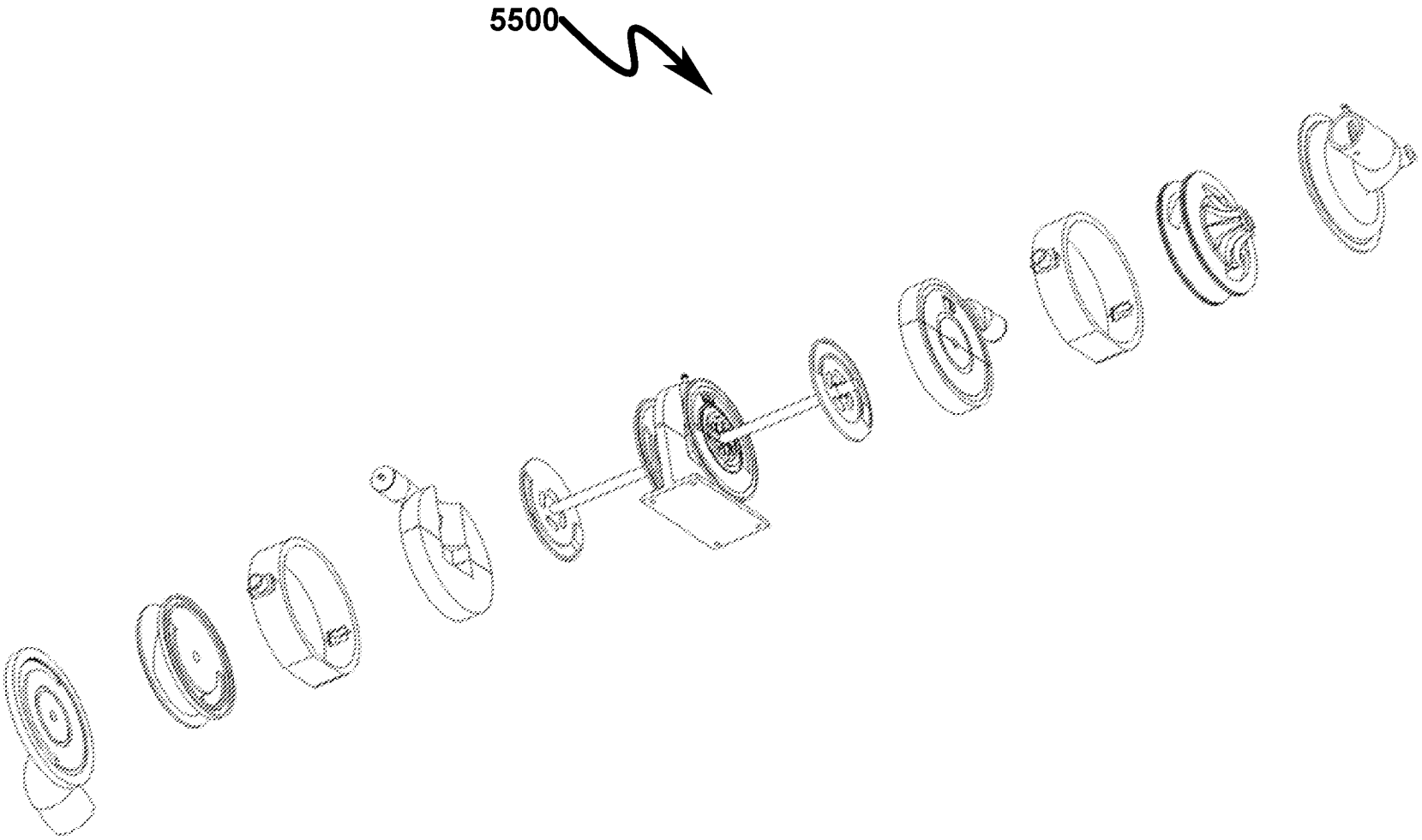
FIG. 55 illustrates a bottom left rear perspective exploded view of a preferred exemplary enhanced invention system embodiment.
Figure 56:
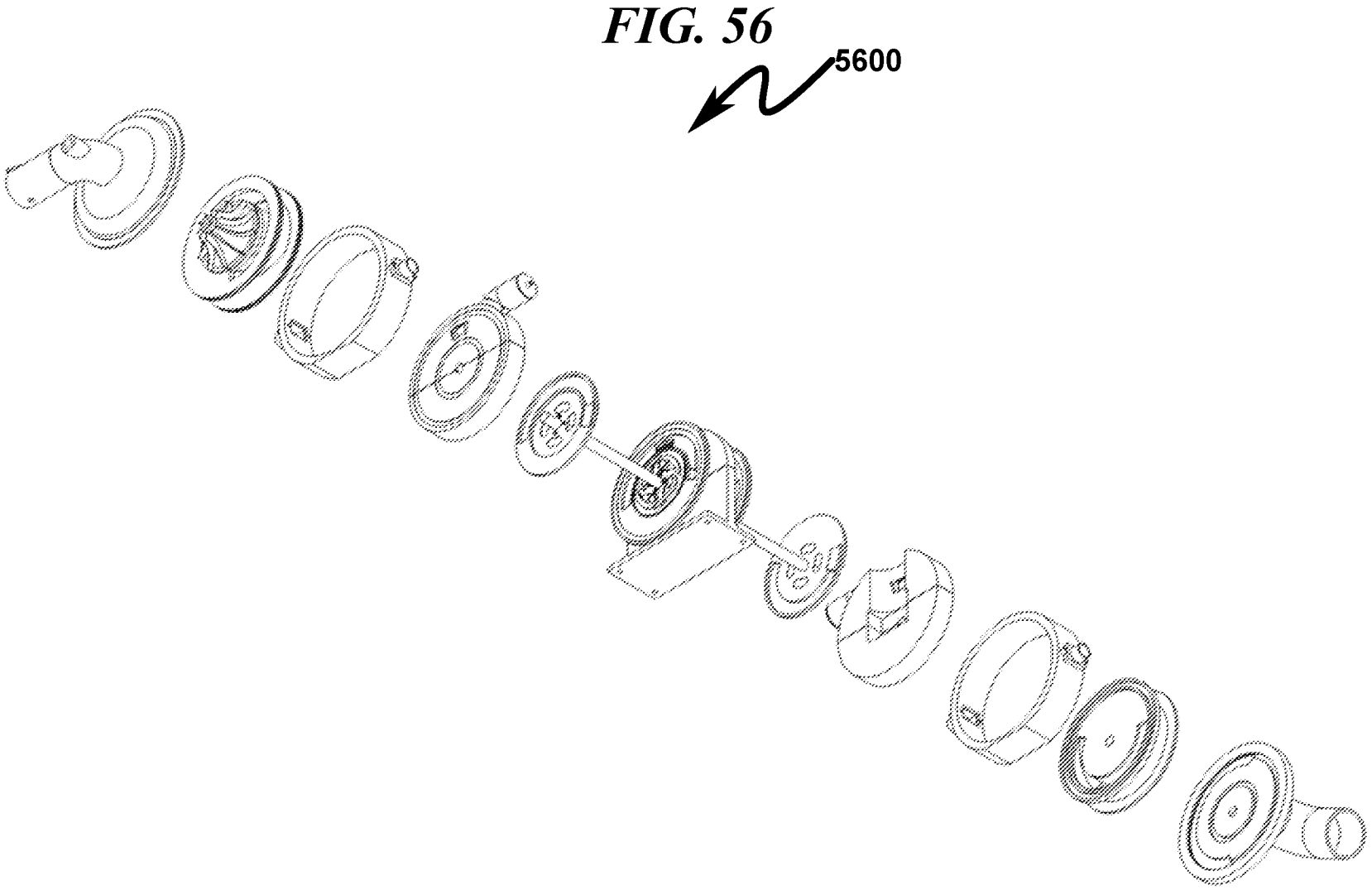
FIG. 56 illustrates a bottom left front perspective exploded view of a preferred exemplary enhanced invention system embodiment.
Figure 57:
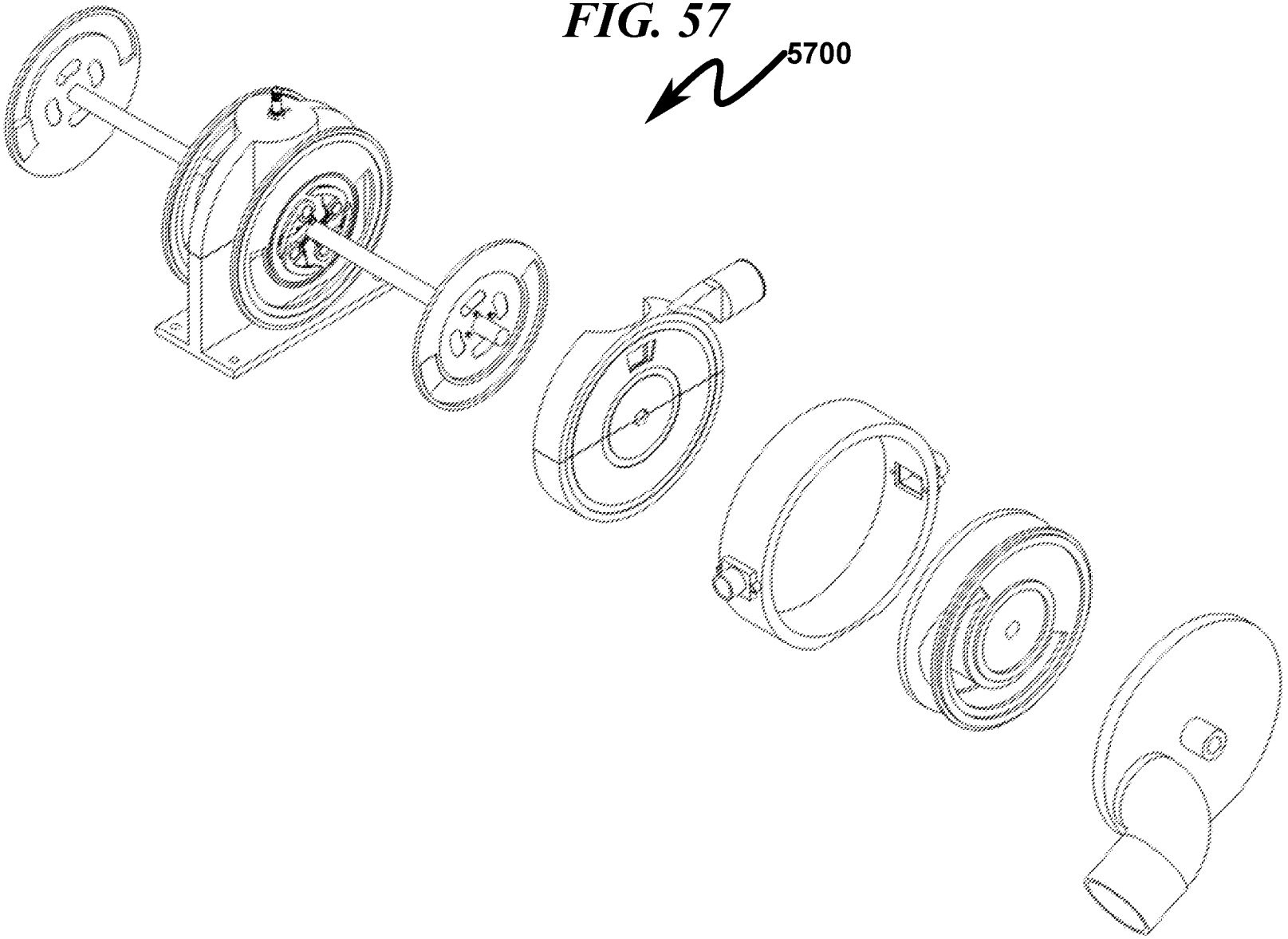
FIG. 57 illustrates a top right front perspective exploded detail view of a preferred exemplary enhanced invention system embodiment.
Figure 58:
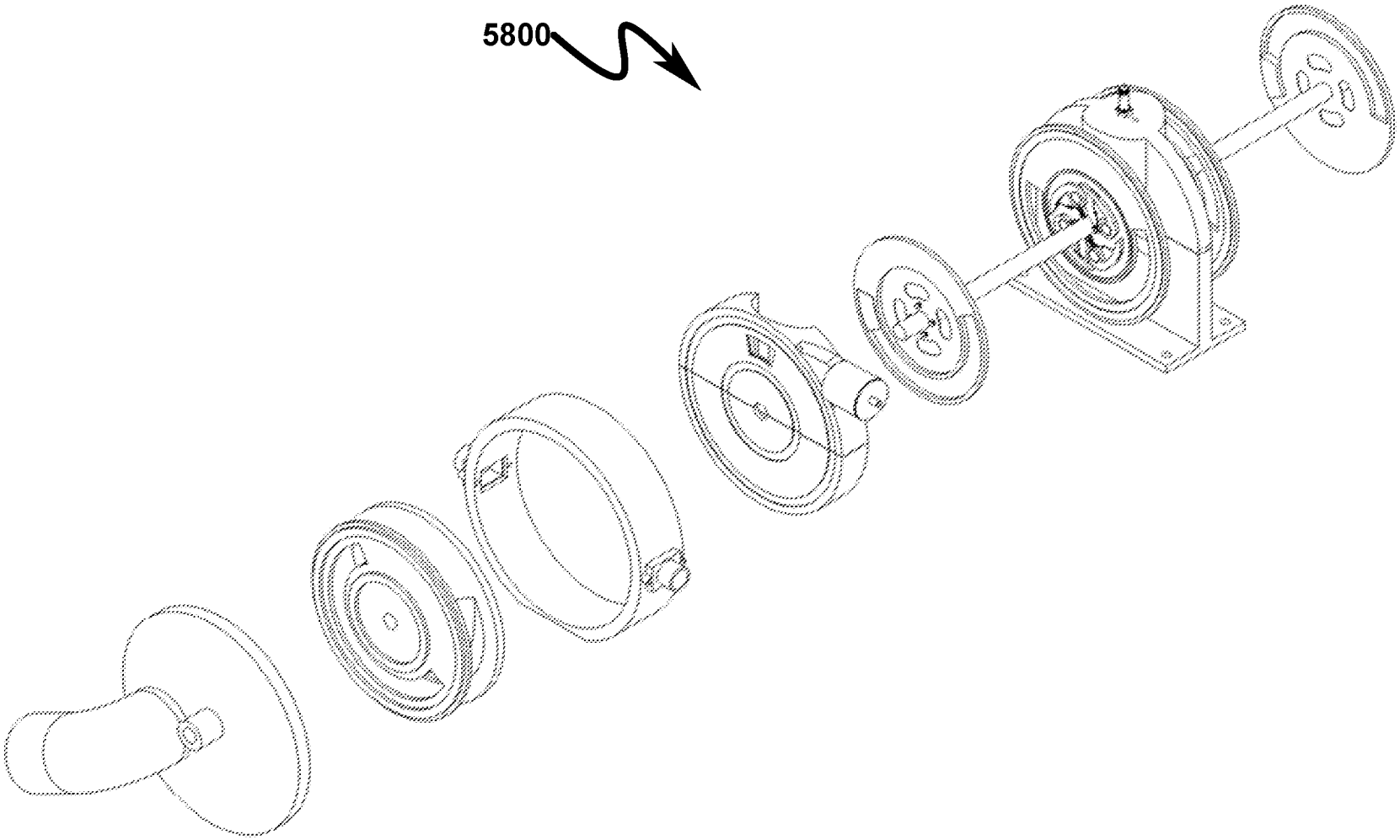
FIG. 58 illustrates a top right rear perspective exploded detail view of a preferred exemplary enhanced invention system embodiment.
Figure 59:
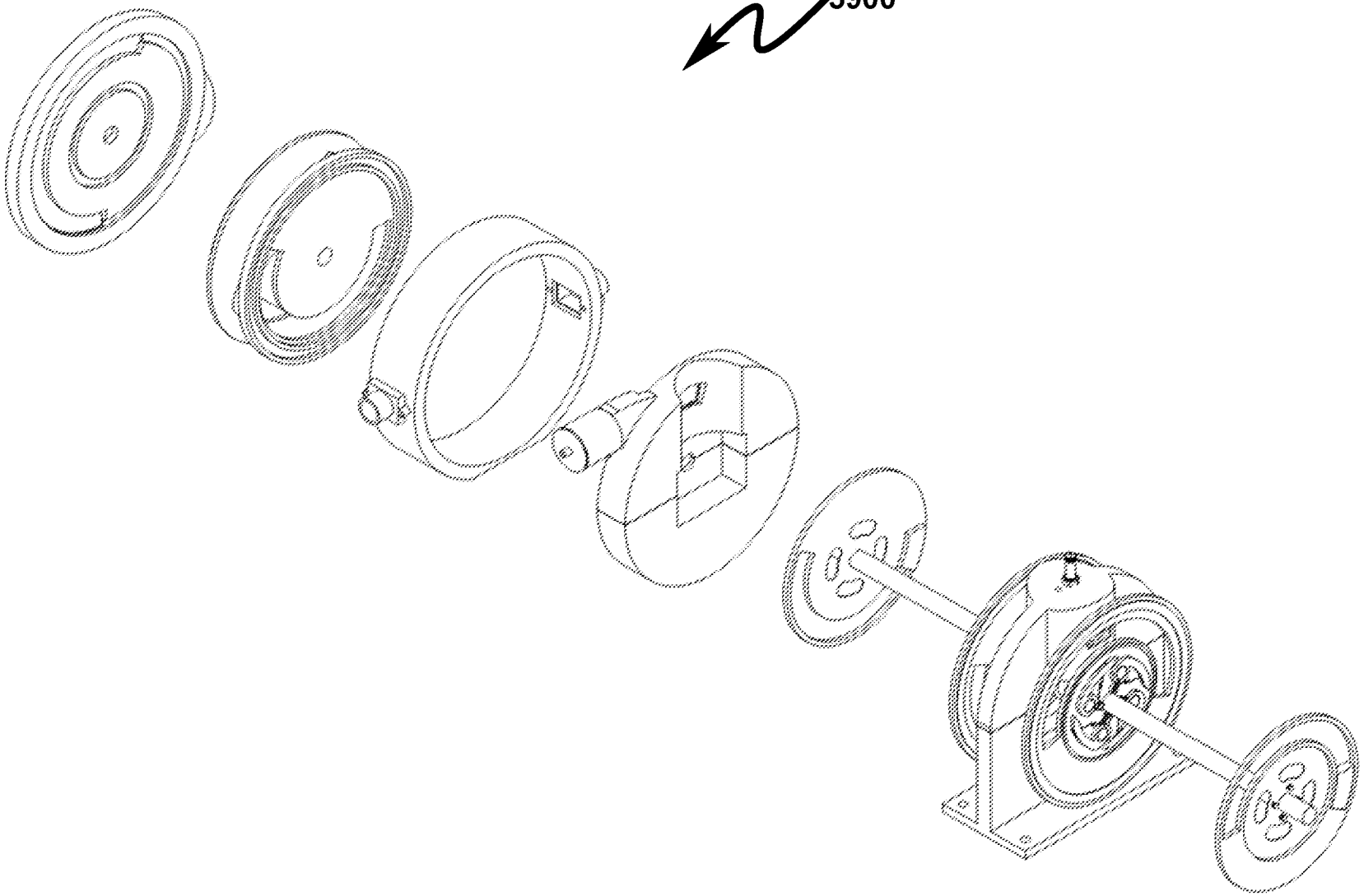
FIG. 59 illustrates a top left rear perspective exploded detail view of a preferred exemplary enhanced invention system embodiment.
Figure 60:
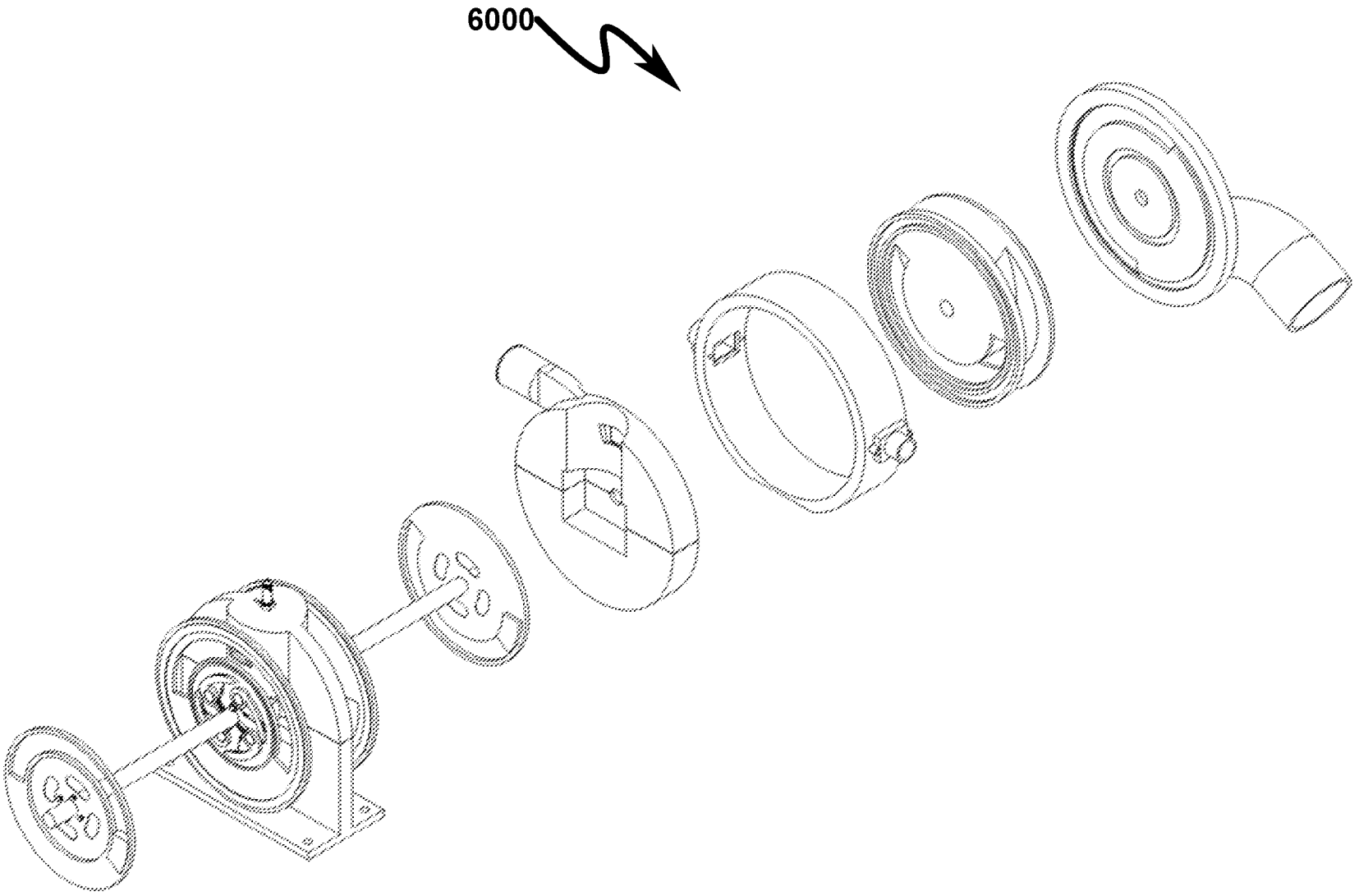
FIG. 60 illustrates a top left front perspective exploded detail view of a preferred exemplary enhanced invention system embodiment.
Figure 61:
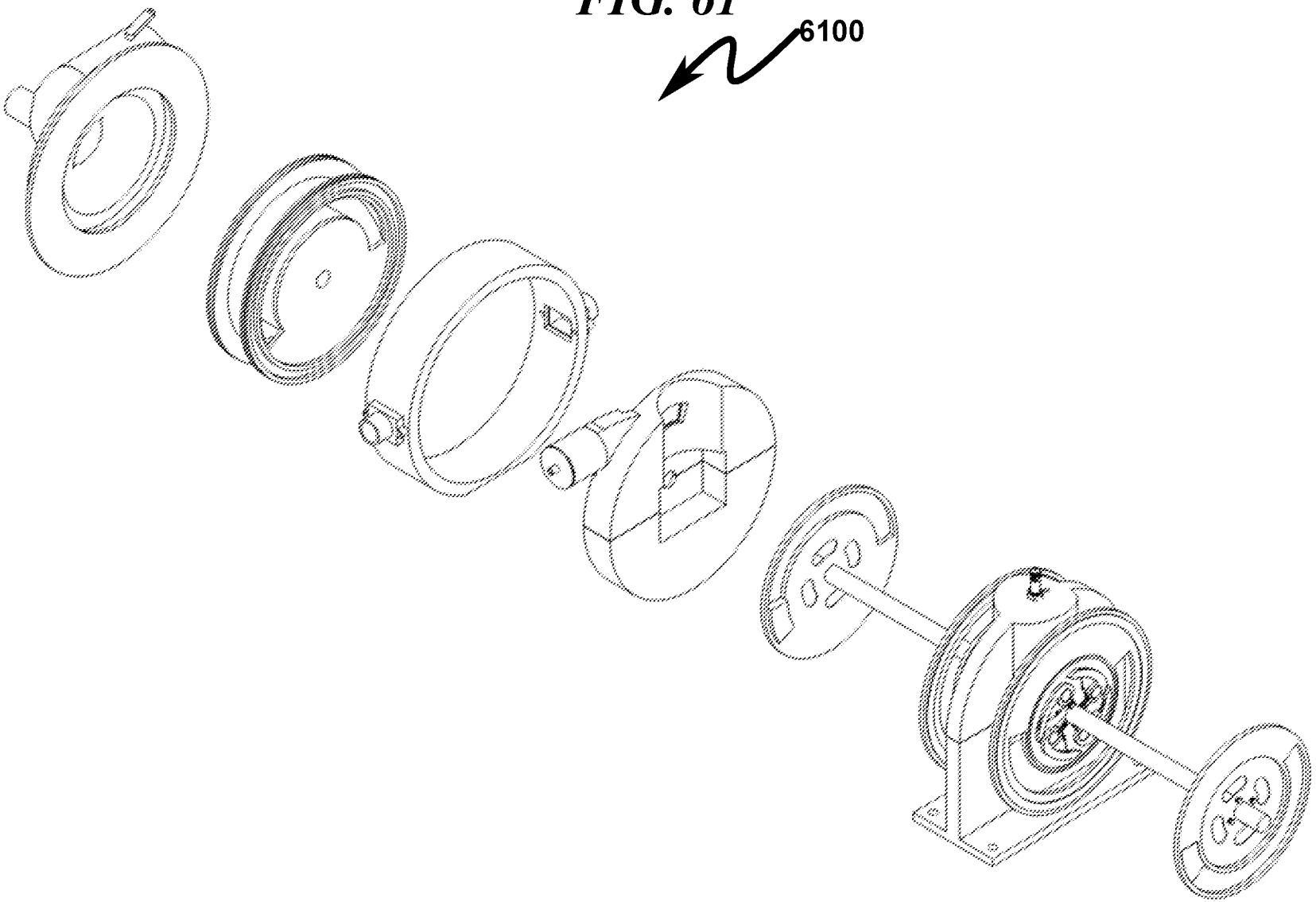
FIG. 61 illustrates a bottom right front perspective exploded detail view of a preferred exemplary enhanced invention system embodiment.
Figure 62:
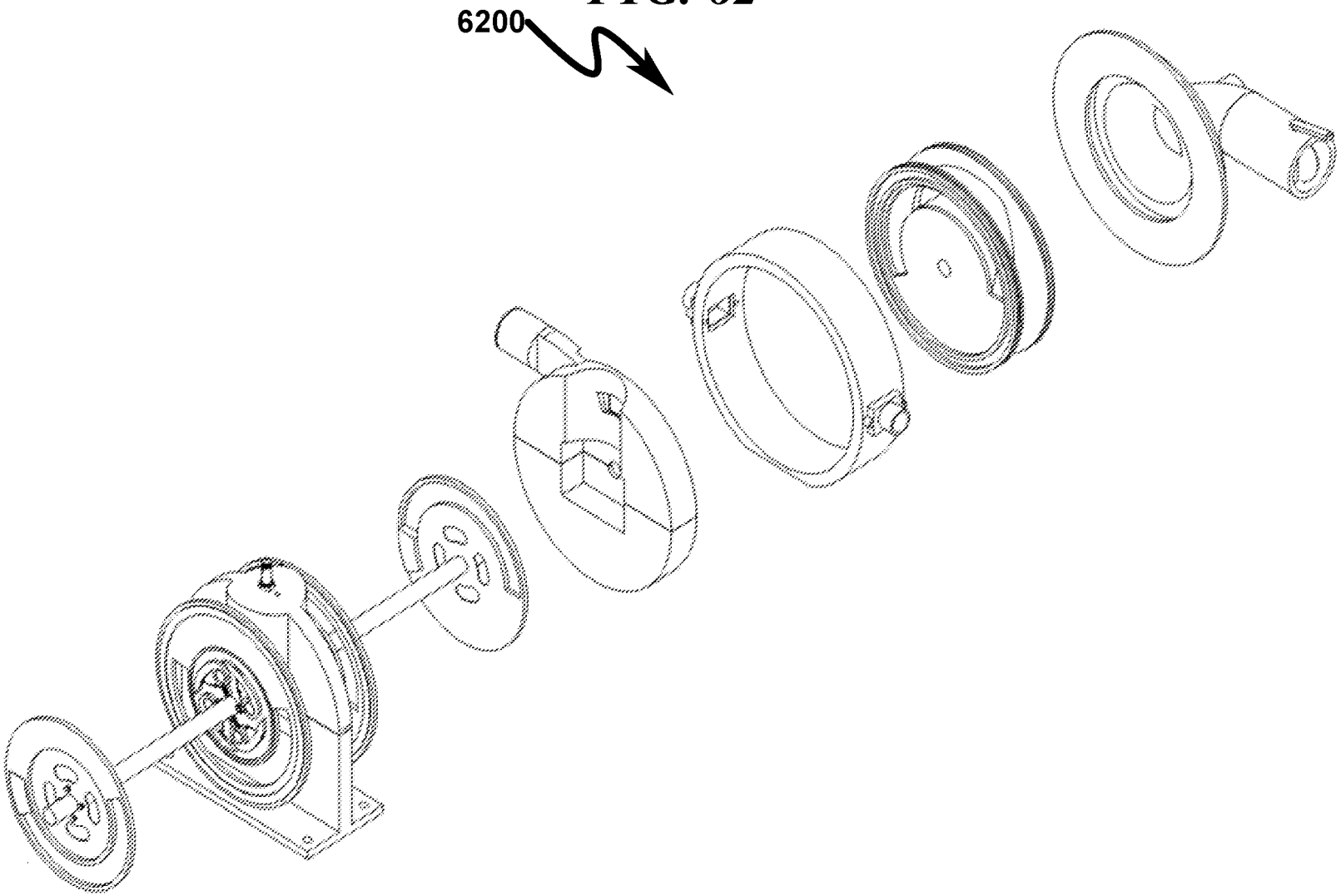
FIG. 62 illustrates a bottom right rear perspective exploded detail view of a preferred exemplary enhanced invention system embodiment.
Figure 63:
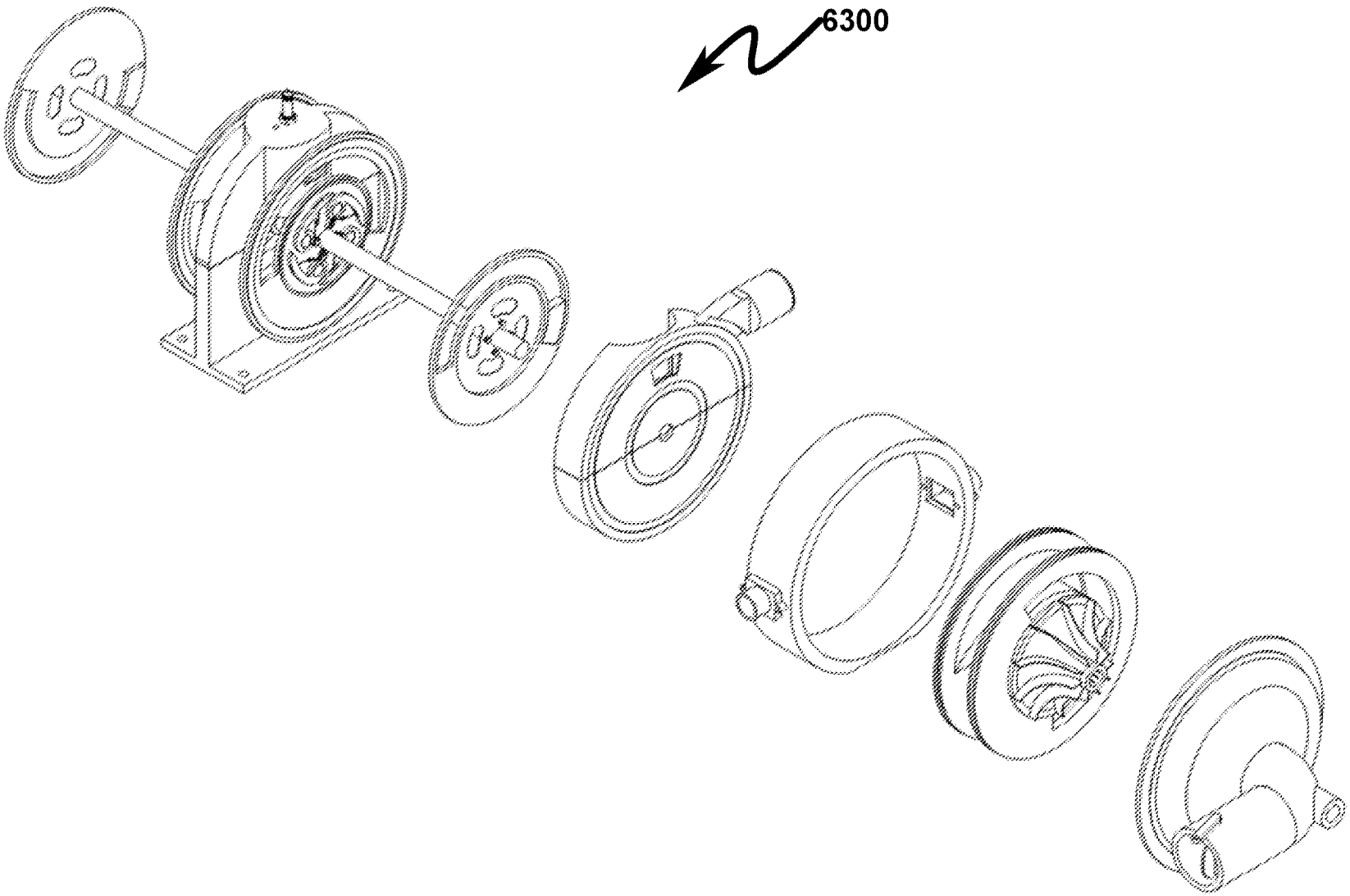
FIG. 63 illustrates a bottom left rear perspective exploded detail view of a preferred exemplary enhanced invention system embodiment.

The present invention details a rudimentary ICE embodiment as generally depicted in FIG. 17 (1700) and an enhanced ICE embodiment as generally depicted in FIG. 49 (4900). The present invention rudimentary system embodiment describes basic ICE functionality, whereas the present invention enhanced system embodiment incorporates performance enhancements that may be individually or corporately combined in a variety of fashions to improve overall ICE system performance.

The present invention enhanced system embodiments include improvements generally that comprise but are not limited to: (a) centrifugal advance; (b) cooling channel spool; and (c) forced induction embodiments.

These enhanced embodiments provide improvement to the molecular flow of gases into and out of the combustion chamber (CCH) (2964).

Centrifugal Advance

The centrifugal advance provides a change in the conical frustum angular shaped port opening of the rotary valve port (RVP) by a reciprocating widening or narrowing of the port opening as the RVD rotates in a directly proportional response to a plurality of centrifugal advance counter weights reacting to the centrifugal force inherent in the RVD's rotation. This results in the centrifugal advance counter weight pivoting on a plurality of centrifugal advance counter weight pivots, which causes a pushing or pulling effect to be exerted on the centrifugal advance plate, that is inversely proportional to the centrifugal advance spring tension, and directly proportional to the ICE's RPM.

Since it is well known to those skilled in the art that the port opening timing is a condition of the valve port open duration versus the port opening geometry, the geometry of the conical frustum angular shaped port opening of the present invention further enhances the volumetric efficiency by allowing for the specific profiling of advancing or retarding the size characteristics of its RVP's opening. The inherent geometry of the conical frustum angular shaped port opening is further enhanced by this centrifugal advance embodiment.

As exampled in the table presented herein of the Specification Estimated Volumetric RPM Limit results clearly bode out the geometrical advantage of the present invention's conical frustum angular shaped port opening over both the Poppet and Posh style valve examples.

Coupled together with this centrifugal advance embodiment, the present invention further enhances the aforementioned geometrical advantage, allowing for a stoichiometric profiling to be rendered in a continuously reciprocating platform.

Cooling Channel Spool

The cooling channel spool contributes a cooling method for wicking away unwanted heat into the ICE's coolant system where it can be recirculated through the cooling process of the cooling system's radiator.

Typically, an ICE's cooling is a component of (i) air flowing across cooling fins specifically placed around the combustion chamber and engine block, (ii) a liquid coolant that recirculates through water jackets of an ICE, (iii) the pressurized oiling system is often times "tapped" to flow through a portion of an ICE's coolant system's radiator or a separate cooling radiator specifically mounted so as to allow air flow across its air fins, as is well known to those skilled in the art.

The cooling channel spool of the present invention provides just such a cooling method where a liquid coolant flows through the center area of the "spool shaped" cooling channel spool embodiment. In concert with the water jacket the cooling channel spool provides this wicking effect of removing a substantial amount of heat thusly providing for cooling on a rotating valve element.

The present exemplary invention benefits greatly from this cooling channel spool in that the inherent heat that is generated by the normal compression and combustion of a typical ICE is better able to be dealt with a wicking effect along the walls and faces of the cooling channel spool's inherent specifically designed construction wherein the cooling channel spool allows several areas within the center of the spool and around the "channel" passageway where the molecular gas flows into and out of the combustion chamber flows.

Forced Induction

The forced induction embodiment of the present invention apprises the function of compressing gas molecules as they rotate in concert with their respective RVD component.

As is well known to those skilled in the art, centrifugal air compressors are by far the most prolific embodiment that employs the effect of compressing gas molecules in an efficient and cost effective manner.

As identified in further discussions on the present invention's RVD, the "pre-charger" characteristics and functionality of the unitization of the centrifugal impeller of the centrifugal air compressor and the spiral impeller of the cooling channel spool, both companioned together with the geometrical advantage of the conical frustum angular shaped port opening of the present invention's RVP further enhances the inherent ability of these two air compressor impellers molecular gas compressing characteristic functionalities.

These embodiments, i.e. (i) centrifugal advance, (ii) cooling channel spool and (iii) forced induction are most effective in the unitized environment provided for inherent within the exemplary invention's specifically designed methodology of providing a prolific channeling of an enhanced volumetrically efficient and effective compilation of elements such that their enhanced configurations magnify the natural aspirated flow of gas molecules into and out of the combustion chamber of the present invention.

Rudimentary System Overview (0100)

Figure 1:
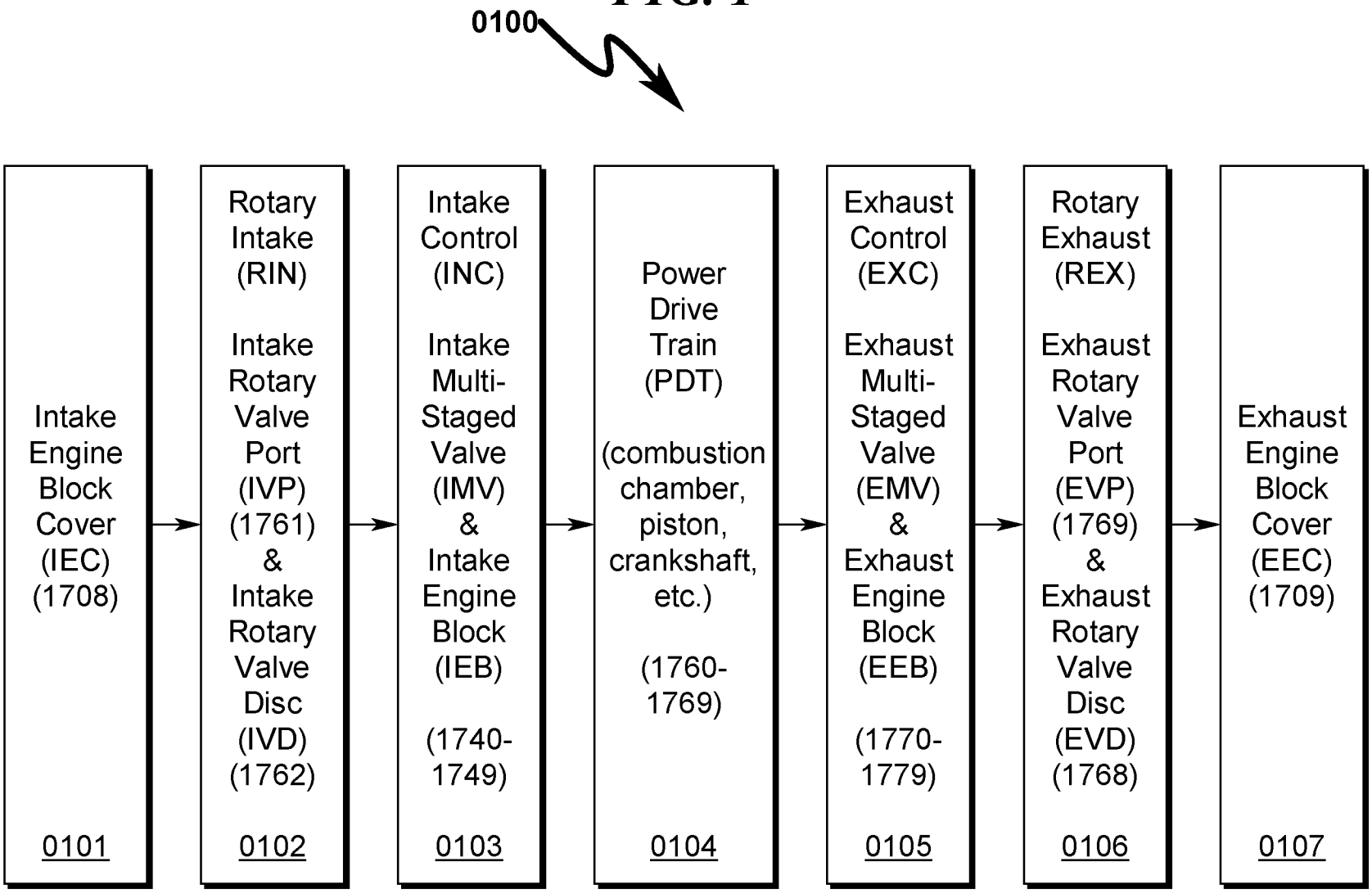
FIG. 1 illustrates a block diagram depicting a preferred rudimentary exemplary invention system embodiment.

A block diagram depicting the major system components of the present invention rudimentary embodiment is generally depicted in FIG. 1 (0100). This present invention embodiment may be constructed using a variety of combinations of the elements depicted in this block diagram. Some invention embodiments may incorporate only a portion of the elements and/or subassemblies listed in this block diagram. A brief description of these subassemblies and their related elements is provided below.

Referencing the block diagram of FIG. 1 (0100), this system comprises an intake engine block cover (IEC) (0101) and exhaust engine block cover (EEC) (0107) that enclose the remaining system components. The IEC (0101) and EEC (0107) provide side covers for the engine as well as providing intake and exhaust port runners/couplings for air/fuel into the engine and exhaust gas emission from the engine. These functions normally incorporate intake and exhaust manifolds that are well known to those skilled in the art and not depicted in this rudimentary engine configuration.

Rotary intake (RIN) (0102) takes air/fuel mixture from the IEC (0101) and via an intake rotary valve port (IVP) and intake rotary valve disc (IVD) sends the air/fuel mixture to the engine intake control (INC) (0103). Timing of the intake to the INC (0103) is accomplished using a port within the IVD. Engine intake control (INC) (0103) is accomplished using an intake multi-staged valve (IMV) and intake engine block (IEB) and modulates the air/fuel mixture to the power drive train (PDT) (0104) combustion chamber (CCH) (2964).

The PDT (0104) encompasses common engine elements such as the spark plug, fuel injector, combustion chamber (CCH) (2964), piston, crankshaft, and other power-transmission elements that are dependent on the type of engine implemented. The combustion chamber (CCH) (2964) is formed by a two-piece combination of the INC (0103) and EXC (0105).

Exhaust from the PDT (0104) combustion chamber (CCH) (2964) is delivered to the exhaust control (EXC) (0105) comprising an exhaust engine block (EEB) and exhaust rotary valve disc (EVD). Exhaust emissions are processed by a rotary exhaust (REX) (0106) that incorporates an exhaust rotary valve port (EVP) and exhaust rotary valve disc (EVD) that port exhaust gasses through the EEC.

Exhaust gasses from the exhaust control (EXC) (0106) are ported through the EEC (0107).

Enhanced System Overview (0200)

Figure 2:
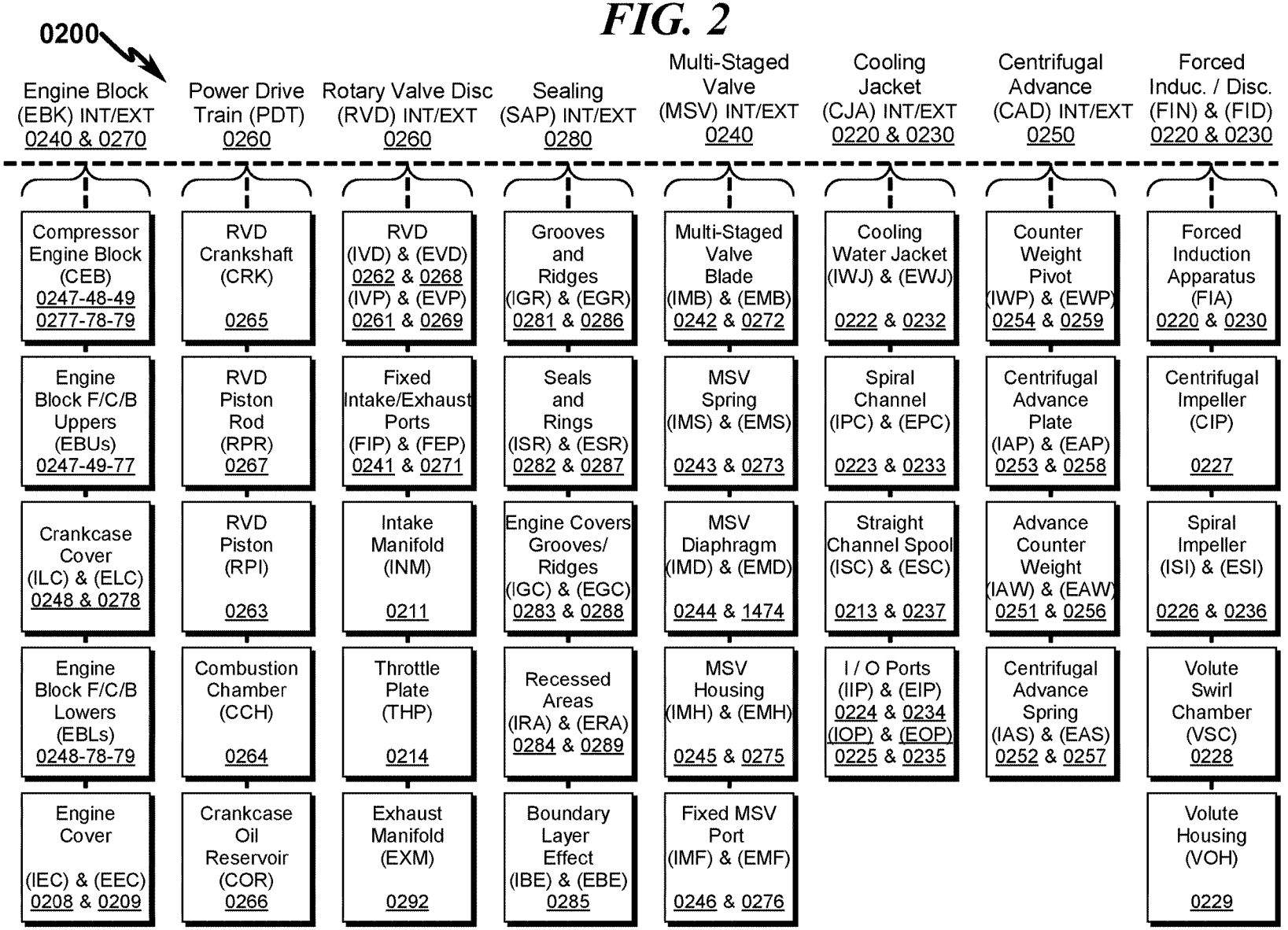
FIG. 2 illustrates a block diagram depicting a preferred enhanced exemplary invention system embodiment.

A block diagram depicting the major system components of the present invention is generally depicted in FIG. 2 (0200). The present invention may be constructed using a variety of combinations of the elements depicted in this block diagram. Some invention embodiments may incorporate only a portion of the elements and/or subassemblies listed in this block diagram. A brief description of these subassemblies and their related elements is provided below.

Please note that some components in some models may be constructed to have more than one intake RVD (IVD)/exhaust RVD (EVD), one MSV, one fixed intake port and one fixed exhaust port, etc.

Engine Block (EBK) (0210)

The EBK (0240) and (0270) subassembly provides structural support for the engine, and generally comprises a compressor engine block (CEB) Intake (0247, 0248, 0249) and Exhaust (0277, 0278, 0279), engine block front/center/back upper sections (EBUs) (0247, 0249, 0277), crankcase cover Intake (ILC) (0248) and Exhaust (ELC) (0278), and engine block front/center/back lower sections (EBLs) (0248, 0278, 0279).

Also, the system may include an engine cover Intake (IEC) (0208) and Exhaust (EEC) (0209). The Intake (IEC) (0208) and Exhaust (EEC) (0209) may be integral with the volute housing or the intake/exhaust manifolds. The EBK (0240) and (0270) has at least one fixed intake and one fixed exhaust port.

Power Drive Train (PDT) (0260)

The PDT (0260) is responsible for transmitting engine power to the load device, and generally comprises a RVD crankshaft (CRK) (0265), RVD piston rod (RPR) (0267), RVD piston (RPI) (0263), combustion chamber (CCH) (0264), and crankcase oil reservoir (COR) (0266).

The PDT (0260) may incorporate an oil pump (not shown in the drawings) or other pressurized lubrication system that are well known to those skilled in the art.

The PDT (4960) may incorporate a water/coolant pump (not shown in the drawings) or other pressurized water/coolant system that are well known to those skilled in the art.

The PDT (4960) may incorporate an oil or coolant filtration system (not shown in the drawings) or other pressurized oil or coolant filtration system that are well known to those skilled in the art.

The PDT (4960) may incorporate an additive injection system on both the intake or exhaust sides of the combustion chamber (CCH) (2964) such as water or other substance element (not shown in the drawings) or other pressurized additive injection element system that are well known to those skilled in the art.

Intake Rotary Valve Disc (IVD) (0260)

The RVD Intake (IVD) (0262) and Exhaust (EVD) (0268) coordinates the input transfer of intake gasses into the combustion chamber (CCH) (2964) and the output transfer of exhaust gasses from the combustion chamber (CCH) (2964), and generally comprises a rotary valve disc port (RVP) Intake (IVP) (0261) and Exhaust (EVP) (0269), at least one fixed intake port (FIP) (1741) and at least one fixed exhaust ports (FEP) (1771) at the combustion chamber (0264), an intake manifold (INM) (0211), at least one throttle plate (THP) (0214), and exhaust manifold (EXM) (0292).

Intake/Exhaust Sealing Apparatus (ISP/ESP) (0280)

The ISP/ESP (0280) is responsible for containing intake and exhaust gasses when and where necessary in the overall engine construction, and generally comprises precision machined and/or powder coated surfaced grooves and ridges Intake (IGR) (0281) and Exhaust (EGR) (0286), seals and rings Intake (ISR) (0282) and Exhaust (ESR) (0287), engine covers with Grooves and Ridges Intake (IGC) (0283) and Exhaust (EGC) (0288) (not illustrated), recessed areas Intake (IRA) (0284) and Exhaust (ERA) (0289), and where the boundary layer effects Intake (IBE) and Exhaust (EBE) (0285) occur (not illustrated). Typically, all of these components are precision machined and/or powder coated surfaced elements. Further disclosure of the operational characteristics of how the Sealing Apparatus is utilized in several stages throughout the valve system, are to follow below, under the headings of "Sealing Apparatus."

Intake/Exhaust Sealing Apparatus (ISP/ESP) (1780) and (4980)

In all ICEs in regular use today, there exists a need to facilitate an adequate sealing vocation wherein fluids and compression must be contained for a reasonable operational period and profile. The example provided in the present invention sealing apparatus (ISP/ESP) (1780, 4980) comprising the following five elements/concepts and is specifically adopted and designed to that end. Since the RVP Intake (IVP) (1761) and Exhaust (EVP) (1769) are a rotating element, the sealing of these components must incorporate specific types of sealing apparatus (ISP/ESP) (1780) and (4980).

Grooves and Ridges (IGR) (10781) (EGR) (10686)

In all models, it should be noted that compression sealing is achieved by the compression grooves and ridges or grooves and compression rings, and the natural tendency of the RVD's embodiments position in front of the fixed intake and fixed exhaust ports wherein a tight near interference fit is achieved between these elements, which are all powder coated with ceramic high temperature resistant materials. The grooves and ridges Intake (IGR) (10781) and Exhaust (EGR) (10686) create an initial internal compression barrier inside of the compartmentalized recessed areas Intake (IRA) (1984) and Exhaust (ERA) (2089) providing a further containment of the compression leakage which prohibits the leaking of it until the rotating valve ports (RVP) Intake (IVP) (1761) and Exhaust (EVP) (1769) rotate around to mate with the fixed intake port (FIP) (1741)/fixed exhaust ports (FEP) (1771). Compression is then compartmentalized inside of the recessed areas Intake (IRA) (1984) and Exhaust (ERA) (2089), capped off by the intake engine cover (IEC) (1708), exhaust engine cover (EEC) (1709), Intake (ENC) (4412), and Exhaust (EBC) (4291) respectively. Compression rings Intake (ISR) (24182) and Exhaust (ESR) (ND) are incorporated where practical.

Fluid Sealing Apparatus (ISP/ESP) (1780) (4980)

In all present invention embodiments it should be noted that oil and fluid sealing is achieved by using intake seals and rings (ISR) (24182) and exhaust seals and rings (ESR) (ND). These seals and rings comprise synthetic high temperature resistant intake seals (ISR) (24182) and exhaust seals (ESR) (ND) secured in place by intake grooves (IGR) (10781) and exhaust grooves (EGR) (10686) that are placed in close proximity of areas where fluids would be expected to leak. These seals and rings must be resilient and resistant to high temperatures and high pressures. The elements must retain their shape and tensile strength over the wide operation range of the ICE. The elements will have special components and configurations that will enable them to provide these sealing characteristics over a reasonable operational service life. On average, it is expected that during normal operation these seals will last 2 to 4 years and will have regular prescribed maintenance intervals, so the additional damage or wear can be avoided, if the replacement schedules are adhered to. Further field engineering test research into the sealing apparatus may yield longer operational periods between maintenance intervals.

Recessed Areas Intake (IRA) (1984) and Exhaust (ERA) (2089)

The recessed areas Intake (IRA) (1984) and Exhaust (ERA) (2089) are encapsulated around each rotating valve port (RVP) Intake (IVP) (1761) and Exhaust (EVP) (1769) element and its associative drive gear coupling cluster. The grooves and ridges Intake (IGR) (10781) and Exhaust (EGR) (10686) located inside of this area provide the initial barrier for compression control or limiting. It is expected that some amounts of compression will find its way around these barriers inside of these compartmentalized recessed areas Intake (IRA) (1984) and Exhaust (ERA) (2089). This excess or blow-by gas will be captured and recycled back into the combustion chamber (CCH) (2964) via the Positive Crankcase Ventilation (PCV) system Intake (ND) and Exhaust (ND). This system is well known to those skilled in the art and thus needs not to be depicted. The recessed areas Intake (IRA) (1984) and Exhaust (ERA) (2089) also provide a barrier for the isolation of the rotating valve port (RVP) Intake (IVP) (1761) and Exhaust (EVP) (1769) element and its associative drive gear coupling cluster in case if there are generated particulate matter or recirculating dirt/debris, and isolating it will restrict the recirculated matter which is the number one reason for premature wear in current ICEs causing operational failure. The gear cluster can be used to form a pressurized oil lubrication system that can lubricate the rotating valve port (RVP) Intake+ and Exhaust (EVP) (1769) element and its associative drive gear coupling cluster. This auxiliary oil lubrication system can have its own independent oil filtration device. This will not impact the main oil lubrication system and filtration device (N/D) resident in the ICE oil reservoir (COR) (7266).

Intake/Exhaust Engine Covers (IEC/EEC) (1708/1709) and Intake (ENC) (4412) and Exhaust (EBC) (4291)

The intake engine cover (IEC) (1708), exhaust engine cover (EEC) (1709), Intake (ENC) (4412), and Exhaust (EBC) (4291) are configured with grooves or ridges Intake (IGR) (10781) and Exhaust (EGR) (10686) similar to the ones in the outer wall of the combustion chamber (CCH) (2964). So, the sealing effect comprised within these barriers' formation is expected to arrest and or limits the leakage of compression gases. This is most critical during the combustion and power strokes of the ICE operation since the pressures of these gases are highest during these two cycles. The fixed intake port (FIP) (1741) and fixed exhaust port (1771) are designed to be the paths of least resistance to the flow of these gases once the rotary valve port (RVP) Intake (IVP) (1761) and Exhaust (EVP) (1769) is aligned with the fixed intake port (FIP) (1741) and fixed exhaust port (FEP) (1771).

Boundary Layer Effect (BLE) (ND)

The Boundary Layer Effect (BLE) may be described as follows. In physics and fluid mechanics, a boundary layer is the layer of fluid in the immediate vicinity of a bounding surface where the effects of viscosity are most significant. In other words, the liquid or gas in the boundary layer (N/D) tends to cling to the surface of both the stationary and rotating components.

In a rotating system, this "clinging to the surface" causes the fluid or gas to reside in a more centralized placement closest to the center of the rotation as the rotation occurs.

What this means is: because of the Boundary Layer Effect (BLE) (ND), the fluid or gas that is inherent in the containment areas are naturally prone to resist leaking outwardly, allowing compression past the rotating valve ports (RVP) Intake (IVP) (1761) and Exhaust (EVP) (1769) element until the mating of the fixed port Intake (FIP) (1741) and Exhaust (FEP) (1771) and the rotating port mated alignment is achieved, thereby giving the fluid or gas particles/molecules a path of least resistance whereby they can exit the containment area. This methodology is utilized on the intake and the exhaust sides of the ICE.

As mentioned earlier, compression rings Intake (ISR) (24182) and Exhaust (ESR) (ND) are incorporated where practical and since these rings are free to also rotate, some miniscule Boundary Layer Effect (BLE) (ND) is also applied to some degree in that area as well. This gives three clear methods to arrest the compression and with the incorporation of the standard ICE PCV Intake (ND) and Exhaust (ND) captures and returns an effective portion of any blow-by compression remaining in the containment areas of both the intake and exhaust sides of the ICE that lingers around after the compression or combustion cycles/strokes of the ICE.

Multi-Staged Valve (MSV) Assembly (1740) (4940) (1770) (4970)

The Multi-Staged Valve Blade Intake (IMB) (9742) and Exhaust (EMB) (9972) is responsible for throttling the cross section of the intake and exhaust fixed ports as necessary and generally comprises at least one multi-staged valve Blade Intake (IMB) (9742) and Exhaust (EMB) (9972), MSV housing Intake (IMH) (1745) and Exhaust (EMH) (1775), MSV spring Intake (IMS) (9143) and Exhaust (EMS) (9173), and MSV diaphragm Intake (IMD) (9144) and Exhaust (EMD) (9174), as well as at least one fixed multi-staged valve port per intake (IMF) (6746) or exhaust (EMF) (13176) designation. The multi-staged valve requires an intake (IMF) (6746) or exhaust (EMF) (13176) port wherein it can "pierce into" the fixed intake/exhaust ports Intake (FIP) (1741) and Exhaust (FEP) (1771) passageways to delay or limit the flow of intake gasses into the combustion chamber (CCH) (2964) and the output transfer of exhaust gasses from the combustion chamber (CCH) (2964).

Cooling Jacket Apparatus (CJA) (1720) (4920) (1730) (4930)

The CJA (1720) (4920) (1730) (4930) is responsible for providing a necessary degree of engine cooling and generally comprises a cooling water jacket Intake (IWJ) (14022) and Exhaust (EWJ) (14132), spiral channel Intake (IPC) (10023) and Exhaust (EPC) (9833), straight channel Exhaust (ESC) (ND), inlet/outlet ports Intake Inlet (IIP) (14024)/ Intake Outlet (IOP) (14025) and Exhaust Inlet (EIP) (14134)/Exhaust Outlet (EOP) (14135), and at least one coolant pump assisting blade element surrounding the center section of each straight or spiral channel element.

The spiral channel Intake (IPC) (10023) and Exhaust (EPC) (9833) will be more widely used on most models due to its inherent additional cooling ability and is used in both the exhaust and intake applications, while the straight channel Exhaust (ESC) (ND) is primarily used in the exhaust applications and can also be used in intake applications where the additional cooling ability of the spiral channel Intake (IPC) (10023) and Exhaust (EPC) (9833) isn't required.

Centrifugal Advance (CAD) (4950)

The CAD (4950) is responsible for advancing the overall engine rotary valve disc's (RVD) Intake (IVD) (1762) and Exhaust (EVD) (1768) port (RVP) Intake (IVP) (1761) and Exhaust (EVP) (1769) "opening duration's" timing advance or retard based on the engine RPM and generally comprises a centrifugal advance cover Intake (IAC) and centrifugal advance cover Exhaust (EAC) (ND), centrifugal advance plate Intake (IAP) (7653) and Exhaust (EAP) (11658), centrifugal advance counterweight Intake (IAN) (10751) and Exhaust (EAW) (10656), and centrifugal advance springs Intake (IAS) (10752) and Exhaust (EAS) (10657).

The advance or retard of the rotary valve disc port is dependent on whether the centrifugal advance counterweights Intake (IAN) (10751) and Exhaust (EAW) (10656) are pushing or pulling the centrifugal advance plate Intake (IAP) (7653) and Exhaust (EAP) (11658). An ICE can start its idle either advanced or retarded in coordination with the desired operational profile. The present invention anticipates at least one centrifugal advance (CAD) (4950) per rotary valve disc port (RVP) Intake (IVP) (1761) and Exhaust (EVP) (1769) in most configurations.

Intake Forced Induction Apparatus (FIN) (4920) and Exhaust Forced Discharge Apparatus (FID) (4930)

The FIN (4920) and FID (4930) are responsible for providing a pre-charging boost to the overall engine and generally comprises a intake forced induction apparatus (FIN) (4920) and exhaust forced discharge (FID) (4930), centrifugal impeller (CIP) (8927) (Intake only), spiral impeller Intake (ISI) (9026) (Intake only) and Exhaust (ESI) (8936), volute swirl chamber (VSC) (24128) (Intake only) and volute housing (VOH) (24929) (Intake only).

It should be noted that the outlet of the air compressor is redirected around or through the centrifugal impeller wheel of some models. There is only a to the normal pressure rise due to the redirect through the impeller wheel, which can easily be overcome by increasing the size of the impeller and the volute swirl chamber. If this feature is given a name that name would be "Pre-Charger," this is because it is only expected to deliver atmospheric or slightly above atmospheric pressure at wide open throttle RPMs. CFD analysis has indicated a 1 PSI to 4.5 PSI boost in ideal conditions. Actual results for an individual prototype may vary. This feature may be added to compensate for the inherent problem that all ICEs exhibit at wide open throttle where the mechanical interference of the ICE's natural aspiration process limits the flow of air molecules, into and out of the combustion chamber. At low RPMs this factor is virtually inert, however at high RPMs this factor has been termed as "Starving the ICE for air" because the mechanical elements inherent inside of the ICE create friction against the flow of air molecules and slow them down greatly. It is expected that the present invention as implemented in a typical ICE will have an upper RPM limit of 25,000 RPM to 30,000 RPM due to all of its designed enhanced elements. However, this is not a limitation on the claim scope of the present invention.

Further disclosure of the operational characteristics of how forced induction is utilized in several stages throughout the valve system is to follow below, under the headings of "Molecular Airflow through engine Intake and Exhaust."

The Forced Induction—in a closed system forces add or combine together, resulting in the maximum possible achievable system pressure.

The intake forced induction (FIN) (4920) and exhaust forced discharge (4930) are achieved through the incorporation of a centrifugal impeller (CIP) (8927) and spiral impeller Intake (ISI) (9026) and Exhaust (ESI) (8936). These impellers are molded or unitized into the elements where they are deployed, thus providing for a mechanical advantage counteracting the inherent losses known to those skilled in the art due to the distance between the impeller and the combustion chamber (CCH) (2964). The centrifugal impeller generates high pressure and low velocity as a final by-product of its operation, such that once the alignment of the fixed port and the rotating port is accomplished, this pressure is funneled into the combustion chamber (CCH) (2964) along with the inherent vacuum activated pull on gas molecules initiated by the piston (RPI) (2563) in its downwards reciprocation towards the Bottom Top Dead Centre.

First, the centrifugal impeller (CIP) (8927) is unitized either by being molded or bolted to the rotary valve disc Intake (IVD) (1762) element in such a fashion as to cause the rotational reaction of the impeller blades and the rotation of the RVD Intake (IVD) (1762) to exert a force on the mass of the air molecules. This creates a pushing or pulling force that makes the molecules move in the prescribed direction of the centrifugal impeller (CIP) (8927).

Second, the Spiral Channel's spiral impeller (ISI) Intake (9026) and Exhaust (ESI) (8936) that is also unitized either by being molded into the "Spool" shaped section of the cooling channel spool Intake (ICS) (10021) and Exhaust (ESC) (10031) applies a similar force to the rotational reaction of this impeller and also exerts a force on the mass of the air molecules in a similar fashion to further assist the flow of air molecules along the path to the combustion chamber (CCH) (2964).

These three forces i.e. (i) the engine vacuum, (ii) the spiral impeller Intake (ISI) (9026) and Exhaust (ESI) (8936), and (iii) the centrifugal impeller (CIP) (8927) add or combine and once the RVP Intake (IVP) (1761) and Exhaust (EVP) (1769) and the fixed intake port Intake (FIP) (1741) are aligned and the intake stroke begins, all three forces act to more effectively and volumetrically efficiently fuel the combustion chamber (CCH) (2964) with gas molecules.

Third, the opening of the RVP can host/have slight slants or indentions that react similarly to the rotational characteristics of a fan blade and exert a force on the air molecules as well as the "Tuned" length of the RVP elements can influence the induction of air molecules.

Flipping the spiral impellers Intake (ISI) (9026) and Exhaust (ESI) (8936) around to operate in a counter rotational (clockwise/counter-clockwise) disposition, can assist in the exhausting of spent combusted gases out of the combustion chamber (CCH) (2964). Only the spiral impeller Intake (ISI) (9026) and Exhaust (ESI) (8936) can be used in this fashion on the exhaust since the high heat of the compression of gases increases temperature and would cause premature failures if centrifugal impellers (CIP) (8927) were attempted to be used on the exhaust side of the ICE. These spiral impellers Intake (ISI) (9026) and Exhaust (ESI) (8936) can be attached to the input of the RVD Intake (IVD) (1762) and Exhaust (EVD) (1768) or integral to the (RVC) (N/D).

The only depictions used are the examples where centrifugal or spiral impellers are used on the RVD.

Albeit that this configuration is not nearly as effective as the ones earlier discussed, they do still provide some forced induction capability at high RPM wide open throttle operation.

It is the high RPM operation where ICEs tend to starve for air due to the inherent mechanical interference of the internal parts of an ICE creating a massive amount of friction as the air molecules attempt to flow. This feature could be used to enhance the operations of small engines where this simple modification could facilitate enhancing its operational capability.

Of course, there is also the premise of incorporating a transmission to drive these centrifugal impellers at higher speeds thus delivering a higher boosted molecular air pressure. The present invention does not intend to provide a full supercharger and makes no attempt at configuring a turbocharger. However these ICEs just as others can be configured with after-market superchargers/turbochargers, the present invention's configuration is at best a "pre-charger" for the specific purpose of overcoming the inherent mechanical interference of ICEs in general.

Molecular Airflow Profile

The Molecular Airflow Profile starts at the intake manifold (INM) (4411).

The present invention is able to use both popular intake manifold styles common to the ICE industry i.e., (i) the "High Rise" or "Low Rise" manifold or commonly referred to as a typical "Dual Plane" manifold. This Dual Plane manifold offers greater high RPM performance as it offers less resistance to the flow of air molecules. And (ii) the classic "Tunnel Ram" manifold which offers greater torque off the line. While no distinction was made for either one of these styles and a basic and simple configuration is depicted as they are both well known to those skilled in the art and are readily adaptable to common ICE applications, the present invention does not claim its novelty.

Subsequently, the molecular air flow is taken into consideration greatly when the choice of which elements were to comprise the example of the present invention.

Whether it is a four or two stroke, certain specific functions must be accomplished and adhered to as is typical of any ICE the required ICE performing the reciprocating cycle elements of the regiment i.e., (i) intake; (ii) compression (iii); power (iv) exhaust; and then repeat as is depicted in the typical reciprocated ICE timing profile.

The 2-stroke profile combines the intake and compression functions together as well as combining the power and exhaust strokes in just two of the corresponding reciprocated strokes of the ICE's piston (RPI) (2563) and crankshaft (CRK) (1765) assembly. Whereas the 4-stroke profile leaves each stroke to the four corresponding reciprocated strokes of the ICE's piston (RPI) (2563) and crankshaft (CRK) (1765) assembly. There are more than the 2 and 4 stroke configurations that the present invention is adaptable to but are not depicted herein. Such as a double expansion secondary cylinder that is added as an expansion processor to extract more energy from the fuel.

Bearings and/or Bushings

While not explicitly depicted in the drawings, the present invention may incorporate a number of bearings and/or bushings in the design. These elements are well known to those skilled in the art and will not be detailed herein. However, a brief description of their operation in this context follows below.

Bushings or bearings occur wherever there are two surfaces that meet to form an axle and axle shaft configuration or that there exists a condition wherein a positional/endplay regiment is required. Although they are not shown in the drawings, they are well known requirements in the industry.

In the disclosed configuration the first significant application of bearings would be on the RVD crankshaft (CRK) (1765). It should be noted that the output shafts of the crankshaft (CRK) (1765) are somewhat longer than that of the standard applicate. This is to ensure the crankshaft's ability to reach each subsequent enhancement's feature stage of the present invention and still be able to allow the output shaft a useful connectivity range. It should be noted that the enhancement features, i.e. (i) Cooling (CJA), (ii) Centrifugal Advance (CAD) and (iii) Forced Induction (FIN) obviously can be combined in some fashion so as to unitize the operational performance and compact them together in a more functional space. In the depiction of this invention, an elaboration exploding them out to a large size was done to affect clarity and understanding of the inherent concepts. Because of this factor, bearings or bushings would be required to maintain the balanced regiment of the crankshaft and to control unwanted endplay. These bearings or bushings that control the crankshafts endplay are common and well known to those skilled in the industry.

The incorporation of pressurized oil lubricated roller bearings are used in areas where specific placement and balancing are regimented. Such placement areas on the present invention configuration are every component where the output shaft passes through that is also given the task of specific positional placement of the output shaft in such a fashion as "not" to allow unwanted endplay due to the longer span of said output shaft.

Some of the critical bearings and bushings locations are:

- the RVD axle shaft
- the upper and lower sections of the engine block which form the main journals of the engine block
- the Cooling Channel Spool spiral/straight channeled "Spool" components which form additional main journals
- the outer engine covers where there also must be a seal to retain the lubrication oils within the engine's crankcase casings Dependent upon the size of the application, a functional profile can be easily realized. The larger the size that an ICE is, the more the use of pressurized oil lubricated roller bearings. Transversely, the smaller the size of an ICE is, the more the use of bushings rather than the use of pressurized oil lubricated roller bearings.

It should also be easily recognized that the pressurized oil lubrication system also contributes to the overall cooling of the ICE. In common applications it is found that the pressurized oil lubrication system accounts for 20% to 30% of the cooling regiment in ICEs. This is why in some applications the pressurized oil lubrication system is tapped and an "Oil Cooler" is added to the cooling system's radiator or a separate oil cooling radiator is added to facilitate the required profiled level of cooling as is well known to those skilled in the art.

In smaller ICE applications, bushings are more commonly used due to the fact that there is less endplay because of the smaller and lighter parts than the greater mass of larger ICEs.

The surfaces of components which form the main journals in the present invention smaller size ICE can be machined to provide adequate bearing surfaces for these smaller ICEs.

Since many of the components of the present invention may be unitized together as one component, the placement of the main journal placements may vary based on the configuration of each model depicted herein.

Rudimentary Engine Assembled/Assembly Detail (0300)-(3200)

Assembled Views (0300)-(1600)

Figure 16:
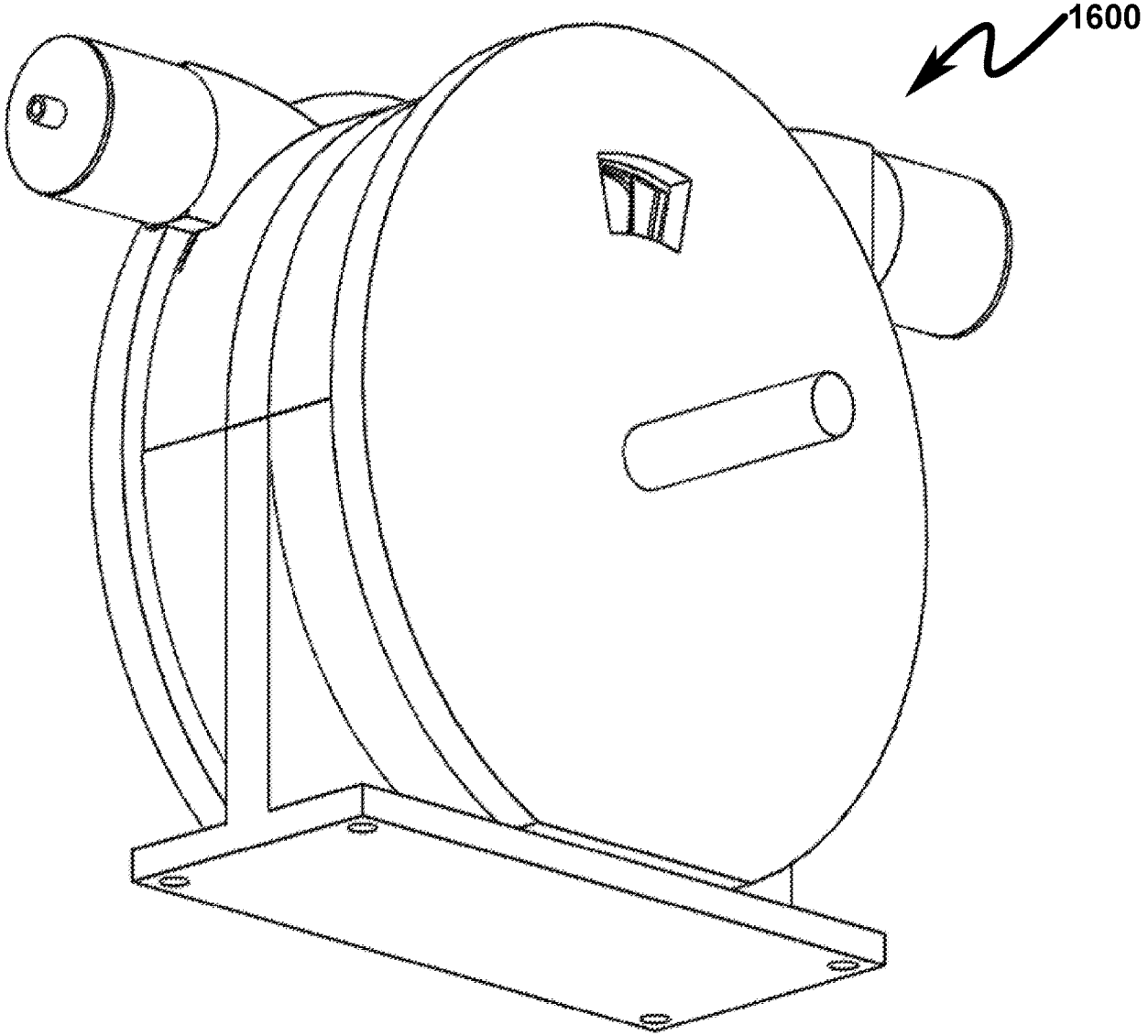
FIG. 16 illustrates a bottom left front perspective view of a preferred exemplary rudimentary invention system embodiment.

The present invention as embodied in rudimentary form is generally depicted in assembled views in FIG. 3 (0300)-FIG. 16 (1600).

Assembly Exploded Views (1700)-(3200)

Figure 32:
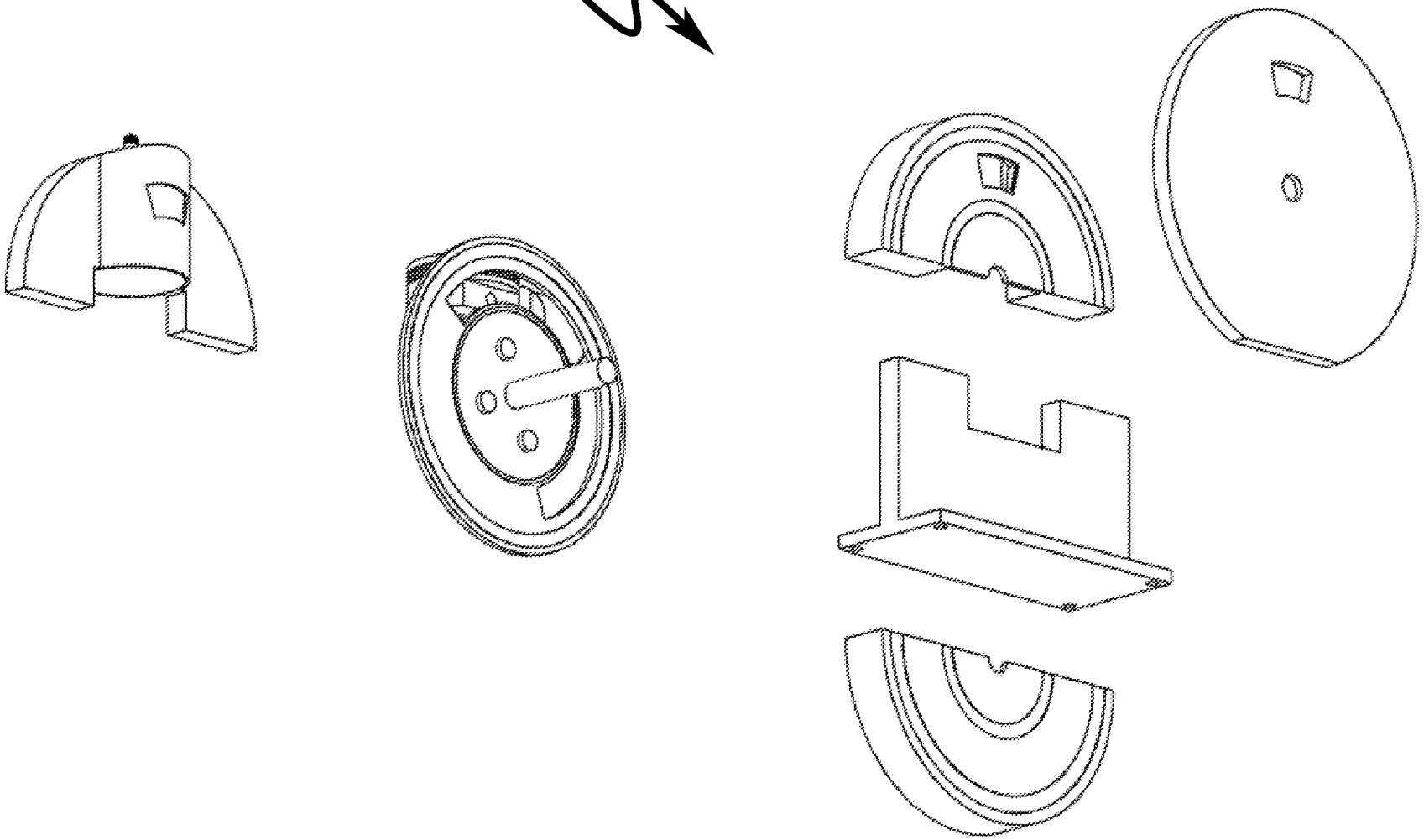
FIG. 32 illustrates a bottom left front perspective engine block exploded view of a preferred exemplary rudimentary invention system embodiment.

The present invention as embodied in rudimentary form is generally depicted in assembly exploded views in FIG. 17 (1700)-FIG. 32 (3200). The major components depicted in these assembly exploded views include the following:

Rudimentary Engine Accessories (BEA) (1700);
Intake Engine Block & (MSV) (1740);
Power Drive Train (PDT) (1760);
Exhaust Engine Block & (MSV) (1770);
Intake and Exhaust Sealing (ISP/ESP) (1780);
Rudimentary Engine Cover Intake (IEC) (1708) and Exhaust (EEC) (1709);

The preferred exemplary invention's rudimentary rotary valve system embodiment is comprised of several specific components that operate in concert to provide for the much sought after stoichiometric efficiency ratio of 14.7:1.

The 14 parts of air is necessary to mix together with 1 part of fuel to provide for adequate oxygen for a complete and efficient combustion process to occur.

The main rudimentary components must be exampled to grasp the concepts behind how this preferred exemplary invention's rudimentary rotary valve system embodiment provides for achieving its designed goal.

The present invention rudimentary rotary valve system embodiment comprises a standard Power Drive Train (PDT) (1760) modified to accept rotary valve port in the following configuration comprising these standard elements:

an intake RVD (IVD) mechanism (1762) comprising an intake RVP (IVP) (1761)
an exhaust RVD (EVD) (1768) comprising an exhaust RVP (EVP) (1769)
an intake & exhaust sealing mechanism ISP/ESP (1780)
an intake MSV & engine block mechanism (1740) comprising an MSV fixed port IMF (6746)
an exhaust MSV & engine block mechanism (1770) comprising an MSV fixed port EMF (13146)
an intake and exhaust engine cover (IEC) (1708) and (EEC) (1709)

Additionally, it is understood that this ICE adheres to all of the normal functionalities normally associated with any ICE appropriately modified to accept above stated configurational elements. These elements comprise what is termed and well known to the art as a rotary valve system.

The present invention efforts to present a more effective and applicable conceptual design that fully supports and facilitates a precision metering valve mechanism. All elements of this valve system work in concert to avail the desired effect of providing an exacting molecular metering standard to an ICE.

This exacting molecular metering standard to an ICE is implemented by the rotational and reciprocated characteristics of the PDT (1760) comprising: a Piston (RPI) (3563), a Combustion Chamber (CCH) (2964), a Crankshaft (CRK) (1765), a Crankcase Oil Reservoir (COR) (7266), a Piston Connecting Rod (RPR) (2567), at least one intake RVD (IVD) (1762) comprising an RVP (IVP) (1761) and at least one exhaust RVD (EVD) (1768) comprising an RVP (EVP) (1769) both mating with the fixed intake port (FIP) (1741) and fixed exhaust port (FEP) (1771) that all work together in concert to affect a flow of gas molecules to flow into or out of the combustion chamber (CCH) (2964) once the mated alignment has occurred or to stop the flowing at the mated union of the stated fixed ports and each respective intake RVP (IVP) (1761) and an exhaust RVP (EVP) (1769) once the duration of the open timing has ended.

During the reciprocated operation of the PDT (1760), the present invention is further enhanced by the reciprocated operation of at least one Intake multi-staged valve (MSV) (1740) & Engine Block (4940) comprising an MSV fixed port (IMF) (6746) and at least one exhaust multi-staged valve (MSV) (1770) & engine block (4970) comprising an MSV fixed port (EMF) (13176) which both operate a continuous reciprocated positioning of their respective intake multi-staged valve blade (MVB) (1742) and exhaust multi-staged valve blade (IMB) (9742) so as to continuously pierce into the fixed intake port (FIP) (1741) and the fixed exhaust port (FEP) (1771) respectively.

The continuous reciprocated operation of the respective multi-staged valve blades (9742) and (9972) creates a delay or divergence of the flow of gas molecules that are flowing through the intake and exhaust passageways into and out of the combustion chamber CCH (2964). This delay to the flow is controlled by the load being imposed on the ICE. A heavy load would require more molecules to flow whereas a light load would require less.

The present invention is a rotary valve mechanism that works in concert with a multi-staged valve to form a more precise valve system that achieves more efficient ICE combustion by allowing more gas molecules into the combustion chamber (CCH) (2964) to increase the closer possibility and efficacy of the highly sought after 14.7 to 1 ideal air-fuel mixture ratio.

The inherent multi-functionalities found in the present preferred exemplary invention embodiment design offers sufficient improvements to the operation of an ICE valve system whereas, in comparison, the Poppet Style Valves only offer a valve system alone that requires a significant number of associative components, whereas, none of the characteristics of the Poppet Style Valve system offer any other benefits to the operational efficiency of an ICE except for its valve.

Some of the present invention's advantages are:

Additional beneficial characteristical features of present invention RVD as compared with the Poppet Style Valves (Poppet) in association with estimated molecular air flow, geometry, engine power, volumetric efficiency, RPM performance, supercharging and cooling features.

A comparative analysis on the mechanism of the Poppet Valve and the present invention (Rotary Valve system):

Poppet Valve vs Rotary Valve (i):

The Poppet Style Intake and Exhaust Valves have geometrically inherent characteristics which cause losses in the molecular air flow rate due to the fact that it creates a restriction to itself because of its own inherent geometry.

The molecular air flow inherent in Poppet Style Intake and Exhaust Valves travels directly in line with the movement of the Poppet Valves.

As the Poppet Valves open and close, molecular air flow must travel along and around the Poppet Valves Geometry and the fixed valve ports.

These initial losses are the result of the geometrical design of Poppet Valves which sit resident directly in the throat of their fixed Intake and Exhaust Ports.

Further losses are the result of the geometric limit of how far the Poppet Valve can be opened and the valve clearance that is hampered by the travel and movement of the Piston from Top Dead Center to Bottom Dead Center inside of the Engine's Combustion Chamber.

The higher the compression ratio of the engine, the less room there is to open the Poppet Valve. This limits the poppet valve to lower compression ICE examples.

This limits the most powerful Poppet Valve Engines to a maximum valve opening cam lift of 0.500" and an open duration of about 232°.

Further limitations occur due to the Valve Springs not being able to fully close the Valves at higher revolution per minute (RPM).

The Rotary Style Intake and Exhaust Valves have geometrical mechanical advantage inherent characteristic which cause naturally occurring gains in the molecular air flow rate due to its geometry not providing a restriction to the molecular air flow because the rotary valve does not sit resident in the throat of the fixed intake or exhaust ports.

The molecular air flow inherent in the Rotary Style Intake and Exhaust Valves travels at right angles to the movement of the Rotary Valves.

As the Rotary Valves open and close, molecular air flow travels through the valve port opening and into the fixed valve ports.

These initial gains are the result of designing a valve which sits resident outside of the throat of the fixed Intake and Exhaust Ports as is depicted. Further gains are the result of there being no limitation on how far the Rotary Valve can be opened in terms of there not existing any interference of the reciprocation of the piston such that the valve clearance is not hampered by the travel and movement of the Piston from Top Dead Center to Bottom Dead Center inside of the Engine's Combustion Chamber due to the fact that the Rotary Valve is not resident inside of the combustion chamber or the throat of the fixed Ports, as is the case of Poppet Valves.

A Rotary Valve Engine can have higher compression ratios because there is no limit due to the travel of the piston in consideration of valve opening interference.

Valve opening duration is increased to 270-degrees because the Rotary Valve Engines don't need a cam to open its valves and its mechanical advantage allows it to take advantage of the full duration possible. The valve is opened and closed by the rotation of the crankshaft's driven gear or crankshaft mounted RVD in reference to the mated fixed ports. The fixed ports of the present invention mirror the exact same size and shape of the respective RVPs.

The result of an increased duration allows the Rotary Valve to remain open longer. Thus, allowing for even greater volumetric efficiency.

Poppet Valve vs Rotary Valve (ii):

Poppet Valves are inherently susceptible to a condition called "Valve Float." This occurs when the valve train gets out of control, usually due to excessive wear or failure of its system components as is well known to those skilled in the art. The number one cause of this is by there not being enough "Valve Spring Pressure."

There are two types of Valve Float:

Loft—When the lifter is thrown off the nose of the cam lobe.

Bounce—When the valve bounces off its seat, before it settles.

This, companioned with its inferior geometry, greatly reduces the volumetric efficiency of the Poppet valve system. Poppet valve systems use about 20% to 30% of the engines power to operate, as is well known to those skilled in the art whereas Rotary valves use nearly 5% to 10% of the engines power to operate.

Rotary Valves are geometrically superior due to their material handling characteristics where a rotary valve forms a geometrical "plug" to stop the flow of a gas or a liquid.

Incorporating Rotary Valves in 2-stroke and 4-stroke ICEs, allow for a precision metering of the molecular air flow due to its inherent geometrical "plug" functionality.

Except during the alignment of the fixed port Intake (FIP) (1741) and Exhaust (FEP) (1771) and the RVP Intake (IVP) (1761) and Exhaust (EVP) (1769), the rotary valves essentially plug or close off the fixed ports passageways.

The functional characteristics of the Rotary Valve can then be depicted using simple geometry to show its efficiency and benefits.

This is besides the fact that the Rotary Valve systems use less engine power and a lower number of components.

Poppet Valve Vs Rotary Valve Estimated Molecular Air Flow

Per Poppet Valve—areas of estimated ideal molecular air flow loss:

Poppet Valve:
Port Wall Friction: 1.30%
Contraction @ Push Rod: 7.15%
Bend @ Valve Guide: 2.60%
Expansion Behind Valve Guide: 7.80%
Expansion 25 Degrees: 12.35%
Expansion 30 Degrees: 11.05%
Fluctuation to Exit Valve: 20.15%
Expansion Exiting Valve 2.60%:
Resultant outcome: 65.00%

Typical Poppet Valve Systems are known to be only at best 35% efficient. This is mostly due to the above listed conditions wherein the air flow loss is estimated based on its flow through and around the geometrical shapes of the inherent components.

Per Rotary Valve—areas of estimated ideal molecular air flow loss

Rotary Valve:
Port Wall Friction Fixed Port: 2.60%
Port Wall Friction Rotary Port: N.A.
Contraction @ Push Rod: N.A.
Bend @ Valve Guide: N.A.
Expansion Behind Valve Guide: N.A.
Expansion 25 Degrees: N.A.
Expansion 30 Degrees: N.A.
Fluctuation to Exit Valve: N.A.
Expansion Exiting Valve: 2.60%
Resultant outcome: 5.20% rotary valve systems geometrically only exhibit 5.2% of estimated frictional losses of molecular air flow comparatively because there are less components to exert the frictional coefficients against. This suggests a theoretical 94.8% efficiency estimate.

The above estimated molecular air flow loss chart identifies where the losses are spread across the fixed intake port and associative components in consideration of each valve type. It can easily be seen that the Rotary Valve style has less frictional losses due to it having less geometrical elements to inhibit the flow of air molecules.

The following estimations given represent an ideal engine condition in a theoretical laboratory setting.

It should be noted that in reality the components which govern the operation of the Poppet Style Valves inherently work against its own operational efficacy: valve springs weaken over time and at high RPM, they lean towards erratic operation as the valves sometimes begin to bounce/float as they are closed which causes erratic responses of the ICE and fluctuating emission pollutants.

Poppet Valve vs Rotary Valve—Friction Against Moving Parts

Poppet Valve:
(2 per combustion chamber)
Camshaft
Camshaft Bearings
Lifters
Lifter guides/journals Pushrods
Valves
Valve Guides
Valve Springs
Valve Retainers
Rocker Arms
Seals
Rotary Valve:
Disc/cylinder w/gear
Rotary Valve Disc (2 per combustion chamber)
Rotary Port Valve
Multi-Staged Valve
Bearing
Axle
Compression Seal
Oil Seal The Poppet Style Valves train typically includes a minimum of 20 moving parts per cylinder which translates into 80 parts on a 4-cylinder and 120 parts on a 6-cylinder engine.

Whereas on a Rotary Style Valve engine, there is a minimum of 8 moving parts per cylinder only, which translates into 32 parts on a 4-cylinder and 48 parts on a 6-cylinder engine.

An engine's RPM is limited by a variety of factors, the most fundamental being the strength limitation on its components. The valve mechanisms are often the most limiting feature in most 2- and 4-stroke reciprocating engines.

The highest engines RPMs achievable for reciprocating style engines are the 2-stroke style engines that do not have poppet valves. Also, (4-stroke equivalent) Wankel or Rotary Vane engines do not have Poppet Valves nor do non-reciprocating turbine engines. In those cases, the strength of other components comes into play.

The versatility found inherent in the Rotary Style Intake and Exhaust Valves of the present invention offer a sufficient improvement to the operation of an ICE whereas, in comparison, the Poppet Style Valves only offer a valve system alone that requires a significant number of associative components, none of the characteristics of this style valve offers any other additional beneficial features to enhance the operational efficiency of an ICE.

However, this does not come without some measure of difficulty as the Rotary Valve is systematically more susceptible to require a precision manufacturing profile, so as to avoid leakage of coolant, compression, and engine oils.

The sealing mechanism of the present invention is comprised of ceramic over metal powder coated coatings companioned with high temperature seals and the precision manufacturing profile requirement which slightly increases the cost associated with the initial implementation of this valve system. However, these costs can be mitigated by mass production.

Poppet valves:
More moving parts
Greater amounts of particulate recirculation
Limited service life expectation
Complicated servicing routines
Rotary valves:
Less moving parts
Less particulate recirculation
Extended service life expectation
Simple servicing routines The geometrical area of the Rotary Valve Port is determined using the following formula for sector area:

Sector Area=

$$r_1=50\ r_2=8$$

$$\Theta=\Theta_1-\Theta_2$$

$$\Theta=112.50°-67.50°$$

$$\Theta=45°$$

$$A=(A_1-A_2)*\Theta/360°$$

$$A1=\pi*50^2$$

$$A2=\pi*8^2$$

$$A=(50^2\pi-8^2\pi)*45°/360°=304.5\pi$$

$$A=956.13\ mm^2$$

It can easily be seen in every example that the present invention rotary valve port has a greater uninhibited conical frustum shaped opening that offers less resistance or obstruction to the flow of air molecules.

Further research and implementation of the Rotary Valve should be made to incorporate it into currently used ICE's.

The equivalent valve openings show that comparing both valve styles with the same size port opening results in the Rotary Style Valve exhibiting a greater capacity for allowing the flow of air molecules than does the Poppet Style Valve as is well known to those skilled in the art.

The ideal sought after air-fuel ratio for the optimal performance of gasoline ICEs is 14.7:1. However, owing to the inherent mechanical interference of ICEs, the average air-fuel ratio of current ICEs is only about 8/9:1 under load. The present invention is designed to increase the air-fuel ratio so that more air could enter the combustion chamber for combustion, thus allowing a closer to 14.7:1 ratio to be achieved.

Engine Power

From the ideal "Power" formula, we find that engine power can be increased by:

- decreasing engine losses (higher fuel conversion efficiency)
- improving air intake capacity of the engine (higher volumetric efficiency)
- increasing engine speed (lower friction losses and components inertia)
- increasing engine capacity
- increasing energy content of the fuel (higher heating value/octane rating)
- increasing intake air density
- increasing fuel-air ratio In the case of the present invention, it has chosen to use both (i) decreasing engine losses by implementing the use of less components and by using less surface areas to inhibit the air molecule particulate travel, resulting in less operational frictional coefficients, and (ii) improving air intake capacity of the engine (higher volumetric efficiency) by removing the Poppet Valves from the throat of the fixed port and increasing the size of the resultant valve opening utilizing the Rotary Valves. The Rotary Valve Port opening is proportionate to the displacement ICE applique, the larger the engine size, the larger the valve port that can be utilized.

ICE Four Stroke Cycle Engine Operation

Since air molecules are expandable, the air molecules are expanded as they enter the intake manifold and are directed into the combustion chamber due to the suction created by the piston moving downwards in the combustion chamber during the Intake Stroke of the engine.

Those same air molecules are compressed during the Compression Stroke of the engine, it is near the end of the Compression Stroke when the fuel is injected. Once the air molecules are compressed, the air fuel mixture is ignited.

Ignition causes the compressed air-fuel mixture to detonate and produce the Power Stroke of the engine.

After which, the final stroke of the engine is the Exhaust Stroke, where the combusted gases are expelled out of the combustion chamber. This is when the cycle repeats.

On an ICE, one RPM is:

For a four-stroke engine: two 360 (720) degree rotation of the engine's crankshaft For a two-stroke engine: one 360-degree rotation of the engine's crankshaft Inside of these cycles/strokes, a valve function must remain consistent. As the RPM speed of an ICE increases, the speed of the valve system increases directly proportional to the RPM speed.

The molecular air flow is limited or delayed in Poppet Valve systems because of the valve's positional geometry and the frictional losses through the throat of the fixed intake/exhaust ports and inherent friction found in its associative components.

Inconsistently, throughout the range of operation, poppet valves offer less ambient air pressure operation inversely proportional to the engine RPM. The higher the engine RPM is, the lower the amount of air molecules that can get into the engine during the intake cycle because the valves are open for a shorter amount of time and the Poppet Valve face acts as a major obstruction to the flow of the air molecule particulates in and out of the combustion chamber.

A cycle is the time it takes for the piston to travel from Top Dead Center to Bottom Dead Center or from Bottom Dead Center to Top Dead Center. The intake cycle and the exhaust cycle are the main focal points of the present invention.

Volumetric Efficiency (VE)

Volumetric efficiency (VE) is the actual amount of air flowing through an engine, compared to its theoretical maximum. Basically, it is a measure of how full the combustion chamber is. VE is expressed as a percentage. An engine operating at 100% VE is using all of its volumetric capacity.

Since VE is the measure of the volume of air molecules theoretically being sucked into an ICE during the naturally aspirated Intake Stroke, it can also be regarded as the efficiency of the ICE to fill the combustion chamber with intake air molecules. The higher the VE, the higher the volume of intake air in the engine and the greater the level of combustion power is realized.

It should be noted that the inherent VE of the operation of an ICE is a function of valve open timing and the frictional characteristic obstruction to the flow of air molecules into and out of the combustion chamber.

This timing is proportional to the amount of time that the valves can be open and the frictional losses that affect or slow down the molecular air flow going into the combustion chamber of an ICE.

Engines are typically designed to have the maximum VE at medium/high engine speed and load. The VE of an ICE depends on several factors like:

geometry of the intake manifold intake air pressure intake air temperature intake air mass flow rate (which depends on engine speed)

The thermal efficiency of an ICE is the percentage of heat energy that is transformed into work. The efficiency of even the best heat engines is low; usually often far below 50%.

The rotary valve system of the present invention estimates that there will be a marked improvement in the VE of an ICE since it is indicated that it systematically allows more air molecules to enter into the combustion chamber than does Poppet Valves.

Poppet Valve RPM Limit

One mechanical limitation with most modern vehicle engines possessing Poppet Style Valves is the fact that the intake and exhaust valves in most overhead cam engines are opened by a camshaft, but closed by springs.

As the engine RPM increases, the rate at which the valve opens goes up linearly. The valve is directly opened by the motion of the camshaft. However, the rate at which the valve closes has an upper limit which is determined by the strength of the valve spring, the weight of the valve, and frictional effects.

What this translates to is that at high RPMs, the effective opening of the Poppet Valves become impervious to the effective and efficient flow of air molecules through them. It is because of this inherent flaw in ICEs that the forced induction appliances were adapted to ICEs.

At lower RPMs, the valve spring can close the valve quickly enough and the valve is not limited by the camshaft. The Poppet Valve timing is consistent.

At high RPMs, the valve spring may not be able to close the valve quickly enough to keep up with the receding profile of the camshaft lobe, this condition is called "valve float". The Poppet Valve timing is inconsistent.

Poppet Valve float decreases horsepower, causes higher quantities of greenhouse gas emissions, and eventually as the RPMs continue to increase, may eventually lead to the piston contacting the valve which can't close quickly enough, leading to engine damage (assuming an interference styled engine).

Rotary Valve RPM Advantage

The number one mechanical advantage of Rotary Valve engines is that the valve system opens and closes the valves without any interference with the travel of the reciprocating piston in the combustion chamber. This allows for a higher compression and RPM capability that is only limited by the mechanical strength of the crankshaft, crankshaft bearings, connecting rod, and piston assemblies.

The number two mechanical advantage is the Rotary Valve can have a larger port opening which allows for a greater amount of unrestricted air molecules to enter the combustion chamber providing for a higher level of combustion.

The number three mechanical advantage of the Rotary Valve is that it can stay open for a longer duration. The longer duration means that it operates more reliably over a wider range of RPMs.

The number four mechanical advantage is that there are fewer moving parts required for its operation. This means that the ICE will run cleaner and have a longer life span since there will be less recirculated particulate matter causing premature component failure.

These factors are estimated to allow most modern vehicle ICEs possessing Rotary Style Intake and Exhaust Valves a greater versatility and since there is no valve springs, the valves are not susceptible to floating or bounce which results in extremely erratic operation.

Timing remains consistent throughout the range of ICE RPM, since there is no valve spring pressure to be overcome, hence no camshaft is needed. The valve of an ICE with Rotary Valves is now a precision factor wherein a longer duration of valve opening is provided for.

As the engine RPM increases, the rate at which the Rotary Valves precisely are opened and closed apprises a potential increase in the ICE's horsepower, lower quantities of greenhouse gas emission output, and fewer moving parts produce less recirculated particulate matter (dirt) thus providing a cleaner operational environment which is more ecologically friendly.

So, whether any or all of the three enhancement options of the present invention is chosen or not, the required fitment allocation is already there in the rudimentary example ICE and since specific cooling features are also resident in the enhanced features with the spool configuration, the forced induction feature is automatically provided with the inherent requirement for cooling. It is well known to those skilled in the art that centrifugal impeller causes the air molecules that it compresses to heat up appreciably. So, it turns out that by modifying the rotary valve into a "spool shape" for cooling purposes and then adding this centrifugal impeller even greater performance is achieved because the cooling feature enhances the forced induction feature. So, in line with the inherent methodology of one component element of each stage should enhance or modify the component element of the previous stage such that the resultant factor of each stage should result in a more effective applique of the much sought after stoichiometric efficiency ratio of 14.7:1 as the final result.

Conclusion

The Poppet Valve System has been in existence for over 161 years since the invention of the Otto 4-Cycle Engine.

It is widely thought that the use of Electric motors will solve the crisis with global warming caused by ICEs emitting higher quantities of greenhouse gases. All this does is exchange one type of Bio-Hazard for another because the power to recharge the batteries has to be done somewhere and wherever that is the power generation will produce Bio-Waste.

Besides the side-effect of creating Bio-Waste that is inherent of the power generation process, there is the growing problem with the number of worn-out unrecyclable lithium batteries, which are also a Bio-Hazard.

The rotary valve system is relatively new with only a few years of recent history. Recent advancements in Additive Manufacturing and other techniques allow precision devices to be manufactured cheaper.

All in all, although there will be a slight increase in the manufacturing cost above the Poppet Valves, because rotary valves have to be precisioned, the additional benefits brought in by rotary valves outweigh the additional precision cost. As analyzed above, the present invention rotary valve system with its many features such as fewer moving parts, cooling mechanism, supercharging capability, etc. is prospective in bringing greater Volumetric Efficiency, higher ICE RPM limit benefits, less environmental harming greenhouse gas emissions, to name a few.

Rotary Valves by far offer greater versatility and reliability. Greater performance and efficiency with the advent of lowering the emissions output into the environment. There really isn't a contest of why not to use the Rotary Valve system as much as it is a question of how soon it has to be used.

Enhanced Engine Assembled/Assembly Detail (3300)-(6400)

Enhanced Engine Overview

The present invention as embodied by the enhanced engine embodiment incorporates the unification of the Intake Manifold (INM) (4411), the Engine Block Cover (ENC) (4412), the Volute Housing (VOH) (24929), and the Throttle Plate (THP) (4214).

None of these compilations of these elements compromises any of the functionality of these mechanisms since they are only lined up in a fashion where the normal natural aspiration of an ICE is enhanced by their inherent presence.

A wider intake manifold allows for greater air molecules to flow with less restriction from the inherent friction that normally accompanies typical intake manifolds. These manifolds like any known in the art are susceptible to "Tuning" characteristic of intake manifolds.

Configuring the intake manifold as part of the engine cover lessens the possibility that there will be losses inherent because of loose parts or worn gaskets. It is well known to those skilled in the art that the intake is a place where much of the volumetric efficiencies are won or lost due to vacuum leaks between the fixed intake port (FIP) (1741) and the intake manifold (INM) (4411).

Compiling the Intake Manifold (INM) (4411), the Engine Block Cover (ENC) (4412), the Volute Housing (VOH) (24929), and the Throttle Plate (THP) (4214) together, the four components form a new device wherein the precise metering of an enhanced attitude for the induction of air molecules to be channeled into the combustion chamber.

Instead of just the brute force application of a supercharger or turbo charger alone, the present invention considers that there are opportunities inherent and well known to those skilled in the art where a variance between long or short runners of the intake couplings can excite improved response from a typical ICE.

High RPM performance is enhanced with a shorter slightly raised above the deck of the manifold is well known to those skilled in the art as a High-Rise Manifold.

Low RPM performance is then enhanced via a longer runner element being incorporated into the intake manifold as is well known to those skilled in the art as being termed a "Tunnel-Ram" intake manifold.

These two concepts are taken into consideration with the rotary valve engine. The coupling passageways are comprised of long and short couplings working together in concert turning on and off these characteristics as the rotary valve rotate.

The Spiral Channel Intake (IPC) (10023) and Exhaust (EPC) (9833) adds length to the short intake manifold, interrupting the molecular air flow and causing the air molecules to rush in faster due to the spiral impeller integral to the Spiral Channel Intake (IPC) (10023) and Exhaust (EPC) (9833) which adds more air molecules to be introduced into their final destination of the combustion chamber (CCH) (2964) under a slight apparent pressure.

Besides the tuning boost inherent in the intake manifold, this Spiral Channel Intake (IPC) (10023) and Exhaust (EPC) (9833) adds to the inherent "Follow the Leader" methodization inherent in ICE as is well known to those skilled in the art to begin with the downwards motion of the piston inside of the combustion chamber (CCH) (2964).

The Volute Housing and Centrifugal Impeller (CIP) (8927) further enhance the "Follow the Leader" methodization inherent in the present invention ICE by applying the characteristics of an air compressor. As the Centrifugal Impeller rotates it generates a slipstream where air molecules are caused to compact together within the Volute Housing swirl chamber (VSC) (24128) until the inevitable alignment of the Fixed Intake Port (FIP) (1741) and the Intake Rotary Valve Port (IVP) (1761) occurs.

This alignment of the two ports acts as a rotary switch which turns on and off the flow of air molecules into and then out of the combustion chamber (CCH) (2964). Because the "Centrifugal Air Compressor" was designed to output from an outlet position within the Volute Housing (VOH) (24929) a "redirect" of this output has to be achieved by closing off the outlet from the Volute Housing (VOH) (24929), and opening the lower end of the Volute Housing (VOH) (4922), to allow the flow of air molecules to through or around the perimeter of the Centrifugal Impeller (CIP) (4921) wheel without disturbing the impellers' ability to compress the ambient air molecules.

This redirection of the Volute's output is further manipulated by positioning the Volute as close as possible to the intake manifold taking into consideration to counteract the losses inherent when an "Air Molecule Charger" is further away from the intake manifold as is well known to those skilled in the art.

This "Pre-Charger" appliance delivers at or slightly above the atmospheric pressure at higher RPMs in an effort to overcome where naturally aspirated ICEs tend to run out of air due to the inherent mechanical interference with the flow of air molecules into the combustion chamber (CCH) (2964) as is well known to those skilled in the art.

It is realized that sealing the rotary valve is required in order that the concept of its use be functionally beneficial.

To this end a sealing regiment has been implemented that addresses these concerns.

The compilation of the Grooves and Ridges Intake (IGR) (10781) and Exhaust (EGR) (10686), Seals and Rings Intake (ISR) (24182) and Exhaust (ESR) (ND), Engine Covers grooves/ridges intake (IGC) (2383) and exhaust (EGC) (2488), Recessed Areas intake (IRA) (1984) and exhaust (ERA) (2089), Boundary Layer Effect (BLE) (ND) all work together to form a containment area for the leaking compression or fluids.

Compression is contained between the Grooves and Ridges intake IGR (10781) and exhaust (EGR) (10686) and the Recessed Areas intake (IRA) (1984) and exhaust (ERA) (2089) of Engine Block.

Fluids are contained by placement Seals and Rings that are made of high temperature heat resistant synthetic materials. These Seals and Rings are held in position by providing grooves for them to reside in.

Further containment of the molecular elements is achieved by the Boundary Layer Effect (BLE) (ND) as the components rotate. In a closed system it is found that molecules of gas or fluid tend to cling to the surfaces of the components as they rotate.

This clinging effect is called the Boundary Layer Effect (BLE) (ND) and it creates a sort of conditioning of the molecules as they circle around with the rotating components.

This Boundary Layer Effect (BLE) (ND) operates in concert with the Grooves and Ridges intake (IGR) (10781) and exhaust (EGR) (10686), Seals and Rings intake (ISR) (24182) and exhaust (ESR) (ND), Engine Covers grooves/ridges intake (IGC) (2383) and exhaust (EGC) (2488), Recessed Areas intake (IRA) (1984) and exhaust (ERA) (2089), resulting in an operational condition where combustion/compression is averted or delayed long enough for the ICE to complete its prescribed 2 or 4 stroke operations.

Centrifugal Advance

The systematic cyclic timing of the ICE is also an area of much concern as is noted by those skilled in the art.

The Centrifugal Advance (CAD) (4950), assists in ensuring at all times the proper placement or positioning of the Rotary Valve Port intake (IVP) (1761) and exhaust (EVP) (1769) occurs optimally sequenced while the Rotary Valve Port intake (IVP) (1761) and exhaust (EVP) (1769) operate.

The Centrifugal Advance (CAD) (4950) utilizes a Centrifugal Advance Spring intake (IAS) (10752) and exhaust (EAS) (10657), with a Centrifugal Advance Plate intake (IAP) (7653) and Exhaust (EAP) (11658), against a Counter Weight Pivot (CWP) (4954) Centrifugal Advance Cover (CAC) (ND).

As is well known to those skilled in the art in other centrifugal advance mechanisms, when there is a rotating element, a manipulation of that element can occur through the incorporation of a centrifugal rotation sensitive componentry. One or more of such elements has been configured here as is displayed in FIG. 49 (4900).

The centrifugal advance mechanism is designed to move the position of the Centrifugal Advance Plate intake (IAP) (7653) and exhaust (EAP) (11658) resulting in opening the RVP wider or closing the RVP tighter.

These two directional acuities enable an advanced positioning or a retarded positioning to occur. As is well known to those skilled in the art, this manipulation can be tuned against Centrifugal Advance Spring intake (IAS) (10752) and exhaust (EAS) (10657), with the intention of delaying or promoting the movement or placement of the centrifugal advance plate intake (IAP) (7653) and exhaust (EAP) (11658).

Assembled Views (3300)-(4800)

Figure 48:
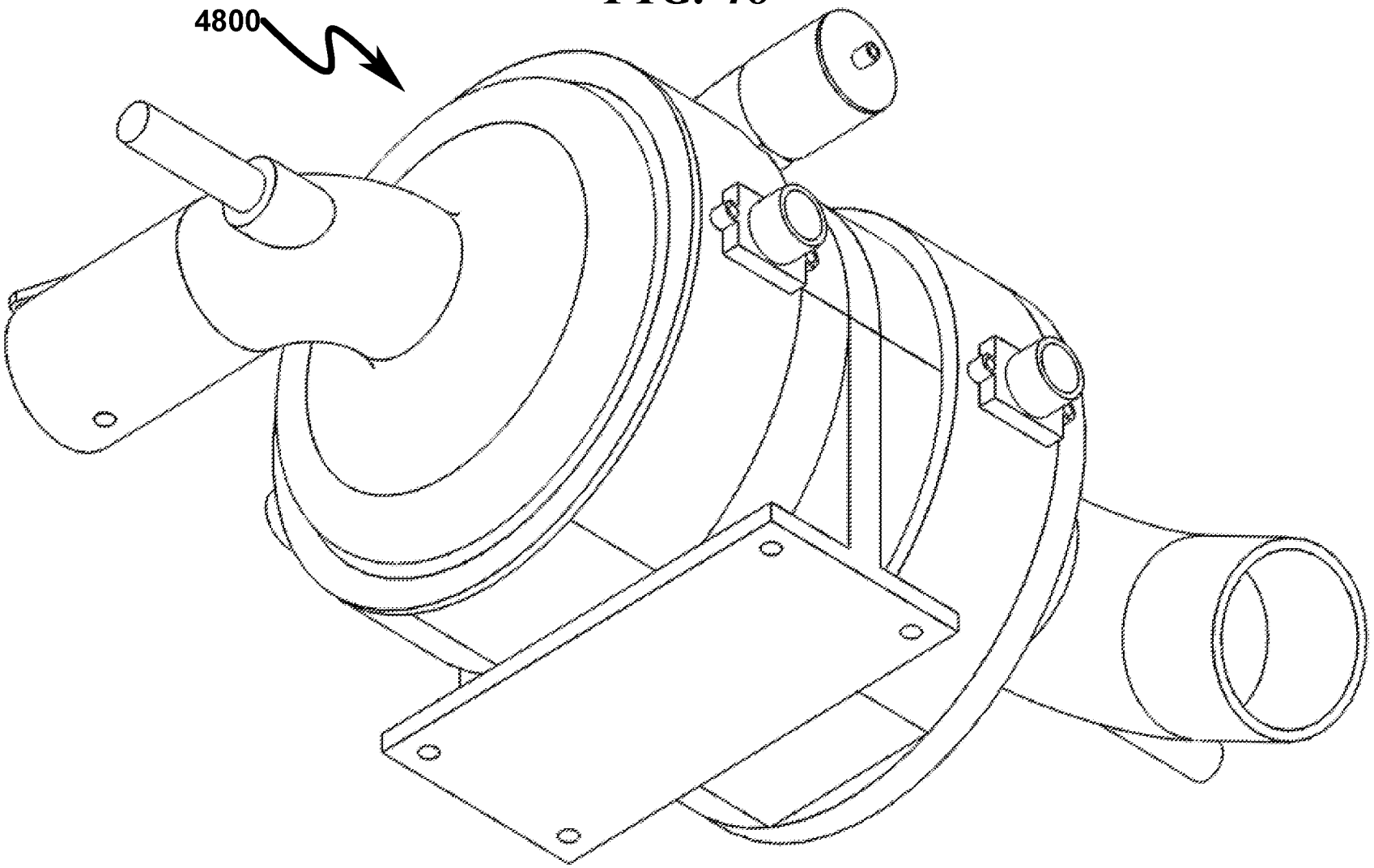
FIG. 48 illustrates a bottom left front perspective view of a preferred exemplary enhanced invention system embodiment.

The present invention as embodied in enhanced form is generally depicted in assembled views in FIG. 33 (3300)-FIG. 48 (4800).

Assembly Exploded Views (4900)-(6400)

Figure 64:
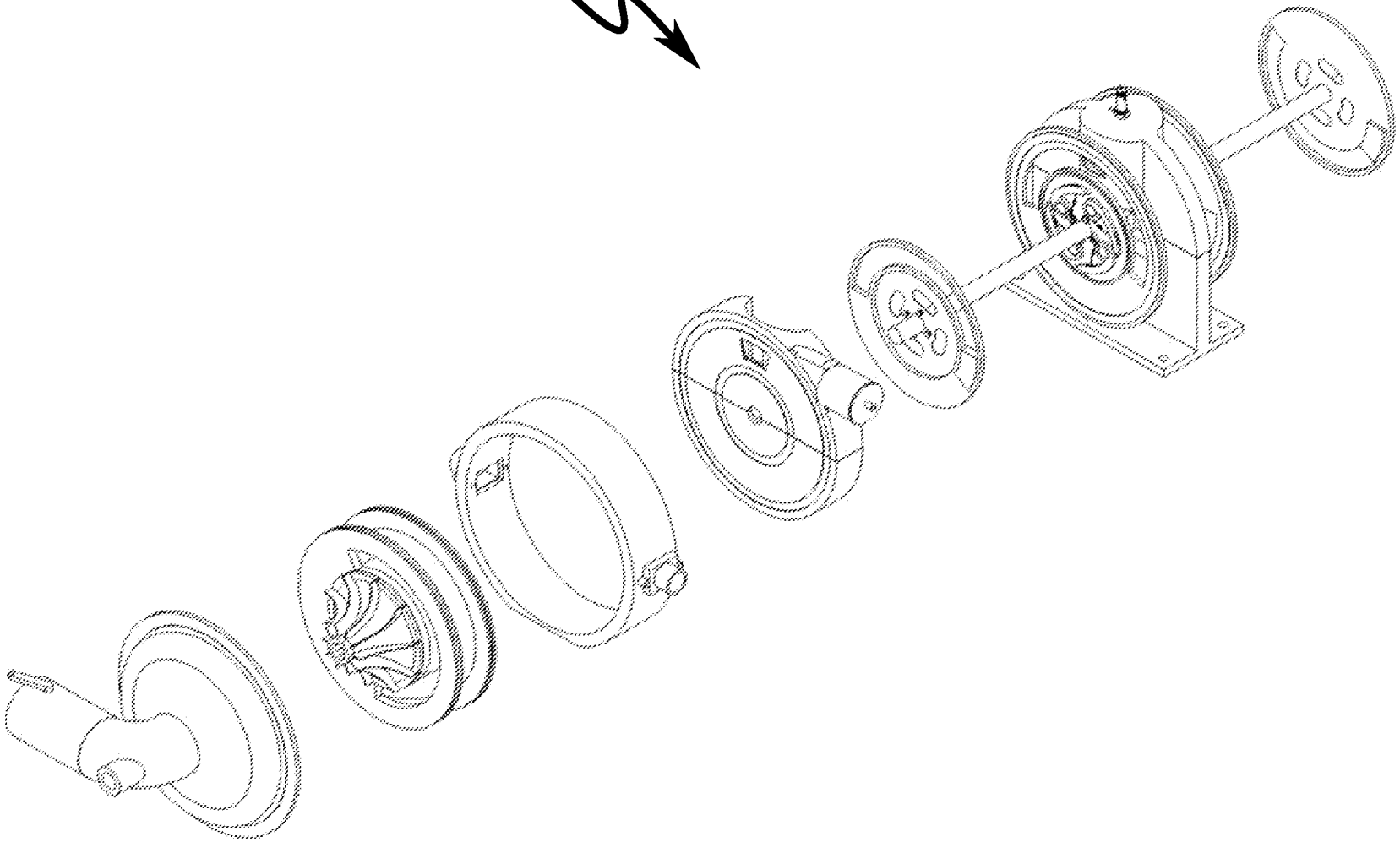
FIG. 64 illustrates a bottom left front perspective exploded detail view of a preferred exemplary enhanced invention system embodiment.
Figure 65:
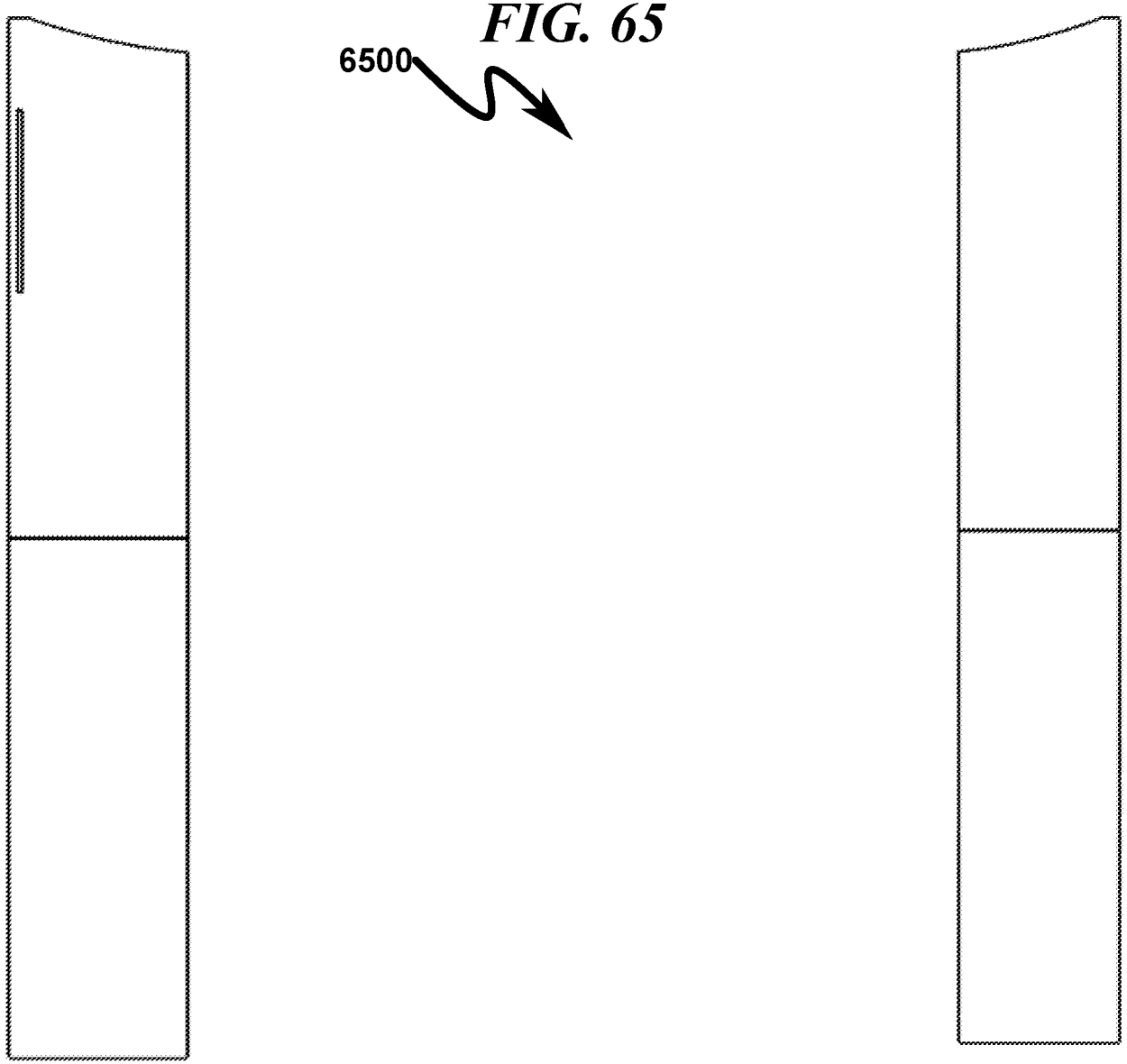
Figure 66:
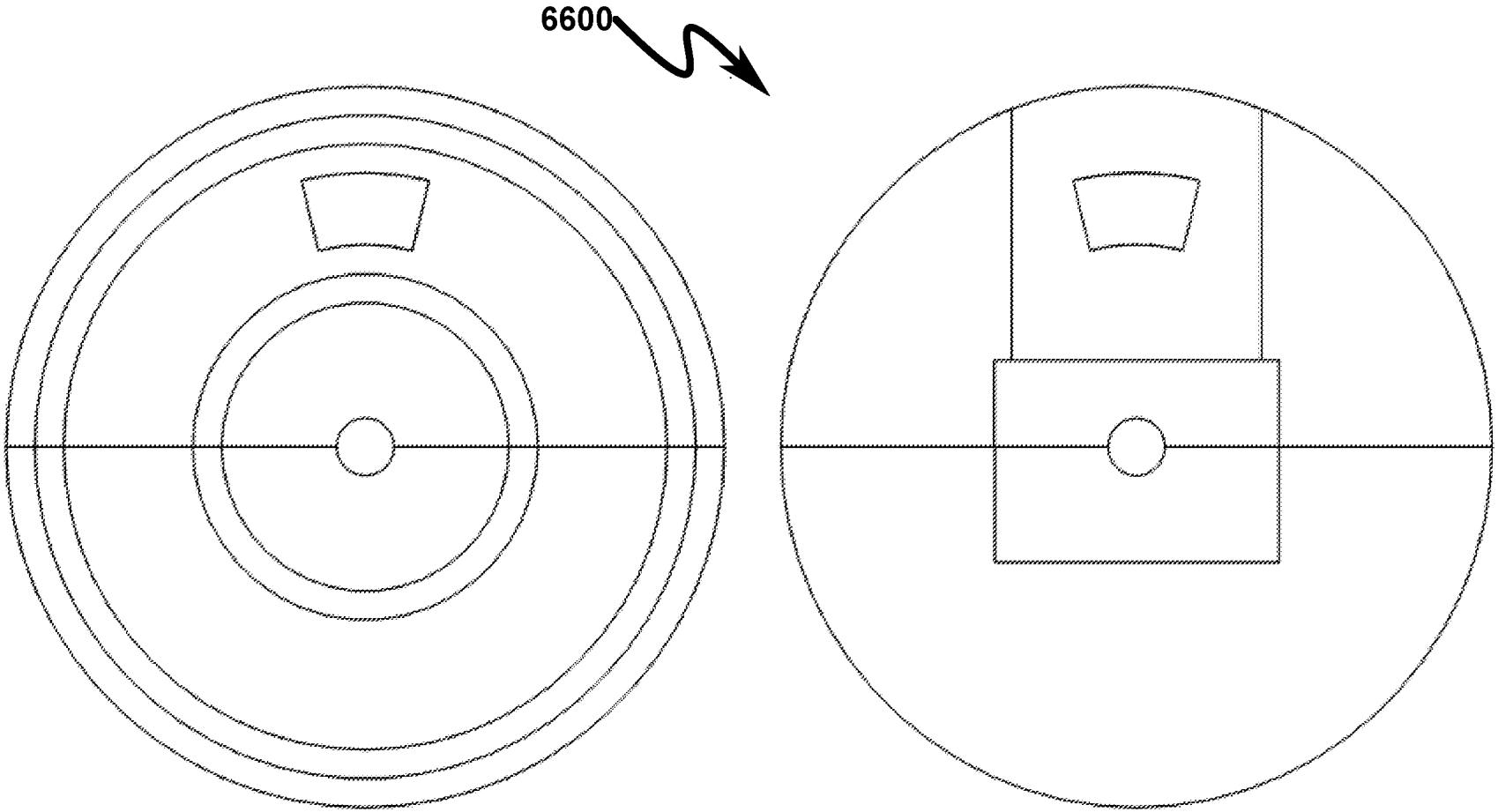
Figure 67:
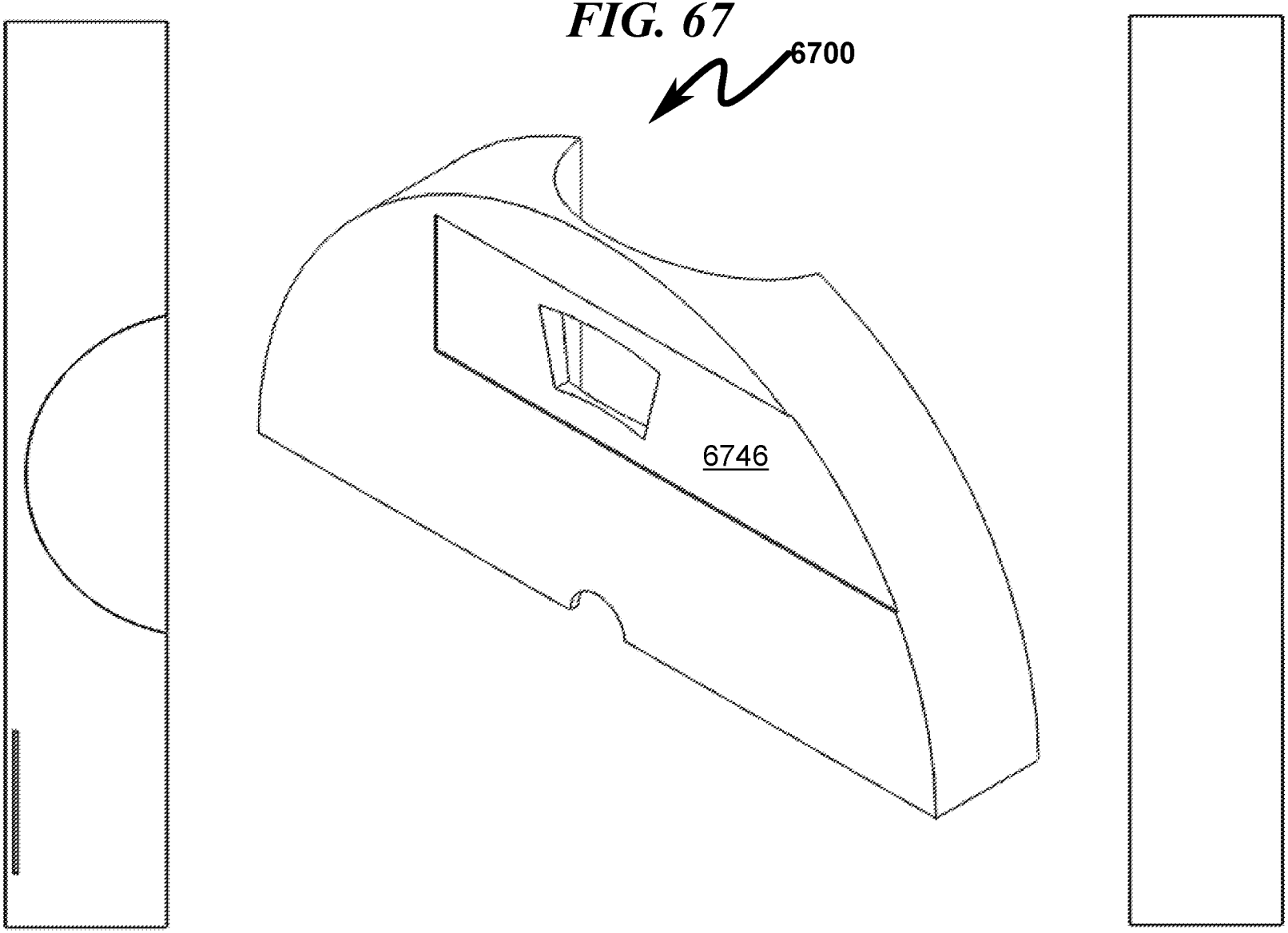
Figure 68:
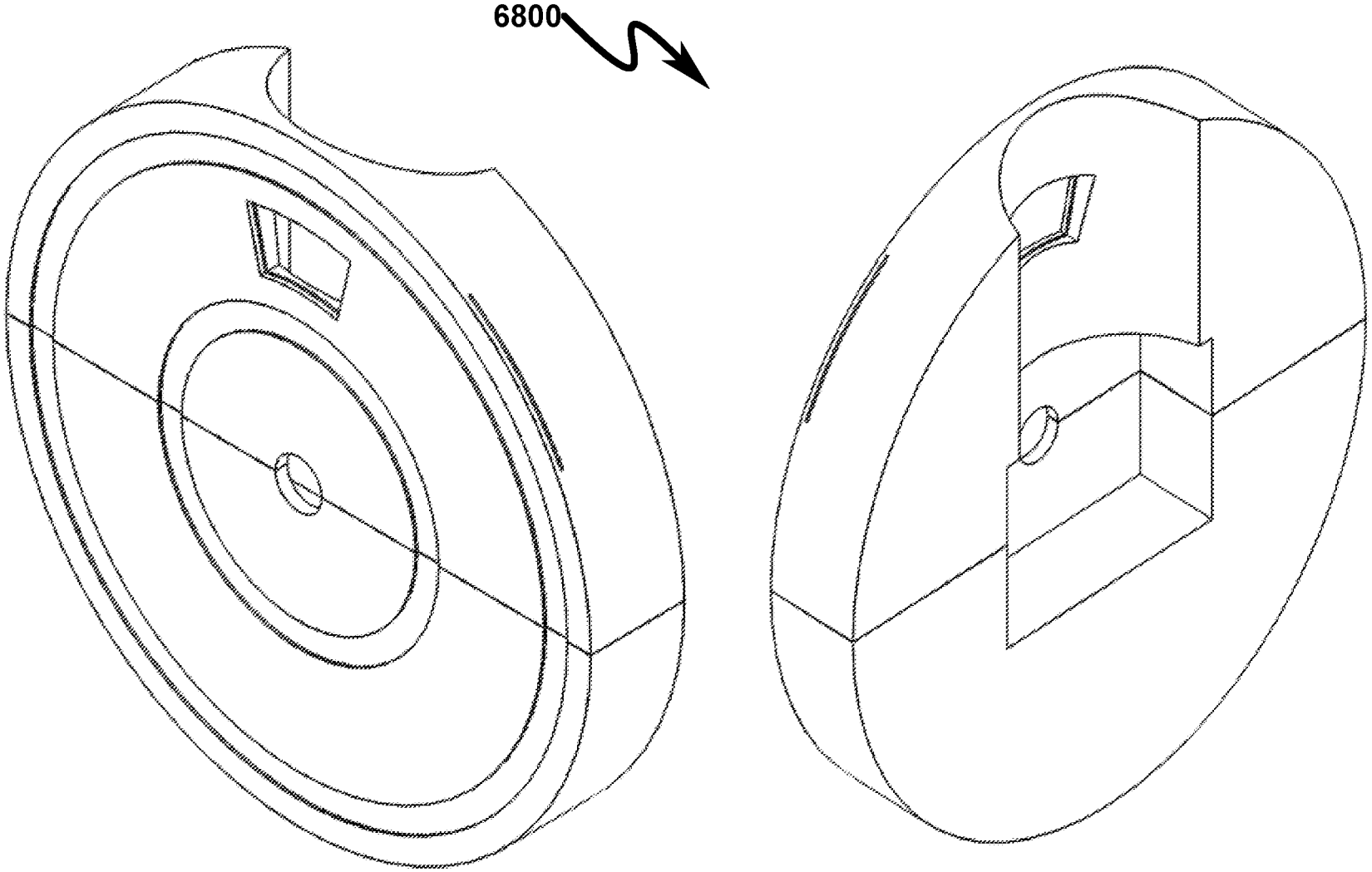
Figure 69:
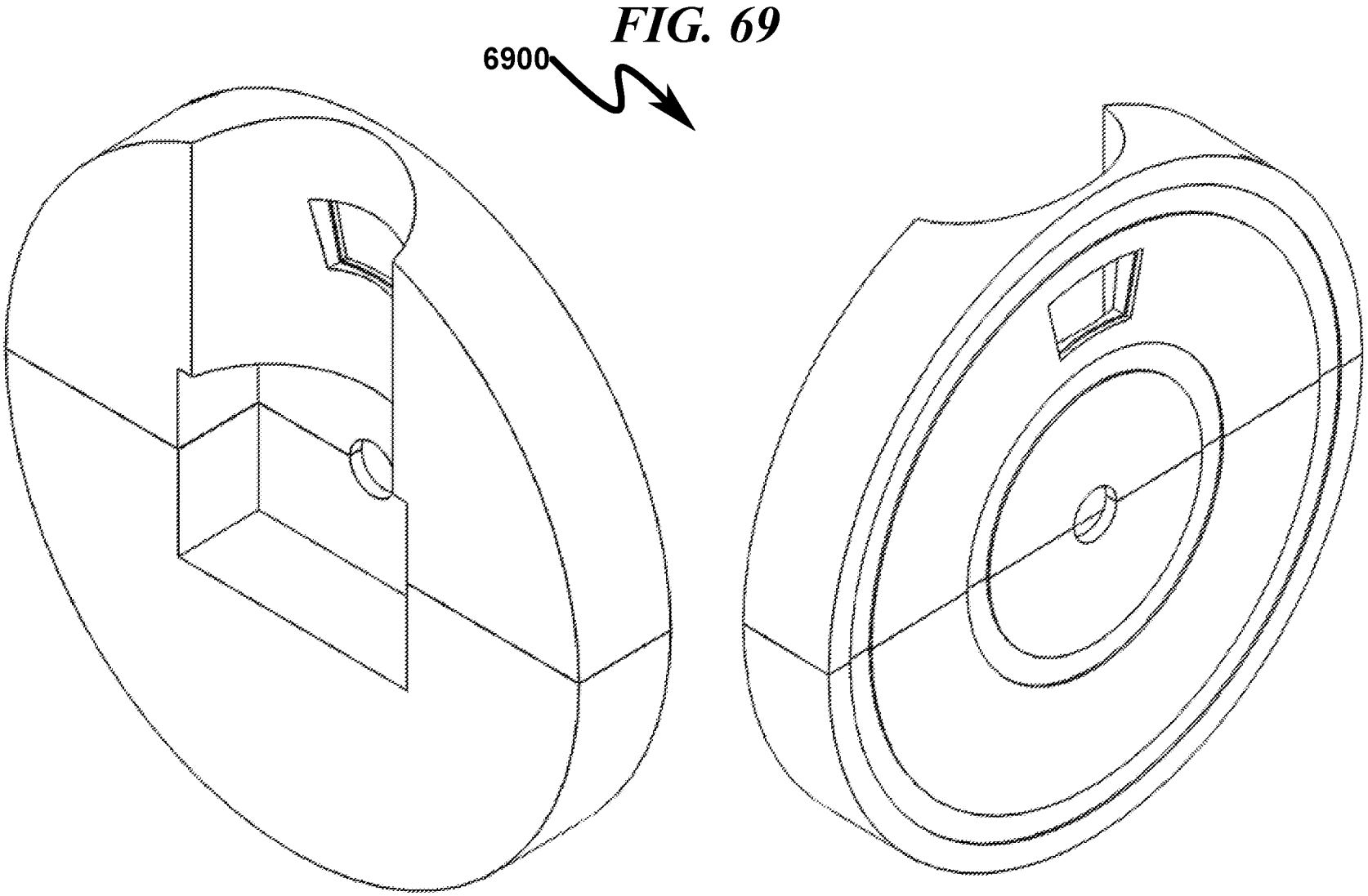
Figure 70:
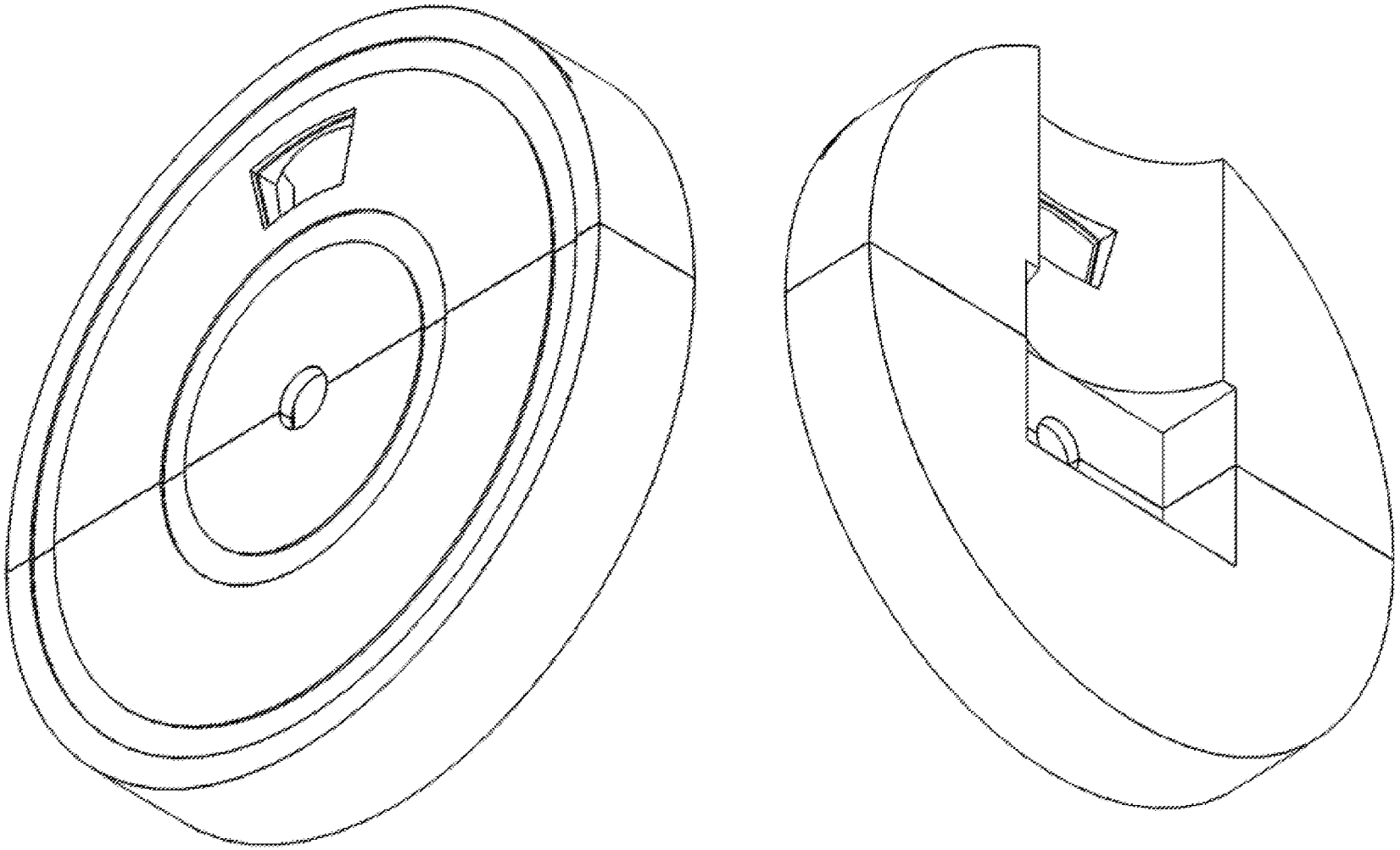
Figure 71:
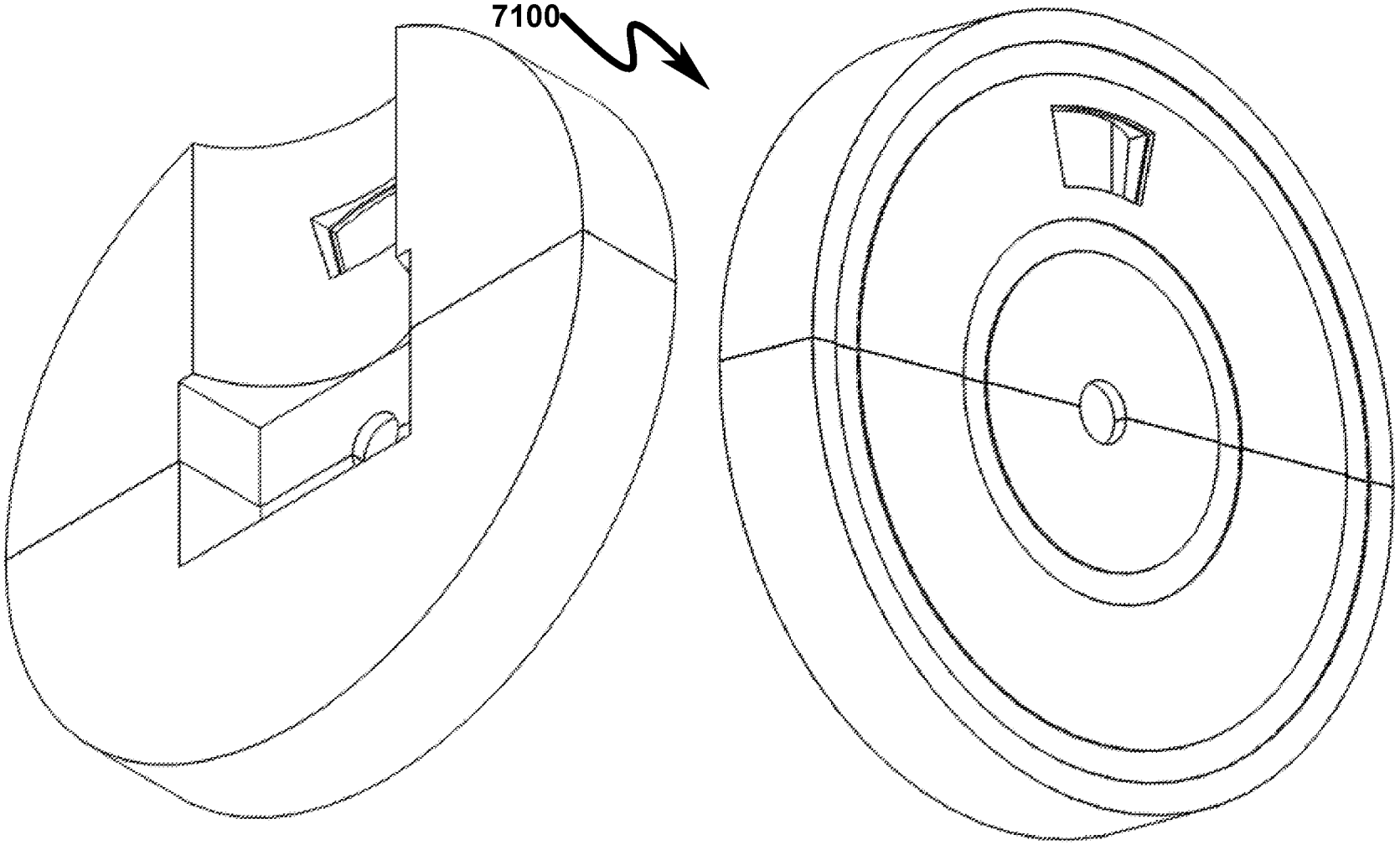
Figure 72:
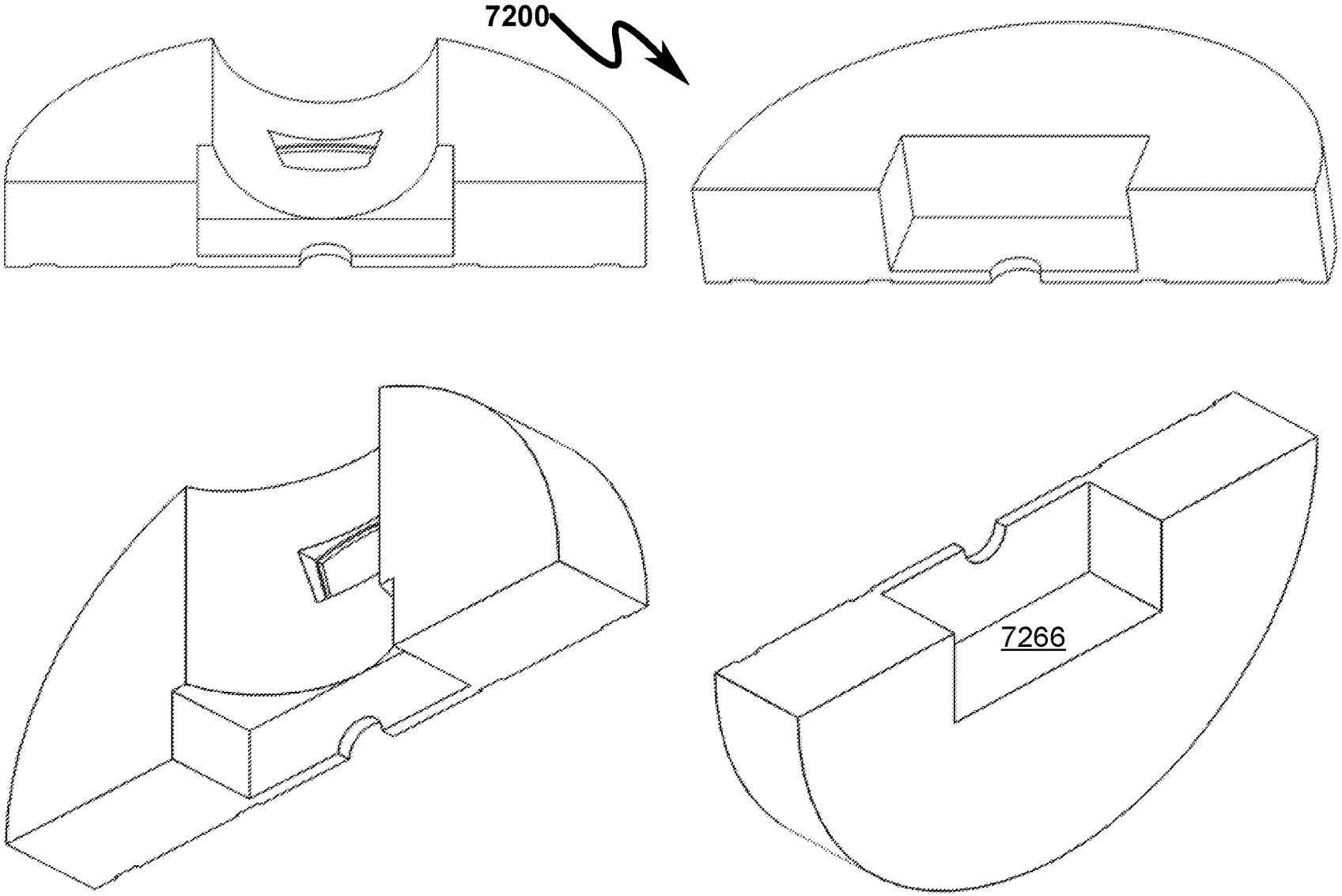

The present invention as embodied in enhanced form is generally depicted in assembly exploded views in FIG. 49 (4900)-FIG. 64 (6400). The major components depicted in these assembly exploded views include the following:

Cooling Channel Spool
Enhanced Engine Accessories (BEA) (4900);
Intake-Manifold-Volute & Engine Cover (MVC) (4910);
Intake (FIN) & Cooling (CJA) (4920);
Exhaust (FIN) & Cooling (CJA) (4930);
Intake Engine Block & (MSV) (4940);
Intake and Exhaust Centrifugal Advance (CAD) (4950);
Power Drive Train (PDT) (4960);
Exhaust Engine Block & (MSV) (4970);
Intake and Exhaust Sealing (ISP/ESP) (4980);
Exhaust Manifold & Engine Cover (EMC) (4990);

System Component Detail (6500)-(25600)

Major system components will now be discussed in detail as depicted in drawings depicted in FIG. 65 (6500)-FIG. 256 (25600).

Intake Upper Engine Block (IUH) and Intake Lower Engine Block Crankcase (ILC) (6500)-(7200)

Detail views of the intake upper engine block (IUH) and intake lower engine block crankcase (ILC) are generally depicted in FIG. 65 (6500)-FIG. 72 (7200). The IUH incorporates an intake port as well as a void supporting insertion of a MSV blade to modulate air flow through the intake port. The ILC mates with the IUH to provide crankcase enclosure and support for the crankshaft (CRK). In many preferred embodiments, the IUH/EUH and ILC/ELC are paired identical components. However, the present invention is not limited to this construction.

Intake Rotary Valve Disc (IVD) (7300)-(8000)

Figure 73:
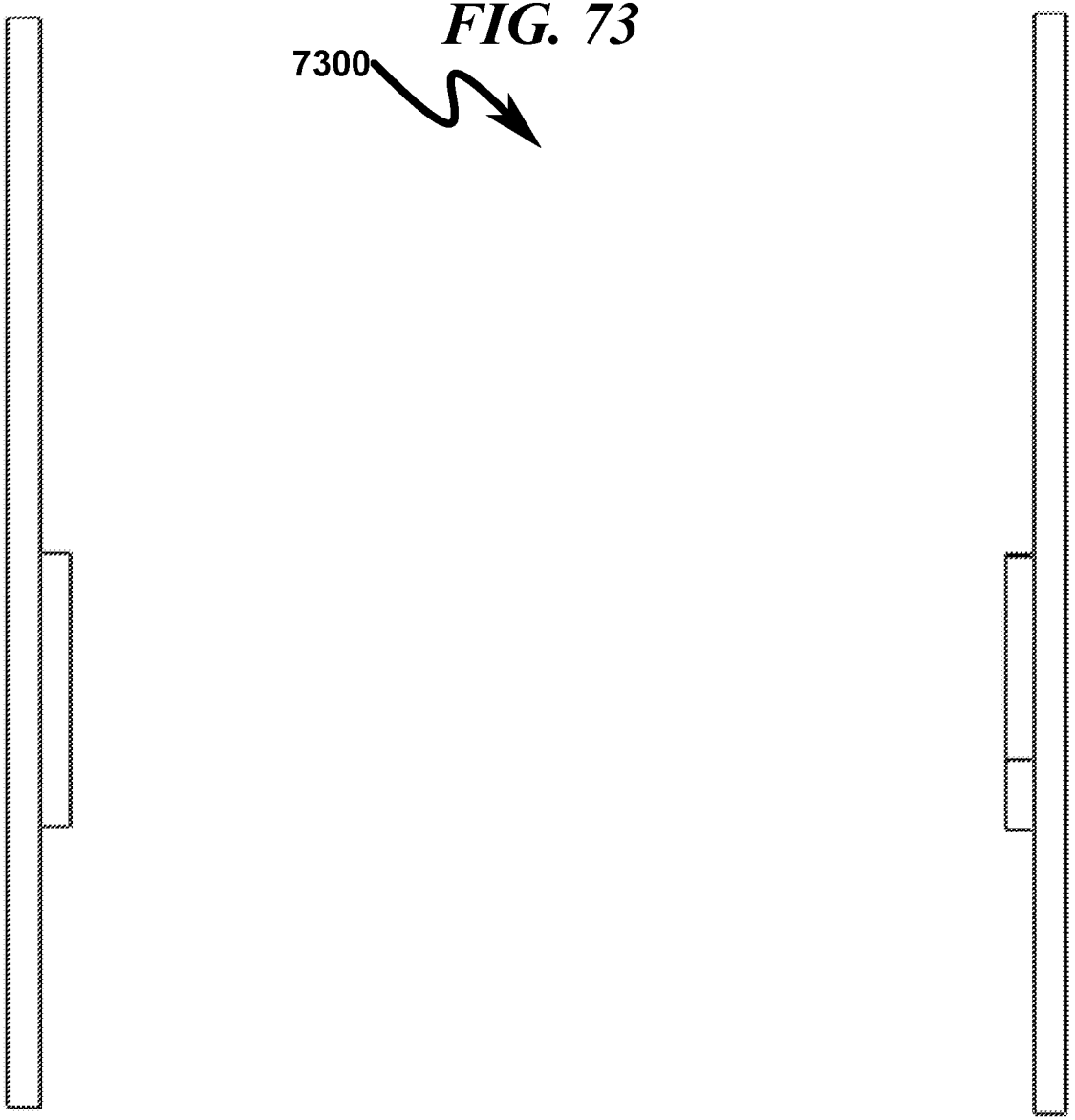
FIG. 73 illustrates front and rear views of a preferred exemplary invention intake rotary valve disc (IVD) system embodiment.
Figure 74:
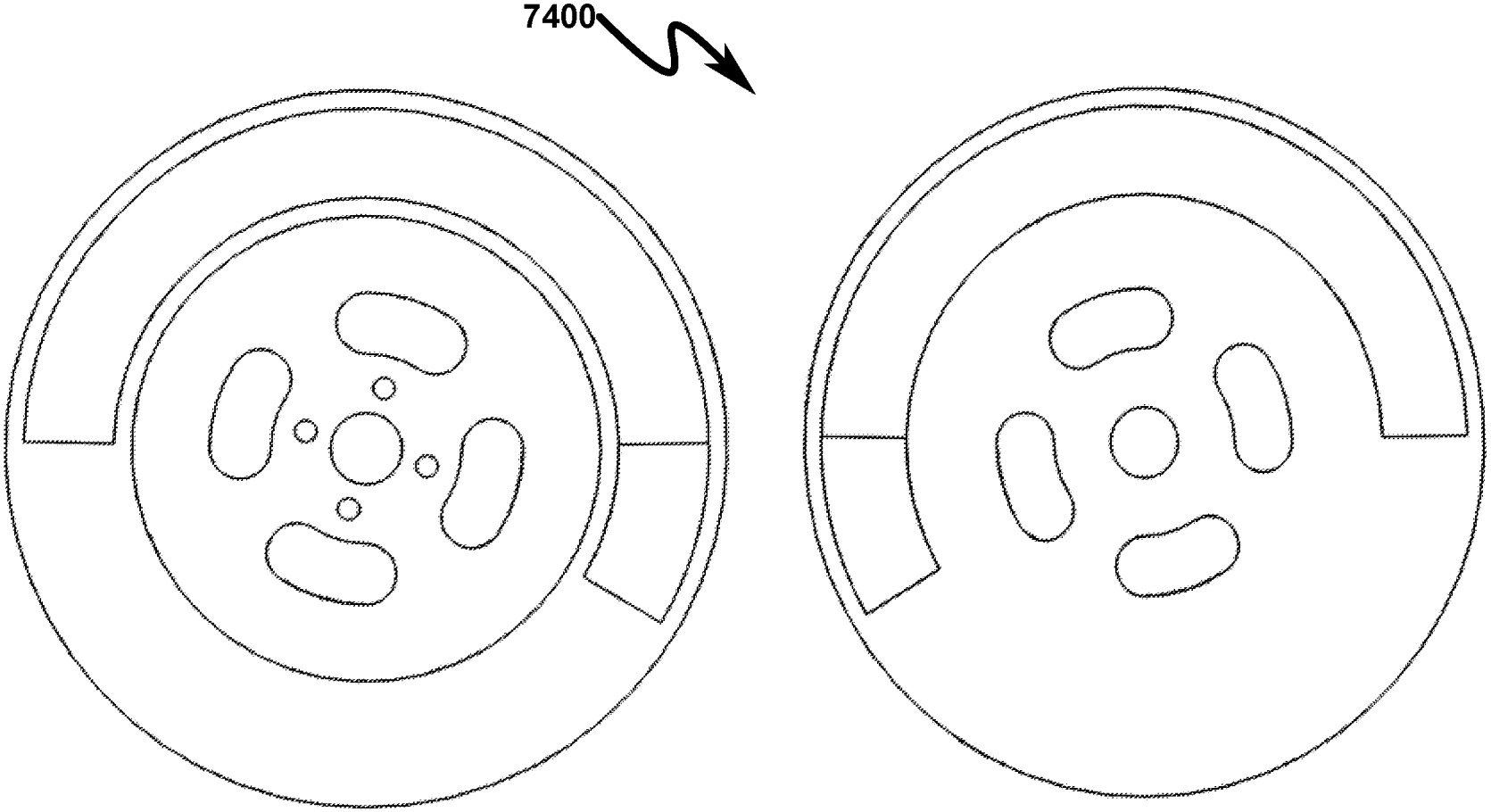
FIG. 74 illustrates left side and right side views of a preferred exemplary invention intake rotary valve disc (IVD) system embodiment.
Figure 76:
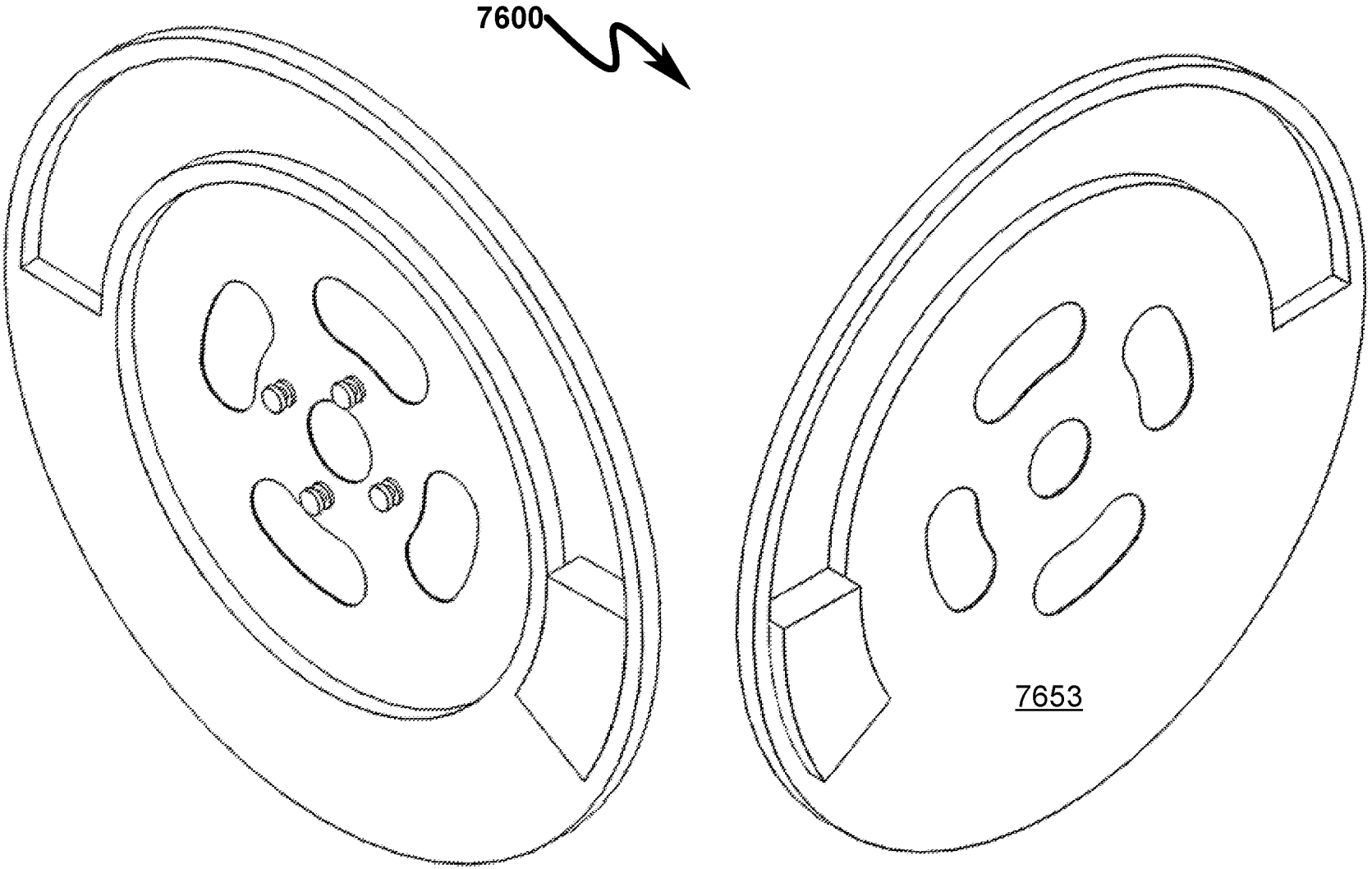
FIG. 76 illustrates top right front and top right rear perspective detail views of a preferred exemplary invention intake rotary valve disc (IVD) system embodiment.
Figure 77:
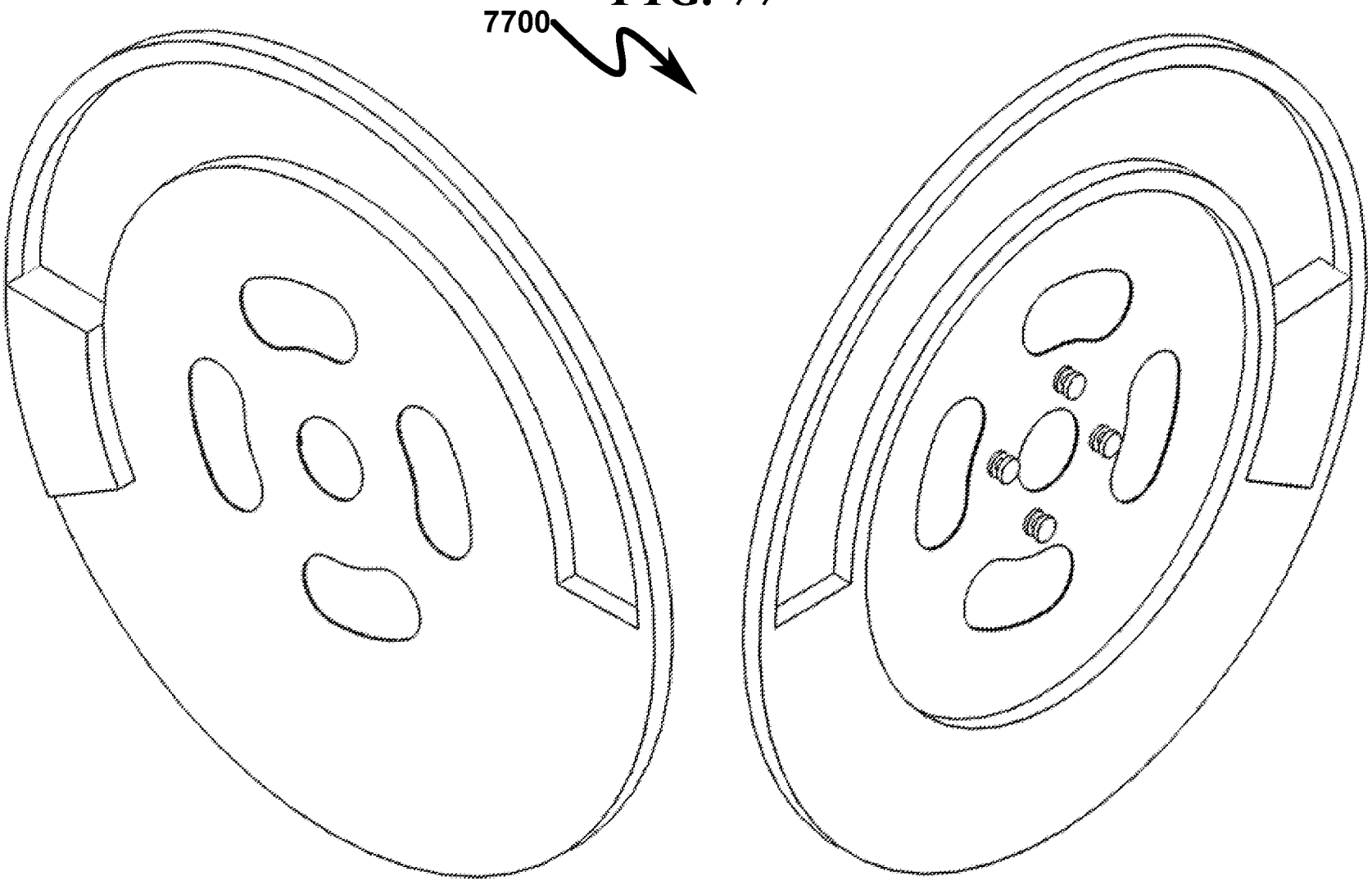
FIG. 77 illustrates top left rear and top left front perspective detail views of a preferred exemplary invention intake rotary valve disc (IVD) system embodiment.
Figure 78:
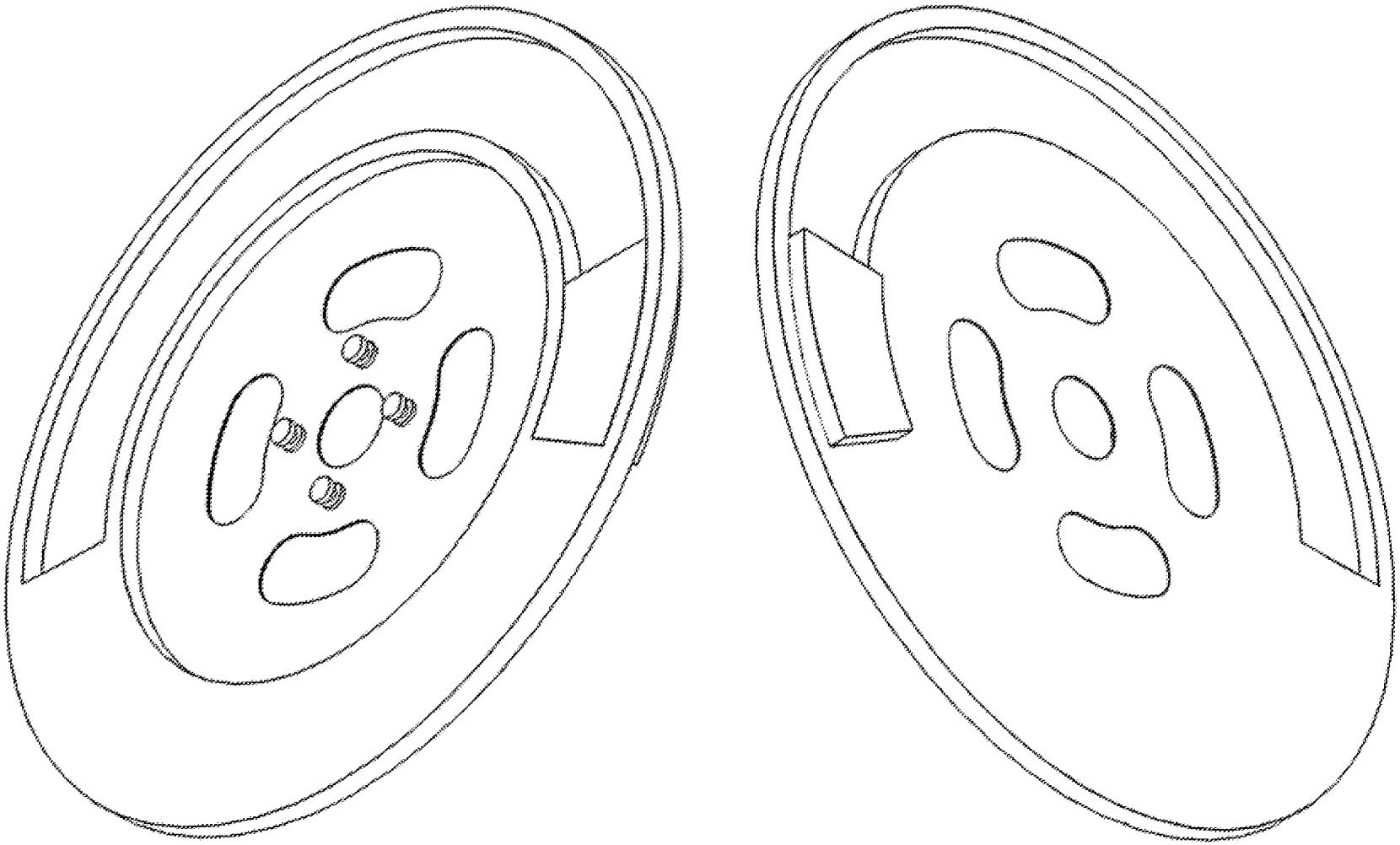
FIG. 78 illustrates bottom right front and bottom right rear perspective detail views of a preferred exemplary invention intake rotary valve disc (IVD) system embodiment.
Figure 79:
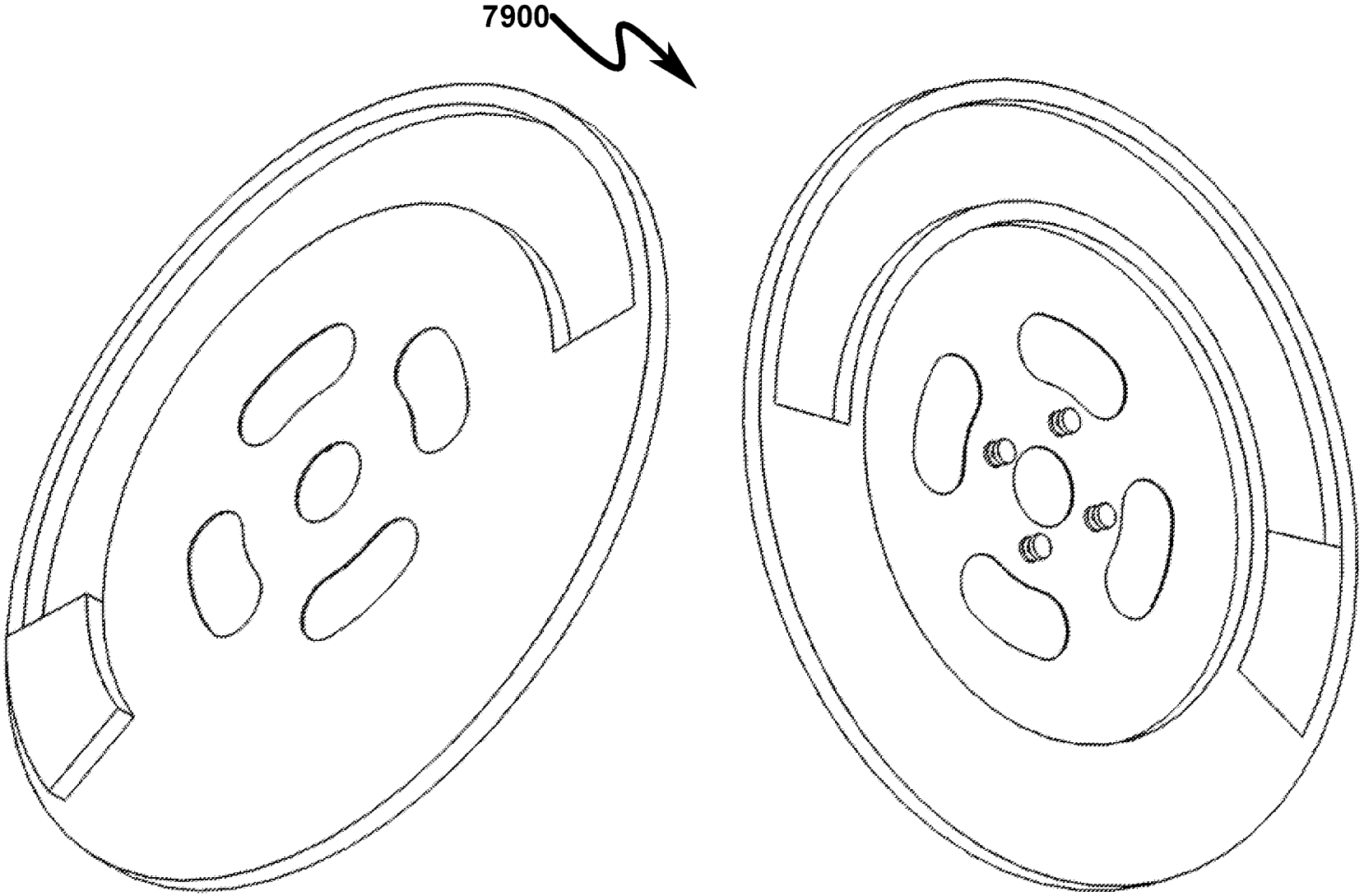
FIG. 79 illustrates bottom left rear and bottom left front perspective detail views of a preferred exemplary invention intake rotary valve disc (IVD) system embodiment.
Figure 80:
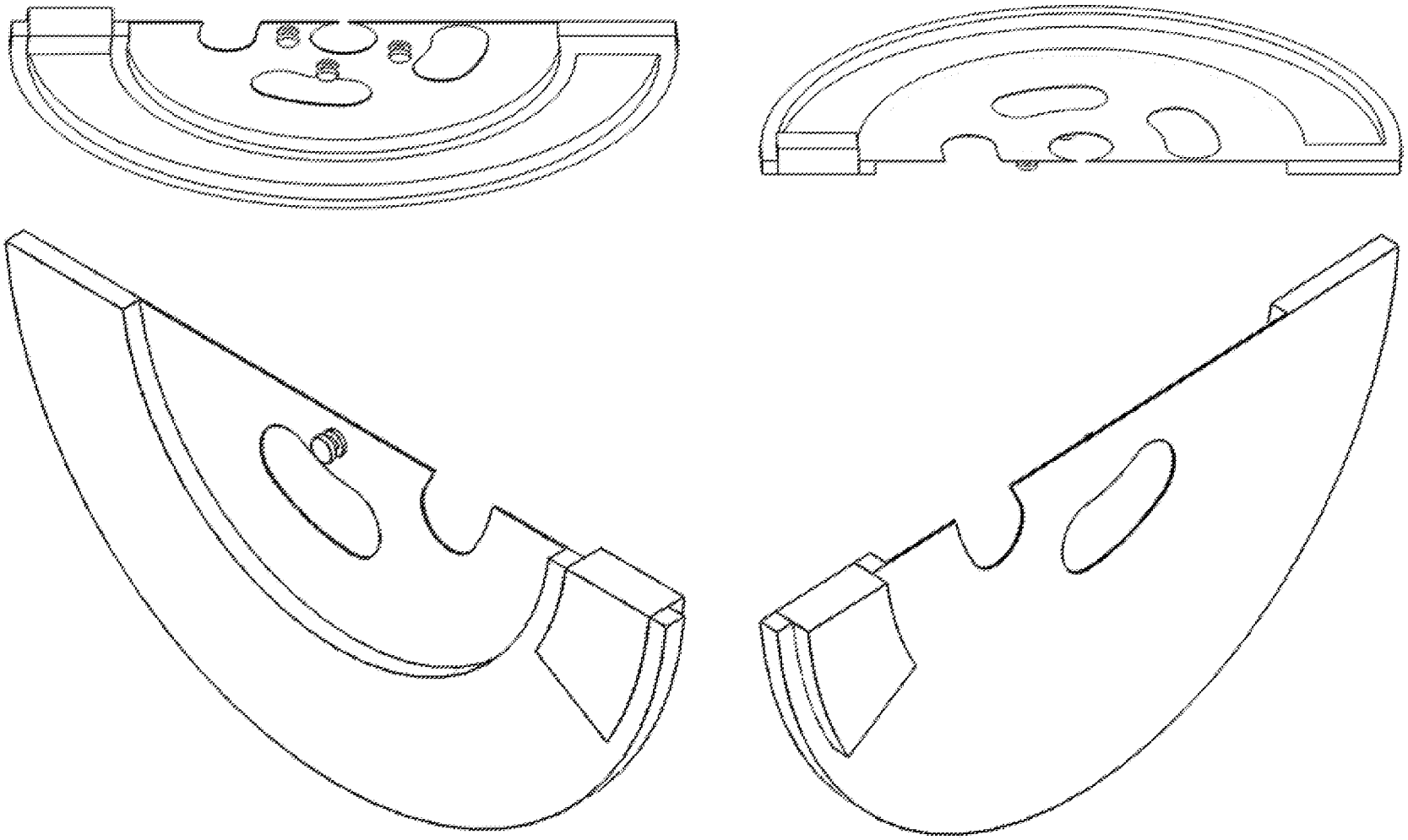
FIG. 80 illustrates various perspective section detail views of a preferred exemplary invention intake rotary valve disc (IVD) system embodiment.
Figure 81:
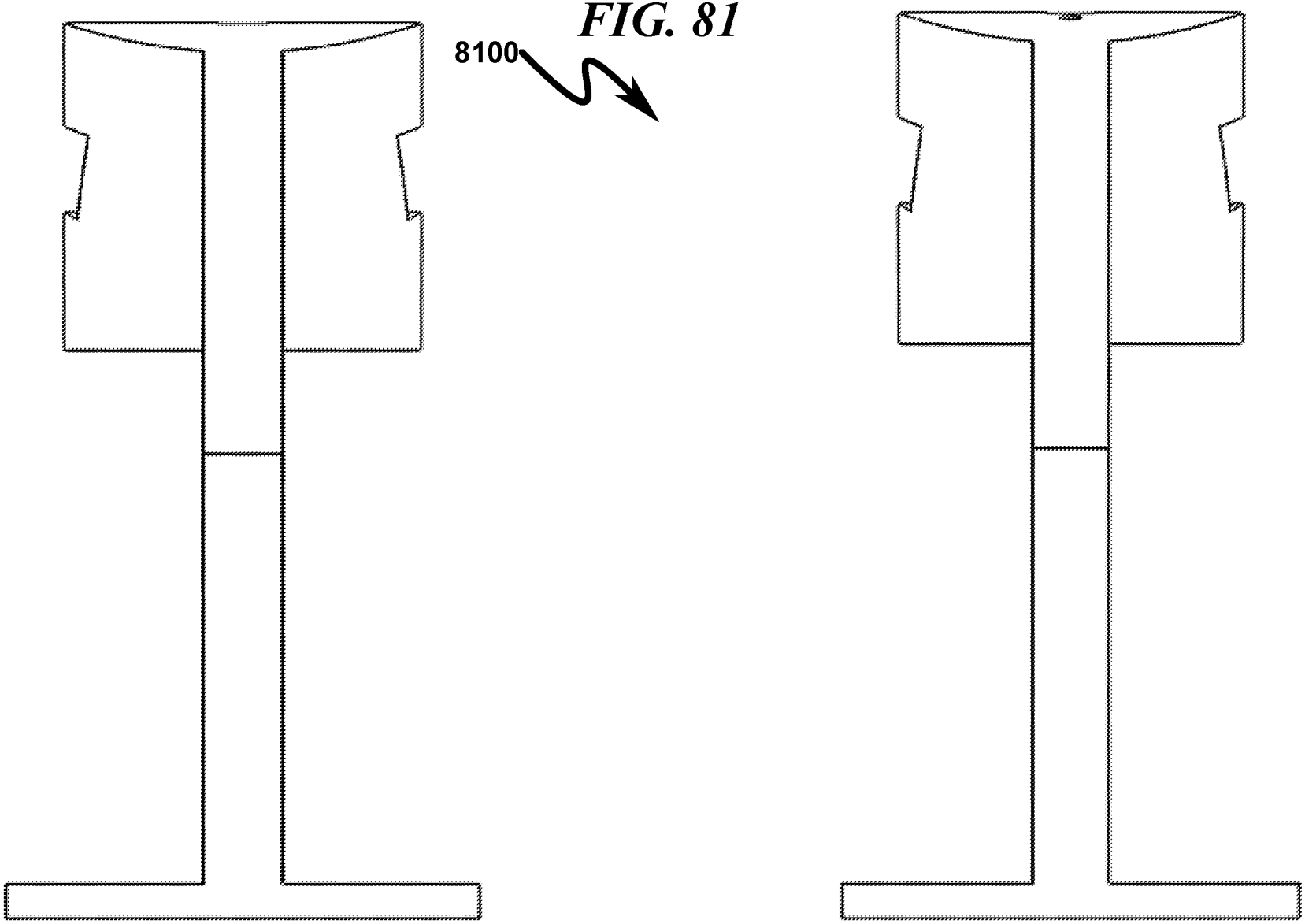
Figure 82:
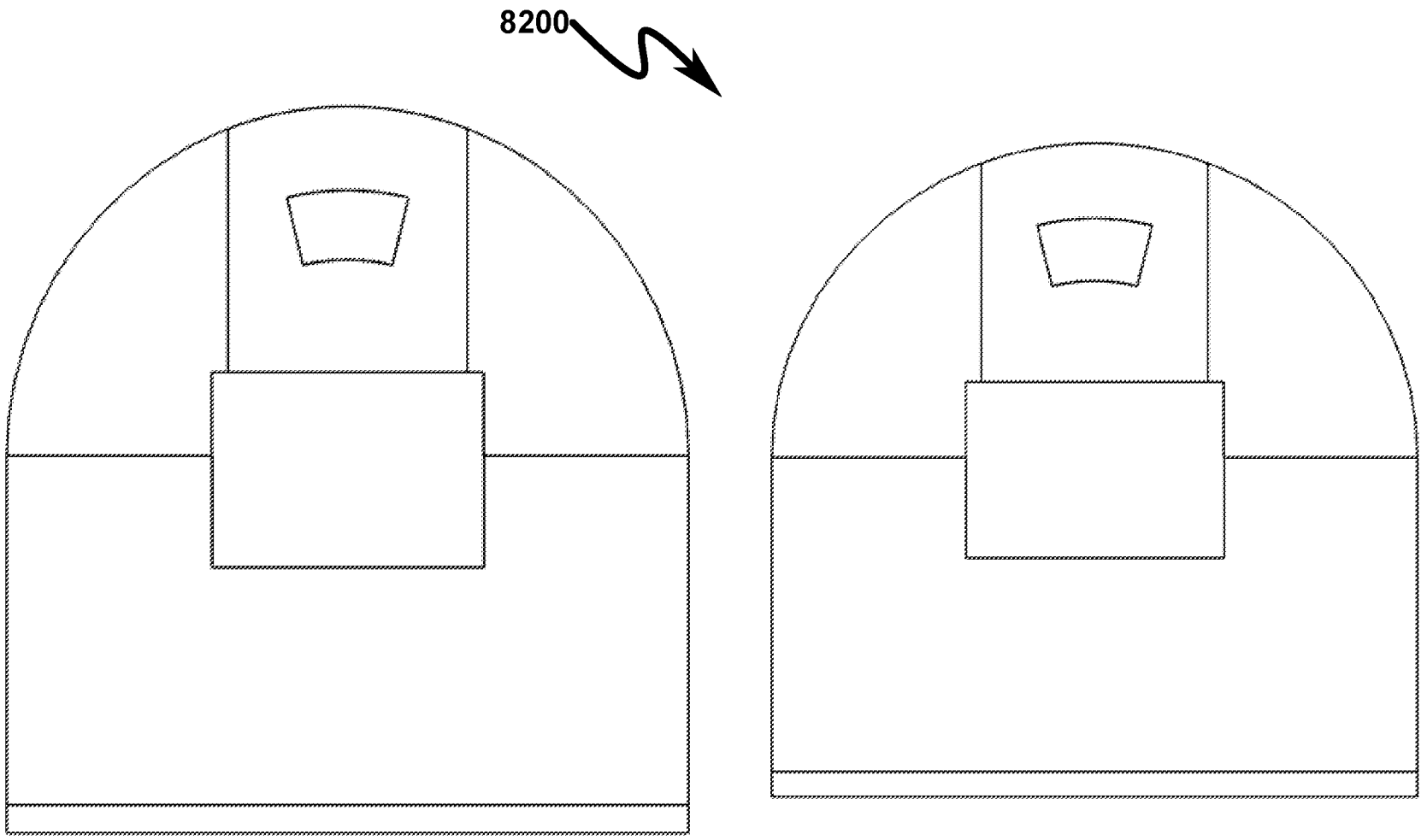
Figure 83:
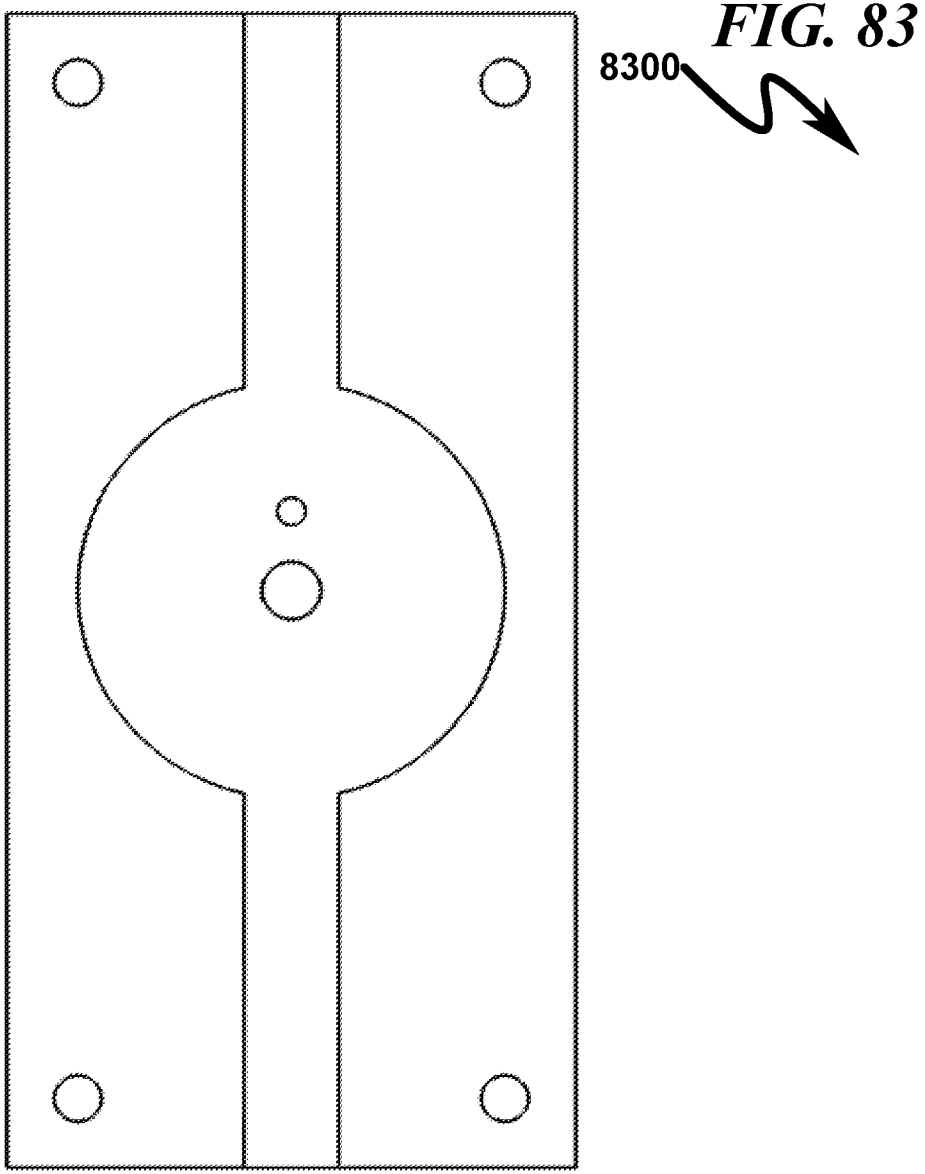
Figure 84:
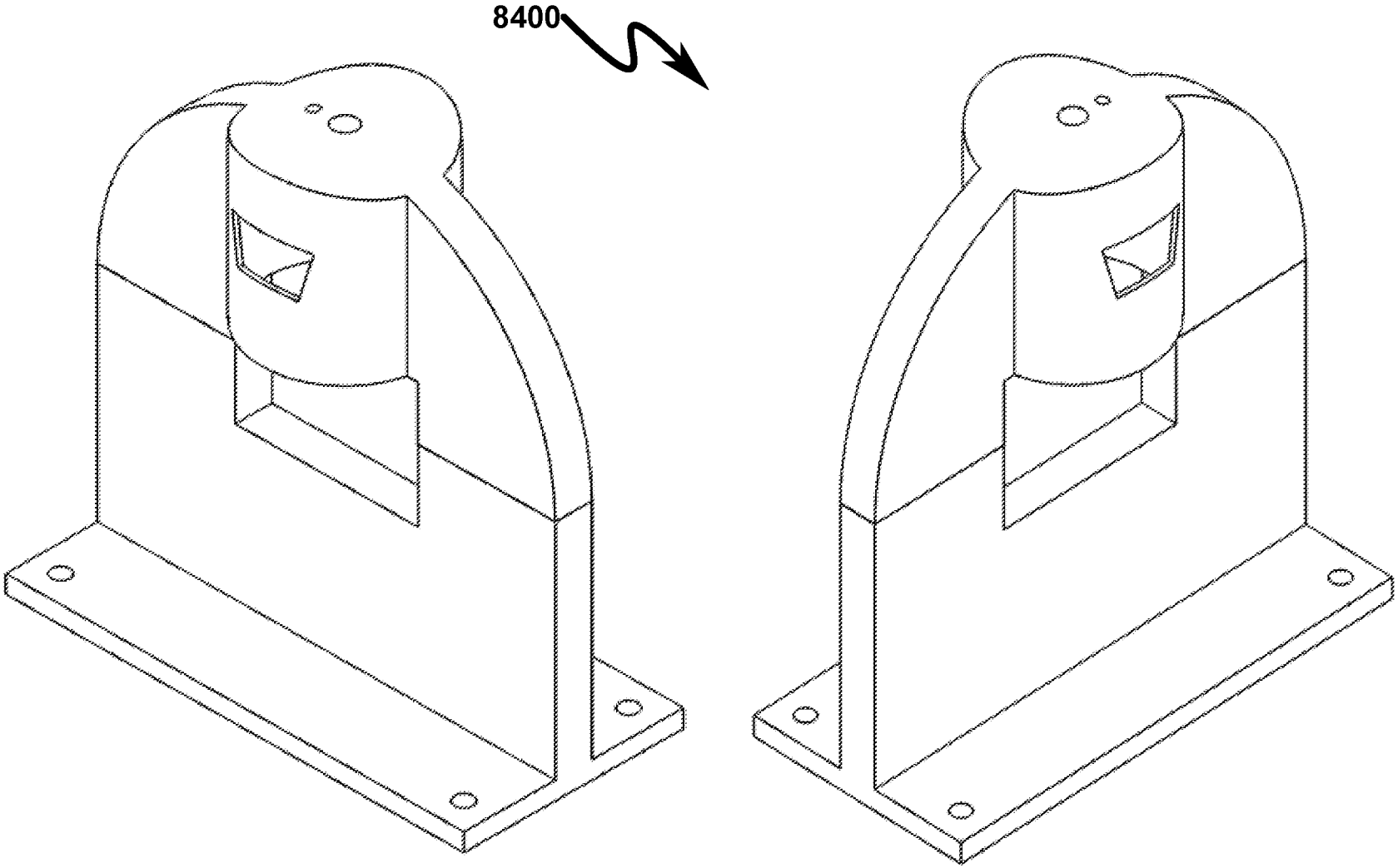
Figure 85:
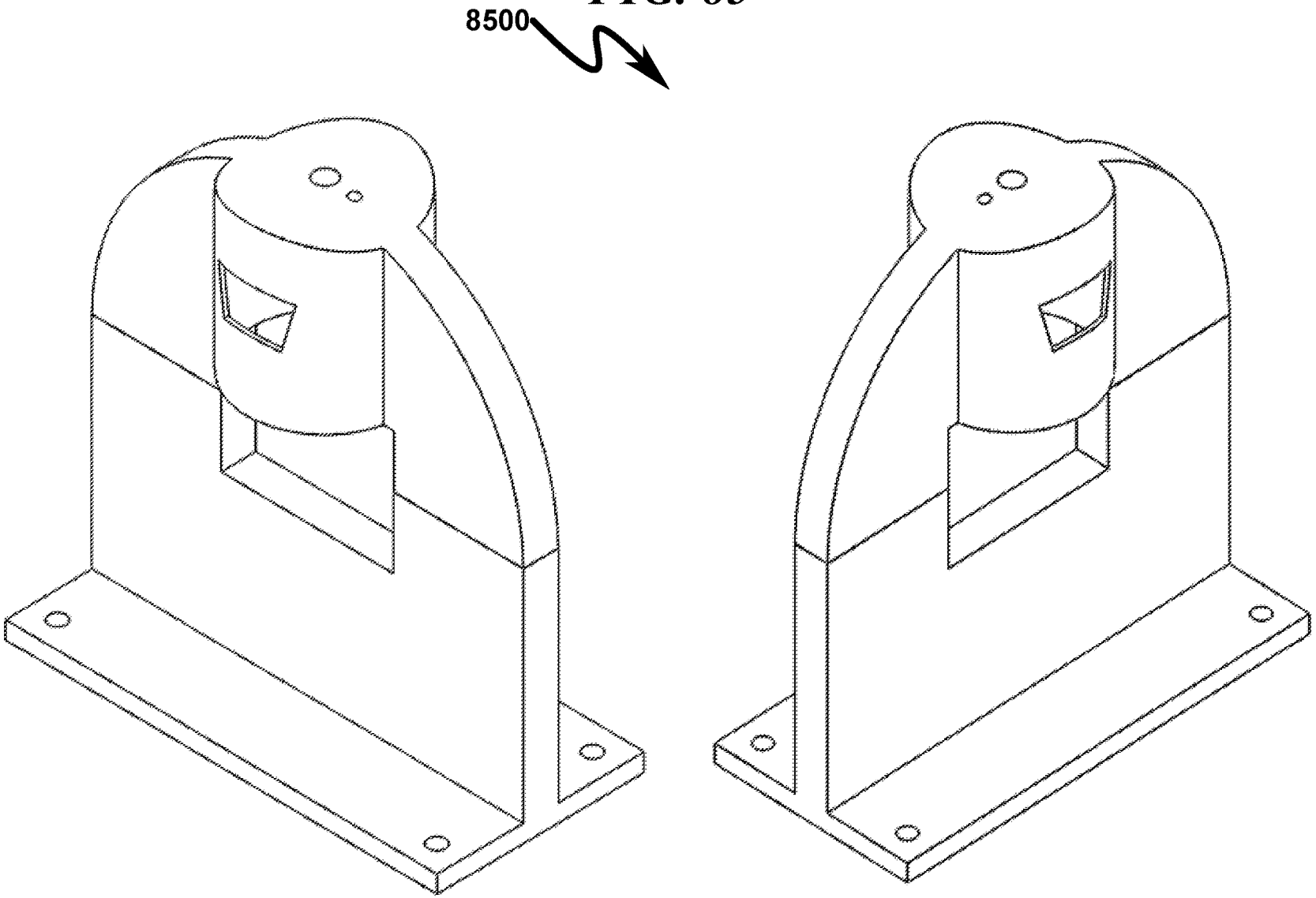
Figure 86:
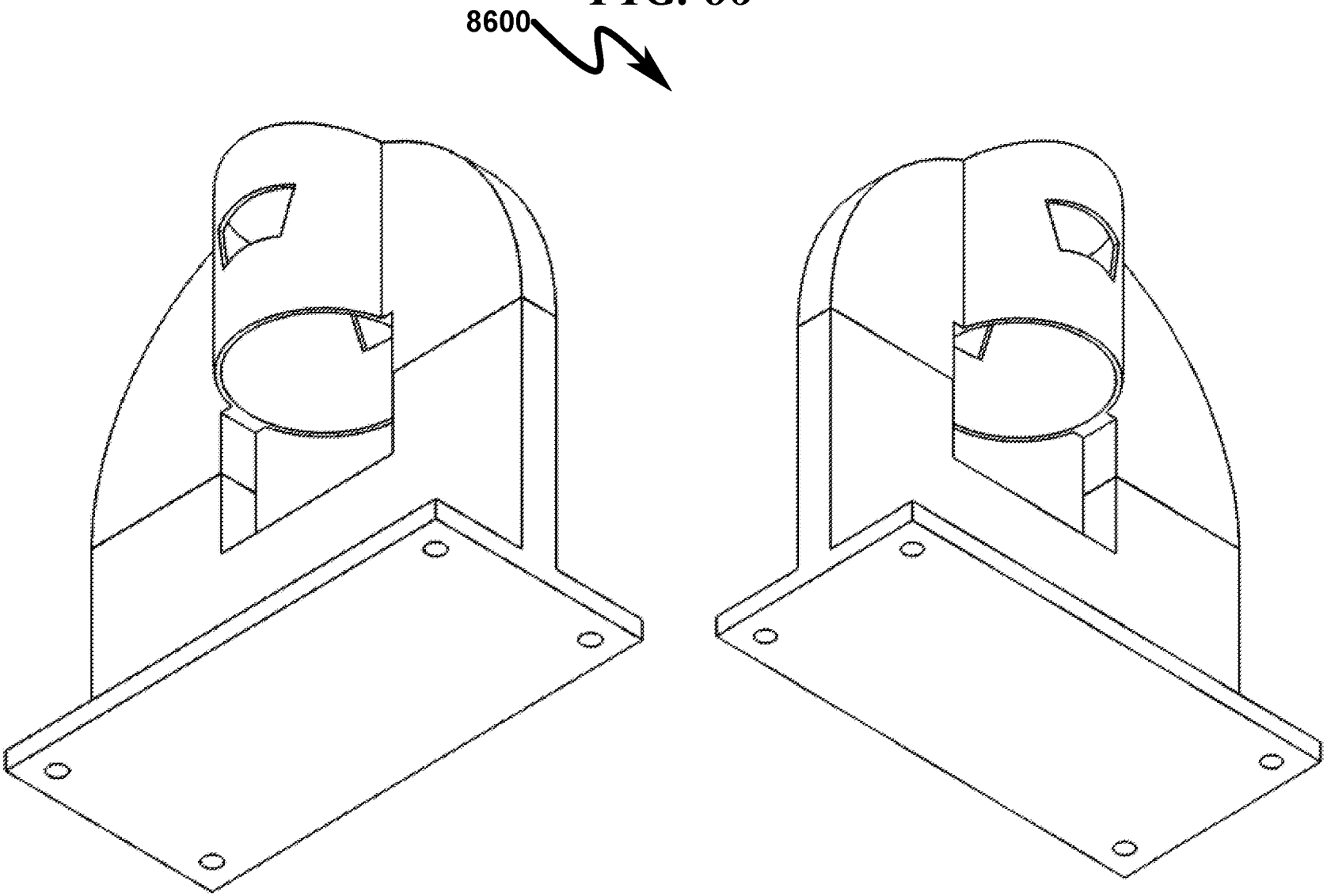
Figure 87:
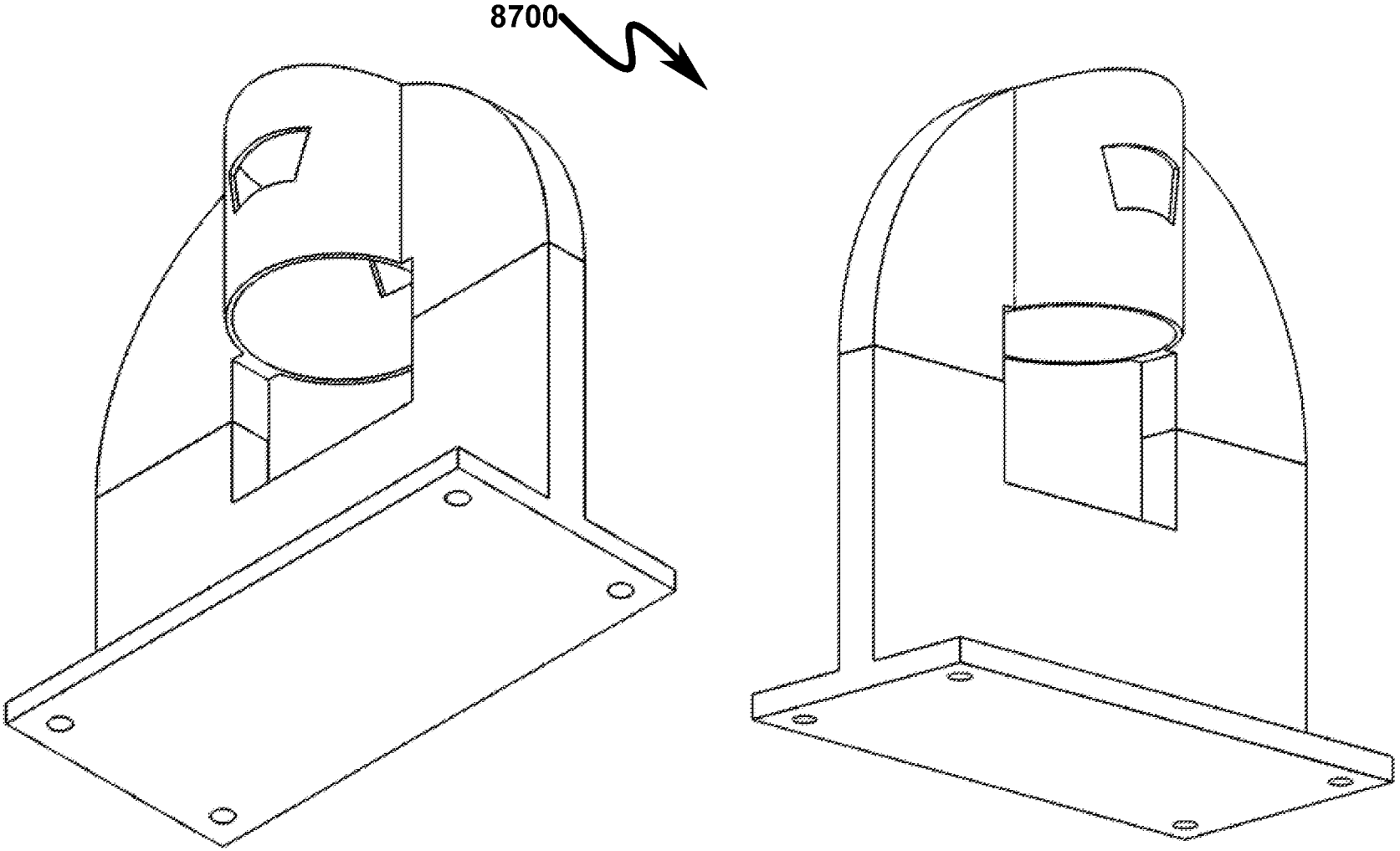
Figure 88:
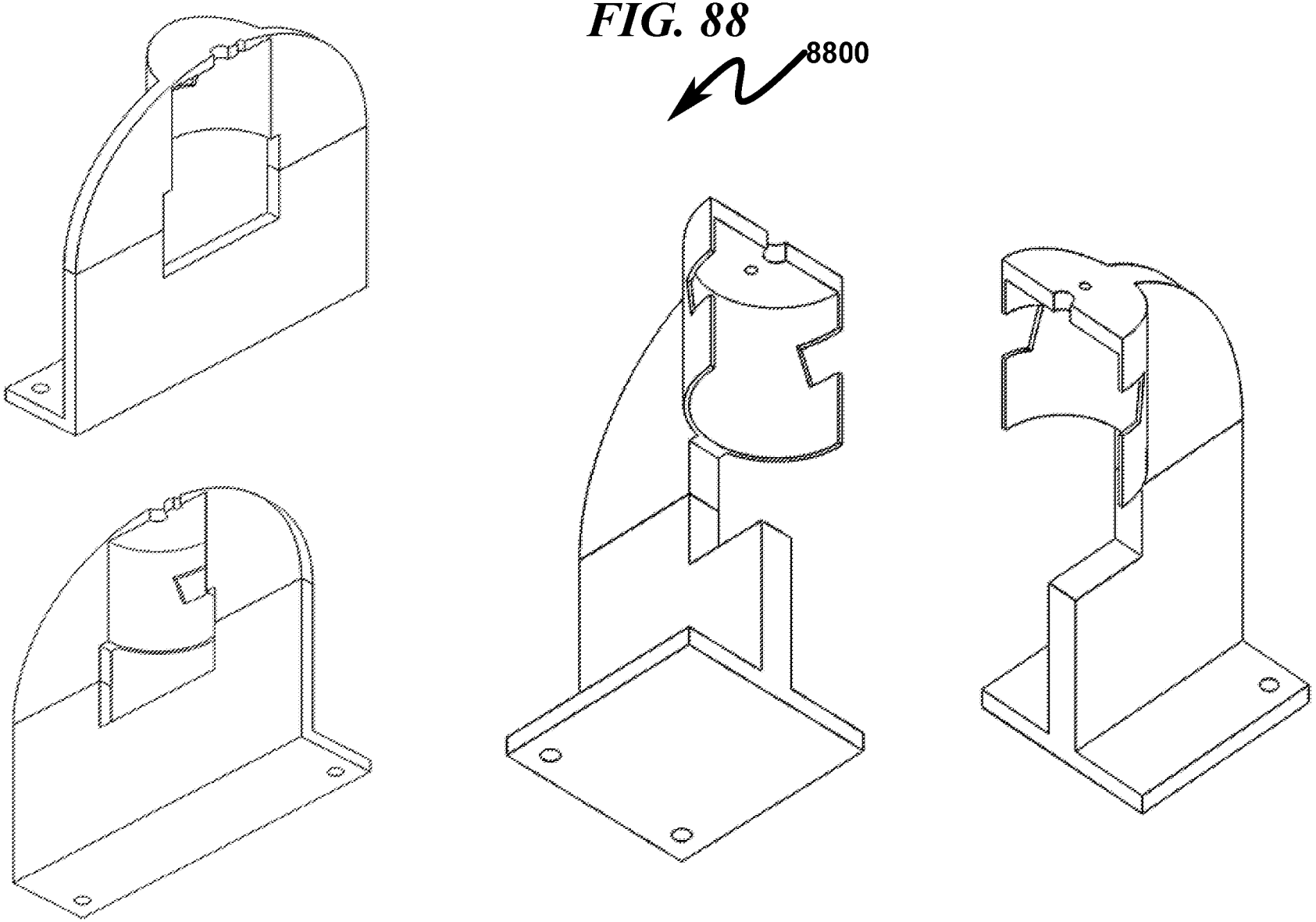
Figure 89:
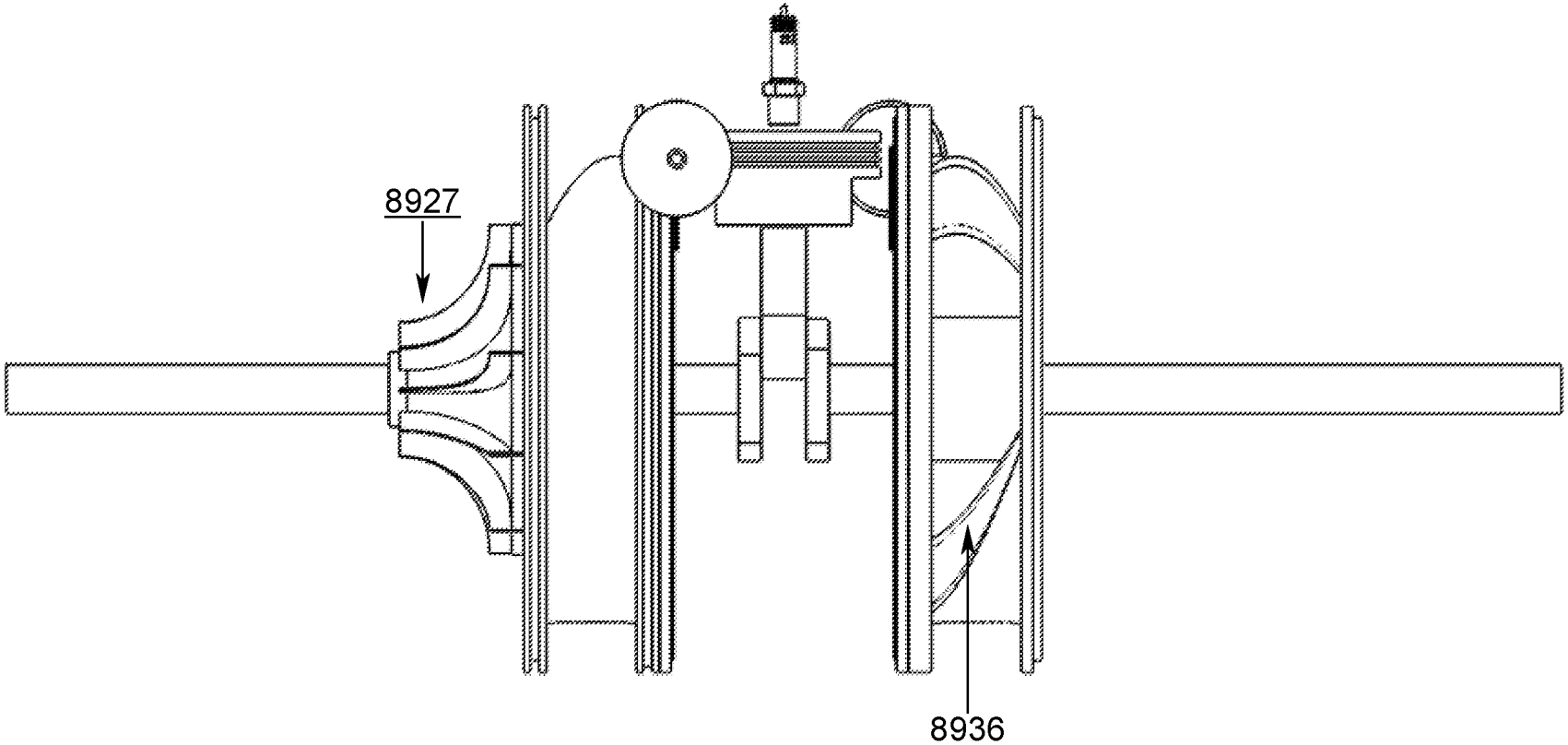
Figure 90:
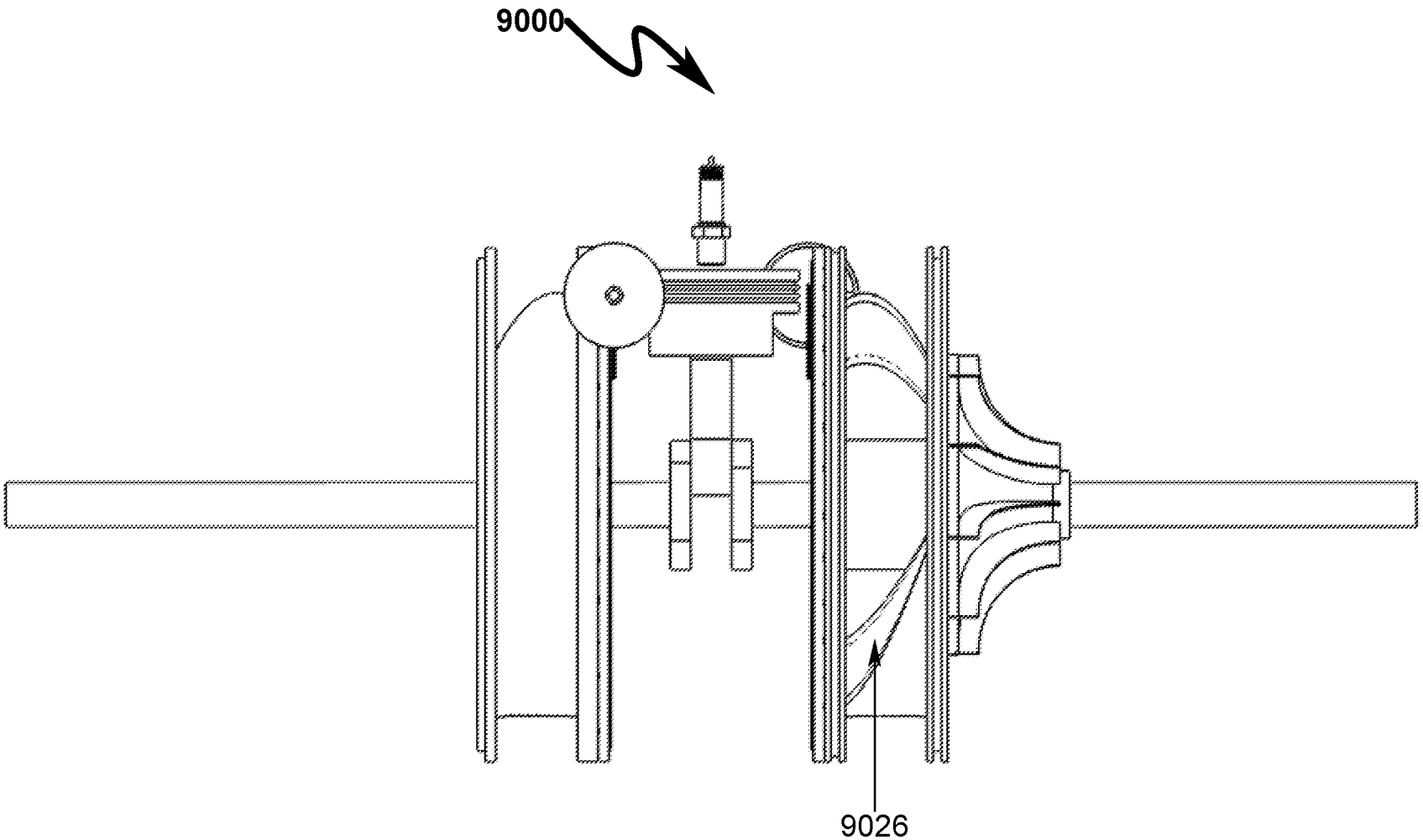
Figure 91:
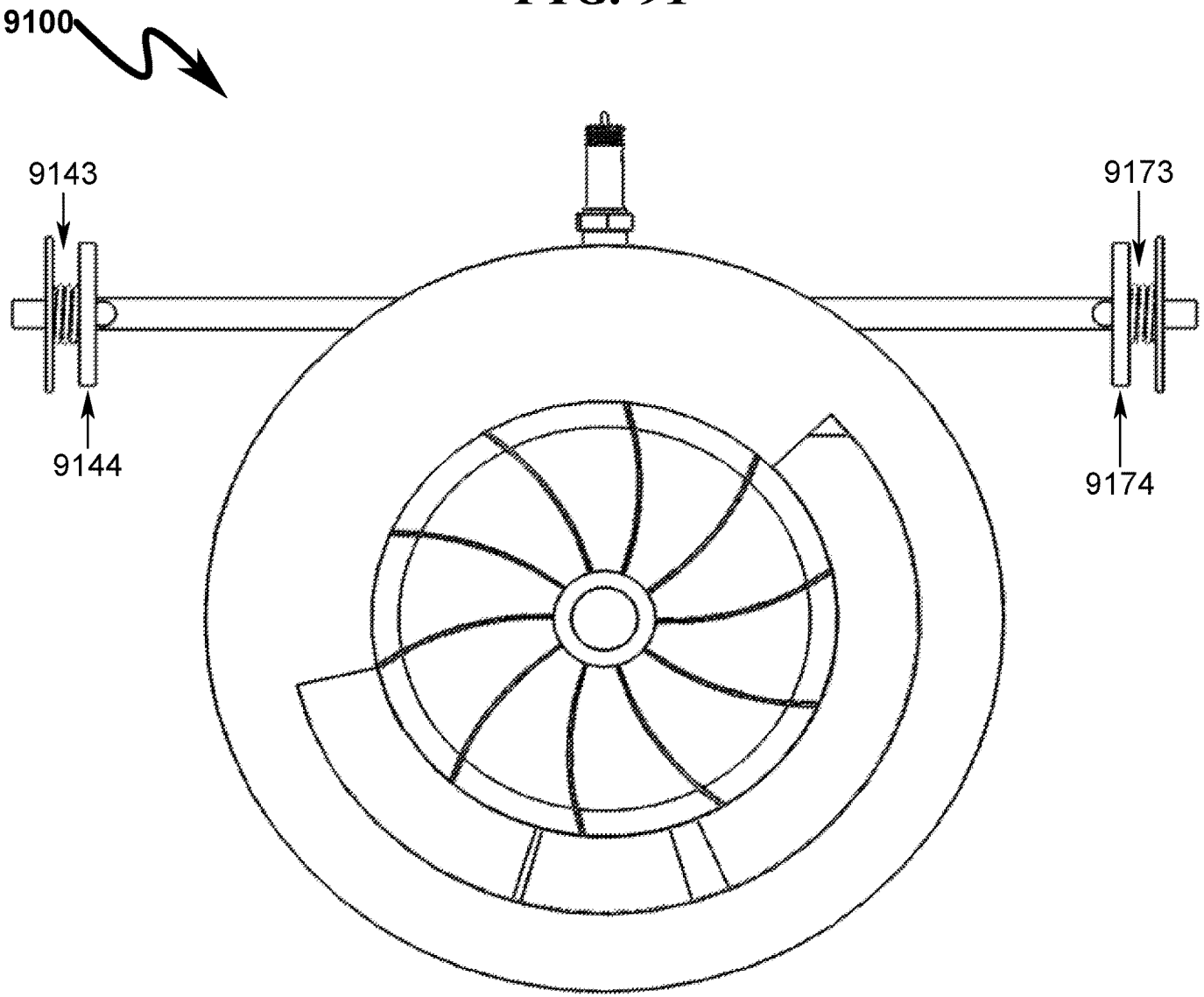
Figure 92:
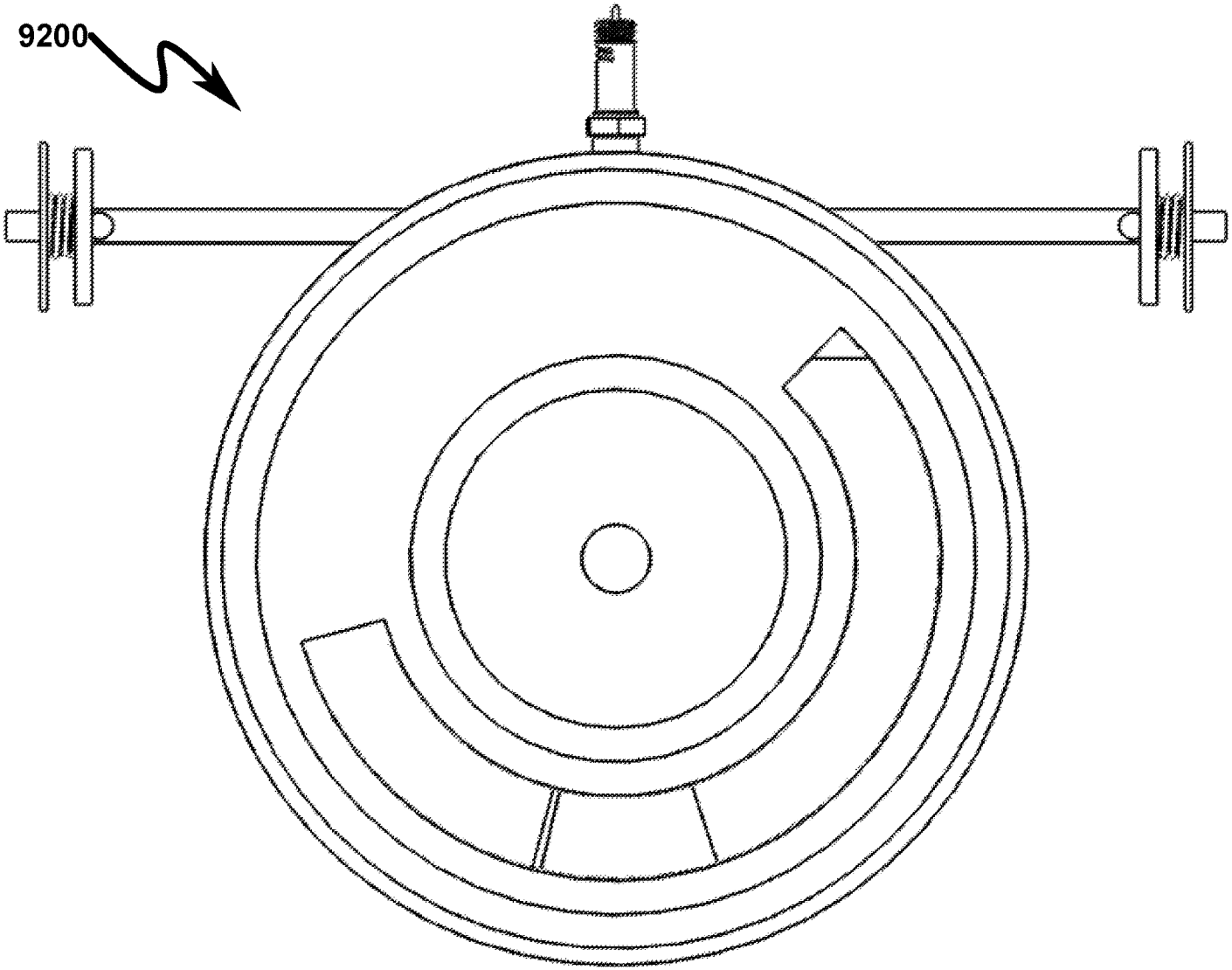
Figure 93:
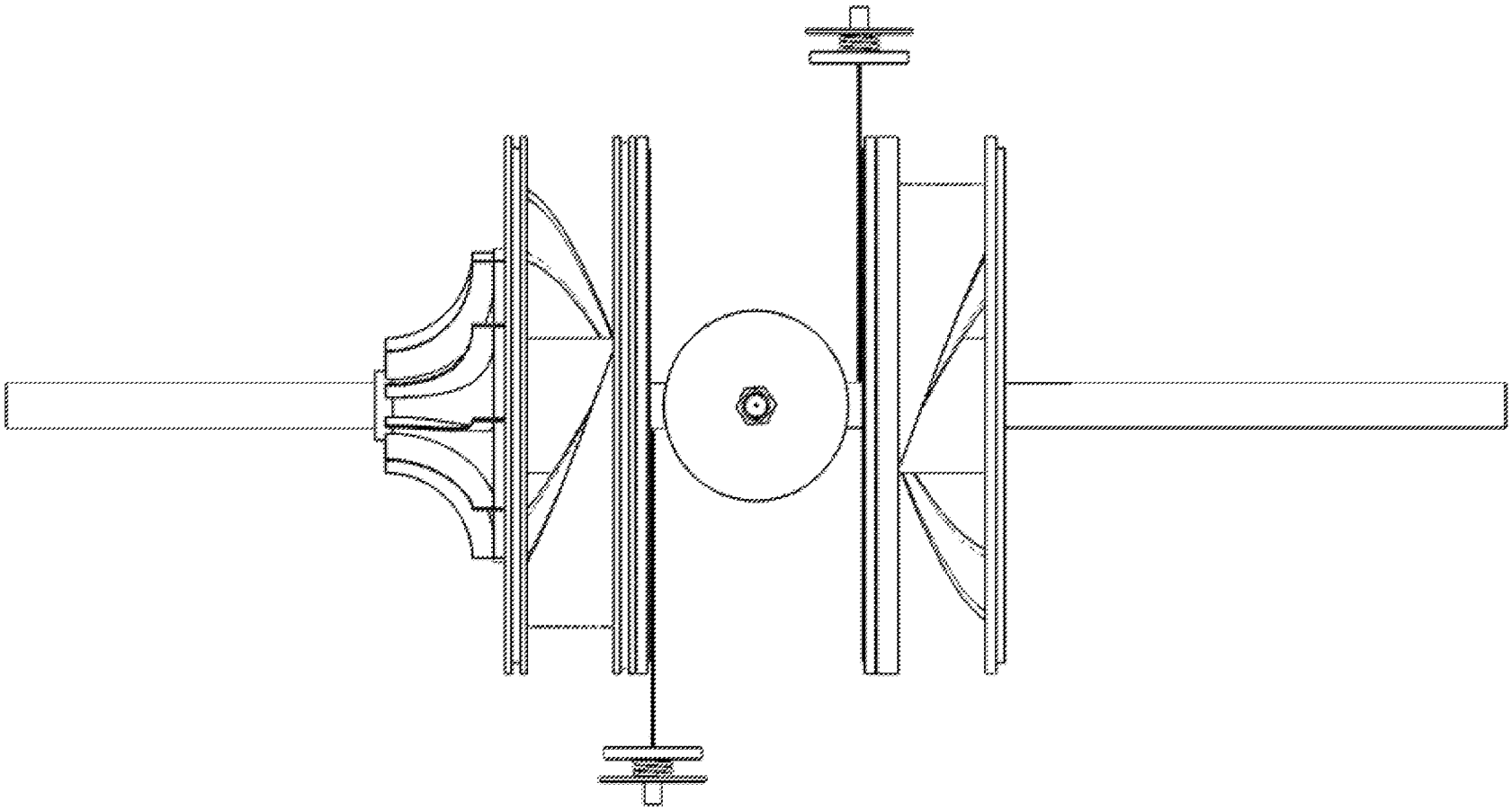
Figure 94:
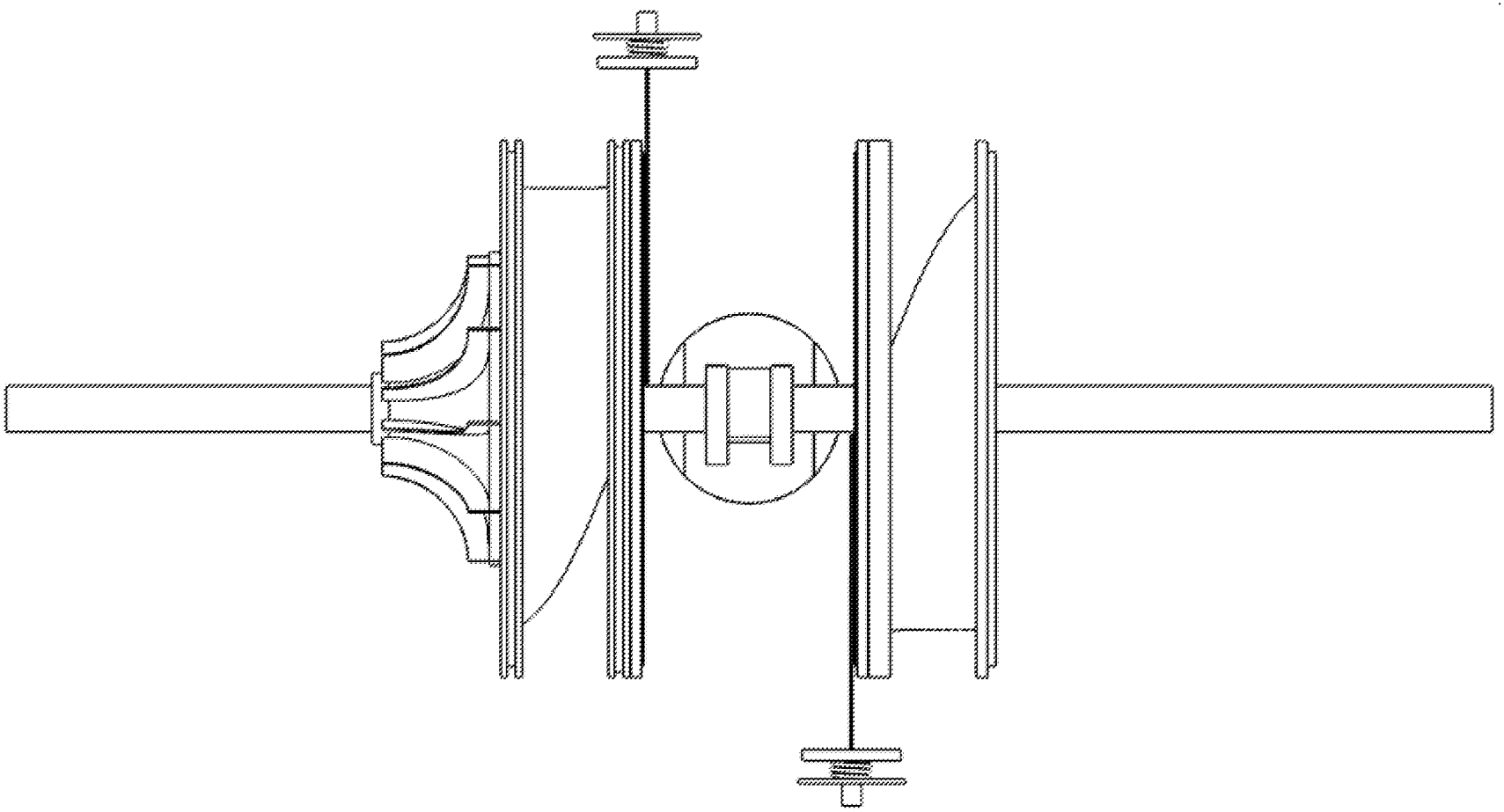
Figure 95:
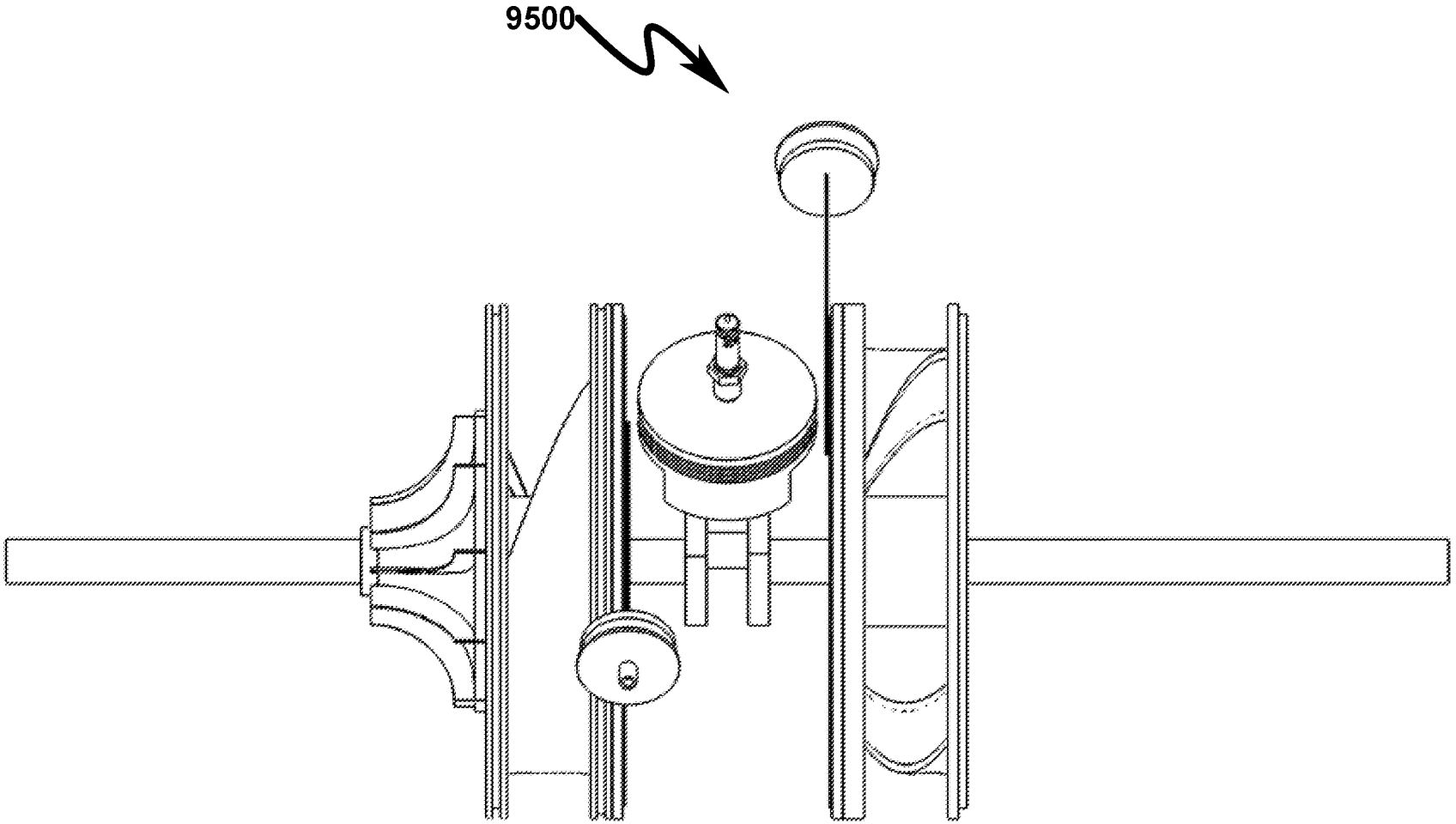
Figure 96:
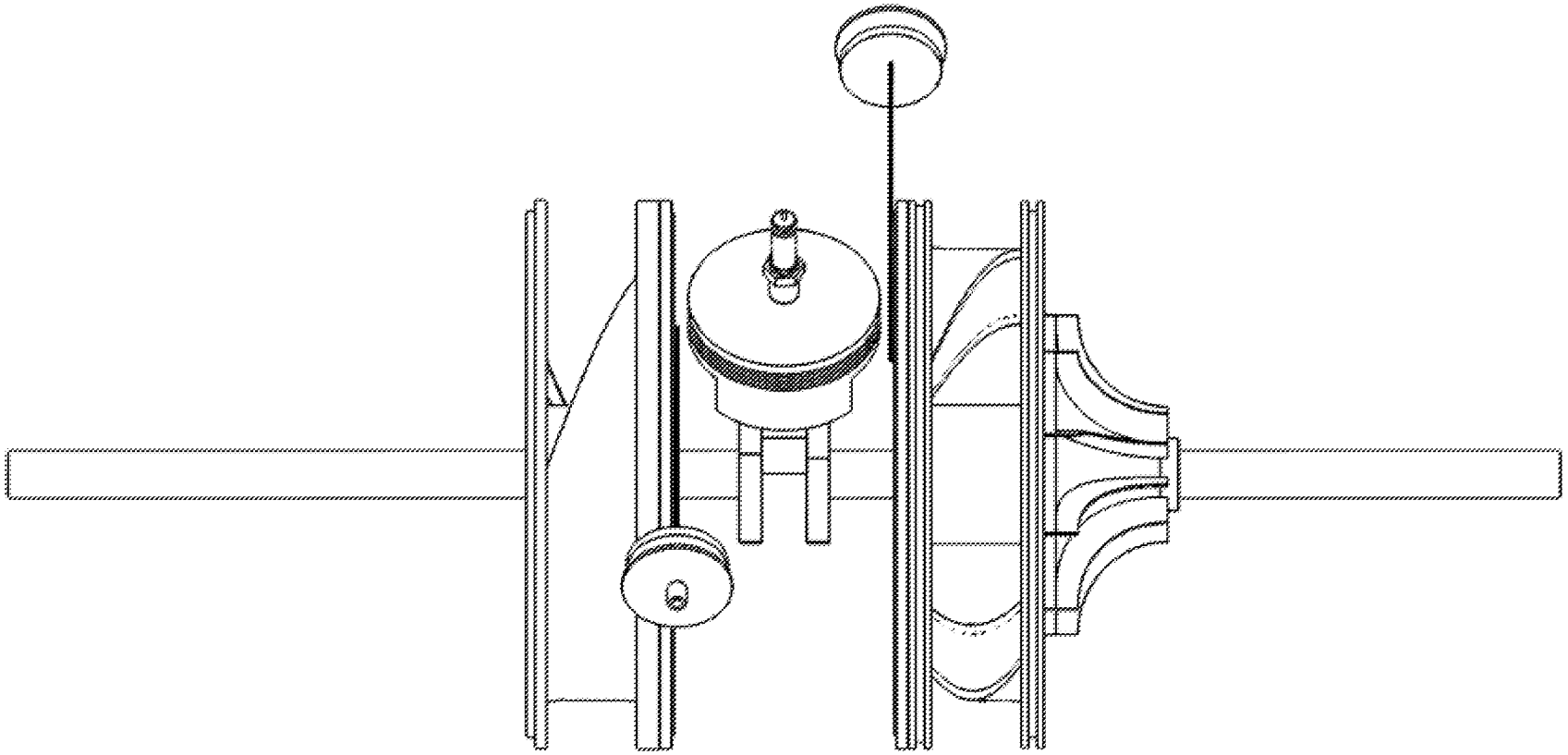
Figure 97:
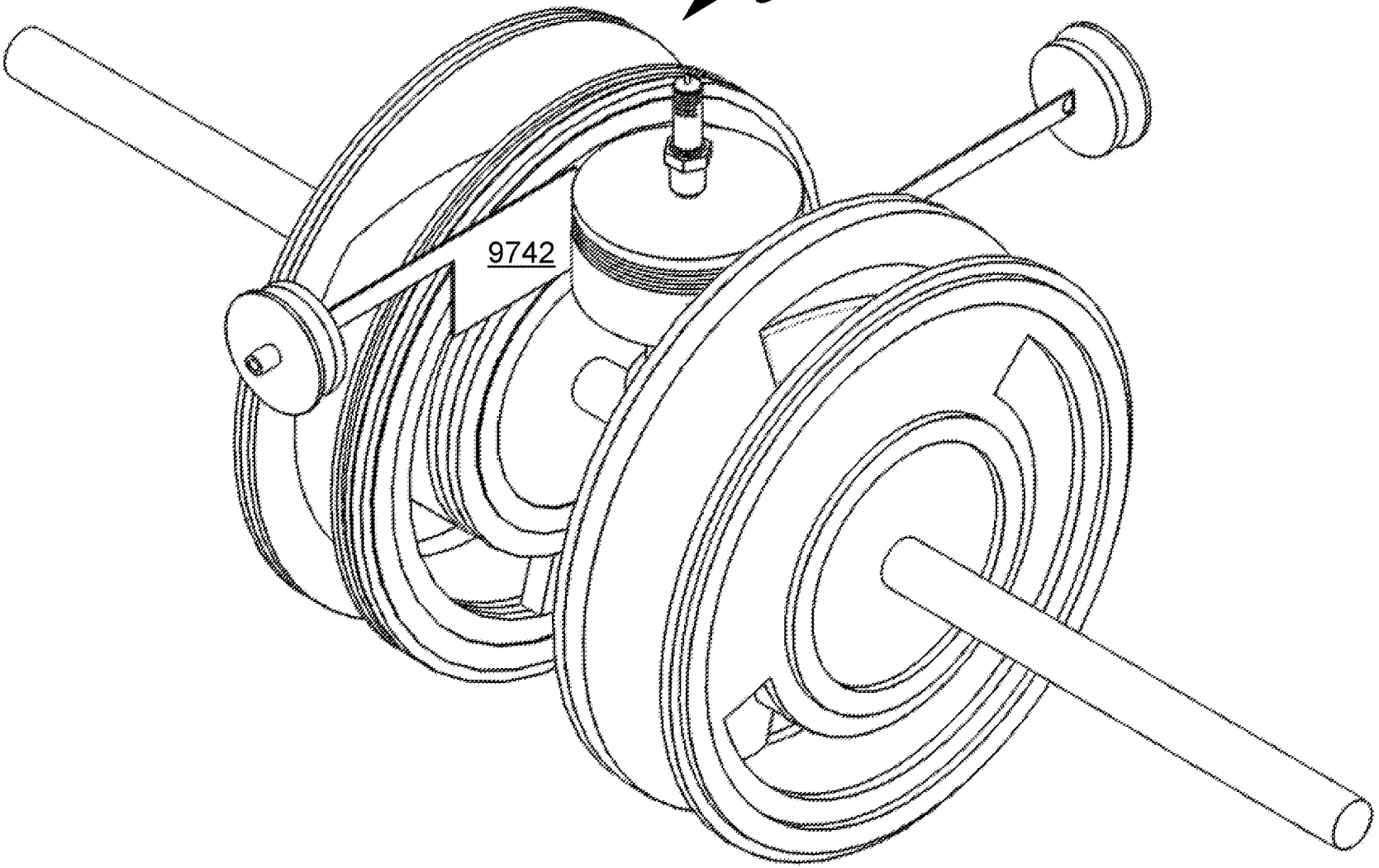
Figure 98:
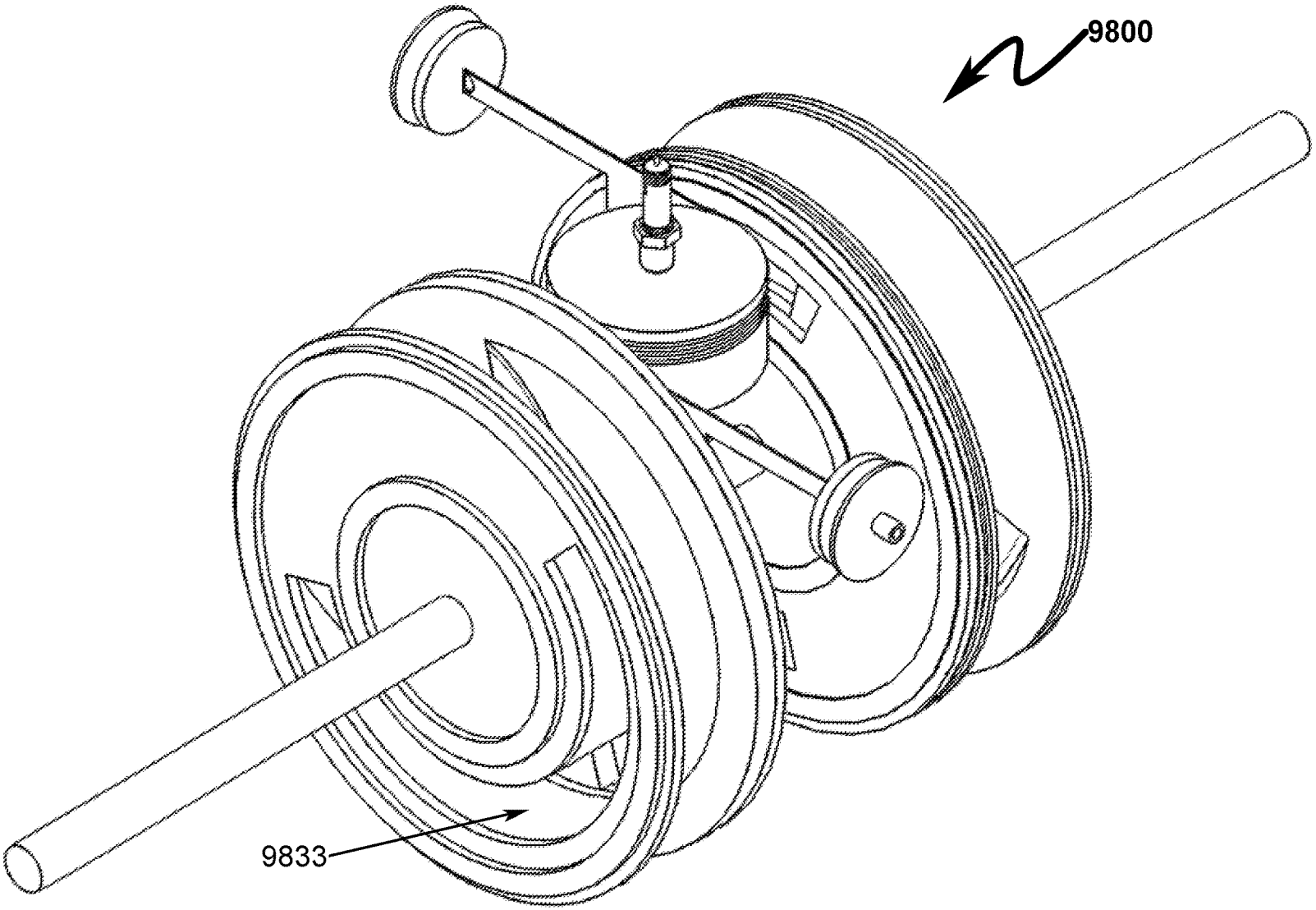
Figure 99:
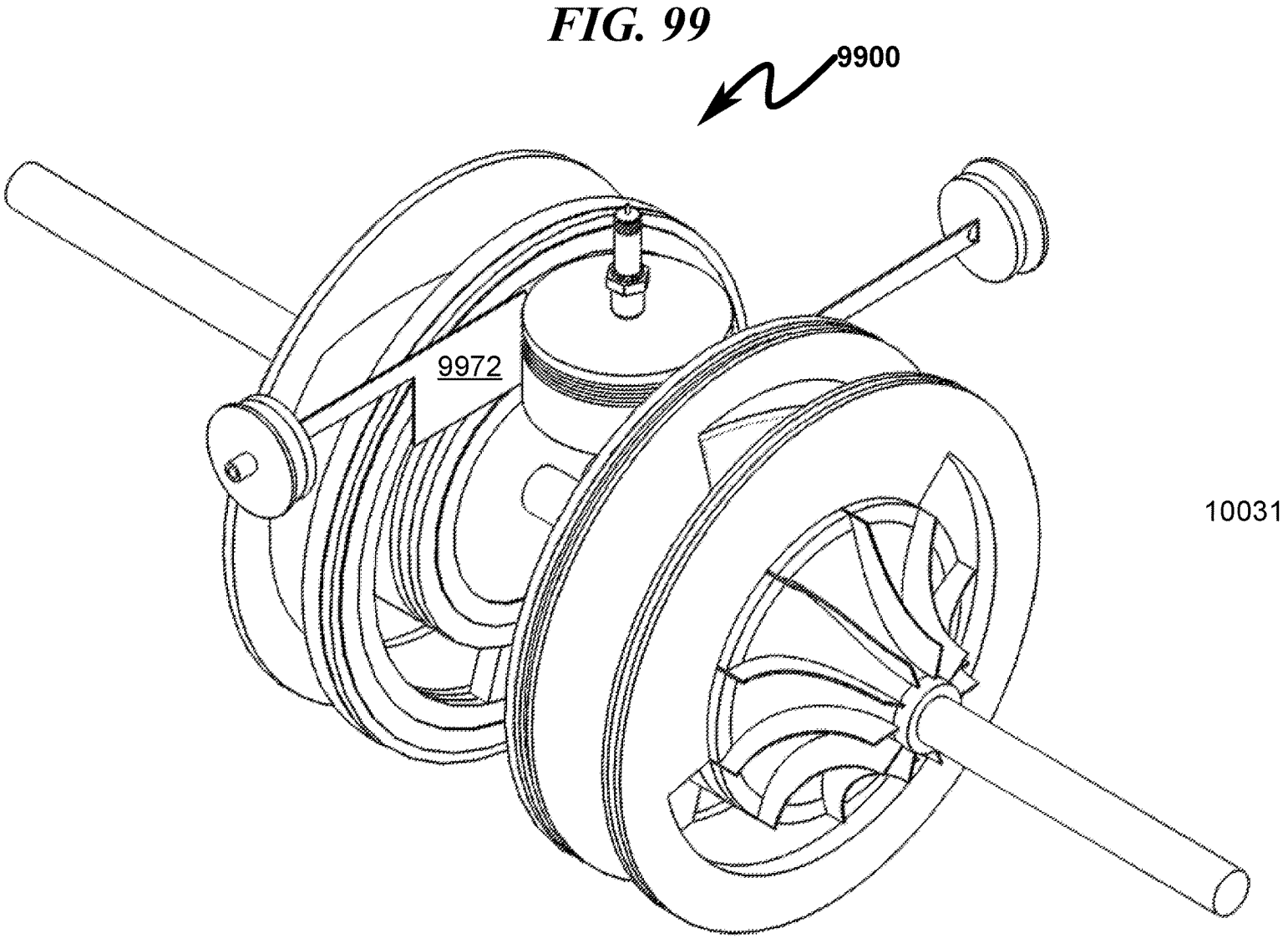
Figure 100:
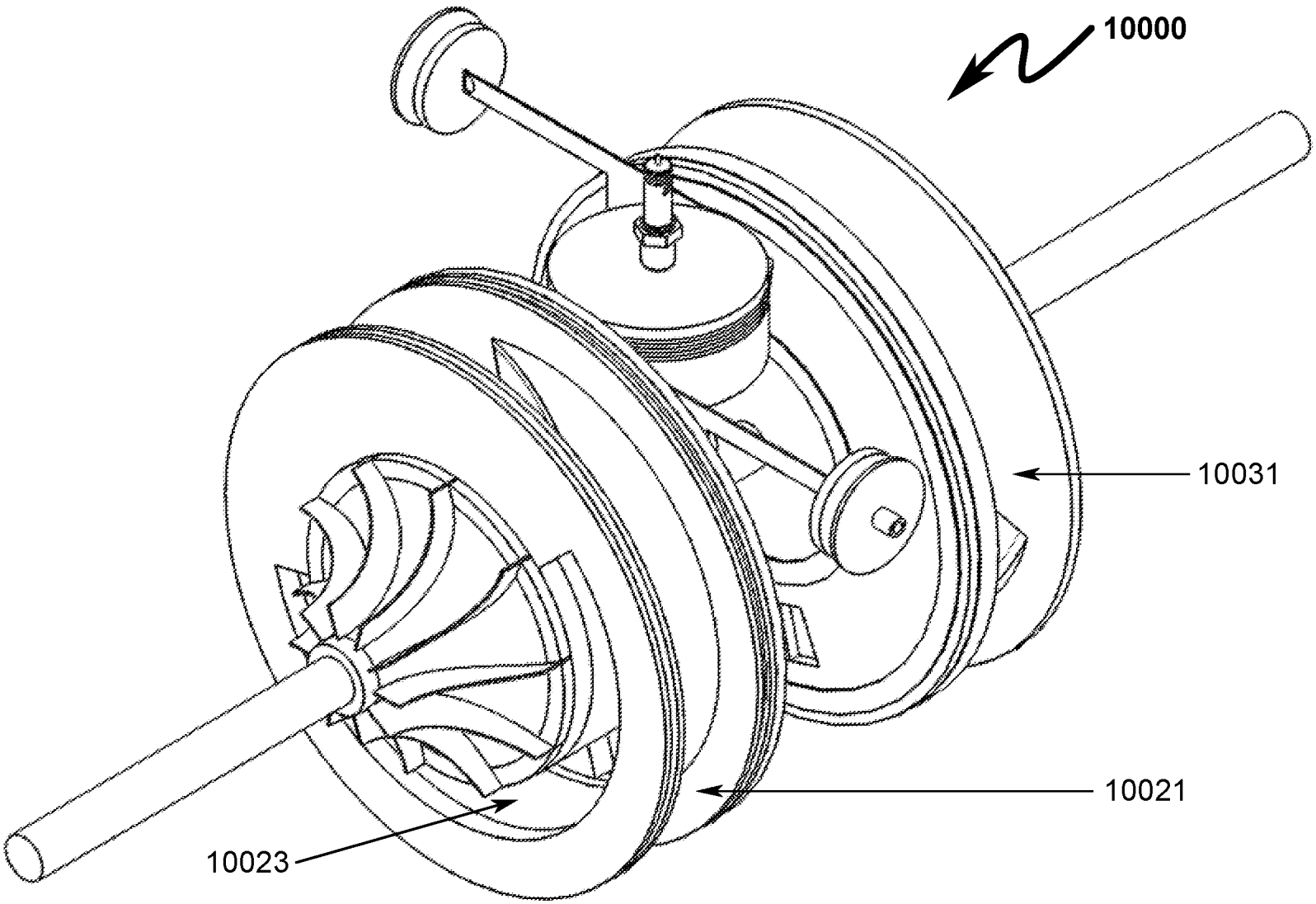
Figure 101:
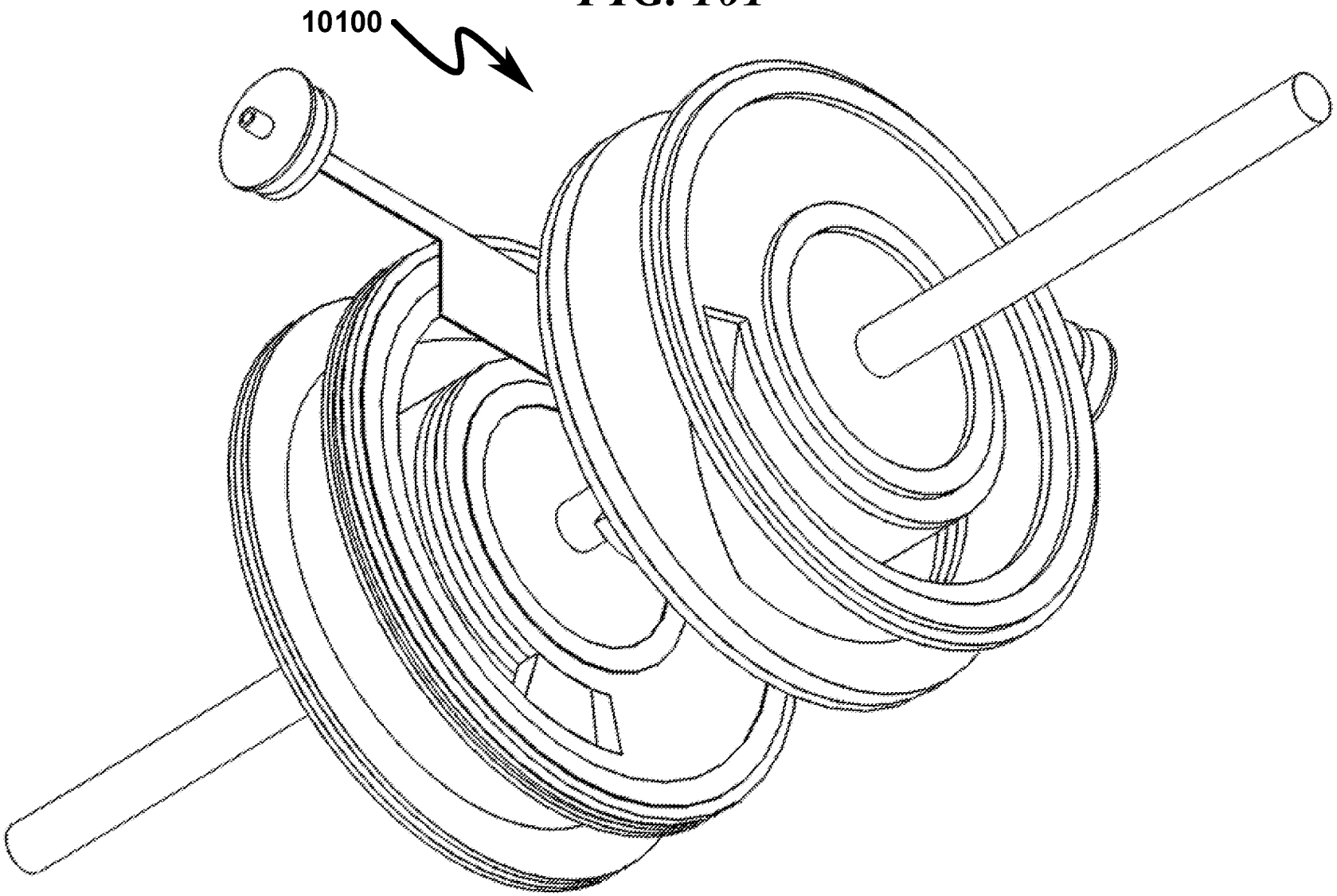
Figure 102:
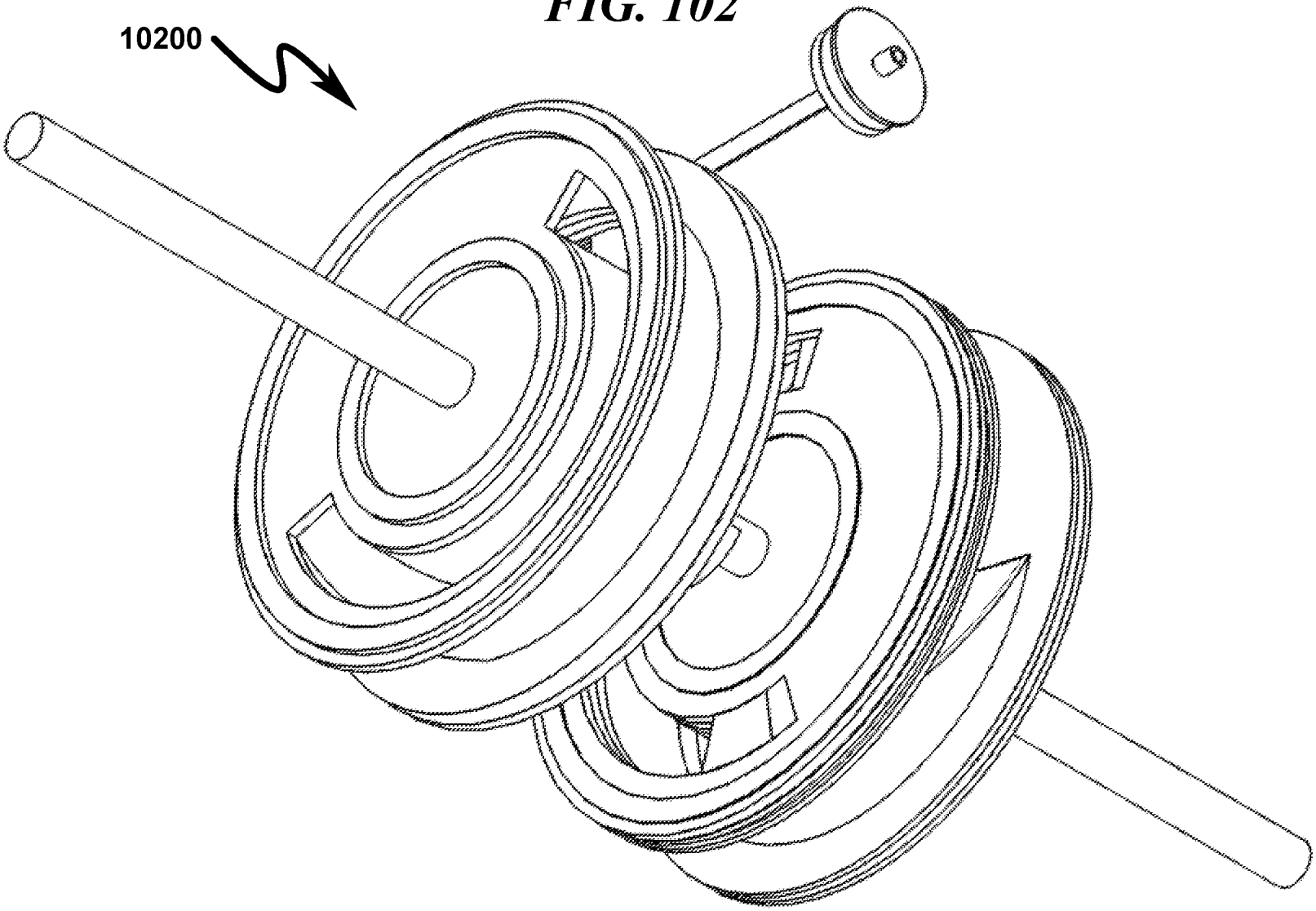
Figure 103:
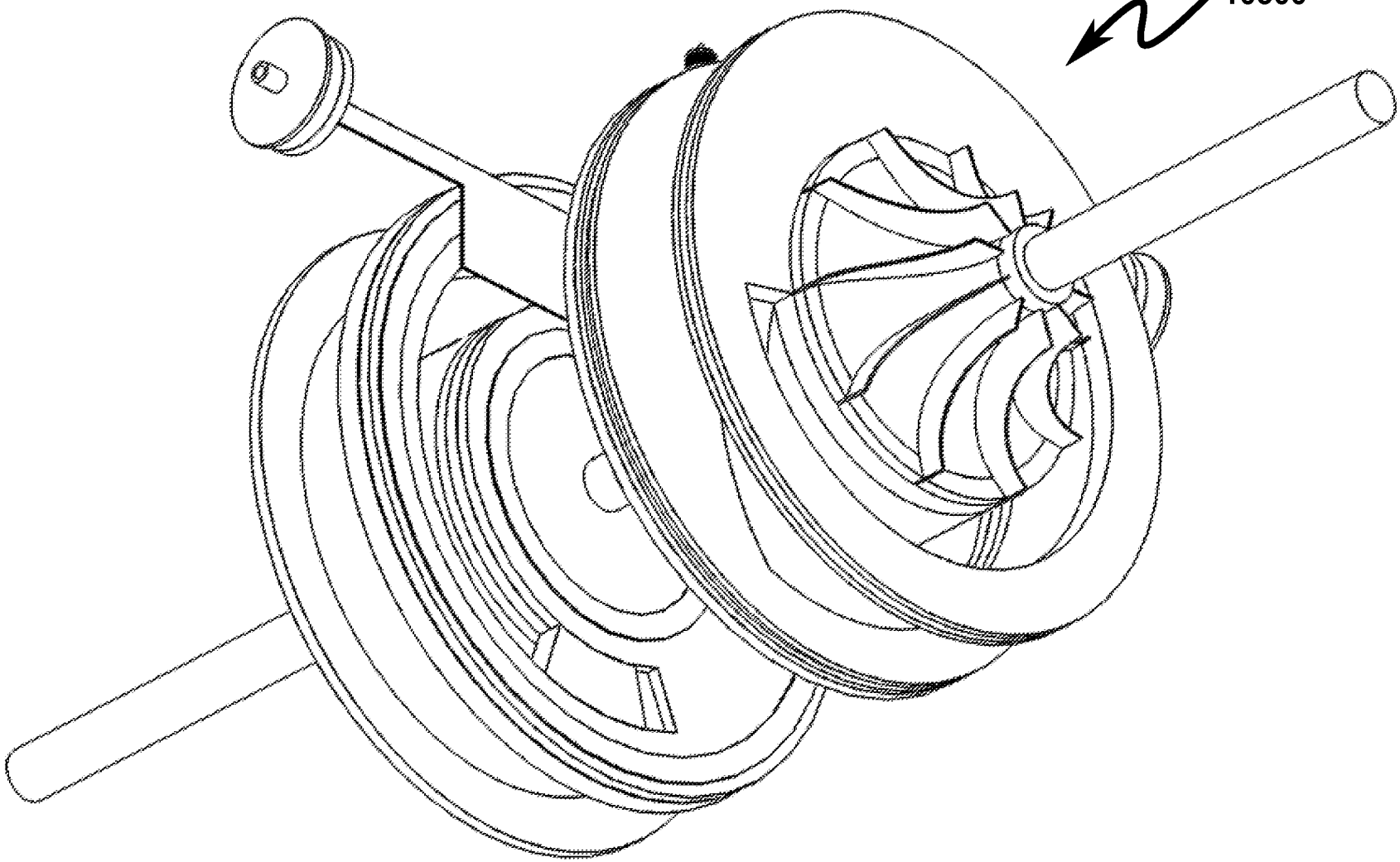
Figure 104:
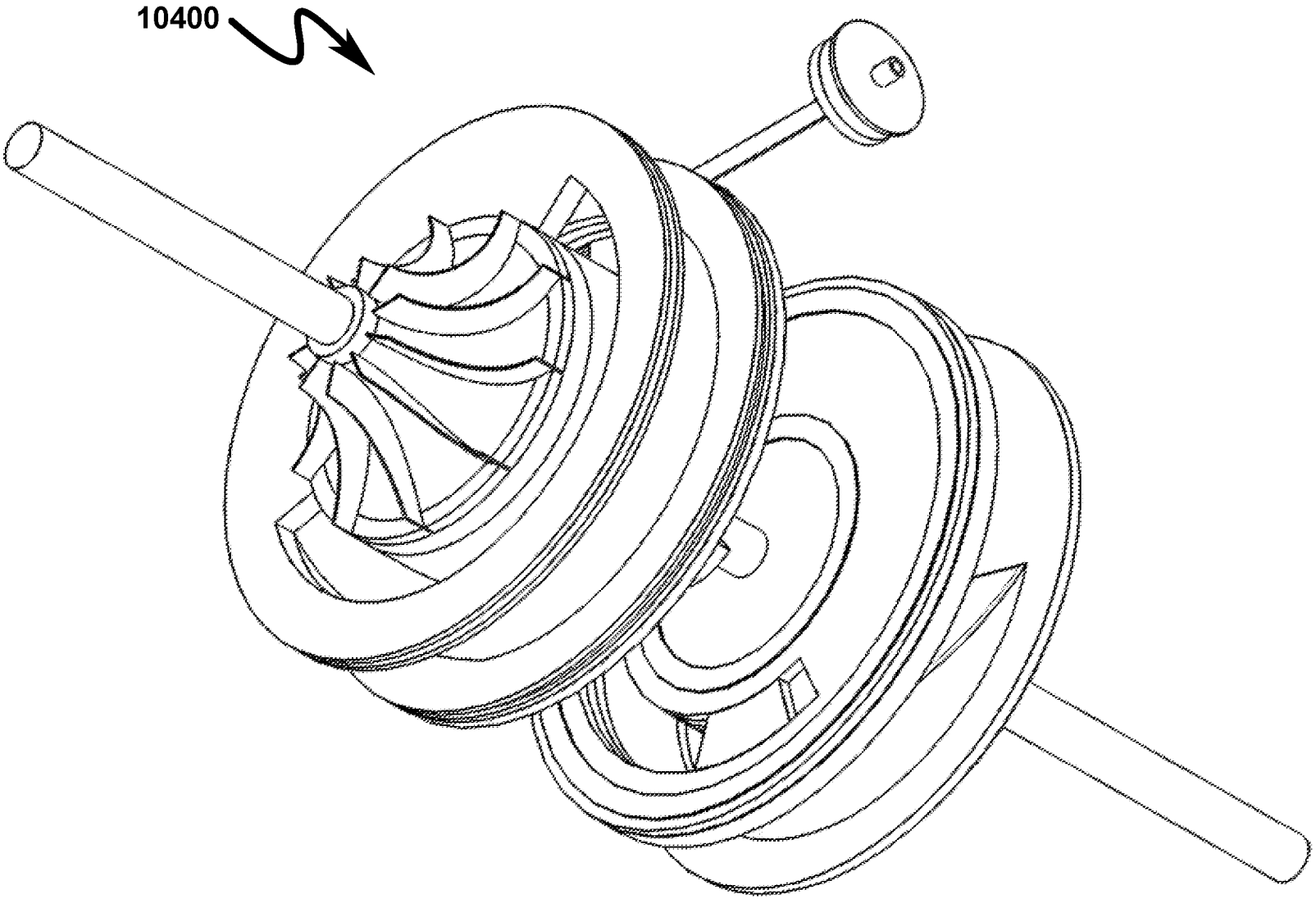
Figure 105:
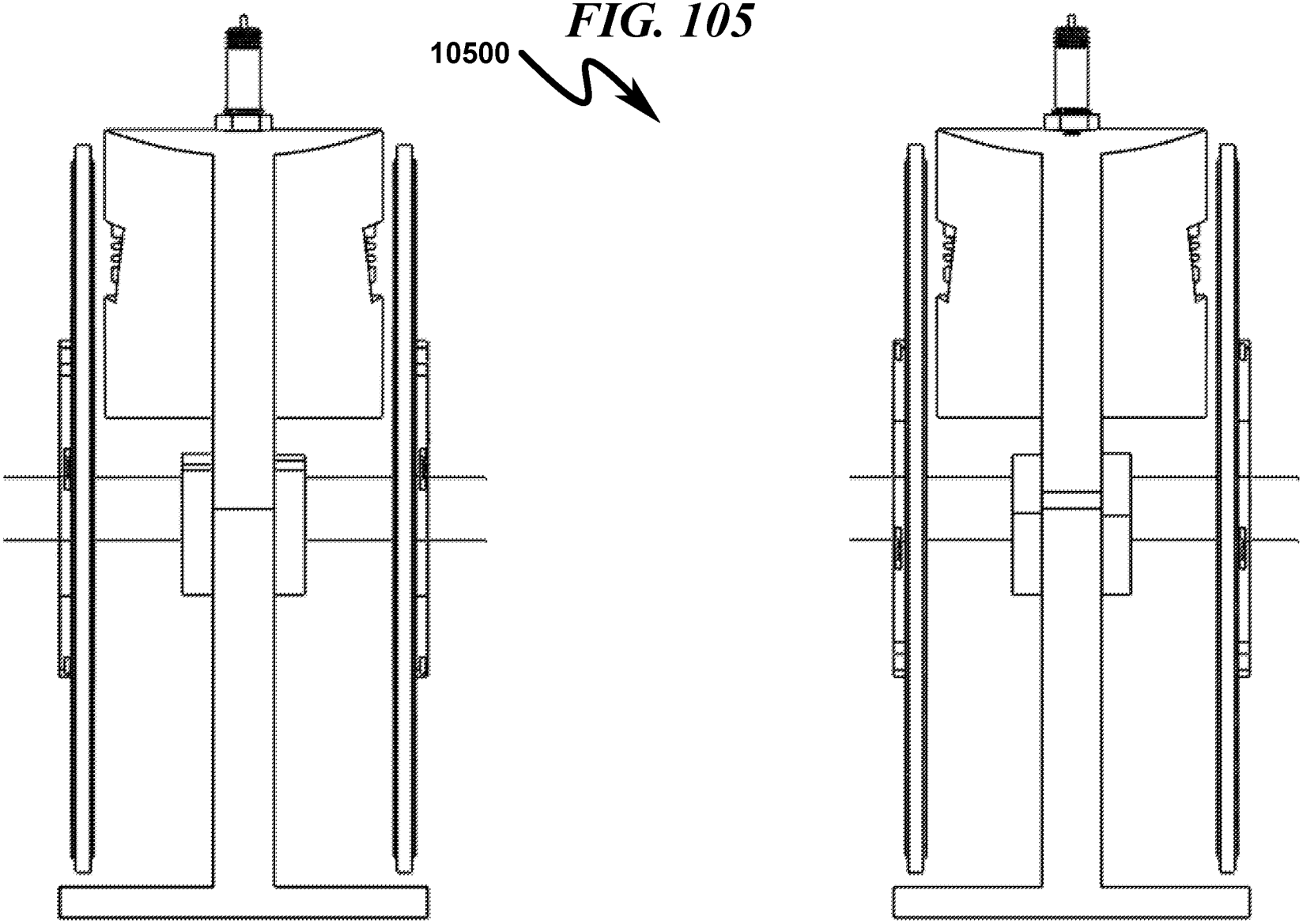
Figure 106:
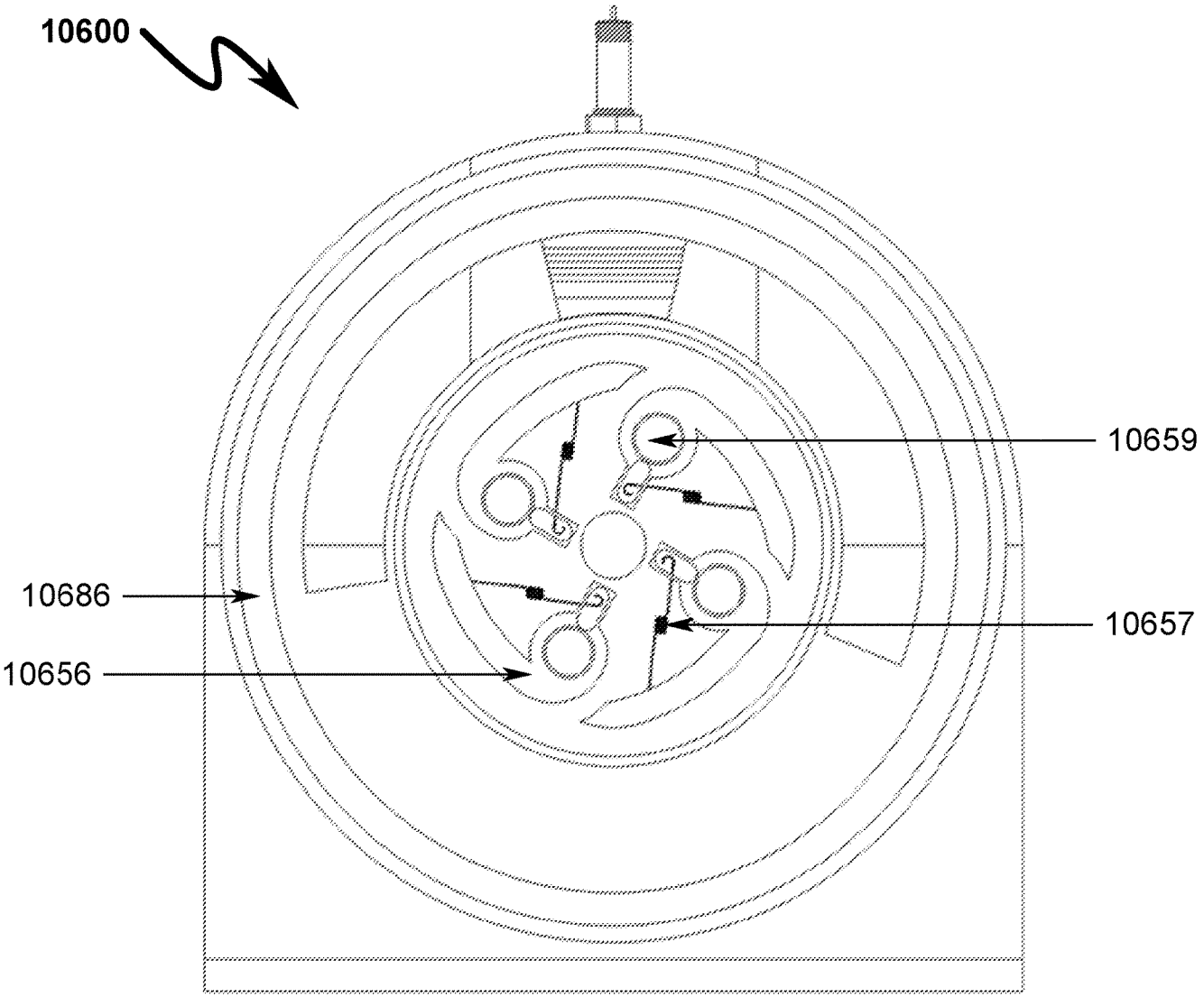
Figure 107:
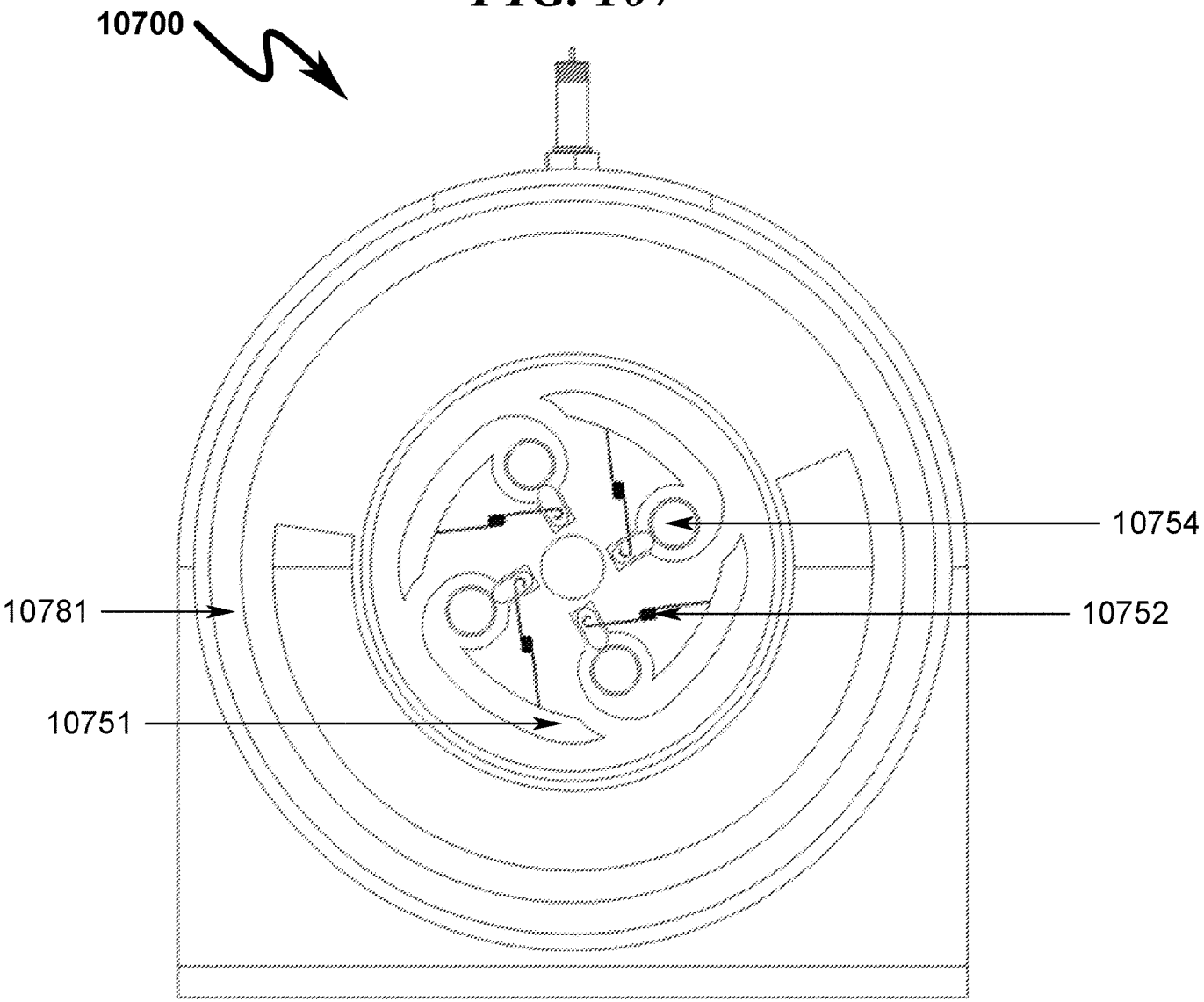
Figure 108:
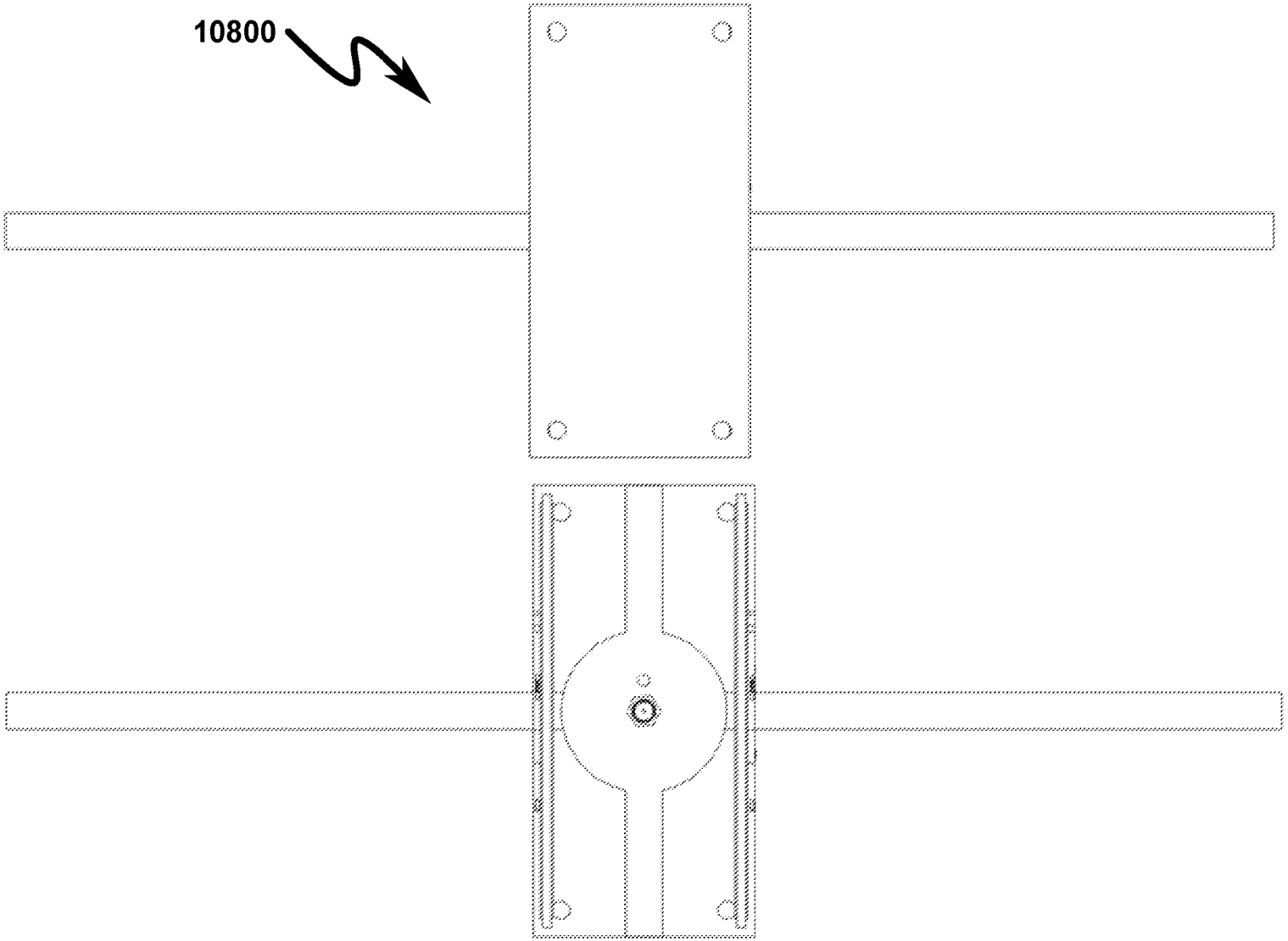
Figure 109:
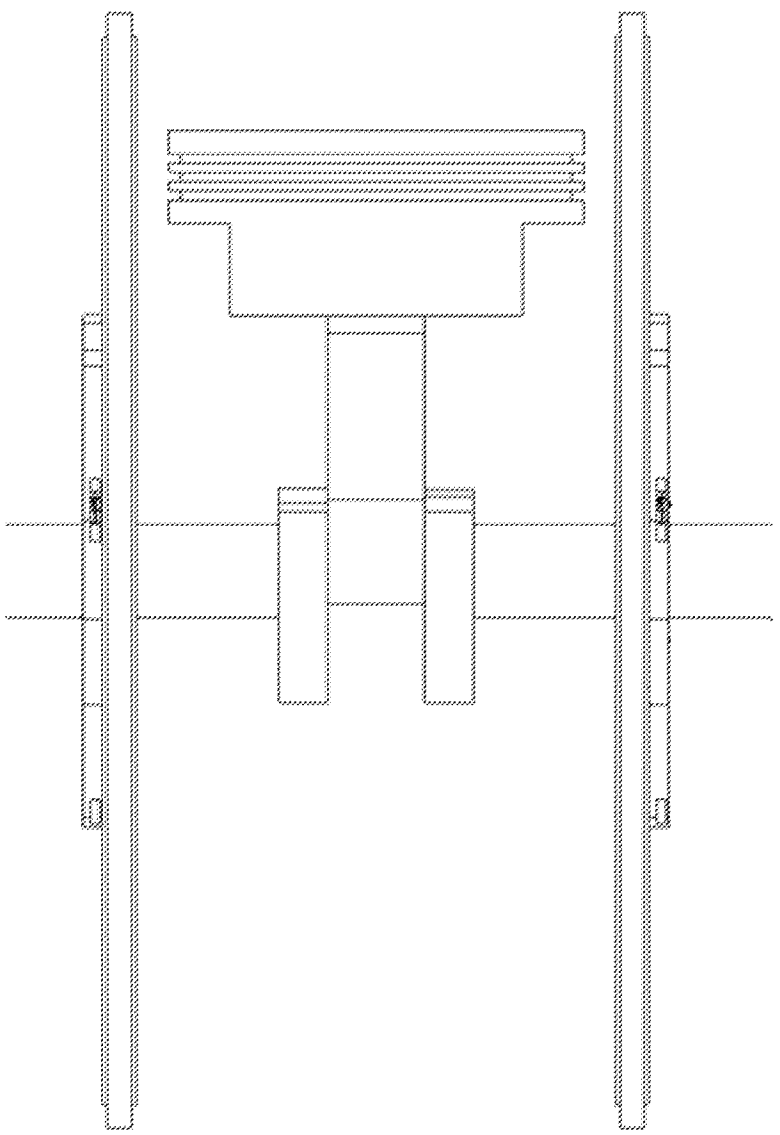
Figure 110:
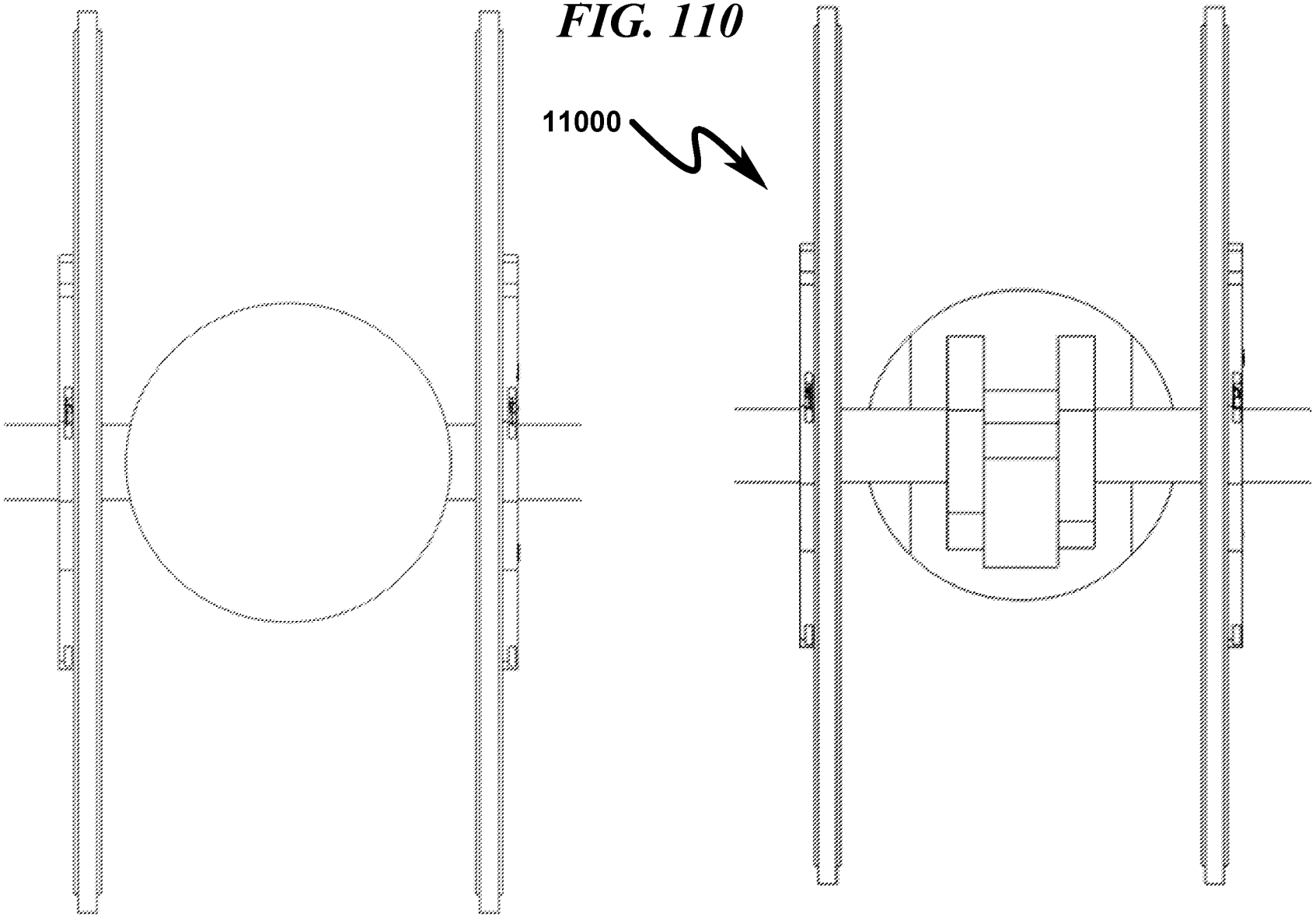
Figure 111:
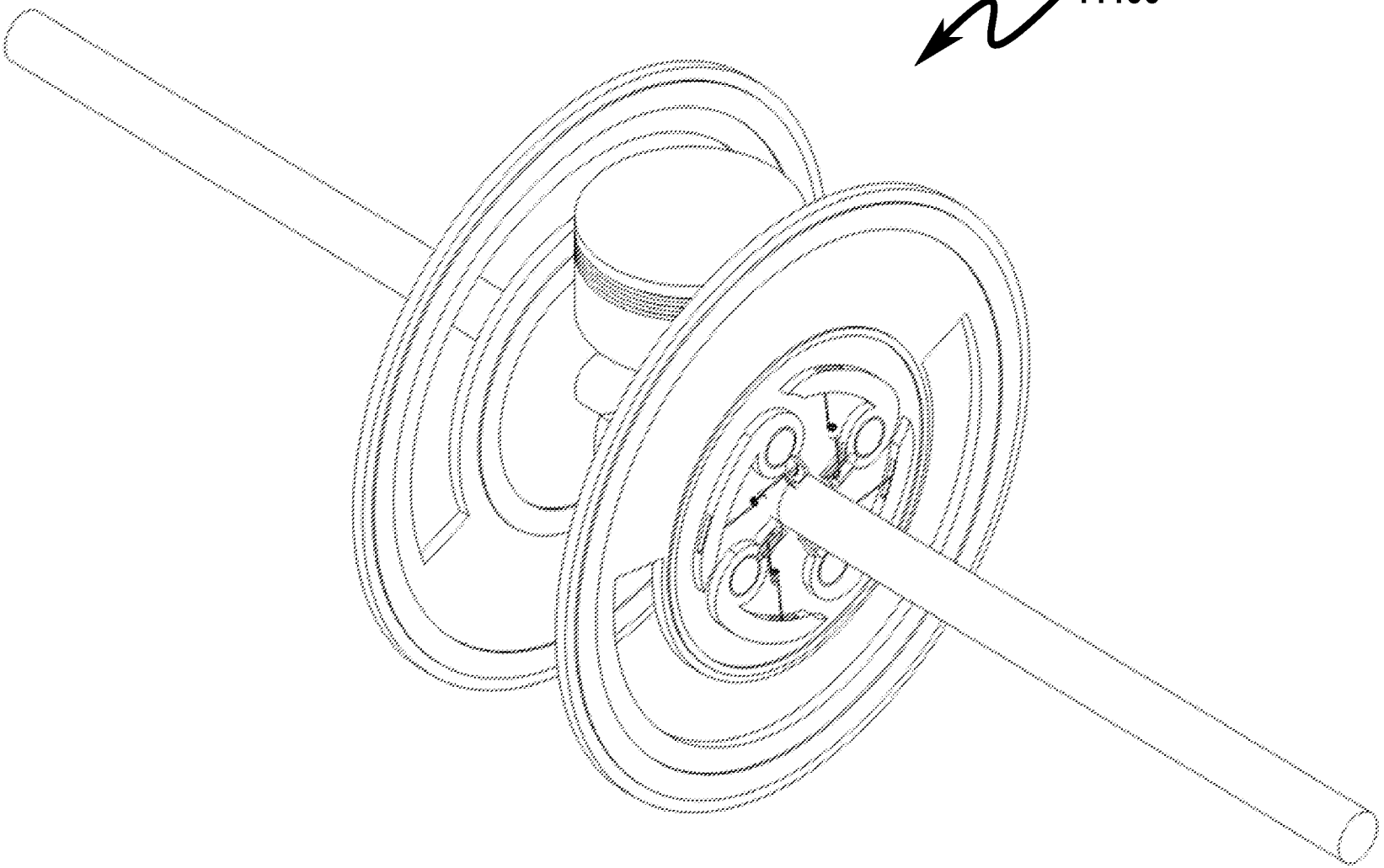
Figure 112:
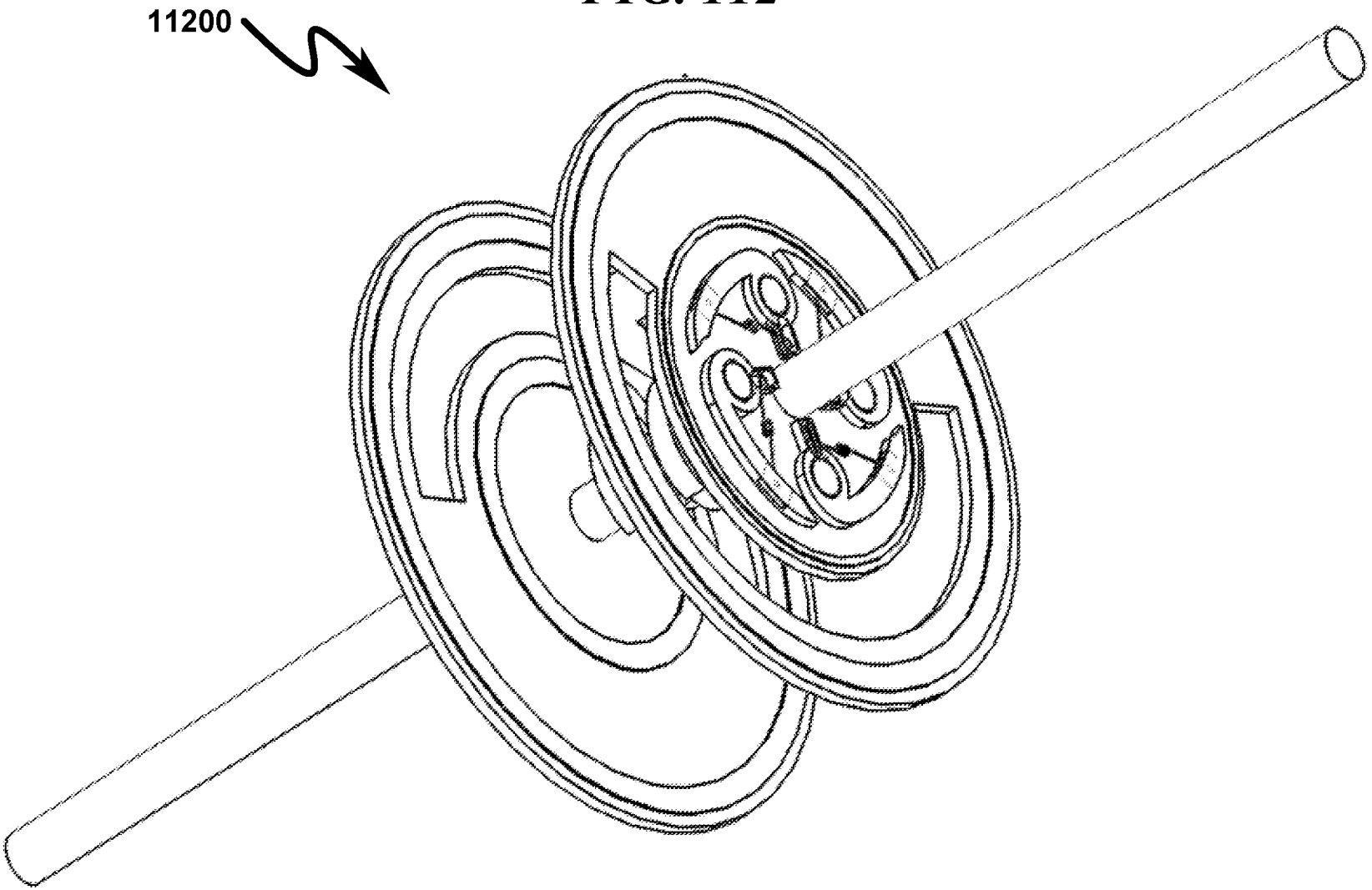
Figure 113:
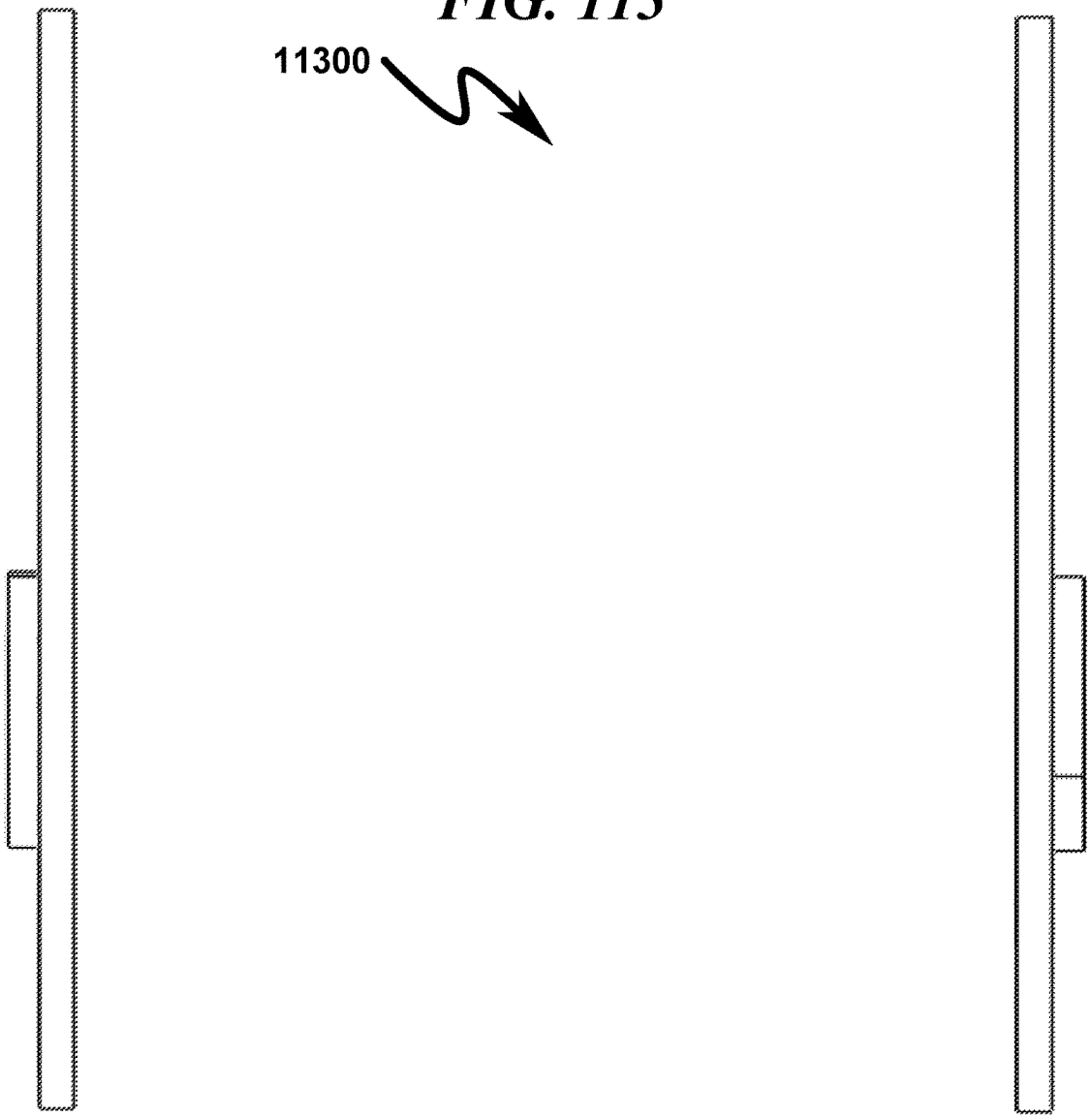
FIG. 113 illustrates front and rear views of a preferred exemplary invention exhaust rotary valve disc (EVD) system embodiment.
Figure 114:
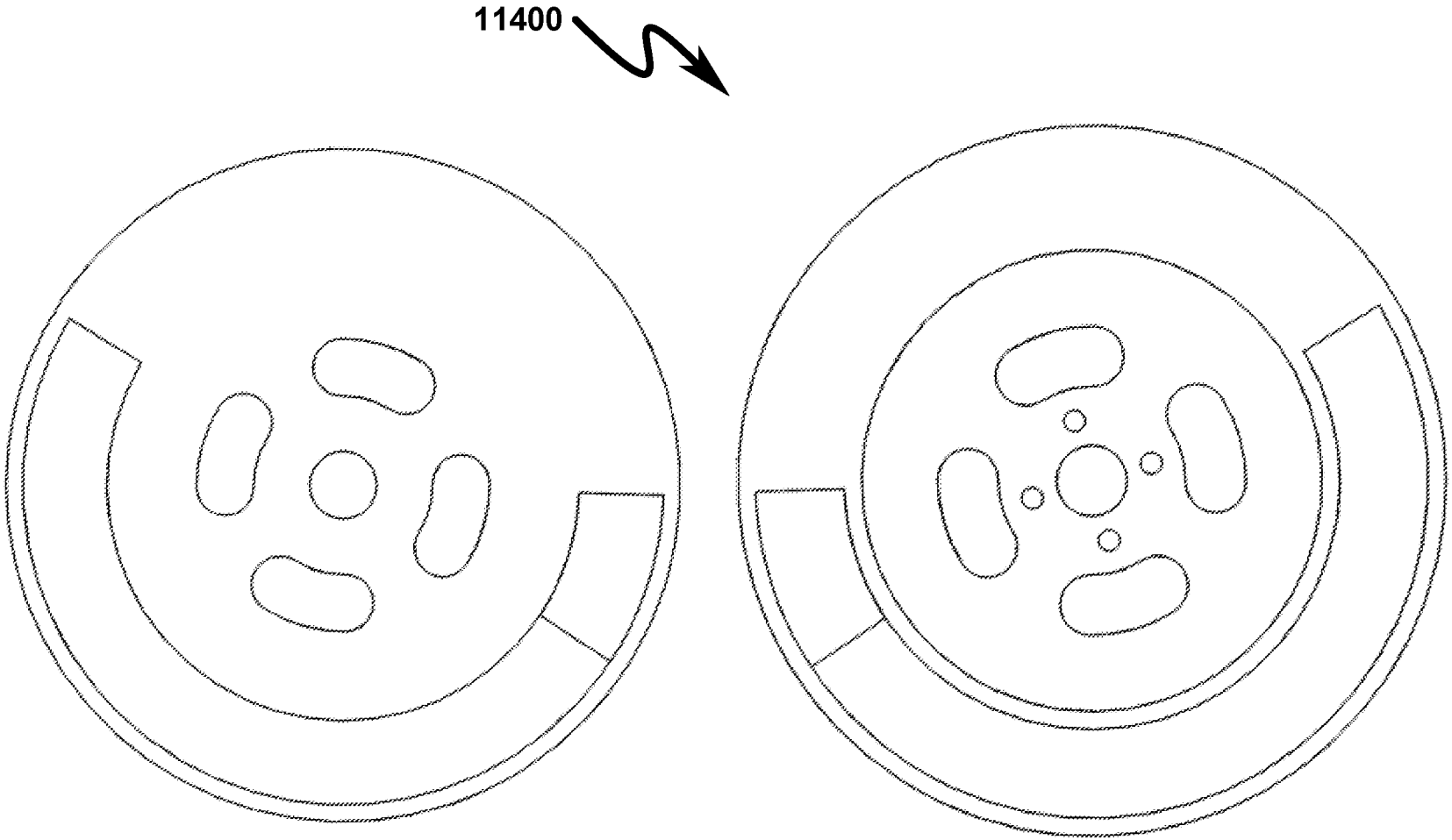
FIG. 114 illustrates left side and right side views of a preferred exemplary invention exhaust rotary valve disc (EVD) system embodiment.
Figure 115:
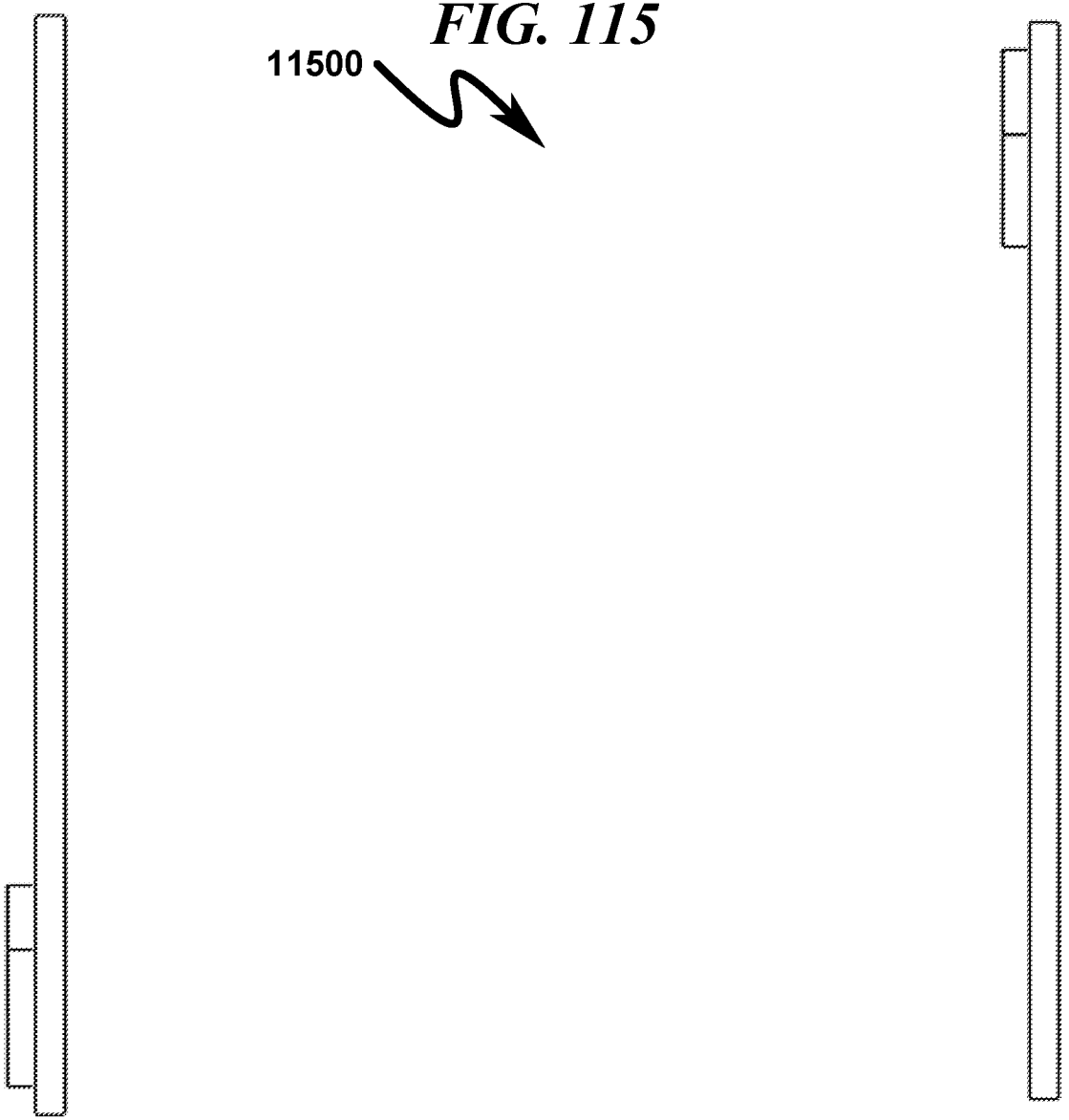
FIG. 115 illustrates top and bottom views of a preferred exemplary invention exhaust rotary valve disc (EVD) system embodiment.
Figure 116:
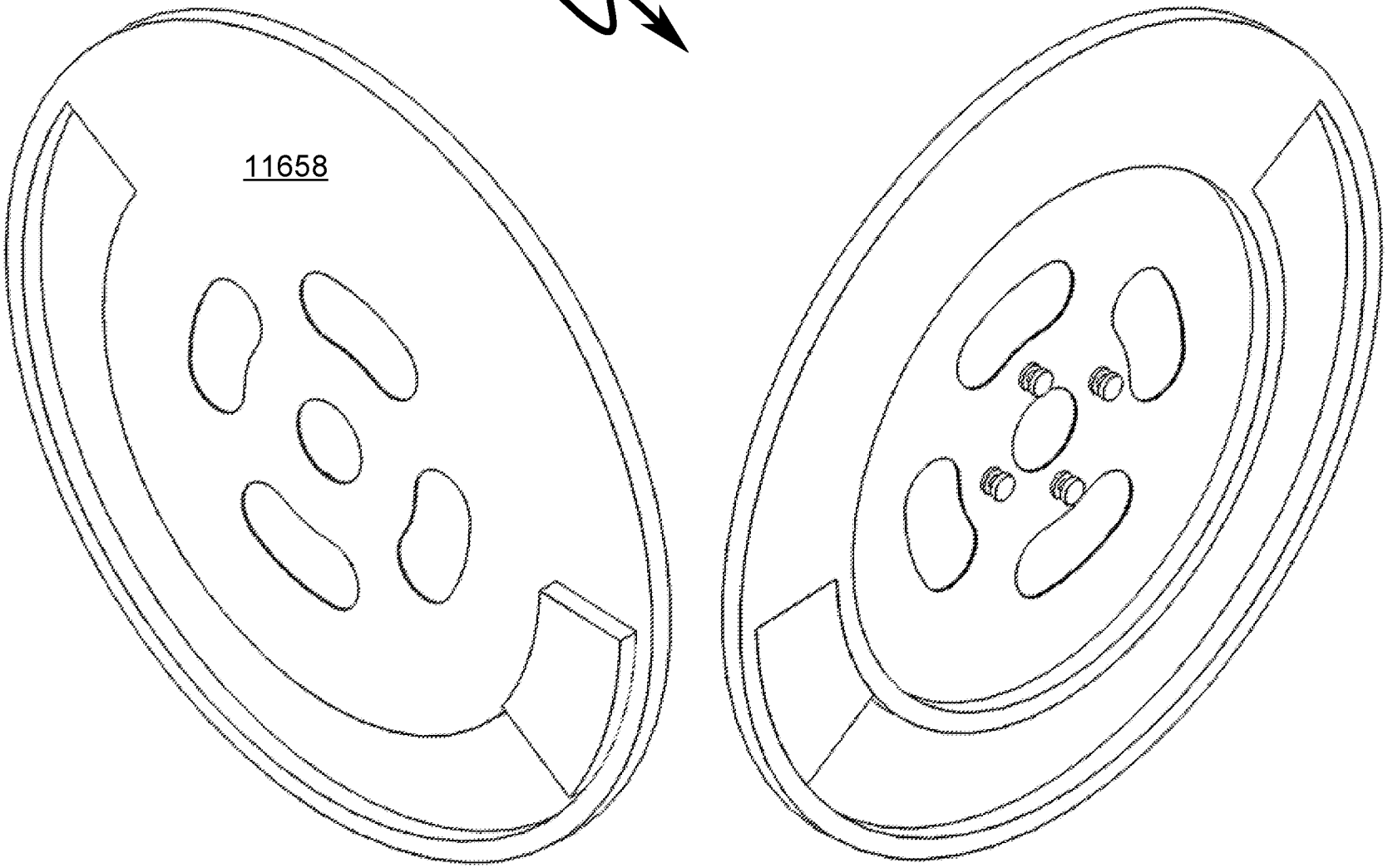
FIG. 116 illustrates top right front and top right rear perspective detail views of a preferred exemplary invention exhaust rotary valve disc (EVD) system embodiment.
Figure 117:
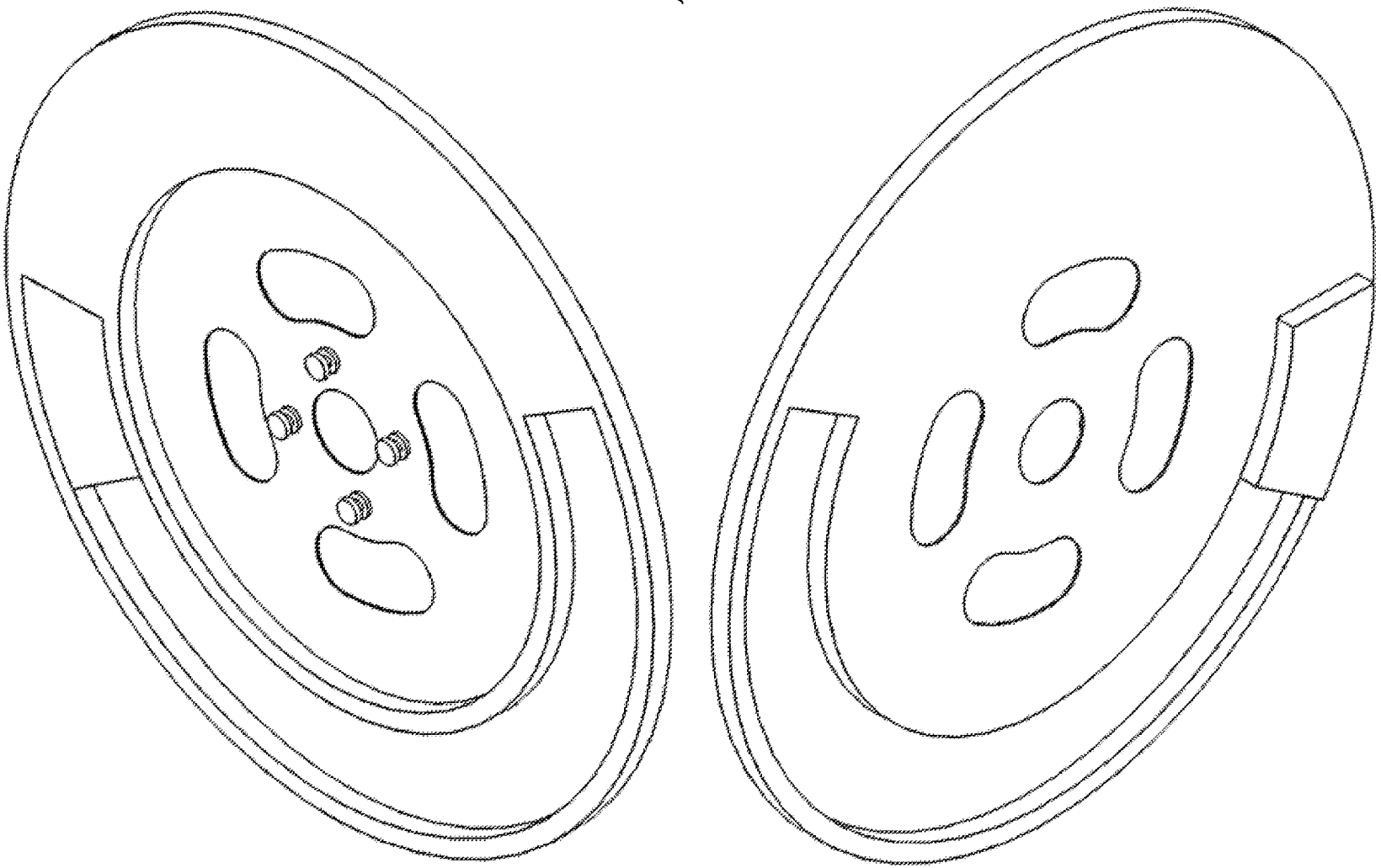
FIG. 117 illustrates top left rear and top left front perspective detail views of a preferred exemplary invention exhaust rotary valve disc (EVD) system embodiment.
Figure 118:
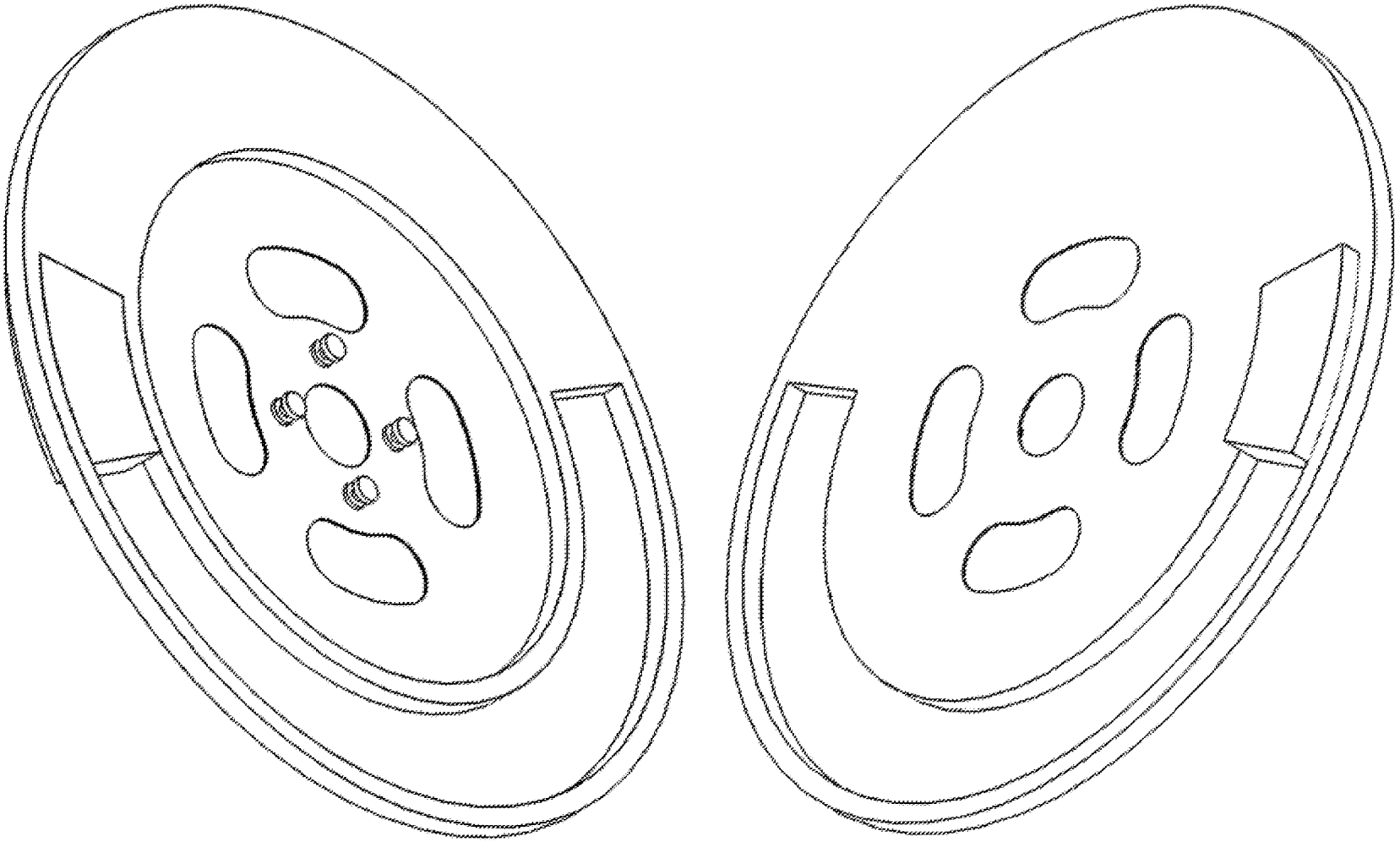
FIG. 118 illustrates bottom right front and bottom right rear perspective detail views of a preferred exemplary invention exhaust rotary valve disc (EVD) system embodiment.
Figure 119:
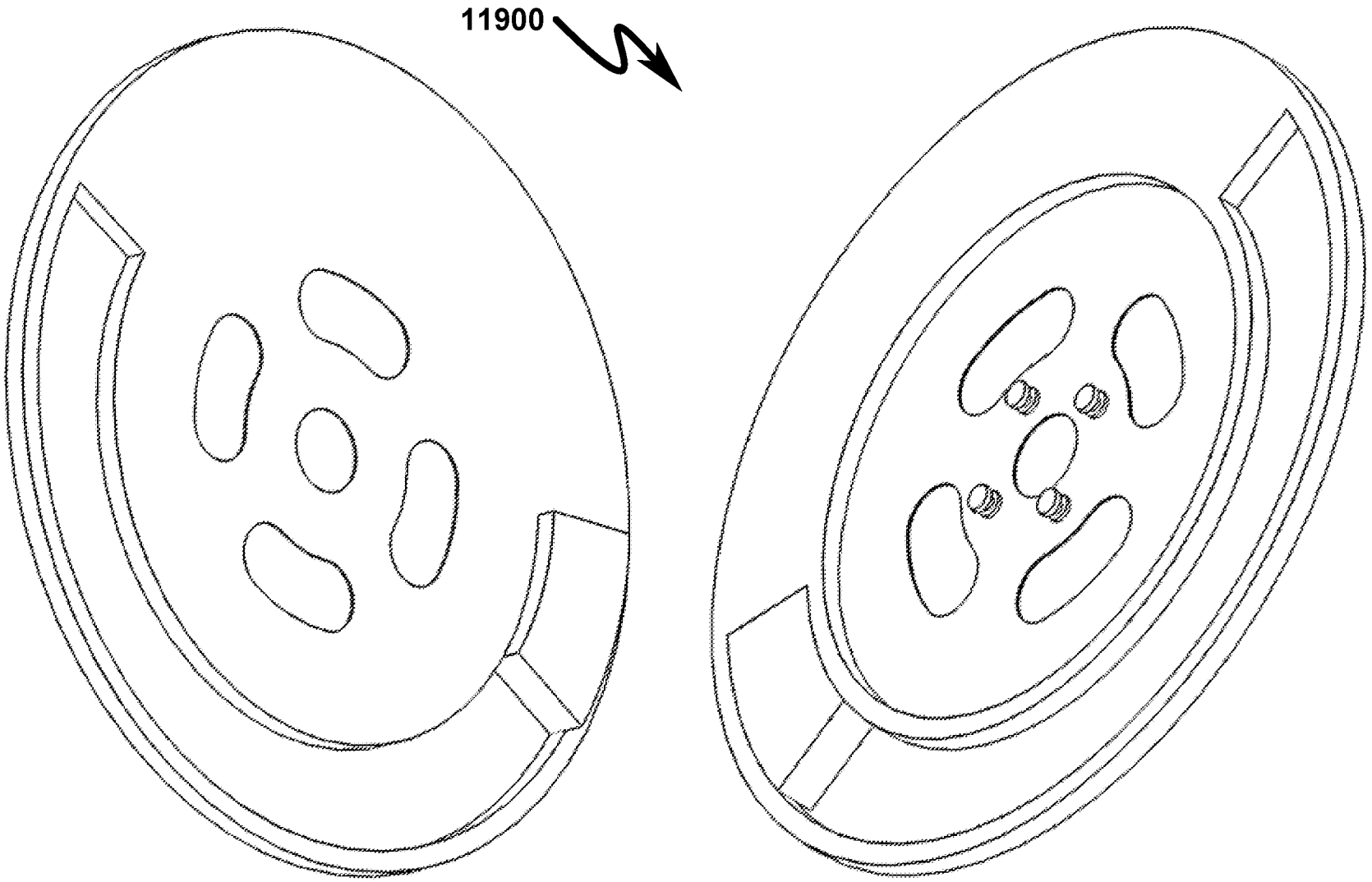
Figure 120:
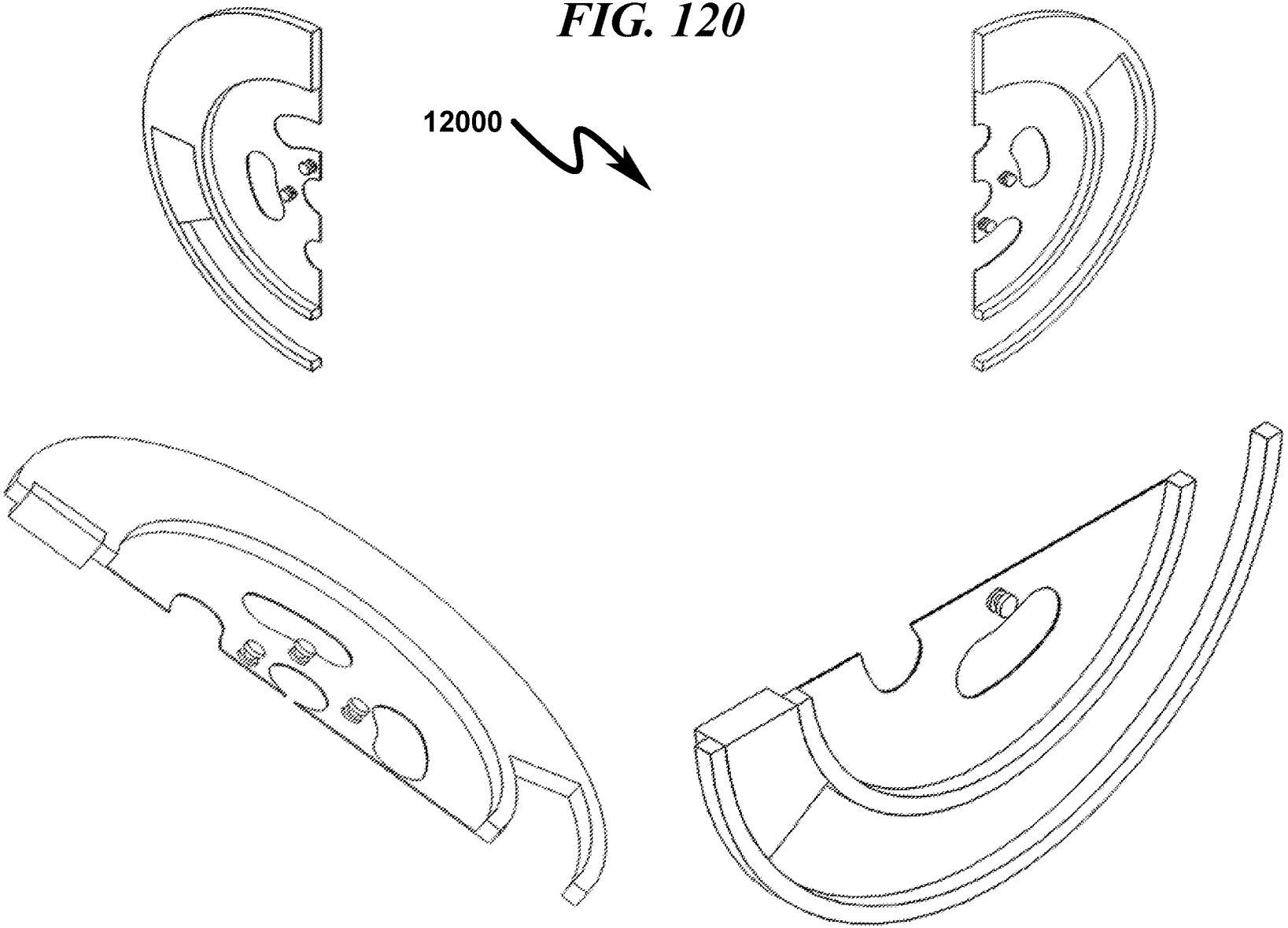

Detail views of the intake rotary valve disc (IVD) are generally depicted in FIG. 73 (7300)-FIG. 80 (8000). The IVD and EVD may be identical and incorporate anti-symmetric rotary valve ports. The rotary valve port in the IVD is coupled to the crankshaft and designed to control the flow of air from the intake into the combustion chamber (CCH) (2964) based on the rotation angle of the crankshaft.

Upper Engine Block Center Section (UBS) and Lower Engine Block Center Section (LBS) (8100)-(8800)

Detail views of the upper engine block center section (UBS) and lower engine block center section (LBS) are generally depicted in FIG. 81 (8100)-FIG. 88 (8800). The UBS incorporates intake and exhaust ports as well as a center void constituting the combustion chamber (CCH) (2964). Provisions are generally provided for a spark plug, ignitor, and/or fuel injector. The LBS supports the UBS and provides clearances necessary for the crankshaft (CRK).

Internal Engine Construction (8900)-(11200)

Detail views of the internal engine construction are generally depicted in FIG. 89 (8900)-FIG. 112 (11200). In these views it can be seen the relationship between the crankshaft, piston, multi-staged valve, intake forced induction, exhaust forced discharge, and other components. Note here that the engine block components have been removed for clarity in isolating the components that are depicted.

Multi-Staged Valve (MSV) (12100)-(12800)

Figure 121:
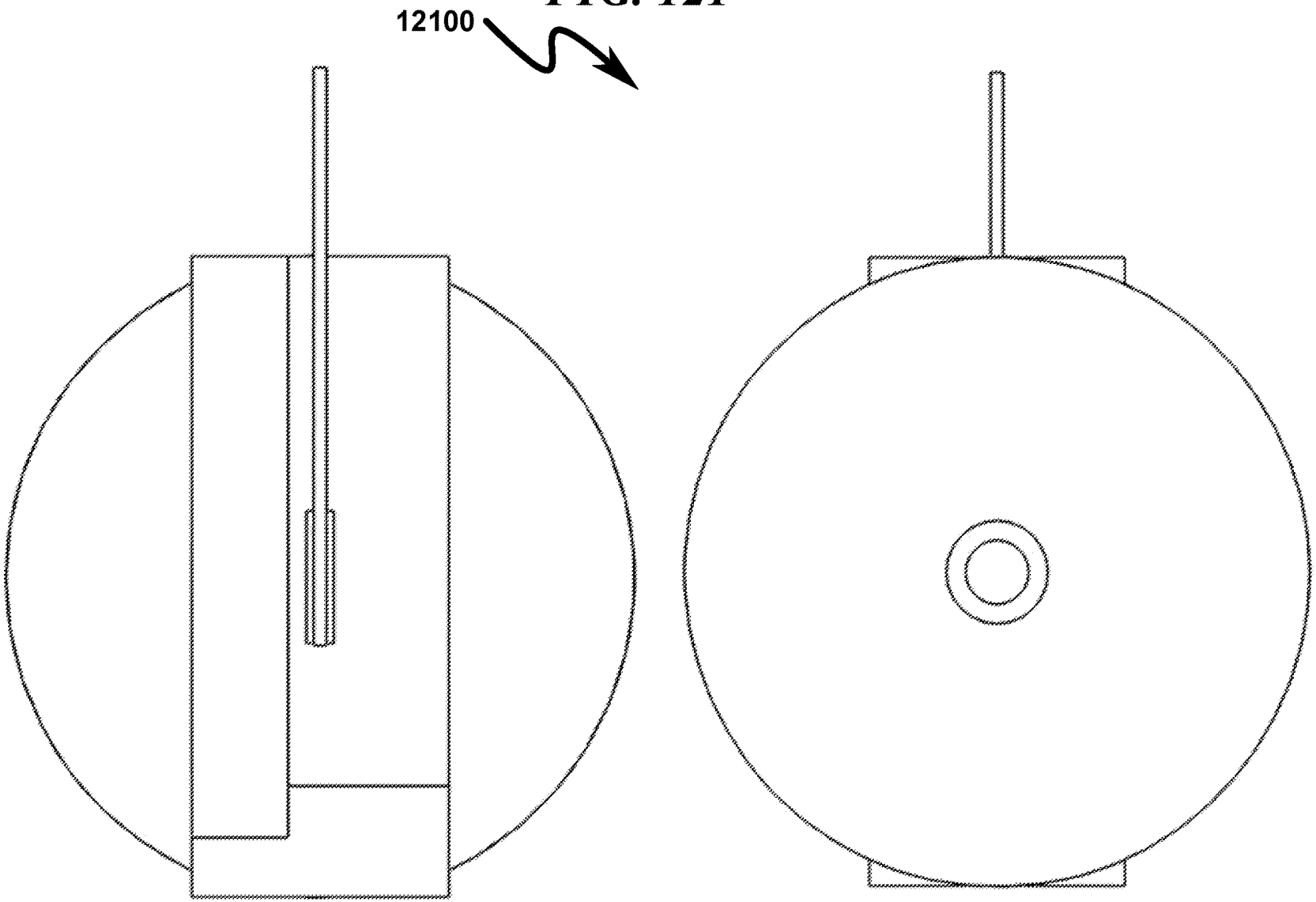
Figure 122:
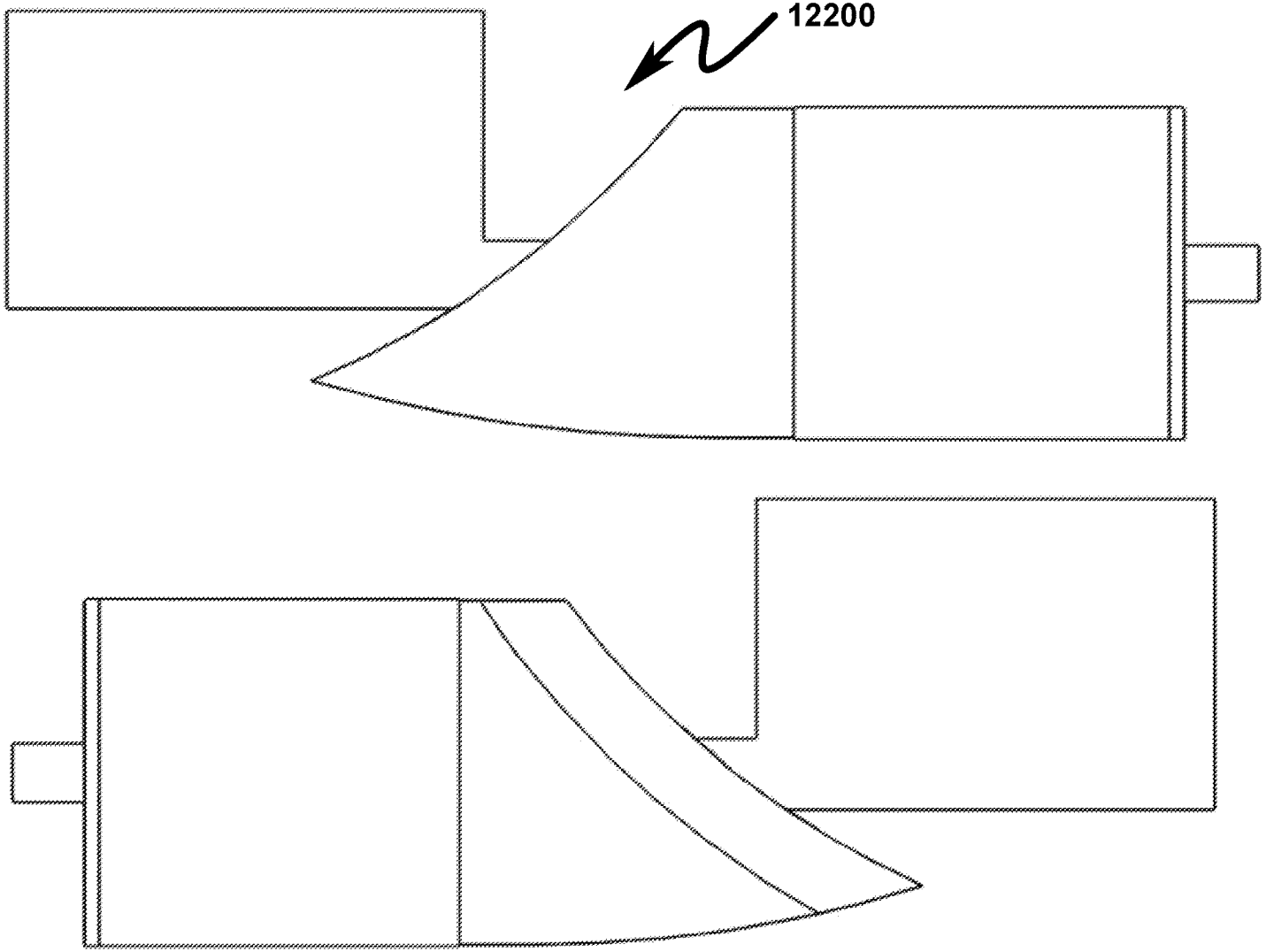
Figure 128:
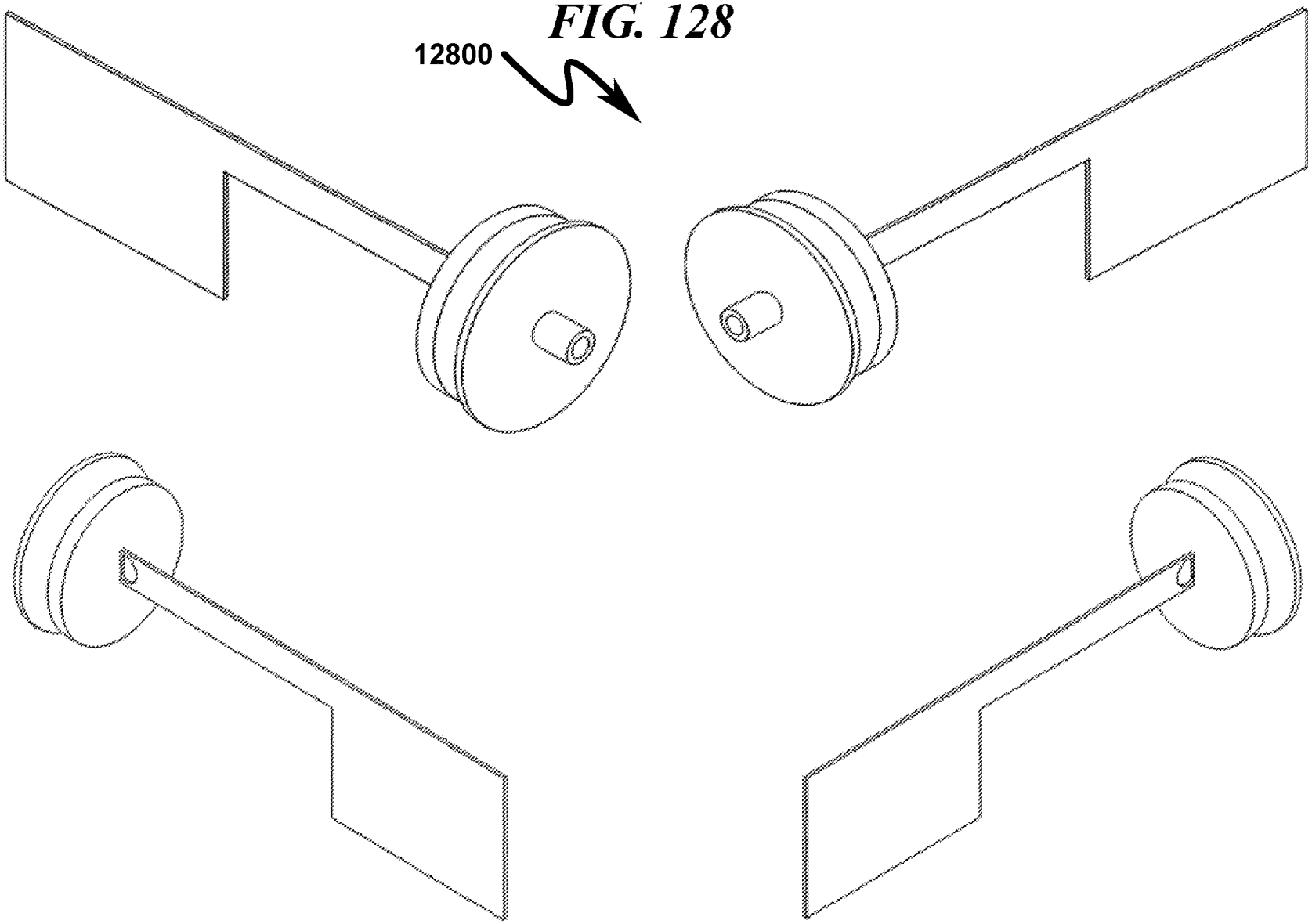
Figure 130:
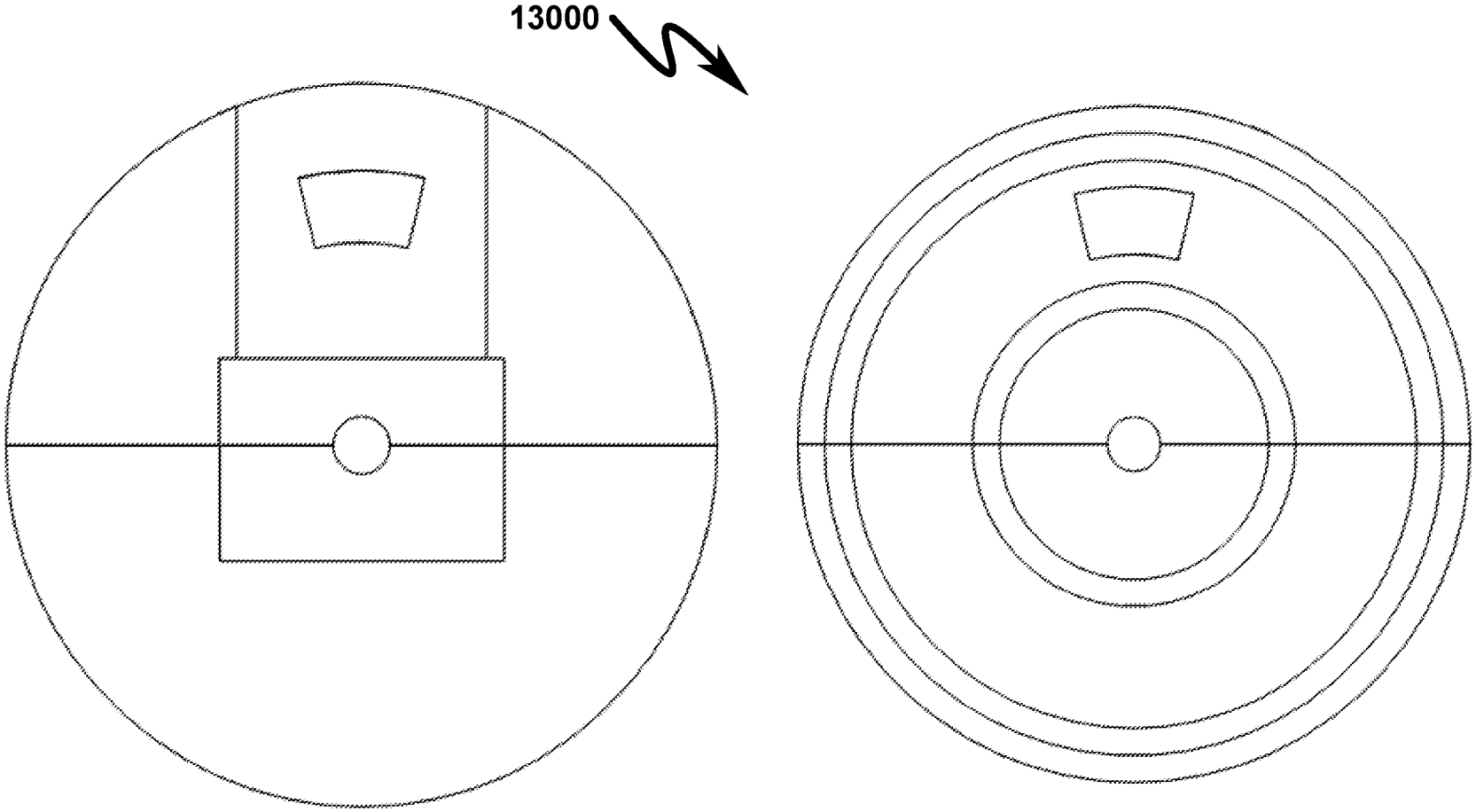
Figure 131:
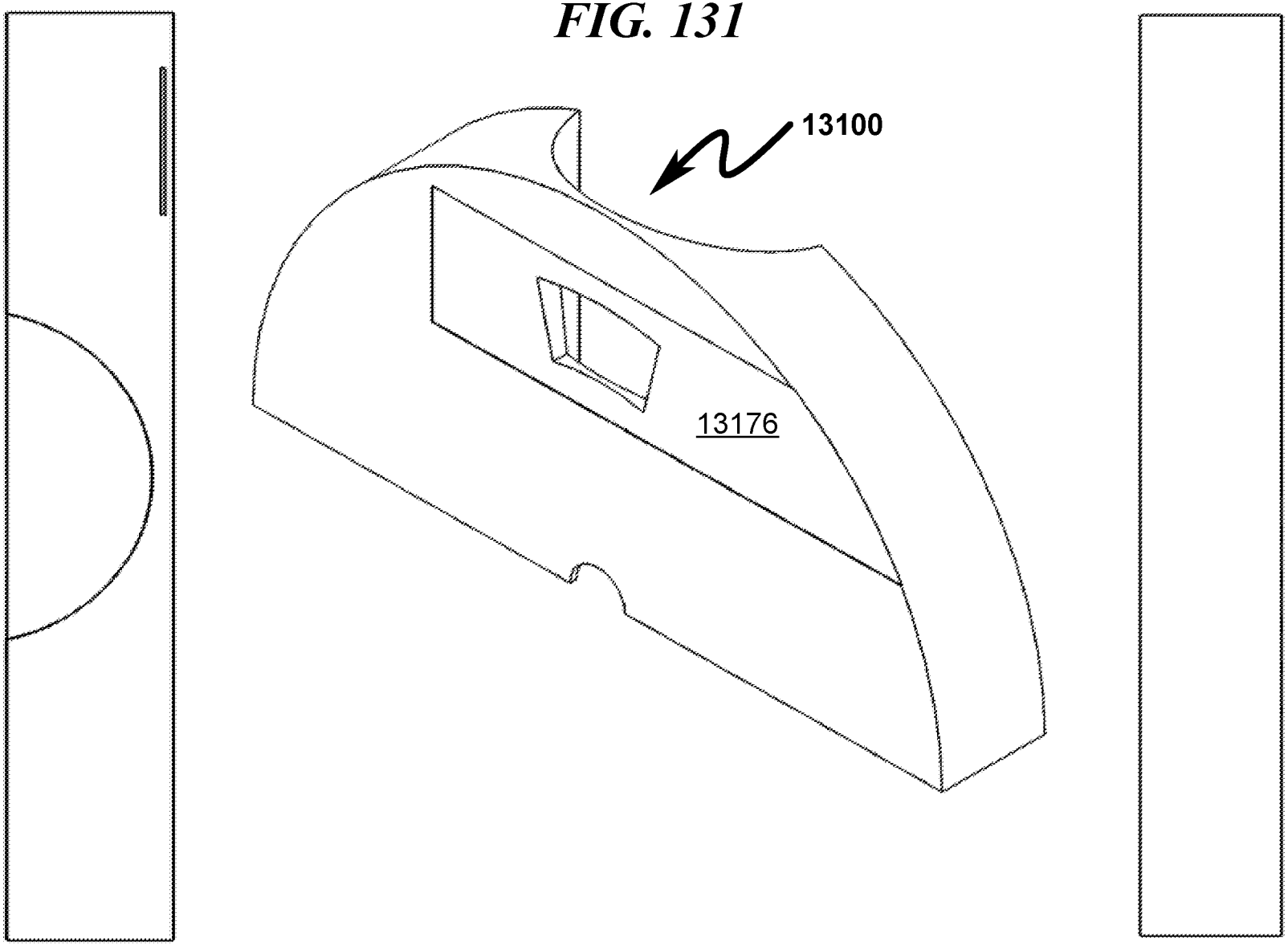
Figure 132:
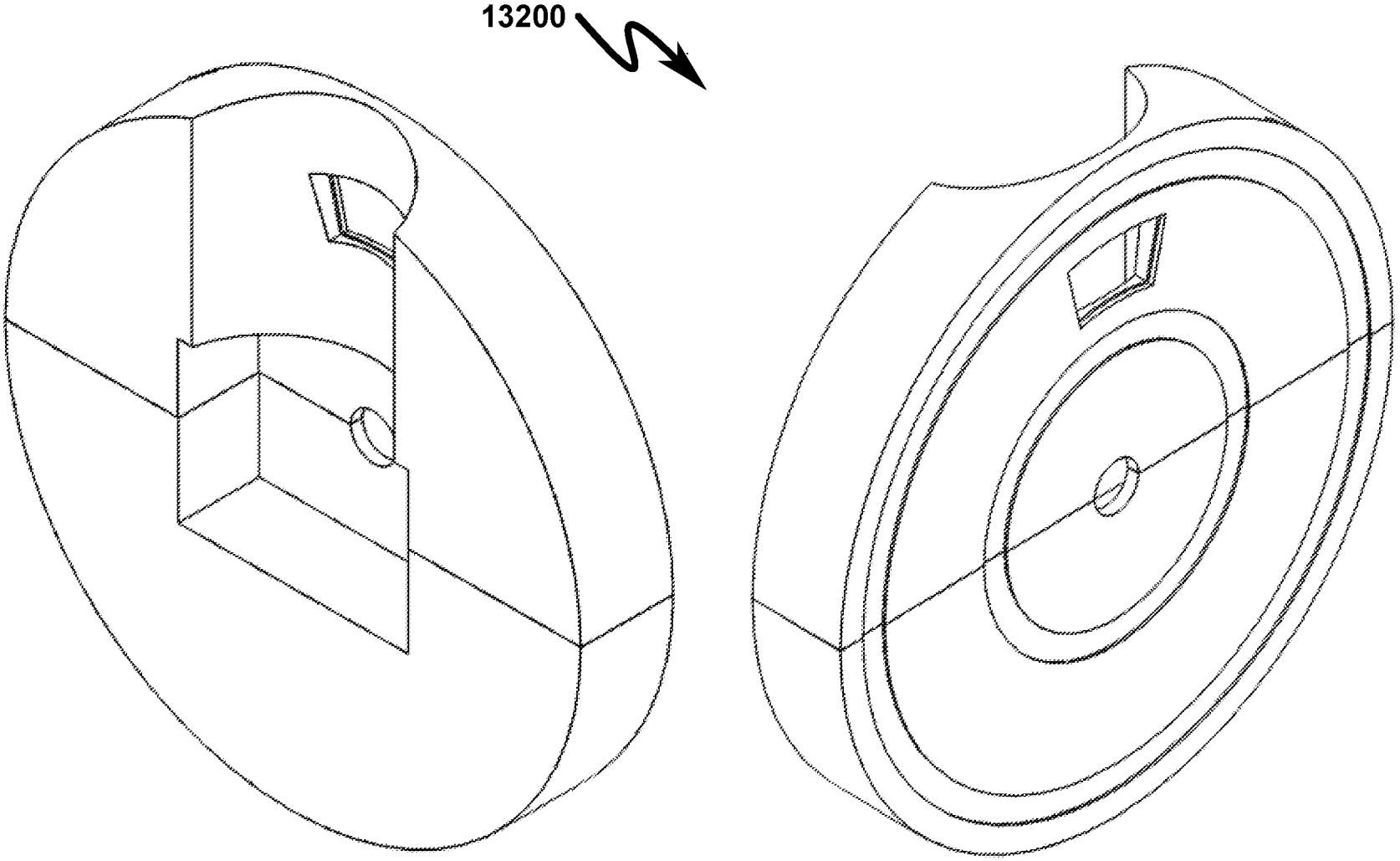
Figure 133:
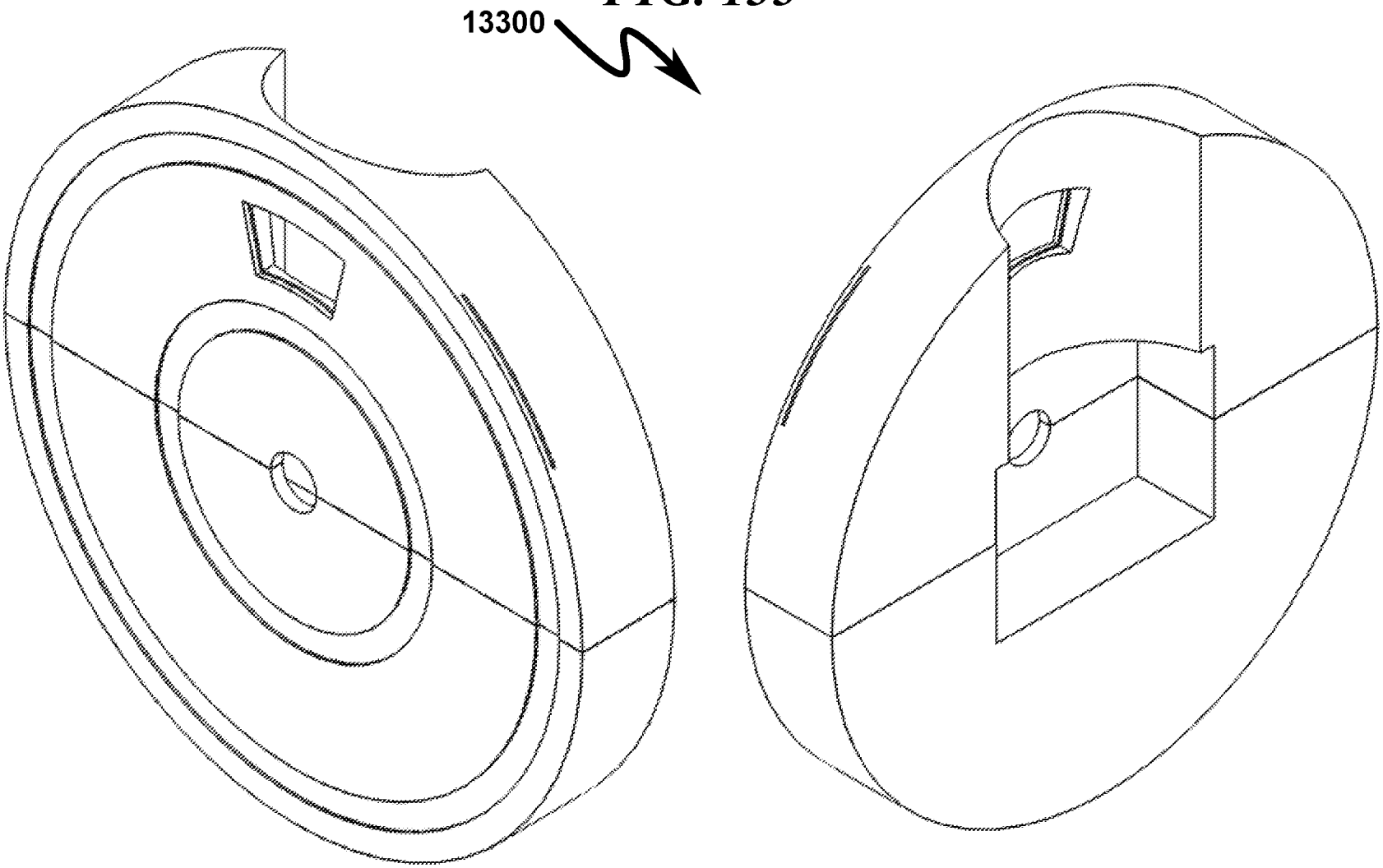
Figure 134:
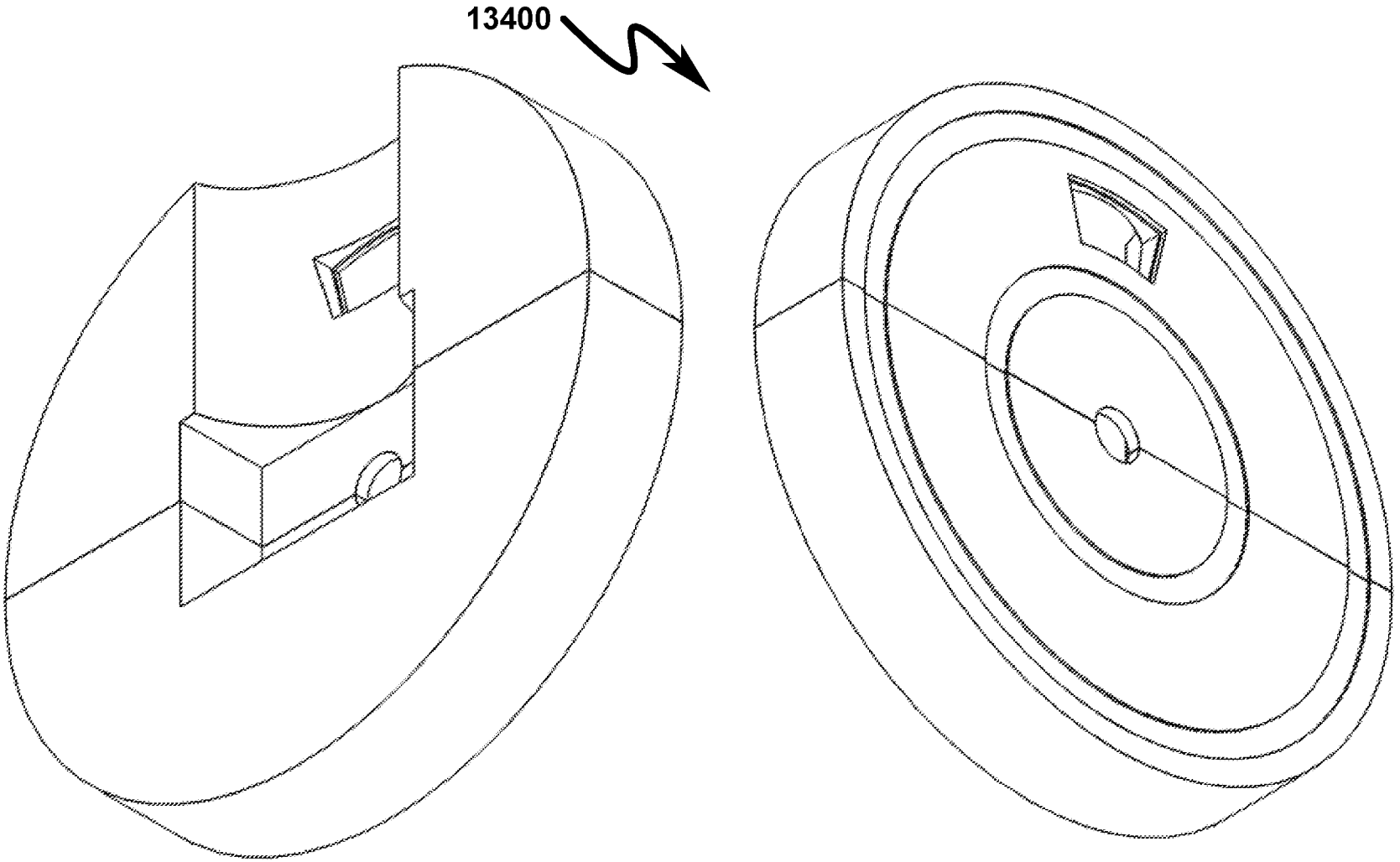
Figure 135:
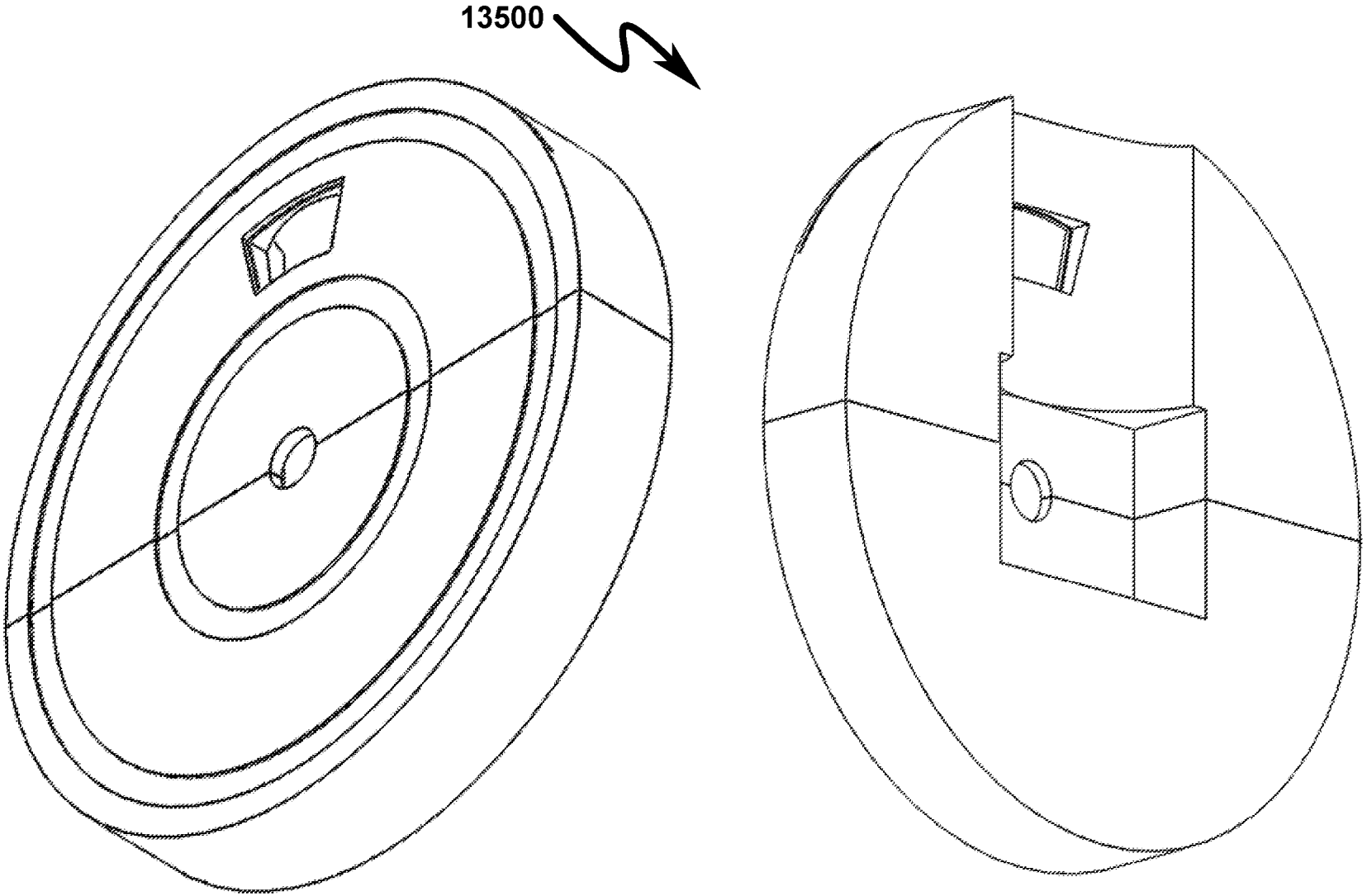
Figure 136:
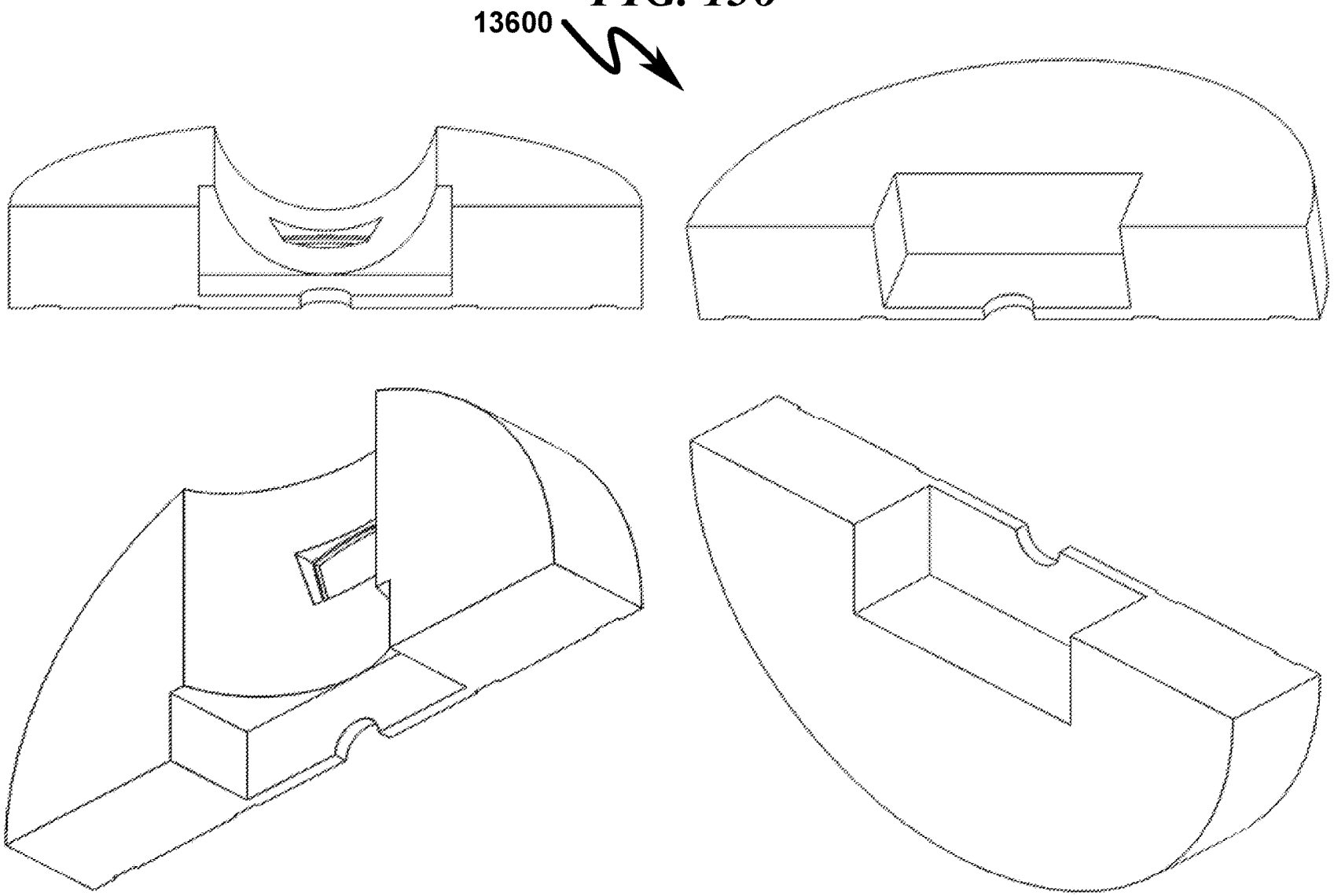

Detail views of the multi-staged valve (MSV) unitized embodiment are generally depicted in FIG. 121 (12100)-FIG. 128 (12800). The MSV incorporates a blade, spring, and diaphragm designed such that the blades separately engage ports in the engine block to individually modulate intake into the engine cylinder and exhaust out of the engine cylinder.

The MSV detailed in FIG. 121 (12100)-FIG. 128 (12800) may be in many preferred embodiments utilized for both the IMV and the EMV.

Exhaust Upper Engine Block (EUH) and Exhaust Lower Engine Block Crankcase (ELC) (12900)-(13600)

Detail views of the exhaust upper engine block (EUH) and exhaust lower engine block crankcase (ELC) are generally depicted in FIG. 129 (12900)-FIG. 136 (13600). The EUH incorporates an exhaust port as well as a void supporting insertion of a MSV blade to modulate air flow through the exhaust port. The ELC mates with the EUH to provide crankcase enclosure and support for the crankshaft (CRK). In many preferred embodiments, the IUH/EUH and ILC/ELC are paired identical components. However, the present invention is not limited to this construction.

Intake/Exhaust Cooling Water Jacket (CWJ) (13700)-(14400)

Detail views of the intake and exhaust cooling water jackets (CWJ) are generally depicted in FIG. 137 (13700)-FIG. 144 (14400). These components are typically identical in many preferred embodiments but this is not a requirement of construction. Each of the CWJ incorporates coolant inlet/outlet ports for water or other coolant to flow through the CWJ. Additional detail of the CWJ inlet/outlet port construction is provided in FIG. 209 (20900)-FIG. 216 (21600).

Exhaust Forced Discharge Apparatus (FID) (14500)-(15200)

Detail views of the exhaust forced discharge apparatus (FIA) are generally depicted in FIG. 145 (14500)-FIG. 152 (15200)

Intake Forced Induction Apparatus (FIN) Detail (24100)-(25600)

Detail views of the intake manifold and intake forced induction apparatus (FIN) generally depicted in FIG. 241 (24100)-FIG. 256 (25600). These components may include a throttle valve plate that modulates the intake air flow to these components.

Supercharging, more commonly known as "Forced Induction," is an appliance created with the sole purpose of forcing more particulate matter into a system. There are many names for the styles and characteristics of forced induction systems.

It can be noted for a given engine, supercharging can improve the engine power output by increasing the intake air density and thus improving the engine's efficiency. Since all ICEs have a limit where its inherent mechanical interference limits their effective and efficient operation range, the present invention incorporates a forced induction device to be integral to the rotary valve.

What this translates into is that at high RPMs, the effective opening of the Rotary Valves becomes enhanced to effect a greater flow of air molecule into the ICE.

It was because of this inherent flaw in Poppet Valve ICEs that forced induction was incorporated into ICEs, to get more air into the combustion chamber.

According to the estimates of the volumetric limitations expressed in Table 1 in reference to the notable areas where the frictional losses occurred in reference to estimates of FIG. 1, the above chart shows that Poppet Valves generally run into their estimated volumetric limit at the 10500-RPM mark while the Rotary Valves generally run into their estimated volumetric limit at the 28440-RPM mark.

While these are estimates based on industry publicized and accepted industry standard efficiency limits of ICEs, the actual volumetric efficiency of real-world examples obviously will vary from any theoretical example. However, the fact that a Rotary Valve presents an open unobstructed port opening to an ICE can be submitted as a substantial advantage over Poppet Valves which are known to hit their upper RPM limit around 8000 to 10000 RPMs.

In present invention, the supercharging effect is incorporated as an optional feature as is depicted in the Continuation-In-Part Patent Application wherein the centrifugal impeller is introduced. It is well known to those skilled in the art that centrifugal superchargers are dynamic which means they only deliver pressure at or above 3000 RPMs or higher which translates into providing even more air flow without the advent of adding more components. The present invention incorporates the impeller's volute housing inside of the engine's cover. This combination greatly improves the efficacy of the centrifugal air compressor.

Centrifugal Compressor Volute Housing (24100)-(25600)

Detail views of the intake manifold, centrifugal compressor volute housing and Engine Cover unitized embodiment is generally depicted in FIG. 241 (24100)-FIG. 256 (25600).

The centrifugal compressor's impeller is formed to operate inside of the volute housing integral to the surface of the intake cooling channel spool (ICS) (10021).

This close union is so that there are minimal losses due to the distance from the outlet port of typical molecular "air chargers" which creates frictional losses as is noted in the art of air chargers and is well known to those skilled in the art.

Further care was taken to provide for these inherent losses upstream by incorporating the intake manifold (INM) (4411) as an integral part of the engine cover and the volute housing. These three elements now function as a single component and because of this fact it can be designed with the optimum configuration that will not be disturbed by repair services or age of the component.

Centrifugal Advance Cover/Cooling Channel Spool/Forced Induction (24100)-(25600)

Detail views of the centrifugal advance cover with Cooling Channel Spool with forced induction unitized embodiment is generally depicted in FIG. 241 (24100)-FIG. 256 (25600).

The unification of the centrifugal advance cover with both the Cooling Channel Spool and with the forced induction centrifugal impeller was designed as stated earlier to avoid the losses inherent in air-charger applications.

Operating as a one unit element provides for trouble free operation of many parts as is noted to those skilled in the art of unitizing components to increase efficiency and performance. It is with this idea then that a simpler applicate be instituted as until now almost all air-chargers have the inherent system losses, wherein for the case of the present invention it is imperative that a minimum of losses be tolerated.

To those who are not skilled in the art it may seem somewhat cumbersome to unitize these components, but it is common knowledge in the art that streamlining a complex system enables that system to operate more effectively and efficiently.

Cooling Channel Spool Water Jacket (21700)-(22400)

Detail views of the Cooling Channel Spool Water Jacket unitized embodiment is generally depicted in FIG. 217 (21700)-FIG. 224 (22400).

Cooling is provided for in all ICEs in regular use today. There exists a need for cooling for applications for which operating temperature exceeds the terminal safe range for the materials inherent in ICE construction.

The present invention has incorporated a "Spool Shape" modification that allows for engine coolant to surround a portion of the intake air passageway. As the spool shape rotates, the heat profile is dissipated around the rotating spool shaped element. Because this rotating cooling channel spool Intake (ICS) (10021) and Exhaust (ECS) (10031) is resident inside of the cooling water jacket intake (IWJ) (14022) and exhaust (EWJ) (14132), system coolant can wick away a significant amount of the generated unwanted heat to be recirculated through the coolant system's radiator. Additionally, this rotating spool shape performs an additional service as it assists the flow of coolant through the coolant system as a secondary coolant pump, besides just allowing the passageway of the water jacket's inherent cooling capacity. This allows for cooling of the air molecules as they pass through the helical/straight channel passageways. This spool shape allows engine coolant to surround a portion of the intake air passageway allowing the "Wicking Effect" to take place.

This Cooling Channel Spool serves multiple purposes: (i) provides cooling for the Rotary Valves, (ii) when the Supercharging forced induction feature is added, the helical/straight channel acts as an interim intercooler for the superheated intake air molecules once it has left the pressurized output of the centrifugal air compressor; (iii) since the helical/straight channel cooling devices reside integral to the Rotary Valve, which also provides for the wicking cooling effect, (iv) it also functions as an auxiliary coolant system pump, which will lengthen the life of the engine's water pump.

Centrifugal Advance Plate (22500)-(24000)

Detail views of the Centrifugal Advance Plate unitized embodiment is generally depicted in FIG. 225 (22500)-FIG. 240 (24400).

Molecular Airflow Through Engine Intake and Exhaust

The molecular airflow through the present invention Intake and Exhaust is purposefully crafted in a predetermined fashion so as to manipulate the rotational characteristics of the rotary valve ports and their associative "rotating" components to provide a sort of "follow the leader" orientation sequencing to enhance the present invention volumetric efficiencies. Every rotating component is manipulated in some fashion to provide for this feature.

The present invention valve system incorporates a "push/pull" operational concept that assists in the induction of air molecules into and then out of the combustion chamber. In the standard present invention ICE the intake Cooling Channel Spool (Spiral Channeled Element) provides a small push/pull force to be exerted on the air molecules as they enter the eye of the intakes Cooling Channel Spool. So, besides providing cooling this component also provides a slight amount of forced induction to the air molecules pushing or pulling them along as it rotates.

There are some elements that must be noted for their operational characteristics:

Spiral and Straight Channeled Cooling Channel Spool Components

This component that is in the spiral channel configuration lends itself to aid in the push/pull regiment concept that is designed into the Present invention valve system of operation. The top and bottom of the spiral channel is configured to apply themselves as a spiral impeller blade. As air molecules enter these areas their mass is acted upon by these spiral impeller blade sections, albeit that at low RPMs their effects are negligible, however at higher RPMs their effects are measurably recognizable.

Conical Frustum RVP Shape inherent in the RVD

The Conical Frustum RVP Shape provides the maximum geometrically allowable opening of the rotating valve port.

This specific design was chosen because it has a "geometrical mathematical advantage" over any rotary valve port opening because no matter the size of the ICE, characteristically, the Conical Frustum RVP Shape offers a greater volumetric opening for the induction of air molecules into the combustion chamber. Other shaped RVP openings cannot allow the comparative amount of air molecules per the valve opening duration in its cyclic time sequences.

This means that for each intake cycle the present invention RVD opens its intake orifice wider than any other rotating valve port, thusly allowing more air molecules to enter into the combustion chamber before sealing it off due to its continuous rotation. A simple geometrical plotting will suffice to show this factor:

This is further exampled through the plot of the molecular airflow through the present inventions intake and exhaust port which are specifically and purposefully crafted in a predetermined fashion so as to manipulate the rotational characteristics of the rotary valve ports and their associative "rotating" components to provide a sort of "follow the leader" orientation sequencing to enhance the present invention ICE volumetric efficiencies.

Almost every rotating component is manipulated in some fashion to provide for this feature.

Further examination in comparison to the Poppet Valve and POSH examples yields further examples of conceptual differences and structural inequivalences.

The present invention ICE valve system incorporates a "push/pull" operational concept that assists in the induction of air molecules into and then out of the combustion chamber. In the standard example of the present invention ICE the intake cooling apparatus (Spiral Channeled Element) provides a small push/pull force to be exerted on the air molecules as they enter the eye of the intakes cooling apparatus. So besides providing cooling this component also provides a slight amount of forced induction to the air molecules pushing or pulling them along as it rotates.

There are some elements that must be noted for their operational characteristics:

This specific design was chosen because it has a "geometrical mathematical advantage" over any rotary valve port opening because no matter the size of the ICE, characteristically, the Conical Frustum RVP Shape offers a greater volumetric opening for the induction of air molecules into the combustion chamber. Other shaped RVP openings cannot allow the comparative amount of air molecules per the valve opening duration in its cyclic time sequences.

This means that for each intake cycle of the example of the present invention opens its intake orifice wider than any other rotating valve port, thusly allowing more air molecules to enter into the combustion chamber before sealing it off due to its continuous rotation.

A simple geometrical plotting will suffice to show this factors concept.

Further examination in comparison to the Poppet Valve and POSH examples yields:

Comparison to Poppet Valve Construction

Within conventional internal combustion engines, the poppet valve is limited for valve opening due to the inherent limitation of the valve's residency inside the combustion chamber which hinders the travel of the piston.

Comparison to POSH Prior Art

POSH has an oval-shaped port opening that is very similar to a circular shape. This configuration significantly limits the flow that can be achieved with this prior art design. In contrast, the present invention utilizes annular sectors to construct the port openings, thus improving the overall air flow through the engine. Additionally, POSH uses an antiqued fuel mixture vocation and does not support an oil reservoir for lubrication. This means the POSH engine has to mix oil in with the fuel so as to lubricate its engine. This single factor renders the POSH engine emitting more harmful pollutants into the environment than the present invention ICE.

While not necessarily explicitly depicted in the drawings, the present invention may incorporate a conical frustum's uniquely shaped RVP in the design, which is a triangular cross-sectional area with an upper and lower circular perimeter, however, a brief description and a derived interim approximation of their operation in this context follows below.

This unique shape more geometrically allows the RVP to track the natural movements of the RVP as it rotates. This factor enables this port opening to achieve a greater geometrical port opening through the cyclic regiment of the ICE as it reciprocates through 2 or 4 stroke cyclic operation respectively.

This conical frustum's uniquely shaped RVP offers the advantage of providing the greatest possible rotary valve port opening allowable given the geometrical size and scope of any given ICE.

Its unique characteristic is unparalleled as it is impossible to take a greater geometrical shaped opening than you can achieve utilizing the conical frustum's unique shape:

The preferred exemplary invention rotary valve system embodiment is introduced into an ICE to increase the volumetric efficiency of the rudimentary invention embodiment.

The Volumetric efficiency of this preferred exemplary invention rotary valve is inherent in its superior geometrical advantage that is unable to be matched by any other styles of rotary valves.

The superiority of the preferred exemplary invention rotary valve system embodiment is due to its conical frustum's uniquely shaped RVP being utilized as the rotary port opening.

The RVP can now open and close with the widest geometrically possible opening and closing cross-section applique because the physics behind this specific physical characteristically fashioned port element simply provides a clear mathematical modeled cross-sectional area that is unmatched in other rotary valve port configurations.

Open/Closing Comparison Advantages

The present invention provides the following comparative advantages over the POSH prior art:

The first comparative advantage of the present invention over the POSH RVP is that an oval shaped RVP is mathematically flawed. POSH uses an oval shaped RVP port that opens and closes with a smaller cross-sectional area than does the preferred exemplary invention rotary valve system.

While POSH's Valve system is struggling to open, the preferred exemplary invention rotary valve system's superior cross-sectional area is already open wide enough to begin its designed preferred task of intaking and then expelling a greater volumetric efficient molecular example.

POSH at best has a circular radius of approximately ⅔ of the cross-sectional area of the present invention's RVP based on the approximations derived data available in POSH.

POSH utilizes an oval geometrically shaped RVP that leaves a greater geometrical variance as compared to the conical frustum in the present invention RVP.

The open cross-sectional area of the present invention's RVP that perimeters around the POSH RVP is an irrefutable mathematical modeled proof that the present invention's RVP is superior in the induction requirement of a valve system for an ICE. POSH does not select the most effective opportunity as a circular RVP would have been an obvious choice for a person skilled in the art.

The ICE is said to "breathe" easier when it has a greater cross-sectional area valve characteristic profile as is well known to those skilled in the art of ICE.

When an ICE is breathing easier it is more fuel efficient and generates a greater power output with less harmful exhaust pipe emissions.

Easily seen in the table below, the preferred exemplary invention rotary valve system opens the maximum that is geometrically capable the full range of the available cross-sectional area given the cyclic restrictions of the 2 or 4 stroke regiment of an ICE and the volumetric size of the ICE.

RVP Timing Comparison

The preferred exemplary invention rotary valve system embodiment may adhere to the common timing regiments of typical 2 and 4 stroke ICEs.

The following chart shows a typical timing example following these concepts. These timing regiments are not limitive to the present invention.

For the 4-stroke cyclic operation of an ICE we find that there is only a 90-degrees geometric opportunity wherein the intake or exhaust valve has to be open because the valve in a 4 stroke is only allowed one fourth of the duration of the crankshaft's revolution. In the 2-stroke example the intake or exhaust valve is open one half of the duration of the crankshaft's revolution.

This geometric opportunity is available longer at lower RPM speeds and shorter at higher RPMs speeds as is detail in the following rotary valve port timing chart:

| Volumetric RPM | Per Valve Port Open Time | Estimated Volumetric RPM Limit |
|---|---|---|
| 0 | 0 | |
| 1 | 15.00 | |
| 100 | 0.15000 | |
| 1000 | 0.01500 | |
| 2000 | 0.00750 | |
| 3000 | 0.00500 | |
| 4000 | 0.00375 | |
| 5000 | 0.00300 | |
| 6000 | 0.00250 | Posh is estimated to experience a limited performance due in part to an estimated compression leakage based on the invention reporting inherent in his patent application, resulting in an RPM limit estimated to be around 6600. |
| 7000 | 0.00214 | |
| 8000 | 0.00188 | |
| 9000 | 0.00167 | |
| 10000 | 0.00150 | Poppet Valves have shown a tendency towards an upper RPM limit of 7000 to 10500 as is well known to those skilled in the art |
| 11000 | 0.00136 | |
| 12000 | 0.00125 | |
| 13000 | 0.00115 | |
| 14000 | 0.00107 | |
| 15000 | 0.00100 | |
| 16000 | 0.00094 | |
| 17000 | 0.00088 | |
| 18000 | 0.00083 | |
| 19000 | 0.00079 | |
| 20000 | 0.00075 | |
| 21000 | 0.00071 | |
| 22000 | 0.00068 | |
| 23000 | 0.00065 | |
| 24000 | 0.00063 | |
| 25000 | 0.00060 | |
| 26000 | 0.00058 | |
| 27000 | 0.00056 | |
| 28000 | 0.00054 | Conservatively, the present exemplary invention is estimated that its RVD runs into its projected volumetric limit at or about the 28440 rpm mark. |
| 29000 | 0.00052 | |
| 30000 | 0.00050 | |

Volumetric RPM estimated results:

POSH Valve Port Per Valve Open Time (25%) (sec)

Posh Valve Volumetric Limit 6600

Poppet Valve Port Per Valve Open Time (35%) (sec)

Poppet Valve Volumetric Limit 10500

The present invention's Rotary Valve Port Per Valve Open Time (94.8%) (sec)

LSE Valve Volumetric Limit 28440

Per (100%) Valve Port Open Duration Time (100%)/(sec)

The preferred exemplary invention rotary valve system makes the most of this as because of the RVP being 1.5 to 2.0 times as wide due to its conical frustum's uniquely shaped RVP. Geometrically oval shaped RVP can't open as wide during the opening or closing operation.

The POSH valve port opening is unable to match the volumetric efficiency of a conical frustum shaped RVP because the conical frustum opens a wide spectrum of the 90-degree exampled opening available. What that means in terms of port opening is that geometrically the capacity of a wider opened port cross-sectional area verses a gradual opening oval port that as soon as it does open fully it begins to close.

The above values are based in part on derived information from POSH, actual test data may differ.

It is understood that all three styles of valves gradually open and close in respect of the open and close duration timing. This open duration is the amount of time that the rotating travel of the crankshaft allocates for any valve system which is incorporated as the valve system for an ICE. The valves have a 2:1 ratio in any 4-stroke ICE and 1:1 ratio in any 2 stroke ICE with the crankshaft rotation.

The present invention's conical frustum's uniquely shaped RVP allows the port to maintain open in a consistent non-diminishing profile during the entire rotational open duration of its operation. However, in the POSH example where an oval shape is used, the port opening increases gradually and at its apex begins to diminish its profile. This is a clear geometrical disadvantage that the present invention inherently overcomes because of its geometrical superiority.

The second comparative advantage of the present invention over the POSH is that the POSH RVP changes its profile shape continually throughout its operation in such a fashion where the two conditions, i.e. (i) the port gradually opens creating an obvious restriction when it initializes its profile for performing the open duration of its operation; (ii) at the point that the port reaches its apex, it begins the similar process as it closes causing a continual restrictive operational profile. This creates a greater restriction on the flow of gas molecules into the combustion chamber during intake operations in the POSH example and then in a similar fashion, as the combusted gas molecules are expelled out of the combustion chamber during the exhaust operation. Basically, this means that the ICE is starved for its molecular flow on both the intake and the exhaust operational profiles in the POSH rotary valve system example.

Whether the RVP be round or oval, there is not a geometrically comparative ability for any other shape to compete with the conical frustum's uniquely shaped RVP geometrical shape of the preferred exemplary invention embodiment.

The third comparative advantage of the present invention over the POSH is that the POSH valve system cannot have an oil reservoir. This is due to the fact that POSH did not teach the presence of an oil reservoir and mixes its fuel with oil in the crankcase where the oil reservoir would also have to be to oil the ICE's moving parts, as is well known to those skilled in the art of 4 stroke ICEs.

The fourth comparative advantage of the present invention over the POSH is because the POSH valve system burns some of the lubricating oil in the combustion chamber in its attempt to lubricate itself and produce power. The result of doing this is dirty exhaust pipe emissions. Whereas the preferred exemplary invention does not burn its lubricating oil in the combustion chamber as it has its separate oil reservoir for lubrication, thereby resulting in cleaner exhaust pipe emissions than does the POSH ICE example.

The fifth comparative advantage of the present invention over the POSH is the sealing system. POSH does not teach a sealing vocation to address containment of the compression or combustion gases. Whereas the preferred exemplary invention incorporates five distinct sealing vocations that ensure an effective operational profile by containing the fluids and compression.

The sixth comparative advantage of the present invention over the POSH is the cooling system. POSH does not teach the incorporation of a cooling system. Whereas the preferred exemplary invention provides for a cooling system directly adapted to the rotary valve elements and further employs an assist to the inherent ICE water pump as an added feature. This ensures that the ICE and its internal componentry remain cooler during its normal operational profile.

The seventh comparative advantage of the present invention over the POSH is the centrifugal advance system. POSH does not teach the incorporation of a centrifugal advance system. Whereas the preferred exemplary invention provides for an advance on the intake and exhaust RVPs. This yields a greater versatility towards providing for a more effective volumetric efficient profile operation.

The eighth comparative advantage of the present invention over the POSH is the forced induction system. POSH does not teach a forced induction system. Whereas the preferred exemplary invention provides for a three-tiered forced induction profile that is inherent to the intake and exhaust profiles. This allows for a greater induction of air molecules increasing the ICE's ability to breathe.

The ninth comparative advantage of the present invention over the POSH is the 2 stroke ICE example. The POSH converts attributes from a 2 stroke to run as a 4 stroke. POSH does not teach a 2 stroke ICE method example. This was identified as a novelty in the Preliminary Report on Patentability. Whereas the preferred exemplary invention provides a 2- and 4-stroke ICE operational profile for four variations of the rotary valve port depiction.

The tenth comparative advantage of the present invention over the POSH is the fuel mixture method. The POSH does not teach an air fuel mixture which is accomplished inside of the combustion chamber. Whereas the preferred exemplary invention mixes its fuel inside of the combustion chamber with the air molecules using a direct injection method. It is commonly noted in the art of ICE that mixing the air-fuel mixture inside of the combustion chamber is the most widely used method due to the inherent benefits and characteristic profile advantages attributable to mixing the air-fuel mixture inside of the combustion chamber.

The eleventh comparative advantage of the present invention over the POSH is the fuel delivery method. A carburetor is less fuel efficient than a direct injection system. Whereas the preferred exemplary invention uses a direct injection fuel delivery method, POSH does not teach a direct injection vocation as it is commonly practiced today and well known to those skilled in the art. The twelfth comparative advantage of the present invention over the POSH is its multi-staged valve element. This is the feature that determines the cross-sectional opening size of the combustion chamber's intake or exhaust passageways. The further it is inserted into the fixed ports passageway, the greater the molecular delay that is imposed. There are infinite MSV configurations possible, depictions are not limitive. POSH does not teach a multi-staged valve element.

Combinatorics of the Present Invention

Due to the inherent ability of combining the features of the present invention ICE it is easily configured in the following 4 valve configuration wherein there are two intake and two exhaust RVPs.

Along with simple manipulations of the elemental features, the MSV, the RVD and the RVC can be incorporated together in one ICE. The fitment of the sealing, cooling, advance, and forced induction becomes also a simple inclusion in this overall application because they are still standard applicate. Thusly, the volumetric efficiency is increased by a factor of at least 2 (two) for the non-forced induction and 4 (four) for the forced induction configuration. Since the valve appliances of the present invention ICE are applicable to being configured anywhere around the perimeter of the combustion chamber, even from the bottom of the combustion chamber, we find the applicability of the present invention ICE valve system to be near limitless. So, the ICE depictions herein are typical yet not limitive. Other variations are also possible.

It can be noted that the simplicity of combining Species A and Species C, the accompanying gear coupling cluster has five elements on the front and back sides of this configuration since there would be two of each species with Species A requiring a drive gear on both sides.

This configuration is easily adaptable for the cooling, centrifugal advance and forced induction features.

It is a simple implementation of the two rudimentary rotary valve port elements where they share the same gear coupling cluster and also share the Cooling Channel Spool water jacket. While both the centrifugal advance and the forced induction are separate features, however, the forced induction would increase by a factor of four inside of the combustion chamber. This is because inside of a closed system forces add or combine.

Molecular Airflow Profile

The Molecular Airflow Profile starts at the intake manifold.

The present invention ICE is able to use both intake styles common to the ICE industry (i) the "High Rise" or "Low Rise" manifold or commonly referred to as a typical "Dual Plane" manifold. This Dual Plane manifold offers greater high RPM performance as it offers less resistance to the flow of air molecules (ii) the classic "Tunnel Ram" manifold which offers greater torque off the line. No distinction was made for either one of these styles nor was they depicted as they are both well known to those skilled in the industry and are readily adaptable to common ICE applications.

So, the molecular air flow is taken into consideration greatly when the choice of which elements were to comprise the present invention ICE's valve system.

The airflow is initiated by the vacuum draw of the intake stroke of the ICE.

This initial vacuum is caused by the downwards travel of the piston as it is reciprocated in the ICE's combustion chamber.

The four or two stroke functions that must be accomplished are, intake-compression-power-exhaust, and then repeat as is depicted in the timing chart above.

The 2-stroke profile combines the intake and compression functions together as well as combining the power and exhaust strokes on just two of the corresponding reciprocated strokes of the ICE's piston and crankshaft assembly. Whereas, the 4-stroke profile leaves each stroke to four corresponding reciprocated strokes of the ICE's piston and crankshaft assembly. There are more stroke configurations that the present invention ICE is adaptable to but are not depicted herein. Such as a double expansion secondary cylinder that is added as an expansion processor to extract more energy from the fuel.

In a closed system, forces are combined or added as such the follow the leader orientation sequencing to enhance the present invention ICE volumetric efficiencies objectives that each element of the valve system is either perceptively placed or configured in anticipation of its inherent function to act in concert with each subsequent or previous element to further enhance the volumetric efficiency.

Forced Induction/Discharge—in a Closed System Forces Add or Combine

The forced induction is achieved through the incorporation of centrifugal impellers. These impellers are molded into the elements where they are deployed, thus providing for a mechanical advantage. The centrifugal impellers generate high pressure and low velocity as a final by-product of its operation.

First, the centrifugal impeller in molded or bolted to the rotary valve port element in such a fashion as to cause the rotational reaction of the impellers to exert a force on the mass of the air molecules. This creates a pushing or pulling force that makes the molecules move in the prescribed direction of the impeller blades.

Second, the Spiral Channel (impeller) that is molded into the "Spool" shaped section of the Cooling Channel Spool applies a similar force to the rotational reaction of this impeller and also exert a force on the mass of the air molecules in a similar fashion to further assist the flow of air molecules along the path to the combustion chamber. These two forces add or combine and once the RVP's fixed intake port are aligned and the intake stroke begins, all three forces act to more effectively and volumetrically efficiently fuel the combustion chamber with gas molecules.

Third, the opening of the RVP can host/have slight slants or indentions that react similarly to the rotation characteristics of a fan blade and exert a force on the air molecules as well as the "Tuned" length of the RVP element can influence the induction of air molecules.

Flipping the spiral impellers around into a counter rotation (clockwise/counter-clockwise) can assist in the exhausting of spent combusted gases out of the combustion chamber. Only the spiral impeller can be used in this fashion since the high heat of the compression of gases increases temperature and would cause premature failures if centrifugal impellers were attempted to be used on the exhaust side of the ICE. These spiral impellers can be attached to the output of the RVD or integral to the RVC.

The only depictions used are the examples where centrifugal or spiral impellers are used on the RVD. However, the RVC can be configured as is depicted in the drawings below:

Albeit that this configuration is not nearly as effective as the ones earlier discussed, they do still provide some forced induction capability at high RPM wide open throttle operation.

It is the high RPM operation where ICEs experience a condition where the ICEs tend to starve for air due to the inherent mechanical interference of the internal parts of an ICE creating a massive amount of friction as the air molecules attempt to flow. This feature could be used to enhance the operations of small engines where a simple modification could facilitate enhancing its operational capability.

Of course there is also the premise of incorporating a transmission to drive these centrifugal impellers at higher speeds thus delivering higher boosted air molecules pressure. The present invention does not intend to provide a full supercharger and makes no attempt at configuring a turbocharger, however these ICEs just as others can be configured with after-market superchargers/turbochargers, the present invention configuration is at best a pre-charger for the specific purpose of overcoming the inherent mechanical interference of ICEs in general.

These above listed embodiments all work with in concert with the flow of air molecules and directly determine the volumetric efficiency of the present invention ICE valve system.

This means that there is a specific intake sequence to the flow of air molecules once they enter the air filter's internal area:

(1) first is the intake stroke of the ICE—this is caused by the downward stroke of the piston (RPI) (2563) inside of the combustion chamber (CCH) (2964). This creates a momentary vacuum that begins the input of molecules into the combustion chamber (CCH) (2964).

(2) the intake flow of the intake manifold (tuning)—this is caused by the combination of the intake stroke and the ambient air pressure of 14.7 psi, that follows the molecular inertia (3) the forced induction elements—this is caused by the centrifugal forces acting on the mass of the air molecules. This creates a reservoir of high-pressure low velocity air molecules to sit and wait until the RVP aligns with the fixed port. Once aligned, this boosted molecular inertia begins to move into the combustion chamber (CCH) (2964).

(4) the flow characteristics of the Rotary Valve Port element—RVD or (RVC) (N/D) has a geometrical advantage of opening nearly as wide as the sidewall length and width of the combustion chamber (CCH) (2964). If the opening was small this opening can act as a restriction adding a timing delay. The centrifugal advance enhances this by being the component that can change the effective size of the Rotary Valve Port (RVP) Intake (IVP) (1761) and Exhaust (EVP) (1769).

(5) the multi-staged valve positioning—this is the feature that determines the cross-sectional opening size of the combustion chamber (CCH) (2964)'s intake or exhaust passageways. The further it is inserted into the fixed ports passageway, the greater the molecular delay is imposed. There are infinite MSV configurations possible, depictions are not limitive (6) the resonate characteristics of the combustion chamber (CCH) (2964)—the shape, bore and stroke of the combustion chamber (CCH) (2964) influence the movements of the gas molecules inside of the combustion chamber (CCH) (2964). This affect dictates the gas atomization capable profile. Whether the molecules tumble or swirl is caused by these factors. Since the opening is to an angle, the molecules both swirl and tumble to some degree. Changing the shape, bore and stroke of the combustion chamber (CCH) (2964) or component surface dimensions of the edges can offer some ability to adjust this feature.

(7) the entire length of the distance from the intake manifold's throttle plate to the combustion chamber (CCH) (2964) plus the distance of the air filter inlet to the throttle plate—this causes good high RPM performance or good low-end response off the line.

(8) compression ratio—since there are no valves inside of the combustion chamber (CCH) (2964), the travel of the piston (RPI) (2563) is unabated, allowing for higher compression ratios as the result.

(9) valve overlap—the intake valve is configured to begin opening before the exhaust valve is completely closed. This feature is well known to those skilled in the art and is sometimes termed, "the Scavenger Effect," which more completely exhausts the combustion chamber (CCH) (2964) on the exhaust stroke. The centrifugal advance (CAD) (4950) can have a slight influential effect on this feature such that the early or late opening of the valve port can be conditioned as a profile responsive to the ICE RPM. In poppet valves this feature is controlled by the camshaft, in the present invention the valve timing is controlled by the timing of the placement of the valve port by the gear teeth of the driving gear or crankshaft's profile which can be selective with splines on the crankshaft driving gear element or as in most models where a drive gear is used the static timing is adjustable based on the incremental variance of the gear teeth. So, the most versatile opportunity is where there are a high number of gear teeth. Normally the drive gear will have 30 teeth and the RVD or RVC which is being driven has 60 teeth for a 4 stroke and 30 teeth for a 2 stroke. If there are 50 teeth on the driving gear and 100 teeth on the driven gear, there will be a greater range to vary the rotary valve port timing profile.

The directional application of each element is important as if one element is installed backwards then that element would be working against the prescribed flow of air molecules, so it is essential that care is taken to ensure this factor is followed. In this regard the components only fit together in one configuration. As is common in the art and well known to those skilled in the art, indexing each subsequent elements makes assemble and servicing operations simpler.

It should be noted that the exhaust side of the ICE is already extremely hot. Unitizing the exhaust RVP (EVP) (1769) together with the cooling apparatus allows some better control of the output temperatures of the exhaust and the emissions of those molecular elements. This is extremely important as if temperatures are regulated well, then some of the more negative pollutants are never created in high numbers in the combustion chamber (CCH) (2964) and then this ICE runs cleaner and more volumetrically efficient.

The exhaust of the spent combusted gases is aided by using the spiral impeller (ESI) (8936) of the cooling apparatus (CJA) (4930) and spiral impeller blades attached to the output of the RVD. This means that there is a specific exhaust sequence to the flow of air molecules once they exit the combustion chamber (CCH) (2964):

(1) first, there is the exhaust stroke of the ICE—this is caused by the upward stroke of the piston (RPI) (2563) inside of the combustion chamber (CCH) (2964).

(2) the exhaust flow of the exhaust manifold (tuning)—this is caused by the exhaust stroke combined with the length of the exhaust manifold (EXM) (4492).

(3) the forced induction elements—this is caused by the centrifugal spiral impeller (ESI) (8936) forces acting on the mass of the spent combusted gas molecules.

(4) the flow characteristics of the Rotary Valve Port (EVP) (1769) element has a geometrical advantage of opening nearly as wide as the sidewall length and width of the combustion chamber (CCH) (2964).

(5) the multi-staged valve (MSV) (4970) positioning—this is the feature that determines the cross-sectional opening size of the combustion chamber's (CCH) (2964) fixed intake port (FIP) (1741) or fixed exhaust port (FEP) (1771) passageways. There are infinite (MSV) (4970) configurations possible. The present invention's depictions are not limitive.

(6) the resonate characteristics of the combustion chamber (CCH) (2964)—the shape, bore and stroke of the combustion chamber (CCH) (2964) influence the movements of the gas molecules inside of the combustion chamber (CCH) (2964). This affect dictates the gas atomization profile.

(7) the entire length of the distance from the exhaust manifold's (EXM) (4492) connecting plate/flange to the end of the exhaust pipe—this causes good overall response if the size and length of the exhaust components are tuned so as not to adversely affect the exhaust flow.

(8) compression ratio—since there are no valves inside of the combustion chamber (CCH) (2964), the travel of the piston (RPI) (2563) is unabated, allowing for higher compression ratios as the result.

(9) valve overlap—the intake RVP (IVP) (1761) is configured to begin opening before the exhaust RVP (EVP) (1769) has completely closed. This feature is well known to those skilled in industry and is sometimes termed, "the Scavenger Effect," which more completely exhausts the combustion chamber (CCH) (2964) on the exhaust stroke.

The flow of molecules through the present invention ICE is this 18-step process that occurs in a cyclic sequence from start to finish. Then of course it repeats the entire 2 Stroke or 4 Stroke operations for each and every RPM, which is countable by the firing of the ignition device. The ignition device can be a sparkplug, glow plug, laser igniter or some other energetic power source.

The nine steps of the intake as well as the nine steps of the exhaust must happen with the same similar repetition with either the 2 or 4 stroke operation.

This sequence must occur with every RPM, so it can be seen that changes to the MSV and CAD happen of several iterations advancing or retarding continuously dependent on demand or load on the ICE. Using computer controls will be the best method for controlling these features as well as ignition timing.

Centrifugal Advance

The centrifugal advance apparatus utilizes the inertia of the rotational force acting on the centrifugal advance counter weight that is acting against the CAD return spring. As the ICE RPM increases the centrifugal advance counter weight pushes or pulls the centrifugal advance plate in an advancing direction or a retarding direction dependent on the profile of the return spring and the centrifugal advance counter weight designation or objective. The centrifugal advance can start in an advanced or retarded static state and due to RPM change to the opposite state while the ice is running. This mechanical centrifugal advance apparatus can be designated to compensate for otherwise erratic starting conditions until the ICE has reached full operating temperatures. There are a wide range of usages where this feature is beneficial.

MSV

The MSV can be configured to control its operation on the presence or absence of manifold, throttle, or venturi vacuum. These various vacuum sources only occur in significant levels at specific points along the operating range of the ICE:

manifold vacuum—most pronounced at idle and just off idle operations throttle vacuum—is vacuum that is activated by the movement of the throttle plate or the lack thereof. It is sometimes referred to as vacuum switch.

venturi vacuum—most pronounced at high cruise speeds and snap throttle operations We can use manifold, throttle, or venturi vacuum through a series of switches analogously or monitored with transducers to provide a control as a subroutine of a computer controller. The MSV affects a delay in the flow of the molecules into or out of the combustion chamber. This delay is caused by the MSV presenting itself "piercing" into the fixed intake or exhausts ports passageways and once inserted the molecules will have to go around it in order to complete their travel path, thusly creating a timing delay. The MSV is found placed in close proximity in between the combustion chamber and the rotary valve port element (RVD or RVC) as can be seen in the drawing below. There are limitless configurative possibilities for the placement or operational characteristic of the MSV. The variations shown below on the right are not limitive.

MSV PORT Manufacture/Fabrication

The MSV port may have various sizes and shapes too numerous to depict in the drawings provided herein. Since the MSV port must pierce into the Fixed Intake and Exhaust Ports, special cutting tools need to be used to cut the MSV Port into the engine block where the Fixed Ports reside. The MSV's main function is to provide a restriction that causes a time delay to the flow of air molecules over and around the MSV. This delay can limit the flow and thusly can be used to create an operational profile to cause the ICE to be more fuel efficient and less harmful emission capable. This delay can cause the combustion chamber to run hotter or cooler at any range of the ICE's operation. It is well known that the introduction or the restriction of the amount of air molecules in a precision fashion is an essential component is fuel efficient operation of ICEs.

Several Engineering Machining techniques are available to facilitate these port cuts. They include but are not limited to WaterJet Cutters, Laser Cutters, Additive Manufacturing, Subtractive Manufacturing, and a process where Machining/drilling is done to facilitate cutting the MSV Port opening in engine block and then the access holes are welded back up and surfaces re-machined to specifications. Also, the Engine Head can be separated from the Engine Block making the access to normal length mills and cutting tools possible. Typical CNC Mills can cut holes and slots 1 to 2 inches without much difficulty. In some cases, special tools are made to facilitate certain kinds of manufacturing processes.

Most good fabrication shops today will have all three styles of manufacturing machines. Typical performance for these techniques is as follows:

WaterJet Cutters—4 to 5 inches deep in metals with great accuracy (this one can go much deeper but accuracy begins to drop off at or beyond the 5-inch point).

Laser Cutters—up to 2 inches on metals with great accuracy.

CNC Mills—1 to 2 inches on metals with great accuracy

For manufacturing purposes of a typical Engine Block Prototype, the fabrication shop may a process where Machining/drilling is done to facilitate cutting the MSV Port opening in engine block and then the access holes are welded back up and surfaces re-machined to specifications. The location of the access hole is placed away from critical elements of the engine block. A point closest to the edges of the engine block is typically chosen to install the MSV Ports.

Differentiating POSH Prior Art

The present invention differs significantly from the POSH prior art. Specifically, geometrically, the RVD opens at the point that the piston begins going downwards in the combustion chamber on the intake stroke and closes as the piston begins to go upwards on the compression stroke. There is no wider opening geometrically possible than the present invention "conical frustum" angular shaped port design. POSH utilizes an "Oval Shaped" rotary port opening that severely hampers the intake flow of air molecules because as soon as it is opened to its maximum size, it begins to diminish in size. The conical frustum angular shaped port opening of the present invention valve system opens wider and admits more air molecules at any comparative point of operation than does the POSH disclosure. This is achieved by a consistent geometrical opening shape that remains constant throughout the valve port opening duration.

The present invention includes a Conical Frustum RVP Shape which differentiates it from the POSH prior art. The open-to-close the timing period are the same on 2 or 4 stroke variants, but the amount of air molecule flow is greater in the present invention valve system as compared to POSH. This differentiation and the manner in which POSH mixes fuel also differentiate the designs.

The POSH design does not permit an oil reservoir in the crankcase, and as such the POSH design must mix oil with fuel to lubricate his engine. The present invention permits an oil reservoir in the crankcase on both the 2 Stroke and the 4 stroke configurations, so this means the present invention engine can support pressurized oil lubrication so that means that it will last longer and be more reliable than design based on the POSH disclosure. Additionally, POSH only has the oiling available internal to the crankcase, this means his engine does not lubricate the moving parts on the outside of the crankcase. The rotating disc on the POSH engine will likely suffer mechanical breakdown due to a lack of lubrication.

POSH does not separate the intake valve from the exhaust, so when the exhaust heats up the valve and it opens for the next intake stroke, this design more than likely will experience Pre-Detonation of the fuel resulting in a gross loss of power. The present invention MSV allows for adjustment of the air flow while the engine is running. The present invention engine is structurally different than the POSH design and likely to be more fuel efficient than POSH.

Rudimentary System Summary

The present invention rudimentary system may be broadly generalized as a valve system comprising:

(a) intake engine block cover (IEC) (1708);
(b) intake rotary valve disc (IVD) (1762);
(c) intake upper engine block head (IUH) (1747);
(d) intake lower engine block crankcase (ILC) (1748);
(e) upper engine block center section (UBS) (1749);
(f) crankshaft (CRK) (1765);
(g) exhaust upper engine block head (EUH) (1777);
(h) exhaust lower engine block crankcase (ELC) (1778);
(i) lower engine block center section (LBS) (1779);
(j) exhaust rotary valve disc (EVD) (1768); and
(k) exhaust engine block cover (EEC) (1709);

wherein:

the CRK (1765) comprises a longitudinal rotation axis (LRA);
the IVD (1762) is coupled to the CRK (1765) and concentric with the LRA;
the EVD (1768) is coupled to the CRK (1765) and concentric with the LRA;
the IEC (1708), the IUH (1747), and the UBS (1749) each comprise a fixed intake port (FIP) (1741);
the FIP comprises an annular sector void;
the EEC (1709), the (EUH) (1777), and the (UBS) (1749) each comprise a fixed exhaust port (FEP) (1771);
the FEP comprises an annular sector void;
the IVD (1762) comprises an intake rotary valve port (IVP) (1761);

the IVP (1761) comprises an intake annular sector void (ISV) configured to control intake air flow from the IEC (1708) FIP through the IUH (1747) FIP through the UBS (1749) FIP as the IVD (1762) rotates;

the EVD (1768) comprises an exhaust rotary valve port (EVP) (1769); and the EVP (1769) comprises an exhaust annular sector void (ESV) configured to control exhaust gas flow from the UBS (1749) FEP through the EUH (1777) FEP through the EEC (1709) FEP as the EVD (1768) rotates.

This general system summary may be augmented by the various elements described herein to produce a wide variety of invention embodiments consistent with this overall design description.

Enhanced System Summary

The present invention enhanced system may be broadly generalized as a valve system comprising:

(a) intake engine block cover (IEC) (1708);
(b) intake rotary valve disc (IVD) (1762);
(c) intake upper engine block head (IUH) (1747);
(d) intake lower engine block crankcase (ILC) (1748);
(e) upper engine block center section (UBS) (1749);
(f) crankshaft (CRK) (1765);
(g) exhaust upper engine block head (EUH) (1777);
(h) exhaust lower engine block crankcase (ELC) (1778);
(i) lower engine block center section (LBS) (1779);
(j) exhaust rotary valve disc (EVD) (1768); and
(k) exhaust engine block cover (EEC) (1709);
(l) intake forced induction (IFI) (1720); and
(m) exhaust forced discharge (EFI) (1730);

wherein:

the CRK (1765) comprises a longitudinal rotation axis (LRA);

the IVD (1762) is coupled to the CRK (1765) and concentric with the LRA;

the EVD (1768) is coupled to the CRK (1765) and concentric with the LRA;

the IEC (1708), the IUH (1747), and the UBS (1749) each comprise a fixed intake port (FIP) (1741);

the FIP comprises an annular sector void;

the EEC (1709), the (EUH) (1777), and the (UBS) (1749) each comprise a fixed exhaust port (FEP) (1771);

the FEP comprises an annular sector void;

the IVD (1762) comprises an intake rotary valve port (IVP) (1761);

the IVP (1761) comprises an intake annular sector void (ISV) configured to control intake air flow from the IEC (1708) FIP through the IUH (1747) FIP through the UBS (1749) FIP as the IVD (1762) rotates;

the EVD (1768) comprises an exhaust rotary valve port (EVP) (1769); and the EVP (1769) comprises an exhaust annular sector void (ESV) configured to control exhaust gas flow from the UBS (1749) FEP through the EUH (1777) FEP through the EEC (1709) FEP as the EVD (1768) rotates;

the IFI (1720) comprises an intake cooling water jacket (IWJ) enclosing an intake centrifugal impeller (CIP), intake spiral impeller (ISI), and intake spiral channel (ISC);

the CIP is coupled to the CRK (1765) along the LRA;

the ISI is coupled to the CRK (1765) along the LRA;

the IFI (1720) is configured to transfer and compress air from the IEC (1708) FIP to the IUH (1747) FIP;

the EFI (4930) comprises an exhaust cooling water jacket (EWJ) enclosing and exhaust spiral impeller (ESI), and exhaust spiral channel (ESC);

the ESI is coupled to the CRK (1765) along the LRA; and the EFI (4920) is configured to transfer exhaust from the EEC (1708) FEP to the EUH (1747) FEP.

This general system summary may be augmented by the various elements described herein to produce a wide variety of invention embodiments consistent with this overall design description.

Rudimentary Method Summary

The present invention rudimentary method may be broadly generalized as a valve method operating on a valve system, the system comprising:

(a) intake engine block cover (IEC) (1708);
(b) intake rotary valve disc (IVD) (1762);
(c) intake upper engine block head (IUH) (1747);
(d) intake lower engine block crankcase (ILC) (1748);
(e) upper engine block center section (UBS) (1749);
(f) crankshaft (CRK) (1765);
(g) exhaust upper engine block head (EUH) (1777);
(h) exhaust lower engine block crankcase (ELC) (1778);
(i) lower engine block center section (LBS) (1779);
(j) exhaust rotary valve disc (EVD) (1768); and
(k) exhaust engine block cover (EEC) (1709);

wherein:

the CRK (1765) comprises a longitudinal rotation axis (LRA);

the IVD (1762) is coupled to the CRK (1765) and concentric with the LRA;

the EVD (1768) is coupled to the CRK (1765) and concentric with the LRA;

the IEC (1708), the IUH (1747), and the UBS (1749) each comprise a fixed intake port (FIP) (1741);

the FIP comprises an annular sector void;

the EEC (1709), the (EUH) (1777), and the (UBS) (1749) each comprise a fixed exhaust port (FEP) (1771);

the FEP comprises an annular sector void;

the IVD (1762) comprises an intake rotary valve port (IVP) (1761);

the IVP (1761) comprises an intake annular sector void (ISV) configured to control intake air flow from the IEC (1708) FIP through the IUH (1747) FIP through the UBS (1749) FIP as the IVD (1762) rotates;

the EVD (1768) comprises an exhaust rotary valve port (EVP) (1769); and the EVP (1769) comprises an exhaust annular sector void (ESV) configured to control exhaust gas flow from the UBS (1749) FEP through the EUH (1777) FEP through the EEC (1709) FEP as the EVD (1768) rotates;

the method comprising the steps of:

(1) rotating the CRK (1765) around the LRA to position the ISV over the IEC (1708) FIP so as to allow air and/or fuel to pass from the IEC (1708) through the IUH (1747) FIP through the UBS (1749);
(2) rotating the CRK (1765) around the LRA to compress and ignite an air/fuel mixture within the UBS (1749);
(3) rotating the CRK (1765) around the LRA to expel exhaust gasses from the UBS (1749) FEP through the EUH (1777) FEP through the EEC (1709) FEP;
(4) rotating the CRK (1765) around the LRA to expel exhaust gasses from the UBS (1749) and intake an air and/or fuel mixture into the UBS (1749); and
(5) proceeding to step (1).

wherein:

the method operates on the CRK (1765) as a two-stroke power cycle.

This general method may be modified heavily depending on a number of factors, with rearrangement and/or addition/deletion of steps anticipated by the scope of the present invention. Integration of this and other preferred exemplary embodiment methods in conjunction with a variety of preferred exemplary embodiment systems described herein is anticipated by the overall scope of the present invention.

The method described above is a general two-stroke engine cycle that has been optimized using the intake IVD and exhaust EVD discs that have corresponding IVP and EVP structures that time the intake and exhaust flows through the combustion chamber in accordance with the rotating crankshaft.

Enhanced Method Summary

The present invention enhanced method may be broadly generalized as a valve method operating on a valve system, the system comprising:

(a) intake engine block cover (IEC) (1708);
(b) intake rotary valve disc (IVD) (1762);
(c) intake upper engine block head (IUH) (1747);
(d) intake lower engine block crankcase (ILC) (1748);
(e) upper engine block center section (UBS) (1749);
(f) crankshaft (CRK) (1765);
(g) exhaust upper engine block head (EUH) (1777);
(h) exhaust lower engine block crankcase (ELC) (1778);
(i) lower engine block center section (LBS) (1779);
(j) exhaust rotary valve disc (EVD) (1768); and
(k) exhaust engine block cover (EEC) (1709);
(l) intake forced induction (IFI) (4920); and
(m) exhaust forced discharge (EFI) (4930);

wherein:

the CRK (1765) comprises a longitudinal rotation axis (LRA);

the IVD (1762) is coupled to the CRK (1765) and concentric with the LRA;

the EVD (1768) is coupled to the CRK (1765) and concentric with the LRA;

the IEC (1708), the IUH (1747), and the UBS (1749) each comprise a fixed intake port (FIP) (1741);

the FIP comprises an annular sector void;

the EEC (1709), the (EUH) (1777), and the (UBS) (1749) each comprise a fixed exhaust port (FEP) (1771);

the FEP comprises an annular sector void;

the IVD (1762) comprises an intake rotary valve port (IVP) (1761);

the IVP (1761) comprises an intake annular sector void (ISV) configured to control intake air flow from the IEC (1708) FIP through the IUH (1747) FIP through the UBS (1749) FIP as the IVD (1762) rotates;

the EVD (1768) comprises an exhaust rotary valve port (EVP) (1769); and the EVP (1769) comprises an exhaust annular sector void (ESV) configured to control exhaust gas flow from the UBS (1749) FEP through the EUH (1777) FEP through the EEC (1709) FEP as the EVD (1768) rotates;

the IFI (4920) comprises an intake cooling water jacket (IWJ) enclosing an intake centrifugal impeller (ICI), intake spiral impeller (ISI), and intake spiral channel (ISC);

the ICI is coupled to the CRK (1765) along the LRA;

the ISI is coupled to the CRK (1765) along the LRA;

the IFI (4920) is configured to transfer and compress air from the IEC (1708) FIP to the IUH (1747) FIP;

the EFI (4930) comprises an exhaust cooling water jacket (EWJ) enclosing and exhaust spiral impeller (ESI), and exhaust spiral channel (ESC);

the ESI is coupled to the CRK (1765) along the LRA; and the EFI (4920) is configured to transfer exhaust from the EEC (1708) FEP to the EUH (1747) FEP.

This general method may be modified heavily depending on a number of factors, with rearrangement and/or addition/deletion of steps anticipated by the scope of the present invention. Integration of this and other preferred exemplary embodiment methods in conjunction with a variety of preferred exemplary embodiment systems described herein is anticipated by the overall scope of the present invention.

The method described above is a general two-stroke engine cycle that has been optimized using the intake IVD and exhaust EVD discs that have corresponding IVP and EVP structures that time the intake and exhaust flows through the combustion chamber in accordance with the rotating crankshaft.

System/Method Variations

The present invention anticipates a wide variety of variations in the rudimentary theme of construction. The examples presented previously do not represent the entire scope of possible usages. They are meant to cite a few of the almost limitless possibilities.

This rudimentary system, method, and product-by-process may be augmented with a variety of ancillary embodiments, including but not limited to:

An embodiment further comprising an intake multi-staged valve (IMV), the IMV comprising:

(a) intake multi-staged valve blade (IMB) (9742);
(b) intake multi-staged valve spring (IMS) (9143);
(c) intake multi-staged valve diaphragm (IMD) (9144);
(d) intake multi-staged valve housing (IMH) (1745); and
(e) intake fixed multi-staged valve port (IMF) (6746);

wherein:

the IMD (9144) is coupled to the IMB (9742) via the IMS (9143);

the IMH (1745) comprises an intake interior housing void (IHV);

the IMD (9144) is configured to conform to the IHV;

the IMF (6746) comprises a void within the IUH (1747) extending across the IUH (1747) FIP and configured to allow insertion of the IMB (9742) into the IMF (6746) so as to modulate a cross sectional area of the IUH (1747) FIP; and the IMB (9742) is configured to engage the IMF (6746) and dynamically modulate the cross sectional area of the IUH (1747) FIP.

An embodiment further comprising an exhaust multi-staged valve (EMV), the EMV comprising:

(a) exhaust multi-staged valve blade (EMB) (9972);
(b) exhaust multi-staged valve spring (EMS) (9173);
(c) exhaust multi-staged valve diaphragm (EMD) (9174);
(d) exhaust multi-staged valve housing (EMH) (1775); and
(e) exhaust fixed multi-staged valve port (EMF) (13176);

wherein:

the EMD (9174) is coupled to the EMB (9972) via the EMS (9173);

the EMH (1775) comprises an exhaust interior housing void (EHV);

the EMD (9174) is configured to conform to the EHV;

the EMF (13176) comprises a void within the EUH (1777) extending across the EUH (1777) FEP and configured to allow insertion of the EMB (9972) into the EMF (13176) so as to modulate a cross sectional area of the EUH (1777) FEP; and the EMB (9972) is configured to engage the EMF (13176) and dynamically modulate a flow control aperture within the cross sectional area of the EUH (1777) FEP.

An embodiment further comprising intake sealing (ISP) wherein the ISP comprises:

(a) grooves and ridges Intake (IGR) (10781) and Exhaust (EGR) (10686); and (b) seals and rings Intake (ISR) (24182) and Exhaust (ESR) (ND);

wherein:

the IGR (10781) is configured on the IUH FIP; and the ISR (24182) is configured on the IUH (1747), the ILC (1748), and the IVD (1762).

An embodiment further comprising further comprising exhaust sealing (ESP) wherein the ESP comprises:

(a) grooves and ridges (EGR) (10686); and (b) seals and rings (ESR) (ND);

wherein:

the EGR (10686) is configured on the EUH (1777) FEP; and the ESR (ND) is configured on the EUH (1777), the ELC (1778), and the EVD (1768).

An embodiment wherein the IVP (1761) and the EVP (1769) are configured anti-symmetrically along the LRA.

An embodiment wherein:

the IVP (1761) is configured to allow air intake into the IUH (1747) once per revolution of the CRK (1765); and the EVP (1769) is configured to allow exhaust out of the EUH (1777) once per revolution of the CRK (1765).

An embodiment further comprising a piston (RPI) (2563) coupled to a piston connecting rod (RPR) (2567) that is coupled to the CRK (1765).

An embodiment further comprising a direct fuel injector (DFI) (1716) coupled to the UBS (1749) and penetrating a combustion chamber (CCH) (2964) void formed by the UBS (1749).

An embodiment further comprising a spark plug (SPK) (N/D) coupled to the UBS (1749) and penetrating a combustion chamber (CCH) (2964) void formed by the UBS (1749).

An embodiment further comprising an intake centrifugal advance plate (IAP);

wherein:

the IAP is configured to articulate about the LRA;

the IAP comprises a plurality of advance counter weights (IAW);

the IAP comprises a corresponding plurality of centrifugal advance springs (IAS) for each of the CAW;

the plurality of IAN are each individually coupled to the IAP via each of the corresponding plurality of the IAS;

the plurality of IAN are each rotationally coupled to the IVD via a pivot on the IVD; and the IAP comprises an annular sector void configured to control intake air flow from the IEC (1708) FIP through the IUH (1747) FIP through the UBS (1749) FIP based on the state of the plurality of the IAN and the plurality of the IAN as the IAP articulates around the LRA.

An embodiment further comprising an exhaust centrifugal advance plate (EAP);

wherein:

the EAP is configured to articulate about the LRA;

the EAP comprises a plurality of advance counter weights (EAW);

the EAP comprises a corresponding plurality of centrifugal advance springs (EAS) for each of the EAW;

the plurality of EAW are each individually coupled to the EAP via each of the corresponding plurality of the EAS;

the plurality of EAW are each rotationally coupled to the EVD via a pivot on the EVD; and the EAP comprises an annular sector void configured to control exhaust flow from the EEC (1709) FEP through the EUH (1747) FEP through the UBS (1749) FEP based on the state of the plurality of the EAW and the plurality of the EAW as the EAP articulates around the LRA.

One skilled in the art will recognize that other embodiments are possible and hereby anticipated by the present invention based on combinations of elements taught within the above invention description.

CONCLUSION

A valve system/method suitable for an internal combustion engine (ICE), compressor pump, vacuum pump, and/or reciprocating mechanical device has been disclosed. The system/method is optimized for construction of a two-stroke ICE. The rudimentary system incorporates an intake engine block cover (IEC) and exhaust engine block cover (EEC) that enclose an intake rotary valve disc (IVD) and exhaust rotary valve disc (EVD) that control intake/exhaust flow through a respective intake rotary valve port (IVP) and an exhaust rotary valve port (EVP) into and out of a combustion cylinder that provides power to a piston and crankshaft. An intake multi-staged valve (IMV) and exhaust multi-staged valve (EMV) provide intake and exhaust flow control for the IVD/IVP and EVD/EVP. An enhanced system may include a variety of intake/exhaust port seals (IPS/EPS), forced induction (FIN), centrifugal advance (CAD), and/or cooling channel spool (ICS/ECS).

CLAIMS INTERPRETATION

The following rules apply when interpreting the CLAIMS of the present invention:

The CLAIM PREAMBLE should be considered as limiting the scope of the claimed invention.

"WHEREIN" clauses should be considered as limiting the scope of the claimed invention.

"WHEREBY" clauses should be considered as limiting the scope of the claimed invention.

"ADAPTED TO" clauses should be considered as limiting the scope of the claimed invention.

"ADAPTED FOR" clauses should be considered as limiting the scope of the claimed invention.

The term "MEANS" specifically invokes the means-plus-function claims limitation recited in 35 U.S.C. § 112(f) and such claim shall be construed to cover the corresponding structure, material, or acts described in the specification and equivalents thereof.

The phrase "MEANS FOR" specifically invokes the means-plus-function claims limitation recited in 35 U.S.C. § 112(f) and such claim shall be construed to cover the corresponding structure, material, or acts described in the specification and equivalents thereof.

The phrase "STEP FOR" specifically invokes the step-plus-function claims limitation recited in 35 U.S.C. § 112(f) and such claim shall be construed to cover the corresponding structure, material, or acts described in the specification and equivalents thereof.

The step-plus-function claims limitation recited in 35 U.S.C. § 112(f) shall be construed to cover the corresponding structure, material, or acts described in the specification and equivalents thereof ONLY for such claims including the phrases "MEANS FOR", "MEANS", or "STEP FOR".

The phrase "AND/OR" in the context of an expression "X and/or Y" should be interpreted to define the set of "(X and Y)" in union with the set "(X or Y)" as interpreted by Ex Parte Gross (USPTO Patent Trial and Appeal Board, Appeal 2011-004811, Ser. No. 11/565,411, ("'and/or' covers embodiments having element A alone, B alone, or elements A and B taken together").

The claims presented herein are to be interpreted in light of the specification and drawings presented herein with sufficiently narrow scope such as to not preempt any abstract idea.

The claims presented herein are to be interpreted in light of the specification and drawings presented herein with sufficiently narrow scope such as to not preclude every application of any idea.

The claims presented herein are to be interpreted in light of the specification and drawings presented herein with sufficiently narrow scope such as to preclude any basic mental process that could be performed entirely in the human mind.

The claims presented herein are to be interpreted in light of the specification and drawings presented herein with sufficiently narrow scope such as to preclude any process that could be performed entirely by human manual effort.

What is claimed is:

1. A valve system comprising:

(a) intake engine block cover (IEC) (1708);

(b) intake rotary valve disc (IVD) (1762);

(c) intake upper engine block head (IUH) (1747);

(d) intake lower engine block crankcase (ILC) (1748);

(e) upper engine block center section (UBS) (1749);

(f) crankshaft (CRK) (1765);

(g) exhaust upper engine block head (EUH) (1777);

(h) exhaust lower engine block crankcase (ELC) (1778);

(i) lower engine block center section (LBS) (1779);

(j) exhaust rotary valve disc (EVD) (1768); and (k) exhaust engine block cover (EEC) (1709);

wherein:

said CRK (1765) comprises a longitudinal rotation axis (LRA);

said IVD (1762) is coupled to said CRK (1765) and concentric with said LRA;

said EVD (1768) is coupled to said CRK (1765) and concentric with said LRA;

said IEC (1708), said IUH (1747), and said UBS (1749) each comprise a fixed intake port (FIP) (1741);

said FIP comprises an annular sector void;

said EEC (1709), said (EUH) (1777), and said (UBS) (1749) each comprise a fixed exhaust port (FEP) (1771);

said FEP comprises an annular sector void;

said IVD (1762) comprises an intake rotary valve port (IVP) (1761);

said IVP (1761) comprises an intake annular sector void (ISV) configured to control intake air flow from said IEC (1708) FIP through said IUH (1747) FIP through said UBS (1749) FIP as said IVD (1762) rotates;

said EVD (1768) comprises an exhaust rotary valve port (EVP) (1769); and said EVP (1769) comprises an exhaust annular sector void (ESV) configured to control exhaust gas flow from said UBS (1749) FEP through said EUH (1777) FEP through said EEC (1709) FEP as said EVD (1768) rotates.

2. The valve system of claim 1 further comprising an intake multi-staged valve (IMV), said IMV comprising:

(a) intake multi-staged valve blade (IMB) (9742);

(b) intake multi-staged valve spring (IMS) (9143);

(c) intake multi-staged valve diaphragm (IMD) (9144);

(d) intake multi-staged valve housing (IMH) (1745); and (e) intake fixed multi-staged valve port (IMF) (6746);

wherein:

said IMD (9144) is coupled to said IMB (9742) via said IMS (9143);

said IMH (1745) comprises an intake interior housing void (IHV);

said IMD (9144) is configured to conform to said IHV;

said IMF (6746) comprises a void within said IUH (1747) extending across said IUH (1747) FIP and configured to allow insertion of said IMB (9742) into said IMF (6746) so as to modulate a cross sectional area of said IUH (1747) FIP; and said IMB (9742) is configured to engage said IMF (6746) and dynamically modulate said cross sectional area of said IUH (1747) FIP.

3. The valve system of claim 1 further comprising an exhaust multi-staged valve (EMV), said EMV comprising:

(a) exhaust multi-staged valve blade (EMB) (9972);

(b) exhaust multi-staged valve spring (EMS) (9173);

(c) exhaust multi-staged valve diaphragm (EMD) (9174);

(d) exhaust multi-staged valve housing (EMH) (1775); and (e) exhaust fixed multi-staged valve port (EMF) (13176);

wherein:

said EMD (9174) is coupled to said EMB (9972) via said EMS (9173);

said EMH (1775) comprises an exhaust interior housing void (EHV);

said EMD (9174) is configured to conform to said EHV;

said EMF (13176) comprises a void within said EUH (1777) extending across said EUH (1777) FEP and configured to allow insertion of said EMB (9972) into said EMF (13176) so as to modulate a cross sectional area of said EUH (1777) FEP; and said EMB (9972) is configured to engage said EMF (13176) and dynamically modulate a flow control aperture within said cross sectional area of said EUH (1777) FEP.

4. The valve system of claim 1 further comprising intake sealing (ISP) wherein said ISP comprises:

(a) grooves and ridges (IGR) (10781); and (b) seals and rings (ISR) (24182);

wherein:

said IGR (10781) is configured on said IUH FIP; and said ISR (24182) is configured on said IUH (1747), said ILC (1748), and said IVD (1762).

5. The valve system of claim 1 further comprising exhaust sealing (ESP) wherein said ESP comprises:

(a) grooves and ridges (EGR) (10686); and (b) seals and rings (ESR) (ND);

wherein:

said EGR (10686) is configured on said EUH (1777) FEP; and said ESR (ND) is configured on said EUH (1777), said ELC (1778), and said EVD (1768).

6. The valve system of claim 1 wherein said IVP (1761) and said EVP (1769) are configured anti-symmetrically along said LRA.

7. The valve system of claim 1 wherein:

said IVP (1761) is configured to allow air intake into said IUH (1747) once per revolution of said CRK (1765); and said EVP (1769) is configured to allow exhaust out of said EUH (1777) once per revolution of said CRK (1765).

8. The valve system of claim 1 further comprising a piston (RPI) (2563) coupled to a piston connecting rod (RPR) (2567) that is coupled to said CRK (1765).

9. The valve system of claim 1 further comprising a direct fuel injector (DFI) (ND) coupled to said UBS (1749) and penetrating a combustion chamber (CCH) (2964) void formed by said UBS (1749).

10. The valve system of claim 1 further comprising a spark plug (SPK) (ND) coupled to said UBS (1749) and penetrating a combustion chamber (CCH) (2964) void formed by said UBS (1749).

11. A valve system comprising:

(a) intake engine block cover (IEC) (1708);

(b) intake rotary valve disc (IVD) (1762);

(c) intake upper engine block head (IUH) (1747);

(d) intake lower engine block crankcase (ILC) (1748);

(e) upper engine block center section (UBS) (1749);

(f) crankshaft (CRK) (1765);

(g) exhaust upper engine block head (EUH) (1777);

(h) exhaust lower engine block crankcase (ELC) (1778);

(i) lower engine block center section (LBS) (1779);

(j) exhaust rotary valve disc (EVD) (1768); and (k) exhaust engine block cover (EEC) (1709);

(l) intake forced induction (IFI) (4920); and (m) exhaust forced discharge (EFI) (4930);

wherein:

said CRK (1765) comprises a longitudinal rotation axis (LRA);

said IVD (1762) is coupled to said CRK (1765) and concentric with said LRA;

said EVD (1768) is coupled to said CRK (1765) and concentric with said LRA;

said IEC (1708), said IUH (1747), and said UBS (1749) each comprise a fixed intake port (FIP) (1741);

said FIP comprises an annular sector void;

said EEC (1709), said (EUH) (1777), and said (UBS) (1749) each comprise a fixed exhaust port (FEP) (1771);

said FEP comprises an annular sector void;

said IVD (1762) comprises an intake rotary valve port (IVP) (1761);

said IVP (1761) comprises an intake annular sector void (ISV) configured to control intake air flow from said IEC (1708) FIP through said IUH (1747) FIP through said UBS (1749) FIP as said IVD (1762) rotates;

said EVD (1768) comprises an exhaust rotary valve port (EVP) (1769); and said EVP (1769) comprises an exhaust annular sector void (ESV) configured to control exhaust gas flow from said UBS (1749) FEP through said EUH (1777) FEP through said EEC (1709) FEP as said EVD (1768) rotates;

said IFI (4920) comprises an intake cooling water jacket (IWJ) enclosing an intake centrifugal impeller (CIP), intake spiral impeller (ISI), and intake spiral channel (IPC);

said CIP is coupled to said CRK (1765) along said LRA;

said ISI is coupled to said CRK (1765) along said LRA;

said IFI (4920) is configured to transfer and compress air from said IEC (1708) FIP to said IUH (1747) FIP;

said EFI (4930) comprises an exhaust cooling water jacket (EWJ) enclosing an exhaust spiral impeller (ESI), and exhaust spiral channel (ESC);

said ESI is coupled to said CRK (1765) along said LRA; and said EFI (4930) is configured to transfer exhaust from said EEC (1708) FEP to said EUH (1747) FEP.

12. The valve system of claim 11 further comprising an intake multi-staged valve (IMV), said IMV comprising:

(a) intake multi-staged valve blade (IMB) (9742);

(b) intake multi-staged valve spring (IMS) (9143);

(c) intake multi-staged valve diaphragm (IMD) (9144);

(d) intake multi-staged valve housing (IMH) (1745); and (e) intake fixed multi-staged valve port (IMF) (6746);

wherein:

said IMD (9144) is coupled to said IMB (9742) via said IMS (9143);

said IMH (1745) comprises an intake interior housing void (IHV);

said IMD (9144) is configured to conform to said IHV;

said IMF (6746) comprises a void within said IUH (1747) extending across said IUH (1747) FIP and configured to allow insertion of said IMB (9742) into said IMF (6746) so as to modulate a cross sectional area of said IUH (1747) FIP; and said IMB (9742) is configured to engage said IMF (6746) and dynamically modulate said cross sectional area of said IUH (1747) FIP.

13. The valve system of claim 11 further comprising an exhaust multi-staged valve (EMV), said EMV comprising:

(a) exhaust multi-staged valve blade (EMB) (9972);

(b) exhaust multi-staged valve spring (EMS) (9173);

(c) exhaust multi-staged valve diaphragm (EMD) (9174);

(d) exhaust multi-staged valve housing (EMH) (1775); and (e) exhaust fixed multi-staged valve port (EMF) (13176);

wherein:

said EMD (9174) is coupled to said EMB (9972) via said EMS (9173);

said EMH (1775) comprises an exhaust interior housing void (EHV);

said EMD (9174) is configured to conform to said EHV;

said EMF (13176) comprises a void within said EUH (1777) extending across said EUH (1777) FEP and configured to allow insertion of said EMB (9972) into said EMF (13176) so as to modulate a cross sectional area of said EUH (1777) FEP; and said EMB (9972) is configured to engage said EMF (13176) and dynamically modulate a flow control aperture within said cross sectional area of said EUH (1777) FEP.

14. The valve system of claim 11 further comprising intake sealing (ISP) wherein said ISP comprises:

(a) grooves and ridges (IGR) (10781); and (b) seals and rings (ISR) (24182);

wherein:

said IGR (10781) is configured on said IUH FIP; and said ISR (24182) is configured on said IUH (1747), said ILC (1748), and said IVD (1762).

15. The valve system of claim 11 further comprising exhaust sealing (ESP) wherein said ESP comprises:

(a) grooves and ridges (EGR) (10686); and (b) seals and rings (ESR) (ND);

wherein:

said EGR (10686) is configured on said EUH (1777) FEP; and said ESR (ND) is configured on said EUH (1777), said ELC (1778), and said EVD (1768).

16. The valve system of claim 11 wherein said IVP (1761) and said EVP (1769) are configured anti-symmetrically along said LRA.

17. The valve system of claim 11 wherein:

said IVP (1761) is configured to allow air intake into said IUH (1747) once per revolution of said CRK (1765); and said EVP (1769) is configured to allow exhaust out of said EUH (1777) once per revolution of said CRK (1765).

18. The valve system of claim 11 further comprising a piston (RPI) (2563) coupled to a piston connecting rod (RPR) (2567) that is coupled to said CRK (1765).

19. The valve system of claim 11 further comprising a direct fuel injector (DFI) (ND) coupled to said UBS (1749) and penetrating a combustion chamber (CCH) (2964) void formed by said UBS (1749).

20. The valve system of claim 11 further comprising a spark plug (SPK) (ND) coupled to said UBS (1749) and penetrating a combustion chamber (CCH) (2964) void formed by said UBS (1749).

21. The valve system of claim 11 further comprising an intake centrifugal advance plate (IAP);

wherein:

said IAP is configured to articulate about said LRA;

said IAP comprises a plurality of advance counter weights (IAW);

said IAP comprises a corresponding plurality of centrifugal advance springs (IAS) for each of said IAW;

said plurality of IAN are each individually coupled to said IAP via each of said corresponding plurality of said IAS;

said plurality of IAN are each rotationally coupled to said IVD via a pivot on said IVD; and said IAP comprises an annular sector void configured to control intake air flow from said IEC (1708) FIP through said IUH (1747) FIP through said UBS (1749) FIP based on the state of said plurality of said IAN and said plurality of said IAN as said IAP articulates around said LRA.

22. The valve system of claim 11 further comprising an exhaust centrifugal advance plate (EAP);

wherein:

said EAP is configured to articulate about said LRA;

said EAP comprises a plurality of advance counter weights (EAW);

said EAP comprises a corresponding plurality of centrifugal advance springs (EAS) for each of said EAW;

said plurality of EAW are each individually coupled to said EAP via each of said corresponding plurality of said EAS;

said plurality of EAW are each rotationally coupled to said EVD via a pivot on said EVD; and said EAP comprises an annular sector void configured to control exhaust flow from said EEC (1709) FEP through said EUH (1747) FEP through said UBS (1749) FEP based on the state of said plurality of said EAW and said plurality of said EAW as said EAP articulates around said LRA.

23. A valve method operating on a valve system, said system comprising:

(a) intake engine block cover (IEC) (1708);

(b) intake rotary valve disc (IVD) (1762);

(c) intake upper engine block head (IUH) (1747);

(d) intake lower engine block crankcase (ILC) (1748);

(e) upper engine block center section (UBS) (1749);

(f) crankshaft (CRK) (1765);

(g) exhaust upper engine block head (EUH) (1777);

(h) exhaust lower engine block crankcase (ELC) (1778);

(i) lower engine block center section (LBS) (1779);

(j) exhaust rotary valve disc (EVD) (1768); and (k) exhaust engine block cover (EEC) (1709);

wherein:

said CRK (1765) comprises a longitudinal rotation axis (LRA);

said IVD (1762) is coupled to said CRK (1765) and concentric with said LRA;

said EVD (1768) is coupled to said CRK (1765) and concentric with said LRA;

said IEC (1708), said IUH (1747), and said UBS (1749) each comprise a fixed intake port (FIP) (1741);

said FIP comprises an annular sector void;

said EEC (1709), said (EUH) (1777), and said (UBS) (1749) each comprise a fixed exhaust port (FEP) (1771);

said FEP comprises an annular sector void;

said IVD (1762) comprises an intake rotary valve port (IVP) (1761);

said IVP (1761) comprises an intake annular sector void (ISV) configured to control intake air flow from said IEC (1708) FIP through said IUH (1747) FIP through said UBS (1749) FIP as said IVD (1762) rotates;

said EVD (1768) comprises an exhaust rotary valve port (EVP) (1769); and said EVP (1769) comprises an exhaust annular sector void (ESV) configured to control exhaust gas flow from said UBS (1749) FEP through said EUH (1777) FEP through said EEC (1709) FEP as said EVD (1768) rotates;

said method comprising the steps of:

(1) rotating said CRK (1765) around said LRA to position said ISV over said IEC (1708) FIP so as to allow air and/or fuel to pass from said IEC (1708) through said IUH (1747) FIP through said UBS (1749);

(2) rotating said CRK (1765) around said LRA to compress and ignite an air/fuel mixture within said UBS (1749);

(3) rotating said CRK (1765) around said LRA to expel exhaust gasses from said UBS (1749) FEP through said EUH (1777) FEP through said EEC (1709) FEP;

(4) rotating said CRK (1765) around said LRA to expel exhaust gasses from said UBS (1749) and intake an air and/or fuel mixture into said UBS (1749); and (5) proceeding to step (1);

wherein:

said method operates on said CRK (1765) as a two-stroke power cycle.

* * * * *